US011427871B2

(12) United States Patent
Hahn et al.

(10) Patent No.: US 11,427,871 B2
(45) Date of Patent: Aug. 30, 2022

(54) METHODS, TREATMENT, AND COMPOSITIONS FOR CHARACTERIZING THYROID NODULE

(71) Applicant: City of Hope, Duarte, CA (US)

(72) Inventors: Maria A. Hahn, Duarte, CA (US); John H. Yim, San Marino, CA (US); Yuman Fong, Duarte, CA (US); Arthur X. Li, Covina, CA (US); Xiwei Wu, Diamond Bar, CA (US)

(73) Assignee: City of Hope, Duarte, CA (US)

( * ) Notice: Subject to any disclaimer, the term of this patent is extended or adjusted under 35 U.S.C. 154(b) by 271 days.

(21) Appl. No.: 15/217,645

(22) Filed: Jul. 22, 2016

(65) Prior Publication Data

US 2017/0022570 A1 Jan. 26, 2017

Related U.S. Application Data

(60) Provisional application No. 62/196,678, filed on Jul. 24, 2015.

(51) Int. Cl.
*C12Q 1/6886* (2018.01)

(52) U.S. Cl.
CPC ..... *C12Q 1/6886* (2013.01); *C12Q 2600/118* (2013.01); *C12Q 2600/154* (2013.01)

(58) Field of Classification Search
None
See application file for complete search history.

(56) References Cited

PUBLICATIONS

Kroese et al. (Genetics in Medicine, vol. 6 (2004), p. 475-480).*
Cottrell (Clin. Biochem. 37(2004) 595-604).*
Ionnidis (Plost Med, 2005, 2(8):e124).*
Ellis (J Clin Endocrinol Metab 99: E329-E337, 2014).*
Human hg19 ch16:23135831-23135833 UCSC Genome Browser v366, available genome.ucsc.edu, printed 6/18, pp. 1-3.*
Hansen (Nature Genetics, 2011, vol. 43, pp. 768-777).*
Gu (Nature Methods, Feb. 2010, vol. 7, pp. 133-138).*
Dean, D.S. et al. (2008) "Epidemiology of thyroid nodules," *Best Pract Res Clin Endocrinol Metab* 22(6):901-911.
Kent, W.J. et al. (2002) "The human genome browser at UCSC," *Genome Res* 12(6):996-1006.

* cited by examiner

*Primary Examiner* — Sarae L Bausch
(74) *Attorney, Agent, or Firm* — Mintz, Levin, Cohn, Ferris, Glovsky and Popeo, P.C.

(57) ABSTRACT

The current disclosure provides, inter alia, method of determining benign nodules from thyroid cancer in a subject that is found to have a thyroid nodule, method of treating thyroid cancer in a subject detected to have thyroid cancer by the method of the current disclosure, compositions for determining benign nodules from thyroid cancer in a subject, and kits including reagents and composition for determining benign nodules from thyroid cancer in a subject.

8 Claims, 7 Drawing Sheets

Specification includes a Sequence Listing.

METHODS, TREATMENT, AND COMPOSITIONS FOR CHARACTERIZING THYROID NODULE

RELATED APPLICATION

This application claims the benefit of priority under 35 U.S.C. § 119(e) to U.S. Provisional Application No. 62/196,678, filed Jul. 24, 2015, the content of which is incorporated herein by reference in its entirety.

INCORPORATION-BY-REFERENCE OF SEQUENCE LISTING

The content of the text file named "48440-573001 US_ST25.TXT", which was created on Jul. 22, 2016, and is 328.827 bytes in size, is hereby incorporated by reference in its entirety.

BACKGROUND OF THE DISCLOSURE

Palpable thyroid nodules are typically detected in 2-6% of the population, and this increases to 19-35% with ultrasound detection (Dean D S and Gharib H. Best Pract Res Clin Endocrinol Metab 2008; 22:901-11). Approximately 5-15% of thyroid nodules are found to be thyroid cancer, making the existence of a nodule clinically relevant. Fine needle aspiration (FNA) with cytology is currently the standard diagnostic procedure used to evaluate thyroid nodules. However, in as many as 30% of cases, the cytological diagnosis is indeterminate because of cytological features that overlap between benign and malignant nodules. For most indeterminate cases half or the entire thyroid is resected, yet as many as 80% of these cases are found to be benign.

Most thyroid nodules do not cause symptoms. Often, thyroid nodules are discovered incidentally during a routine physical examination or on imaging tests like CT scans or neck ultrasound done for completely unrelated reasons. Occasionally, patients themselves find thyroid nodules by noticing a lump in their neck while looking in a mirror, buttoning their collar, or fastening a necklace. Abnormal thyroid function tests may occasionally be the reason a thyroid nodule is found. Thyroid nodules may produce excess amounts of thyroid hormone causing hyperthyroidism. However, most thyroid nodules, including those that cancerous, are actually non-functioning, meaning current diagnostic test readouts such as the level of Thyroid-Stimulating Hormone (TSH) are normal. Rarely, patients with thyroid nodules may complain of pain in the neck, jaw, or ear. If a nodule is large enough to compress the windpipe or esophagus, it may cause difficulty with breathing, swallowing, or cause a "tickle in the throat". Even less commonly, hoarseness can be caused if the nodule invades the nerve that controls the vocal cords but this is usually related to thyroid cancer.

Molecular testing is a potential alternative to cytopathological examination. However, FNA molecular testing based on DNA mutations frequently fails. There are two major reasons for this failure: (i) not all papillary thyroid carcinoma (PTC) specimens are characterized by a common set of cancer associated mutations, and (ii) cancer associated mutations like KRAS are frequently found in benign thyroid nodule (BTN) specimens. At the same time commercial diagnostic tests for FNA based on transcriptional activity and currently implemented in clinical practice is complicated due to RNA instability and associated with only an approximately 50% positive predictive value. Thus, there is an urgent need for highly sensitive, low cost biomarker panels that can accurately diagnose thyroid nodules from FNA biopsies.

BRIEF SUMMARY OF THE DISCLOSURE

The present subject matter provides, inter alia, a method of determining benign nodules from thyroid cancer in a subject that is found to have a thyroid nodule, a method of treating thyroid cancer in a subject detected to have thyroid cancer, compositions for determining benign nodules from thyroid cancer in a subject, and kits including reagents and compositions for determining benign nodules from thyroid cancer in a subject.

In embodiments, aspects of the present subject matter provide a method of detecting methylation or unmethylation of a thyroid nodule DNA of a subject, the method including: (i) isolating DNA from a thyroid nodule of the subject thereby forming isolated thyroid nodule DNA, (ii) contacting the isolated thyroid nodule DNA with a bisulfite salt (such as sodium bisulfite) thereby forming a reacted thyroid nodule DNA, (iii) detecting the presence or absence of uracil in the reacted thyroid nodule DNA at a methylation site set forth in Table 1, thereby detecting methylation or unmethylation of the thyroid nodule DNA of the subject.

Also provided is a method of determining a thyroid cancer or risk of developing thyroid cancer in a subject in need thereof. The method includes isolating DNA from a thyroid nodule of the subject thereby forming isolated thyroid nodule DNA. The isolated thyroid nodule DNA is contacted with sodium bisulfite thereby forming a reacted thyroid nodule DNA. The presence or absence of uracil is detected in the reacted thyroid nodule DNA at a methylation site set forth in Table 1 thereby determining thyroid cancer in the subject.

In embodiments, provided herein is a method of treating thyroid cancer in a subject by administering to the subject an active agent for treating thyroid cancer. The method includes identifying the subject for treatment by a method including isolating DNA from a thyroid nodule of the subject thereby forming isolated thyroid nodule DNA. The isolated thyroid nodule DNA is contacted with sodium bisulfite thereby forming a reacted thyroid nodule DNA. The presence or absence of uracil in the reacted thyroid nodule DNA is detected at a methylation site set forth in Table 1 thereby determining thyroid cancer in the subject.

Also included herein is a deoxyribonucleic acid 5 to 100, 5 to 200, 5 to 300, or at least about 5, 50, 100, 150, 200, 250, 300, or more nucleotides in length including a uracil-containing sequence identical to at least a 5 contiguous nucleotides within a sequence including SEQ ID NO: 1 to SEQ ID NO:550.

In embodiments, provided herein is an oligonucleotide 5 to 100, 5 to 200, 5 to 300, or at least about 5, 50, 100, 150, 200, 250, 300, or more nucleotides in length including identical or complementary to at least 5, 10, 20, 25, 50, 100, 150, 200, 250, or 300 contiguous nucleotides within a sequence including SEQ ID NO: 1 to SEQ ID NO:550.

Aspects of the present subject matter also include a deoxyribonucleic acid including SEQ ID NO: 551 to SEQ ID NO: 782, in which the nucleic acid is hybridized to a complementary DNA sequence having uridine or cytosine.

Also provided is a kit including a plurality (e.g., at least about 10, 20, 40, 50, 100, 150, 200, 225, or 232) nucleic acids each independently comprising SEQ ID NO: 551 to SEQ ID NO: 782, in which the nucleic acids do not simultaneously include the same sequence of SEQ ID NO: 551 to SEQ ID NO: 782.

Aspects of the present subject matter also provide a system for detecting methylation or unmethylation of a thyroid nodule deoxyribonucleic acid (DNA) of a subject. The system can include at least one processor; and at least one memory including program code which when executed by the at least one memory provides operations. The operations can include: isolating DNA from a thyroid nodule of the subject thereby forming isolated thyroid nodule DNA; contacting the isolated thyroid nodule DNA with bisulfite salt thereby forming a reacted thyroid nodule DNA; detecting a presence or absence of uracil in the reacted thyroid nodule DNA at a plurality of methylation sites set forth in Table 1, thereby detecting methylation or unmethylation of the thyroid nodule DNA of the subject; and generating a diagnosis for the subject based at least in part on the presence or absence of uracil in the reacted thyroid nodule DNA at the plurality of methylation sites set forth in Table 1; and providing, via a user interface, the diagnosis for the subject.

BRIEF DESCRIPTION OF THE DRAWINGS

FIG. 1A: Adenoma specific hypomethylation signature. FIG. 1B: Adenoma specific hypermethylation signature.

FIG. 2B: 364 CpG sites associated with benign- and thyroid cancer-specific DNA methylation changes. Each row represents a single cytosine. Each column represents tissue specimen. Dark gray, light gray and black indicate high, low and medium levels of DNA methylation, respectively. Abbreviation "A" is for thyroid benign nodule and "T" is for thyroid cancer.

FIG. 3A: Thyroid cancer diganostics based on benign DNA methylation signature, cancer DNA methylation signature and cancer risk scores. FIG. 3B: DNA methylation signatures for malignant and benign thyroid nodules according to leave one-out-cross-validation technique. Specimens with indeterminate epigenetic signature are underlined. Abbreviation "A" is for thyroid benign nodule and "T" is for thyroid cancer. FIG. 3C: Algorithm for the diagnosis prediction based on BTN. PTC and cancer risk scores.

DETAILED DESCRIPTION OF THE DISCLOSURE

Figure 1A:
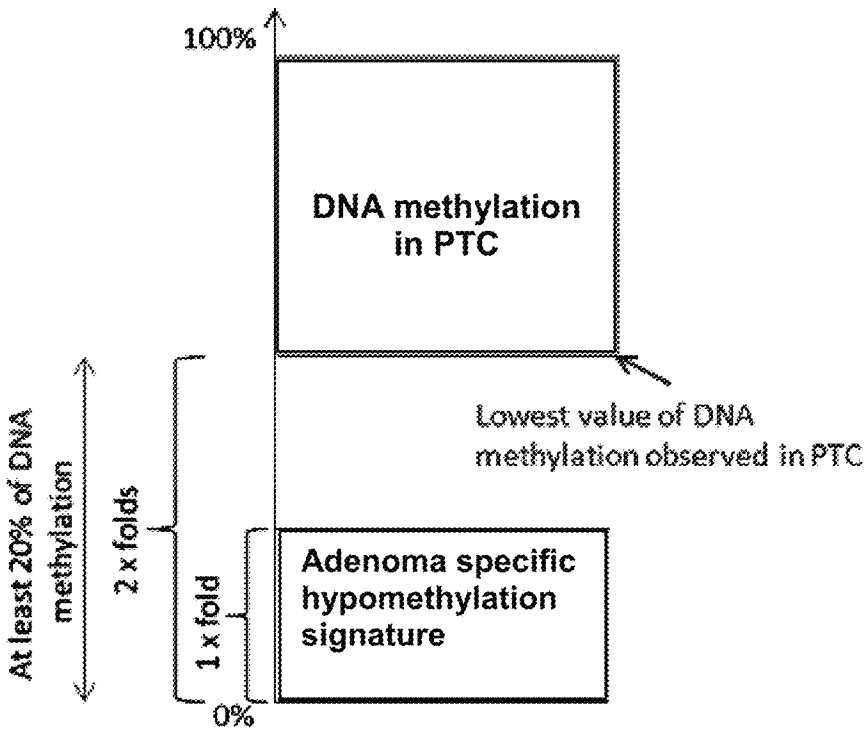
FIGS. 1A-1B show a drawing defining a threshold for thyroid adenoma specific signature for individual cytosine regions.

Provided herein are, inter alia, compositions, methods, kits, and systems for detecting unmethylated DNA. In embodiments, compositions, methods, kits, and systems for detecting unmethylated DNA from thyroid nodule are included herein.

The following definitions are included for the purpose of understanding the present subject matter and for constructing the appended patent claims. Abbreviations used herein have their conventional meaning within the chemical and biological arts.

Definitions

The term "thyroid nodule" is used according to its plain ordinary meaning and refers to an abnormal growth of thyroid cells. The abnormal growth may form, for example, a mass or lump within or on the thyroid gland. The mass or lump may be fluid-filled or solid. The thyroid nodules may be benign (noncancerous) or cancerous.

Thyroid fine needle aspiration biopsy (FNA or FNAB): For a fine needle biopsy, a needle is used to withdraw cells from a thyroid nodule. In embodiments, several samples are taken from different parts of the nodule, e.g., to increase the chance of finding cancerous cells if they are present. In embodiments, a sample is taken from one part of the nodule. In embodiments, examination of the cells under a microscope is not necessary. In non-limiting examples, the needle used for FNA is a 20-35 gauge needle (such as a 23, 24 or 25 gauge needle).

The term "disease" refers to any deviation from the normal health of a mammal and includes a state when disease symptoms are present, as well as conditions in which a deviation (e.g., infection, gene mutation, genetic defect, etc.) has occurred, but symptoms are not yet manifested. According to the present disclosure, the methods disclosed herein are suitable for use in a patient that is a member of the Vertebrate class. Mammalia, including, without limitation, primates, livestock and domestic pets (e.g., a companion animal). Typically, a patient will be a human patient. As used herein, a "symptom" of a disease includes and clinical or laboratory manifestation associated with the disease, and is not limited to what a subject can feel or observe.

The terms "subject," "patient," "individual," and the like as used herein are not intended to be limiting and can be generally interchanged. That is, an individual described as a "patient" does not necessarily have a given disease, but may be merely seeking medical advice.

The term "subject" as used herein includes all members of the animal kingdom that may suffer from the indicated disorder. In some aspects, the subject is a mammal, and in some aspects, the subject is a human.

It must be noted that as used herein and in the appended embodiments, the singular forms "a," "an," and "the" include the plural reference unless the context clearly dictates otherwise. Thus, for example, a reference to "a disease," "a disease state", "a nucleic acid" or "a CpG site" is a reference to one or more such embodiments, and includes equivalents thereof known to those skilled in the art and so forth.

Throughout the description and claims of this specification the word "comprise" and other forms of the word, such as "comprising" and "comprises." means including but not limited to, and is not intended to exclude, for example, other components.

A "control" sample or value refers to a sample that serves as a reference, usually a known reference, for comparison to a test sample. For example, a test sample can be taken from a patient suspected or at risk of having thyroid cancer and compared to samples from a known thyroid cancer patient, or a known normal (non-disease) individual. A control can also represent an average value gathered from a population of similar individuals, e.g., thyroid cancer patients or healthy individuals with a similar medical background, same age, weight, etc. A control value can also be obtained from the same individual, e.g., from an earlier-obtained sample, prior to disease, or prior to treatment. One of skill will recognize that controls can be designed for assessment of any number of parameters.

One of skill in the art will understand which controls are valuable in a given situation and be able to analyze data based on comparisons to control values. Controls are also valuable for determining the significance of data. For example, if values for a given parameter are widely variant in controls, variation in test samples will not be considered as significant.

The term "diagnosis" refers to a relative probability that a disease is present in the subject. Similarly, the term "prognosis" refers to a relative probability that a certain future outcome may occur in the subject. For example, in the context of the present disclosure, prognosis can refer to the likelihood that an individual will develop a disease, or the likely severity of the disease (e.g., severity of symptoms, rate of functional decline, survival, etc.). The terms are not intended to be absolute, as will be appreciated by any one of skill in the field of medical diagnostics.

"Nucleic acid" or "oligonucleotide" or "polynucleotide" or grammatical equivalents used herein means at least two nucleotides covalently linked together. Oligonucleotides are typically from about 5, 6, 7, 8, 9, 10, 12, 15, 25, 30, 40, 50 or more nucleotides in length, up to about 100 nucleotides in length. Nucleic acids, including ribonucleic acids (RNA) and deoxyribonucleic acids (DNA), and polynucleotides are a polymers of any length, including longer lengths. e.g., 200, 300, 500, 1000, 2000, 3000, 5000, 7000, 10,000, etc. A nucleic acid of the present invention will generally contain phosphodiester bonds, although in some cases, nucleic acid analogs are included that may have alternate backbones, comprising, e.g., phosphoramidate, phosphorothioate, phosphorodithioate, or O-methylphophoroamidite linkages (see Eckstein, Oligonucleotides and Analogues: A Practical Approach, Oxford University Press); and peptide nucleic acid backbones and linkages. Other analog nucleic acids include those with positive backbones; non-ionic backbones, and non-ribose backbones, including those described in U.S. Pat. Nos. 5,235,033 and 5,034,506, and Chapters 6 and 7, ASC Symposium Series 580. *Carbohydrate Modifications in Antisense Research*, Sanghui & Cook, eds. Nucleic acids containing one or more carbocyclic sugars are also included within one definition of nucleic acids. Modifications of the ribose-phosphate backbone may be done for a variety of reasons, e.g., to increase the stability and half-life of such molecules in physiological environments or as probes on a biochip. Mixtures of naturally occurring nucleic acids and analogs can be made; alternatively, mixtures of different nucleic acid analogs, and mixtures of naturally occurring nucleic acids and analogs may be made.

The term "bp" and the like refer, in the usual and customary sense, to the indicated number of base pairs.

The terms "identical" or percent "identity," in the context of two or more nucleic acids (e.g., genomic sequences or subsequences or coding sequences) or polypeptide sequences, refer to two or more sequences or subsequences that are the same or have a specified percentage of amino acid residues or nucleotides that are the same (i.e., 50%, 55%, 60%, 65%, 70%, 75%, 80%, 85%, 90%, 91%, 92%, 93%, 94%, 95%, 96%, 97%, 98%, 99%, or more identity over a specified region), when compared and aligned for maximum correspondence over a comparison window, or designated region as measured using one of the following sequence comparison algorithms or by manual alignment and visual inspection. Such sequences are then said to be "substantially identical." This definition also refers to the compliment of a test sequence. Optionally, the identity exists over a region that is at least about 10 to about 100, about 20 to about 75, about 30 to about 50 amino acids or nucleotides in length.

An example of algorithms suitable for determining percent sequence identity and sequence similarity are the BLAST and BLAST 2.0 algorithms, which are described in Altschul et al., *Nuc. Acids Res.* 25:3389-3402 (1977) and Altschul et al., *J. Mol. Biol.* 215:403-410 (1990), respectively. As will be appreciated by one of skill in the art, the software for performing BLAST analyses is publicly available through the website of the National Center for Biotechnology Information.

A "label" or a "detectable moiety" is a composition detectable by spectroscopic, photochemical, biochemical, immunochemical, chemical, or other physical means. For example, useful labels include $^{32}P$, fluorescent dyes, electron-dense reagents, enzymes (e.g., as commonly used in an ELISA), biotin, digoxigenin, or haptens and proteins or other entities which can be made detectable, e.g., by incorporating a radiolabel into a peptide or antibody specifically reactive with a target peptide. Any method known in the art for conjugating an antibody to the label may be employed, e.g., using methods described in Hermanson, Bioconjugate Techniques 1996, Academic Press, Inc., San Diego.

The term "associated" or "associated with" in the context of a substance (e.g., level of uracil or methylation level in a thyroid nodule) does not necessarily mean that the disease is caused by (in whole or in part), or a symptom of the disease is caused by (in whole or in part) the substance or substance activity or function (i.e., level of uracil in the regions of chromosomes assayed).

The term "unmethylated DNA" or "demethylated DNA" means DNA that lacks a methyl group conjugated to cytosine in a segment of the DNA. DNA methylation typically occurs in a CpG dinucleotide context. DNA methylation at the 5' position of cytosine may have the specific effect on gene expression in vivo. DNA methylation may also form the basis of epigenetic structure, which typically enables a single cell to grow into multiple organs or perform multiple functions.

The CpG sites or CG sites are regions of DNA where a cytosine nucleotide occurs next to a guanine nucleotide in the linear sequence of bases along its length. "CpG" is shorthand for "-C-phosphate-G-", that is, cytosine and guanine separated by only one phosphate; phosphate links any two nucleosides together in DNA. The "CpG" notation is used to distinguish this linear sequence from the CG base-pairing of cytosine and guanine. The CpG notation can also be interpreted as the cytosine being 5' prime to the guanine base.

In embodiments, methylation is detected based on a chemical reaction of sodium bisulfite with DNA that converts unmethylated cytosines of CpG dinucleotides to uracil or UpG. However, methylated cytosine is not converted in this process, the methods described herein allow determination of methylation status as methylated or unmethylated.

Evaluation of Thyroid Fine Needle Biopsies by Visual Examination

Cells in a thyroid vine needle biopsy sample may be examined under a microscope by, e.g., a pathologist. The report of a thyroid fine needle biopsy followed by examination under a microscope will usually indicate one of the following findings:

1. The nodule is benign (noncancerous). This result is obtained in up to 80% of biopsies. The risk of overlooking a cancer when the biopsy is benign is generally less than 3 in 100 tests or 3%. This is even lower when the biopsy is reviewed by an experienced pathologist at a major medical center. Generally, benign thyroid nodules do not need to be removed unless they are causing symptoms like choking or difficulty swallowing. Follow up ultrasound exams are important. Occasionally, another biopsy may be required in the future, especially if the nodule grows over time.

2. The nodule is malignant (cancerous) or suspicious for malignancy. A malignant result is obtained in about 5% of biopsies and is most often due to papillary cancer, which is the most common type of thyroid cancer. A malignant diagnosis has a >99% risk of cancer in the nodule. A suspicious biopsy has a 50-75% risk of cancer in the nodule. These diagnoses require surgical removal of the thyroid after consultation with the endocrinologist and surgeon.

3. The nodule is indeterminate. This is actually a group of several diagnoses that may occur in up to 30% of cases. An indeterminate finding means that even though an adequate number of cells was removed during the fine needle biopsy, examination with a microscope cannot reliably classify the result as benign or cancer. The biopsy may be indeterminate because the nodule is described as a Follicular Lesion. These nodules are cancerous 20-30% of the time. However, under the current state of the art, the diagnosis can only be made by surgery. Because the odds that the nodule is not a cancer are much better by surgery (70-80%), only the side of the thyroid with the nodule is usually removed. If a cancer is found, the remaining thyroid gland is usually removed as well. If the surgery confirms that no cancer is present, no additional surgery to "complete" the thyroidectomy is necessary.

The biopsy may also be indeterminate because the cells from the nodule have features that cannot be placed in one of the other diagnostic categories. This diagnosis is called atypia, or a follicular lesion of undetermined significance. Diagnoses in this category will contain cancer rarely, so repeat evaluation with FNA or surgical biopsy to remove half of the thyroid containing the nodule is usually recommended.

4. The biopsy may also be non-diagnostic or inadequate. This result indicates that not enough cells were obtained to make a diagnosis but is a common result if the nodule is a cyst. These nodules may require reevaluation with second fine needle biopsy, or may need to be removed surgically depending on the clinical judgment of the doctor.

Methods, compositions, kits, and systems provided herein provide significant advantages over the visual examination of biopsies.

Method of Detection Methylation Status of a Thyroid Nodule DNA

In an aspect, provided herein is a method of detecting methylation or unmethylation of a thyroid nodule DNA of a subject. The method includes: (i) isolating a thyroid nodule DNA molecule from a thyroid nodule of the subject thereby forming an isolated thyroid nodule DNA molecule, (ii) contacting the isolated thyroid nodule DNA molecule with a bisulfite salt (such as sodium bisulfite) thereby forming a reacted thyroid nodule DNA molecule, (iii) detecting the presence or absence of uracil in the reacted thyroid nodule DNA molecule at a methylation site set forth in Table 1, thereby detecting methylation or unmethylation of the thyroid nodule DNA molecule of the subject. In embodiments, contacting the isolated thyroid nodule DNA with a bisulfite salt comprises adding a solution comprising the bisulfite salt to a solution comprising the isolated single stranded DNA.

In an aspect, provided herein is a method of detecting methylation or unmethylation of a thyroid nodule DNA molecule of a subject comprising (i) isolating a plurality of thyroid nodule DNA molecules from the thyroid nodule of the subject thereby forming a plurality of isolated thyroid nodule DNA molecules, (ii) contacting the plurality of isolated thyroid nodule DNA molecules with the bisulfite salt thereby forming a plurality of reacted thyroid nodule DNA molecules, (iii) detecting the level of reacted thyroid nodule DNA molecules in the plurality of reacted thyroid nodule DNA molecules having a uracil at a methylation site set forth in Table 1, thereby detecting the level of methylation or unmethylation in the plurality of thyroid nodule DNA molecules of the subject.

In an aspect, provided herein is a method of detecting methylation or unmethylation of a thyroid nodule DNA molecule of a subject comprising (i) isolating a plurality of thyroid nodule DNA molecules from the thyroid nodule of the subject thereby forming a plurality of isolated thyroid nodule DNA molecules, (ii) contacting the plurality of isolated thyroid nodule DNA molecules with the bisulfite salt thereby forming a plurality of reacted thyroid nodule DNA molecules, (iii) detecting the presence or absence of uracil in a reacted thyroid nodule DNA molecule at a methylation site set forth in Table 1, thereby detecting methylation or unmethylation of the thyroid nodule DNA molecule of the subject.

In an aspect, provided herein is a method of detecting methylation or unmethylation of a thyroid nodule DNA of a subject. The method includes: (i) isolating a thyroid nodule DNA molecule from a thyroid nodule of the subject thereby forming an isolated thyroid nodule DNA molecule, (ii) contacting the isolated thyroid nodule DNA molecule with a bisulfite salt (such as sodium bisulfite) thereby forming a reacted thyroid nodule DNA molecule, (iii) amplifying the reacted thyroid nodule DNA molecule thereby forming a reacted thyroid nodule DNA amplicon molecule, (iv) detecting the presence or absence of thymidine in a reacted thyroid nodule DNA amplicon molecule at a methylation site set forth in Table 1, thereby detecting methylation or unmethylation of the thyroid nodule DNA molecule of the subject. In embodiments, contacting the isolated thyroid nodule DNA with a bisulfite salt comprises adding a solution comprising the bisulfite salt to a solution comprising the isolated single stranded DNA.

In an aspect, provided herein is a method of detecting methylation or unmethylation of a thyroid nodule DNA molecule of a subject comprising (i) isolating a plurality of thyroid nodule DNA molecules from the thyroid nodule of the subject thereby forming a plurality of isolated thyroid nodule DNA molecules, (ii) contacting the plurality of isolated thyroid nodule DNA molecules with the bisulfite salt thereby forming a plurality of reacted thyroid nodule DNA molecules, (iii) amplifying the plurality of reacted thyroid nodule DNA molecules thereby forming a plurality of reacted thyroid nodule DNA amplicon molecules, (iv) detecting one or more thyroid nodule DNA amplicon molecules within the plurality of reacted thyroid nodule DNA amplicon molecules having a thymidine at a methylation site set forth in Table 1, thereby detecting methylation or unmethylation of the thyroid nodule DNA molecule of the subject.

In embodiments, detecting one or more thyroid nodule DNA amplicon molecules comprises detecting the level of one or more one or more thyroid nodule DNA amplicon molecules. In embodiments, detecting one or more thyroid nodule DNA amplicon molecules comprises detecting the level of reacted thyroid nodule DNA amplicon molecules in the plurality of reacted thyroid nodule DNA amplicon molecules having a thymidine at a methylation site set forth in Table 1, thereby detecting the level of methylation or unmethylation in the plurality of thyroid nodule DNA molecules of the subject.

In embodiments, detecting a level includes determining the number (e.g. quantitating) or molecules having, e.g., a thymidine or a uracil. In embodiments, detecting a level includes detecting the portion or proportion of a population or plurality of molecules having, e.g., a thymidine or a uracil.

In embodiments, the isolated thyroid nodule DNA sample is treated with a bisulfite reagent, e.g., a bisulfite salt (i.e., a process called DNA bisulfite conversion). Non-limiting examples of bisulfite salts include sodium bisulfite, potassium bisulfite, ammonium bisulfite, magnesium bisulfite, sodium metabisulfite, potassium metabisulfite, ammonium metabisulfite and magnesium metabisulfite. Bisulfite salts such as sodium bisulfite or ammonium bisulfite can convert cytosine to uracil and leave 5-methylcytosine (5-mC) the same. Thus after bisulfite treatment methylated cytosine in the DNA remains the same and unmodified cytosines will be changed to uracil. The bisulfite treatment can be performed by using the methods disclosed herein or in the art, and/or with commercial kits such as the Bisulflash DNA Modification Kit (Epigentek) and Imprint DNA Modification Kit (Sigma). For achieving the optimal bisulfite conversion, the bisulfite reaction should be carried out in an appropriate concentration of bisulfite reagents, appropriate temperature and appropriate reaction time period. A reagent such as potassium chloride that reduces thermophilic DNA degradation could also be used in bisulfite treatment so that the DNA bisulfite process can be much shorter without interrupting a completed conversion of unmethylated cytosine to uracil and without a significant thermodegradation of DNA resulted from depurination. In embodiments, a commercially available bisulfite treatment kit is used. A non-limiting example of such a kit is EZ DNA Methylation-Gold™ Kit (Zymo Research. Irvine, Calif., USA).

In embodiments, once DNA bisulfite conversion is complete, DNA is captured, desulphonated and washed. In embodiments, the bisulfite-treated DNA can be captured by, e.g., a solid matrix selected from silica salt, silica dioxide, silica polymers, magnetic beads, glass fiber, celite diatoms and nitrocellulose in the presence of high concentrations of chaotropic or non-chaotropic salts. In embodiments, the bisulfite-treated DNA is further desulphonated with an alkalized solution, preferably sodium hydroxide at concentrations from 10 mM to 300 mM. In embodiments, the DNA is then eluted and collected into a capped microcentrifuge tube. Non-limiting examples of elution solutions include DEPC-treated water and TE buffer (10 mM Tris-HCL, pH 8.0, and 1 mM EDTA).

In embodiments, the reacted thyroid nodule DNA resulting from bisulfite treatment is amplified. In embodiments, detecting the presence or absence of uracil in reacted thyroid nodule DNA molecule at a methylation site comprises amplifying the reacted thyroid nodule DNA molecule thereby forming a reacted thyroid nodule DNA amplicon molecule, and detecting the presence or absence of thymidine in a reacted thyroid nodule DNA amplicon molecule at the methylation site. In embodiments, a polymerase chain reaction (PCR) method is used for amplifying the reacted thyroid nodule DNA. PCR methods are known to those of ordinary skill in the art. In general, the PCR reactions can be set up by adding sample, dNTPs, and appropriate polymerase such as Taq polymerase, primers, and a buffer.

In embodiments, the method of detecting methylation or unmethylation of a thyroid nodule DNA of a subject, includes detecting methylation or unmethylation at a plurality of methylation sites set forth in Table 1. In embodiments, the plurality of methylation sites comprises at least about 2, 3, 4, 5, 10, 25, 50, 75, 80, 85, 90, 100, 150, 200, 250, 300, 350, 400, 450, 500, or 550, or 5-550 methylation sites. In embodiments, the plurality of methylation sites comprises less than about 550, 500, 450, 400, 350, 300, 250, 200, 150, 100, 90, 85, 80, 75, 50, 25, or 10 methylation sites. In embodiments, the plurality of methylation sites is about 5, 6, 7, 8, 9, 10, 11, 12, 13, 14, 15, 16, 17, 18, 19, 20, 25, 50.75, 80, 85.90, 100, 150, 200.250, 300.350, 400, 450, 500, or 550, or 5-550 methylation sites. In embodiments, the plurality of methylation sites includes two or more methylation sites set forth in Table 1 and no other methylation sites.

In embodiments, the method includes detecting methylation or unmethylation of at least 1, 2, 3, 4, 5, 6, 7, 8, 9, 10, 50, 100, 200, 300, 400, or 500 of the following sites: Chromosome 1 (Chr1) position 2996653, Chr1 position 11979164, Chr1 position 12655938, Chr1 position 16450525, Chr1 position 16450542, Chr1 position 16450545, Chr1 position 16469987, Chr1 position 17494491, Chr1 position 25473203, Chr1 position 27640460, Chr1 position 29565080, Chr1 position 38493013, Chr1 position 38493030, Chr1 position 38493074, Chr1 position 46713777, Chr1 position 46914121, Chr1 position 46955744, Chr1 position 55008344, Chr1 position 109816092, Chr1 position 109816111, Chr1 position 110074669, Chr1 position 110074681, Chr1 position 110074685, Chr1 position 150949856, Chr1 position 150949857, Chr1 position 153540282, Chr1 position 155162704, Chr1 position 155162714, Chr1 position 156676611, Chr1 position 157611881, Chr1 position 182205324, Chr1 position 204118999, Chr1 position 206741875, Chr1 position 206741989, Chr1 position 212587673, Chr1 position 212841198, Chr1 position 223403952, Chr1 position 233430972, Chr1 position 234342767, Chromosome 2 (Chr2) position 3454277, Chr2 position 8793724, Chr2 position 20412441, Chr2 position 42329402, Chr2 position 42329494, Chr2 position 55289272, Chr2 position 65064865, Chr2 position 70823641, Chr2 position 73143689, Chr2 position 74454110, Chr2 position 122014529, Chr2 position 128158884, Chr2 position 128158910, Chr2 position 203114171, Chr2 position 218221671, Chr2 position 219745335, Chr2 position 238341465, Chr2 position 238341542, Chr2 position 238341546, Chr2 position 238774763, Chromosome 3 (Chr3) position 13323642, Chr3 position 14180153, Chr3 position 45209073, Chr3 position 45209207, Chr3 position 52525100, Chr3 position 62589658, Chr3 position 65388317, Chr3 position 65388388, Chr3 position 73599302, Chr3 position 195636893, Chr3 position 197093846, Chromosome 4 (Chr4) position 3743223, Chr4 position 5755716, Chr4 position 5755717, Chr4 position 5755728, Chr4 position 5755729, Chr4 position 5755734, Chr4 position 8372861, Chr4 position 57548289, Chromosome 5 (Chr5) position 1118280, Chr5 position 34564389, Chr5 position 73871907, Chr5 position 78013596, Chr5 position 78013643, Chr5 position 137802650, Chr5 position 139051189, Chr5 position 167838221, Chr5 position 177541401, Chr5 position 180018672, Chr5 position 180101026, Chromosome 6 (Chr6) position 3394325, Chr6 position 3887581, Chr6 position 7236568, Chr6 position 7728692, Chr6 position 34203617, Chr6 position 37751320, Chr6 position 41410682, Chr6 position 41438516, Chr6 position 41438575, Chr6 position 43464150, Chr6 position 158734279, Chromosome 7 (Chr7) position 989235, Chr7 position 2673543, Chr7 position 73508602, Chr7 position 105079565, Chr7 position 105079631, Chr7 position 151425103, Chr7 position 151425104, Chromosome 8 (Chr8) position 11764017, Chr8 position 21647308, Chr8 position 22548399, Chr8 position 22548483, Chr8 position 133570537, Chr8 position 141320393, Chr8 position 141320410, Chromosome 9 (Chr9) position 6566568, Chr9 position 16197862, Chr9 position 34591313, Chr9 position 98225096, Chr9 position 126126741, Chr9 position 132083428, Chr9 position 136077410, Chr9 position 139655018, Chr9 position 140205985, Chr9 position 140205985, Chr9 position 140205997, Chromosome 10 (Chr10) position 3929071, Chr10 position 30047012, Chr10 position 79702989, Chr10 position 87984905, Chr10 position 94838789, Chr10 position 102131187, Chr10 position 104196489, Chr10 position 111766879, Chr10 position 112258886, Chr10 position 112258984, Chr10 position 112259015, Chr10 position 116391763, Chr10 position 120011530, Chr10 position 126172714, Chr10 position 126172747, Chromosome 11 (Chr11) position 556355, Chr11 position 821282, Chr11 position 12188937, Chr11 position 12188948, Chr11 position 12188995, Chr11 position 36057726, Chr11 position 48070143, Chr11 position 48070163, Chr11 position 48070166, Chr11 position 48070174, Chr11 position 65158294, Chr11 position 65158342, Chr11 position 65297089, Chr11 position 66104481, Chr11 position 66104485, Chr11 position 66104578, Chr11 position 68608767, Chr11 position 70236292, Chr11 position 70236320, Chr11 position 70236331, Chr11 position 115530032, Chr11 position 117950310, Chr11 position 117950329, Chr11 position 117950361, Chr11 position 117950362, Chr11 position 119293593, Chromosome 12 (Chr12) position 679803, Chr12 position 26039132, Chr12 position 31004558, Chr12 position 45610695, Chr12 position 45610701, Chr12 position 45610702, Chr12 position 45610706, Chr12 position 50286016, Chr12 position 52243258, Chr12 position 52243286, Chr12 position 54145732, Chr12 position 54145741, Chr12 position 54145825, Chr12 position 56115043, Chr12 position 66262229, Chr12 position 66262230, Chr12 position 66262233, Chr12 position 66262234, Chr12 position 77266621, Chr12 position 117580102, Chr12 position 123435962, Chr12 position 123436011, Chr12 position 123436065, Chr12 position 123540893, Chromosome 13 (Chr13) position 20735797, Chr13 position 23500419, Chr13 position 46771519, Chr13 position 46771520, Chr13 position 53313426, Chr13 position 113807393, Chromosome 14 (Chr14) position 38599118, Chr14 position 69170010, Chr14 position 75701632, Chr14 position 75701643, Chr14 position 90850454, Chr14 position 97524282, Chr14 position 103541602, Chr14 position 103768055, Chr14 position 104209000, Chr14 position 104209068, Chr14 position 104354645, Chr14 position 104360487, Chromosome 15 (Chr15) position 41068807, Chr15 position 61152225, Chr15 position 61152253, Chr15 position 61152313, Chr15 position 65186440, Chr15 position 68851629, Chr15 position 70667596, Chr15 position 70767206, Chr15 position 75251486, Chr15 position 77984014, Chr15 position 77989064, Chr15 position 83952081, Chr15 position 85402496, Chr15 position 85402497, Chr15 position 99417337, Chromosome 16 (Chr16) position 1231873, Chr16 position 1458639, Chr16 position 3023231, Chr16 position 23135832, Chr16 position 29616265, Chr16 position 31009547, Chr16 position 31009548, Chr16 position 31009590, Chr16 position 57793674, Chr16 position 57793715, Chr16 position 57793727, Chr16 position 70771056, Chr16 position 70771079, Chr16 position 70771141, Chr16 position 77332010, Chr16 position 78540378, Chr16 position 79333435, Chr16 position 84262419, Chr16 position 88701114, Chr16 position 89988308, Chr16 position 89988644, Chromosome 17 (Chr17) position 1509928, Chr17 position 1509945, Chr17 position 1509952, Chr17 position 1509953, Chr17 position 7644013, Chr17 position 16323460, Chr17 position 16323473, Chr17 position 16924561, Chr17 position 16924562, Chr17 position 16924594, Chr17 position 17717918, Chr17 position 17718591, Chr17 position 18139506, Chr17 position 35278031, Chr17 position 39677570, Chr17 position 40826257, Chr17 position 43037426, Chr17 position 43200096, Chr17 position 43200239, Chr17 position 43510142, Chr17 position 47987828, Chr17 position 48178379, Chr17 position 48596391, Chr17 position 48764165, Chr17 position 55701962, Chr17 position 73584599, Chr17 position 73993165, Chr17 position 75827716, Chr17 position 76882243, Chr17 position 78765910, Chr17 position 79544478, Chr17 position 80696474, Chromosome 18 (Chr18) position 19751759, Chr18 position 21440760, Chr18 position 45555437, Chr18 position 45555438, Chr18 position 46547891, Chr18 position 55888885, Chr18 position 56452096, Chr18 position 56452476, Chr18 position 56887181, Chr18 position 76002973, Chr18 position 77331090, Chromosome 19 (Chr19) position 677895, Chr19 position 884044, Chr19 position 884059, Chr19 position 884105, Chr19 position 884115, Chr19 position 1136511, Chr19 position 1177605, Chr19 position 1177612, Chr19 position 1177640, Chr19 position 1860601, Chr19 position 1860607, Chr19 position 2503954, Chr19 position 3434917, Chr19 position 3434921, Chr19 position 3434930, Chr19 position 3434939, Chr19 position 3434952, Chr19 position 3434954, Chr19 position 3434962, Chr19 position 3434964, Chr19 position 3434979, Chr19 position 3434985, Chr19 position 4052713, Chr19 position 4052714, Chr19 position 4052749, Chr19 position 4374591, Chr19 position 5013982, Chr19 position 5048836, Chr19 position 5048867, Chr19 position 5048877, Chr19 position 8367279, Chr19 position 8428573, Chr19 position 10254577, Chr19 position 10254578, Chr19 position 10463956, Chr19 position 10464137, Chr19 position 13203671, Chr19 position 13266925, Chr19 position 13266934, Chr19 position 13266970, Chr19 position 13842142, Chr19 position 14248494, Chr19 position 15375465, Chr19 position 17218912, Chr19 position 17346702, Chr19 position 17346702, Chr19 position 18157161, Chr19 position 18157221, Chr19 position 18157258, Chr19 position 18415877, Chr19 position 18415890, Chr19 position 30606642, Chr19 position 35531842, Chr19 position 44303112, Chr19 position 47173037, Chr19 position 47316268, Chr19 position 47778278, Chr19 position 47778298, Chromosome 20 (Chr20) position 34206950, Chr20 position 36771969, Chr20 position 48993661, Chr20 position 58406398, Chr20 position 61976049, Chr20 position 61976073, Chr20 position 62588571, Chr20 position 62588579, Chromosome 22 (Chr22) position 19738127, Chr22 position 35965176, Chr22 position 36549809, Chr22 position 36973375, Chr22 position 37447953, Chr22 position 37914998, Chr22 position 38307317, Chr22 position 39662794, and Chr22 position 45622980.

In embodiments, the method includes detecting methylation or unmethylation of at least 1 of the following sites: Chr1 position 2996653, Chr1 position 11979164, Chr1 position 12655938, Chr1 position 16450525, Chr1 position 16450542, Chr1 position 16450545, Chr1 position 16469987, Chr1 position 17494491, Chr1 position 25473203, Chr1 position 27640460, Chr1 position 29565080, Chr1 position 38493013, Chr1 position 38493030, Chr1 position 38493074, Chr1 position 46713777, Chr1 position 46914121, Chr1 position 46955744, Chr1 position 55008344, Chr1 position 109816092, Chr1 position 109816111, Chr1 position 110074669, Chr1 position 110074681, Chr1 position 110074685, Chr1 position 150949856, Chr1 position 150949857, Chr1 position 153540282, Chr1 position 155162704, Chr1 position 155162714, Chr1 position 156676611, Chr1 position 157611881, Chr1 position 182205324, Chr1 position 204118999, Chr1 position 206741875, Chr1 position 206741989, Chr1 position 212587673, Chr1 position 212841198, Chr1 position 223403952, Chr1 position 233430972, Chr1 position 234342767, Chr2 position 3454277, Chr2 position 8793724, Chr2 position 20412441, Chr2 position 42329402, Chr2 position 42329494, Chr2 position 55289272, Chr2 position 65064865, Chr2 position 70823641, Chr2 position 73143689, Chr2 position 74454110, Chr2 position 122014529, Chr2 position 128158884, Chr2 position 128158910, Chr2 position 203114171, Chr2 position 218221671, Chr2 position 219745335, Chr2 position 238341465, Chr2 position 238341542, Chr2 position 238341546, Chr2 position 238774763, Chr3 position 13323642, Chr3 position 14180153, Chr3 position 45209073, Chr3 position 45209207, Chr3 position 52525100, Chr3 position 62589658, Chr3 position 65388317, Chr3 position 65388388, Chr3 position 73599302, Chr3 position 195636893, Chr3 position 197093846, Chr4 position 3743223, Chr4 position 5755716, Chr4 position 5755717, Chr4 position 5755728, Chr4 position 5755729, Chr4 position 5755734, Chr4 position 8372861, Chr4 position 57548289, Chr5 position 1118280, Chr5 position 34564389, Chr5 position 73871907, Chr5 position 78013596, Chr5 position 78013643, Chr5 position 137802650, Chr5 position 139051189, Chr5 position 167838221, Chr5 position 177541401, Chr5 position 180018672, Chr5 position 180101026, Chr6 position 3394325, Chr6 position 3887581, Chr6 position 7236568, Chr6 position 7728692, Chr6 position 34203617, Chr6 position 37751320, Chr6 position 41410682, Chr6 position 41438516, Chr6 position 41438575, Chr6 position 43464150, Chr6 position 158734279, Chr7 position 989235, Chr7 position 2673543, Chr7 position 73508602, Chr7 position 105079565, Chr7 position 105079631, Chr7 position 151425103, Chr7 position 151425104, Chr8 position 11764017, Chr8 position 21647308, Chr8 position 22548399, Chr8 position 22548483, Chr8 position 133570537, Chr8 position 141320393, Chr8 position 141320410, Chr9 position 6566568, Chr9 position 16197862, Chr9 position 34591313, Chr9 position 98225096, Chr9 position 126126741, Chr9 position 132083428, Chr9 position 136077410, Chr9 position 139655018, Chr9 position 140205985, Chr9 position 140205985, Chr9 position 140205997, Chr10 position 3929071, Chr10 position 30047012, Chr10 position 79702989, Chr10 position 87984905, Chr10 position 94838789, Chr10 position 102131187, Chr10 position 104196489, Chr10 position 111766879, Chr10 position 112258886, Chr10 position 112258984, Chr10 position 112259015, Chr10 position 116391763, Chr10 position 120011530, Chr10 position 126172714, Chr10 position 126172747, Chr11 position 556355, Chr11 position 821282, Chr11 position 12188937, Chr11 position 12188948, Chr11 position 12188995, Chr11 position 36057726, Chr11 position 48070143, Chr11 position 48070163, Chr11 position 48070166, Chr11 position 48070174, Chr11 position 65158294, Chr11 position 65158342, Chr11 position 65297089, Chr11 position 66104481, Chr11 position 66104485, Chr11 position 66104578, Chr11 position 68608767, Chr11 position 70236292, Chr11 position 70236320, Chr11 position 70236331, Chr11 position 115530032, Chr11 position 117950310, Chr11 position 117950329, Chr11 position 117950361, Chr11 position 117950362, Chr11 position 119293593, Chr12 position 679803, Chr12 position 26039132, Chr12 position 31004558, Chr12 position 45610695, Chr12 position 45610701, Chr12 position 45610702, Chr12 position 45610706, Chr12 position 50286016, Chr12 position 52243258, Chr12 position 52243286, Chr12 position 54145732, Chr12 position 54145741, Chr12 position 54145825, Chr12 position 56115043, Chr12 position 66262229, Chr12 position 66262230, Chr12 position 66262233, Chr12 position 66262234, Chr12 position 77266621, Chr12 position 117580102, Chr12 position 123435962, Chr12 position 123436011, Chr12 position 123436065, Chr12 position 123540893, Chr13 position 20735797, Chr13 position 23500419, Chr13 position 46771519, Chr13 position 46771520, Chr13 position 53313426, Chr13 position 113807393, Chr14 position 38599118, Chr14 position 69170010, Chr14 position 75701632, Chr14 position 75701643, Chr14 position 90850454, Chr14 position 97524282, Chr14 position 103541602, Chr14 position 103768055, Chr14 position 104209000, Chr14 position 104209068, Chr14 position 104354645, Chr14 position 104360487, Chr15 position 41068807, Chr15 position 61152225, Chr15 position 61152253, Chr15 position 61152313, Chr15 position 65186440, Chr15 position 68851629, Chr15 position 70667596, Chr15 position 70767206, Chr15 position 75251486, Chr15 position 77984014, Chr15 position 77989064, Chr15 position 83952081, Chr15 position 85402496, Chr15 position 85402497, Chr15 position 99417337, Chr16 position 1231873, Chr16 position 1458639, Chr16 position 3023231, Chr16 position 23135832, Chr16 position 29616265, Chr16 position 31009547, Chr16 position 31009548, Chr16 position 31009590, Chr16 position 57793674, Chr16 position 57793715, Chr16 position 57793727, Chr16 position 70771056, Chr16 position 70771079, Chr16 position 70771141, Chr16 position 77332010, Chr16 position 78540378, Chr16 position 79333435, Chr16 position 84262419, Chr16 position 88701114, Chr16 position 89988308, Chr16 position 89988644, Chr17 position 1509928, Chr17 position 1509945, Chr17 position 1509952, Chr17 position 1509953, Chr17 position 7644013, Chr17 position 16323460, Chr17 position 16323473, Chr17 position 16924561, Chr17 position 16924562, Chr17 position 16924594, Chr17 position 17717918, Chr17 position 17718591, Chr17 position 18139506, Chr17 position 35278031, Chr17 position 39677570, Chr17 position 40826257, Chr17 position 43037426, Chr17 position 43200096, Chr17 position 43200239, Chr17 position 43510142, Chr17 position 47987828, Chr17 position 48178379, Chr17 position 48596391, Chr17 position 48764165, Chr17 position 55701962, Chr17 position 73584599, Chr17 position 73993165, Chr17 position 75827716, Chr17 position 76882243, Chr17 position 78765910, Chr17 position 79544478, Chr17 position 80696474, Chr18 position 19751759, Chr18 position 21440760, Chr18 position 45555437, Chr18 position 45555438, Chr18 position 46547891, Chr18 position 55888885, Chr18 position 56452096, Chr18 position 56452476, Chr18 position 56887181, Chr18 position 76002973, Chr18 position 77331090, Chr19 position 677895, Chr19 position 884044, Chr19 position 884059, Chr19 position 884105, Chr19 position 884115, Chr19 position 1136511, Chr19 position 1177605, Chr19 position 1177612, Chr19 position 1177640, Chr19 position 1860601, Chr19 position 1860607, Chr19 position 2503954, Chr19 position 3434917, Chr19 position 3434921, Chr19 position 3434930, Chr19 position 3434939, Chr19 position 3434952, Chr19 position 3434954, Chr19 position 3434962, Chr19 position 3434964, Chr19 position 3434979, Chr19 position 3434985, Chr19 position 4052713, Chr19 position 4052714, Chr19 position 4052749, Chr19 position 4374591, Chr19 position 5013982, Chr19 position 5048836, Chr19 position 5048867, Chr19 position 5048877, Chr19 position 8367279, Chr19 position 8428573, Chr19 position 10254577, Chr19 position 10254578, Chr19 position 10463956, Chr19 position 10464137, Chr19 position 13203671, Chr19 position 13266925, Chr19 position 13266934, Chr19 position 13266970, Chr19 position 13842142, Chr19 position 14248494, Chr19 position 15375465, Chr19 position 17218912, Chr19 position 17346702, Chr19 position 17346702, Chr19 position 18157161, Chr19 position 18157221, Chr19 position 18157258, Chr19 position 18415877, Chr19 position 18415890, Chr19 position 30606642, Chr19 position 35531842, Chr19 position 44303112, Chr19 position 47173037, Chr19 position 47316268, Chr19 position 47778278, Chr19 position 47778298, Chr20 position 34206950, Chr20 position 36771969, Chr20 position 48993661, Chr20 position 58406398, Chr20 position 61976049, Chr20 position 61976073, Chr20 position 62588571, Chr20 position 62588579, Chr22 position 19738127, Chr22 position 35965176, Chr22 position 36549809, Chr22 position 36973375, Chr22 position 37447953, Chr22 position 37914998, Chr22 position 38307317, Chr22 position 39662794, and Chr22 position 45622980.

In embodiments, the method includes detecting methylation or unmethylation of at least 2 of the following sites: Chr1 position 2996653, Chr1 position 11979164, Chr1 position 12655938, Chr1 position 16450525, Chr1 position 16450542, Chr1 position 16450545, Chr1 position 16469987, Chr1 position 17494491, Chr1 position 25473203, Chr1 position 27640460, Chr1 position 29565080, Chr1 position 38493013, Chr1 position 38493030, Chr1 position 38493074, Chr1 position 46713777, Chr1 position 46914121, Chr1 position 46955744, Chr1 position 55008344, Chr1 position 109816092, Chr1 position 109816111, Chr1 position 110074669, Chr1 position 110074681, Chr1 position 110074685, Chr1 position 150949856, Chr1 position 150949857, Chr1 position 153540282, Chr1 position 155162704, Chr1 position 155162714, Chr1 position 156676611, Chr1 position 157611881, Chr1 position 182205324, Chr1 position 204118999, Chr1 position 206741875, Chr1 position 206741989, Chr1 position 212587673, Chr1 position 212841198, Chr1 position 223403952, Chr1 position 233430972, Chr1 position 234342767, Chr2 position 3454277, Chr2 position 8793724, Chr2 position 20412441, Chr2 position 42329402, Chr2 position 42329494, Chr2 position 55289272, Chr2 position 65064865, Chr2 position 70823641, Chr2 position 73143689, Chr2 position 74454110, Chr2 position 122014529, Chr2 position 128158884, Chr2 position 128158910, Chr2 position 203114171, Chr2 position 218221671, Chr2 position 219745335, Chr2 position 238341465, Chr2 position 238341542, Chr2 position 238341546, Chr2 position 238774763, Chr3 position 13323642, Chr3 position 14180153, Chr3 position 45209073, Chr3 position 45209207, Chr3 position 52525100, Chr3 position 62589658, Chr3 position 65388317, Chr3 position 65388388, Chr3 position 73599302, Chr3 position 195636893, Chr3 position 197093846, Chr4 position 3743223, Chr4 position 5755716, Chr4 position 5755717, Chr4 position 5755728, Chr4 position 5755729, Chr4 position 5755734, Chr4 position 8372861, Chr4 position 57548289, Chr5 position 1118280, Chr5 position 34564389, Chr5 position 73871907, Chr5 position 78013596, Chr5 position 78013643, Chr5 position 137802650, Chr5 position 139051189, Chr5 position 167838221, Chr5 position 177541401, Chr5 position 180018672, Chr5 position 180101026, Chr6 position 3394325, Chr6 position 3887581, Chr6 position 7236568, Chr6 position 7728692, Chr6 position 34203617, Chr6 position 37751320, Chr6 position 41410682, Chr6 position 41438516, Chr6 position 41438575, Chr6 position 43464150, Chr6 position 158734279, Chr7 position 989235, Chr7 position 2673543, Chr7 position 73508602, Chr7 position 105079565, Chr7 position 105079631, Chr7 position 151425103, Chr7 position 151425104, Chr8 position 11764017, Chr8 position 21647308, Chr8 position 22548399, Chr8 position 22548483, Chr8 position 133570537, Chr8 position 141320393, Chr8 position 141320410, Chr9 position 6566568, Chr9 position 16197862, Chr9 position 34591313, Chr9 position 98225096, Chr9 position 126126741, Chr9 position 132083428, Chr9 position 136077410, Chr9 position 139655018, Chr9 position 140205985, Chr9 position 140205985, Chr9 position 140205997, Chr10 position 3929071, Chr10 position 30047012, Chr10 position 79702989, Chr10 position 87984905, Chr10 position 94838789, Chr10 position 102131187, Chr10 position 104196489, Chr10 position 111766879, Chr10 position 112258886, Chr10 position 112258984, Chr10 position 112259015, Chr10 position 116391763, Chr10 position 120011530, Chr10 position 126172714, Chr10 position 126172747, Chr11 position 556355, Chr11 position 821282, Chr11 position 12188937, Chr11 position 12188948, Chr11 position 12188995, Chr11 position 36057726, Chr11 position 48070143, Chr11 position 48070163, Chr11 position 48070166, Chr11 position 48070174, Chr11 position 65158294, Chr11 position 65158342, Chr11 position 65297089, Chr11 position 66104481, Chr11 position 66104485, Chr11 position 66104578, Chr11 position 68608767, Chr11 position 70236292, Chr11 position 70236320, Chr11 position 70236331, Chr11 position 115530032, Chr11 position 117950310, Chr11 position 117950329, Chr11 position 117950361, Chr11 position 117950362, Chr11 position 119293593, Chr12 position 679803, Chr12 position 26039132, Chr12 position 31004558, Chr12 position 45610695, Chr12 position 45610701, Chr12 position 45610702, Chr12 position 45610706, Chr12 position 50286016, Chr12 position 52243258, Chr12 position 52243286, Chr12 position 54145732, Chr12 position 54145741, Chr12 position 54145825, Chr12 position 56115043, Chr12 position 66262229, Chr12 position 66262230, Chr12 position 66262233, Chr12 position 66262234, Chr12 position 77266621, Chr12 position 117580102, Chr12 position 123435962, Chr12 position 123436011, Chr12 position 123436065, Chr12 position 123540893, Chr13 position 20735797, Chr13 position 23500419, Chr13 position 46771519, Chr13 position 46771520, Chr13 position 53313426, Chr13 position 113807393, Chr14 position 38599118, Chr14 position 69170010, Chr14 position 75701632, Chr14 position 75701643, Chr14 position 90850454, Chr14 position 97524282, Chr14 position 103541602, Chr14 position 103768055, Chr14 position 104209000, Chr14 position 104209068, Chr14 position 104354645, Chr14 position 104360487, Chr15 position 41068807, Chr15 position 61152225, Chr15 position 61152253, Chr15 position 61152313, Chr15 position 65186440, Chr15 position 68851629, Chr15 position 70667596, Chr15 position 70767206, Chr15 position 75251486, Chr15 position 77984014, Chr15 position 77989064, Chr15 position 83952081, Chr15 position 85402496, Chr15 position 85402497, Chr15 position 99417337, Chr16 position 1231873, Chr16 position 1458639, Chr16 position 3023231, Chr16 position 23135832, Chr16 position 29616265, Chr16 position 31009547, Chr16 position 31009548, Chr16 position 31009590, Chr16 position 57793674, Chr16 position 57793715, Chr16 position 57793727, Chr16 position 70771056, Chr16 position 70771079, Chr16 position 70771141, Chr16 position 77332010, Chr16 position 78540378, Chr16 position 79333435, Chr16 position 84262419, Chr16 position 88701114, Chr16 position 89988308, Chr16 position 89988644, Chr17 position 1509928, Chr17 position 1509945, Chr17 position 1509952, Chr17 position 1509953, Chr17 position 7644013, Chr17 position 16323460, Chr17 position 16323473, Chr17 position 16924561, Chr17 position 16924562, Chr17 position 16924594, Chr17 position 17717918, Chr17 position 17718591, Chr17 position 18139506, Chr17 position 35278031, Chr17 position 39677570, Chr17 position 40826257, Chr17 position 43037426, Chr17 position 43200096, Chr17 position 43200239, Chr17 position 43510142, Chr17 position 47987828, Chr17 position 48178379, Chr17 position 48596391, Chr17 position 48764165, Chr17 position 55701962, Chr17 position 73584599, Chr17 position 73993165, Chr17 position 75827716, Chr17 position 76882243, Chr17 position 78765910, Chr17 position 79544478, Chr17 position 80696474, Chr18 position 19751759, Chr18 position 21440760, Chr18 position 45555437, Chr18 position 45555438, Chr18 position 46547891, Chr18 position 55888885, Chr18 position 56452096, Chr18 position 56452476, Chr18 position 56887181, Chr18 position 76002973, Chr18 position 77331090, Chr19 position 677895, Chr19 position 884044, Chr19 position 884059, Chr19 position 884105, Chr19 position 884115, Chr19 position 1136511, Chr19 position 1177605, Chr19 position 1177612, Chr19 position 1177640, Chr19 position 1860601, Chr19 position 1860607, Chr19 position 2503954, Chr19 position 3434917, Chr19 position 3434921, Chr19 position 3434930, Chr19 position 3434939, Chr19 position 3434952, Chr19 position 3434954, Chr19 position 3434962, Chr19 position 3434964, Chr19 position 3434979, Chr19 position 3434985, Chr19 position 4052713, Chr19 position 4052714, Chr19 position 4052749, Chr19 position 4374591, Chr19 position 5013982, Chr19 position 5048836, Chr19 position 5048867, Chr19 position 5048877, Chr19 position 8367279, Chr19 position 8428573, Chr19 position 10254577, Chr19 position 10254578, Chr19 position 10463956, Chr19 position 10464137, Chr19 position 13203671, Chr19 position 13266925, Chr19 position 13266934, Chr19 position 13266970, Chr19 position 13842142, Chr19 position 14248494, Chr19 position 15375465, Chr19 position 17218912, Chr19 position 17346702, Chr19 position 17346702, Chr19 position 18157161, Chr19 position 18157221, Chr19 position 18157258, Chr19 position 18415877, Chr19 position 18415890, Chr19 position 30606642, Chr19 position 35531842, Chr19 position 44303112, Chr19 position 47173037, Chr19 position 47316268, Chr19 position 47778278, Chr19 position 47778298, Chr20 position 34206950, Chr20 position 36771969, Chr20 position 48993661, Chr20 position 58406398, Chr20 position 61976049, Chr20 position 61976073, Chr20 position 62588571, Chr20 position 62588579, Chr22 position 19738127, Chr22 position 35965176, Chr22 position 36549809, Chr22 position 36973375, Chr22 position 37447953, Chr22 position 37914998, Chr22 position 38307317, Chr22 position 39662794, and Chr22 position 45622980.

In embodiments, the method includes detecting methylation or unmethylation of at least 3 of the following sites: Chr1 position 2996653, Chr1 position 11979164, Chr1 position 12655938, Chr1 position 16450525, Chr1 position 16450542, Chr1 position 16450545, Chr1 position 16469987, Chr1 position 17494491, Chr1 position 25473203, Chr1 position 27640460, Chr1 position 29565080, Chr1 position 38493013, Chr1 position 38493030, Chr1 position 38493074, Chr1 position 46713777, Chr1 position 46914121, Chr1 position 46955744, Chr1 position 55008344, Chr1 position 109816092, Chr1 position 109816111, Chr1 position 110074669, Chr1 position 110074681, Chr1 position 110074685, Chr1 position 150949856, Chr1 position 150949857, Chr1 position 153540282, Chr1 position 155162704, Chr1 position 155162714, Chr1 position 156676611, Chr1 position 157611881, Chr1 position 182205324, Chr1 position 204118999, Chr1 position 206741875, Chr1 position 206741989, Chr1 position 212587673, Chr1 position 212841198, Chr1 position 223403952, Chr1 position 233430972, Chr1 position 234342767, Chr2 position 3454277, Chr2 position 8793724, Chr2 position 20412441, Chr2 position 42329402, Chr2 position 42329494, Chr2 position 55289272, Chr2 position 65064865, Chr2 position 70823641, Chr2 position 73143689, Chr2 position 74454110, Chr2 position 122014529, Chr2 position 128158884, Chr2 position 128158910, Chr2 position 203114171, Chr2 position 218221671, Chr2 position 219745335, Chr2 position 238341465, Chr2 position 238341542, Chr2 position 238341546, Chr2 position 238774763, Chr3 position 13323642, Chr3 position 14180153, Chr3 position 45209073, Chr3 position 45209207, Chr3 position 52525100, Chr3 position 62589658, Chr3 position 65388317, Chr3 position 65388388, Chr3 position 73599302, Chr3 position 195636893, Chr3 position 197093846, Chr4 position 3743223, Chr4 position 5755716, Chr4 position 5755717, Chr4 position 5755728, Chr4 position 5755729, Chr4 position 5755734, Chr4 position 8372861, Chr4 position 57548289, Chr5 position 1118280, Chr5 position 34564389, Chr5 position 73871907, Chr5 position 78013596, Chr5 position 78013643, Chr5 position 137802650, Chr5 position 139051189, Chr5 position 167838221, Chr5 position 177541401, Chr5 position 180018672, Chr5 position 180101026, Chr6 position 3394325, Chr6 position 3887581, Chr6 position 7236568, Chr6 position 7728692, Chr6 position 34203617, Chr6 position 37751320, Chr6 position 41410682, Chr6 position 41438516, Chr6 position 41438575, Chr6 position 43464150, Chr6 position 158734279, Chr7 position 989235, Chr7 position 2673543, Chr7 position 73508602, Chr7 position 105079565, Chr7 position 105079631, Chr7 position 151425103, Chr7 position 151425104, Chr8 position 11764017, Chr8 position 21647308, Chr8 position 22548399, Chr8 position 22548483, Chr8 position 133570537, Chr8 position 141320393, Chr8 position 141320410, Chr9 position 6566568, Chr9 position 16197862, Chr9 position 34591313, Chr9 position 98225096, Chr9 position 126126741, Chr9 position 132083428, Chr9 position 136077410, Chr9 position 139655018, Chr9 position 140205985, Chr9 position 140205985, Chr9 position 140205997, Chr10 position 3929071, Chr10 position 30047012, Chr10 position 79702989, Chr10 position 87984905, Chr10 position 94838789, Chr10 position 102131187, Chr10 position 104196489, Chr10 position 111766879, Chr10 position 112258886, Chr10 position 112258984, Chr10 position 112259015, Chr10 position 116391763, Chr10 position 120011530, Chr10 position 126172714, Chr10 position 126172747, Chr11 position 556355, Chr11 position 821282, Chr11 position 12188937, Chr11 position 12188948, Chr11 position 12188995, Chr11 position 36057726, Chr11 position 48070143, Chr11 position 48070163, Chr11 position 48070166, Chr11 position 48070174, Chr11 position 65158294, Chr11 position 65158342, Chr11 position 65297089, Chr11 position 66104481, Chr11 position 66104485, Chr11 position 66104578, Chr11 position 68608767, Chr11 position 70236292, Chr11 position 70236320, Chr11 position 70236331, Chr11 position 115530032, Chr11 position 117950310, Chr11 position 117950329, Chr11 position 117950361, Chr11 position 117950362, Chr11 position 119293593, Chr12 position 679803, Chr12 position 26039132, Chr12 position 31004558, Chr12 position 45610695, Chr12 position 45610701, Chr12 position 45610702, Chr12 position 45610706, Chr12 position 50286016, Chr12 position 52243258, Chr12 position 52243286, Chr12 position 54145732, Chr12 position 54145741, Chr12 position 54145825, Chr12 position 56115043, Chr12 position 66262229, Chr12 position 66262230, Chr12 position 66262233, Chr12 position 66262234, Chr12 position 77266621, Chr12 position 117580102, Chr12 position 123435962, Chr12 position 123436011, Chr12 position 123436065, Chr12 position 123540893, Chr13 position 20735797, Chr13 position 23500419, Chr13 position 46771519, Chr13 position 46771520, Chr13 position 53313426, Chr13 position 113807393, Chr14 position 38599118, Chr14 position 69170010, Chr14 position 75701632, Chr14 position 75701643, Chr14 position 90850454, Chr14 position 97524282, Chr14 position 103541602, Chr14 position 103768055, Chr14 position 104209000, Chr14 position 104209068, Chr14 position 104354645, Chr14 position 104360487, Chr15 position 41068807, Chr15 position 61152225, Chr15 position 61152253, Chr15 position 61152313, Chr15 position 65186440, Chr15 position 68851629, Chr15 position 70667596, Chr15 position 70767206, Chr15 position 75251486, Chr15 position 77984014, Chr15 position 77989064, Chr15 position 83952081, Chr15 position 85402496, Chr15 position 85402497, Chr15 position 99417337, Chr16 position 1231873, Chr16 position 1458639, Chr16 position 3023231, Chr16 position 23135832, Chr16 position 29616265, Chr16 position 31009547, Chr16 position 31009548, Chr16 position 31009590, Chr16 position 57793674, Chr16 position 57793715, Chr16 position 57793727, Chr16 position 70771056, Chr16 position 70771079, Chr16 position 70771141, Chr16 position 77332010, Chr16 position 78540378, Chr16 position 79333435, Chr16 position 84262419, Chr16 position 88701114, Chr16 position 89988308, Chr16 position 89988644, Chr17 position 1509928, Chr17 position 1509945, Chr17 position 1509952, Chr17 position 1509953, Chr17 position 7644013, Chr17 position 16323460, Chr17 position 16323473, Chr17 position 16924561, Chr17 position 16924562, Chr17 position 16924594, Chr17 position 17717918, Chr17 position 17718591, Chr17 position 18139506, Chr17 position 35278031, Chr17 position 39677570, Chr17 position 40826257, Chr17 position 43037426, Chr17 position 43200096, Chr17 position 43200239, Chr17 position 43510142, Chr17 position 47987828, Chr17 position 48178379, Chr17 position 48596391, Chr17 position 48764165, Chr17 position 55701962, Chr17 position 73584599, Chr17 position 73993165, Chr17 position 75827716, Chr17 position 76882243, Chr17 position 78765910, Chr17 position 79544478, Chr17 position 80696474, Chr18 position 19751759, Chr18 position 21440760, Chr18 position 45555437, Chr18 position 45555438, Chr18 position 46547891, Chr18 position 55888885, Chr18 position 56452096, Chr18 position 56452476, Chr18 position 56887181, Chr18 position 76002973, Chr18 position 77331090, Chr19 position 677895, Chr19 position 884044, Chr19 position 884059, Chr19 position 884105, Chr19 position 884115, Chr19 position 1136511, Chr19 position 1177605, Chr19 position 1177612, Chr19 position 1177640, Chr19 position 1860601, Chr19 position 1860607, Chr19 position 2503954, Chr19 position 3434917, Chr19 position 3434921, Chr19 position 3434930, Chr19 position 3434939, Chr19 position 3434952, Chr19 position 3434954, Chr19 position 3434962, Chr19 position 3434964, Chr19 position 3434979, Chr19 position 3434985, Chr19 position 4052713, Chr19 position 4052714, Chr19 position 4052749, Chr19 position 4374591, Chr19 position 5013982, Chr19 position 5048836, Chr19 position 5048867, Chr19 position 5048877, Chr19 position 8367279, Chr19 position 8428573, Chr19 position 10254577, Chr19 position 10254578, Chr19 position 10463956, Chr19 position 10464137, Chr19 position 13203671, Chr19 position 13266925, Chr19 position 13266934, Chr19 position 13266970, Chr19 position 13842142, Chr19 position 14248494, Chr19 position 15375465, Chr19 position 17218912, Chr19 position 17346702, Chr19 position 17346702, Chr19 position 18157161, Chr19 position 18157221, Chr19 position 18157258, Chr19 position 18415877, Chr19 position 18415890, Chr19 position 30606642, Chr19 position 35531842, Chr19 position 44303112, Chr19 position 47173037, Chr19 position 47316268, Chr19 position 47778278, Chr19 position 47778298, Chr20 position 34206950, Chr20 position 36771969, Chr20 position 48993661, Chr20 position 58406398, Chr20 position 61976049, Chr20 position 61976073, Chr20 position 62588571, Chr20 position 62588579, Chr22 position 19738127, Chr22 position 35965176, Chr22 position 36549809, Chr22 position 36973375, Chr22 position 37447953, Chr22 position 37914998, Chr22 position 38307317, Chr22 position 39662794, and Chr22 position 45622980.

In embodiments, the method includes detecting methylation or unmethylation of at least 4 of the following sites: Chr1 position 2996653, Chr1 position 11979164, Chr1 position 12655938, Chr1 position 16450525, Chr1 position 16450542, Chr1 position 16450545, Chr1 position 16469987, Chr1 position 17494491, Chr1 position 25473203, Chr1 position 27640460, Chr1 position 29565080, Chr1 position 38493013, Chr1 position 38493030, Chr1 position 38493074, Chr1 position 46713777, Chr1 position 46914121, Chr1 position 46955744, Chr1 position 55008344, Chr1 position 109816092, Chr1 position 109816111, Chr1 position 110074669, Chr1 position 110074681, Chr1 position 110074685, Chr1 position 150949856, Chr1 position 150949857, Chr1 position 153540282, Chr1 position 155162704, Chr1 position 155162714, Chr1 position 156676611, Chr1 position 157611881, Chr1 position 182205324, Chr1 position 204118999, Chr1 position 206741875, Chr1 position 206741989, Chr1 position 212587673, Chr1 position 212841198, Chr1 position 223403952, Chr1 position 233430972, Chr1 position 234342767, Chr2 position 3454277, Chr2 position 8793724, Chr2 position 20412441, Chr2 position 42329402, Chr2 position 42329494, Chr2 position 55289272, Chr2 position 65064865, Chr2 position 70823641, Chr2 position 73143689, Chr2 position 74454110, Chr2 position 122014529, Chr2 position 128158884, Chr2 position 128158910, Chr2 position 203114171, Chr2 position 218221671, Chr2 position 219745335, Chr2 position 238341465, Chr2 position 238341542, Chr2 position 238341546, Chr2 position 238774763, Chr3 position 13323642, Chr3 position 14180153, Chr3 position 45209073, Chr3 position 45209207, Chr3 position 52525100, Chr3 position 62589658, Chr3 position 65388317, Chr3 position 65388388, Chr3 position 73599302, Chr3 position 195636893, Chr3 position 197093846, Chr4 position 3743223, Chr4 position 5755716, Chr4 position 5755717, Chr4 position 5755728, Chr4 position 5755729, Chr4 position 5755734, Chr4 position 8372861, Chr4 position 57548289, Chr5 position 1118280, Chr5 position 34564389, Chr5 position 73871907, Chr5 position 78013596, Chr5 position 78013643, Chr5 position 137802650, Chr5 position 139051189, Chr5 position 167838221, Chr5 position 177541401, Chr5 position 180018672, Chr5 position 180101026, Chr6 position 3394325, Chr6 position 3887581, Chr6 position 7236568, Chr6 position 7728692, Chr6 position 34203617, Chr6 position 37751320, Chr6 position 41410682, Chr6 position 41438516, Chr6 position 41438575, Chr6 position 43464150, Chr6 position 158734279, Chr7 position 989235, Chr7 position 2673543, Chr7 position 73508602, Chr7 position 105079565, Chr7 position 105079631, Chr7 position 151425103, Chr7 position 151425104, Chr8 position 11764017, Chr8 position 21647308, Chr8 position 22548399, Chr8 position 22548483, Chr8 position 133570537, Chr8 position 141320393, Chr8 position 141320410, Chr9 position 6566568, Chr9 position 16197862, Chr9 position 34591313, Chr9 position 98225096, Chr9 position 126126741, Chr9 position 132083428, Chr9 position 136077410, Chr9 position 139655018, Chr9 position 140205985, Chr9 position 140205985, Chr9 position 140205997, Chr10 position 3929071, Chr10 position 30047012, Chr10 position 79702989, Chr10 position 87984905, Chr10 position 94838789, Chr10 position 102131187, Chr10 position 104196489, Chr10 position 111766879, Chr10 position 112258886, Chr10 position 112258984, Chr10 position 112259015, Chr10 position 116391763, Chr10 position 120011530, Chr10 position 126172714, Chr10 position 126172747, Chr11 position 556355, Chr11 position 821282, Chr11 position 12188937, Chr11 position 12188948, Chr11 position 12188995, Chr11 position 36057726, Chr11 position 48070143, Chr11 position 48070163, Chr11 position 48070166, Chr11 position 48070174, Chr11 position 65158294, Chr11 position 65158342, Chr11 position 65297089, Chr11 position 66104481, Chr11 position 66104485, Chr11 position 66104578, Chr11 position 68608767, Chr11 position 70236292, Chr11 position 70236320, Chr11 position 70236331, Chr11 position 115530032, Chr11 position 117950310, Chr11 position 117950329, Chr11 position 117950361, Chr11 position 117950362, Chr11 position 119293593, Chr12 position 679803, Chr12 position 26039132, Chr12 position 31004558, Chr12 position 45610695, Chr12 position 45610701, Chr12 position 45610702, Chr12 position 45610706, Chr12 position 50286016, Chr12 position 52243258, Chr12 position 52243286, Chr12 position 54145732, Chr12 position 54145741, Chr12 position 54145825, Chr12 position 56115043, Chr12 position 66262229, Chr12 position 66262230, Chr12 position 66262233, Chr12 position 66262234, Chr12 position 77266621, Chr12 position 117580102, Chr12 position 123435962, Chr12 position 123436011, Chr12 position 123436065, Chr12 position 123540893, Chr13 position 20735797, Chr13 position 23500419, Chr13 position 46771519, Chr13 position 46771520, Chr13 position 53313426, Chr13 position 113807393, Chr14 position 38599118, Chr14 position 69170010, Chr14 position 75701632, Chr14 position 75701643, Chr14 position 90850454, Chr14 position 97524282, Chr14 position 103541602, Chr14 position 103768055, Chr14 position 104209000, Chr14 position 104209068, Chr14 position 104354645, Chr14 position 104360487, Chr15 position 41068807, Chr15 position 61152225, Chr15 position 61152253, Chr15 position 61152313, Chr15 position 65186440, Chr15 position 68851629, Chr15 position 70667596, Chr15 position 70767206, Chr15 position 75251486, Chr15 position 77984014, Chr15 position 77989064, Chr15 position 83952081, Chr15 position 85402496, Chr15 position 85402497, Chr15 position 99417337, Chr16 position 1231873, Chr16 position 1458639, Chr16 position 3023231, Chr16 position 23135832, Chr16 position 29616265, Chr16 position 31009547, Chr16 position 31009548, Chr16 position 31009590, Chr16 position 57793674, Chr16 position 57793715, Chr16 position 57793727, Chr16 position 70771056, Chr16 position 70771079, Chr16 position 70771141, Chr16 position 77332010, Chr16 position 78540378, Chr16 position 79333435, Chr16 position 84262419, Chr16 position 88701114, Chr16 position 89988308, Chr16 position 89988644, Chr17 position 1509928, Chr17 position 1509945, Chr17 position 1509952, Chr17 position 1509953, Chr17 position 7644013, Chr17 position 16323460, Chr17 position 16323473, Chr17 position 16924561, Chr17 position 16924562, Chr17 position 16924594, Chr17 position 17717918, Chr17 position 17718591, Chr17 position 18139506, Chr17 position 35278031, Chr17 position 39677570, Chr17 position 40826257, Chr17 position 43037426, Chr17 position 43200096, Chr17 position 43200239, Chr17 position 43510142, Chr17 position 47987828, Chr17 position 48178379, Chr17 position 48596391, Chr17 position 48764165, Chr17 position 55701962, Chr17 position 73584599, Chr17 position 73993165, Chr17 position 75827716, Chr17 position 76882243, Chr17 position 78765910, Chr17 position 79544478, Chr17 position 80696474, Chr18 position 19751759, Chr18 position 21440760, Chr18 position 45555437, Chr18 position 45555438, Chr18 position 46547891, Chr18 position 55888885, Chr18 position 56452096, Chr18 position 56452476, Chr18 position 56887181, Chr18 position 76002973, Chr18 position 77331090, Chr19 position 677895, Chr19 position 884044, Chr19 position 884059, Chr19 position 884105, Chr19 position 884115, Chr19 position 1136511, Chr19 position 1177605, Chr19 position 1177612, Chr19 position 1177640, Chr19 position 1860601, Chr19 position 1860607, Chr19 position 2503954, Chr19 position 3434917, Chr19 position 3434921, Chr19 position 3434930, Chr19 position 3434939, Chr19 position 3434952, Chr19 position 3434954, Chr19 position 3434962, Chr19 position 3434964, Chr19 position 3434979, Chr19 position 3434985, Chr19 position 4052713, Chr19 position 4052714, Chr19 position 4052749, Chr19 position 4374591, Chr19 position 5013982, Chr19 position 5048836, Chr19 position 5048867, Chr19 position 5048877, Chr19 position 8367279, Chr19 position 8428573, Chr19 position 10254577, Chr19 position 10254578, Chr19 position 10463956, Chr19 position 10464137, Chr19 position 13203671, Chr19 position 13266925, Chr19 position 13266934, Chr19 position 13266970, Chr19 position 13842142, Chr19 position 14248494, Chr19 position 15375465, Chr19 position 17218912, Chr19 position 17346702, Chr19 position 17346702, Chr19 position 18157161, Chr19 position 18157221, Chr19 position 18157258, Chr19 position 18415877, Chr19 position 18415890, Chr19 position 30606642, Chr19 position 35531842, Chr19 position 44303112, Chr19 position 47173037, Chr19 position 47316268, Chr19 position 47778278, Chr19 position 47778298, Chr20 position 34206950, Chr20 position 36771969, Chr20 position 48993661, Chr20 position 58406398, Chr20 position 61976049, Chr20 position 61976073, Chr20 position 62588571, Chr20 position 62588579, Chr22 position 19738127, Chr22 position 35965176, Chr22 position 36549809, Chr22 position 36973375, Chr22 position 37447953, Chr22 position 37914998, Chr22 position 38307317, Chr22 position 39662794, and Chr22 position 45622980.

In embodiments, the method includes detecting methylation or unmethylation of at least 5 of the following sites: Chr1 position 2996653, Chr1 position 11979164, Chr1 position 12655938, Chr1 position 16450525, Chr1 position 16450542, Chr1 position 16450545, Chr1 position 16469987, Chr1 position 17494491, Chr1 position 25473203, Chr1 position 27640460, Chr1 position 29565080, Chr1 position 38493013, Chr1 position 38493030, Chr1 position 38493074, Chr1 position 46713777, Chr1 position 46914121, Chr1 position 46955744, Chr1 position 55008344, Chr1 position 109816092, Chr1 position 109816111, Chr1 position 110074669, Chr1 position 110074681, Chr1 position 110074685, Chr1 position 150949856, Chr1 position 150949857, Chr1 position 153540282, Chr1 position 155162704, Chr1 position 155162714, Chr1 position 156676611, Chr1 position 157611881, Chr1 position 182205324, Chr1 position 204118999, Chr1 position 206741875, Chr1 position 206741989, Chr1 position 212587673, Chr1 position 212841198, Chr1 position 223403952, Chr1 position 233430972, Chr1 position 234342767, Chr2 position 3454277, Chr2 position 8793724, Chr2 position 20412441, Chr2 position 42329402, Chr2 position 42329494, Chr2 position 55289272, Chr2 position 65064865, Chr2 position 70823641, Chr2 position 73143689, Chr2 position 74454110, Chr2 position 122014529, Chr2 position 128158884, Chr2 position 128158910, Chr2 position 203114171, Chr2 position 218221671, Chr2 position 219745335, Chr2 position 238341465, Chr2 position 238341542, Chr2 position 238341546, Chr2 position 238774763, Chr3 position 13323642, Chr3 position 14180153, Chr3 position 45209073, Chr3 position 45209207, Chr3 position 52525100, Chr3 position 62589658, Chr3 position 65388317, Chr3 position 65388388, Chr3 position 73599302, Chr3 position 195636893, Chr3 position 197093846, Chr4 position 3743223, Chr4 position 5755716, Chr4 position 5755717, Chr4 position 5755728, Chr4 position 5755729, Chr4 position 5755734, Chr4 position 8372861, Chr4 position 57548289, Chr5 position 1118280, Chr5 position 34564389, Chr5 position 73871907, Chr5 position 78013596, Chr5 position 78013643, Chr5 position 137802650, Chr5 position 139051189, Chr5 position 167838221, Chr5 position 177541401, Chr5 position 180018672, Chr5 position 180101026, Chr6 position 3394325, Chr6 position 3887581, Chr6 position 7236568, Chr6 position 7728692, Chr6 position 34203617, Chr6 position 37751320, Chr6 position 41410682, Chr6 position 41438516, Chr6 position 41438575, Chr6 position 43464150, Chr6 position 158734279, Chr7 position 989235, Chr7 position 2673543, Chr7 position 73508602, Chr7 position 105079565, Chr7 position 105079631, Chr7 position 151425103, Chr7 position 151425104, Chr8 position 11764017, Chr8 position 21647308, Chr8 position 22548399, Chr8 position 22548483, Chr8 position 133570537, Chr8 position 141320393, Chr8 position 141320410, Chr9 position 6566568, Chr9 position 16197862, Chr9 position 34591313, Chr9 position 98225096, Chr9 position 126126741, Chr9 position 132083428, Chr9 position 136077410, Chr9 position 139655018, Chr9 position 140205985, Chr9 position 140205985, Chr9 position 140205997, Chr10 position 3929071, Chr10 position 30047012, Chr10 position 79702989, Chr10 position 87984905, Chr10 position 94838789, Chr10 position 102131187, Chr10 position 104196489, Chr10 position 111766879, Chr10 position 112258886, Chr10 position 112258984, Chr10 position 112259015, Chr10 position 116391763, Chr10 position 120011530, Chr10 position 126172714, Chr10 position 126172747, Chr11 position 556355, Chr11 position 821282, Chr11 position 12188937, Chr11 position 12188948, Chr11 position 12188995, Chr11 position 36057726, Chr11 position 48070143, Chr11 position 48070163, Chr11 position 48070166, Chr11 position 48070174, Chr11 position 65158294, Chr11 position 65158342, Chr11 position 65297089, Chr11 position 66104481, Chr11 position 66104485, Chr11 position 66104578, Chr11 position 68608767, Chr11 position 70236292, Chr11 position 70236320, Chr11 position 70236331, Chr11 position 115530032, Chr11 position 117950310, Chr11 position 117950329, Chr11 position 117950361, Chr11 position 117950362, Chr11 position 119293593, Chr12 position 679803, Chr12 position 26039132, Chr12 position 31004558, Chr12 position 45610695, Chr12 position 45610701, Chr12 position 45610702, Chr12 position 45610706, Chr12 position 50286016, Chr12 position 52243258, Chr12 position 52243286, Chr12 position 54145732, Chr12 position 54145741, Chr12 position 54145825, Chr12 position 56115043, Chr12 position 66262229, Chr12 position 66262230, Chr12 position 66262233, Chr12 position 66262234, Chr12 position 77266621, Chr12 position 117580102, Chr12 position 123435962, Chr12 position 123436011, Chr12 position 123436065, Chr12 position 123540893, Chr13 position 20735797, Chr13 position 23500419, Chr13 position 46771519, Chr13 position 46771520, Chr13 position 53313426, Chr13 position 113807393, Chr14 position 38599118, Chr14 position 69170010, Chr14 position 75701632, Chr14 position 75701643, Chr14 position 90850454, Chr14 position 97524282, Chr14 position 103541602, Chr14 position 103768055, Chr14 position 104209000, Chr14 position 104209068, Chr14 position 104354645, Chr14 position 104360487, Chr15 position 41068807, Chr15 position 61152225, Chr15 position 61152253, Chr15 position 61152313, Chr15 position 65186440, Chr15 position 68851629, Chr15 position 70667596, Chr15 position 70767206, Chr15 position 75251486, Chr15 position 77984014, Chr15 position 77989064, Chr15 position 83952081, Chr15 position 85402496, Chr15 position 85402497, Chr15 position 99417337, Chr16 position 1231873, Chr16 position 1458639, Chr16 position 3023231, Chr16 position 23135832, Chr16 position 29616265, Chr16 position 31009547, Chr16 position 31009548, Chr16 position 31009590, Chr16 position 57793674, Chr16 position 57793715, Chr16 position 57793727, Chr16 position 70771056, Chr16 position 70771079, Chr16 position 70771141, Chr16 position 77332010, Chr16 position 78540378, Chr16 position 79333435, Chr16 position 84262419, Chr16 position 88701114, Chr16 position 89988308, Chr16 position 89988644, Chr17 position 1509928, Chr17 position 1509945, Chr17 position 1509952, Chr17 position 1509953, Chr17 position 7644013, Chr17 position 16323460, Chr17 position 16323473, Chr17 position 16924561, Chr17 position 16924562, Chr17 position 16924594, Chr17 position 17717918, Chr17 position 17718591, Chr17 position 18139506, Chr17 position 35278031, Chr17 position 39677570, Chr17 position 40826257, Chr17 position 43037426, Chr17 position 43200096, Chr17 position 43200239, Chr17 position 43510142, Chr17 position 47987828, Chr17 position 48178379, Chr17 position 48596391, Chr17 position 48764165, Chr17 position 55701962, Chr17 position 73584599, Chr17 position 73993165, Chr17 position 75827716, Chr17 position 76882243, Chr17 position 78765910, Chr17 position 79544478, Chr17 position 80696474, Chr18 position 19751759, Chr18 position 21440760, Chr18 position 45555437, Chr18 position 45555438, Chr18 position 46547891, Chr18 position 55888885, Chr18 position 56452096, Chr18 position 56452476, Chr18 position 56887181, Chr18 position 76002973, Chr18 position 77331090, Chr19 position 677895, Chr19 position 884044, Chr19 position 884059, Chr19 position 884105, Chr19 position 884115, Chr19 position 1136511, Chr19 position 1177605, Chr19 position 1177612, Chr19 position 1177640, Chr19 position 1860601, Chr19 position 1860607, Chr19 position 2503954, Chr19 position 3434917, Chr19 position 3434921, Chr19 position 3434930, Chr19 position 3434939, Chr19 position 3434952, Chr19 position 3434954, Chr19 position 3434962, Chr19 position 3434964, Chr19 position 3434979, Chr19 position 3434985, Chr19 position 4052713, Chr19 position 4052714, Chr19 position 4052749, Chr19 position 4374591, Chr19 position 5013982, Chr19 position 5048836, Chr19 position 5048867, Chr19 position 5048877, Chr19 position 8367279, Chr19 position 8428573, Chr19 position 10254577, Chr19 position 10254578, Chr19 position 10463956, Chr19 position 10464137, Chr19 position 13203671, Chr19 position 13266925, Chr19 position 13266934, Chr19 position 13266970, Chr19 position 13842142, Chr19 position 14248494, Chr19 position 15375465, Chr19 position 17218912, Chr19 position 17346702, Chr19 position 17346702, Chr19 position 18157161, Chr19 position 18157221, Chr19 position 18157258, Chr19 position 18415877, Chr19 position 18415890, Chr19 position 30606642, Chr19 position 35531842, Chr19 position 44303112, Chr19 position 47173037, Chr19 position 47316268, Chr19 position 47778278, Chr19 position 47778298, Chr20 position 34206950, Chr20 position 36771969, Chr20 position 48993661, Chr20 position 58406398, Chr20 position 61976049, Chr20 position 61976073, Chr20 position 62588571, Chr20 position 62588579, Chr22 position 19738127, Chr22 position 35965176, Chr22 position 36549809, Chr22 position 36973375, Chr22 position 37447953, Chr22 position 37914998, Chr22 position 38307317, Chr22 position 39662794, and Chr22 position 45622980.

In embodiments, the method includes detecting methylation or unmethylation of at least 6 of the following sites: Chr1 position 2996653, Chr1 position 11979164, Chr1 position 12655938, Chr1 position 16450525, Chr1 position 16450542, Chr1 position 16450545, Chr1 position 16469987, Chr1 position 17494491, Chr1 position 25473203, Chr1 position 27640460, Chr1 position 29565080, Chr1 position 38493013, Chr1 position 38493030, Chr1 position 38493074, Chr1 position 46713777, Chr1 position 46914121, Chr1 position 46955744, Chr1 position 55008344, Chr1 position 109816092, Chr1 position 109816111, Chr1 position 110074669, Chr1 position 110074681, Chr1 position 110074685, Chr1 position 150949856, Chr1 position 150949857, Chr1 position 153540282, Chr1 position 155162704, Chr1 position 155162714, Chr1 position 156676611, Chr1 position 157611881, Chr1 position 182205324, Chr1 position 204118999, Chr1 position 206741875, Chr1 position 206741989, Chr1 position 212587673, Chr1 position 212841198, Chr1 position 223403952, Chr1 position 233430972, Chr1 position 234342767, Chr2 position 3454277, Chr2 position 8793724, Chr2 position 20412441, Chr2 position 42329402, Chr2 position 42329494, Chr2 position 55289272, Chr2 position 65064865, Chr2 position 70823641, Chr2 position 73143689, Chr2 position 74454110, Chr2 position 122014529, Chr2 position 128158884, Chr2 position 128158910, Chr2 position 203114171, Chr2 position 218221671, Chr2 position 219745335, Chr2 position 238341465, Chr2 position 238341542, Chr2 position 238341546, Chr2 position 238774763, Chr3 position 13323642, Chr3 position 14180153, Chr3 position 45209073, Chr3 position 45209207, Chr3 position 52525100, Chr3 position 62589658, Chr3 position 65388317, Chr3 position 65388388, Chr3 position 73599302, Chr3 position 195636893, Chr3 position 197093846, Chr4 position 3743223, Chr4 position 5755716, Chr4 position 5755717, Chr4 position 5755728, Chr4 position 5755729, Chr4 position 5755734, Chr4 position 8372861, Chr4 position 57548289, Chr5 position 1118280, Chr5 position 34564389, Chr5 position 73871907, Chr5 position 78013596, Chr5 position 78013643, Chr5 position 137802650, Chr5 position 139051189, Chr5 position 167838221, Chr5 position 177541401, Chr5 position 180018672, Chr5 position 180101026, Chr6 position 3394325, Chr6 position 3887581, Chr6 position 7236568, Chr6 position 7728692, Chr6 position 34203617, Chr6 position 37751320, Chr6 position 41410682, Chr6 position 41438516, Chr6 position 41438575, Chr6 position 43464150, Chr6 position 158734279, Chr7 position 989235, Chr7 position 2673543, Chr7 position 73508602, Chr7 position 105079565, Chr7 position 105079631, Chr7 position 151425103, Chr7 position 151425104, Chr8 position 11764017, Chr8 position 21647308, Chr8 position 22548399, Chr8 position 22548483, Chr8 position 133570537, Chr8 position 141320393, Chr8 position 141320410, Chr9 position 6566568, Chr9 position 16197862, Chr9 position 34591313, Chr9 position 98225096, Chr9 position 126126741, Chr9 position 132083428, Chr9 position 136077410, Chr9 position 139655018, Chr9 position 140205985, Chr9 position 140205985, Chr9 position 140205997, Chr10 position 3929071, Chr10 position 30047012, Chr10 position 79702989, Chr10 position 87984905, Chr10 position 94838789, Chr10 position 102131187, Chr10 position 104196489, Chr10 position 111766879, Chr10 position 112258886, Chr10 position 112258984, Chr10 position 112259015, Chr10 position 116391763, Chr10 position 120011530, Chr10 position 126172714, Chr10 position 126172747, Chr11 position 556355, Chr11 position 821282, Chr11 position 12188937, Chr11 position 12188948, Chr11 position 12188995, Chr11 position 36057726, Chr11 position 48070143, Chr11 position 48070163, Chr11 position 48070166, Chr11 position 48070174, Chr11 position 65158294, Chr11 position 65158342, Chr11 position 65297089, Chr11 position 66104481, Chr11 position 66104485, Chr11 position 66104578, Chr11 position 68608767, Chr11 position 70236292, Chr11 position 70236320, Chr11 position 70236331, Chr11 position 115530032, Chr11 position 117950310, Chr11 position 117950329, Chr11 position 117950361, Chr11 position 117950362, Chr11 position 119293593, Chr12 position 679803, Chr12 position 26039132, Chr12 position 31004558, Chr12 position 45610695, Chr12 position 45610701, Chr12 position 45610702, Chr12 position 45610706, Chr12 position 50286016, Chr12 position 52243258, Chr12 position 52243286, Chr12 position 54145732, Chr12 position 54145741, Chr12 position 54145825, Chr12 position 56115043, Chr12 position 66262229, Chr12 position 66262230, Chr12 position 66262233, Chr12 position 66262234, Chr12 position 77266621, Chr12 position 117580102, Chr12 position 123435962, Chr12 position 123436011, Chr12 position 123436065, Chr12 position 123540893, Chr13 position 20735797, Chr13 position 23500419, Chr13 position 46771519, Chr13 position 46771520, Chr13 position 53313426, Chr13 position 113807393, Chr14 position 38599118, Chr14 position 69170010, Chr14 position 75701632, Chr14 position 75701643, Chr14 position 90850454, Chr14 position 97524282, Chr14 position 103541602, Chr14 position 103768055, Chr14 position 104209000, Chr14 position 104209068, Chr14 position 104354645, Chr14 position 104360487, Chr15 position 41068807, Chr15 position 61152225, Chr15 position 61152253, Chr15 position 61152313, Chr15 position 65186440, Chr15 position 68851629, Chr15 position 70667596, Chr15 position 70767206, Chr15 position 75251486, Chr15 position 77984014, Chr15 position 77989064, Chr15 position 83952081, Chr15 position 85402496, Chr15 position 85402497, Chr15 position 99417337, Chr16 position 1231873, Chr16 position 1458639, Chr16 position 3023231, Chr16 position 23135832, Chr16 position 29616265, Chr16 position 31009547, Chr16 position 31009548, Chr16 position 31009590, Chr16 position 57793674, Chr16 position 57793715, Chr16 position 57793727, Chr16 position 70771056, Chr16 position 70771079, Chr16 position 70771141, Chr16 position 77332010, Chr16 position 78540378, Chr16 position 79333435, Chr16 position 84262419, Chr16 position 88701114, Chr16 position 89988308, Chr16 position 89988644, Chr17 position 1509928, Chr17 position 1509945, Chr17 position 1509952, Chr17 position 1509953, Chr17 position 7644013, Chr17 position 16323460, Chr17 position 16323473, Chr17 position 16924561, Chr17 position 16924562, Chr17 position 16924594, Chr17 position 17717918, Chr17 position 17718591, Chr17 position 18139506, Chr17 position 35278031, Chr17 position 39677570, Chr17 position 40826257, Chr17 position 43037426, Chr17 position 43200096, Chr17 position 43200239, Chr17 position 43510142, Chr17 position 47987828, Chr17 position 48178379, Chr17 position 48596391, Chr17 position 48764165, Chr17 position 55701962, Chr17 position 73584599, Chr17 position 73993165, Chr17 position 75827716, Chr17 position 76882243, Chr17 position 78765910, Chr17 position 79544478, Chr17 position 80696474, Chr18 position 19751759, Chr18 position 21440760, Chr18 position 45555437, Chr18 position 45555438, Chr18 position 46547891, Chr18 position 55888885, Chr18 position 56452096, Chr18 position 56452476, Chr18 position 56887181, Chr18 position 76002973, Chr18 position 77331090, Chr19 position 677895, Chr19 position 884044, Chr19 position 884059, Chr19 position 884105, Chr19 position 884115, Chr19 position 1136511, Chr19 position 1177605, Chr19 position 1177612, Chr19 position 1177640, Chr19 position 1860601, Chr19 position 1860607, Chr19 position 2503954, Chr19 position 3434917, Chr19 position 3434921, Chr19 position 3434930, Chr19 position 3434939, Chr19 position 3434952, Chr19 position 3434954, Chr19 position 3434962, Chr19 position 3434964, Chr19 position 3434979, Chr19 position 3434985, Chr19 position 4052713, Chr19 position 4052714, Chr19 position 4052749, Chr19 position 4374591, Chr19 position 5013982, Chr19 position 5048836, Chr19 position 5048867, Chr19 position 5048877, Chr19 position 8367279, Chr19 position 8428573, Chr19 position 10254577, Chr19 position 10254578, Chr19 position 10463956, Chr19 position 10464137, Chr19 position 13203671, Chr19 position 13266925, Chr19 position 13266934, Chr19 position 13266970, Chr19 position 13842142, Chr19 position 14248494, Chr19 position 15375465, Chr19 position 17218912, Chr19 position 17346702, Chr19 position 17346702, Chr19 position 18157161, Chr19 position 18157221, Chr19 position 18157258, Chr19 position 18415877, Chr19 position 18415890, Chr19 position 30606642, Chr19 position 35531842, Chr19 position 44303112, Chr19 position 47173037, Chr19 position 47316268, Chr19 position 47778278, Chr19 position 47778298, Chr20 position 34206950, Chr20 position 36771969, Chr20 position 48993661, Chr20 position 58406398, Chr20 position 61976049, Chr20 position 61976073, Chr20 position 62588571, Chr20 position 62588579, Chr22 position 19738127, Chr22 position 35965176, Chr22 position 36549809, Chr22 position 36973375, Chr22 position 37447953, Chr22 position 37914998, Chr22 position 38307317, Chr22 position 39662794, and Chr22 position 45622980.

In embodiments, the method includes detecting methylation or unmethylation of at least 7 of the following sites: Chr1 position 2996653, Chr1 position 11979164, Chr1 position 12655938, Chr1 position 16450525, Chr1 position 16450542, Chr1 position 16450545, Chr1 position 16469987, Chr1 position 17494491, Chr1 position 25473203, Chr1 position 27640460, Chr1 position 29565080, Chr1 position 38493013, Chr1 position 38493030, Chr1 position 38493074, Chr1 position 46713777, Chr1 position 46914121, Chr1 position 46955744, Chr1 position 55008344, Chr1 position 109816092, Chr1 position 109816111, Chr1 position 110074669, Chr1 position 110074681, Chr1 position 110074685, Chr1 position 150949856, Chr1 position 150949857, Chr1 position 153540282, Chr1 position 155162704, Chr1 position 155162714, Chr1 position 156676611, Chr1 position 157611881, Chr1 position 182205324, Chr1 position 204118999, Chr1 position 206741875, Chr1 position 206741989, Chr1 position 212587673, Chr1 position 212841198, Chr1 position 223403952, Chr1 position 233430972, Chr1 position 234342767, Chr2 position 3454277, Chr2 position 8793724, Chr2 position 20412441, Chr2 position 42329402, Chr2 position 42329494, Chr2 position 55289272, Chr2 position 65064865, Chr2 position 70823641, Chr2 position 73143689, Chr2 position 74454110, Chr2 position 122014529, Chr2 position 128158884, Chr2 position 128158910, Chr2 position 203114171, Chr2 position 218221671, Chr2 position 219745335, Chr2 position 238341465, Chr2 position 238341542, Chr2 position 238341546, Chr2 position 238774763, Chr3 position 13323642, Chr3 position 14180153, Chr3 position 45209073, Chr3 position 45209207, Chr3 position 52525100, Chr3 position 62589658, Chr3 position 65388317, Chr3 position 65388388, Chr3 position 73599302, Chr3 position 195636893, Chr3 position 197093846, Chr4 position 3743223, Chr4 position 5755716, Chr4 position 5755717, Chr4 position 5755728, Chr4 position 5755729, Chr4 position 5755734, Chr4 position 8372861, Chr4 position 57548289, Chr5 position 1118280, Chr5 position 34564389, Chr5 position 73871907, Chr5 position 78013596, Chr5 position 78013643, Chr5 position 137802650, Chr5 position 139051189, Chr5 position 167838221, Chr5 position 177541401, Chr5 position 180018672, Chr5 position 180101026, Chr6 position 3394325, Chr6 position 3887581, Chr6 position 7236568, Chr6 position 7728692, Chr6 position 34203617, Chr6 position 37751320, Chr6 position 41410682, Chr6 position 41438516, Chr6 position 41438575, Chr6 position 43464150, Chr6 position 158734279, Chr7 position 989235, Chr7 position 2673543, Chr7 position 73508602, Chr7 position 105079565, Chr7 position 105079631, Chr7 position 151425103, Chr7 position 151425104, Chr8 position 11764017, Chr8 position 21647308, Chr8 position 22548399, Chr8 position 22548483, Chr8 position 133570537, Chr8 position 141320393, Chr8 position 141320410, Chr9 position 6566568, Chr9 position 16197862, Chr9 position 34591313, Chr9 position 98225096, Chr9 position 126126741, Chr9 position 132083428, Chr9 position 136077410, Chr9 position 139655018, Chr9 position 140205985, Chr9 position 140205985, Chr9 position 140205997, Chr10 position 3929071, Chr10 position 30047012, Chr10 position 79702989, Chr10 position 87984905, Chr10 position 94838789, Chr10 position 102131187, Chr10 position 104196489, Chr10 position 111766879, Chr10 position 112258886, Chr10 position 112258984, Chr10 position 112259015, Chr10 position 116391763, Chr10 position 120011530, Chr10 position 126172714, Chr10 position 126172747, Chr11 position 556355, Chr11 position 821282, Chr11 position 12188937, Chr11 position 12188948, Chr11 position 12188995, Chr11 position 36057726, Chr11 position 48070143, Chr11 position 48070163, Chr11 position 48070166, Chr11 position 48070174, Chr11 position 65158294, Chr11 position 65158342, Chr11 position 65297089, Chr11 position 66104481, Chr11 position 66104485, Chr11 position 66104578, Chr11 position 68608767, Chr11 position 70236292, Chr11 position 70236320, Chr11 position 70236331, Chr11 position 115530032, Chr11 position 117950310, Chr11 position 117950329, Chr11 position 117950361, Chr11 position 117950362, Chr11 position 119293593, Chr12 position 679803, Chr12 position 26039132, Chr12 position 31004558, Chr12 position 45610695, Chr12 position 45610701, Chr12 position 45610702, Chr12 position 45610706, Chr12 position 50286016, Chr12 position 52243258, Chr12 position 52243286, Chr12 position 54145732, Chr12 position 54145741, Chr12 position 54145825, Chr12 position 56115043, Chr12 position 66262229, Chr12 position 66262230, Chr12 position 66262233, Chr12 position 66262234, Chr12 position 77266621, Chr12 position 117580102, Chr12 position 123435962, Chr12 position 123436011, Chr12 position 123436065, Chr12 position 123540893, Chr13 position 20735797, Chr13 position 23500419, Chr13 position 46771519, Chr13 position 46771520, Chr13 position 53313426, Chr13 position 113807393, Chr14 position 38599118, Chr14 position 69170010, Chr14 position 75701632, Chr14 position 75701643, Chr14 position 90850454, Chr14 position 97524282, Chr14 position 103541602, Chr14 position 103768055, Chr14 position 104209000, Chr14 position 104209068, Chr14 position 104354645, Chr14 position 104360487, Chr15 position 41068807, Chr15 position 61152225, Chr15 position 61152253, Chr15 position 61152313, Chr15 position 65186440, Chr15 position 68851629, Chr15 position 70667596, Chr15 position 70767206, Chr15 position 75251486, Chr15 position 77984014, Chr15 position 77989064, Chr15 position 83952081, Chr15 position 85402496, Chr15 position 85402497, Chr15 position 99417337, Chr16 position 1231873, Chr16 position 1458639, Chr16 position 3023231, Chr16 position 23135832, Chr16 position 29616265, Chr16 position 31009547, Chr16 position 31009548, Chr16 position 31009590, Chr16 position 57793674, Chr16 position 57793715, Chr16 position 57793727, Chr16 position 70771056, Chr16 position 70771079, Chr16 position 70771141, Chr16 position 77332010, Chr16 position 78540378, Chr16 position 79333435, Chr16 position 84262419, Chr16 position 88701114, Chr16 position 89988308, Chr16 position 89988644, Chr17 position 1509928, Chr17 position 1509945, Chr17 position 1509952, Chr17 position 1509953, Chr17 position 7644013, Chr17 position 16323460, Chr17 position 16323473, Chr17 position 16924561, Chr17 position 16924562, Chr17 position 16924594, Chr17 position 17717918, Chr17 position 17718591, Chr17 position 18139506, Chr17 position 35278031, Chr17 position 39677570, Chr17 position 40826257, Chr17 position 43037426, Chr17 position 43200096, Chr17 position 43200239, Chr17 position 43510142, Chr17 position 47987828, Chr17 position 48178379, Chr17 position 48596391, Chr17 position 48764165, Chr17 position 55701962, Chr17 position 73584599, Chr17 position 73993165, Chr17 position 75827716, Chr17 position 76882243, Chr17 position 78765910, Chr17 position 79544478, Chr17 position 80696474, Chr18 position 19751759, Chr18 position 21440760, Chr18 position 45555437, Chr18 position 45555438, Chr18 position 46547891, Chr18 position 55888885, Chr18 position 56452096, Chr18 position 56452476, Chr18 position 56887181, Chr18 position 76002973, Chr18 position 77331090, Chr19 position 677895, Chr19 position 884044, Chr19 position 884059, Chr19 position 884105, Chr19 position 884115, Chr19 position 1136511, Chr19 position 1177605, Chr19 position 1177612, Chr19 position 1177640, Chr19 position 1860601, Chr19 position 1860607, Chr19 position 2503954, Chr19 position 3434917, Chr19 position 3434921, Chr19 position 3434930, Chr19 position 3434939, Chr19 position 3434952, Chr19 position 3434954, Chr19 position 3434962, Chr19 position 3434964, Chr19 position 3434979, Chr19 position 3434985, Chr19 position 4052713, Chr19 position 4052714, Chr19 position 4052749, Chr19 position 4374591, Chr19 position 5013982, Chr19 position 5048836, Chr19 position 5048867, Chr19 position 5048877, Chr19 position 8367279, Chr19 position 8428573, Chr19 position 10254577, Chr19 position 10254578, Chr19 position 10463956, Chr19 position 10464137, Chr19 position 13203671, Chr19 position 13266925, Chr19 position 13266934, Chr19 position 13266970, Chr19 position 13842142, Chr19 position 14248494, Chr19 position 15375465, Chr19 position 17218912, Chr19 position 17346702, Chr19 position 17346702, Chr19 position 18157161, Chr19 position 18157221, Chr19 position 18157258, Chr19 position 18415877, Chr19 position 18415890, Chr19 position 30606642, Chr19 position 35531842, Chr19 position 44303112, Chr19 position 47173037, Chr19 position 47316268, Chr19 position 47778278, Chr19 position 47778298, Chr20 position 34206950, Chr20 position 36771969, Chr20 position 48993661, Chr20 position 58406398, Chr20 position 61976049, Chr20 position 61976073, Chr20 position 62588571, Chr20 position 62588579, Chr22 position 19738127, Chr22 position 35965176, Chr22 position 36549809, Chr22 position 36973375, Chr22 position 37447953, Chr22 position 37914998, Chr22 position 38307317, Chr22 position 39662794, and Chr22 position 45622980.

In embodiments, the method includes detecting methylation or unmethylation of at least 8 of the following sites: Chr1 position 2996653, Chr1 position 11979164, Chr1 position 12655938, Chr1 position 16450525, Chr1 position 16450542, Chr1 position 16450545, Chr1 position 16469987, Chr1 position 17494491, Chr1 position 25473203, Chr1 position 27640460, Chr1 position 29565080, Chr1 position 38493013, Chr1 position 38493030, Chr1 position 38493074, Chr1 position 46713777, Chr1 position 46914121, Chr1 position 46955744, Chr1 position 55008344, Chr1 position 109816092, Chr1 position 109816111, Chr1 position 110074669, Chr1 position 110074681, Chr1 position 110074685, Chr1 position 150949856, Chr1 position 150949857, Chr1 position 153540282, Chr1 position 155162704, Chr1 position 155162714, Chr1 position 156676611, Chr1 position 157611881, Chr1 position 182205324, Chr1 position 204118999, Chr1 position 206741875, Chr1 position 206741989, Chr1 position 212587673, Chr1 position 212841198, Chr1 position 223403952, Chr1 position 233430972, Chr1 position 234342767, Chr2 position 3454277, Chr2 position 8793724, Chr2 position 20412441, Chr2 position 42329402, Chr2 position 42329494, Chr2 position 55289272, Chr2 position 65064865, Chr2 position 70823641, Chr2 position 73143689, Chr2 position 74454110, Chr2 position 122014529, Chr2 position 128158884, Chr2 position 128158910, Chr2 position 203114171, Chr2 position 218221671, Chr2 position 219745335, Chr2 position 238341465, Chr2 position 238341542, Chr2 position 238341546, Chr2 position 238774763, Chr3 position 13323642, Chr3 position 14180153, Chr3 position 45209073, Chr3 position 45209207, Chr3 position 52525100, Chr3 position 62589658, Chr3 position 65388317, Chr3 position 65388388, Chr3 position 73599302, Chr3 position 195636893, Chr3 position 197093846, Chr4 position 3743223, Chr4 position 5755716, Chr4 position 5755717, Chr4 position 5755728, Chr4 position 5755729, Chr4 position 5755734, Chr4 position 8372861, Chr4 position 57548289, Chr5 position 1118280, Chr5 position 34564389, Chr5 position 73871907, Chr5 position 78013596, Chr5 position 78013643, Chr5 position 137802650, Chr5 position 139051189, Chr5 position 167838221, Chr5 position 177541401, Chr5 position 180018672, Chr5 position 180101026, Chr6 position 3394325, Chr6 position 3887581, Chr6 position 7236568, Chr6 position 7728692, Chr6 position 34203617, Chr6 position 37751320, Chr6 position 41410682, Chr6 position 41438516, Chr6 position 41438575, Chr6 position 43464150, Chr6 position 158734279, Chr7 position 989235, Chr7 position 2673543, Chr7 position 73508602, Chr7 position 105079565, Chr7 position 105079631, Chr7 position 151425103, Chr7 position 151425104, Chr8 position 11764017, Chr8 position 21647308, Chr8 position 22548399, Chr8 position 22548483, Chr8 position 133570537, Chr8 position 141320393, Chr8 position 141320410, Chr9 position 6566568, Chr9 position 16197862, Chr9 position 34591313, Chr9 position 98225096, Chr9 position 126126741, Chr9 position 132083428, Chr9 position 136077410, Chr9 position 139655018, Chr9 position 140205985, Chr9 position 140205985, Chr9 position 140205997, Chr10 position 3929071, Chr10 position 30047012, Chr10 position 79702989, Chr10 position 87984905, Chr10 position 94838789, Chr10 position 102131187, Chr10 position 104196489, Chr10 position 111766879, Chr10 position 112258886, Chr10 position 112258984, Chr10 position 112259015, Chr10 position 116391763, Chr10 position 120011530, Chr10 position 126172714, Chr10 position 126172747, Chr11 position 556355, Chr11 position 821282, Chr11 position 12188937, Chr11 position 12188948, Chr11 position 12188995, Chr11 position 36057726, Chr11 position 48070143, Chr11 position 48070163, Chr11 position 48070166, Chr11 position 48070174, Chr11 position 65158294, Chr11 position 65158342, Chr11 position 65297089, Chr11 position 66104481, Chr11 position 66104485, Chr11 position 66104578, Chr11 position 68608767, Chr11 position 70236292, Chr11 position 70236320, Chr11 position 70236331, Chr11 position 115530032, Chr11 position 117950310, Chr11 position 117950329, Chr11 position 117950361, Chr11 position 117950362, Chr11 position 119293593, Chr12 position 679803, Chr12 position 26039132, Chr12 position 31004558, Chr12 position 45610695, Chr12 position 45610701, Chr12 position 45610702, Chr12 position 45610706, Chr12 position 50286016, Chr12 position 52243258, Chr12 position 52243286, Chr12 position 54145732, Chr12 position 54145741, Chr12 position 54145825, Chr12 position 56115043, Chr12 position 66262229, Chr12 position 66262230, Chr12 position 66262233, Chr12 position 66262234, Chr12 position 77266621, Chr12 position 117580102, Chr12 position 123435962, Chr12 position 123436011, Chr12 position 123436065, Chr12 position 123540893, Chr13 position 20735797, Chr13 position 23500419, Chr13 position 46771519, Chr13 position 46771520, Chr13 position 53313426, Chr13 position 113807393, Chr14 position 38599118, Chr14 position 69170010, Chr14 position 75701632, Chr14 position 75701643, Chr14 position 90850454, Chr14 position 97524282, Chr14 position 103541602, Chr14 position 103768055, Chr14 position 104209000, Chr14 position 104209068, Chr14 position 104354645, Chr14 position 104360487, Chr15 position 41068807, Chr15 position 61152225, Chr15 position 61152253, Chr15 position 61152313, Chr15 position 65186440, Chr15 position 68851629, Chr15 position 70667596, Chr15 position 70767206, Chr15 position 75251486, Chr15 position 77984014, Chr15 position 77989064, Chr15 position 83952081, Chr15 position 85402496, Chr15 position 85402497, Chr15 position 99417337, Chr16 position 1231873, Chr16 position 1458639, Chr16 position 3023231, Chr16 position 23135832, Chr16 position 29616265, Chr16 position 31009547, Chr16 position 31009548, Chr16 position 31009590, Chr16 position 57793674, Chr16 position 57793715, Chr16 position 57793727, Chr16 position 70771056, Chr16 position 70771079, Chr16 position 70771141, Chr16 position 77332010, Chr16 position 78540378, Chr16 position 79333435, Chr16 position 84262419, Chr16 position 88701114, Chr16 position 89988308, Chr16 position 89988644, Chr17 position 1509928, Chr17 position 1509945, Chr17 position 1509952, Chr17 position 1509953, Chr17 position 7644013, Chr17 position 16323460, Chr17 position 16323473, Chr17 position 16924561, Chr17 position 16924562, Chr17 position 16924594, Chr17 position 17717918, Chr17 position 17718591, Chr17 position 18139506, Chr17 position 35278031, Chr17 position 39677570, Chr17 position 40826257, Chr17 position 43037426, Chr17 position 43200096, Chr17 position 43200239, Chr17 position 43510142, Chr17 position 47987828, Chr17 position 48178379, Chr17 position 48596391, Chr17 position 48764165, Chr17 position 55701962, Chr17 position 73584599, Chr17 position 73993165, Chr17 position 75827716, Chr17 position 76882243, Chr17 position 78765910, Chr17 position 79544478, Chr17 position 80696474, Chr18 position 19751759, Chr18 position 21440760, Chr18 position 45555437, Chr18 position 45555438, Chr18 position 46547891, Chr18 position 55888885, Chr18 position 56452096, Chr18 position 56452476, Chr18 position 56887181, Chr18 position 76002973, Chr18 position 77331090, Chr19 position 677895, Chr19 position 884044, Chr19 position 884059, Chr19 position 884105, Chr19 position 884115, Chr19 position 1136511, Chr19 position 1177605, Chr19 position 1177612, Chr19 position 1177640, Chr19 position 1860601, Chr19 position 1860607, Chr19 position 2503954, Chr19 position 3434917, Chr19 position 3434921, Chr19 position 3434930, Chr19 position 3434939, Chr19 position 3434952, Chr19 position 3434954, Chr19 position 3434962, Chr19 position 3434964, Chr19 position 3434979, Chr19 position 3434985, Chr19 position 4052713, Chr19 position 4052714, Chr19 position 4052749, Chr19 position 4374591, Chr19 position 5013982, Chr19 position 5048836, Chr19 position 5048867, Chr19 position 5048877, Chr19 position 8367279, Chr19 position 8428573, Chr19 position 10254577, Chr19 position 10254578, Chr19 position 10463956, Chr19 position 10464137, Chr19 position 13203671, Chr19 position 13266925, Chr19 position 13266934, Chr19 position 13266970, Chr19 position 13842142, Chr19 position 14248494, Chr19 position 15375465, Chr19 position 17218912, Chr19 position 17346702, Chr19 position 17346702, Chr19 position 18157161, Chr19 position 18157221, Chr19 position 18157258, Chr19 position 18415877, Chr19 position 18415890, Chr19 position 30606642, Chr19 position 35531842, Chr19 position 44303112, Chr19 position 47173037, Chr19 position 47316268, Chr19 position 47778278, Chr19 position 47778298, Chr20 position 34206950, Chr20 position 36771969, Chr20 position 48993661, Chr20 position 58406398, Chr20 position 61976049, Chr20 position 61976073, Chr20 position 62588571, Chr20 position 62588579, Chr22 position 19738127, Chr22 position 35965176, Chr22 position 36549809, Chr22 position 36973375, Chr22 position 37447953, Chr22 position 37914998, Chr22 position 38307317, Chr22 position 39662794, and Chr22 position 45622980.

In embodiments, the method includes detecting methylation or unmethylation of at least 9 of the following sites: Chr1 position 2996653, Chr1 position 11979164, Chr1 position 12655938, Chr1 position 16450525, Chr1 position 16450542, Chr1 position 16450545, Chr1 position 16469987, Chr1 position 17494491, Chr1 position 25473203, Chr1 position 27640460, Chr1 position 29565080, Chr1 position 38493013, Chr1 position 38493030, Chr1 position 38493074, Chr1 position 46713777, Chr1 position 46914121, Chr1 position 46955744, Chr1 position 55008344, Chr1 position 109816092, Chr1 position 109816111, Chr1 position 110074669, Chr1 position 110074681, Chr1 position 110074685, Chr1 position 150949856, Chr1 position 150949857, Chr1 position 153540282, Chr1 position 155162704, Chr1 position 155162714, Chr1 position 156676611, Chr1 position 157611881, Chr1 position 182205324, Chr1 position 204118999, Chr1 position 206741875, Chr1 position 206741989, Chr1 position 212587673, Chr1 position 212841198, Chr1 position 223403952, Chr1 position 233430972, Chr1 position 234342767, Chr2 position 3454277, Chr2 position 8793724, Chr2 position 20412441, Chr2 position 42329402, Chr2 position 42329494, Chr2 position 55289272, Chr2 position 65064865, Chr2 position 70823641, Chr2 position 73143689, Chr2 position 74454110, Chr2 position 122014529, Chr2 position 128158884, Chr2 position 128158910, Chr2 position 203114171, Chr2 position 218221671, Chr2 position 219745335, Chr2 position 238341465, Chr2 position 238341542, Chr2 position 238341546, Chr2 position 238774763, Chr3 position 13323642, Chr3 position 14180153, Chr3 position 45209073, Chr3 position 45209207, Chr3 position 52525100, Chr3 position 62589658, Chr3 position 65388317, Chr3 position 65388388, Chr3 position 73599302, Chr3 position 195636893, Chr3 position 197093846, Chr4 position 3743223, Chr4 position 5755716, Chr4 position 5755717, Chr4 position 5755728, Chr4 position 5755729, Chr4 position 5755734, Chr4 position 8372861, Chr4 position 57548289, Chr5 position 1118280, Chr5 position 34564389, Chr5 position 73871907, Chr5 position 78013596, Chr5 position 78013643, Chr5 position 137802650, Chr5 position 139051189, Chr5 position 167838221, Chr5 position 177541401, Chr5 position 180018672, Chr5 position 180101026, Chr6 position 3394325, Chr6 position 3887581, Chr6 position 7236568, Chr6 position 7728692, Chr6 position 34203617, Chr6 position 37751320, Chr6 position 41410682, Chr6 position 41438516, Chr6 position 41438575, Chr6 position 43464150, Chr6 position 158734279, Chr7 position 989235, Chr7 position 2673543, Chr7 position 73508602, Chr7 position 105079565, Chr7 position 105079631, Chr7 position 151425103, Chr7 position 151425104, Chr8 position 11764017, Chr8 position 21647308, Chr8 position 22548399, Chr8 position 22548483, Chr8 position 133570537, Chr8 position 141320393, Chr8 position 141320410, Chr9 position 6566568, Chr9 position 16197862, Chr9 position 34591313, Chr9 position 98225096, Chr9 position 126126741, Chr9 position 132083428, Chr9 position 136077410, Chr9 position 139655018, Chr9 position 140205985, Chr9 position 140205985, Chr9 position 140205997, Chr10 position 3929071, Chr10 position 30047012, Chr10 position 79702989, Chr10 position 87984905, Chr10 position 94838789, Chr10 position 102131187, Chr10 position 104196489, Chr10 position 111766879, Chr10 position 112258886, Chr10 position 112258984, Chr10 position 112259015, Chr10 position 116391763, Chr10 position 120011530, Chr10 position 126172714, Chr10 position 126172747, Chr11 position 556355, Chr11 position 821282, Chr11 position 12188937, Chr11 position 12188948, Chr11 position 12188995, Chr11 position 36057726, Chr11 position 48070143, Chr11 position 48070163, Chr11 position 48070166, Chr11 position 48070174, Chr11 position 65158294, Chr11 position 65158342, Chr11 position 65297089, Chr11 position 66104481, Chr11 position 66104485, Chr11 position 66104578, Chr11 position 68608767, Chr11 position 70236292, Chr11 position 70236320, Chr11 position 70236331, Chr11 position 115530032, Chr11 position 117950310, Chr11 position 117950329, Chr11 position 117950361, Chr11 position 117950362, Chr11 position 119293593, Chr12 position 679803, Chr12 position 26039132, Chr12 position 31004558, Chr12 position 45610695, Chr12 position 45610701, Chr12 position 45610702, Chr12 position 45610706, Chr12 position 50286016, Chr12 position 52243258, Chr12 position 52243286, Chr12 position 54145732, Chr12 position 54145741, Chr12 position 54145825, Chr12 position 56115043, Chr12 position 66262229, Chr12 position 66262230, Chr12 position 66262233, Chr12 position 66262234, Chr12 position 77266621, Chr12 position 117580102, Chr12 position 123435962, Chr12 position 123436011, Chr12 position 123436065, Chr12 position 123540893, Chr13 position 20735797, Chr13 position 23500419, Chr13 position 46771519, Chr13 position 46771520, Chr13 position 53313426, Chr13 position 113807393, Chr14 position 38599118, Chr14 position 69170010, Chr14 position 75701632, Chr14 position 75701643, Chr14 position 90850454, Chr14 position 97524282, Chr14 position 103541602, Chr14 position 103768055, Chr14 position 104209000, Chr14 position 104209068, Chr14 position 104354645, Chr14 position 104360487, Chr15 position 41068807, Chr15 position 61152225, Chr15 position 61152253, Chr15 position 61152313, Chr15 position 65186440, Chr15 position 68851629, Chr15 position 70667596, Chr15 position 70767206, Chr15 position 75251486, Chr15 position 77984014, Chr15 position 77989064, Chr15 position 83952081, Chr15 position 85402496, Chr15 position 85402497, Chr15 position 99417337, Chr16 position 1231873, Chr16 position 1458639, Chr16 position 3023231, Chr16 position 23135832, Chr16 position 29616265, Chr16 position 31009547, Chr16 position 31009548, Chr16 position 31009590, Chr16 position 57793674, Chr16 position 57793715, Chr16 position 57793727, Chr16 position 70771056, Chr16 position 70771079, Chr16 position 70771141, Chr16 position 77332010, Chr16 position 78540378, Chr16 position 79333435, Chr16 position 84262419, Chr16 position 88701114, Chr16 position 89988308, Chr16 position 89988644, Chr17 position 1509928, Chr17 position 1509945, Chr17 position 1509952, Chr17 position 1509953, Chr17 position 7644013, Chr17 position 16323460, Chr17 position 16323473, Chr17 position 16924561, Chr17 position 16924562, Chr17 position 16924594, Chr17 position 17717918, Chr17 position 17718591, Chr17 position 18139506, Chr17 position 35278031, Chr17 position 39677570, Chr17 position 40826257, Chr17 position 43037426, Chr17 position 43200096, Chr17 position 43200239, Chr17 position 43510142, Chr17 position 47987828, Chr17 position 48178379, Chr17 position 48596391, Chr17 position 48764165, Chr17 position 55701962, Chr17 position 73584599, Chr17 position 73993165, Chr17 position 75827716, Chr17 position 76882243, Chr17 position 78765910, Chr17 position 79544478, Chr17 position 80696474, Chr18 position 19751759, Chr18 position 21440760, Chr18 position 45555437, Chr18 position 45555438, Chr18 position 46547891, Chr18 position 55888885, Chr18 position 56452096, Chr18 position 56452476, Chr18 position 56887181, Chr18 position 76002973, Chr18 position 77331090, Chr19 position 677895, Chr19 position 884044, Chr19 position 884059, Chr19 position 884105, Chr19 position 884115, Chr19 position 1136511, Chr19 position 1177605, Chr19 position 1177612, Chr19 position 1177640, Chr19 position 1860601, Chr19 position 1860607, Chr19 position 2503954, Chr19 position 3434917, Chr19 position 3434921, Chr19 position 3434930, Chr19 position 3434939, Chr19 position 3434952, Chr19 position 3434954, Chr19 position 3434962, Chr19 position 3434964, Chr19 position 3434979, Chr19 position 3434985, Chr19 position 4052713, Chr19 position 4052714, Chr19 position 4052749, Chr19 position 4374591, Chr19 position 5013982, Chr19 position 5048836, Chr19 position 5048867, Chr19 position 5048877, Chr19 position 8367279, Chr19 position 8428573, Chr19 position 10254577, Chr19 position 10254578, Chr19 position 10463956, Chr19 position 10464137, Chr19 position 13203671, Chr19 position 13266925, Chr19 position 13266934, Chr19 position 13266970, Chr19 position 13842142, Chr19 position 14248494, Chr19 position 15375465, Chr19 position 17218912, Chr19 position 17346702, Chr19 position 17346702, Chr19 position 18157161, Chr19 position 18157221, Chr19 position 18157258, Chr19 position 18415877, Chr19 position 18415890, Chr19 position 30606642, Chr19 position 35531842, Chr19 position 44303112, Chr19 position 47173037, Chr19 position 47316268, Chr19 position 47778278, Chr19 position 47778298, Chr20 position 34206950, Chr20 position 36771969, Chr20 position 48993661, Chr20 position 58406398, Chr20 position 61976049, Chr20 position 61976073, Chr20 position 62588571, Chr20 position 62588579, Chr22 position 19738127, Chr22 position 35965176, Chr22 position 36549809, Chr22 position 36973375, Chr22 position 37447953, Chr22 position 37914998, Chr22 position 38307317, Chr22 position 39662794, and Chr22 position 45622980.

In embodiments, the method includes detecting methylation or unmethylation of at least 10 of the following sites: Chr1 position 2996653, Chr1 position 11979164, Chr1 position 12655938, Chr1 position 16450525, Chr1 position 16450542, Chr1 position 16450545, Chr1 position 16469987, Chr1 position 17494491, Chr1 position 25473203, Chr1 position 27640460, Chr1 position 29565080, Chr1 position 38493013, Chr1 position 38493030, Chr1 position 38493074, Chr1 position 46713777, Chr1 position 46914121, Chr1 position 46955744, Chr1 position 55008344, Chr1 position 109816092, Chr1 position 109816111, Chr1 position 110074669, Chr1 position 110074681, Chr1 position 110074685, Chr1 position 150949856, Chr1 position 150949857, Chr1 position 153540282, Chr1 position 155162704, Chr1 position 155162714, Chr1 position 156676611, Chr1 position 157611881, Chr1 position 182205324, Chr1 position 204118999, Chr1 position 206741875, Chr1 position 206741989, Chr1 position 212587673, Chr1 position 212841198, Chr1 position 223403952, Chr1 position 233430972, Chr1 position 234342767, Chr2 position 3454277, Chr2 position 8793724, Chr2 position 20412441, Chr2 position 42329402, Chr2 position 42329494, Chr2 position 55289272, Chr2 position 65064865, Chr2 position 70823641, Chr2 position 73143689, Chr2 position 74454110, Chr2 position 122014529, Chr2 position 128158884, Chr2 position 128158910, Chr2 position 203114171, Chr2 position 218221671, Chr2 position 219745335, Chr2 position 238341465, Chr2 position 238341542, Chr2 position 238341546, Chr2 position 238774763, Chr3 position 13323642, Chr3 position 14180153, Chr3 position 45209073, Chr3 position 45209207, Chr3 position 52525100, Chr3 position 62589658, Chr3 position 65388317, Chr3 position 65388388, Chr3 position 73599302, Chr3 position 195636893, Chr3 position 197093846, Chr4 position 3743223, Chr4 position 5755716, Chr4 position 5755717, Chr4 position 5755728, Chr4 position 5755729, Chr4 position 5755734, Chr4 position 8372861, Chr4 position 57548289, Chr5 position 1118280, Chr5 position 34564389, Chr5 position 73871907, Chr5 position 78013596, Chr5 position 78013643, Chr5 position 137802650, Chr5 position 139051189, Chr5 position 167838221, Chr5 position 177541401, Chr5 position 180018672, Chr5 position 180101026, Chr6 position 3394325, Chr6 position 3887581, Chr6 position 7236568, Chr6 position 7728692, Chr6 position 34203617, Chr6 position 37751320, Chr6 position 41410682, Chr6 position 41438516, Chr6 position 41438575, Chr6 position 43464150, Chr6 position 158734279, Chr7 position 989235, Chr7 position 2673543, Chr7 position 73508602, Chr7 position 105079565, Chr7 position 105079631, Chr7 position 151425103, Chr7 position 151425104, Chr8 position 11764017, Chr8 position 21647308, Chr8 position 22548399, Chr8 position 22548483, Chr8 position 133570537, Chr8 position 141320393, Chr8 position 141320410, Chr9 position 6566568, Chr9 position 16197862, Chr9 position 34591313, Chr9 position 98225096, Chr9 position 126126741, Chr9 position 132083428, Chr9 position 136077410, Chr9 position 139655018, Chr9 position 140205985, Chr9 position 140205985, Chr9 position 140205997, Chr10 position 3929071, Chr10 position 30047012, Chr10 position 79702989, Chr10 position 87984905, Chr10 position 94838789, Chr10 position 102131187, Chr10 position 104196489, Chr10 position 111766879, Chr10 position 112258886, Chr10 position 112258984, Chr10 position 112259015, Chr10 position 116391763, Chr10 position 120011530, Chr10 position 126172714, Chr10 position 126172747, Chr11 position 556355, Chr11 position 821282, Chr11 position 12188937, Chr11 position 12188948, Chr11 position 12188995, Chr11 position 36057726, Chr11 position 48070143, Chr11 position 48070163, Chr11 position 48070166, Chr11 position 48070174, Chr11 position 65158294, Chr11 position 65158342, Chr11 position 65297089, Chr11 position 66104481, Chr11 position 66104485, Chr11 position 66104578, Chr11 position 68608767, Chr11 position 70236292, Chr11 position 70236320, Chr11 position 70236331, Chr11 position 115530032, Chr11 position 117950310, Chr11 position 117950329, Chr11 position 117950361, Chr11 position 117950362, Chr11 position 119293593, Chr12 position 679803, Chr12 position 26039132, Chr12 position 31004558, Chr12 position 45610695, Chr12 position 45610701, Chr12 position 45610702, Chr12 position 45610706, Chr12 position 50286016, Chr12 position 52243258, Chr12 position 52243286, Chr12 position 54145732, Chr12 position 54145741, Chr12 position 54145825, Chr12 position 56115043, Chr12 position 66262229, Chr12 position 66262230, Chr12 position 66262233, Chr12 position 66262234, Chr12 position 77266621, Chr12 position 117580102, Chr12 position 123435962, Chr12 position 123436011, Chr12 position 123436065, Chr12 position 123540893, Chr13 position 20735797, Chr13 position 23500419, Chr13 position 46771519, Chr13 position 46771520, Chr13 position 53313426, Chr13 position 113807393, Chr14 position 38599118, Chr14 position 69170010, Chr14 position 75701632, Chr14 position 75701643, Chr14 position 90850454, Chr14 position 97524282, Chr14 position 103541602, Chr14 position 103768055, Chr14 position 104209000, Chr14 position 104209068, Chr14 position 104354645, Chr14 position 104360487, Chr15 position 41068807, Chr15 position 61152225, Chr15 position 61152253, Chr15 position 61152313, Chr15 position 65186440, Chr15 position 68851629, Chr15 position 70667596, Chr15 position 70767206, Chr15 position 75251486, Chr15 position 77984014, Chr15 position 77989064, Chr15 position 83952081, Chr15 position 85402496, Chr15 position 85402497, Chr15 position 99417337, Chr16 position 1231873, Chr16 position 1458639, Chr16 position 3023231, Chr16 position 23135832, Chr16 position 29616265, Chr16 position 31009547, Chr16 position 31009548, Chr16 position 31009590, Chr16 position 57793674, Chr16 position 57793715, Chr16 position 57793727, Chr16 position 70771056, Chr16 position 70771079, Chr16 position 70771141, Chr16 position 77332010, Chr16 position 78540378, Chr16 position 79333435, Chr16 position 84262419, Chr16 position 88701114, Chr16 position 89988308, Chr16 position 89988644, Chr17 position 1509928, Chr17 position 1509945, Chr17 position 1509952, Chr17 position 1509953, Chr17 position 7644013, Chr17 position 16323460, Chr17 position 16323473, Chr17 position 16924561, Chr17 position 16924562, Chr17 position 16924594, Chr17 position 17717918, Chr17 position 17718591, Chr17 position 18139506, Chr17 position 35278031, Chr17 position 39677570, Chr17 position 40826257, Chr17 position 43037426, Chr17 position 43200096, Chr17 position 43200239, Chr17 position 43510142, Chr17 position 47987828, Chr17 position 48178379, Chr17 position 48596391, Chr17 position 48764165, Chr17 position 55701962, Chr17 position 73584599, Chr17 position 73993165, Chr17 position 75827716, Chr17 position 76882243, Chr17 position 78765910, Chr17 position 79544478, Chr17 position 80696474, Chr18 position 19751759, Chr18 position 21440760, Chr18 position 45555437, Chr18 position 45555438, Chr18 position 46547891, Chr18 position 55888885, Chr18 position 56452096, Chr18 position 56452476, Chr18 position 56887181, Chr18 position 76002973, Chr18 position 77331090, Chr19 position 677895, Chr19 position 884044, Chr19 position 884059, Chr19 position 884105, Chr19 position 884115, Chr19 position 1136511, Chr19 position 1177605, Chr19 position 1177612, Chr19 position 1177640, Chr19 position 1860601, Chr19 position 1860607, Chr19 position 2503954, Chr19 position 3434917, Chr19 position 3434921, Chr19 position 3434930, Chr19 position 3434939, Chr19 position 3434952, Chr19 position 3434954, Chr19 position 3434962, Chr19 position 3434964, Chr19 position 3434979, Chr19 position 3434985, Chr19 position 4052713, Chr19 position 4052714, Chr19 position 4052749, Chr19 position 4374591, Chr19 position 5013982, Chr19 position 5048836, Chr19 position 5048867, Chr19 position 5048877, Chr19 position 8367279, Chr19 position 8428573, Chr19 position 10254577, Chr19 position 10254578, Chr19 position 10463956, Chr19 position 10464137, Chr19 position 13203671, Chr19 position 13266925, Chr19 position 13266934, Chr19 position 13266970, Chr19 position 13842142, Chr19 position 14248494, Chr19 position 15375465, Chr19 position 17218912, Chr19 position 17346702, Chr19 position 17346702, Chr19 position 18157161, Chr19 position 18157221, Chr19 position 18157258, Chr19 position 18415877, Chr19 position 18415890, Chr19 position 30606642, Chr19 position 35531842, Chr19 position 44303112, Chr19 position 47173037, Chr19 position 47316268, Chr19 position 47778278, Chr19 position 47778298, Chr20 position 34206950, Chr20 position 36771969, Chr20 position 48993661, Chr20 position 58406398, Chr20 position 61976049, Chr20 position 61976073, Chr20 position 62588571, Chr20 position 62588579, Chr22 position 19738127, Chr22 position 35965176, Chr22 position 36549809, Chr22 position 36973375, Chr22 position 37447953, Chr22 position 37914998, Chr22 position 38307317, Chr22 position 39662794, and Chr22 position 45622980.

In embodiments, the method includes detecting methylation or unmethylation of at least 50 of the following sites: Chr1 position 2996653, Chr1 position 11979164, Chr1 position 12655938, Chr1 position 16450525, Chr1 position 16450542, Chr1 position 16450545, Chr1 position 16469987, Chr1 position 17494491, Chr1 position 25473203, Chr1 position 27640460, Chr1 position 29565080, Chr1 position 38493013, Chr1 position 38493030, Chr1 position 38493074, Chr1 position 46713777, Chr1 position 46914121, Chr1 position 46955744, Chr1 position 55008344, Chr1 position 109816092, Chr1 position 109816111, Chr1 position 110074669, Chr1 position 110074681, Chr1 position 110074685, Chr1 position 150949856, Chr1 position 150949857, Chr1 position 153540282, Chr1 position 155162704, Chr1 position 155162714, Chr1 position 156676611, Chr1 position 157611881, Chr1 position 182205324, Chr1 position 204118999, Chr1 position 206741875, Chr1 position 206741989, Chr1 position 212587673, Chr1 position 212841198, Chr1 position 223403952, Chr1 position 233430972, Chr1 position 234342767, Chr2 position 3454277, Chr2 position 8793724, Chr2 position 20412441, Chr2 position 42329402, Chr2 position 42329494, Chr2 position 55289272, Chr2 position 65064865, Chr2 position 70823641, Chr2 position 73143689, Chr2 position 74454110, Chr2 position 122014529, Chr2 position 128158884, Chr2 position 128158910, Chr2 position 203114171, Chr2 position 218221671, Chr2 position 219745335, Chr2 position 238341465, Chr2 position 238341542, Chr2 position 238341546, Chr2 position 238774763, Chr3 position 13323642, Chr3 position 14180153, Chr3 position 45209073, Chr3 position 45209207, Chr3 position 52525100, Chr3 position 62589658, Chr3 position 65388317, Chr3 position 65388388, Chr3 position 73599302, Chr3 position 195636893, Chr3 position 197093846, Chr4 position 3743223, Chr4 position 5755716, Chr4 position 5755717, Chr4 position 5755728, Chr4 position 5755729, Chr4 position 5755734, Chr4 position 8372861, Chr4 position 57548289, Chr5 position 1118280, Chr5 position 34564389, Chr5 position 73871907, Chr5 position 78013596, Chr5 position 78013643, Chr5 position 137802650, Chr5 position 139051189, Chr5 position 167838221, Chr5 position 177541401, Chr5 position 180018672, Chr5 position 180101026, Chr6 position 3394325, Chr6 position 3887581, Chr6 position 7236568, Chr6 position 7728692, Chr6 position 34203617, Chr6 position 37751320, Chr6 position 41410682, Chr6 position 41438516, Chr6 position 41438575, Chr6 position 43464150, Chr6 position 158734279, Chr7 position 989235, Chr7 position 2673543, Chr7 position 73508602, Chr7 position 105079565, Chr7 position 105079631, Chr7 position 151425103, Chr7 position 151425104, Chr8 position 11764017, Chr8 position 21647308, Chr8 position 22548399, Chr8 position 22548483, Chr8 position 133570537, Chr8 position 141320393, Chr8 position 141320410, Chr9 position 6566568, Chr9 position 16197862, Chr9 position 34591313, Chr9 position 98225096, Chr9 position 126126741, Chr9 position 132083428, Chr9 position 136077410, Chr9 position 139655018, Chr9 position 140205985, Chr9 position 140205985, Chr9 position 140205997, Chr10 position 3929071, Chr10 position 30047012, Chr10 position 79702989, Chr10 position 87984905, Chr10 position 94838789, Chr10 position 102131187, Chr10 position 104196489, Chr10 position 111766879, Chr10 position 112258886, Chr10 position 112258984, Chr10 position 112259015, Chr10 position 116391763, Chr10 position 120011530, Chr10 position 126172714, Chr10 position 126172747, Chr11 position 556355, Chr11 position 821282, Chr11 position 12188937, Chr11 position 12188948, Chr11 position 12188995, Chr11 position 36057726, Chr11 position 48070143, Chr11 position 48070163, Chr11 position 48070166, Chr11 position 48070174, Chr11 position 65158294, Chr11 position 65158342, Chr11 position 65297089, Chr11 position 66104481, Chr11 position 66104485, Chr11 position 66104578, Chr11 position 68608767, Chr11 position 70236292, Chr11 position 70236320, Chr11 position 70236331, Chr11 position 115530032, Chr11 position 117950310, Chr11 position 117950329, Chr11 position 117950361, Chr11 position 117950362, Chr11 position 119293593, Chr12 position 679803, Chr12 position 26039132, Chr12 position 31004558, Chr12 position 45610695, Chr12 position 45610701, Chr12 position 45610702, Chr12 position 45610706, Chr12 position 50286016, Chr12 position 52243258, Chr12 position 52243286, Chr12 position 54145732, Chr12 position 54145741, Chr12 position 54145825, Chr12 position 56115043, Chr12 position 66262229, Chr12 position 66262230, Chr12 position 66262233, Chr12 position 66262234, Chr12 position 77266621, Chr12 position 117580102, Chr12 position 123435962, Chr12 position 123436011, Chr12 position 123436065, Chr12 position 123540893, Chr13 position 20735797, Chr13 position 23500419, Chr13 position 46771519, Chr13 position 46771520, Chr13 position 53313426, Chr13 position 113807393, Chr14 position 38599118, Chr14 position 69170010, Chr14 position 75701632, Chr14 position 75701643, Chr14 position 90850454, Chr14 position 97524282, Chr14 position 103541602, Chr14 position 103768055, Chr14 position 104209000, Chr14 position 104209068, Chr14 position 104354645, Chr14 position 104360487, Chr15 position 41068807, Chr15 position 61152225, Chr15 position 61152253, Chr15 position 61152313, Chr15 position 65186440, Chr15 position 68851629, Chr15 position 70667596, Chr15 position 70767206, Chr15 position 75251486, Chr15 position 77984014, Chr15 position 77989064, Chr15 position 83952081, Chr15 position 85402496, Chr15 position 85402497, Chr15 position 99417337, Chr16 position 1231873, Chr16 position 1458639, Chr16 position 3023231, Chr16 position 23135832, Chr16 position 29616265, Chr16 position 31009547, Chr16 position 31009548, Chr16 position 31009590, Chr16 position 57793674, Chr16 position 57793715, Chr16 position 57793727, Chr16 position 70771056, Chr16 position 70771079, Chr16 position 70771141, Chr16 position 77332010, Chr16 position 78540378, Chr16 position 79333435, Chr16 position 84262419, Chr16 position 88701114, Chr16 position 89988308, Chr16 position 89988644, Chr17 position 1509928, Chr17 position 1509945, Chr17 position 1509952, Chr17 position 1509953, Chr17 position 7644013, Chr17 position 16323460, Chr17 position 16323473, Chr17 position 16924561, Chr17 position 16924562, Chr17 position 16924594, Chr17 position 17717918, Chr17 position 17718591, Chr17 position 18139506, Chr17 position 35278031, Chr17 position 39677570, Chr17 position 40826257, Chr17 position 43037426, Chr17 position 43200096, Chr17 position 43200239, Chr17 position 43510142, Chr17 position 47987828, Chr17 position 48178379, Chr17 position 48596391, Chr17 position 48764165, Chr17 position 55701962, Chr17 position 73584599, Chr17 position 73993165, Chr17 position 75827716, Chr17 position 76882243, Chr17 position 78765910, Chr17 position 79544478, Chr17 position 80696474, Chr18 position 19751759, Chr18 position 21440760, Chr18 position 45555437, Chr18 position 45555438, Chr18 position 46547891, Chr18 position 55888885, Chr18 position 56452096, Chr18 position 56452476, Chr18 position 56887181, Chr18 position 76002973, Chr18 position 77331090, Chr19 position 677895, Chr19 position 884044, Chr19 position 884059, Chr19 position 884105, Chr19 position 884115, Chr19 position 1136511, Chr19 position 1177605, Chr19 position 1177612, Chr19 position 1177640, Chr19 position 1860601, Chr19 position 1860607, Chr19 position 2503954, Chr19 position 3434917, Chr19 position 3434921, Chr19 position 3434930, Chr19 position 3434939, Chr19 position 3434952, Chr19 position 3434954, Chr19 position 3434962, Chr19 position 3434964, Chr19 position 3434979, Chr19 position 3434985, Chr19 position 4052713, Chr19 position 4052714, Chr19 position 4052749, Chr19 position 4374591, Chr19 position 5013982, Chr19 position 5048836, Chr19 position 5048867, Chr19 position 5048877, Chr19 position 8367279, Chr19 position 8428573, Chr19 position 10254577, Chr19 position 10254578, Chr19 position 10463956, Chr19 position 10464137, Chr19 position 13203671, Chr19 position 13266925, Chr19 position 13266934, Chr19 position 13266970, Chr19 position 13842142, Chr19 position 14248494, Chr19 position 15375465, Chr19 position 17218912, Chr19 position 17346702, Chr19 position 17346702, Chr19 position 18157161, Chr19 position 18157221, Chr19 position 18157258, Chr19 position 18415877, Chr19 position 18415890, Chr19 position 30606642, Chr19 position 35531842, Chr19 position 44303112, Chr19 position 47173037, Chr19 position 47316268, Chr19 position 47778278, Chr19 position 47778298, Chr20 position 34206950, Chr20 position 36771969, Chr20 position 48993661, Chr20 position 58406398, Chr20 position 61976049, Chr20 position 61976073, Chr20 position 62588571, Chr20 position 62588579, Chr22 position 19738127, Chr22 position 35965176, Chr22 position 36549809, Chr22 position 36973375, Chr22 position 37447953, Chr22 position 37914998, Chr22 position 38307317, Chr22 position 39662794, and Chr22 position 45622980.

In embodiments, the method includes detecting methylation or unmethylation of at least 100 of the following sites: Chr1 position 2996653, Chr1 position 11979164, Chr1 position 12655938, Chr1 position 16450525, Chr1 position 16450542, Chr1 position 16450545, Chr1 position 16469987, Chr1 position 17494491, Chr1 position 25473203, Chr1 position 27640460, Chr1 position 29565080, Chr1 position 38493013, Chr1 position 38493030, Chr1 position 38493074, Chr1 position 46713777, Chr1 position 46914121, Chr1 position 46955744, Chr1 position 55008344, Chr1 position 109816092, Chr1 position 109816111, Chr1 position 110074669, Chr1 position 110074681, Chr1 position 110074685, Chr1 position 150949856, Chr1 position 150949857, Chr1 position 153540282, Chr1 position 155162704, Chr1 position 155162714, Chr1 position 156676611, Chr1 position 157611881, Chr1 position 182205324, Chr1 position 204118999, Chr1 position 206741875, Chr1 position 206741989, Chr1 position 212587673, Chr1 position 212841198, Chr1 position 223403952, Chr1 position 233430972, Chr1 position 234342767, Chr2 position 3454277, Chr2 position 8793724, Chr2 position 20412441, Chr2 position 42329402, Chr2 position 42329494, Chr2 position 55289272, Chr2 position 65064865, Chr2 position 70823641, Chr2 position 73143689, Chr2 position 74454110, Chr2 position 122014529, Chr2 position 128158884, Chr2 position 128158910, Chr2 position 203114171, Chr2 position 218221671, Chr2 position 219745335, Chr2 position 238341465, Chr2 position 238341542, Chr2 position 238341546, Chr2 position 238774763, Chr3 position 13323642, Chr3 position 14180153, Chr3 position 45209073, Chr3 position 45209207, Chr3 position 52525100, Chr3 position 62589658, Chr3 position 65388317, Chr3 position 65388388, Chr3 position 73599302, Chr3 position 195636893, Chr3 position 197093846, Chr4 position 3743223, Chr4 position 5755716, Chr4 position 5755717, Chr4 position 5755728, Chr4 position 5755729, Chr4 position 5755734, Chr4 position 8372861, Chr4 position 57548289, Chr5 position 1118280, Chr5 position 34564389, Chr5 position 73871907, Chr5 position 78013596, Chr5 position 78013643, Chr5 position 137802650, Chr5 position 139051189, Chr5 position 167838221, Chr5 position 177541401, Chr5 position 180018672, Chr5 position 180101026, Chr6 position 3394325, Chr6 position 3887581, Chr6 position 7236568, Chr6 position 7728692, Chr6 position 34203617, Chr6 position 37751320, Chr6 position 41410682, Chr6 position 41438516, Chr6 position 41438575, Chr6 position 43464150, Chr6 position 158734279, Chr7 position 989235, Chr7 position 2673543, Chr7 position 73508602, Chr7 position 105079565, Chr7 position 105079631, Chr7 position 151425103, Chr7 position 151425104, Chr8 position 11764017, Chr8 position 21647308, Chr8 position 22548399, Chr8 position 22548483, Chr8 position 133570537, Chr8 position 141320393, Chr8 position 141320410, Chr9 position 6566568, Chr9 position 16197862, Chr9 position 34591313, Chr9 position 98225096, Chr9 position 126126741, Chr9 position 132083428, Chr9 position 136077410, Chr9 position 139655018, Chr9 position 140205985, Chr9 position 140205985, Chr9 position 140205997, Chr10 position 3929071, Chr10 position 30047012, Chr10 position 79702989, Chr10 position 87984905, Chr10 position 94838789, Chr10 position 102131187, Chr10 position 104196489, Chr10 position 111766879, Chr10 position 112258886, Chr10 position 112258984, Chr10 position 112259015, Chr10 position 116391763, Chr10 position 120011530, Chr10 position 126172714, Chr10 position 126172747, Chr11 position 556355, Chr11 position 821282, Chr11 position 12188937, Chr11 position 12188948, Chr11 position 12188995, Chr11 position 36057726, Chr11 position 48070143, Chr11 position 48070163, Chr11 position 48070166, Chr11 position 48070174, Chr11 position 65158294, Chr11 position 65158342, Chr11 position 65297089, Chr11 position 66104481, Chr11 position 66104485, Chr11 position 66104578, Chr11 position 68608767, Chr11 position 70236292, Chr11 position 70236320, Chr11 position 70236331, Chr11 position 115530032, Chr11 position 117950310, Chr11 position 117950329, Chr11 position 117950361, Chr11 position 117950362, Chr11 position 119293593, Chr12 position 679803, Chr12 position 26039132, Chr12 position 31004558, Chr12 position 45610695, Chr12 position 45610701, Chr12 position 45610702, Chr12 position 45610706, Chr12 position 50286016, Chr12 position 52243258, Chr12 position 52243286, Chr12 position 54145732, Chr12 position 54145741, Chr12 position 54145825, Chr12 position 56115043, Chr12 position 66262229, Chr12 position 66262230, Chr12 position 66262233, Chr12 position 66262234, Chr12 position 77266621, Chr12 position 117580102, Chr12 position 123435962, Chr12 position 123436011, Chr12 position 123436065, Chr12 position 123540893, Chr13 position 20735797, Chr13 position 23500419, Chr13 position 46771519, Chr13 position 46771520, Chr13 position 53313426, Chr13 position 113807393, Chr14 position 38599118, Chr14 position 69170010, Chr14 position 75701632, Chr14 position 75701643, Chr14 position 90850454, Chr14 position 97524282, Chr14 position 103541602, Chr14 position 103768055, Chr14 position 104209000, Chr14 position 104209068, Chr14 position 104354645, Chr14 position 104360487, Chr15 position 41068807, Chr15 position 61152225, Chr15 position 61152253, Chr15 position 61152313, Chr15 position 65186440, Chr15 position 68851629, Chr15 position 70667596, Chr15 position 70767206, Chr15 position 75251486, Chr15 position 77984014, Chr15 position 77989064, Chr15 position 83952081, Chr15 position 85402496, Chr15 position 85402497, Chr15 position 99417337, Chr16 position 1231873, Chr16 position 1458639, Chr16 position 3023231, Chr16 position 23135832, Chr16 position 29616265, Chr16 position 31009547, Chr16 position 31009548, Chr16 position 31009590, Chr16 position 57793674, Chr16 position 57793715, Chr16 position 57793727, Chr16 position 70771056, Chr16 position 70771079, Chr16 position 70771141, Chr16 position 77332010, Chr16 position 78540378, Chr16 position 79333435, Chr16 position 84262419, Chr16 position 88701114, Chr16 position 89988308, Chr16 position 89988644, Chr17 position 1509928, Chr17 position 1509945, Chr17 position 1509952, Chr17 position 1509953, Chr17 position 7644013, Chr17 position 16323460, Chr17 position 16323473, Chr17 position 16924561, Chr17 position 16924562, Chr17 position 16924594, Chr17 position 17717918, Chr17 position 17718591, Chr17 position 18139506, Chr17 position 35278031, Chr17 position 39677570, Chr17 position 40826257, Chr17 position 43037426, Chr17 position 43200096, Chr17 position 43200239, Chr17 position 43510142, Chr17 position 47987828, Chr17 position 48178379, Chr17 position 48596391, Chr17 position 48764165, Chr17 position 55701962, Chr17 position 73584599, Chr17 position 73993165, Chr17 position 75827716, Chr17 position 76882243, Chr17 position 78765910, Chr17 position 79544478, Chr17 position 80696474, Chr18 position 19751759, Chr18 position 21440760, Chr18 position 45555437, Chr18 position 45555438, Chr18 position 46547891, Chr18 position 55888885, Chr18 position 56452096, Chr18 position 56452476, Chr18 position 56887181, Chr18 position 76002973, Chr18 position 77331090, Chr19 position 677895, Chr19 position 884044, Chr19 position 884059, Chr19 position 884105, Chr19 position 884115, Chr19 position 1136511, Chr19 position 1177605, Chr19 position 1177612, Chr19 position 1177640, Chr19 position 1860601, Chr19 position 1860607, Chr19 position 2503954, Chr19 position 3434917, Chr19 position 3434921, Chr19 position 3434930, Chr19 position 3434939, Chr19 position 3434952, Chr19 position 3434954, Chr19 position 3434962, Chr19 position 3434964, Chr19 position 3434979, Chr19 position 3434985, Chr19 position 4052713, Chr19 position 4052714, Chr19 position 4052749, Chr19 position 4374591, Chr19 position 5013982, Chr19 position 5048836, Chr19 position 5048867, Chr19 position 5048877, Chr19 position 8367279, Chr19 position 8428573, Chr19 position 10254577, Chr19 position 10254578, Chr19 position 10463956, Chr19 position 10464137, Chr19 position 13203671, Chr19 position 13266925, Chr19 position 13266934, Chr19 position 13266970, Chr19 position 13842142, Chr19 position 14248494, Chr19 position 15375465, Chr19 position 17218912, Chr19 position 17346702, Chr19 position 17346702, Chr19 position 18157161, Chr19 position 18157221, Chr19 position 18157258, Chr19 position 18415877, Chr19 position 18415890, Chr19 position 30606642, Chr19 position 35531842, Chr19 position 44303112, Chr19 position 47173037, Chr19 position 47316268, Chr19 position 47778278, Chr19 position 47778298, Chr20 position 34206950, Chr20 position 36771969, Chr20 position 48993661, Chr20 position 58406398, Chr20 position 61976049, Chr20 position 61976073, Chr20 position 62588571, Chr20 position 62588579, Chr22 position 19738127, Chr22 position 35965176, Chr22 position 36549809, Chr22 position 36973375, Chr22 position 37447953, Chr22 position 37914998, Chr22 position 38307317, Chr22 position 39662794, and Chr22 position 45622980.

In embodiments, the method includes detecting methylation or unmethylation of at least 200 of the following sites: Chr1 position 2996653, Chr1 position 11979164, Chr1 position 12655938, Chr1 position 16450525, Chr1 position 16450542, Chr1 position 16450545, Chr1 position 16469987, Chr1 position 17494491, Chr1 position 25473203, Chr1 position 27640460, Chr1 position 29565080, Chr1 position 38493013, Chr1 position 38493030, Chr1 position 38493074, Chr1 position 46713777, Chr1 position 46914121, Chr1 position 46955744, Chr1 position 55008344, Chr1 position 109816092, Chr1 position 109816111, Chr1 position 110074669, Chr1 position 110074681, Chr1 position 110074685, Chr1 position 150949856, Chr1 position 150949857, Chr1 position 153540282, Chr1 position 155162704, Chr1 position 155162714, Chr1 position 156676611, Chr1 position 157611881, Chr1 position 182205324, Chr1 position 204118999, Chr1 position 206741875, Chr1 position 206741989, Chr1 position 212587673, Chr1 position 212841198, Chr1 position 223403952, Chr1 position 233430972, Chr1 position 234342767, Chr2 position 3454277, Chr2 position 8793724, Chr2 position 20412441, Chr2 position 42329402, Chr2 position 42329494, Chr2 position 55289272, Chr2 position 65064865, Chr2 position 70823641, Chr2 position 73143689, Chr2 position 74454110, Chr2 position 122014529, Chr2 position 128158884, Chr2 position 128158910, Chr2 position 203114171, Chr2 position 218221671, Chr2 position 219745335, Chr2 position 238341465, Chr2 position 238341542, Chr2 position 238341546, Chr2 position 238774763, Chr3 position 13323642, Chr3 position 14180153, Chr3 position 45209073, Chr3 position 45209207, Chr3 position 52525100, Chr3 position 62589658, Chr3 position 65388317, Chr3 position 65388388, Chr3 position 73599302, Chr3 position 195636893, Chr3 position 197093846, Chr4 position 3743223, Chr4 position 5755716, Chr4 position 5755717, Chr4 position 5755728, Chr4 position 5755729, Chr4 position 5755734, Chr4 position 8372861, Chr4 position 57548289, Chr5 position 1118280, Chr5 position 34564389, Chr5 position 73871907, Chr5 position 78013596, Chr5 position 78013643, Chr5 position 137802650, Chr5 position 139051189, Chr5 position 167838221, Chr5 position 177541401, Chr5 position 180018672, Chr5 position 180101026, Chr6 position 3394325, Chr6 position 3887581, Chr6 position 7236568, Chr6 position 7728692, Chr6 position 34203617, Chr6 position 37751320, Chr6 position 41410682, Chr6 position 41438516, Chr6 position 41438575, Chr6 position 43464150, Chr6 position 158734279, Chr7 position 989235, Chr7 position 2673543, Chr7 position 73508602, Chr7 position 105079565, Chr7 position 105079631, Chr7 position 151425103, Chr7 position 151425104, Chr8 position 11764017, Chr8 position 21647308, Chr8 position 22548399, Chr8 position 22548483, Chr8 position 133570537, Chr8 position 141320393, Chr8 position 141320410, Chr9 position 6566568, Chr9 position 16197862, Chr9 position 34591313, Chr9 position 98225096, Chr9 position 126126741, Chr9 position 132083428, Chr9 position 136077410, Chr9 position 139655018, Chr9 position 140205985, Chr9 position 140205985, Chr9 position 140205997, Chr10 position 3929071, Chr10 position 30047012, Chr10 position 79702989, Chr10 position 87984905, Chr10 position 94838789, Chr10 position 102131187, Chr10 position 104196489, Chr10 position 111766879, Chr10 position 112258886, Chr10 position 112258984, Chr10 position 112259015, Chr10 position 116391763, Chr10 position 120011530, Chr10 position 126172714, Chr10 position 126172747, Chr11 position 556355, Chr11 position 821282, Chr11 position 12188937, Chr11 position 12188948, Chr11 position 12188995, Chr11 position 36057726, Chr11 position 48070143, Chr11 position 48070163, Chr11 position 48070166, Chr11 position 48070174, Chr11 position 65158294, Chr11 position 65158342, Chr11 position 65297089, Chr11 position 66104481, Chr11 position 66104485, Chr11 position 66104578, Chr11 position 68608767, Chr11 position 70236292, Chr11 position 70236320, Chr11 position 70236331, Chr11 position 115530032, Chr11 position 117950310, Chr11 position 117950329, Chr11 position 117950361, Chr11 position 117950362, Chr11 position 119293593, Chr12 position 679803, Chr12 position 26039132, Chr12 position 31004558, Chr12 position 45610695, Chr12 position 45610701, Chr12 position 45610702, Chr12 position 45610706, Chr12 position 50286016, Chr12 position 52243258, Chr12 position 52243286, Chr12 position 54145732, Chr12 position 54145741, Chr12 position 54145825, Chr12 position 56115043, Chr12 position 66262229, Chr12 position 66262230, Chr12 position 66262233, Chr12 position 66262234, Chr12 position 77266621, Chr12 position 117580102, Chr12 position 123435962, Chr12 position 123436011, Chr12 position 123436065, Chr12 position 123540893, Chr13 position 20735797, Chr13 position 23500419, Chr13 position 46771519, Chr13 position 46771520, Chr13 position 53313426, Chr13 position 113807393, Chr14 position 38599118, Chr14 position 69170010, Chr14 position 75701632, Chr14 position 75701643, Chr14 position 90850454, Chr14 position 97524282, Chr14 position 103541602, Chr14 position 103768055, Chr14 position 104209000, Chr14 position 104209068, Chr14 position 104354645, Chr14 position 104360487, Chr15 position 41068807, Chr15 position 61152225, Chr15 position 61152253, Chr15 position 61152313, Chr15 position 65186440, Chr15 position 68851629, Chr15 position 70667596, Chr15 position 70767206, Chr15 position 75251486, Chr15 position 77984014, Chr15 position 77989064, Chr15 position 83952081, Chr15 position 85402496, Chr15 position 85402497, Chr15 position 99417337, Chr16 position 1231873, Chr16 position 1458639, Chr16 position 3023231, Chr16 position 23135832, Chr16 position 29616265, Chr16 position 31009547, Chr16 position 31009548, Chr16 position 31009590, Chr16 position 57793674, Chr16 position 57793715, Chr16 position 57793727, Chr16 position 70771056, Chr16 position 70771079, Chr16 position 70771141, Chr16 position 77332010, Chr16 position 78540378, Chr16 position 79333435, Chr16 position 84262419, Chr16 position 88701114, Chr16 position 89988308, Chr16 position 89988644, Chr17 position 1509928, Chr17 position 1509945, Chr17 position 1509952, Chr17 position 1509953, Chr17 position 7644013, Chr17 position 16323460, Chr17 position 16323473, Chr17 position 16924561, Chr17 position 16924562, Chr17 position 16924594, Chr17 position 17717918, Chr17 position 17718591, Chr17 position 18139506, Chr17 position 35278031, Chr17 position 39677570, Chr17 position 40826257, Chr17 position 43037426, Chr17 position 43200096, Chr17 position 43200239, Chr17 position 43510142, Chr17 position 47987828, Chr17 position 48178379, Chr17 position 48596391, Chr17 position 48764165, Chr17 position 55701962, Chr17 position 73584599, Chr17 position 73993165, Chr17 position 75827716, Chr17 position 76882243, Chr17 position 78765910, Chr17 position 79544478, Chr17 position 80696474, Chr18 position 19751759, Chr18 position 21440760, Chr18 position 45555437, Chr18 position 45555438, Chr18 position 46547891, Chr18 position 55888885, Chr18 position 56452096, Chr18 position 56452476, Chr18 position 56887181, Chr18 position 76002973, Chr18 position 77331090, Chr19 position 677895, Chr19 position 884044, Chr19 position 884059, Chr19 position 884105, Chr19 position 884115, Chr19 position 1136511, Chr19 position 1177605, Chr19 position 1177612, Chr19 position 1177640, Chr19 position 1860601, Chr19 position 1860607, Chr19 position 2503954, Chr19 position 3434917, Chr19 position 3434921, Chr19 position 3434930, Chr19 position 3434939, Chr19 position 3434952, Chr19 position 3434954, Chr19 position 3434962, Chr19 position 3434964, Chr19 position 3434979, Chr19 position 3434985, Chr19 position 4052713, Chr19 position 4052714, Chr19 position 4052749, Chr19 position 4374591, Chr19 position 5013982, Chr19 position 5048836, Chr19 position 5048867, Chr19 position 5048877, Chr19 position 8367279, Chr19 position 8428573, Chr19 position 10254577, Chr19 position 10254578, Chr19 position 10463956, Chr19 position 10464137, Chr19 position 13203671, Chr19 position 13266925, Chr19 position 13266934, Chr19 position 13266970, Chr19 position 13842142, Chr19 position 14248494, Chr19 position 15375465, Chr19 position 17218912, Chr19 position 17346702, Chr19 position 17346702, Chr19 position 18157161, Chr19 position 18157221, Chr19 position 18157258, Chr19 position 18415877, Chr19 position 18415890, Chr19 position 30606642, Chr19 position 35531842, Chr19 position 44303112, Chr19 position 47173037, Chr19 position 47316268, Chr19 position 47778278, Chr19 position 47778298, Chr20 position 34206950, Chr20 position 36771969, Chr20 position 48993661, Chr20 position 58406398, Chr20 position 61976049, Chr20 position 61976073, Chr20 position 62588571, Chr20 position 62588579, Chr22 position 19738127, Chr22 position 35965176, Chr22 position 36549809, Chr22 position 36973375, Chr22 position 37447953, Chr22 position 37914998, Chr22 position 38307317, Chr22 position 39662794, and Chr22 position 45622980.

In embodiments, the method includes detecting methylation or unmethylation of at least 300 of the following sites: Chr1 position 2996653, Chr1 position 11979164, Chr1 position 12655938, Chr1 position 16450525, Chr1 position 16450542, Chr1 position 16450545, Chr1 position 16469987, Chr1 position 17494491, Chr1 position 25473203, Chr1 position 27640460, Chr1 position 29565080, Chr1 position 38493013, Chr1 position 38493030, Chr1 position 38493074, Chr1 position 46713777, Chr1 position 46914121, Chr1 position 46955744, Chr1 position 55008344, Chr1 position 109816092, Chr1 position 109816111, Chr1 position 110074669, Chr1 position 110074681, Chr1 position 110074685, Chr1 position 150949856, Chr1 position 150949857, Chr1 position 153540282, Chr1 position 155162704, Chr1 position 155162714, Chr1 position 156676611, Chr1 position 157611881, Chr1 position 182205324, Chr1 position 204118999, Chr1 position 206741875, Chr1 position 206741989, Chr1 position 212587673, Chr1 position 212841198, Chr1 position 223403952, Chr1 position 233430972, Chr1 position 234342767, Chr2 position 3454277, Chr2 position 8793724, Chr2 position 20412441, Chr2 position 42329402, Chr2 position 42329494, Chr2 position 55289272, Chr2 position 65064865, Chr2 position 70823641, Chr2 position 73143689, Chr2 position 74454110, Chr2 position 122014529, Chr2 position 128158884, Chr2 position 128158910, Chr2 position 203114171, Chr2 position 218221671, Chr2 position 219745335, Chr2 position 238341465, Chr2 position 238341542, Chr2 position 238341546, Chr2 position 238774763, Chr3 position 13323642, Chr3 position 14180153, Chr3 position 45209073, Chr3 position 45209207, Chr3 position 52525100, Chr3 position 62589658, Chr3 position 65388317, Chr3 position 65388388, Chr3 position 73599302, Chr3 position 195636893, Chr3 position 197093846, Chr4 position 3743223, Chr4 position 5755716, Chr4 position 5755717, Chr4 position 5755728, Chr4 position 5755729, Chr4 position 5755734, Chr4 position 8372861, Chr4 position 57548289, Chr5 position 1118280, Chr5 position 34564389, Chr5 position 73871907, Chr5 position 78013596, Chr5 position 78013643, Chr5 position 137802650, Chr5 position 139051189, Chr5 position 167838221, Chr5 position 177541401, Chr5 position 180018672, Chr5 position 180101026, Chr6 position 3394325, Chr6 position 3887581, Chr6 position 7236568, Chr6 position 7728692, Chr6 position 34203617, Chr6 position 37751320, Chr6 position 41410682, Chr6 position 41438516, Chr6 position 41438575, Chr6 position 43464150, Chr6 position 158734279, Chr7 position 989235, Chr7 position 2673543, Chr7 position 73508602, Chr7 position 105079565, Chr7 position 105079631, Chr7 position 151425103, Chr7 position 151425104, Chr8 position 11764017, Chr8 position 21647308, Chr8 position 22548399, Chr8 position 22548483, Chr8 position 133570537, Chr8 position 141320393, Chr8 position 141320410, Chr9 position 6566568, Chr9 position 16197862, Chr9 position 34591313, Chr9 position 98225096, Chr9 position 126126741, Chr9 position 132083428, Chr9 position 136077410, Chr9 position 139655018, Chr9 position 140205985, Chr9 position 140205985, Chr9 position 140205997, Chr10 position 3929071, Chr10 position 30047012, Chr10 position 79702989, Chr10 position 87984905, Chr10 position 94838789, Chr10 position 102131187, Chr10 position 104196489, Chr10 position 111766879, Chr10 position 112258886, Chr10 position 112258984, Chr10 position 112259015, Chr10 position 116391763, Chr10 position 120011530, Chr10 position 126172714, Chr10 position 126172747, Chr11 position 556355, Chr11 position 821282, Chr11 position 12188937, Chr11 position 12188948, Chr11 position 12188995, Chr11 position 36057726, Chr11 position 48070143, Chr11 position 48070163, Chr11 position 48070166, Chr11 position 48070174, Chr11 position 65158294, Chr11 position 65158342, Chr11 position 65297089, Chr11 position 66104481, Chr11 position 66104485, Chr11 position 66104578, Chr11 position 68608767, Chr11 position 70236292, Chr11 position 70236320, Chr11 position 70236331, Chr11 position 115530032, Chr11 position 117950310, Chr11 position 117950329, Chr11 position 117950361, Chr11 position 117950362, Chr11 position 119293593, Chr12 position 679803, Chr12 position 26039132, Chr12 position 31004558, Chr12 position 45610695, Chr12 position 45610701, Chr12 position 45610702, Chr12 position 45610706, Chr12 position 50286016, Chr12 position 52243258, Chr12 position 52243286, Chr12 position 54145732, Chr12 position 54145741, Chr12 position 54145825, Chr12 position 56115043, Chr12 position 66262229, Chr12 position 66262230, Chr12 position 66262233, Chr12 position 66262234, Chr12 position 77266621, Chr12 position 117580102, Chr12 position 123435962, Chr12 position 123436011, Chr12 position 123436065, Chr12 position 123540893, Chr13 position 20735797, Chr13 position 23500419, Chr13 position 46771519, Chr13 position 46771520, Chr13 position 53313426, Chr13 position 113807393, Chr14 position 38599118, Chr14 position 69170010, Chr14 position 75701632, Chr14 position 75701643, Chr14 position 90850454, Chr14 position 97524282, Chr14 position 103541602, Chr14 position 103768055, Chr14 position 104209000, Chr14 position 104209068, Chr14 position 104354645, Chr14 position 104360487, Chr15 position 41068807, Chr15 position 61152225, Chr15 position 61152253, Chr15 position 61152313, Chr15 position 65186440, Chr15 position 68851629, Chr15 position 70667596, Chr15 position 70767206, Chr15 position 75251486, Chr15 position 77984014, Chr15 position 77989064, Chr15 position 83952081, Chr15 position 85402496, Chr15 position 85402497, Chr15 position 99417337, Chr16 position 1231873, Chr16 position 1458639, Chr16 position 3023231, Chr16 position 23135832, Chr16 position 29616265, Chr16 position 31009547, Chr16 position 31009548, Chr16 position 31009590, Chr16 position 57793674, Chr16 position 57793715, Chr16 position 57793727, Chr16 position 70771056, Chr16 position 70771079, Chr16 position 70771141, Chr16 position 77332010, Chr16 position 78540378, Chr16 position 79333435, Chr16 position 84262419, Chr16 position 88701114, Chr16 position 89988308, Chr16 position 89988644, Chr17 position 1509928, Chr17 position 1509945, Chr17 position 1509952, Chr17 position 1509953, Chr17 position 7644013, Chr17 position 16323460, Chr17 position 16323473, Chr17 position 16924561, Chr17 position 16924562, Chr17 position 16924594, Chr17 position 17717918, Chr17 position 17718591, Chr17 position 18139506, Chr17 position 35278031, Chr17 position 39677570, Chr17 position 40826257, Chr17 position 43037426, Chr17 position 43200096, Chr17 position 43200239, Chr17 position 43510142, Chr17 position 47987828, Chr17 position 48178379, Chr17 position 48596391, Chr17 position 48764165, Chr17 position 55701962, Chr17 position 73584599, Chr17 position 73993165, Chr17 position 75827716, Chr17 position 76882243, Chr17 position 78765910, Chr17 position 79544478, Chr17 position 80696474, Chr18 position 19751759, Chr18 position 21440760, Chr18 position 45555437, Chr18 position 45555438, Chr18 position 46547891, Chr18 position 55888885, Chr18 position 56452096, Chr18 position 56452476, Chr18 position 56887181, Chr18 position 76002973, Chr18 position 77331090, Chr19 position 677895, Chr19 position 884044, Chr19 position 884059, Chr19 position 884105, Chr19 position 884115, Chr19 position 1136511, Chr19 position 1177605, Chr19 position 1177612, Chr19 position 1177640, Chr19 position 1860601, Chr19 position 1860607, Chr19 position 2503954, Chr19 position 3434917, Chr19 position 3434921, Chr19 position 3434930, Chr19 position 3434939, Chr19 position 3434952, Chr19 position 3434954, Chr19 position 3434962, Chr19 position 3434964, Chr19 position 3434979, Chr19 position 3434985, Chr19 position 4052713, Chr19 position 4052714, Chr19 position 4052749, Chr19 position 4374591, Chr19 position 5013982, Chr19 position 5048836, Chr19 position 5048867, Chr19 position 5048877, Chr19 position 8367279, Chr19 position 8428573, Chr19 position 10254577, Chr19 position 10254578, Chr19 position 10463956, Chr19 position 10464137, Chr19 position 13203671, Chr19 position 13266925, Chr19 position 13266934, Chr19 position 13266970, Chr19 position 13842142, Chr19 position 14248494, Chr19 position 15375465, Chr19 position 17218912, Chr19 position 17346702, Chr19 position 17346702, Chr19 position 18157161, Chr19 position 18157221, Chr19 position 18157258, Chr19 position 18415877, Chr19 position 18415890, Chr19 position 30606642, Chr19 position 35531842, Chr19 position 44303112, Chr19 position 47173037, Chr19 position 47316268, Chr19 position 47778278, Chr19 position 47778298, Chr20 position 34206950, Chr20 position 36771969, Chr20 position 48993661, Chr20 position 58406398, Chr20 position 61976049, Chr20 position 61976073, Chr20 position 62588571, Chr20 position 62588579, Chr22 position 19738127, Chr22 position 35965176, Chr22 position 36549809, Chr22 position 36973375, Chr22 position 37447953, Chr22 position 37914998, Chr22 position 38307317, Chr22 position 39662794, and Chr22 position 45622980.

In embodiments, the method includes detecting methylation or unmethylation of at least 400 of the following sites: Chr1 position 2996653, Chr1 position 11979164, Chr1 position 12655938, Chr1 position 16450525, Chr1 position 16450542, Chr1 position 16450545, Chr1 position 16469987, Chr1 position 17494491, Chr1 position 25473203, Chr1 position 27640460, Chr1 position 29565080, Chr1 position 38493013, Chr1 position 38493030, Chr1 position 38493074, Chr1 position 46713777, Chr1 position 46914121, Chr1 position 46955744, Chr1 position 55008344, Chr1 position 109816092, Chr1 position 109816111, Chr1 position 110074669, Chr1 position 110074681, Chr1 position 110074685, Chr1 position 150949856, Chr1 position 150949857, Chr1 position 153540282, Chr1 position 155162704, Chr1 position 155162714, Chr1 position 156676611, Chr1 position 157611881, Chr1 position 182205324, Chr1 position 204118999, Chr1 position 206741875, Chr1 position 206741989, Chr1 position 212587673, Chr1 position 212841198, Chr1 position 223403952, Chr1 position 233430972, Chr1 position 234342767, Chr2 position 3454277, Chr2 position 8793724, Chr2 position 20412441, Chr2 position 42329402, Chr2 position 42329494, Chr2 position 55289272, Chr2 position 65064865, Chr2 position 70823641, Chr2 position 73143689, Chr2 position 74454110, Chr2 position 122014529, Chr2 position 128158884, Chr2 position 128158910, Chr2 position 203114171, Chr2 position 218221671, Chr2 position 219745335, Chr2 position 238341465, Chr2 position 238341542, Chr2 position 238341546, Chr2 position 238774763, Chr3 position 13323642, Chr3 position 14180153, Chr3 position 45209073, Chr3 position 45209207, Chr3 position 52525100, Chr3 position 62589658, Chr3 position 65388317, Chr3 position 65388388, Chr3 position 73599302, Chr3 position 195636893, Chr3 position 197093846, Chr4 position 3743223, Chr4 position 5755716, Chr4 position 5755717, Chr4 position 5755728, Chr4 position 5755729, Chr4 position 5755734, Chr4 position 8372861, Chr4 position 57548289, Chr5 position 1118280, Chr5 position 34564389, Chr5 position 73871907, Chr5 position 78013596, Chr5 position 78013643, Chr5 position 137802650, Chr5 position 139051189, Chr5 position 167838221, Chr5 position 177541401, Chr5 position 180018672, Chr5 position 180101026, Chr6 position 3394325, Chr6 position 3887581, Chr6 position 7236568, Chr6 position 7728692, Chr6 position 34203617, Chr6 position 37751320, Chr6 position 41410682, Chr6 position 41438516, Chr6 position 41438575, Chr6 position 43464150, Chr6 position 158734279, Chr7 position 989235, Chr7 position 2673543, Chr7 position 73508602, Chr7 position 105079565, Chr7 position 105079631, Chr7 position 151425103, Chr7 position 151425104, Chr8 position 11764017, Chr8 position 21647308, Chr8 position 22548399, Chr8 position 22548483, Chr8 position 133570537, Chr8 position 141320393, Chr8 position 141320410, Chr9 position 6566568, Chr9 position 16197862, Chr9 position 34591313, Chr9 position 98225096, Chr9 position 126126741, Chr9 position 132083428, Chr9 position 136077410, Chr9 position 139655018, Chr9 position 140205985, Chr9 position 140205985, Chr9 position 140205997, Chr10 position 3929071, Chr10 position 30047012, Chr10 position 79702989, Chr10 position 87984905, Chr10 position 94838789, Chr10 position 102131187, Chr10 position 104196489, Chr10 position 111766879, Chr10 position 112258886, Chr10 position 112258984, Chr10 position 112259015, Chr10 position 116391763, Chr10 position 120011530, Chr10 position 126172714, Chr10 position 126172747, Chr11 position 556355, Chr11 position 821282, Chr11 position 12188937, Chr11 position 12188948, Chr11 position 12188995, Chr11 position 36057726, Chr11 position 48070143, Chr11 position 48070163, Chr11 position 48070166, Chr11 position 48070174, Chr11 position 65158294, Chr11 position 65158342, Chr11 position 65297089, Chr11 position 66104481, Chr11 position 66104485, Chr11 position 66104578, Chr11 position 68608767, Chr11 position 70236292, Chr11 position 70236320, Chr11 position 70236331, Chr11 position 115530032, Chr11 position 117950310, Chr11 position 117950329, Chr11 position 117950361, Chr11 position 117950362, Chr11 position 119293593, Chr12 position 679803, Chr12 position 26039132, Chr12 position 31004558, Chr12 position 45610695, Chr12 position 45610701, Chr12 position 45610702, Chr12 position 45610706, Chr12 position 50286016, Chr12 position 52243258, Chr12 position 52243286, Chr12 position 54145732, Chr12 position 54145741, Chr12 position 54145825, Chr12 position 56115043, Chr12 position 66262229, Chr12 position 66262230, Chr12 position 66262233, Chr12 position 66262234, Chr12 position 77266621, Chr12 position 117580102, Chr12 position 123435962, Chr12 position 123436011, Chr12 position 123436065, Chr12 position 123540893, Chr13 position 20735797, Chr13 position 23500419, Chr13 position 46771519, Chr13 position 46771520, Chr13 position 53313426, Chr13 position 113807393, Chr14 position 38599118, Chr14 position 69170010, Chr14 position 75701632, Chr14 position 75701643, Chr14 position 90850454, Chr14 position 97524282, Chr14 position 103541602, Chr14 position 103768055, Chr14 position 104209000, Chr14 position 104209068, Chr14 position 104354645, Chr14 position 104360487, Chr15 position 41068807, Chr15 position 61152225, Chr15 position 61152253, Chr15 position 61152313, Chr15 position 65186440, Chr15 position 68851629, Chr15 position 70667596, Chr15 position 70767206, Chr15 position 75251486, Chr15 position 77984014, Chr15 position 77989064, Chr15 position 83952081, Chr15 position 85402496, Chr15 position 85402497, Chr15 position 99417337, Chr16 position 1231873, Chr16 position 1458639, Chr16 position 3023231, Chr16 position 23135832, Chr16 position 29616265, Chr16 position 31009547, Chr16 position 31009548, Chr16 position 31009590, Chr16 position 57793674, Chr16 position 57793715, Chr16 position 57793727, Chr16 position 70771056, Chr16 position 70771079, Chr16 position 70771141, Chr16 position 77332010, Chr16 position 78540378, Chr16 position 79333435, Chr16 position 84262419, Chr16 position 88701114, Chr16 position 89988308, Chr16 position 89988644, Chr17 position 1509928, Chr17 position 1509945, Chr17 position 1509952, Chr17 position 1509953, Chr17 position 7644013, Chr17 position 16323460, Chr17 position 16323473, Chr17 position 16924561, Chr17 position 16924562, Chr17 position 16924594, Chr17 position 17717918, Chr17 position 17718591, Chr17 position 18139506, Chr17 position 35278031, Chr17 position 39677570, Chr17 position 40826257, Chr17 position 43037426, Chr17 position 43200096, Chr17 position 43200239, Chr17 position 43510142, Chr17 position 47987828, Chr17 position 48178379, Chr17 position 48596391, Chr17 position 48764165, Chr17 position 55701962, Chr17 position 73584599, Chr17 position 73993165, Chr17 position 75827716, Chr17 position 76882243, Chr17 position 78765910, Chr17 position 79544478, Chr17 position 80696474, Chr18 position 19751759, Chr18 position 21440760, Chr18 position 45555437, Chr18 position 45555438, Chr18 position 46547891, Chr18 position 55888885, Chr18 position 56452096, Chr18 position 56452476, Chr18 position 56887181, Chr18 position 76002973, Chr18 position 77331090, Chr19 position 677895, Chr19 position 884044, Chr19 position 884059, Chr19 position 884105, Chr19 position 884115, Chr19 position 1136511, Chr19 position 1177605, Chr19 position 1177612, Chr19 position 1177640, Chr19 position 1860601, Chr19 position 1860607, Chr19 position 2503954, Chr19 position 3434917, Chr19 position 3434921, Chr19 position 3434930, Chr19 position 3434939, Chr19 position 3434952, Chr19 position 3434954, Chr19 position 3434962, Chr19 position 3434964, Chr19 position 3434979, Chr19 position 3434985, Chr19 position 4052713, Chr19 position 4052714, Chr19 position 4052749, Chr19 position 4374591, Chr19 position 5013982, Chr19 position 5048836, Chr19 position 5048867, Chr19 position 5048877, Chr19 position 8367279, Chr19 position 8428573, Chr19 position 10254577, Chr19 position 10254578, Chr19 position 10463956, Chr19 position 10464137, Chr19 position 13203671, Chr19 position 13266925, Chr19 position 13266934, Chr19 position 13266970, Chr19 position 13842142, Chr19 position 14248494, Chr19 position 15375465, Chr19 position 17218912, Chr19 position 17346702, Chr19 position 17346702, Chr19 position 18157161, Chr19 position 18157221, Chr19 position 18157258, Chr19 position 18415877, Chr19 position 18415890, Chr19 position 30606642, Chr19 position 35531842, Chr19 position 44303112, Chr19 position 47173037, Chr19 position 47316268, Chr19 position 47778278, Chr19 position 47778298, Chr20 position 34206950, Chr20 position 36771969, Chr20 position 48993661, Chr20 position 58406398, Chr20 position 61976049, Chr20 position 61976073, Chr20 position 62588571, Chr20 position 62588579, Chr22 position 19738127, Chr22 position 35965176, Chr22 position 36549809, Chr22 position 36973375, Chr22 position 37447953, Chr22 position 37914998, Chr22 position 38307317, Chr22 position 39662794, and Chr22 position 45622980.

In embodiments, the method includes detecting methylation or unmethylation of at least 500 of the following sites: Chr1 position 2996653, Chr1 position 11979164, Chr1 position 12655938, Chr1 position 16450525, Chr1 position 16450542, Chr1 position 16450545, Chr1 position 16469987, Chr1 position 17494491, Chr1 position 25473203, Chr1 position 27640460, Chr1 position 29565080, Chr1 position 38493013, Chr1 position 38493030, Chr1 position 38493074, Chr1 position 46713777, Chr1 position 46914121, Chr1 position 46955744, Chr1 position 55008344, Chr1 position 109816092, Chr1 position 109816111, Chr1 position 110074669, Chr1 position 110074681, Chr1 position 110074685, Chr1 position 150949856, Chr1 position 150949857, Chr1 position 153540282, Chr1 position 155162704, Chr1 position 155162714, Chr1 position 156676611, Chr1 position 157611881, Chr1 position 182205324, Chr1 position 204118999, Chr1 position 206741875, Chr1 position 206741989, Chr1 position 212587673, Chr1 position 212841198, Chr1 position 223403952, Chr1 position 233430972, Chr1 position 234342767, Chr2 position 3454277, Chr2 position 8793724, Chr2 position 20412441, Chr2 position 42329402, Chr2 position 42329494, Chr2 position 55289272, Chr2 position 65064865, Chr2 position 70823641, Chr2 position 73143689, Chr2 position 74454110, Chr2 position 122014529, Chr2 position 128158884, Chr2 position 128158910, Chr2 position 203114171, Chr2 position 218221671, Chr2 position 219745335, Chr2 position 238341465, Chr2 position 238341542, Chr2 position 238341546, Chr2 position 238774763, Chr3 position 13323642, Chr3 position 14180153, Chr3 position 45209073, Chr3 position 45209207, Chr3 position 52525100, Chr3 position 62589658, Chr3 position 65388317, Chr3 position 65388388, Chr3 position 73599302, Chr3 position 195636893, Chr3 position 197093846, Chr4 position 3743223, Chr4 position 5755716, Chr4 position 5755717, Chr4 position 5755728, Chr4 position 5755729, Chr4 position 5755734, Chr4 position 8372861, Chr4 position 57548289, Chr5 position 1118280, Chr5 position 34564389, Chr5 position 73871907, Chr5 position 78013596, Chr5 position 78013643, Chr5 position 137802650, Chr5 position 139051189, Chr5 position 167838221, Chr5 position 177541401, Chr5 position 180018672, Chr5 position 180101026, Chr6 position 3394325, Chr6 position 3887581, Chr6 position 7236568, Chr6 position 7728692, Chr6 position 34203617, Chr6 position 37751320, Chr6 position 41410682, Chr6 position 41438516, Chr6 position 41438575, Chr6 position 43464150, Chr6 position 158734279, Chr7 position 989235, Chr7 position 2673543, Chr7 position 73508602, Chr7 position 105079565, Chr7 position 105079631, Chr7 position 151425103, Chr7 position 151425104, Chr8 position 11764017, Chr8 position 21647308, Chr8 position 22548399, Chr8 position 22548483, Chr8 position 133570537, Chr8 position 141320393, Chr8 position 141320410, Chr9 position 6566568, Chr9 position 16197862, Chr9 position 34591313, Chr9 position 98225096, Chr9 position 126126741, Chr9 position 132083428, Chr9 position 136077410, Chr9 position 139655018, Chr9 position 140205985, Chr9 position 140205985, Chr9 position 140205997, Chr10 position 3929071, Chr10 position 30047012, Chr10 position 79702989, Chr10 position 87984905, Chr10 position 94838789, Chr10 position 102131187, Chr10 position 104196489, Chr10 position 111766879, Chr10 position 112258886, Chr10 position 112258984, Chr10 position 112259015, Chr10 position 116391763, Chr10 position 120011530, Chr10 position 126172714, Chr10 position 126172747, Chr11 position 556355, Chr11 position 821282, Chr11 position 12188937, Chr11 position 12188948, Chr11 position 12188995, Chr11 position 36057726, Chr11 position 48070143, Chr11 position 48070163, Chr11 position 48070166, Chr11 position 48070174, Chr11 position 65158294, Chr11 position 65158342, Chr11 position 65297089, Chr11 position 66104481, Chr11 position 66104485, Chr11 position 66104578, Chr11 position 68608767, Chr11 position 70236292, Chr11 position 70236320, Chr11 position 70236331, Chr11 position 115530032, Chr11 position 117950310, Chr11 position 117950329, Chr11 position 117950361, Chr11 position 117950362, Chr11 position 119293593, Chr12 position 679803, Chr12 position 26039132, Chr12 position 31004558, Chr12 position 45610695, Chr12 position 45610701, Chr12 position 45610702, Chr12 position 45610706, Chr12 position 50286016, Chr12 position 52243258, Chr12 position 52243286, Chr12 position 54145732, Chr12 position 54145741, Chr12 position 54145825, Chr12 position 56115043, Chr12 position 66262229, Chr12 position 66262230, Chr12 position 66262233, Chr12 position 66262234, Chr12 position 77266621, Chr12 position 117580102, Chr12 position 123435962, Chr12 position 123436011, Chr12 position 123436065, Chr12 position 123540893, Chr13 position 20735797, Chr13 position 23500419, Chr13 position 46771519, Chr13 position 46771520, Chr13 position 53313426, Chr13 position 113807393, Chr14 position 38599118, Chr14 position 69170010, Chr14 position 75701632, Chr14 position 75701643, Chr14 position 90850454, Chr14 position 97524282, Chr14 position 103541602, Chr14 position 103768055, Chr14 position 104209000, Chr14 position 104209068, Chr14 position 104354645, Chr14 position 104360487, Chr15 position 41068807, Chr15 position 61152225, Chr15 position 61152253, Chr15 position 61152313, Chr15 position 65186440, Chr15 position 68851629, Chr15 position 70667596, Chr15 position 70767206, Chr15 position 75251486, Chr15 position 77984014, Chr15 position 77989064, Chr15 position 83952081, Chr15 position 85402496, Chr15 position 85402497, Chr15 position 99417337, Chr16 position 1231873, Chr16 position 1458639, Chr16 position 3023231, Chr16 position 23135832, Chr16 position 29616265, Chr16 position 31009547, Chr16 position 31009548, Chr16 position 31009590, Chr16 position 57793674, Chr16 position 57793715, Chr16 position 57793727, Chr16 position 70771056, Chr16 position 70771079, Chr16 position 70771141, Chr16 position 77332010, Chr16 position 78540378, Chr16 position 79333435, Chr16 position 84262419, Chr16 position 88701114, Chr16 position 89988308, Chr16 position 89988644, Chr17 position 1509928, Chr17 position 1509945, Chr17 position 1509952, Chr17 position 1509953, Chr17 position 7644013, Chr17 position 16323460, Chr17 position 16323473, Chr17 position 16924561, Chr17 position 16924562, Chr17 position 16924594, Chr17 position 17717918, Chr17 position 17718591, Chr17 position 18139506, Chr17 position 35278031, Chr17 position 39677570, Chr17 position 40826257, Chr17 position 43037426, Chr17 position 43200096, Chr17 position 43200239, Chr17 position 43510142, Chr17 position 47987828, Chr17 position 48178379, Chr17 position 48596391, Chr17 position 48764165, Chr17 position 55701962, Chr17 position 73584599, Chr17 position 73993165, Chr17 position 75827716, Chr17 position 76882243, Chr17 position 78765910, Chr17 position 79544478, Chr17 position 80696474, Chr18 position 19751759, Chr18 position 21440760, Chr18 position 45555437, Chr18 position 45555438, Chr18 position 46547891, Chr18 position 55888885, Chr18 position 56452096, Chr18 position 56452476, Chr18 position 56887181, Chr18 position 76002973, Chr18 position 77331090, Chr19 position 677895, Chr19 position 884044, Chr19 position 884059, Chr19 position 884105, Chr19 position 884115, Chr19 position 1136511, Chr19 position 1177605, Chr19 position 1177612, Chr19 position 1177640, Chr19 position 1860601, Chr19 position 1860607, Chr19 position 2503954, Chr19 position 3434917, Chr19 position 3434921, Chr19 position 3434930, Chr19 position 3434939, Chr19 position 3434952, Chr19 position 3434954, Chr19 position 3434962, Chr19 position 3434964, Chr19 position 3434979, Chr19 position 3434985, Chr19 position 4052713, Chr19 position 4052714, Chr19 position 4052749, Chr19 position 4374591, Chr19 position 5013982, Chr19 position 5048836, Chr19 position 5048867, Chr19 position 5048877, Chr19 position 8367279, Chr19 position 8428573, Chr19 position 10254577, Chr19 position 10254578, Chr19 position 10463956, Chr19 position 10464137, Chr19 position 13203671, Chr19 position 13266925, Chr19 position 13266934, Chr19 position 13266970, Chr19 position 13842142, Chr19 position 14248494, Chr19 position 15375465, Chr19 position 17218912, Chr19 position 17346702, Chr19 position 17346702, Chr19 position 18157161, Chr19 position 18157221, Chr19 position 18157258, Chr19 position 18415877, Chr19 position 18415890, Chr19 position 30606642, Chr19 position 35531842, Chr19 position 44303112, Chr19 position 47173037, Chr19 position 47316268, Chr19 position 47778278, Chr19 position 47778298, Chr20 position 34206950, Chr20 position 36771969, Chr20 position 48993661, Chr20 position 58406398, Chr20 position 61976049, Chr20 position 61976073, Chr20 position 62588571, Chr20 position 62588579, Chr22 position 19738127, Chr22 position 35965176, Chr22 position 36549809, Chr22 position 36973375, Chr22 position 37447953, Chr22 position 37914998, Chr22 position 38307317, Chr22 position 39662794, and Chr22 position 45622980.

In embodiments, a method provided herein is practiced for a subject more than once over time. In embodiments, methylation or unmethylation of thyroid nodule DNA from a subject is assessed using a method provided herein at least 1, 2, 3, 4, 5, 6, 7, 8, 9, 10 or more times. In embodiments, the method is repeated at least once every 4, 6, 8, 12 or 18 months, or at least once every 2, 3, 4, or 5 more years.

In embodiments, the method includes: (i) isolating DNA from multiple cells of a thyroid nodule of the subject thereby forming a plurality of isolated thyroid nodule DNA molecules, (ii) contacting the plurality of isolated thyroid nodule DNA molecules with a bisulfite salt thereby forming a plurality of reacted thyroid nodule DNA molecules, (iii) detecting the proportion of DNA molecules in the plurality of reacted thyroid nodule DNA molecules having a uracil at a methylation site set forth in Table 1, thereby detecting methylation or unmethylation of said thyroid nodule DNA of the subject.

The methylation of a CpG site of interest may vary between individual cells (and even between chromosome pairs of individual cells) in a biological sample. When DNA is obtained from a biological sample and treated with a bisulfite salt to convert unmethylated cytosines to uracils, the bisulfite-treated DNA will typically contain (i) a proportion of DNA molecules with a cytosine at the site of interest (indicating that the site was methylated); and (ii) a proportion of DNA molecules with a uracil at the site of interest (indicating that the site was unmethylated). Since a uracil at a site of interest in bisulfite-treated DNA indicates that the site was unmethylated in the untreated DNA, a thymidine at the corresponding site in an amplicon of the bisulfite-treated DNA (e.g., an amplicon obtained by PCR) also indicates that the site was unmethylated in the untreated DNA.

In embodiments, the level of methylation at a site of interest is the proportion of bisulfite-treated DNA molecules having a cytosine rather than a uracil at that site of interest. In embodiments, the level of methylation at a site of interest is the proportion of amplicons of bisulfite-treated DNA molecules having a cytosine rather than a thymidine at that site of interest.

In embodiments, the level of unmethylation at a site of interest is the proportion of bisulfite-treated DNA molecules having a uracil rather than a cytosine at that site of interest. In embodiments, the level of unmethylation at a site of interest is the proportion of amplicons of bisulfite-treated DNA molecules having a thymidine rather than a cytosine at that site of interest. In Table 1, an indicated level of uracil is the proportion of bisulfite-treated DNA molecules having a uracil rather than a cytosine at the specified methylation site. The same levels listed in Table 1 also apply to the thymidine levels at a site of interest in an amplicon, i.e., the proportion of amplicons (derived from the PCR amplification of bisulfite-treated DNA molecules) having a thymidine rather than a cytosine at the specified methylation site.

The level of DNA methylation at a site of interest (e.g., a methylation site listed in Table 1) may be determined using sequencing technology. Sequencing technology can reveal nucleotide sequence variations in a plurality of DNA molecules at a single nucleotide base resolution. For example, the proportions of corresponding DNA molecules having a uracil, a thymidine, and/or a cytosine at a site may be determined. A non-limiting example of a sequencing-based method for determining the methylation level at a site of interest is described in Masser et al. (2015) Targeted DNA Methylation Analysis by Next-generation Sequencing. J Vis Exp. (96): 52488, the entire content of which is incorporated herein by reference.

The chromosomal positions listed in Tables 1-4 relate to the human genome that is publically accessible in the University of California Santa Cruz (UCSC) genome browser database under accession number HG19, the entire content of which is incorporated herein by reference in its entirety. Non-limiting information regarding the UCSC Genome Browser is provided in Kent W J, Sugnet C W, Furey T S, Roskin K M, Pringle T H, Zahler A M, Haussler D. The human genome browser at UCSC. Genome Res. 2002 June; 12(6):996-1006, the entire content of which is incorporated herein by reference. Each methylation site of interest listed in Table 1 may be located in other human genomes (e.g., within the genome of a specific subject or group of subjects) by replacing every U and R in the corresponding sequence with a C and then searching for the location of the X within a reference genome by aligning the sequence against the reference genome. For example, the methylation site of interest "X" in SEQ ID NO: 1 may be located within a genome by replacing each U and R in SEQ ID NO: 1 with a C (to obtain the pre-bisulfite-modified sequence having an X at the site of interest) and then aligning the sequence against the genome using a BLAST algorithm. Also expressly provided, disclosed, and incorporated herein is the non-bisulfite-modified sequence corresponding to each of SEQ ID NOS: 1-550. The non-bisulfite-modified sequence corresponding to each of SEQ ID NOS: 1-550 is each respective sequence in which each U and R is replaced with a C, where X is the methylation site of interest. For example, the non-bisulfite-modified sequence corresponding to SEQ ID NO: 1 provided herein is a modified version of SEQ ID NO: 1 in which each U and R in SEQ ID NO: 1 is replaced with a C, where X is the methylation site of interest; the non-bisulfite-modified sequence corresponding to SEQ ID NO:2 provided herein is a modified version of SEQ ID NO:2 in which each U and R in SEQ ID NO:2 is replaced with a C, where X is the methylation site of interest; the non-bisulfite-modified sequence corresponding to SEQ ID NO:3 provided herein is a modified version of SEQ ID NO:3 in which each U and R in SEQ ID NO:3 is replaced with a C, where X is the methylation site of interest, and so on.

TABLE 1

| Chromosome (chr) | Chr Position | Uracil level in reacted thyroid nodule DNA from cancer tissues is above indicated level* | Uracil level in reacted thyroid nodule DNA from benign tissues is above indicated level* | Uracil level in reacted thyroid nodule DNA from benign tissues is below indicated level* | SEQ ID NO: Forward Strand | SEQ ID NO: Reverse Strand |
|---|---|---|---|---|---|---|
| chr1 | 2996653 | N/A | 88.84 | N/A | 1 | 2 |
| chr1 | 11979164 | 89.29 | N/A | N/A | 3 | 4 |
| chr1 | 12655938 | N/A | N/A | 69.23 | 5 | 6 |
| chr1 | 16450525 | 70.00 | N/A | N/A | 7 | 8 |
| chr1 | 16450542 | 72.00 | N/A | N/A | 7 | 8 |
| chr1 | 16450545 | 73.33 | N/A | N/A | 7 | 8 |
| chr1 | 16469987 | 80.00 | N/A | N/A | 9 | 10 |
| chr1 | 17494491 | 86.00 | N/A | N/A | 11 | 12 |
| chr1 | 25473203 | 88.89 | N/A | N/A | 13 | 14 |
| chr1 | 27640460 | N/A | 80.56 | N/A | 15 | 16 |
| chr1 | 29565080 | N/A | N/A | 60.00 | 17 | 18 |
| chr1 | 38493013 | 86.36 | N/A | N/A | 19 | 20 |
| chr1 | 38493030 | 79.17 | N/A | N/A | 19 | 20 |
| chr1 | 38493074 | 80.95 | N/A | N/A | 19 | 20 |
| chr1 | 46713777 | N/A | N/A | 73.33 | 21 | 22 |
| chr1 | 46914121 | N/A | N/A | 60.00 | 23 | 24 |
| chr1 | 46955744 | N/A | N/A | 77.78 | 25 | 26 |
| chr1 | 55008344 | N/A | N/A | 60.00 | 27 | 28 |
| chr1 | 109816092 | 80.77 | N/A | N/A | 29 | 30 |
| chr1 | 109816111 | 80.77 | N/A | N/A | 29 | 30 |
| chr1 | 110074669 | 75.00 | N/A | N/A | 31 | 32 |
| chr1 | 110074681 | 71.43 | N/A | N/A | 31 | 32 |
| chr1 | 110074685 | 63.16 | N/A | N/A | 31 | 32 |
| chr1 | 150949856 | 89.29 | N/A | N/A | 33 | 34 |
| chr1 | 150949857 | 88.46 | N/A | N/A | 33 | 34 |
| chr1 | 153540282 | 78.26 | N/A | N/A | 35 | 36 |
| chr1 | 155162704 | 84.21 | N/A | N/A | 37 | 38 |
| chr1 | 155162714 | 88.64 | N/A | N/A | 37 | 38 |
| chr1 | 156676611 | N/A | N/A | 84.62 | 39 | 40 |
| chr1 | 157611881 | 83.05 | N/A | N/A | 41 | 42 |
| chr1 | 182205324 | 77.50 | N/A | N/A | 43 | 44 |
| chr1 | 204118999 | 59.09 | N/A | N/A | 45 | 46 |
| chr1 | 206741875 | 83.33 | N/A | N/A | 47 | 48 |
| chr1 | 206741989 | 66.67 | N/A | N/A | 49 | 50 |
| chr1 | 212587673 | N/A | N/A | 80.00 | 51 | 52 |
| chr1 | 212841198 | 85.29 | N/A | N/A | 53 | 54 |
| chr1 | 223403952 | 79.17 | N/A | N/A | 55 | 56 |
| chr1 | 233430972 | N/A | N/A | 86.67 | 57 | 58 |
| chr1 | 234342767 | 76.67 | N/A | N/A | 59 | 60 |
| chr10 | 3929071 | 88.68 | N/A | N/A | 61 | 62 |
| chr10 | 30047012 | 86.84 | N/A | N/A | 63 | 64 |
| chr10 | 79702989 | 83.33 | N/A | N/A | 65 | 66 |
| chr10 | 87984905 | 86.36 | N/A | N/A | 67 | 68 |
| chr10 | 94838789 | 63.33 | N/A | N/A | 69 | 70 |
| chr10 | 102131187 | 90.00 | N/A | N/A | 71 | 72 |
| chr10 | 104196489 | 75.00 | N/A | N/A | 73 | 74 |
| chr10 | 111766879 | 89.47 | N/A | N/A | 75 | 76 |
| chr10 | 112258886 | 81.82 | N/A | N/A | 77 | 78 |
| chr10 | 112258984 | 83.33 | N/A | N/A | 79 | 80 |
| chr10 | 112259015 | 82.61 | N/A | N/A | 79 | 80 |
| chr10 | 116391763 | N/A | N/A | 75.00 | 81 | 82 |
| chr10 | 120011530 | 79.55 | N/A | N/A | 83 | 84 |
| chr10 | 126172714 | N/A | 80.00 | N/A | 85 | 86 |
| chr10 | 126172747 | N/A | 84.62 | N/A | 85 | 86 |
| chr11 | 556355 | N/A | N/A | 75.00 | 87 | 88 |
| chr11 | 821282 | 89.13 | N/A | N/A | 89 | 90 |
| chr11 | 12188937 | 83.33 | N/A | N/A | 91 | 92 |
| chr11 | 12188948 | 77.78 | N/A | N/A | 91 | 92 |
| chr11 | 12188995 | 78.57 | N/A | N/A | 93 | 94 |
| chr11 | 36057726 | N/A | 79.63 | N/A | 95 | 96 |
| chr11 | 48070143 | N/A | 84.38 | N/A | 97 | 98 |
| chr11 | 48070163 | N/A | 87.50 | N/A | 97 | 98 |
| chr11 | 48070166 | N/A | 84.38 | N/A | 97 | 98 |
| chr11 | 48070174 | N/A | 84.48 | N/A | 97 | 98 |
| chr11 | 65158294 | 78.00 | N/A | N/A | 99 | 100 |
| chr11 | 65158342 | 85.00 | N/A | N/A | 99 | 100 |
| chr11 | 65297089 | 75.00 | N/A | N/A | 101 | 102 |
| chr11 | 66104481 | 81.58 | N/A | N/A | 103 | 104 |
| chr11 | 66104485 | 83.33 | N/A | N/A | 103 | 104 |
| chr11 | 66104578 | 81.82 | N/A | N/A | 105 | 106 |
| chr11 | 68608767 | N/A | N/A | 73.33 | 107 | 108 |
| chr11 | 70236292 | 89.29 | N/A | N/A | 109 | 110 |
| chr11 | 70236320 | 85.71 | N/A | N/A | 109 | 110 |

TABLE 1-continued

| Chromosome (chr) | Chr Position | Uracil level in reacted thyroid nodule DNA from cancer tissues is above indicated level* | Uracil level in reacted thyroid nodule DNA from benign tissues is above indicated level* | Uracil level in reacted thyroid nodule DNA from benign tissues is below indicated level* | SEQ ID NO: Forward Strand | SEQ ID NO: Reverse Strand |
|---|---|---|---|---|---|---|
| chr11 | 70236331 | 70.83 | N/A | N/A | 109 | 110 |
| chr11 | 115530032 | N/A | N/A | 79.49 | 111 | 112 |
| chr11 | 117950310 | 79.55 | N/A | N/A | 113 | 114 |
| chr11 | 117950329 | 79.55 | N/A | N/A | 113 | 114 |
| chr11 | 117950361 | 80.00 | N/A | N/A | 115 | 116 |
| chr11 | 117950362 | 81.82 | N/A | N/A | 115 | 116 |
| chr11 | 119293593 | N/A | N/A | 60.00 | 117 | 118 |
| chr12 | 679803 | 86.84 | N/A | N/A | 119 | 120 |
| chr12 | 26039132 | 73.91 | N/A | N/A | 121 | 122 |
| chr12 | 31004558 | N/A | N/A | 81.82 | 123 | 124 |
| chr12 | 45610695 | N/A | N/A | 83.33 | 125 | 126 |
| chr12 | 45610701 | N/A | N/A | 86.67 | 125 | 126 |
| chr12 | 45610702 | N/A | N/A | 89.47 | 125 | 126 |
| chr12 | 45610706 | N/A | N/A | 80.00 | 125 | 126 |
| chr12 | 50286016 | 82.14 | N/A | N/A | 127 | 128 |
| chr12 | 52243258 | 82.00 | N/A | N/A | 129 | 130 |
| chr12 | 52243286 | 82.50 | N/A | N/A | 129 | 130 |
| chr12 | 54145732 | N/A | N/A | 82.35 | 131 | 132 |
| chr12 | 54145741 | N/A | N/A | 76.47 | 131 | 132 |
| chr12 | 54145825 | N/A | N/A | 70.59 | 131 | 132 |
| chr12 | 56115043 | 89.29 | N/A | N/A | 133 | 134 |
| chr12 | 66262229 | 72.22 | N/A | N/A | 135 | 136 |
| chr12 | 66262230 | 71.74 | N/A | N/A | 135 | 136 |
| chr12 | 66262233 | 68.27 | N/A | N/A | 135 | 136 |
| chr12 | 66262234 | 71.74 | N/A | N/A | 135 | 136 |
| chr12 | 77266621 | N/A | 73.53 | N/A | 137 | 138 |
| chr12 | 117580102 | 84.62 | N/A | N/A | 139 | 140 |
| chr12 | 123435962 | 63.89 | N/A | N/A | 141 | 142 |
| chr12 | 123436011 | 71.88 | N/A | N/A | 143 | 144 |
| chr12 | 123436065 | 69.44 | N/A | N/A | 143 | 144 |
| chr12 | 123540893 | 77.27 | N/A | N/A | 145 | 146 |
| chr13 | 20735797 | N/A | N/A | 82.35 | 147 | 148 |
| chr13 | 23500419 | N/A | N/A | 68.42 | 149 | 150 |
| chr13 | 46771519 | 67.65 | N/A | N/A | 151 | 152 |
| chr13 | 46771520 | 73.91 | N/A | N/A | 151 | 152 |
| chr13 | 53313426 | N/A | N/A | 60.00 | 153 | 154 |
| chr13 | 113807393 | N/A | N/A | 27.27 | 155 | 156 |
| chr14 | 38599118 | 65.91 | N/A | N/A | 157 | 158 |
| chr14 | 69170010 | 86.36 | N/A | N/A | 159 | 160 |
| chr14 | 75701632 | 68.42 | N/A | N/A | 161 | 162 |
| chr14 | 75701643 | 68.75 | N/A | N/A | 161 | 162 |
| chr14 | 90850454 | N/A | N/A | 54.55 | 163 | 164 |
| chr14 | 97524282 | N/A | 88.89 | N/A | 165 | 166 |
| chr14 | 103541602 | N/A | N/A | 52.00 | 167 | 168 |
| chr14 | 103768055 | 76.09 | N/A | N/A | 169 | 170 |
| chr14 | 104209000 | N/A | 80.77 | N/A | 171 | 172 |
| chr14 | 104209068 | N/A | 83.33 | N/A | 171 | 172 |
| chr14 | 104354645 | 72.92 | N/A | N/A | 173 | 174 |
| chr14 | 104360487 | 83.33 | N/A | N/A | 175 | 176 |
| chr15 | 41068807 | 69.12 | N/A | N/A | 177 | 178 |
| chr15 | 61152225 | 83.33 | N/A | N/A | 179 | 180 |
| chr15 | 61152253 | 86.67 | N/A | N/A | 181 | 182 |
| chr15 | 61152313 | 86.67 | N/A | N/A | 183 | 184 |
| chr15 | 65186440 | N/A | N/A | 55.56 | 185 | 186 |
| chr15 | 68851629 | N/A | N/A | 63.64 | 187 | 188 |
| chr15 | 70667596 | 83.33 | N/A | N/A | 189 | 190 |
| chr15 | 70767206 | 90.00 | N/A | N/A | 191 | 192 |
| chr15 | 75251486 | N/A | N/A | 60.00 | 193 | 194 |
| chr15 | 77984014 | N/A | 88.89 | N/A | 195 | 196 |
| chr15 | 77989064 | 73.53 | N/A | N/A | 197 | 198 |
| chr15 | 83952081 | N/A | N/A | 72.73 | 199 | 200 |
| chr15 | 85402496 | 82.10 | N/A | N/A | 201 | 202 |
| chr15 | 85402497 | 79.49 | N/A | N/A | 201 | 202 |
| chr15 | 99417337 | 88.89 | N/A | N/A | 203 | 204 |
| chr16 | 1231873 | 86.36 | N/A | N/A | 205 | 206 |
| chr16 | 1458639 | N/A | N/A | 75.00 | 207 | 208 |
| chr16 | 3023231 | N/A | 84.00 | N/A | 209 | 210 |
| chr16 | 23135832 | 87.50 | N/A | N/A | 211 | 212 |
| chr16 | 29616265 | 85.71 | N/A | N/A | 213 | 214 |
| chr16 | 31009547 | 84.00 | N/A | N/A | 215 | 216 |
| chr16 | 31009548 | 85.00 | N/A | N/A | 215 | 216 |
| chr16 | 31009590 | 85.00 | N/A | N/A | 215 | 216 |
| chr16 | 57793674 | 80.95 | N/A | N/A | 217 | 218 |

TABLE 1-continued

| Chromosome (chr) | Chr Position | Uracil level in reacted thyroid nodule DNA from cancer tissues is above indicated level* | Uracil level in reacted thyroid nodule DNA from benign tissues is above indicated level* | Uracil level in reacted thyroid nodule DNA from benign tissues is below indicated level* | SEQ ID NO: Forward Strand | SEQ ID NO: Reverse Strand |
|---|---|---|---|---|---|---|
| chr16 | 57793715 | 85.71 | N/A | N/A | 217 | 218 |
| chr16 | 57793727 | 80.95 | N/A | N/A | 217 | 218 |
| chr16 | 70771056 | 68.75 | N/A | N/A | 219 | 220 |
| chr16 | 70771079 | 63.33 | N/A | N/A | 219 | 220 |
| chr16 | 70771141 | 65.79 | N/A | N/A | 219 | 220 |
| chr16 | 77332010 | 72.58 | N/A | N/A | 221 | 222 |
| chr16 | 78540378 | 75.76 | N/A | N/A | 223 | 224 |
| chr16 | 79333435 | N/A | 89.61 | N/A | 225 | 226 |
| chr16 | 84262419 | 87.23 | N/A | N/A | 227 | 228 |
| chr16 | 88701114 | N/A | N/A | 66.67 | 229 | 230 |
| chr16 | 89988308 | N/A | N/A | 83.33 | 231 | 232 |
| chr16 | 89988644 | N/A | N/A | 47.37 | 233 | 234 |
| chr17 | 1509928 | N/A | 88.46 | N/A | 235 | 236 |
| chr17 | 1509945 | N/A | 88.46 | N/A | 235 | 236 |
| chr17 | 1509952 | N/A | 83.93 | N/A | 235 | 236 |
| chr17 | 1509953 | N/A | 85.00 | N/A | 235 | 236 |
| chr17 | 7644013 | N/A | 85.42 | N/A | 237 | 238 |
| chr17 | 16323460 | 85.00 | N/A | N/A | 239 | 240 |
| chr17 | 16323473 | 84.21 | N/A | N/A | 239 | 240 |
| chr17 | 16924561 | 80.36 | N/A | N/A | 241 | 242 |
| chr17 | 16924562 | 75.71 | N/A | N/A | 241 | 242 |
| chr17 | 16924594 | 75.71 | N/A | N/A | 241 | 242 |
| chr17 | 17717918 | 72.73 | N/A | N/A | 243 | 244 |
| chr17 | 17718591 | 84.38 | N/A | N/A | 245 | 246 |
| chr17 | 18139506 | 82.81 | N/A | N/A | 247 | 248 |
| chr17 | 35278031 | N/A | N/A | 28.42 | 249 | 250 |
| chr17 | 39677570 | 71.88 | N/A | N/A | 251 | 252 |
| chr17 | 40826257 | N/A | N/A | 23.81 | 253 | 254 |
| chr17 | 43037426 | N/A | N/A | 33.33 | 255 | 256 |
| chr17 | 43200096 | 77.78 | N/A | N/A | 257 | 258 |
| chr17 | 43200239 | 85.00 | N/A | N/A | 259 | 260 |
| chr17 | 43510142 | N/A | N/A | 81.82 | 261 | 262 |
| chr17 | 47987828 | N/A | N/A | 69.23 | 263 | 264 |
| chr17 | 48178379 | 83.33 | N/A | N/A | 265 | 266 |
| chr17 | 48596391 | N/A | 88.64 | N/A | 267 | 268 |
| chr17 | 48764165 | 88.89 | N/A | N/A | 269 | 270 |
| chr17 | 55701962 | 68.75 | N/A | N/A | 271 | 272 |
| chr17 | 73584599 | N/A | N/A | 60.00 | 273 | 274 |
| chr17 | 73993165 | 90.00 | N/A | N/A | 275 | 276 |
| chr17 | 75827716 | 78.57 | N/A | N/A | 277 | 278 |
| chr17 | 76882243 | 61.54 | N/A | N/A | 279 | 280 |
| chr17 | 78765910 | 88.71 | N/A | N/A | 281 | 282 |
| chr17 | 79544478 | 83.15 | N/A | N/A | 283 | 284 |
| chr17 | 80696474 | 60.00 | N/A | N/A | 285 | 286 |
| chr18 | 19751759 | N/A | N/A | 33.33 | 287 | 288 |
| chr18 | 21440760 | 67.86 | N/A | N/A | 289 | 290 |
| chr18 | 45555437 | 66.18 | N/A | N/A | 291 | 292 |
| chr18 | 45555438 | 73.68 | N/A | N/A | 291 | 292 |
| chr18 | 46547891 | 76.09 | N/A | N/A | 293 | 294 |
| chr18 | 55888885 | 75.47 | N/A | N/A | 295 | 296 |
| chr18 | 56452096 | 90.00 | N/A | N/A | 297 | 298 |
| chr18 | 56452476 | 81.82 | N/A | N/A | 299 | 300 |
| chr18 | 56887181 | N/A | N/A | 60.00 | 301 | 302 |
| chr18 | 76002973 | 81.58 | N/A | N/A | 303 | 304 |
| chr18 | 77331090 | 81.03 | N/A | N/A | 305 | 306 |
| chr19 | 677895 | 85.29 | N/A | N/A | 307 | 308 |
| chr19 | 884044 | 76.92 | N/A | N/A | 309 | 310 |
| chr19 | 884059 | 76.92 | N/A | N/A | 309 | 310 |
| chr19 | 884105 | 84.62 | N/A | N/A | 311 | 312 |
| chr19 | 884115 | 84.62 | N/A | N/A | 311 | 312 |
| chr19 | 1136511 | 86.96 | N/A | N/A | 313 | 314 |
| chr19 | 1177605 | 73.68 | N/A | N/A | 315 | 316 |
| chr19 | 1177612 | 72.73 | N/A | N/A | 315 | 316 |
| chr19 | 1177640 | 81.82 | N/A | N/A | 315 | 316 |
| chr19 | 1860601 | 88.46 | N/A | N/A | 317 | 318 |
| chr19 | 1860607 | 82.81 | N/A | N/A | 317 | 318 |
| chr19 | 2503954 | 90.00 | N/A | N/A | 319 | 320 |
| chr19 | 3434917 | N/A | N/A | 40.00 | 321 | 322 |
| chr19 | 3434921 | N/A | N/A | 42.86 | 321 | 322 |
| chr19 | 3434930 | N/A | N/A | 57.14 | 321 | 322 |
| chr19 | 3434939 | N/A | N/A | 71.43 | 321 | 322 |
| chr19 | 3434952 | N/A | N/A | 71.43 | 321 | 322 |
| chr19 | 3434954 | N/A | N/A | 60.00 | 321 | 322 |

TABLE 1-continued

| Chromosome (chr) | Chr Position | Uracil level in reacted thyroid nodule DNA from cancer tissues is above indicated level* | Uracil level in reacted thyroid nodule DNA from benign tissues is above indicated level* | Uracil level in reacted thyroid nodule DNA from benign tissues is below indicated level* | SEQ ID NO: Forward Strand | SEQ ID NO: Reverse Strand |
|---|---|---|---|---|---|---|
| chr19 | 3434962 | N/A | N/A | 71.43 | 321 | 322 |
| chr19 | 3434964 | N/A | N/A | 71.43 | 321 | 322 |
| chr19 | 3434979 | N/A | N/A | 66.67 | 321 | 322 |
| chr19 | 3434985 | N/A | N/A | 55.56 | 321 | 322 |
| chr19 | 4052713 | 85.56 | N/A | N/A | 323 | 324 |
| chr19 | 4052714 | 85.14 | N/A | N/A | 323 | 324 |
| chr19 | 4052749 | 84.62 | N/A | N/A | 323 | 324 |
| chr19 | 4374591 | 82.14 | N/A | N/A | 325 | 326 |
| chr19 | 5013982 | N/A | 83.33 | N/A | 327 | 328 |
| chr19 | 5048836 | 11.21 | N/A | N/A | 329 | 330 |
| chr19 | 5048867 | 70.59 | N/A | N/A | 329 | 330 |
| chr19 | 5048877 | 73.53 | N/A | N/A | 329 | 330 |
| chr19 | 8367279 | 75.00 | N/A | N/A | 331 | 332 |
| chr19 | 8428573 | N/A | N/A | 75.00 | 333 | 334 |
| chr19 | 10254577 | 76.25 | N/A | N/A | 335 | 336 |
| chr19 | 10254578 | 79.17 | N/A | N/A | 335 | 336 |
| chr19 | 10463956 | N/A | 86.73 | N/A | 337 | 338 |
| chr19 | 10464137 | N/A | 89.29 | N/A | 339 | 340 |
| chr19 | 13203671 | 75.86 | N/A | N/A | 341 | 342 |
| chr19 | 13266925 | N/A | N/A | 66.67 | 343 | 344 |
| chr19 | 13266934 | N/A | N/A | 66.67 | 343 | 344 |
| chr19 | 13266970 | N/A | N/A | 63.64 | 343 | 344 |
| chr19 | 13842142 | N/A | N/A | 76.47 | 345 | 346 |
| chr19 | 14248494 | N/A | N/A | 73.91 | 347 | 348 |
| chr19 | 15375465 | 72.22 | N/A | N/A | 349 | 350 |
| chr19 | 17218912 | 81.25 | N/A | N/A | 351 | 352 |
| chr19 | 17346702 | N/A | N/A | 85.71 | 353 | 354 |
| chr19 | 17346702 | N/A | N/A | 78.95 | 353 | 354 |
| chr19 | 18157161 | 88.24 | N/A | N/A | 355 | 356 |
| chr19 | 18157221 | 86.76 | N/A | N/A | 357 | 358 |
| chr19 | 18157258 | 65.22 | N/A | N/A | 359 | 360 |
| chr19 | 18415877 | N/A | N/A | 47.83 | 361 | 362 |
| chr19 | 18415890 | N/A | N/A | 47.83 | 361 | 362 |
| chr19 | 30606642 | 80.56 | N/A | N/A | 363 | 364 |
| chr19 | 35531842 | N/A | N/A | 83.33 | 365 | 366 |
| chr19 | 44303112 | N/A | N/A | 77.78 | 367 | 368 |
| chr19 | 47173037 | N/A | 88.64 | N/A | 369 | 370 |
| chr19 | 47316268 | 76.67 | N/A | N/A | 371 | 372 |
| chr19 | 47778278 | N/A | N/A | 66.67 | 373 | 374 |
| chr19 | 47778298 | N/A | N/A | 83.33 | 373 | 374 |
| chr2 | 3454277 | N/A | 84.78 | N/A | 375 | 376 |
| chr2 | 8793724 | N/A | 78.57 | N/A | 377 | 378 |
| chr2 | 20412441 | 85.71 | N/A | N/A | 379 | 380 |
| chr2 | 42329402 | N/A | N/A | 78.95 | 381 | 382 |
| chr2 | 42329494 | N/A | N/A | 60.00 | 381 | 382 |
| chr2 | 55289272 | N/A | 75.00 | N/A | 383 | 384 |
| chr2 | 65064865 | 64.71 | N/A | N/A | 385 | 386 |
| chr2 | 70823641 | 79.03 | N/A | N/A | 387 | 388 |
| chr2 | 73143689 | N/A | N/A | 77.78 | 389 | 390 |
| chr2 | 74454110 | 70.00 | N/A | N/A | 391 | 392 |
| chr2 | 122014529 | N/A | 86.36 | N/A | 393 | 394 |
| chr2 | 128158884 | 85.00 | N/A | N/A | 395 | 396 |
| chr2 | 128158910 | 77.50 | N/A | N/A | 395 | 396 |
| chr2 | 203114171 | 79.63 | N/A | N/A | 397 | 398 |
| chr2 | 218221671 | N/A | 85.19 | N/A | 399 | 400 |
| chr2 | 219745335 | N/A | N/A | 81.82 | 401 | 402 |
| chr2 | 238341465 | 86.36 | N/A | N/A | 403 | 404 |
| chr2 | 238341542 | 90.00 | N/A | N/A | 405 | 406 |
| chr2 | 238341546 | 87.50 | N/A | N/A | 405 | 406 |
| chr2 | 238774763 | 67.57 | N/A | N/A | 407 | 408 |
| chr20 | 31126186 | 87.50 | N/A | N/A | 409 | 410 |
| chr20 | 31126189 | 84.21 | N/A | N/A | 409 | 410 |
| chr20 | 34206950 | N/A | N/A | 76.47 | 411 | 412 |
| chr20 | 36771969 | 79.31 | N/A | N/A | 413 | 414 |
| chr20 | 48993661 | 80.00 | N/A | N/A | 415 | 416 |
| chr20 | 58406398 | 89.66 | N/A | N/A | 417 | 418 |
| chr20 | 61976049 | 87.93 | N/A | N/A | 419 | 420 |
| chr20 | 61976073 | 89.66 | N/A | N/A | 419 | 420 |
| chr20 | 62588571 | N/A | N/A | 50.00 | 421 | 422 |
| chr20 | 62588579 | N/A | N/A | 38.46 | 421 | 422 |
| chr22 | 19738127 | 70.59 | N/A | N/A | 423 | 424 |
| chr22 | 35965176 | 76.32 | N/A | N/A | 425 | 426 |
| chr22 | 36549809 | 83.33 | N/A | N/A | 427 | 428 |

TABLE 1-continued

| Chromosome (chr) | Chr Position | Uracil level in reacted thyroid nodule DNA from cancer tissues is above indicated level* | Uracil level in reacted thyroid nodule DNA from benign tissues is above indicated level* | Uracil level in reacted thyroid nodule DNA from benign tissues is below indicated level* | SEQ ID NO: Forward Strand | SEQ ID NO: Reverse Strand |
|---|---|---|---|---|---|---|
| chr22 | 36973375 | 80.43 | N/A | N/A | 429 | 430 |
| chr22 | 37447953 | N/A | N/A | 73.33 | 431 | 432 |
| chr22 | 37914998 | N/A | N/A | 69.23 | 433 | 434 |
| chr22 | 38307317 | N/A | 89.66 | N/A | 435 | 436 |
| chr22 | 39662794 | 84.62 | N/A | N/A | 437 | 438 |
| chr22 | 45622980 | 85.00 | N/A | N/A | 439 | 440 |
| chr3 | 13323642 | N/A | N/A | 72.73 | 441 | 442 |
| chr3 | 14180153 | 57.89 | N/A | N/A | 443 | 444 |
| chr3 | 45209073 | N/A | N/A | 60.00 | 445 | 446 |
| chr3 | 45209207 | N/A | N/A | 83.33 | 447 | 448 |
| chr3 | 52525100 | 79.41 | N/A | N/A | 449 | 450 |
| chr3 | 62589658 | 87.50 | N/A | N/A | 451 | 452 |
| chr3 | 65388317 | 71.43 | N/A | N/A | 453 | 454 |
| chr3 | 65388388 | 79.31 | N/A | N/A | 455 | 456 |
| chr3 | 73599302 | 85.11 | N/A | N/A | 457 | 458 |
| chr3 | 195636893 | N/A | N/A | 84.62 | 459 | 460 |
| chr3 | 197093846 | 80.00 | N/A | N/A | 461 | 462 |
| chr4 | 3743223 | 68.18 | N/A | N/A | 463 | 464 |
| chr4 | 5755716 | 85.48 | N/A | N/A | 465 | 466 |
| chr4 | 5755717 | 80.00 | N/A | N/A | 465 | 466 |
| chr4 | 5755728 | 82.26 | N/A | N/A | 465 | 466 |
| chr4 | 5755729 | 79.17 | N/A | N/A | 465 | 466 |
| chr4 | 5755734 | 79.17 | N/A | N/A | 465 | 466 |
| chr4 | 8372861 | N/A | 85.71 | N/A | 467 | 468 |
| chr4 | 57548289 | 80.23 | N/A | N/A | 469 | 470 |
| chr5 | 1118280 | 73.08 | N/A | N/A | 471 | 472 |
| chr5 | 34564389 | 89.29 | N/A | N/A | 473 | 474 |
| chr5 | 73871907 | 89.47 | N/A | N/A | 475 | 476 |
| chr5 | 78013596 | 70.00 | N/A | N/A | 477 | 478 |
| chr5 | 78013643 | 80.00 | N/A | N/A | 479 | 480 |
| chr5 | 137802650 | 72.73 | N/A | N/A | 481 | 482 |
| chr5 | 139051189 | 84.09 | N/A | N/A | 483 | 484 |
| chr5 | 167838221 | 68.18 | N/A | N/A | 485 | 486 |
| chr5 | 177541401 | N/A | N/A | 69.23 | 487 | 488 |
| chr5 | 180018672 | N/A | N/A | 72.73 | 489 | 490 |
| chr5 | 180101026 | N/A | N/A | 64.71 | 491 | 492 |
| chr6 | 3394325 | N/A | 87.84 | N/A | 493 | 494 |
| chr6 | 3887581 | N/A | 85.71 | N/A | 495 | 496 |
| chr6 | 7236568 | 84.43 | N/A | N/A | 497 | 498 |
| chr6 | 7728692 | N/A | N/A | 73.33 | 499 | 500 |
| chr6 | 34203617 | N/A | N/A | 45.45 | 501 | 502 |
| chr6 | 37751320 | N/A | N/A | 78.57 | 503 | 504 |
| chr6 | 41410682 | N/A | N/A | 77.78 | 505 | 506 |
| chr6 | 41438516 | N/A | N/A | 39.13 | 507 | 508 |
| chr6 | 41438575 | 89.66 | N/A | N/A | 507 | 508 |
| chr6 | 43464150 | 75.76 | N/A | N/A | 509 | 510 |
| chr6 | 158734279 | N/A | 86.84 | N/A | 511 | 512 |
| chr7 | 989235 | 76.67 | N/A | N/A | 513 | 514 |
| chr7 | 2673543 | 82.14 | N/A | N/A | 515 | 516 |
| chr7 | 73508602 | N/A | N/A | 85.71 | 517 | 518 |
| chr7 | 105079565 | 78.75 | N/A | N/A | 519 | 520 |
| chr7 | 105079631 | 71.25 | N/A | N/A | 519 | 520 |
| chr7 | 151425103 | 86.96 | N/A | N/A | 521 | 522 |
| chr7 | 151425104 | 76.19 | N/A | N/A | 521 | 522 |
| chr8 | 11764017 | 80.77 | N/A | N/A | 523 | 524 |
| chr8 | 21647308 | N/A | N/A | 71.43 | 525 | 526 |
| chr8 | 22548399 | N/A | 88.16 | N/A | 527 | 528 |
| chr8 | 22548483 | N/A | 87.50 | N/A | 527 | 528 |
| chr8 | 133570537 | N/A | 80.00 | N/A | 529 | 530 |
| chr8 | 141320393 | 75.00 | N/A | N/A | 531 | 532 |
| chr8 | 141320410 | 85.00 | N/A | N/A | 531 | 532 |
| chr9 | 6566568 | 86.84 | N/A | N/A | 533 | 534 |
| chr9 | 16197862 | N/A | 86.36 | N/A | 535 | 536 |
| chr9 | 34591313 | N/A | N/A | 80.00 | 537 | 538 |
| chr9 | 98225096 | N/A | N/A | 22.22 | 539 | 540 |
| chr9 | 126126741 | 86.11 | N/A | N/A | 541 | 542 |
| chr9 | 132083428 | N/A | N/A | 70.59 | 543 | 544 |
| chr9 | 136077410 | 73.91 | N/A | N/A | 545 | 546 |
| chr9 | 139655018 | 83.33 | N/A | N/A | 547 | 548 |

TABLE 1-continued

| Chromosome (chr) | Chr Position | Uracil level in reacted thyroid nodule DNA from cancer tissues is above indicated level* | Uracil level in reacted thyroid nodule DNA from benign tissues is above indicated level* | Uracil level in reacted thyroid nodule DNA from benign tissues is below indicated level* | SEQ ID NO: Forward Strand | SEQ ID NO: Reverse Strand |
|---|---|---|---|---|---|---|
| chr9 | 140205985 | 75.00 | N/A | N/A | 549 | 550 |
| chr9 | 140205985 | 83.33 | N/A | N/A | 549 | 550 |
| chr9 | 140205997 | 79.17 | N/A | N/A | 549 | 550 |

*Level values provided are the proportion (percentage) of reacted thyroid nodule DNA molecules having a uracil at the methylation site of interest. When amplicons generated from reacted thyroid nodule DNA molecules (e.g., by PCR) are used to assess the level of methylation, the values provided correspond to the proportion of amplicons having a thymidine at the nucleotide position that corresponds to the methylation site of interest.

In embodiments, the method of detecting methylation or unmethylation of a thyroid nodule DNA of a subject detects an alteration in methylation including increase or loss of uracil level at plurality of methylation sites. In embodiments, the method of detecting methylation or unmethylation of a thyroid nodule DNA of a subject detects an alteration in methylation including increase or loss of thymidine level at plurality of methylation sites. The indicated levels in Tables 1, 2, 3, and 4, are approximate indicated levels, and include values that are within about 15%, about 10%, or about 5% above and below the indicated levels.

In embodiments, the method detects the uracil level above about a threshold as set forth in Table 2 in subjects with a cancerous thyroid nodule. In embodiments, the method detects the thymidine level above about a threshold as set forth in Table 2 in subjects with a cancerous thyroid nodule.

TABLE 2

Methylation Threshold for Cancerous Thyroid Nodule

| Chromosome | Chromosomal Position | Uracil level in reacted thyroid nodule DNA from cancer tissues is about above indicated level* |
|---|---|---|
| chr1 | 11979164 | 89.29 |
| chr1 | 16450525 | 70.00 |
| chr1 | 16450542 | 72.00 |
| chr1 | 16450545 | 73.33 |
| chr1 | 16469987 | 80.00 |
| chr1 | 17494491 | 86.00 |
| chr1 | 25473203 | 88.89 |
| chr1 | 38493013 | 86.36 |
| chr1 | 38493030 | 79.17 |
| chr1 | 38493074 | 80.95 |
| chr1 | 109816092 | 80.77 |
| chr1 | 109816111 | 80.77 |
| chr1 | 110074669 | 75.00 |
| chr1 | 110074681 | 71.43 |
| chr1 | 110074685 | 63.16 |
| chr1 | 150949856 | 89.29 |
| chr1 | 150949857 | 88.46 |
| chr1 | 153540282 | 78.26 |
| chr1 | 155162704 | 84.21 |
| chr1 | 155162714 | 88.64 |
| chr1 | 157611881 | 83.05 |
| chr1 | 182205324 | 77.50 |
| chr1 | 204118999 | 59.09 |
| chr1 | 206741875 | 83.33 |
| chr1 | 206741989 | 66.67 |
| chr1 | 212841198 | 85.29 |
| chr1 | 223403952 | 79.17 |
| chr1 | 234342767 | 76.67 |
| chr10 | 3929071 | 88.68 |
| chr10 | 30047012 | 86.84 |
| chr10 | 79702989 | 83.33 |
| chr10 | 87984905 | 86.36 |
| chr10 | 94838789 | 63.33 |

TABLE 2-continued

Methylation Threshold for Cancerous Thyroid Nodule

| Chromosome | Chromosomal Position | Uracil level in reacted thyroid nodule DNA from cancer tissues is about above indicated level* |
|---|---|---|
| chr10 | 102131187 | 90.00 |
| chr10 | 104196489 | 75.00 |
| chr10 | 111766879 | 89.47 |
| chr10 | 112258886 | 81.82 |
| chr10 | 112258984 | 83.33 |
| chr10 | 112259015 | 82.61 |
| chr10 | 120011530 | 79.55 |
| chr11 | 821282 | 89.13 |
| chr11 | 12188937 | 83.33 |
| chr11 | 12188948 | 77.78 |
| chr11 | 12188995 | 78.57 |
| chr11 | 65158294 | 78.00 |
| chr11 | 65158342 | 85.00 |
| chr11 | 65297089 | 75.00 |
| chr11 | 66104481 | 81.58 |
| chr11 | 66104485 | 83.33 |
| chr11 | 66104578 | 81.82 |
| chr11 | 70236292 | 89.29 |
| chr11 | 70236320 | 85.71 |
| chr11 | 70236331 | 70.83 |
| chr11 | 117950310 | 79.55 |
| chr11 | 117950329 | 79.55 |
| chr11 | 117950361 | 80.00 |
| chr11 | 117950362 | 81.82 |
| chr12 | 679803 | 86.84 |
| chr12 | 26039132 | 73.91 |
| chr12 | 50286016 | 82.14 |
| chr12 | 52243258 | 82.00 |
| chr12 | 52243286 | 82.50 |
| chr12 | 56115043 | 89.29 |
| chr12 | 66262229 | 72.22 |
| chr12 | 66262230 | 71.74 |
| chr12 | 66262233 | 68.27 |
| chr12 | 66262234 | 71.74 |
| chr12 | 117580102 | 84.62 |
| chr12 | 123435962 | 63.89 |
| chr12 | 123436011 | 71.88 |
| chr12 | 123436065 | 69.44 |
| chr12 | 123540893 | 77.27 |
| chr13 | 46771519 | 67.65 |
| chr13 | 46771520 | 73.91 |
| chr14 | 38599118 | 65.91 |
| chr14 | 69170010 | 86.36 |
| chr14 | 75701632 | 68.42 |
| chr14 | 75701643 | 68.75 |
| chr14 | 103768055 | 76.09 |
| chr14 | 104354645 | 72.92 |
| chr14 | 104360487 | 83.33 |
| chr15 | 41068807 | 69.12 |
| chr15 | 61152225 | 83.33 |
| chr15 | 61152253 | 86.67 |
| chr15 | 61152313 | 86.67 |
| chr15 | 70667596 | 83.33 |
| chr15 | 70767206 | 90.00 |

TABLE 2-continued

Methylation Threshold for Cancerous Thyroid Nodule

| Chromosome | Chromosomal Position | Uracil level in reacted thyroid nodule DNA from cancer tissues is about above indicated level* |
|---|---|---|
| chr15 | 77989064 | 73.53 |
| chr15 | 85402496 | 82.10 |
| chr15 | 85402497 | 79.49 |
| chr15 | 99417337 | 88.89 |
| chr16 | 1231873 | 86.36 |
| chr16 | 23135832 | 87.50 |
| chr16 | 29616265 | 85.71 |
| chr16 | 31009547 | 84.00 |
| chr16 | 31009548 | 85.00 |
| chr16 | 31009590 | 85.00 |
| chr16 | 57793674 | 80.95 |
| chr16 | 57793715 | 85.71 |
| chr16 | 57793727 | 80.95 |
| chr16 | 70771056 | 68.75 |
| chr16 | 70771079 | 63.33 |
| chr16 | 70771141 | 65.79 |
| chr16 | 77332010 | 72.58 |
| chr16 | 78540378 | 75.76 |
| chr16 | 84262419 | 87.23 |
| chr17 | 16323460 | 85.00 |
| chr17 | 16323473 | 84.21 |
| chr17 | 16924561 | 80.36 |
| chr17 | 16924562 | 75.71 |
| chr17 | 16924594 | 75.71 |
| chr17 | 17717918 | 72.73 |
| chr17 | 17718591 | 84.38 |
| chr17 | 18139506 | 82.81 |
| chr17 | 39677570 | 71.88 |
| chr17 | 43200096 | 77.78 |
| chr17 | 43200239 | 85.00 |
| chr17 | 48178379 | 83.33 |
| chr17 | 48764165 | 88.89 |
| chr17 | 55701962 | 68.75 |
| chr17 | 73993165 | 90.00 |
| chr17 | 75827716 | 78.57 |
| chr17 | 76882243 | 61.54 |
| chr17 | 78765910 | 88.71 |
| chr17 | 79544478 | 83.15 |
| chr17 | 80696474 | 60.00 |
| chr18 | 21440760 | 67.86 |
| chr18 | 45555437 | 66.18 |
| chr18 | 45555438 | 73.68 |
| chr18 | 46547891 | 76.09 |
| chr18 | 55888885 | 75.47 |
| chr18 | 56452096 | 90.00 |
| chr18 | 56452476 | 81.82 |
| chr18 | 76002973 | 81.58 |
| chr18 | 77331090 | 81.03 |
| chr19 | 677895 | 85.29 |
| chr19 | 884044 | 76.92 |
| chr19 | 884059 | 76.92 |
| chr19 | 884105 | 84.62 |
| chr19 | 884115 | 84.62 |
| chr19 | 1136511 | 86.96 |
| chr19 | 1177605 | 73.68 |
| chr19 | 1177612 | 72.73 |
| chr19 | 1177640 | 81.82 |
| chr19 | 1860601 | 88.46 |
| chr19 | 1860607 | 82.81 |
| chr19 | 2503954 | 90.00 |
| chr19 | 4052713 | 85.56 |
| chr19 | 4052714 | 85.14 |
| chr19 | 4052749 | 84.62 |
| chr19 | 4374591 | 82.14 |
| chr19 | 5048836 | 77.27 |
| chr19 | 5048867 | 70.59 |
| chr19 | 5048877 | 73.53 |
| chr19 | 8367279 | 75.00 |
| chr19 | 10254577 | 76.25 |
| chr19 | 10254578 | 79.17 |
| chr19 | 13203671 | 75.86 |
| chr19 | 15375465 | 72.22 |
| chr19 | 17218912 | 81.25 |

TABLE 2-continued

Methylation Threshold for Cancerous Thyroid Nodule

| Chromosome | Chromosomal Position | Uracil level in reacted thyroid nodule DNA from cancer tissues is about above indicated level* |
|---|---|---|
| chr19 | 18157161 | 88.24 |
| chr19 | 18157221 | 86.76 |
| chr19 | 18157258 | 65.22 |
| chr19 | 30606642 | 80.56 |
| chr19 | 47316268 | 76.67 |
| chr2 | 20412441 | 85.71 |
| chr2 | 65064865 | 64.71 |
| chr2 | 70823641 | 79.03 |
| chr2 | 74454110 | 70.00 |
| chr2 | 128158884 | 85.00 |
| chr2 | 128158910 | 77.50 |
| chr2 | 203114171 | 79.63 |
| chr2 | 238341465 | 86.36 |
| chr2 | 238341542 | 90.00 |
| chr2 | 238341546 | 87.50 |
| chr2 | 238774763 | 67.57 |
| chr20 | 31126186 | 87.50 |
| chr20 | 31126189 | 84.21 |
| chr20 | 36771969 | 79.31 |
| chr20 | 48993661 | 80.00 |
| chr20 | 58406398 | 89.66 |
| chr20 | 61976049 | 87.93 |
| chr20 | 61976073 | 89.66 |
| chr22 | 19738127 | 70.59 |
| chr22 | 35965176 | 76.32 |
| chr22 | 36549809 | 83.33 |
| chr22 | 36973375 | 80.43 |
| chr22 | 39662794 | 84.62 |
| chr22 | 45622980 | 85.00 |
| chr3 | 14180153 | 57.89 |
| chr3 | 52525100 | 79.41 |
| chr3 | 62589658 | 87.50 |
| chr3 | 65388317 | 71.43 |
| chr3 | 65388388 | 79.31 |
| chr3 | 73599302 | 85.11 |
| chr3 | 197093846 | 80.00 |
| chr4 | 3743223 | 68.18 |
| chr4 | 5755716 | 85.48 |
| chr4 | 5755717 | 80.00 |
| chr4 | 5755728 | 82.26 |
| chr4 | 5755729 | 79.17 |
| chr4 | 5755734 | 79.17 |
| chr4 | 57548289 | 80.23 |
| chr5 | 1118280 | 73.08 |
| chr5 | 34564389 | 89.29 |
| chr5 | 73871907 | 89.47 |
| chr5 | 78013596 | 70.00 |
| chr5 | 78013643 | 80.00 |
| chr5 | 137802650 | 72.73 |
| chr5 | 139051189 | 84.09 |
| chr5 | 167838221 | 68.18 |
| chr6 | 7236568 | 84.43 |
| chr6 | 41438575 | 89.66 |
| chr6 | 43464150 | 75.76 |
| chr7 | 989235 | 76.67 |
| chr7 | 2673543 | 82.14 |
| chr7 | 105079565 | 78.75 |
| chr7 | 105079631 | 71.25 |
| chr7 | 151425103 | 86.96 |
| chr7 | 151425104 | 76.19 |
| chr8 | 11764017 | 80.77 |
| chr8 | 141320393 | 75.00 |
| chr8 | 141320410 | 85.00 |
| chr9 | 6566568 | 86.84 |
| chr9 | 126126741 | 86.11 |
| chr9 | 136077410 | 73.91 |
| chr9 | 139655018 | 83.33 |

TABLE 2-continued

| Methylation Threshold for Cancerous Thyroid Nodule | | |
|---|---|---|
| Chromosome | Chromosomal Position | Uracil level in reacted thyroid nodule DNA from cancer tissues is about above indicated level* |
| chr9 | 140205985 | 75.00 |
| chr9 | 140205989 | 83.33 |
| chr9 | 140205997 | 79.17 |

*Level values provided are the proportion (percentage) of reacted thyroid nodule DNA molecules having a uracil at the methylation site of interest. When amplicons generated from reacted thyroid nodule DNA molecules (e.g., by PCR) are used to assess the level of methylation, the values provided correspond to the proportion of amplicons having a thymidine at the nucleotide position that corresponds to the methylation site of interest.

In embodiments, the uracil level is above a threshold as set forth in Table 3 in subjects with benign thyroid nodules. In embodiments, the thymidine level is above a threshold as set forth in Table 3 in subjects with benign thyroid nodules.

TABLE 3

| Threshold for Benign Thyroid Nodule | | |
|---|---|---|
| Chromosome | Chromosomal Position | Uracil level in reacted thyroid nodule DNA from benign tissues is about above indicated level* |
| chr1 | 2996653 | 88.84 |
| chr1 | 27640460 | 80.56 |
| chr10 | 126172714 | 80.00 |
| chr10 | 126172747 | 84.62 |
| chr11 | 36057726 | 79.63 |
| chr11 | 48070143 | 84.38 |
| chr11 | 48070163 | 87.50 |
| chr11 | 48070166 | 84.38 |
| chr11 | 48070174 | 84.48 |
| chr12 | 77266621 | 73.53 |
| chr14 | 97524282 | 88.89 |
| chr14 | 104209000 | 80.77 |
| chr14 | 104209068 | 83.33 |
| chr15 | 77984014 | 88.89 |
| chr16 | 3023231 | 84.00 |
| chr16 | 79333435 | 89.61 |
| chr17 | 1509928 | 88.46 |
| chr17 | 1509945 | 88.46 |
| chr17 | 1509952 | 83.93 |
| chr17 | 1509953 | 85.00 |
| chr17 | 7644013 | 85.42 |
| chr17 | 48596391 | 88.64 |
| chr19 | 5013982 | 83.33 |
| chr19 | 10463956 | 86.73 |
| chr19 | 10464137 | 89.29 |
| chr19 | 47173037 | 88.64 |
| chr2 | 3454277 | 84.78 |
| chr2 | 8793724 | 78.57 |
| chr2 | 55289272 | 75.00 |
| chr2 | 122014529 | 86.36 |
| chr2 | 218221671 | 85.19 |
| chr22 | 38307317 | 89.66 |
| chr4 | 8372861 | 85.71 |
| chr6 | 3394325 | 87.84 |
| chr6 | 3887581 | 85.71 |
| chr6 | 1.59E+08 | 86.84 |
| chr8 | 22548399 | 88.16 |
| chr8 | 22548483 | 87.50 |
| chr8 | 1.34E+08 | 80.00 |
| chr9 | 16197862 | 86.36 |

*Level values provided are the proportion (percentage) of reacted thyroid nodule DNA molecules having a uracil at the methylation site of interest. When amplicons generated from reacted thyroid nodule DNA molecules (e.g., by PCR) are used to assess the level of methylation, the values provided correspond to the proportion of amplicons having a thymidine at the nucleotide position that corresponds to the methylation site of interest.

In embodiments, the uracil level is below a threshold as set forth in Table 4 in subjects with benign thyroid nodule. In embodiments, the thymidine level is below a threshold as set forth in Table 4 in subjects with benign thyroid nodule.

TABLE 4

| Methylation Threshold for Benign Thyroid Nodule | | |
|---|---|---|
| Chromosome | Chromosomal Position | Uracil level in reacted thyroid nodule DNA from benign tissues is about below indicated level* |
| chr1 | 12655938 | 69.23 |
| chr1 | 29565080 | 60.00 |
| chr1 | 46713777 | 73.33 |
| chr1 | 46914121 | 60.00 |
| chr1 | 46955744 | 77.78 |
| chr1 | 55008344 | 60.00 |
| chr1 | 156676611 | 84.62 |
| chr1 | 212587673 | 80.00 |
| chr1 | 233430972 | 86.67 |
| chr10 | 116391763 | 75.00 |
| chr11 | 556355 | 75.00 |
| chr11 | 68608767 | 73.33 |
| chr11 | 115530032 | 79.49 |
| chr11 | 119293593 | 60.00 |
| chr12 | 31004558 | 81.82 |
| chr12 | 45610695 | 83.33 |
| chr12 | 45610701 | 86.67 |
| chr12 | 45610702 | 89.47 |
| chr12 | 45610706 | 80.00 |
| chr12 | 54145732 | 82.35 |
| chr12 | 54145741 | 76.47 |
| chr12 | 54145825 | 70.59 |
| chr13 | 20735797 | 82.35 |
| chr13 | 23500419 | 68.42 |
| chr13 | 53313426 | 60.00 |
| chr13 | 113807393 | 27.27 |
| chr14 | 90850454 | 54.55 |
| chr14 | 103541602 | 52.00 |
| chr15 | 65186440 | 55.56 |
| chr15 | 68851629 | 63.64 |
| chr15 | 75251486 | 60.00 |
| chr15 | 83952081 | 72.73 |
| chr16 | 1458639 | 75.00 |
| chr16 | 88701114 | 66.67 |
| chr16 | 89988308 | 83.33 |
| chr16 | 89988644 | 47.37 |
| chr17 | 35278031 | 28.42 |
| chr17 | 40826257 | 23.81 |
| chr17 | 43037426 | 33.33 |
| chr17 | 43510142 | 81.82 |
| chr17 | 47987828 | 69.23 |
| chr17 | 73584599 | 60.00 |
| chr18 | 19751759 | 33.33 |
| chr18 | 56887181 | 60.00 |
| chr19 | 3434917 | 40.00 |
| chr19 | 3434921 | 42.86 |
| chr19 | 3434930 | 57.14 |
| chr19 | 3434939 | 71.43 |
| chr19 | 3434952 | 71.43 |
| chr19 | 3434954 | 60.00 |
| chr19 | 3434962 | 71.43 |
| chr19 | 3434964 | 71.43 |
| chr19 | 3434979 | 66.67 |
| chr19 | 3434985 | 55.56 |
| chr19 | 8428573 | 75.00 |
| chr19 | 13266925 | 66.67 |
| chr19 | 13266934 | 66.67 |
| chr19 | 13266970 | 63.64 |
| chr19 | 13842142 | 76.47 |
| chr19 | 14248494 | 73.91 |
| chr19 | 17346702 | 85.71 |
| chr19 | 17346735 | 78.95 |
| chr19 | 18415877 | 47.83 |
| chr19 | 18415890 | 47.83 |
| chr19 | 35531842 | 83.33 |
| chr19 | 44303112 | 77.78 |
| chr19 | 47778278 | 66.67 |
| chr19 | 47778298 | 83.33 |
| chr2 | 42329402 | 78.95 |

TABLE 4-continued

| Methylation Threshold for Benign Thyroid Nodule | | |
|---|---|---|
| Chromosome | Chromosomal Position | Uracil level in reacted thyroid nodule DNA from benign tissues is about below indicated level* |
| chr2 | 42329494 | 60.00 |
| chr2 | 73143689 | 77.78 |
| chr2 | 219745335 | 81.82 |
| chr20 | 34206950 | 76.47 |
| chr20 | 62588571 | 50.00 |
| chr20 | 62588579 | 38.46 |
| chr22 | 37447953 | 73.33 |
| chr22 | 37914998 | 69.23 |
| chr3 | 13323642 | 72.73 |
| chr3 | 45209073 | 60.00 |
| chr3 | 45209207 | 83.33 |
| chr3 | 195636893 | 84.62 |
| chr5 | 177541401 | 69.23 |
| chr5 | 180018672 | 72.73 |
| chr5 | 180101026 | 64.71 |
| chr6 | 7728692 | 73.33 |
| chr6 | 34203617 | 45.45 |
| chr6 | 37751320 | 78.57 |
| chr6 | 41410682 | 77.78 |
| chr6 | 41438516 | 39.13 |
| chr7 | 73508602 | 85.71 |
| chr8 | 21647308 | 71.43 |
| chr9 | 34591313 | 80.00 |
| chr9 | 98225096 | 22.22 |
| chr9 | 132083428 | 70.59 |

*Level values provided are the proportion (percentage) of reacted thyroid nodule DNA molecules having a uracil at the methylation site of interest. When amplicons generated from reacted thyroid nodule DNA molecules (e.g., by PCR) are used to assess the level of methylation, the values provided correspond to the proportion of amplicons having a thymidine at the nucleotide position that corresponds to the methylation site of interest.

In embodiments, the method of detecting methylation or unmethylation of a thyroid nodule DNA is of a candidate thyroid cancer patient. In embodiments, the subject is suspected of having thyroid cancer. In embodiments, the subject has thyroid cancer.

In embodiments, the method of detecting methylation or unmethylation of a thyroid nodule DNA is based on the level of uracil as set forth Table 2, in which the uracil level above the threshold identifies the thyroid nodule as a cancerous thyroid nodule. In embodiments, the method of detecting methylation or unmethylation of a thyroid nodule DNA is based on a level of thymidine indicated in Table 2, in which the thymidine level above the threshold identifies the thyroid nodule as a cancerous thyroid nodule. In embodiments, the level is the proportion of molecules (e.g., in a plurality of reacted thyroid nodule DNA molecules or a plurality of reacted thyroid nodule DNA amplicons) having a uracil or thymidine as determined by a quantitation method. Non-limiting examples of quantitation methods include sequencing and microarray methods.

In embodiments, the method of detecting methylation or unmethylation of a thyroid nodule DNA is based on the level of uracil as set forth Table 3, in which the uracil level above the threshold identifies the thyroid nodule as a benign thyroid nodule. In embodiments, the method of detecting methylation or unmethylation of a thyroid nodule DNA is based on a level of thymidine indicated in Table 3, in which the thymidine level above the threshold identifies the thyroid nodule as a benign thyroid nodule. In embodiments, the level is the proportion of molecules (e.g., in a plurality of reacted thyroid nodule DNA molecules or a plurality of reacted thyroid nodule DNA amplicons) having a uracil or thymidine as determined by a quantitation method.

In embodiments, the method of detecting methylation or unmethylation of a thyroid nodule DNA is based on the level of uracil as set forth Table 4, in which the uracil level below the threshold identifies the thyroid nodule as a benign thyroid nodule. In embodiments, the method of detecting methylation or unmethylation of a thyroid nodule DNA is based on a level of thymidine indicated in Table 4, in which the thymidine level below the threshold identifies the thyroid nodule as a benign thyroid nodule. In embodiments, the level is the proportion of molecules (e.g., in a plurality of reacted thyroid nodule DNA molecules or a plurality of reacted thyroid nodule DNA amplicons) having a uracil or thymidine as determined by a quantitation method.

In embodiments, the thyroid nodule is a specimen obtained by biopsy or by surgical resection of a subject.

In embodiments, the subject has undergone thyroid surgery, radiation therapy, radioactive iodine therapy, chemotherapy, thyroid hormone therapy, and administration of an active agent before the subject undergoes the method of detecting methylation or unmethylation of a thyroid nodule DNA.

In embodiments, the method includes a determination of prognosis for local recurrence in thyroid cancer. In embodiments, the method includes determination of prognosis of distant recurrence of thyroid cancer.

In embodiments, the method of detecting DNA methylation level in DNA of thyroid nodule may lead to changes in therapeutic regimen for treating the subject. In embodiments a subject identified as having thyroid cancer may be treated with tyrosine kinase inhibitors.

In embodiments, the active agent administered to a subject before or after detecting the level of methylation or unmethylation is: Cabozantinib-S-Malate, Caprelsa® (Vandetanib). Cometriq® (Cabozantinib-S-Malate), Doxorubicin Hydrochloride, Lenvatinib Mesylate, Lenvima® (Lenvatinib Mesylate), Nexavar® (Sorafenib Tosylate), Sorafenib Tosylate, and/or Vandetanib.

Method of Determining Thyroid Cancer or Risk of Developing Thyroid Cancer

In an aspect, provided herein is a method of determining a thyroid cancer or risk of developing thyroid cancer in a subject in need thereof. The method involves:

(i) isolating a thyroid nodule DNA molecule from a thyroid nodule of the subject thereby forming an isolated thyroid nodule DNA molecule;

(ii) contacting the isolated thyroid nodule DNA molecule with a bisulfite salt (such as sodium bisulfite) thereby forming a reacted thyroid nodule DNA molecule; and (iii) detecting the presence or absence of uracil in the reacted thyroid nodule DNA molecule at a methylation site set forth in Table 1; thereby detecting the thyroid cancer in the subject.

In an aspect, provided herein is a method of detecting a thyroid cancer or risk of developing thyroid cancer in a subject in need thereof, comprising (i) isolating a plurality of thyroid nodule DNA molecules from the thyroid nodule of the subject thereby forming a plurality of isolated thyroid nodule DNA molecules, (ii) contacting the plurality of isolated thyroid nodule DNA molecules with the bisulfite salt thereby forming a plurality of reacted thyroid nodule DNA molecules, (iii) detecting the level of reacted thyroid nodule DNA molecules in the plurality of reacted thyroid nodule DNA molecules having a uracil at a methylation site set forth in Table 1; thereby detecting the thyroid cancer in the subject.

In an aspect, provided herein is a method of detecting a thyroid cancer or risk of developing thyroid cancer in a subject in need thereof, comprising (i) isolating a plurality of thyroid nodule DNA molecules from the thyroid nodule of the subject thereby forming a plurality of isolated thyroid nodule DNA molecules, (ii) contacting the plurality of isolated thyroid nodule DNA molecules with the bisulfite salt thereby forming a plurality of reacted thyroid nodule DNA molecules, (iii) detecting the presence or absence of uracil in a reacted thyroid nodule DNA molecule at a methylation site set forth in Table 1, thereby detecting methylation or unmethylation of the thyroid nodule DNA molecule of the subject.

In an aspect, provided herein is a method of detecting a thyroid cancer or risk of developing thyroid cancer in a subject in need thereof. The method includes: (i) isolating a thyroid nodule DNA molecule from a thyroid nodule of the subject thereby forming an isolated thyroid nodule DNA molecule, (ii) contacting the isolated thyroid nodule DNA molecule with a bisulfite salt (such as sodium bisulfite) thereby forming a reacted thyroid nodule DNA molecule, (iii) amplifying the reacted thyroid nodule DNA molecule thereby forming a reacted thyroid nodule DNA amplicon molecule, (iv) detecting the presence or absence of thymidine in a reacted thyroid nodule DNA amplicon molecule at a methylation site set forth in Table 1, thereby detecting methylation or unmethylation of the thyroid nodule DNA molecule of the subject. In embodiments, contacting the isolated thyroid nodule DNA with a bisulfite salt comprises adding a solution comprising the bisulfite salt to a solution comprising the isolated single stranded DNA.

In an aspect, provided herein is a method of detecting a thyroid cancer or risk of developing thyroid cancer in a subject in need thereof, comprising (i) isolating a plurality of thyroid nodule DNA molecules from the thyroid nodule of the subject thereby forming a plurality of isolated thyroid nodule DNA molecules, (ii) contacting the plurality of isolated thyroid nodule DNA molecules with the bisulfite salt thereby forming a plurality of reacted thyroid nodule DNA molecules, (iii) amplifying the plurality of reacted thyroid nodule DNA molecules thereby forming a plurality of reacted thyroid nodule DNA amplicon molecules, (iv) detecting one or more thyroid nodule DNA amplicon molecules within the plurality of reacted thyroid nodule DNA amplicon molecules having a thymidine at a methylation site set forth in Table 1, thereby detecting methylation or unmethylation of the thyroid nodule DNA molecule of the subject.

In embodiments, detecting one or more thyroid nodule DNA amplicon molecules comprises detecting the level of one or more one or more thyroid nodule DNA amplicon molecules. In embodiments, detecting one or more thyroid nodule DNA amplicon molecules comprises detecting the level of reacted thyroid nodule DNA amplicon molecules in the plurality of reacted thyroid nodule DNA amplicon molecules having a thymidine at a methylation site set forth in Table 1, thereby detecting the level of methylation or unmethylation in the plurality of thyroid nodule DNA molecules of the subject.

In embodiments, detecting a level includes determining the number (e.g. quantitating) or molecules having, e.g., a thymidine or a uracil. In embodiments, detecting a level includes detecting the portion or proportion of a population or plurality of molecules having, e.g., a thymidine or a uracil.

In embodiments, contacting the isolated thyroid nodule DNA with a bisulfite salt comprises adding a solution comprising the bisulfite salt to a solution comprising the isolated thyroid nodule DNA.

In embodiments, the method of determining a thyroid cancer or risk of developing thyroid cancer in a subject in need thereof includes selecting a subject that has or is at risk for developing thyroid cancer. In embodiments, the subject (a) is a woman; (b) is about 20 to about 55 years old; (c) has a mutated Ret Proto-Oncogene; (d) has a grandparent, parent, or sibling who has been diagnosed with thyroid cancer, (e) self-identifies as being Caucasian or Asian; and/or (f) has or has had breast cancer.

In embodiments, the method includes detecting methylation or unmethylation at a plurality of methylation sites set forth in Table 1. In embodiments, the plurality of methylation sites comprises at least about 2, 3, 4, 5, 10, 25, 50, 75, 80, 85, 90, 100, 150, 200, 250, 300, 350, 400, 450, 500, or 550, or 5-550 methylation sites. In embodiments, the plurality of methylation sites comprises less than about 550, 500, 450, 400, 350, 300, 250, 200, 150, 100, 90, 85, 80, 75, 50, 25, or 10 methylation sites. In embodiments, the plurality of methylation sites is about 5, 6, 7, 8, 9, 10, 11, 12, 13, 14, 15, 16, 17, 18, 19, 20, 25, 50, 75, 80, 85, 90, 100, 150, 200, 250, 300, 350, 400, 450, 500, or 550, or 5-550 methylation sites. In embodiments, the plurality of methylation sites includes two or more methylation sites set forth in Table 1 and no other methylation sites.

In embodiments, a method provided herein is practiced for a subject more than once over time. In embodiments, methylation or unmethylation of thyroid nodule DNA from a subject is assessed using a method provided herein at least 1, 2, 3, 4, 5, 6, 7, 8, 9, 10 or more times. In embodiments, the method is repeated at least once every 4, 6, 8, 12 or 18 months, or at least once every 2, 3, 4, or 5 more years.

In embodiments, the method of determining a thyroid cancer or risk of developing thyroid cancer in a subject in need thereof includes determining alteration in methylation at a plurality of methylation sites set forth in Table 1. In embodiments, the method comprises: (i) isolating DNA from multiple cells of a thyroid nodule of the subject thereby forming a plurality of isolated thyroid nodule DNA molecules, (ii) contacting the plurality of isolated thyroid nodule DNA molecules with a bisulfite salt thereby forming a plurality of reacted thyroid nodule DNA molecules, (iii) detecting the proportion of DNA molecules in the plurality of reacted thyroid nodule DNA molecules having a uracil at a methylation site set forth in Table 1.

In embodiments, the method of determining a thyroid cancer or risk of developing thyroid cancer in a subject in need thereof includes alteration. i.e., increase or loss of uracil level at plurality of methylation sites. In embodiments, the method of determining a thyroid cancer or risk of developing thyroid cancer in a subject in need thereof includes alteration, i.e., increase or loss of thymidine level at plurality of methylation sites.

In embodiments, the method of determining a thyroid cancer or risk of developing thyroid cancer in a subject in need thereof includes determining a uracil level which is above a threshold as set forth in Table 2. In embodiments, the method of determining a thyroid cancer or risk of developing thyroid cancer in a subject in need thereof includes determining a thymidine level which is above a threshold indicated in Table 2. In embodiments, the level is the proportion of molecules (e.g., in a plurality of reacted thyroid nodule DNA molecules or a plurality of reacted thyroid nodule DNA amplicons) having a uracil or thymidine as determined by a quantitation method.

In embodiments, the method of determining a thyroid cancer or risk of developing thyroid cancer in a subject in need thereof includes determining a uracil level which is above a threshold as set forth in Table 3. In embodiments, the method of determining a thyroid cancer or risk of developing thyroid cancer in a subject in need thereof includes determining a thymidine level which is above a threshold indicated in Table 3. In embodiments, the level is the proportion of molecules (e.g., in a plurality of reacted thyroid nodule DNA molecules or a plurality of reacted thyroid nodule DNA amplicons) having a uracil or thymidine as determined by a quantitation method.

In embodiments, the method of determining a thyroid cancer or risk of developing thyroid cancer in a subject in need thereof includes determining a uracil level which is below a threshold as set forth in Table 4. In embodiments, the method of determining a thyroid cancer or risk of developing thyroid cancer in a subject in need thereof includes determining a thymidine level which is below a threshold indicated in Table 4. In embodiments, the level is the proportion of molecules (e.g., in a plurality of reacted thyroid nodule DNA molecules or a plurality of reacted thyroid nodule DNA amplicons) having a uracil or thymidine as determined by a quantitation method.

In embodiments, the method of determining a thyroid cancer or risk of developing thyroid cancer involves a candidate thyroid cancer patient. In embodiments, the subject is suspected of having thyroid cancer. In embodiments, the subject has thyroid cancer.

In embodiments, the method of determining a thyroid cancer or risk of developing thyroid cancer in a subject in need thereof includes determining a uracil level in which a threshold above the threshold set forth in Table 2 identifies the thyroid nodule as a cancerous thyroid nodule. In embodiments, the method of determining a thyroid cancer or risk of developing thyroid cancer in a subject in need thereof includes determining a thymidine level in which a threshold above the threshold indicated in Table 2 identifies the thyroid nodule as a cancerous thyroid nodule. In embodiments, the level is the proportion of molecules (e.g., in a plurality of reacted thyroid nodule DNA molecules or a plurality of reacted thyroid nodule DNA amplicons) having a uracil or thymidine as determined by a quantitation method.

In embodiments, the method of determining a thyroid cancer or risk of developing thyroid cancer in a subject in need thereof includes determining a uracil level in which a threshold above the threshold set forth in Table 3 identifies the thyroid nodule as a benign thyroid nodule. In embodiments, the method of determining a thyroid cancer or risk of developing thyroid cancer in a subject in need thereof includes determining a thymidine level in which a threshold above the threshold indicated in Table 3 identifies the thyroid nodule as a benign thyroid nodule. In embodiments, the level is the proportion of molecules (e.g., in a plurality of reacted thyroid nodule DNA molecules or a plurality of reacted thyroid nodule DNA amplicons) having a uracil or thymidine as determined by a quantitation method.

In embodiments, the method of determining a thyroid cancer or risk of developing thyroid cancer in a subject in need thereof includes determining a uracil level in which a threshold below the threshold set forth in Table 4 identifies the thyroid nodule as a benign thyroid nodule. In embodiments, the method of determining a thyroid cancer or risk of developing thyroid cancer in a subject in need thereof includes determining a thymidine level in which a threshold below the threshold indicated in Table 4 identifies the thyroid nodule as a benign thyroid nodule. In embodiments, the level is the proportion of molecules (e.g., in a plurality of reacted thyroid nodule DNA molecules or a plurality of reacted thyroid nodule DNA amplicons) having a uracil or thymidine as determined by a quantitation method.

In embodiments, the method of determining a thyroid cancer or risk of developing thyroid cancer in a subject in need thereof includes determining a uracil level in DNA of a thyroid nodule specimen obtained by biopsy or by surgical resection of a subject. In embodiments, the method of determining a thyroid cancer or risk of developing thyroid cancer in a subject in need thereof includes determining a thymidine level in DNA of a thyroid nodule specimen obtained by biopsy or by surgical resection of a subject.

In embodiments, the method of determining a thyroid cancer or risk of developing thyroid cancer is of a subject who has previously undergone thyroid surgery, radiation therapy, radioactive iodine therapy, chemotherapy, thyroid hormone therapy, and/or administration of an active agent, before the determination.

In embodiments, a subject having thyroid cancer or at risk of developing thyroid cancer was administered an active agent: Cabozantinib-S-Malate, Caprelsa (Vandetanib), Cometriq (Cabozantinib-S-Malate), Doxorubicin Hydrochloride, Lenvatinib Mesylate, Lenvima (Lenvatinib Mesylate), Nexavar (Sorafenib Tosylate). Sorafenib Tosylate, and/or Vandetanib.

In embodiments, the method of determining a thyroid cancer may lead to changes in therapeutic regimen for treating the subject. In embodiments a subject identified as having thyroid cancer may be treated with tyrosine kinase inhibitors. In embodiments, a subject identified as having thyroid cancer or being at risk of developing thyroid cancer according to a method disclosed herein is advised and/or directed to receive additional screening and/or treatment for thyroid cancer.

In embodiments, the active agent administered to a subject after determining thyroid cancer is: Cabozantinib-S-Malate, Caprelsa (Vandetanib), Cometriq (Cabozantinib-S-Malate), Doxorubicin Hydrochloride. Lenvatinib Mesylate, Lenvima (Lenvatinib Mesylate), Nexavar (Sorafenib Tosylate). Sorafenib Tosylate, and/or Vandetanib.

Method of Treating Thyroid Cancer

Also provided herein is a method of treating thyroid cancer in a subject by administering to the subject an active agent for treating thyroid cancer, in which the subject is identified for treatment by a method including isolating a thyroid nodule DNA molecule from a thyroid nodule of the subject thereby forming an isolated thyroid nodule DNA molecule; contacting the isolated thyroid nodule DNA molecule with a bisulfite salt (such as sodium bisulfite) thereby forming a reacted thyroid nodule DNA molecule; and detecting the presence or absence of uracil in the reacted thyroid nodule DNA molecule at a methylation site set forth in Table 1; thereby detecting the thyroid cancer in the subject. In embodiments, contacting the isolated thyroid nodule DNA with a bisulfite salt comprises adding a solution comprising the bisulfite salt to a solution comprising the isolated thyroid nodule DNA.

In embodiments, the method includes detecting methylation or unmethylation at a plurality of methylation sites set forth in Table 1. In embodiments, the plurality of methylation sites comprises at least about 2, 3, 4, 5, 10, 25, 50, 75, 80, 85, 90, 100, 150, 200, 250, 300, 350, 400, 450, 500, or 550, or 5-550 methylation sites. In embodiments, the plurality of methylation sites comprises less than about 550, 500, 450, 400, 350, 300, 250, 200, 150, 100, 90, 85, 80, 75, 50, 25, or 10 methylation sites. In embodiments, the plurality of methylation sites is about 5, 6, 7, 8, 9, 10, 11, 12, 13, 14, 15, 16, 17, 18, 19, 20, 25, 50, 75, 80, 85, 90, 100, 150, 200, 250, 300, 350, 400, 450, 500, or 550, or 5-550 methylation sites. In embodiments, the plurality of methylation sites includes two or more methylation sites set forth in Table 1 and no other methylation sites.

In embodiments, a method provided herein is practiced for a subject more than once over time. In embodiments, methylation or unmethylation of thyroid nodule DNA from a subject is assessed using a method provided herein at least 1, 2, 3, 4, 5, 6, 7, 8, 9, 10 or more times. In embodiments, the method is repeated at least once every 4, 6, 8, 12 or 18 months, or at least once every 2, 3, 4, or 5 more years.

In embodiments, the method of treating a thyroid cancer in a subject in need thereof includes determining alteration in methylation at a plurality of methylation sites set forth in Table 1.

In embodiments, the method of treating a thyroid cancer in a subject in need thereof includes alteration which includes increase or loss of uracil level at plurality of methylation sites.

In embodiments, the method of treating a thyroid cancer in a subject in need thereof includes determining a uracil level which is above a threshold as set forth in Table 2. In embodiments, the method of treating a thyroid cancer in a subject in need thereof includes determining a thymidine level which is above a threshold indicated in Table 2. In embodiments, the level is the proportion of molecules (e.g., in a plurality of reacted thyroid nodule DNA molecules or a plurality of reacted thyroid nodule DNA amplicons) having a uracil or thymidine as determined by a quantitation method.

In embodiments, the method of treating a thyroid cancer in a subject in need thereof includes determining a uracil level which is above a threshold as set forth in Table 3. In embodiments, the method of treating a thyroid cancer in a subject in need thereof includes determining a thymidine level which is above a threshold indicated in Table 3. In embodiments, the level is the proportion of molecules (e.g., in a plurality of reacted thyroid nodule DNA molecules or a plurality of reacted thyroid nodule DNA amplicons) having a uracil or thymidine as determined by a quantitation method.

In embodiments, the method of treating a thyroid cancer in a subject in need thereof includes determining a uracil level which is below a threshold as set forth in Table 4. In embodiments, the method of treating a thyroid cancer in a subject in need thereof includes determining a thymidine level which is below a threshold indicated in Table 4. In embodiments, the level is the proportion of molecules (e.g., in a plurality of reacted thyroid nodule DNA molecules or a plurality of reacted thyroid nodule DNA amplicons) having a uracil or thymidine as determined by a quantitation method.

In embodiments, the method of treating a thyroid cancer is in a subject who has undergone surgery, radiation therapy, radioactive iodine therapy, chemotherapy, or thyroid hormone therapy, before the detecting thyroid cancer.

In embodiments, an active agent administered to a subject for treating thyroid cancer: Cabozantinib-S-Malate, Caprelsa (Vandetanib), Cometriq (Cabozantinib-S-Malate). Doxorubicin Hydrochloride, Lenvatinib Mesylate, Lenvima (Lenvatinib Mesylate). Nexavar (Sorafenib Tosylate), Sorafenib Tosylate, and/or Vandetanib.

In embodiments, the subject has or is at risk of papillary thyroid cancer, follicular thyroid cancer, medullary thyroid cancer, or anaplastic thyroid cancer.

In embodiments, the method includes determining a papillary thyroid carcinoma (PTC) methylation alteration score for the subject, wherein the PTC methylation alteration score is equal to the number of methylation sites in Table 1 having a uracil level equal to or greater than the corresponding threshold level set forth in Table 2.

In embodiments, the method includes determining a PTC methylation alteration score for the subject, wherein the PTC methylation alteration score is equal to the number of methylation sites in Table 1 having a thymidine level equal to or greater than the corresponding threshold level set forth in Table 2.

In embodiments, the method includes determining a benign thyroid nodule (BTN) methylation alteration score for said subject, wherein the BTN methylation alteration score is equal to: (a) the number of methylation sites in Table 1 having a uracil level equal to or greater than the corresponding threshold level set forth in Table 3; (b) the number of methylation sites in Table 1 having a uracil level equal to or less than the corresponding threshold level set forth in Table 4; or (c) the number of methylation sites in Table 1 having a uracil level equal to or greater than the corresponding threshold level set forth in Table 3 plus the number of methylation sites in Table 1 having a uracil level equal to or less than the corresponding threshold level set forth in Table 4.

In embodiments, the method includes determining a benign thyroid nodule (BTN) methylation alteration score for said subject, wherein the BTN methylation alteration score is equal to: (a) the number of methylation sites in Table 1 having a thymidine level equal to or greater than the corresponding threshold level set forth in Table 3; (b) the number of methylation sites in Table 1 having a thymidine level equal to or less than the corresponding threshold level set forth in Table 4; or (c) the number of methylation sites in Table 1 having a thymidine level equal to or greater than the corresponding threshold level set forth in Table 3 plus the number of methylation sites in Table 1 having a thymidine level equal to or less than the corresponding threshold level set forth in Table 4.

In embodiments, the method comprises calculating a Composite Cancer Risk Score for the subject. In embodiments, the Composite Cancer Risk Score for the subject equals: [the PTC methylation alteration score for said subject]/[BTN methylation alteration score for said subject]. In embodiments, the Composite Cancer Risk Score for the subject equals: [(the PTC methylation alteration score for said subject)+1]/[(BTN methylation alteration score for said subject)+1].

In embodiments, the subject is identified as being at risk of developing thyroid cancer or diagnosed as having thyroid cancer if (a) the PTC methylation alteration score for the subject is at least 5, 6, 7, 8, 9, or 10; (b) the BTN methylation alteration score for the subject is at least 5, 6, 7, 8, 9, or 10; and/or (c) the Composite Cancer Risk Score for the subject is at least about 2, 2.1, 2.2, 2.3, 2.4, 2.5, 2.6, 2.7, 2.8, 2.9, or 3.0.

In embodiments, the subject receives treatment (e.g., is directed or advised to receive treatment) for thyroid cancer or is directed to receive additional screening for thyroid cancer if (a) the PTC methylation alteration score for the subject is at least 5, 6, 7, 8, 9, or 10; (b) the BTN methylation alteration score for the subject is at least 5, 6, 7, 8, 9, or 10; and/or (c) the Composite Cancer Risk Score for the subject is at least about 2, 2.1, 2.2, 2.3, 2.4, 2.5, 2.6, 2.7, 2.8, 2.9, or 3.0.

Target Sites for Methylation Level of Thyroid Nodule

In another aspect, provided herein is a deoxyribonucleic acid 5 to 100, 5 to 300, 5 to 300, or at least about 5, 50, 100, 150, 200, 250, 300, or more nucleotides in length including a uracil-containing sequence identical to the sequence of at least 5 contiguous nucleotides within a sequence including SEQ ID NO: 1 to SEQ ID NO:550.

SEQ ID NO: 1 to SEQ ID NO:500 are 300 bp length sequences that include the target sites (i.e., methylation sites of interest). The sequences provided are as modified after bisulfite conversion. Therefore "C" in the non-CpG context becomes "U", and C in the CpG context is designated as R or X (either "U" either "C"), where X is the target site. The DNA strands (sense and antisense) are no longer complementary after bisulfite conversion. Therefore, each DNA strand is identified with its unique sequence, and is designated as "forward" and "reverse" respectively, in Table 1.

The sequences listed in Table 1 are provided below with their respective sequence identification number.

| SEQ ID NO: | Sequence |
|---|---|
| 1 | TUUTTAGUUUTURGTGGRGUUAGAGTTGGTTGUUTUAGTAGRGRGTGUUUAUURGG<br>UUUAAAGUTGTTUTGUAGUTGGTUAUTGTGGGAGAAGAGAUTGGAAAAGTTUAAAG<br>GTGGAGAGGRGGUAGRGATUTGGAGUAUTTTTURGUAXGUTGTAAUUUUTGAGAAG<br>AAAUAAAGAGGAAARGAGGUTGTTTAGATAATUURGGGUUUTGGTGUTTGUATTTA<br>GAAAAATTAGGUUUTUTGAAAAATTAUAGAATTATGUTGUUAGTGTUAGGTTUUU<br>AGATAATGATGTGTUTGTGT |
| 2 | UAUAGAUAUATUATTATUTGGGAAUUTGAUAUTGGUAGUATAATTUTGTAATTTTT<br>UAAGAGGGUUTAATTTTTUTAAATGUAAGUAUUAGGGUURGGGATTATUTAAAUAG<br>UUTRGTTTUUTUTTTGTTTUTTUTUAGGGGTTAUAGXGTGRGGAAAAGTGUTUUAGA<br>TRGUTGURGUUTUTUUAUUTTTGAAUTTTTUUAGTUTUTTUTUUUAUAGTGAUUAGU<br>TGUAGAAUAGUTTTGGGURGGGTGGGUARGRGUTAUTGAGGUAAUUAAUTUTGGRG<br>UUARGGAGGGUTAAGGAU |
| 3 | GGGTGAUUAGTGUUAUTAAAAGUAGAGUTTGAGTTTAUTUTUATAAUUATRGGUTG<br>TGGGUUAGAUATTTGGUTGUTTTGUAGGUAGAUUAGGUTTUURGGTGAGTUATGUT<br>GUTTAAAATGUTGTUTGGGAARGUAGAGAAAGTUTAAAXGUUAAGARGUTGAGGA<br>UAGUUURGUAGGTGGAUTGUUATGUURGGUTRGGUUUUTTTTTGGTUUUUAGAGTG<br>GAUUUTTUTUUTUUUUAUAGAGGGGAGGUATUTGATGGTGGUTTUAGUAGAUAAU<br>UTGGAGAAGAAUUAUTUAGGGT |
| 4 | AUUUTGAGTGGTTUTTUTUUAGGTTGTUTGUTGAAGUAUUATUAGATGUUTUUUU<br>TUTGTGGGGAGGAGAAGGGTUUAUTUTGGGGAUUAAAAAGGGGURGAGURGGGUA<br>TGGUAGTUUAUUTGRGGGGUTGTUUTUAGRGTUTTGGXGTTTAGAUTTTUTUTGRGT<br>TUUUAGAUAGUATTTAAGUAGUATGAUTUAURGGGAAGUUTGGTUTGUUTGUAAA<br>GUAGUUAAATGTUTGGUUUAUAGURGATGGTTATGAGAGTAAAUTUAAGUTUTGUT<br>TTTAGTGGUAUTGGTUAUUU |
| 5 | CAGUTGGGGAGGGGAUAGGGTAGGTGGUTGUAGAAGGGGGUTGGGTTGAGGTUTU<br>AGGTGUAGARGAGGAGGGGUTGGGRGGAGGGGGTGAGGAGGGGAGURGGGUTGGG<br>GGURGGGRGRGUTGUTGGGGTUUUUUTUURGUUURGGGAUXGTURGUTUTTGUUUA<br>GAUURGTRGGTAAAUAGARGURGTGATGTUARGGGRGURGUTGAUUTGTGGUTGAA<br>UURGGAGUTGTAAATGAGATGUAAGGTGUUAGUAGUUTURGGURGUAGGGUUTAR<br>GAGUUAUARGRGUTUUTURGURGG |
| 6 | URGGRGGAGGAGRGRGTGTGGUTRGTAGGUUUTGRGGURGGAGGUTGUTGGUAUUT<br>TGUATUTUATTTAUAGUTURGGGTTUAGUUAUAGGTUAGRGGRGUURGTGAUATUA<br>RGGRGTUTGTTTAURGARGGGTUTGGGUAAGAGRGGAXGGTUURGGGGRGGGAGGG<br>GGAUUUUAGUAGRGUUURGGUUUUUAGUURGGUTUUUUTUUTUAUUUUUTURGUU<br>UAGUUUUTUUTRGTUTGUAUUTGAGAUUTUAAUUUAGUUUUUTTUTGUAGUUAUU<br>TAUUUTGTUUUUTUUUUAGUTG |
| 7 | TTTTUTGTAAAATGGGGURGUUUAUAAAAUTUATAAUAAAGTGTTGAGGTTURGAU<br>AAGURGAAAUUTGTGAAAAGUTTGTGTAAAUUTUAGAGUTGTAUATGGATGGTTGA<br>AGGATUTATTTRGAUAGUTURGGGGAGUXGTGGGAGGGAAGUTGAXGGXGGUTUTT<br>GUTGTTUTUUTAUUTUUUAGUUUTUURGAAGAUTUTGAGUAGUUTGGAGATUAAAG<br>GTGATTGGGGUUTGUTGGUATGGAGGURGGGUTRGGUAGAAUUTGUTTUURGGUUU<br>UUTGUUUAUUTUUUAUUUAU |
| 8 | GTGGGTGGGAGGTGGGUAGGGGGURGGGAAGUAGGTTUTGURGAGUURGGUUTUU<br>ATGUUAGUAGGUUUUAATUAUUTTTGATUTUUAGGUTGUTUAGAGTUTTRGGGAGG<br>GUTGGGAGGTAGGAGAAUAGUAAGAGUXGUXGTUAGUTTUUUTUUUAXGGUTUUU<br>RGGAGUTGTRGAAATAGATUUTTUAAUUATUUATGTAUAGUTUTGAGGTTTAUAUA<br>AGUTTTTUAUAGGTTTRGGUTTGTRGGAAUUTUAAUAUTTGTTATGAGTTTTGTGG<br>GRGGUUUUATTTTAUAGAAAA |
| 9 | TGAGUAGTGTTTUAGRGUUUAGAGAGAUAUTGTGGAGAAGGTUUAUUAGGATGUU<br>TAUUTGUUTTAUAUAAGAGUUTAAUTTTGGUAUAUUTGTGGUAUAUUTGTGGAGAG<br>UTGTTUTGGUUURGGTTGTUTGGUAGGUUTGGGUTAUTUXGAGUAGGGGAAUTGGG<br>GUAUAGTGGUTGUAUUTURGGUTATAUUUTGGTTTTTUUAGTTUUTGATGUURGUU<br>UUTUAGGTGGUAGUATGAGGTGAUTUAGGGAUAGARGUUUTTATRGTGARGUAAGT<br>UUAGUUUUUAGTGGAGUUUUT |
| 10 | AGGGGUTUUAUTGGGGGUTGGAUTTGRGTUARGATAAGGGRGTUTGTUUUTGAGTU<br>AUUTUATGUTGUUAUUTGAGGGGRGGGUATUAGGAAUTGGAAAAAUUAGGGTATA<br>GURGGAGGTGUAGUUAUTGTGUUUUAGTTUUUUTGUTXGGAGTAGUUUAGGUUTG<br>UUAGAUAAURGGGGUUAGAAUAGUTUTUUAUAGGTGTGUUAUAGGTGTGUUAAAG |

-continued

| SEQ ID NO: | Sequence |
|---|---|
| | TTAGGUTUTTGTGTAAGGUAGGTAGGUATUUTGGTGGAUUTTUTUUAUAGTGTUTUT UTGGGRGUTGAAAUAUTGUTUA |
| 11 | TUTTGTAAAATTUUAGAGUUAGGTATAUUUAATrUTGUAARGTGGTAGUTGUATGA UTGTAUAAGTUUUTTAAUAGUAURGGGUUTUAGTGAUATUATUTGTTAAATGGGTT GGTGATGATAATGGTUAGUATTTATGGAGGAGUUUAUAXGGTGUTAAGTGUTTrAU AUATATUAGUTAAUTGAATUUTUAUTGUTGUUAATGAGAUAGGTAUTATTGAATUA GAGGUURGGAGAGAGUTUUARGRGGTTGGTUATAUTGGTGAAGAGUTTGGTTUAAT GUUTGGTGAAUTUTRGGUAU |
| 12 | GTGURGAGAGTTUAUUAGGUATTGAAUUAAGUTUTTUAUUAGTATGAUUAAURGRG TGGAGUTUTUTURGGGUUTUTGATTUAATAGTAUUTGTUTUATTGGUAGUAGTGAG GATTUAGTTAGUTGATATGTGTAAAGUAUTTAGUAUXGTGTGGGUTUUTUUATAAA TGUTGAUUATTATUATUAUUAAUUUATTTAAUAGATGATGTUAUTGAGGUURGGTG UTGTTAAGGGAUTTGTAUAGTUATGUAGUTAUUARGTTGUAGAATTGGGTATAUUT GGUTUTGGAATTTTAUAAGA |
| 13 | TURGGAGUUAGTGAAUTTGTGATURGGAGUUAGTTAAUTTUAUAGUTAATGTGUTG AGUAGUATTUUAGUUAGRGTUTGAAGUUAGAGUAGGGAGGRGGARGGGUUUUAGG AGTTRGAGGTURGGGAAGURGAAGUAUUAUUAAAUTGAGXGAGGTTUUAAUTUTU UUTUUUAGGAGGTURGGUTGUUTUUUAUUAGUAGUUUAAUUAUAGGGTUUTGUTU UAGARGTTAUTATTTTUTUTTTTUAGTGTGTUUAGUAGUAAUUTRGAUTGUUAAUA AUAARGTGAAAAATAAUTGUAG |
| 14 | UTGUAGTTATTTTTUARGTTGTTGTTGGUAGTRGAGGTTGUTGUTGGAUAUAUTGAA AAAGAGAAAATAGTAARGTUTGGAGUAGGAUUUTGTGGTTGGGUTGUTGGTGGGAG GUAGURGGAUUTUUTGGGAGGGAGAGTTGGAAUUTXGUTUAGTTTGGTGGTGUTTR GGUTTUURGGAUUTRGAAUTUUTGGGGUURGTURGUUTUUTGUTUTGGUTTUAGA RGUTGGUTGGAATGUTGUTUAGUAUATTAGUTGTGAAGTTAAUTGGUTURGGATUA UAAGTTUAUTGGUTURGGA |
| 15 | TTGUUAAAAUTGGAAGUAAUUAAGATGUUUUTUAAAAGGTGAATGGAGGUUAGGT GRGGTGGUTUARGURGATAATUUUAGUAUTTTGGGAGGUTGAGGUAGGTGGATUAU TTGAGATUARGAGTTTGAGAUUAGUURGGUUAAUATGGXGAAAUUURGTUTUTAUT AAAAATAUTAAGATTAAURGGGRGTGGTGGUARGTGUUTGTTATUUUAGUTAUTTG GGAAGUTGAGGUAGGUAAATTGUTTGAAUUTGGGAGGTGGAGGTUAUAGTGAGUU AAGATTGTGUUAUTGUAUTUUA |
| 16 | TGGAGTGUAGTGGUAUAATUTTGGUTUAUTGTGAUUTUUAUUTUUUAGGTTUAAGU AATTTGUUTGUUTUAGUTTUUUAAGTAGUTGGGATAAUAGGUARGTGUUAUUARGU URGGTTAATUTTAGTATTTTTAGTAGAGARGGGGTTTXGUUATGTTGGURGGGUTGG TUTUAAAUTRGTGATUTUAAGTGATUUAUUTGUUTUAGUUTUUUAAAGTGUTGGGA TTATRGGRGTGAGUUAURGUAUUTGGUUTUUATTUAUUTTTTGAGGGGUATUTTGGT TGUTTUUAGTTTTGGUAA |
| 17 | GGRGGGATURGAGURGAGAUARGTGUTGGAGRGGAGURGUTTUUTUARGGTRGUUA GURGUAGAUAAUTGAUUTUUURGGUATRGRGTTRGRGGUUUTGUTGUTGGUTURGG TGTUTRGGGURGGAAUTUUTGTGGUTUUAGRGTTRGXGURGGUUAUTGGUUAGRGU TTGGGUUTRGUUUTGUAGUTURGGGGUUATAGGGUAUAGUTTTAGUTTTGAUUTUU URGTTUURGAAAGGARGUUUAAGGRGAUUTUUUAUUUUATUUTUUUUAAUTTUTU UUUUATGTUUTGRGGUAAUTT |
| 18 | AGTTGURGUAGGAUATGGGGGAGAAGTTGGGGAGGATGGGGTGGGAGGTRGUUTTG GGRGTUUTTTRGGGAARGGGGAGGTUAAAGUTAAAGUTGTGUUUTATGGUUURGGA GUTGUAGGGRGAGGUUUAAGRGUTGGUUAGTGGURGGXGRGAARGUTGGAGUUAU AGGAGTTURGGUURGAGAUAURGGAGUUAGUAGUAGGGURGRGAARGRGATGURG GGGAGGTUAGTTGTUTGRGGUTGGRGAURGTGAGGAAGRGGUTURGUTUUAGUARG TGTUTRGGUTRGGATUURGUUU |
| 19 | UUAGUAGGGAAGGUAGUUAAUAGATGUAGAUTRGUTUTGUUTAUUTGTGGAGGUR GGTGAGGUUAGGGUUTGTTGGGAUTTGAAAUAGTGAGGUAAGTGGGTGTGTGGTGU TGGGUTUUUXGUTUAAGTTUTUUUAGXGTGUUAGTTUURGGAGUUTTATGTGUAGG GTGTTGGGGAAGGGXGGGUTGAATRGTGGGTGGGAGTUTTGGUTUAAAGUUUUAGG TGAGTGGAGGAATTGGGGGRGGAUUTGAAGTAUTGTUTTGAAGTGGAUUTGGUAGG UUTUTTGGGUTTGTGUAGUTG |
| 20 | UAGUTGUAUAAGUUUAAGAGGUUTGUUAGGTLTUAUTTUAAGAUAGTAUTTUAGGT URGUUUUUAATTUUTUUAUTUAUUTGGGGUTTTGAGUUAAGAUTUITUAUUUARGAT TUAGUUXGUUUTTUUUUAAUAUUUTGUAUATAAGGUTURGGGAAUTGGUAXGUTG GGAGAAUTTGAGXGGGGAGUUUAGUAUUAUAUAUUUAUTTGUUTUAUTGTTTUAA GTUUUAAUAGGUUUTGGUUTUAURGGUUTUUAUAGGTAGGUAGAGRGAGTUTGUA TUTGTTGGUTGUUTTUUUTGUTGG |
| 21 | UUAGAUTRGUUUTUUUUAUURGGGUUTRGGAUTTTUAUUUUAGUTTUTUTUTUUTG GUUAGTGATTAUUUAUUUUUAATUUUAUUURGUUURGURGRGUAAUTAUUTUUTU |

-continued

| SEQ ID NO: | Sequence |
|---|---|
| | UUTTUAUURGGAUTGGGAUUATUATUUUUAUTUUAUTUXGUUUAGTUTGGGAUTU<br>UAUUTGUUTUUTUUUUAATUUUAUAUTAATUTUTGUTTGGTUTUTTUUTUTTTGGUU<br>TAATUTUTRGTUTRGGUTTATTGGGGARGGUUAUTUTUAUAGTTTGGTTUUAAAUAU<br>UAGTTUUTGGATGGATTUUU |
| 22 | GGGAATUUATUUAGGAAUTGGTGTTTGGAAUUAAAUTGTGAGAGTGGURGTUUUUA<br>ATAAGURGAGARGAGAGATTAGGUUAAAGAGGAAGAGAUUAAGUAGAGATTAGTG<br>TGGGATTGGGGAGGAGGUAGGTGGAGTUUUAGAUTGGGXGGAGTGGAGTGGGGAT<br>GATGGTUUUAGTURGGGTGAAGGGAGGAGGTAGTTGRGRGGRGGGGRGGGGTGGG<br>ATTGGGGGTGGGTAATUAUTGGUUAGGAGAGAGAAGUTGGGGTGAAAGTURGAGG<br>UURGGGTGGGGAGGGRGAGTUTGG |
| 23 | RGUAGGUURGRGUUURGUTUURGUUURGUUTGURGRGUUTUURGGGGRGUURGUA<br>TTAAAGRGUATATGUAAGUUATGAATTATUAAUTGAAAGGAGTUAATTAURGGUTU<br>TAAAAARGAGTGTUTGRGUTRGUAGRGUUURGGGUUATUXGUUTATTTARGGAGRG<br>ATUTAUUURGUURGGUTGGGGAGGGGGUUTRGGGAGGGAGAGAGARGGAGAAARG<br>GAGUURGAGAURGGGAGAGAGURGGAGAGGUAGGGAUTGGAGAGTUTGGGAUARG<br>AAGGAGAGGRGGGGAGAGAURGA |
| 24 | TRGGTUTUTUUURGUUTUTUUTTRGTGTUUUAGAUTUTUUAGTUUUTGUUTUTURGG<br>UTUTUTUURGGTUTRGGGUTURGTTTUTURGTUTUTUTUUUTUURGAGGUUUUUTUU<br>UUAGURGGGRGGGGTAGATRGUTURGTAAATAGGXGGATGGUURGGGGRGUTGRG<br>AGRGUAGAUAUTRGTTTTTAGAGURGGTAATTGAUTUUTTTUAGTTGATAATTUATG<br>GUTTGUATATGRGUTTTAATGRGGGRGUUURGGGAGGRGRGGUAGGRGGGGRGGGA<br>GRGGGGRGRGGGUUTGRG |
| 25 | AUAGTRGUTGUAGGGAGGARGRGGGURGTGAGAAUURGGGGAUAGUUTUUUUTUT<br>TGRGGTUUTGUAGTUURGGAUUUAUTGGGRGGATUAGAAAGTTTGUAGGGAGUUA<br>GGGAUTAGGAGAUAGAUAGAUAGRGUAGGGAUAGAGAAAGXGGAGGGATGUUAG<br>AAAGAURGAGTRGGGGAUAGAUAGAGAGAUUUAGGGTGAGAUAGAGGAAGAGAT<br>AUURGGGGUTGAAAARGGTGGUAGAAAGTGAGUAAUTTAGGGAGAUAGAAAGAGR<br>GUAGAAUTRGAAATTURGAGGUAGAGA |
| 26 | TUTUTGUUTRGGAATTTRGAGTTUTGRGUTUTTTUTGTUTUUUTAAGTTGUTUAUTTT<br>UTGUUAURGTTTTUAGUUURGGGTATUTUTTUUTUTGTUTUAUUUTGGGTUTUTUTG<br>TUTGTUUURGAUTRGGTUTTTUTGGUATUUUTUXGUTTTUTUTGTUUUTGRGUTGTU<br>TGTUTGTUTUUTAGTUUUTGGUTUUUTGUAAAUTTTUTGATURGUUUAGTGGGTURG<br>GGAUTGUAGGAURGUAAGAGGGGAGGUTGTUUURGGGTTUTUARGGUURGRGTUU<br>TUUUTGUAGRGAUTGT |
| 27 | TUAGUUTGTAUUURGGRGUTGGUUTUUAGAUAGUUAGGTGUTGUUTRGUARGGTUT<br>TGUTTGUAGGUTGGGGUATGAAGUAUUUTGGTATTTARGUTGGGATTGGTUTUTUA<br>UTAGGGTTGGGGRGGGUTGTGGTUAUUTGGUURGGRGXGURGUAGAGGUTGGUTUR<br>GGAGAAGAUUTGGGGGRGUAAGAUTUAGAGGUUAGAGGGTGUAGURGUTGUTGAU<br>TUATTTGRGGARGGGGRGGUTGGGAGGAGRGUTAGUUUUTGTTGTGAGRGATTTGA<br>GAGUUAGGGUUAAATUTGGGT |
| 28 | AUUUAGATTTGGUUUTGGUTUTUAAATRGUTUAUAAUAGGGGUTAGRGUTUUTUUU<br>AGURGUUURGTURGUAAATGAGTUAGUAGRGGUTGUAUUUTUTGGUTUTUTGAGTUT<br>TGRGUUUUUAGGTUTTUTURGGAGUUAGUUTUTGRGGXGRGURGGGUUAGGTGAU<br>UAUAGUURGUUUUAAUUUTAGTGAGAGAUUAATUUUAGRGTAAATAUUAGGGTGU<br>TTUATGUUUUAGUUTGUAAGUAAGAURGTGRGAGGUAGUAUUTGGUTGTUTGGAG<br>GUUAGRGURGGGGTAUAGGUTGA |
| 29 | GUUUAGUUTUAUAAAGGTGAGTGGGGUAUUUUUAGUTGURGAGUTUUUUTAGTUA<br>GUAGUUTUATAUUTUAUATTUTUUTGTGGURGUAUUTUAUAGUUURGUUURGGUU<br>UAUAGGUATUUTTAAGAAGAAGTGTUTGUUUAUUATUAGXGAGAAGAGUAGUUTU<br>UTGXGGUTUUUUUTGGAGUAATGUAUAGGGTUTTUURGGGGUTUUTURGUTAGTGA<br>GGGUAGURGGGGAGGUUUUUUTUUURGUUUAURGUUURGGUAGAGUUTUUAGGA<br>GUAGUTGAARGGGGTUATGUUUATRG |
| 30 | RGATGGGUATGAUUURGTTUAGUTGUTUUTGGAGGUTUTGURGGGGRGGTGGGRGG<br>GGAGGGGGGUUTUUURGGUTGUUUTUAUTAGRGGAGGAGUUURGGGAAGAUUUTG<br>TGUATTGUTUUAGGGGGAGUXGUAGGAGGUTGUTUTTUTXGUTGATGGTGGGUAGA<br>UAUTTUTTUTTAAGGATGUUTGTGGGURGGGGRGGGGUTGTGAGGTGRGGUUAUAG<br>GAGAATGTGAGGTATGAGGUTGUTGAUTAGGGGAGUTRGGUAGUTGGGGGTGUUU<br>UAUTUAUUTTTGTGAGGUTGGGU |
| 31 | TUAGAATAATGGUTGGTTTGTAGAGATUAGAAATGUUUAUTGUTGTTTUUTGTAT<br>UUUTUUAUUUAUUUAGAUTGAGUUTUTGAAGUTGTURGGGGUUTGGAGAGAGAAG<br>UUAUTUAAGGAUAGUAGUTGUTGAUTUAGAXGUTUAAATTUTXGGGXGGAAAAGG<br>AUUTTAGAGAATGUUTAAAATRGTGGUUUAATUUUTUATTGGAAGUTGGGGUTURG<br>AAAAGURGGGGUTURGAAAAGUTGGGAGAGUAGUUUAAAGRGTAUTGUUUAUTAA<br>ATGTGGATGUARGUTGGAURGU |

-continued

| SEQ ID NO: | Sequence |
|---|---|
| 32 | GRGGTUUAGRGTGUATUUAUATTTAGTGGGUAGTARGUTTTGGGUTGUTUTUUUAG<br>UTTTTRGGAGUUURGGUTTTTRGGAGUUUUAGUTTUUAATGAGGGATTGGGUUARG<br>ATTTTAGGUATTUTUTAAGGTUUTTTTUXGUUXGAGAATTTGAGXGTUTGAGTUAGU<br>AGUTGUTGTUUTTGAGTGGUTTUTUTUTUUAGGUUURGGAUAGUTTUAGAGGUTUA<br>GTUTGGGTGGGTGGAGGGATAUAGGAAAUAGUAGTGGGUATTTUTGATUTUTAUAA<br>AUUAGGUUATTATTUTGGA |
| 33 | AAGTTUTGGGGUAGAAGTTGGATAAUUAGGGUUTGAGAAATAAAGATAAGAGGGT<br>ATATTUUTUUUUUAGGAGAUAAAAGAGAAGGTGGATGGAGAAGGGGAAAUTGGGU<br>UTUAGUUAGUAURGGGATGATGRGAUUAGUTTTGTUAGUAXGUTTGGGGAGUATAU<br>AUAURGUTTGUUTTGGUTGGAURGGAGAUTGTGATUAUUAUUUTTUUAAUUUATUU<br>UUUAAUARGUAGGUTGGUATGGUUARGUUUAUAGTGUUUUAAGTGUTGUUTGUUT<br>TGUAGTGAUTUAUTTUUTUTGTA |
| 34 | TAUAGAGGAAGTGAGTUAUTGUAAGGUAGGUAGUAUTTGGGGUAUTGTGGGRGTG<br>GUUATGUUAGUUTGRGTGTTGGGGGATGGGTTGGAAGGGTGGTGATUAUAGTUTUR<br>GGTUUAGUUAAGGUAAGRGGTGTGTATGUTUUUUAAGXGTGUTGAUAAAGUTGGTR<br>GUATUATUURGGTGUTGGUTGAGGUUUAGTTTUUUUTTUTUUATUUAUUTTUTUTTT<br>TGTUTUUTGGGGGAGGAATATAUUUTUTTATUTTTATTTUTUAGGUUUTGGTTATUU<br>AAUTTUTGUUUUAGAAUTT |
| 35 | TUAGAARGTGUUUAUAUATGUUUATGUUUTUTATUUTGUTGAAATUUAAUUUUUU<br>UTTUAAAGGUUAUTGUAGGGAGUUTTUUUAGGGUUUAAURGGATTUAGTGTUTAU<br>UTGTTUTGTUUTGTAUAAAGRGUUUUTTTTGUUUTTTTXGTGTGTAUTTAGAGAATT<br>UTGATTTTGAUTGAATUAUUTGTGTAUTTGTTTTUTUTUAGUUTUAUUUUUAUATGG<br>TGAGUTUAURGGTUTTAUTUATTTUTGUATGAGGTAAGGGTUTRGUUUAUAUUAGG<br>TGUUAAUUAGTGUTTARGGU |
| 36 | URGTAAGUAUTGGTTGGUAUUTGGTGTGGGRGAGAUUUTTAUUTUATGUAGAAATG<br>AGTAAGAURGGTGAGUTUAUUATGTGGGGGTGAGGUTGAGAGAAAAUAAGTAUAU<br>AGGTGATTUAGTUAAAATUAGAATTUTUTAAGTAUAUAXGAAAAGGGUAAAAGGG<br>GRGUTTTGTAUAGGAUAGAAUAGGTAGAUAUTGAATURGGTTGGGUUUTGGGAAGG<br>UTUUUTGUAGTGGUUTTTGAAGGGGGGGTTGGATTTUAGUAGGATAGAGGGUATGG<br>GUATGTGTGGGUARGTTUTGAA |
| 37 | UAUUTRGTGUUUUTUAUUTGTAAGUAUTGTGAGGAGUAGUAGUAGGAAGAAAGGA<br>GAUTGGGTGUURGGTGTUATGGTGGTGGTGAAATGGGTGGGGAGGGGGUAGAAUA<br>GATTUAGGUAGGRGUTGGUTGUTTGAGAGGTGGAGXGGGUAUAGGXGUUTAURGU<br>TTTATAURGGTUUUUUUAUTUUURGUURGUURGUUUTAGGUAUAGURGGAGUAGG<br>TGAUAGGTGAUAAAAUUURGUUUUUTUUUUTAUUTUUTAUUTUTTUUTUUTUUTUU<br>UUAAUUATTUUTGGGTAGGGTAUA |
| 38 | TGTAUUUTAUUUAGGAATGGTTGGGGAGGAGGAGGAAGAGGTAGGAGGTAGGGGA<br>GGGGGRGGGGTTTTGTUAUUTGTUAUUTGUTURGGUTGTGUUTAGGGRGGGRGGGR<br>GGGGAGTGGGGGGAURGGTATAAAGRGGTAGGXGUUTGTGUUXGUTUUAUUTUTU<br>AAGUAGUUAGRGUUTGUUTGAATUTGTTUTGUUUUUTUUUUAUUUATTTUAUUAUU<br>AUUATGAUAURGGGUAUUUAGTUTUUTTTUTTUUTGUTGUTGUTAUTUAUAGTGUT<br>TAUAGGTGAGGGGUARGAGGTG |
| 39 | AGARGGAGAAAUAGAAARGGAGGTUAGGRGGGGAGUUTRGGGGAUAGGUUTGGGA<br>UURGAGGURGGAAAURGUAGAGGAGRGAAGUUTGGRGGGATGUAGTGATTGGAGU<br>UAAAGGAAURGTUURGGUUTGTUUAARGRGGGGGGGUUTTXGGUURGGTGGUUUT<br>GAGRGAAURGATGUARGTGGUUURGURGUATUUUATUUUUUAUUUTUUUUAGAUT<br>UTUUUTUUUAGUTUUTTUTGAGGRGGAAAGAAAAAUUUTAUATUTGGTUUUAGUU<br>UTGGGTUUUTGUUUTGGUUUUTUUT |
| 40 | AGGAGGGGUUAGGGUAGGGAUUUAGGGUTGGGAUUAGATGTAGGGTTTTTUTTTUR<br>GUUTUAGAAGGAGUTGGGAGGGAGAGTUTGGGGAGGGTGGGGGATGGGATGRGGR<br>GGGGUUARGTGUATRGGTTRGUTUAGGGUUAURGGGUXGAAGGUUUUUURGRGTT<br>GGAUAGGURGGGARGGTTUUTTTGGUTUUAATUAUTGUATUURGUUAGGUTTRGUT<br>UUTUTGRGGTTTURGGUUTRGGGTUUUAGGUUTGTUUURGAGGUTUUURGUUTGAU<br>UTURGTTTUTGTTTUTURGTUT |
| 41 | TUAAAUUUAGGTATTUTGGGTUTAGTRGGTGTTUTTUTGUUAAAGAGTAUTTTGTGG<br>UTAAATTUAUTGGATGTGAUTUAGTTTTTATUTTTRGTUATUTUTTAGUTTTGUUTTA<br>TUUAAAURGGATUAUTUTUTTUTGUTTAGAAUTXGTTUTGUTUTTGGTGAUAGTGGT<br>AUATAUTUTUATAUTGUUTUTTUUUTTGUUUAGAGTUUTTUUTTUTUATGTTUUAUU<br>TUUTUTAUTGGGAURGGUUTGGGTGTGUTGTUUAATRGGAUAUTATTTTGTTGGGUU<br>UTUTUUTTUAUTUU |
| 42 | GAGTGAAGGAGAGGGUUUAAUAAAATAGTGTURGATTGGAUAGUAUAUUUAGGUR<br>GGTUUUAGTAGAGGAGGTGGAAUATGAGAAGGAAGGAUTUTGGGUAAGGGAAGAG<br>GUAGTATGAGAGTATGTAUUAUTGTUAUUAAGAGUAGAAXGAGTTUTAAGUAGAA |

-continued

| SEQ ID NO: | Sequence |
|---|---|
| | GAGAGTGATURGGTTTGGATAAGGUAAAGUTAAGAGATGARGAAAGATAAAAAUTG<br>AGTUAUATUUAGTGAATTTAGUUAUAAAGTAUTUTTTGGUAGAAGAAUAURGAUTA<br>GAUUUAGAATAUUTGGGTTTGAU |
| 43 | AAGTGTUTTTAUUTUUTGAGTGRGAUUUAAGTUAGGAGGUAGGAGGUTGAUTGAGG<br>GAUARGGAGGAGGTATGUAUAUTUAUAGUATGAGGUAGAGUTGTGTGUAUAUATU<br>AAGUAAGGAAATGGGGURGGAATATGGGGUAAAGGUUTAXGGATTGAATGGTGGA<br>TTTGGATGTGGGUUAUTTUTTUUAGUUUUTGAAAGAGGAUUAGGUAATGTGGUTAT<br>GAATGGGUUTAATGAGAATTGATTGATTRGUTRGAGATGTTTTUTTTTTUTTUUTAAA<br>ATAGAAAATGAUATAUUUUA |
| 44 | TGGGGTATGTUATTTTUTATTTTAGGAAGAAAAAGAAAAUATUTRGAGRGAATUAAT<br>UAATTUTUATTAGGUUUATTUATAGUUAUATTGUUTGGTUUTUTTTUAGGGGUTGG<br>AAGAAGTGGUUUAUATUUAAATUUAUUATTUAATUXGTAGGUUTTTGUUUUATATT<br>URGGUUUUATTTUUTTGUTTGATGTGTGUAUAUAGUTUTGUUTUATGUTGTGAGTGT<br>GUATAUUTUUTURGTGTUUUTUAGTUAGUUTUUTGUUTUUTGAUTTGGGTRGUAUT<br>UAGGAGGTAAAGAUAUTT |
| 45 | GGATGTGUTUAGGUTUUAGGGUUAUAUUUTGUATGTAUTUATAGUAUAGUUUATTU<br>TGGAAGGTGUAGTAGAGTTTGGGGGUAUAGUTGTGTGUTRGUAGUAGUTGGAAGTT<br>TUTGAUUTUATTUTUURGGTUUAUUAGUAGUTURGTUXGUTUUUUATAUAUURGGA<br>UUAGUARGUAGTUUTGUATGTUUTUUTUUAUATAGUAGGUUAUUAGUTTGTTGGTG<br>ATGUUATURGTGAAGRGUTAGUATGGGGAGAGGAUAGTGRGTGGGTGGGTGGGTGG<br>GGUAGGATUTUTUTGGTUTU |
| 46 | GAGAUUAGAGAGATUUTGUUUUAUUUAUUUAUUUARGUAUTGTUUTUTUUUUATG<br>UTAGRGUTTUARGGATGGUATUAUUAAUAAGUTGGTGGUUTGUTATGTGGAGGAGG<br>AUATGUAGGAUTGRGTGUTGGTURGGGTGTATGGGGAGXGGARGGAGUTGUTGGTG<br>GAURGGGAGAATGAGGTUAGAAAUTTUUAGUTGUTGRGAGUAUAUAGUTGTGUUU<br>UUAAAUTUTAUTGUAUUTTUUAGAATGGGUTGTGUTATGAGTAUATGUAGGGTGTG<br>GUUUTGGAGUUTGAGUAUATUU |
| 47 | AGUUAGGAAGGGUTGUAUTTUUUUAGTGGTUAGRGUAGGUTGGRGTUUTGGUTGUT<br>GGRGUAAGTUTUAAGUTGUUUUTUUUUTTUTAGUAAGUATGGGRGGTGTGGGTATG<br>RGGGGTGUTGGGTAUTGAUTUAUUTURGGAGAUUAUTXGGUTUUUAUAUAUUAUU<br>TUTGAATGATUTGAATUATTTATGAGGUTGAATGUUUTGTUUTUUAGGGAGUTUUA<br>GUTGGAGUTGGAGUUAGUATATGGAGGTGGAGAGAGUTUUXGUAGTUAUURGGGU<br>UUTGTAUAGUUTGUAGGUAGAAU |
| 48 | GTTUTGUUTGUAGGUTGTAUAGGGUURGGGTGAUTGXGGGAGUTUTUTUUAUUTUU<br>ATATGUTGGUTUUAGUTUUAGUTGGAGUTUUUTGGAGGAUAGGGUATTUAGUUTUA<br>TAAATGATTUAGATUATTUAGAGGTGGTGTGTGGGAGUXGAGTGGTUTURGGAGGT<br>GAGTUAGTAUUUAGUAUUURGUATAUUUAUAURGUUUATGUTTGUTAGAAGGGGA<br>GGGGUAGUTTGAGAUTTGRGUUAGUAGUUAGGARGUUAGUUTGRGUTGAUUAUTG<br>GGGAAGTGUAGUUUTTUUTGGUT |
| 49 | GGGTGUTGGGTAUTGAUTUAUUTURGGAGAUUAUTXGGUTUUUAUAUAUUAUUTU<br>TGAATGATUTGAATUATTTATGAGGUTGAATGUUUTGTUUTUUAGGGAGUTUUAGU<br>TGGAGUTGGAGUUAGUATATGGAGGTGGAGAGAGUTUUXGUAGTUAUURGGGUUU<br>TGTAUAGUUTGUAGGUAGAAUUTATAAAUTGGAUTUUTAAAGUUAUTUUTUTUAAG<br>GUUTGGAGATTUTGUTGAGTTTUAUTUTITGGUTUTUAGAGUATUTGGAAUTUTAUA<br>TAAAGUTGAGGAAUUUTTTGT |
| 50 | AUAAAGGGTTUUTUAGUTTTATGTAGAGTTUUAGATGUTUTGAGAGUUAAAGAGTG<br>AAAUTUAGUAGAATUTUUAGGUUTTGAGAGGAGTGGUTTTAGGAGTUUAGTTTATA<br>GGTTUTGUUTGUAGGUTGTAUAGGGUURGGGTGAUTGXGGGAGUTUTUTUUAUUTU<br>UATATGUTGGUTUUAGUTUUAGUTGGAGUTUUUTGGAGGAUAGGGUATTUAGUUTU<br>ATAAATGATTUAGATUATTUAGAGGTGGTGTGTGGGAGUXGAGTGGTUTURGGAGG<br>TGAGTUAGTAUUUAGUAUUU |
| 51 | AGTUUATGAAGGUAUTTTTTUAAAGTTAGGTGGTUAUUAAAAAAUAGGTAATUAAT<br>UUTGTUAUUAGURGRGGGGAUAGRGAGGUUTTGGGUTTGGAGGGGGAGGATGURG<br>ARGATGURGAURGRGUATUAGATUTRGURGGGAGGAGGGXGRGGGRGUTUUAUTTG<br>TTGUAAAGAARGURGGGTTUUTUTGGGUUATTGGGUTGURGUTURGGRGGGGAGRG<br>RGGAAGGUTGGGUUTUAGGTAGUTTUAATUATTUAUUTGUTGGTTARGGGTRGRGG<br>RGURGGGGAUUUTAUTURGGA |
| 52 | TURGGAGTAGGGTUUURGGRGURGRGAUURGTAAUUAGUAGGTGAATGATTGAAGU<br>TAUUTGAGGUUUAGUUTTURGRGUTUUURGURGGAGRGGUAGUUUAATGGUUUAG<br>AGGAAUURGGRGTTUTTTGUAAUAAGTGGAGRGUURGXGUUUTUUTUURGGRGAGA<br>TUTGATGRGRGGTRGGUATRGTRGGUATUUTUUUUUTUUAAGUUUAAGGUUTRGUT<br>GTUUURGRGGUTGGTGAUAGGATTGATTAUUTGTTTTTTGGTGAUUAUUTAAUTTTG<br>AAAAAGTGUUTTUATGGAUT |

-continued

| SEQ ID NO: | Sequence |
|---|---|
| 53 | GTUTGUAGUTGGGAATGAATGGAATGAAGGTUAAGGATGAAGTAATAAUUAAATAT<br>TGGGTTTTGGGTGUUUTGGTAAUTGTURGGTTTUUAGTTAGGGTTUUTGGGTGAUAT<br>UTTUUTTUTGGGGGAAGAUAGAGTUAAATGAGAAAXGTGAGTTGAGUUUAGGGGA<br>AAGGATUATURGGGAGATGUUTGAGGGGUTUUAGGGUATRGTAATUTUTTGUTUAG<br>UTGGUAGAGTGGGGUTGAUARGGUUAGUTGUTUTUTGGAGTUUTRGGUUTTUUTGT<br>TTUUUUUTGAGGAUTTTGAG |
| 54 | TUAAAGTUUTUAGGGGGAAAUAGGAAGGURGAGGAUTUUAGAGAGUAGUTGGURG<br>TGTUAGUUUUAUTUTGUUAGUTGAGUAAGAGATTARGATGUUUTGGAGUUUUTUA<br>GGUATUTUURGGATGATUUTTTUUUUTGGGUTUAAUTUAXGTTTUTUATTTGAUTUT<br>GTUTTUUUUUAGAAGGAAGATGTUAUUUAGGAAUUUTAAUTGGAAAURGGAUAGT<br>TAUUAGGGUAUUUAAAAUUUAATATTTGGTTATTAUTTUATUUTTGAUUTTUATTUU<br>ATTUATTUUUAGUTGUAGAUA |
| 55 | UUAGTGUAGAAUAGGUAUTGUUUAUUATAUAGGUUAGAAGAGGTGUUUTUTUUAU<br>AUTGGUUAUTGAAAUTAUTUAUTGGUAGUAGTGGGTGUUAUTTGGAAAAUAAGAT<br>GGUUUTUUUTGUAGAGUAGGUUAUUUTGURGGAGGTGTUUXGATGRGTGTGAAGU<br>AGGGTTGGAGGUAUAUTAUAGGUAUTUTUTAGTUUTTUAAAUAAUAUTGTAGTGTA<br>GATUTTGTTGGTTUTTTUAGAGAAGGGGAAARGGAAAUTUAUAGAAGUAAUTAGAG<br>GAGTGAGTAGAAGUUUAGGTATG |
| 56 | UATAUUTGGGUTTUTAUTUAUTUUTUTAGTTGUTTUTGTGAGTTTURGTTTU<br>UTUTGAAAGAAUUAAUAAGATUTAUAUTAUAGTGTTGTTTGAAGGAUTAGAGAGTG<br>UUTGTAGTGTGUUTUUAAUUUTGUTTUAUARGUATXGGGAUAUUTURGGUAGGGTG<br>GUUTGmWGUAGGGAGGGUUATUTTGTTTTUUAAGTGGUAUUUAUTGUTGUUAGT<br>GAGTAGTTTUAGTGGUUAGTGTGGAGAGGGUAUUTUTTUTGGUUTGTATGGTGGGU<br>AGTGUUTGTTUTGUAUTGG |
| 57 | TURGGUATUAATTUTTAATGAGTUUURGAGUUUURGUAGTUUGTUTAUTTUTTTTU<br>TTTTUUAGTGAATUUTUAUAGTUUUUTTTUUUTGUATGTTUTUTGTUUUAAATTTUT<br>GAAGUUUUTUUUTTTURGTUTUTTAAGAATUTUTAXGAAUURGAAAGUURGTGAGG<br>UTGATGGUARGTUTGTGGTTUUTTTUTUUTTUTTUUUTUUATAUUUAUAGUTUUURG<br>GGAURGGAUUUTUUUUAUTUAUUAGGTGUAGGGUUAGGGGUAGUAGUAGGAGGA<br>AUAGUUAUAGGTAGAGGTG |
| 58 | UAUUTUTAUUTGTGGUTGTTUUTUUTGUTGUTGUUUUTGGUUUTGUAUUTGGTGAG<br>TGGGGAGGGTURGGTUURGGGGAGUTGTGGGTATGGAGGGAAGAAGGAGAAAGGA<br>AUUAUAGARGTGUUATUAGUUTUARGGGUTTTRGGGTTXGTAGAGATTUTTAAGAG<br>ARGGAAAGGGAGGGGUTTUAGAAATTTGGGAUAGAGAAUATGUAGGGAAAGGGGA<br>UTGTGAGGATTUAUTGGAAAAGAAAAGAAGTAGAUAGGAUTGRGGGGGUTRGGGG<br>AUTUATTAAGAATTGATGURGGA |
| 59 | AGUUTGTGUTUAGGAATAAUTAAGGAGTGGAGURGUATUAAUUTUUTTUUUAAATU<br>RGGARGTUTTUUTURGAUTUAAGUUUAGUUTGAGGGUUATTUTUUTTGATTUAUUU<br>TTGGAAAUAGAUAUUAGUUAAGGGAGUTGTUTUUTGGXGTTGARGAGGATURGATT<br>TAGGTUAGTATTUTAGTTUUUAUTUUAUAGAGGAATUTGAUTGGAGGUUAGUTGTG<br>GTRGATGAGTUATURGGAAUAUAAGUAGGUAGUTATTTURGAAUTAAATGGUATUT<br>GATUTUUUTUUTUAUUTTGA |
| 60 | TUAAGGTGAGGAGGGAGATUAGATGUUATTTAGTTRGGAAATAGUTGUUTGUTTGT<br>GTTURGGATGAUTUATRGAUUAUAGUTGGUUTUUAGTUAGATTUUTUTGTGGAGTG<br>GGAAUTAGAATAUTGAUUTAAATRGGATUUTRGTUAAXGUUAGGAGAUAGUTUUUT<br>TGGUTGGTGTUTGTTTUUAAGGGTGAATUAAGGAGAATGGUUUTUAGGUTGGGUTT<br>GAGTRGGAGGAAGARGTURGGATTTGGGAAGGAGGTTGATGRGGUTUUAUTUUTTA<br>GTTATTUUTGAGUAUAGGUT |
| 61 | GAUUTUAGGATUTGAATGGTTUTTGGAGTTUTTTGUAGATGAGGTAATGTTTTGGTT<br>AAUTUATAGGTUAGAUUTGUTGTUUTTAGUTAAUTTGUURGGGAGGTTTTTAARGG<br>AAGGUUTGTGTTAGUAUAAATUATATTTUUTGATGAXGAGUAGAGAUITITGATUTG<br>GTUTTAAAGAARGRGTTTTUUAAUTTAUUUTGGGAUTTTTTTGAATTAGURGGUUAU<br>ATATAUUAGGGTTUTUAGAGGATTTTTTUTUUUUTTTUTUTUTGTUTUTTTUTGGG<br>TTTUUTATTAUTAATT |
| 62 | ATTAGTAATAGGAAAAAUUUAGAAAGAGAUAGAGAGAAAGGGGGGAAAAAATUUT<br>UTGAGAAUUUTGGTATATGTGGURGGUTAATTUAAAAAAGTUUUAGGGTAAGTTGG<br>AAAARGRGTTUTTTAAGAUUAGATUAAGGTUTUTGUTXGTUATUAGGAAATATGAT<br>TTGTGUTAAUAUAGGUUTTURGTTAAAAAUUTUURGGGUAAGTTAGUTAAGGAUAG<br>UAGGTUTGAUUTATGAGTTAAUUAAAAUATTAUUTUATUTGUAAAGAAUTUUAAGA<br>AUUATTUAGATUUTGAGGTUU |
| 63 | GUUTGGAAUUURGGRGATUTUTTGTTTUTUUAUUAAGGGAAUTUTGUTTGTAAUAU<br>TTTAAGUUTUAGUTGAAAAGTGGTUTUUTGGGTGAAGTUTUAUUTGTGUAUUUAUU<br>TGAGGGTGAGTUAGUTUTGUTUUUUTGGUTUTUAURGXGGUTGTTATAGUATTTAU<br>RGGAGTUUUAUAGTGAUTUATTTGTUUATUAUUUTUURGAUAAAUUTTUUAGUTTU |

-continued

| SEQ ID NO: | Sequence |
|---|---|
| | TGAAGGGUAGAGAUAGUATUATAATUATUTTTTATAAUTUURGTGUUTAGTGUTAU<br>TUUUAATUUUTAGTAAGUAT |
| 64 | ATGUTTAUTAGGGATTGGGAGTAGUAUTAGGUARGGGAGTTATAAAAGATGATTAT<br>GATGUTGTUTUTGUUUTTUAGAAGUTGGAAGGTTTGTRGGGAGGGTGATGGAUAAA<br>TGAGTUAUTGTGGGAUTURGGTAAATGUTATAAUAGUXGRGGTGAGAGUUAGGGGA<br>GUAGAGUTGAUTUAUUUTUAGGTGGGTGUAUAGGTGAGAUTTUAUUUAGGAGAUU<br>AUTTTTUAGUTGAGGUTTAAAGTGTTAUAAGUAGAGTTUUUTTGGTGGAGAAAUAA<br>GAGATRGURGGGGTTUUAGGU |
| 65 | AATUUUTTUUURGGGATAGTUAARGAGGUTTTUAATTTAAAUTTGUATTTGAAGUTT<br>GUAGAGAUTUAUAUTGAUTTAUUUAGGUUUTAAUAUAUAGUAGUTGTUTUUATGG<br>TTGRGUUAGGTAGTGAAGGATAUAGGGUAGUAGGAAAXGAGTUURGGTTUTUAGGT<br>GGATUURGTGUTTUUAUUTUTGTTAGAGUUUAGGUUUTGAGGGUATAGGGUUAAAT<br>TGUUAUAGAGUTUUAGAGAAATUTGTUTUTUURGTUUUUUAUUUTAAGAUTGAGUT<br>GUTGGAGGAAAGAGGUUAGG |
| 66 | UUTGGUUTUTTTUUTUUAGUAGUTUAGTUTTAGGGTGGGGGARGGGAGAGAUAGAT<br>TTUTUTGGAGUTUTGTGGUAATTTGGUUUTATGUUUTUAGGGUUTGGGUTUTAAUA<br>GAGGTGGAAGUARGGGATUUAUUTGAGAAURGGGAUTXGTTTUUTGUTGUUUTGTA<br>TUUTTUAUTAUUTGGRGUAAUUATGGAGAUAGUTGUTGTGTGTTAGGGUUTGGGTA<br>AGTUAGTGTGAGTUTUTGUAAGUTTUAAATGUAAGTTTAAATTGAAAGUUTRGTTGA<br>UTATUURGGGGAAGGGATT |
| 67 | AGGAATGTTTAUTGAAGGAGTGAATGAAAUTATTGUATTAGATUAAGUUUAGGTGU<br>AGAGGAUTGGTTTUAUATAGAAAGUATRGATTTTGUUUTAUAGAAUUUTGAUTUUA<br>GTTTTUUAGUAGAUAAUUUTGGTGTGAAGAUAGAGGGGXGGGGAGGAAGGTAGGG<br>GUTGAUATTTUUUAGUUUUTUUUAGGURGGTGGGGAGUTGAATAGUTUAGTGAUTT<br>GTUUAGGAGUURGAGGTAAAUUAUAGAUTAAGAGUUAAGAGTUATGATTUAUTAU<br>TTGUATTTUTUUAGUUATGAUA |
| 68 | TGTUATGGUTGGAGAAATGUAAGTAGTGAATUATGAUTUTTGGUTUTTAGTUTGTGG<br>TTTAUUTRGGGUTUUTGGAUAAGTUAUTGAGUTATTUAGUTUUUUAURGGUUTGGG<br>AGGGGUTGGGAAATGTUAGUUUUTAUUTTUUTUUUXGUUUUTUTGTUTTUAUAUUA<br>GGGTTGTUTGUTGGAAAAUTGGAGTUAGGGTTUTGTAGGGUAAAATRGATGUTTTUT<br>ATGTGAAAUUAGTUUTUTGUAUUTGGGUTTGATUTAATGUAATAGTTTUATTUAUTU<br>UTTUAGTAAAUATTUUT |
| 69 | GUTGGGATTATATATGUAUAUUAUUATGUURGGUTAATTTTTATATTTTTGGTAGAG<br>ATAGGGGTTUUAUUATGTTGGUUAGGGTGGTUTTGAAUUUUTGAUUTUAGGTGATU<br>UAUUUAUUTTGGUUTUUUAGAGTGUTGGGATTAUAGGXGTGAGUUAUTGUAUURG<br>GUAUAAAGUUATTTTAAAAUAGUTTTTTTTTTTTTTTTGAAAUAGUUTTGUUUTGTA<br>GUUUAGGUTGGAGTGTAGTGGTAUAATUTUAGUTUAUTGUAAUUTUUAUUTTURGG<br>GTTUAAGTGATTUTTGTGU |
| 70 | GUAUAAGAATUAUTTGAAUURGGAAGGTGGAGGTTGUAGTGAGUTGAGATTGTAUU<br>AUTAUAUTUUAGUUTGGGUTAUAGGGUAAGGUTGTTTUAAAAAAAAAAAAAAAAGU<br>TGTTTTAAAATGGUTTTGTGURGGGTGUAGTGGUTUAXGUUTGTAATUUUAGUAUTU<br>TGGGAGGUUAAGGTGGGTGGATUAUUTGAGGTUAGGGGTTUAAGAUUAUUUTGGU<br>UAAUATGGTGGAAUUUUTATUTUTAUUAAAAATATAAAAATTAGURGGGUATGGTG<br>GTGTGUATATATAATUUUAGU |
| 71 | AAUAAATGUUAUAGGUUUTAATTGUAGGUTUUAAGGAGTTGAGATTUUATAUTGGG<br>GTTGUTGGAGGUAGAAGUUTTUUUAUTTTUAGGAUURGGAUUTGUUUTTUUUUUAR<br>GRGGTUURGUUUAGUUAGUTAUAUUUTGGUUAUAGAGXGUTUAUAAAGGUTUAGT<br>GTGTGTATGURGGGUTGAUTUAUAGTGGTTUTGGGUUUAGGRGAGGAUUTTUTUAG<br>AGGGGRGGAAGGGGUUUTUTUUUTUUTGGUUATTTTUUATGGGGAGUAGTUAGTAA<br>UUAGGAUUATGUUAGAUTTUA |
| 72 | TGAAGTUTGGUATGGTUUTGGTTAUTGAUTGUTUUUUATGGAAAATGGUUAGGAGG<br>GAGAGGGUUUUTTURGUUUUTUTGAGAAGGTUUTRGUUTGGGUUUAGAAUUAUTG<br>TGAGTUAGUURGGUATAUAUAUAUTGAGUUTTTGTGAGXGUTUTGTGGUUAGGGTG<br>TAGUTGGUTGGGRGGGAURGRGTGGGGGAAGGGUAGGTURGGGTUUTGAAAGTGG<br>GAAGGUTTUTGUUTUUAGUAAUUUUAGTATGGAATUTUAAUTUUTTGGAGUUTGUA<br>ATTAGGGUUTGTGGUATTTGTT |
| 73 | GUAGTGUTAUAAUATUAATGUUAAGGURGTGGGGUAGUTGATGGTTTGGGUTUUUA<br>AUTTUUUAGUUAGGTGUTTUTGUAGGUUUAUATUTTGUUUAUTGGUUAAAUUTTTA<br>AATAAUTTTGAUTRGGGUTAUTUTTATGUTUAAAGAXGTUAGGGGUTUTUUUAAAT<br>UTUTTTAUUUTGUUAGAAAGTUTTUTATAGTARGGUUTUUAUTTAGUTTTUARGUUT<br>GATUTTUUATRGUATUUTGUTUATAAUUTGUUAUTAGTGAAUUUUTGUTGUTURGG<br>UTUUAUAUTTUTUATGUTG |
| 74 | AGUATGAGAAGTGTGGAGURGGAGUAGUAGGGGTTUAUTAGTGGUAGGTTATGAG<br>UAGGATGRGATGGAAGATUAGGRGTGAAAGUTAAGTGGAGGURGTAUTATAGAAG |

-continued

| SEQ ID NO: | Sequence |
|---|---|
| | AUTTTUTGGUAGGGTAAAGAGATTTGGGAGAGUUUUTGAXGTUTTTGAGUATAAGA<br>GTAGUURGAGTUAAAGTTATTTAAAGGTTTGGUUAGTGGGUAAGATGTGGGUUTGU<br>AGAAGUAUUTGGUTGGGAAGTTGGGAGUUUAAAUUATUAGUTGUUUUARGGUUTT<br>GGUATTGATGTTGTAGUAUTGUU |
| 75 | AGGAGGGARGTGGAAGTRGTGGGTGGUAGAGAAAAGTGTGUAURGUTGGGAGGTU<br>TATTTUAAGAATAGGTTGGGATGAGAAAUATGTUTGGGRGAGGGGGGTGGGAGGUU<br>RGGTGTUAUUTGTGGATGGATUUAUAGUUUTGUAATTGXGTGTTGUAAAGTTTGUU<br>RGGUUURGUATTUATTTTGAAGGTTUTTGGRGATGUUTRGAUTTTTRGUUTUAAAGA<br>AGTGAGUTUTUATAAGGTTUAGAGGURGGGAGUUAAAGRGGGAGTGAAGAUTUTR<br>GAGGGGTUUAAATGAAGUAGA |
| 76 | TUTGUTTUATTTGGAUUUUTRGAGAGTUTTUAUTUURGUTTTGGUTUURGGUUTUTG<br>AAUUTTATGAGAGUTUAUTTUTTTGAGGRGAAAAGTRGAGGUATRGUUAAGAAUUT<br>TUAAAATGAATGRGGGGURGGGUAAAUTTTGUAAUAXGUAATTGUAGGGUTGTGGA<br>TUUATUUAUAGGTGAUAURGGGUUTUUUAUUUUUUTRGUUUAGAUATGTTTUTUAT<br>UUUAAUUTATTUTTGAAATAGAUUTUUUAGRGGTGUAUAUTTTTUTUTGUUAUUUA<br>RGAUTTUUARGTUUUTUUT |
| 77 | UUTTTTTGAUUTGGRGAGTUUUTTUUUTTTUUATTTUATTTTATTGUTTTTTATTGTTT<br>UUUTURGGUUTUTTUTUUUUTUUTAGGTUTTTTUTUTAGUTUAGTTTGGAGUTUAUA<br>TUUTTTUUAUUUTTTTUAUUTUUTUUTTUUTUXGUUUUAGGATTATUUUTGGGAUU<br>UATUUTGAGUTGAGUUTAUAGUUAGUUAGUUARGAAATAGAGGTGRGRGGGGGUA<br>GGGTGGTATGGAGATTUTGXGGUUTTTGATTTGAUAUUTUURGGAGUTAURGUUAU<br>AGGUUTGUUUATTTUAU |
| 78 | TGAAATGGGUAGGUUTGTGGRGGTAGUTURGGGAGGTGTUAAATUAAAGGUXGUA<br>GAATUTUUATAUUAUUUTGUUUURGRGUAUUTUTATTTRGTGGUTGGUTGGUTGTA<br>GGUTUAGUTUAGGATGGGTUUUAGGGATAATUUTGGGGXGGAGGAAGGAGGAGGT<br>GAAAAGGGTGGAAAGGATGTGAGUTUUAAAUTGAGUTAGAGAAAAGAUUTAGGAG<br>GGGAGAAGAGGURGGAGGGAAAUAATAAAAAGUAATAAAATGAAATGGAAAGGGA<br>AGGGAUTRGUUAGGTUAAAAAGGU |
| 79 | GUTUAGTTTGGAGUTUAUATUUTTTUUAUUUTTTTUAUUTUUTUUTTUUTUXGUUUU<br>AGGATTATUUUTGGGAUUUATUUTGAGUTGAGUUTAUAGUUAGUUAGUUARGAAA<br>TAGAGGTGRGRGGGGGUAGGGTGGTATGGAGATTUTGXGGUUTTTGATTTGAUAUU<br>TUURGGAGUTAUXGUUAUAGGUUTGUUUATTTUAUUTGURGGGAAGATAAUTTTGG<br>UTTUTGGTGGTGGGTGGGTGATTGAUTUTUAAAATUUAAAGUATTGGTTTITTUTGG<br>GTTAUTTUUTATGAUTGUT |
| 80 | AGUAGTUATAGGAAGTAAUUUAGAAAAAAUUAATGUTTTGGATTTTGAGAGTUAAT<br>UAUUUAUUUAUUAUUAGAAGUUAAAGTTATUTTUURGGUAGGTGAAATGGGUAGU<br>UUTGTGGXGGTAGUTURGGGAGGTGTUAAATUAAAGGUXGUAGAATUTUUATAUU<br>AUUUTGUUUURGRGUAUUTUTATTTRGTGGUTGGUTGGUTGTAGGUTUAGUTUAGG<br>ATGGGTUUUAGGGATAATUUTGGGGXGGAGGAAGGAGGAGGTGAAAAGGGTGGAA<br>AGGATGTGAGUTUUAAAUTGAGU |
| 81 | UATTUUAAUTTUTGUAAUUATGUAUAGTGATRGATATTTATAATTAUUTTTTTUUTT<br>UAUUATGGUAAURGGGTUUTURGARGAGUAGGAUTGAAGAAGGAARGAGGAATAA<br>AUTUTGGGAGTGGAAGRGRGUUTRGGUAGAUAGATURGXGGGRGUTGGGGUAGUU<br>AGGAGAAGUUURGGUATURGUTTGTGAGGTURGGGGUTGTGGTUTRGAGTUURGUU<br>URGUUTRGGRGGGUUURGUTUUUATGUURGUUURGUTATRGUUUURGRGUTUTTUT<br>URGUURGUURGURGAGUTGUA |
| 82 | TGUAGUTRGGRGGGRGGGRGGAGAAGAGRGRGGGGGRGATAGRGGGGRGGGUATG<br>GGAGRGGGGUURGURGAGGRGGGGRGGGAUTRGAGAUUAUAGUUURGGAUUTUAU<br>AAGRGGATGURGGGGUTTUTUUTGGUTGUUUUAGRGUUXGRGGATUTGTUTGURGA<br>GGRGRGUTTUUAUTUUUAGAGTTTATTUUTRGTTUUTTUTTUAGTUUTGUTRGTRGG<br>AGGAUURGGTTGUUATGGTGAAGGAAAAAGGTAATTATAAATATRGATUAUTGTGU<br>ATGGTTGUAGAAGTTGGAATG |
| 83 | TATGATGUUAGTGGTTGAATAUUTTAGTAGAGAAAAATUTTGAATAATUAAUKUUA<br>GGTTUAGGAGAUAGUTGGGTATTTGAGAGUUTATGAGTUAUATAAGUAAUUTTGGA<br>GUUAAGTTGTATTUTUTGTTTGGUUTUAGAGUUAGTUTXGAGUAUATGUAGUUAGA<br>UTGURGGUAGAGAAGATGTGGAGUTGGUATTUTGGUTTAGGUUTGAGUAAGGTRGT<br>GGAAGUUUUAGGTTUUTGAUUATGGUURGUAUAGAGUUATGUTUUAGUUUTGGGT<br>UTUAGUAGGUAGUUAGGTGAG |
| 84 | UTUAUUTGGUTGUUTGUTGAGAUUUAGGGUTGGAGUATGGUTUTGTGRGGGUUATG<br>GTUAGGAAUUTGGGGUTTUUARGAUUTTGUTUAGGUUTAAGUUAGAATGUUAGUT<br>UUAUATUTTUTUTGURGGUAGTLTTGGUTGUATGTGUTXGAGAUTGGUTUTGAGGUU<br>AAAUAGAGAATAUAAUTTGGUTUUAAGGTTGUTTATGTGAUTUATAGGUTUTUAAA<br>TAUUUAGUTGTUTUUTGAAUUTURGGTTGATTATTUAAGATTTTUTUTAUTAAGGT<br>ATTUAAUUAUTGGUATUATA |

-continued

| SEQ ID NO: | Sequence |
|---|---|
| 85 | GGGGUTRGUAGTGGUUTAGTUTGUTUTGGGUTTTGUTGGATGUUUTTRGAGAATUA<br>URGRGUAAUUTUUTTUAGAGGUUUAAUAUTUUARGTGUTGAUTTUURGGGUUTGTG<br>TUTUUUUTGURGUAGAUTGAAGXGTTUURGGUTGAAGGTGAGGTTUTGUAUUAAXG<br>AGTRGUAGAAGTUURGGGUAGAGUTGGTGGGGUAGUTTUAGAGGUTGGGATTTGAU<br>ATUTUTGAGUAGGAGGTGAURGUUURGGUAUUAGUTGUUTGUUAGATUUTGAAGG<br>AGUAAGGUUTGRGAUUATAUU |
| 86 | GGTATGGTRGUAGGUUTTGUTUUTTUAGGATUTGGUAGUUAGUTUUUUKUUUUKU<br>GTUAUUTUUTGUTUAGAGATGTUAAATUUUAGUUTUTGAAGUTGUUUUAUUAGUTU<br>TGUURGGGAUTTUTGRGAUTXGTTGGTGUAGAAUUTUAUUTTUAGURGGGAAXGUT<br>TUAGTUTGRGGUAGGGGAGAUAUAGGUURGGGAAGTUAGUARGTGGAGTGTTGGG<br>UUTUTGAAGGAGGTTGRGRGGTGATTUTRGAAGGGUATUUAGUAAAGUUUAGAGU<br>AGAUTAGGUUAUTGRGAGUUUU |
| 87 | GRGGGGUUAGUAGRGTGUURGGRGGGAAGRGGTAUAGGRGUTURGGGAAGURGRG<br>UAUUAGUTGUTTUAGUAUUATGURGUTUAGGTRGGURGTGUTUTUUTGRGARGGGT<br>TGAAGATGRGGARGAAUTTUTUURGGUAGUTUAUAGUUAXGATUTTUAGGUUTGTR<br>GGGUTGGGAAGAGAGGAGARGUTGTGAGGAGATGRGGURGGTUUAUURGUAUAGU<br>TGRGRGUUURGUURGGAAAUUAGUTUUAGTURGGRGURGGAGGUTTGGGTUAUTRC<br>UUUUTTAUUTUTGUAGGAGTTU |
| 88 | GAAUTUUTGUAGAGGTAAGGGGRGAGTGAUUUAAGUUTURGGRGURGGAUTGGAG<br>UTGGTTTURGGGRGGGGRGRGUAGUTGTGRGGGTGGAURGGURGUATUTUUTUAUA<br>GRGTUTUUTUTUTTUUUAGUURGAUAGGUUTGAAGATXGTGGUTGTGAGUTGURGG<br>GAGAAGTTRGTURGUATUTTUAAUURGTRGUAGGAGAGUARGGURGAUUTGAGRGG<br>UATGGTGUTGAAGUAGUTGGTGRGRGGUTTUURGGAGRGUUTGTAURGUTTUURGU<br>RGGGUARGUTGUTGGUUURGU |
| 89 | AGGAGTGTTTGGGGTGUTTUUTUTTGGUTGUAGTGGGAUAUAGGTGTGUUTTUUTA<br>GGAAUTGGGUUUTGAUTAUTTUUAGUUUAAUAUTUURGGGUUTGTGAAUTGTGAU<br>UTGTGTGURGGGATGGGTTTTGTGGGTUTGUUUUATUUUXGUAUTGUTGGATUTGG<br>UUAAGTGGGTGAAGGUTAAGGURGGTUAGAGTTGAGTTTUTGUUTTGTUUUUTUTU<br>UTGGGUTAGATGUUAUAUUAGGUUUAGTGAUTUATAGGGUAGGUAGTTGGGAAAT<br>AUUAGGUAGAGGGUAGGTUUTG |
| 90 | UAGGAUUTGUUUTUTGUUTGGTATTTUUUAAUTGUUTGUUUTATGAGTUAUTGGGU<br>UTGGTGTGGUATUTAGUUUAGGAGAGGGGAUAAGGUAGAAAUTUAAUTUTGAURG<br>GUUTTAGUUTTUAUUUAUTTGGUUAGATUUAGUAGTGXGGGGATGGGGUAGAUUU<br>AUAAAAUUUATUURGGUAUAUAGGTUAUAGTTUAUAGGUURGGGAGTGTTGGGUT<br>GGAAGTAGTUAGGGUUUAGTTUUTAGGAAGGUAUAUUTGTGTUUUAUTGUAGUUA<br>AGAGGAAGUAUUUUAAAUAUTUUT |
| 91 | GUAGGAATUAGGUUAGRGTATGTAATGAAAAUTUTTGRGTTATUTTTTTAGAAGGAT<br>GTGAUTGTATTTTATGAGTATGUAGUAGGGTUAUUAUAUAUUTTTTGUTUUTGGGU<br>UUUTUUUUTGTGTGTAGUUUAGGUUURGGTTTGTGUTXGAGGGUUAGAXGGUUUTA<br>TGGTUUUUAGTTTUUTURGTAGATUAUAUAGGGAGGUAGRGAGGUAGGGTGUAAG<br>GATGTTAGGGGTGGAAGGGGTGAUAURGGGAGUAAAGAUTGUTAUUUUTTGGUUT<br>GGATAAAUUTGTUTGAUATTU |
| 92 | GAATGTUAGAUAGGTTTATUUAGGUUAAGGGGTAGUAGTUTTTGUTUURGGTGTUA<br>UUUUTTUUAUUUUTAAUATUUTTGUAUUUTGUUTRGUTGUUTUUUTGTGTGATUTA<br>RGGAGGAAAUTGGGGAUUATAGGGURGTUTGGUUUTXGAGUAUAAAUXGGGGUUT<br>GGGUTAUAUAUAGGGGAGGGGUUUAGGAGUAAAAGGTGTGTGGTGAUUUTGUTGU<br>ATAUTUATAAAATAUAGTUAUATUUTTUTAAAAAGATAARGUAAGAGTTTTUATTA<br>UATARGUTGGUUTGATTUUTGU |
| 93 | TGAUTGTATTTTATGAGTATGUAGUAGGGTUAUUAUAUAUUTTTTGUTUUTGGGUU<br>UUTUUUUTGTGTGTAGUUUAGGUUURGGTTTGTGUTRGAGGGUUAGARGGUUUTAT<br>GGTUUUUAGTTTUUTURGTAGATUAUAUAGGGAGGUAGXGAGGUAGGGTGUAAGG<br>ATGTTAGGGGTGGAAGGGGTGAUAURGGGAGUAAAGAUTGUTAUUUUTTGGUUTG<br>GATAAAUUTGTUTGAUATTUURGAUUTUTGAAGTUATUUATUATGGUTGRGUTGGU<br>TUAGAUAUTTUAAGGGUUAUTTT |
| 94 | AAAGTGGUUUTTGAAGTGTUTGAGUUAGRGUAGUUATGATGGATGAUTTUAGAGGT<br>RGGGAATGTUAGAUAGGTTTATUUAGGUUAAGGGGTAGUAGTUTTTGUTUURGGTG<br>TUAUUUUTTUUAUUUUTAAUATUUTTGUAUUUTGUUTXGUTGUUTUUUTGTGTGAT<br>UTARGGAGGAAAUTGGGGAUUATAGGGURGTUTGGUUUTRGAGUAUAAAURGGGG<br>UUTGGGUTAUAUAUAGGGGAGGGGUUUAGGAGUAAAAGGTGTGTGGTGAUUUTGU<br>TGUATAUTUATAAAATAUAGTUA |
| 95 | UAUAUAUUTTTUAGTTGAGGGGRGUTGAGGTUUUTGUTGTTGUTGTGURGTUTGAU<br>UTGTUUUUTUTUTUTGAUAGAGAGUUAGUTGUTUUURGGGAAUAAUTTUAUUAATG<br>AGTGUAAUATAUUAGGUAAUTTUATGTGUAGUAATGGAXGGTGUATUURGGGRGU |

-continued

| SEQ ID NO: | Sequence |
|---|---|
| | UTGGUAGTGTGARGGGUTGUUTGAUTGUTTRGAUAAGAGTGATGAGAAGGAGTGUR<br>GTGAGTGGUUTGGUUUTTTGUTGGGGTGGGGTGGUAGUUATUUTGGGGUAGAGGGG<br>AGUAGGTUUTGAGUAGGUTTA |
| 96 | TAAGUUTGUTUAGGAUUTGUTUUUUTUTGUUUUAGGATGGUTGUUAUUUUAUUUU<br>AGUAAAGGGUUAGGUUAUTUARGGUAUTUUTTUTUATUAUTUTTGTRGAAGUAGTU<br>AGGUAGUURGTUAUAUTGUUAGGRGUURGGGATGUAUXGTUUATTGUTGUAUATG<br>AAGTTUUTGGTATGTTGUAUTUATTGGTGAAGTTGTTUURGGGGAGUAGUTGGUTU<br>TUTGTUAGAGAGAGGGGAUAGGTUAGARGGUAUAGUAAUAGUAGGGAUUTUAGRG<br>UUUUTUAAUTGAAAGGTGTGTG |
| 97 | UATGUATTTTGTGTTTGTAGTGTGUTGGUUARGGGAGUAUTUTAAAUAUATTATGGG<br>URGGGRGUAGTGGUTURGGUUTGTAATUTUAGUAUTTTGGGAGGUTGAGGRGGGUA<br>GATUAUTTGAGUUUAGGAGTTXGAUAUUAGUUTGGUUAAUAXGGXGAAAUUUXGT<br>UTUTAUTAAAAATAUAAAAATTAAURGGGTGTGATGGRGRGTGUUTGTATTUUUAG<br>UTAUTAGGGAGGUTGAGGUAGGAGAATUTUUTGAAUUTGGGAGGUAGGGAUTGUA<br>GTGAGUUAAGATTGTGUUAUT |
| 98 | AGTGGUAUAATUTTGGTUAUTGUAGTUUUTGUUTUUUAGGTUAGGAGATTUTUU<br>TGUUTUAGUUTUUUTAGTAGUTGGGAATAUAGGUARGRGUUATUAUAUURGGTTAA<br>TTTTTGTATTTTTAGTAGAGAXGGGTTTXGUXGTGTTGGUUAGGUTGGTGTXGAAU<br>TUUTGGGUTUAAGTGATUTGUURGUUTUAGUUTUUUAAAGTGUTGAGATTAUAGGU<br>RGGAGUUAUTGRGUURGGUUUATAATGTGTTTAGAGTGUTUURGTGGUUAGUAUAU<br>TAUAAAUAUAAAATGUATG |
| 99 | GGAUTGTGGGUUUUTTGGTTTGTGTUTGAAAGUTGGGGGTAUAGTTUTGUATGGGTT<br>GGUUUUTGUUTTAUUTRGGGAAGUTUUUAGAGUUTGUTGGGUAGUUTGUUTUUTU<br>UTUTUAUUTUUTUXGTUTUUAUTUUUTUUTUAUUAUATTURGGUTUTUUUARGGUR<br>GGAGGUXGTGAATGGGUTGUTTTGTTGUURGGUUUAUAUAGGAGGATGGTGGUAG<br>AAGAUUURGGUAUAAAGTUAGUAUUUAUTUTGTTUUUAGGUTGGGTTUAGGGAGG<br>UTGAAAAGUUAUTTUAGUTGTG |
| 100 | UAUAGUTGAAGTGGUTTTTUAGUUTUUUTGAAUUUAGUUTGGGAAUAGAGTGGGTG<br>UTGAUTTTGTGURGGGGTUTTUTGUUAUUATUUTUUTGTGTGGGURGGGUAAUAAA<br>GUAGUUUATTUARGGUUTURGGURGTGGGAGAGURGGAATGTGGTGAGGAGGGAG<br>TGGAGARGGAGGAGGTGAGAGGAGGAGGUAGGUTGUUUAGUAGGUTUTGGGAGUT<br>TUURGAGGTAAGGUAGGGGUUAAUUUATGUAGAAUTGTAUUUUUAGUTTTUAGAU<br>AUAAAUUAAGGGGUUUAUAGTUU |
| 101 | TAUTUTUTTGATGTATGAUUTTGGATGTGATTTAGUUTUTUTGGGUUTTGGUUUKUU<br>TGAAUUATGTGATUAGAGUAUUAAGURGGUUTUUUARGUTGGTUTGAGUTGUTUAA<br>GGGUUATUTAGGTUUTUTTTGTUUUAAGUUAGAGGTXGUUTUTUUURGGUUAAGUR<br>GRGGUTATGGGGGTGGTGGTAUAAUAGAGAGUAUAGGGAUTTTGGAAUAUAAUAU<br>TGGGTUATGAUUUUTGUUTGGUUAUTUTTGGUTGUTGAUUTTGAUUUTUTGTUTUU<br>TUUTTTGTGAATGGGGGGAGT |
| 102 | AUTUUUUUUATTUAUAAAGGAGGAGAUAGAGGGTUAAGGTUAGUAGUUAAGAGTG<br>GUUAGGUAGGGGTUATGAUUUAGTGTTGTGTTUUAAAGTUUUTGTGUTUTUTGTTG<br>TAUUAUUAUUUUUATAGURGRGGUTTGGURGGGGAGAGGXGAUUTUTGGUTTGGG<br>AUAAAGAGGAUUTAGATGGUUUTTGAGUAGUTUAGAUUAGRGTGGGAGGURGGUT<br>TGGTGUTUTGATUAUATGGTTUAGRGGGGUUAAGGUUUAGAGAGGUTAAATUAUAT<br>UUAAGGTUATAUATUAAGAGAGTA |
| 103 | GUUATGGAGAAAATATGUUATGTUTUUATGGAAAUUAAUUTATTTGUTTAAUTGAGGTTUTG<br>GGGGTGGTTUTGAUAUTUAGTGUTAAUUAGGGGGAGTUTGGUTGTGAGGTRGTUAGUAUATG<br>GRGGTGUTGURGGUTGUUTUUUAXGUAXGUAGGUTUTGUUAGUUTGUUTTGUUAATUTGUU<br>AGGUAAUTGGGAUAGGTGUAGAUATGAUUUAGGUTUUAAGUAUARGUATUUAUUUTUUUR<br>GURGAGGUAUTUTUURGGTGUUATATGTTGAUTUTGUUUAGRGUUAGGUAGUUUA |
| 104 | TGGGUTGUUTGGRGUTGGGUAGAGTUAAUATATGGUAURGGGAGAGTGUUTRGGRGGGGAG<br>GGTGGATGRGTGTGUTTGGAGUUTGGGTUATGTUTGUAUUTGTUUUAGTTGUUTGGUAGATT<br>GGUAAGGUAGGUTGGUAGAGUUTGXGTGXGTGGGAGGUAGURGGUAGUAURGUUATGTGUT<br>GARGAUUTUAUAGUUAGAUTUUUUUTGGTTAGUAUTGAGTGTUAGAAUUAUUUUUAGAAUU<br>TUAGTTAAGUAAATAGGTTGGTTTUUATGGAGAUATGGUATATTTTUTUUATGGU |
| 105 | GAGTUTGGUTGTGAGGTRGTUAGUAUATGGRGGTGUTGURGGUTGUUTUUUARGUA<br>RGUAGGUTUTGUUAGUUTGUUTTGUUAATUTGUUAGGUAAUTGGGAUAGGTGUAG<br>AUATGAUUUAGGUTUUAAGUAUARGUATUUAUUUTUUUXGURGAGGUAUTUTUUR<br>GGTGUUATATGTTGAUTUTGUUUAGRGUUAGGUAGUUUAGRGUUUAUUTUUUUUT<br>UUUUAGUUTGGUUUUARGUAUAGTGUTUTAGUUTUTGUTGGGTAGTGTGAGGAGTG<br>GUAATUTGUAGGUAUUUTAGAAG |
| 106 | UTTUTAGGGTGUUTGUAGATTGUUAUTUUTUAUAUTAUUUAGUAGAGGUTAGAGUA<br>UTGTGRGTGGGGUUAGGUTGGGGAGGGGGAGGTGGGRGUTGGGUTGUUTGGRGUT<br>GGGUAGAGTUAAUATATGGUAURGGGAGAGTGUUTRGGXGGGGAGGGTGGATGRG |

-continued

| SEQ ID NO: | Sequence |
|---|---|
| | TGTGUTTGGAGUUTGGGTUATGTUTGUAUUTGTUUUAGTTGUUTGGUAGATTGGUA<br>AGGUAGGUTGGUAGAGUUTGRGTGRGTGGGAGGUAGURGGUAGUAURGUUATGTG<br>UTGARGAUUTUAUAGUUAGAUTU |
| 107 | GURGAATUURGAGGGURGAGUAUUUUTUUUTUAGURGUAUTGUAUUTGUURGTAG<br>GTGAUUAAUUUARGGGRGGAUUUUUAGAUUUAATUUTUTUUAGAGUUAGGGTGGG<br>ATGGGUAGGGAUAGGAGURGGAGGUUUTAUTGGUUURGGGXGAAGGUATUUTGGA<br>AAGUATUUAGAGRGTUUAGUATUUUTUURGRGGUUAUURGUAGGUTGAURGAUUU<br>UTGGGUAGAUUUTUAGAUTUAATUUAGTUUAGGGRGGATTAAGGAGTGGGAGAUA<br>AGGGAGURGGTGGUUURGUTGGUUU |
| 108 | GGGUUAGRGGGGUUAURGGUTUUUTTGTUTUUUAUTUUTTAATURGUUUTGGAUTG<br>GATTGAGTUTGAGGGTUTGUUUAGGGGTRGGTUAGUUTGRGGGTGGURGRGGGAGG<br>GATGUTGGARGUTUTGGATGUTTTUUAGGATGUUTTXGUURGGGGUUAGTAGGGUU<br>TURGGUTUUTGTUUUTGUUUATUUUAUUUTGGUTUTGGAGAGGATTGGGTUTGGGG<br>GTURGUURGTGGGTTGGTUAUUTARGGGUAGGTGUAGTGRGGUTGAGGGAGGGGTG<br>UTRGGUUUTRGGGATTRGGU |
| 109 | TTGUTTGAUUAAAAGAATGUAGUAGAUATAAUTTTGAGAUUTGGAGUTAGGTUAUA<br>AGARGATTTUUTGGGTTTTGTGGAATTUTRGTTUTGAAAGAAAUAAGUUAUUAAGT<br>GGURGGGTGAGUTGGUTUAXGUUTGTAATUUUAGUAUTTTGGGAGGUXGAGURGG<br>GUXGATUAUAAGGTUAGGAGATRGAGAUUATUUTGGUTAAUATGGTGAAAUUURG<br>TUTUTAUTAAAAATAUAAAAAAATTAGURGGGUATAUTGGRGGGRGUUTGTAGTUU<br>UAGUTAUTRGGGAGGUTGAGGU |
| 110 | GUUTUAGUUTUURGAGTAGUTGGGAUTAUAGGRGUURGUUAGTATGUURGGUTAAT<br>TTTTTTGTATTTTTAGTAGAGARGGGGTTTUAUUATGTTAGUUAGGATGGTUTRGATU<br>TUUTGAUUTTGTGATXGGUURGGUTXGGUUTUUUAAAGTGUTGGGATTAUAGGXGT<br>GAGUUAGUTUAUURGGUUAUTTGGTGGUTTGTTTUTTTUAGAARGAGAATTUUAUA<br>AAAUUUAGGAAATRGTUTTGTGAUUTAGUTUUAGGTUTUAAAGTTATGTUTGUTGU<br>ATTUTTTTGGTUAAGUAA |
| 111 | AGAATUTGUUTAGUAGGRGGUTUTUUUUTGUTUUUUUAURGAGUAUAUAUKUIUU<br>GAGGGGAUUUTGRGGGAGGAGGUTGUTTUAGTUTUUAGAGAUUATUTUUUATUTUT<br>AUAGRGAUTUUUUTATGAURGTUUUUUAUURGGTGUTUTXGGGUUARGGGGAAGG<br>GAUAUTRGGGAAAGAUAUUAGAGAURGGGAGGGTGUAGUTGGGUTUTTRGRGGGG<br>AGRGGGRGGGAGGUUTTUUTGTTAUATGTRGUAGUTGGGAUAUAGARGGUAGRGUT<br>UUAGGGTUUAUTTGURGGUTTRG |
| 112 | RGAAGURGGUAAGTGGAUUUTGGAGRGUTGURGTUTGTGTUUUAGUTGRGAUATGT<br>AAUAGGAAGGUUTUURGUURGUTUUURGRGAAGAGUUUAGUTGUAUUUTUURGGT<br>UTUTGGTGTUTTTUURGAGTGTUUUTTUUURGTGGUUXGAGAGUAURGGGTGGGGG<br>ARGGTUATAGGGGAGTRGUTGTAGAGATGGGAGATGGTUTUTGGAGAUTGAAGUAG<br>UUTUUTUURGUAGGGTUUUUTUUUARGGTUTGTGUTRGGTGGGGGAGUAGGGGAG<br>AGURGUUTGUTAGGUAGATTUT |
| 113 | AGGUUUAGGUAGAGGTUAGAGUUUAAGUUUTGTUUURGAAGGAAATGTGTUUUAT<br>GUTAAUTAUTUUATAGUTGAGGUUTGGAGGGAAGTUAGGGAUUUTGGGAUTGGTTA<br>TUUTGGUUTTGAUTUATTAUTGTTURGGAGAUUTAAAXGUAUUUTGAGUUAUUAGA<br>XGTGGGTGTTAAUAUUTGAGGTUAAUUUUUTGAXGUTTURGGUTGUTUTGGAGGAA<br>GUTGGTUUTUUUTUUUAUUTUUTGTTTTURGTGUUAGUUTGGTAUAGAGTUAAGGG<br>GUTTGGUTGGGUTTGGUTGGG |
| 114 | UUAGUUAAGUUUAGUUAAGUUUUTTGAUTUTGTAUUAGGUTGGUARGGAAAAUAG<br>GAGGTGGGAGGGAGGAUUAGUTTUUTUUAGAGUAGURGGAAGXGTUAGGGGGTTG<br>AUUTUAGGTGTTAAUAUUUAXGTUTGGTGGUTUAGGGTGXGTTTAGGTUTURGGAA<br>UAGTAATGAGTUAAGGUUAGGATAAUUAGTUUUAGGGTUUUTGAUTTUUUTUUAG<br>GUUTUAGUTATGGAGTAGTTAGUATGGGAUAUATTTUUTTRGGGGAUAGGGUTTGG<br>GUTUTGAUUTUTGUUTGGGUUTG |
| 115 | UUUATGUTAAUTAUTUUATAGUTGAGGUUTGGAGGGAAGTUAGGGAUUUTGGGAU<br>TGGTTATUUTGGUUTTGAUTUATTAUTGTTURGGAGAUUTAAAXGUAUUUTGAGUU<br>AUUAGAXGTGGGTGTTAAUAUUTGAGGTUAAUUUUUTGAXGUTTURGGUTGUTUTG<br>GAGGAAGUTGGTUUTUUUTUUUAUUTUUTGTTTTURGTGUUAGUUTGGTAUAGAGT<br>UAAGGGGUTTGGUTGGGUTTGGUTGGGUTUAGAAARGTGGUAGTUAGGAGUUAGU<br>UTGRGGGUAGRGGGGTGUTGGG |
| 116 | UUUAGUAUUURGUTGUURGUAGGUTGGUTUUTUAUTGUUARGTTTUTGAGUUUAG<br>UUAAGUUUAGUUAAGUUUUTTGAUTUTGTAUUAGGUTGGUARGGAAAAUAGGAGG<br>TGGGAGGGAGGAUUAGUTTUUTUUAGAGUAGURGGAAGXGTUAGGGGGTTGAUUT<br>UAGGTGTTAAUAUUUAXGTUTGGTGGUTUAGGGTGXGTTTAGGTUTURGGAAUAGT<br>AATGAGTUAAGGUUAGGATAAUUAGTUUUAGGGTUUUTGAUTTUUUTUUAGGUUT<br>UAGUTATGGAGTAGTTAGUATGGG |

-continued

| SEQ ID NO: | Sequence |
|---|---|
| 117 | UTUTUUURGUAGTTTUATURGTUUTUUTUUURGUUTUTGRGAGUTGGGTTTGGGGAR<br>GTUTGGGTGGAATGTAGAUUUAUAGGUTGTUUTTGGTGUUUTUUUTUUUTGTTUTU<br>UAGRGUUUUAGUUUUAGAUAUUAGTUUUUUAGRGGGXGAAAGUURGGGAGRGUU<br>TTUUURGAAAGAUATUAGGGTGUUARGRGGUUUUTGUUUTGUAGAAGUATUUUUU<br>TUURGUUUUTGUUTGGAAAGUAGGUUUUTUUUTAAGUTUTGRGUUUTTUTTUUUTG<br>GGRGUUUTRGGAURGTGGUURG |
| 118 | RGGGUUARGGTURGAGGGRGUUUAGGGAAGAAGGGRGUAGAGUTTAGGGAGGGGU<br>UTGUTTTUUAGGUAGGGGRGGGAGGGGGATGUTTUTGUAGGGUAGGGGURGRGTG<br>GUAUUUTGATGTUTTTRGGGGAAGGRGUTUURGGGUTTTXGUURGUTGGGGGAUTG<br>GTGTUTGGGGUTGGGGRGUTGGAGAAUAGGGAGGAAGGGUAUUAAGGAUAGUUTG<br>TGGGTUTAUATTUUAUUUAGARGTUUUUAAAUUUAGUTRGUAGAGGRGGGGAGGA<br>GGARGGATGAAAUTGRGGGGAGAG |
| 119 | AGAGGAGTGGGGAGRGUAGUAGGGTGGUUUURGUTUURGUTUAGAGGAGUTGGUU<br>UTTTAAGGUUAGGUUUAGGRGGGTRGGGAAUAGAGAUURGGGAATGTGGGUTGGA<br>UTGGGGAGUAGAGUUAUUUAGUATGAGTUATTUURGTTTXGURGGAUTUTTRGURG<br>UTGGUTUTRGUTTGURGUUUTUUUUTGGUUUTGGUUUTGGUUTUTGRGUUUTUUUT<br>GUAGAGUTGGTURGGGTGGGUTGGRGGUUTUUAUURGUUAUAAGRGUAUAGGGUT<br>UTGUUUAUTUUURGUUUUTTTTU |
| 120 | GAAAAGGGGRGGGGAGTGGGUAGAGUUUTGTGRGUTTGTGGRGGGTGGAGGURGU<br>UAGUUUAUURGGAUUAGUTUTGUAGGGAGGGRGUAGAGGUUAGGGUUAGGGUUA<br>GGGGAGGGRGGUAAGRGAGAGUUAGRGGRGAAGAGTURGGXGAAARGGGAATGAU<br>TUATGUTGGGTGGUTUTGUTUUUUAGTUUAGUUUAUATTUURGGGTUTUTGTTUUR<br>GAUURGUUTGGGUUTGGUUTTAAAGGGUUAGUTUUTUTGAGRGGGAGRGGGGGUU<br>AUUUTGUTGRGUTUUUUAUTUUTUT |
| 121 | GURGAGRGRGGTGGUTUATGUUTGTAATUUUAGUAUTTTGGGAGARGGAGGTGGGT<br>GGATUAUUTUAGGTUAGAAGTTTGAGAUUTUTGTUTUTAUTGAAAUTATAAAAAAT<br>TGGURGGGUATGGTGGTGGGTGTUTGTAGTTUUAGUTAXGTGGTAAGUTGAGGUAG<br>GAGAATGAUTTGAAUURGGGAGGRGGAGGTTGUAGTGAGUUAGGATTGRGUUAUT<br>GUAUTUUAGUUTGGGAGAUAGAGTUAGAUTUTGTUTUAAAAAAAAGUTATGGGUU<br>TGUAGGATGUUTAATATAAAAG |
| 122 | UTTTTATATTAGGUATUUTGUAGGUUUATAGUTTTTTTTTGAGAUAGAGTUTGAUTU<br>TGTUTUUUAGGUTGGAGTGUAGTGGRGUAATUUTGGUTUAUTGUAAUUTURGUUTU<br>URGGGTTUAAGTUATTUTUUTGUUTUAGUTTAUUAXGTAGUTGGAAUTAUAGAUAU<br>UUAUUAUUATGUURGGUUAATTTTTTATAGTTTUAGTAGAGAUAGAGGTUTUAAAU<br>TTUTGAUUTGAGGTGATUUAUUUAUUTURGTUTUUUAAAGTGUTGGGATTAUAGGU<br>ATGAGUUAURGRGUTRGGU |
| 123 | UARGUTUUTGTTTUAUTTTUATGTTUTGUTUTGTAUAUUTGGUTURGUUTTUTAGAT<br>AGUAATAGUAGAATTAGTGAAAGTATTAAAGTUTTTGATUTTTUTGAGAAGAGUAT<br>AGAAGAAATAATGARGTAAGUTGTUUTUTUTUUAGUTXGGUTAUUTAAAAGGGAAA<br>GGUUUUUTGTURGGTGGAUARGTGAUTUAUATGAUUTTATTAATUAUTGGAGATGA<br>UTUAUAUTUUTTAUUUTGUUUUTTTGUUTTGTAUAUAATAAATAAUAGRGRGAUUA<br>GGUATTRGGGGUUAUTGUU |
| 124 | GGUAGTGGUUURGAATGUUTGGTRGRGUTGTTATTTATTGTGTAUAAGGUAAAGGG<br>GUAGGGTAAGGAGTGTGAGTUATUTUUAGTGATTAATAAGGTUATGTGAGTUARGT<br>GTUUAURGGAUAGGGGGUUTTTUUUTTTTAGGTAGUXGAGUTGGAGAGAGGAUAG<br>UTTARGTUATTATTTUTTUTATGUTUTTUTUAGAAAGATUAAAGAUTTTAATAUTTTU<br>AUTAATTUTGUTATTGUTATUTAGAAGGRGGAGUUAGGTGTAUAGAGUAGAAUATG<br>AAAGTGAAAUAGGAGRGTG |
| 125 | AGUUUUUTGGGRGGGGTURGGGGAGUAGGUURGUATTTGGAGGAUAGGGTGTGAU<br>UUATUTGAATUUTRGTTAAAGTAAAAGURGAURGARGGUTUTGGGAGGTTTGAGGU<br>UTGGRGGGGRGGUUURGGGAAGTGATTTGTGGUXGUTAGGXGRGXGUTGGAAAUU<br>UTTTUUUATUTGRGGAGUUUAURGGAGUTGTGATRGGAGGAGGAATTUUUUUAGGU<br>AGGGAGGAURGUAGGGUUTTTTTUAUTRGTUUTGAGGGGUUUTGGGGUTTGGGGAG<br>UAAAUUTGGGGTGAUUUATTTU |
| 126 | GAAATGGGTUAUUUUAGGTTTGUTUUUUAAGUUUUAGGGUUUUTUAGGARGAGTG<br>AAAAAGGUUUTGRGGTUUTUUUTGUUGGGGGAATTUUTUUTURGATUAUAGUTUR<br>GGTGGGUTURGUAGATGGGAAAGGGTTTUUAGXGRGXGUUTAGXGGUUAUAAATU<br>AUTTUURGGGGURGUUURGUUAGGUUTUAAAUUTUUUAGAGURGTRGGTRGGUTTT<br>TAUTTTAARGAGGATTUAGATGGGTUAUAUUUTGTUUTUUAAATGRGGGUUTGUTU<br>UURGGAUUURGUUUAGGGGGUT |
| 127 | UATUUAUAAAUUTUUUAGGUUUUUTUAUTUTTUURGUAUAGTUTGUUTURGGTGUT<br>UUAGAAAGAUTGGAAATGAGGTGAGUTUUUTTGGATUUUTGUUTGUUAUUTGUAA<br>ATATUATGTGGTGUTAUTTGUUUTUUTGTUUUTUUTUUXGTUUUAGGUUAATUUTU<br>UUAUUUUUTTAATTGUURGGGGATUTUUATTAUTTAAAUUTTTUUAUTGGTAUUTUT |

-continued

| SEQ ID NO: | Sequence |
|---|---|
| | UUTUUUAUAUAAGUUTUUTUAGUTGTTTTURGTUTTTAAUUAAUAUUTTUUUTGGU<br>TUUAGUTAUTGUUAUTTUAT |
| 128 | ATGAAGTGGUAGTAGUTGGAGUUAGGGAAGGTGTTGGTTAAAGARGGAAAAUAGU<br>TGAGGAGGUTTGTGTGGGAGGAGAGGTAUUAGTGGAAAGGTTTAAGTAATGGAGAT<br>UUURGGGUAATTAAGGGGGTGGGAGGATTGGUUTGGGAXGGGAGGAGGGAUAGGA<br>GGGUAAGTAGUAUUAUATGATATTTGUAGGTGGUAGGUAGGGATUUAAGGGAGUT<br>UAUUTUATTTUUAGTUTTTUTGGAGUAURGGAGGUAGAUTGTGRGGGAAGAGTGAG<br>GGGGUUTGGGAGGTTTGTGGATG |
| 129 | UTTTUUUAGGAUTGUUTTGGUUUUUTGGUUUUAGTUTGGAGGAUTUTTGUTUAUTT<br>UUTURGUUUUUAGGTGAGUTGAGAAUUUAUTGRGRGRGGGAUTUTGUTGRGUUTG<br>UUUTUURGGGUTGUAGAGGGUAGGAXGUAURGUUAGGUAAGGURGRGGUTUTGXG<br>UTGATGUUAUTURGGGAGRGGGTGGUTGRGGGGGAGGAGGGRGAGUAUTGGARGG<br>GGGUAGRGGAGTGTAGGGTGTGAGATUTAAAUAGAGGGUTUUAUTGGAGGGUTTG<br>UUUAGAAGGRGGUAGTUAUAUTGG |
| 130 | UUAGTGTGAUTGURGUUTTUTGGGUAAGUUUTUUAGTGGAGUUUTUTGTTTAGATU<br>TUAUAUUUTAUAUTURGUTGUUUURGTUUAGTGUTRGUUUTUUTUUUURGUAGUUA<br>UURGUTUURGGAGTGGUATUAGXGUAGAGURGRGGUUTTGUUTGGRGGTGXGTUUT<br>GUUUTUTGUAGUURGGGAGGGUAGGRGUAGUAGAGTUURGRGRGUAGTGGGTTUT<br>UAGUTUAUUTGGGGGRGGAGGAAGTGAGUAAGAGTUUTUUAGAUTGGGGUUAGGG<br>GGUUAAGGUAGTUUTGGGAAAG |
| 131 | TTTAGGGTUTUTUTUURGUUTUTTTTUUTUUUURGUTUUUTUTUTUUTTGRGGUTGA<br>UTUUAGUTUUUUUTRGGTGUURGTAAUUUTUUTTTUUTUTTTTGUXGUAGTUTUXG<br>TUTUTUTTUUAUAGGGTUTUTUUUTUUUUUTUTUUURGTGGTTGTUAGAUTTTUTUU<br>TGGAUTTTUTURGUUURGUAURGUUXGUUURGGATGURGAGRGTGGTAGAUTUTGU<br>AGURGGGUTUUTRGUTGUURGUTGGRGUTGUUTAUAUUUUUTTGGGUTUUUUTUUA<br>AGGTUUUUTURGUTRGU |
| 132 | GRGAGRGGAGGGGAUUTTGGAGGGGAGUUUAAGGGGGTGTAGGUAGRGUUAGRGG<br>GUAGRGAGGAGUURGGUTGUAGAGTUTAUUARGUTRGGUATURGGGGXGGGRGGT<br>GRGGGGRGGAGAAAGTUUAGGAGAAAGTUTGAUAAUUARGGGGAGAGGGGGAGGG<br>AGAGAUUUTGTGGAAGAGAGAXGGAGAUTGXGGUAAAAAGAGGAAAGGAGGGTTA<br>RGGGUAURGAGGGGGAGUTGGAGTUAGURGUAAGGAGAGAGGGAGRGGGGGAGG<br>AAAAGAGGRGGGAGAGAGAUUUTAAA |
| 133 | GAGGGUUAUAGTAAAUTGGAUAAGTTTTTUTGUUUAGUUTAGGUTGUUAUUTGTAG<br>GTUAUTTGGGUTUUAGUTATGTGGUTGUUTUTTUTGUTGGGTGUUTTAUTUTGGGUA<br>GTGUTGTGGTTGUTUAGGGAURGGUAGAGUUTGUUXGUUAGUAATGUUTTTGTUTT<br>UATUAURGGUTGTGAUTUAGGUTTTGGGRGUUTTUTGGUAUTGUAGUTGGAUUAGA<br>GAGGUTTURGAGTUUTGGUUAGUTGUUTGAUUUUUTURGGGGURGAGGAUUTGUA<br>GRGGGTGGUUTUUTUURGUU |
| 134 | GRGGGAGGAGGUUAUURGUTGUAGGTUUTRGGUUURGGAGGGGGTUAGGUAGUTG<br>GUUAGGAUTRGGAAGUUTUTUTGGTUUAGUTGUAGTGUUAGAAGGRGUUUAAAGU<br>UTGAGTUAUAGURGGTGATGAAGAUAAAGGUATTGUTGGXGGGUAGGUTUTGURG<br>GTUUUTGAGUAAUUAUAGUAUTGUUUAGAGTAAGGUAUUUAGUAGAAGAGGUAG<br>UUAUATAGUTGGAGUUUAAGTGAUUTAUAGGTGGUAGUUTAGGUTGGGUAGAAAA<br>AUTTGTUUAGTTTAUTGTGGUUUTUA |
| 135 | GTTUTGGUTTUATTTTTTTTTTUUUAAAATGUUATTTTUATTTGTTUTTAGAGTTUAG<br>AAUATGTUAAAGAGUTTUTTTAAGUAGTAGGTGGTTTTAUAGAGUUUAUAGAGAAG<br>GAAAAUTAAATATUATUURGGATGUAGTUUAUTAXGATXGTGGAGGAGTUAGATTA<br>UTUTURGGGUTTTGUTGTGTUTGUTTGTGAAAUAGGAAAGGGAGAAUTGAGGUAAT<br>GAGTUAUUTUAUTTGGGUUUAAAGUAUUAUUTARGTTGAATATGGAGAAAATGTGA<br>AGUAAGAGTTTUTTTTTA |
| 136 | TAAAAAGAAAUTUTTGUTTUAUATTTTUTUUATATTUAARGTAGGTGGTGUTTTGGG<br>UUUAAGTGAGGTGAUTUATTGUUTUAGTTUTUUUTTTUUTGTTTUAUAAGUAGAUA<br>UAGUAAAGUURGGAGAGTAATUTGAUTUUTUUAXGATXGTAGTGGAUTGUATURGG<br>GATGATATTTAGTTTTUUTTUTUTGTGGGUTUTGTAAAAUUAUUTAUTGUTTAAAGA<br>AGUTUTTTGAUATGTTUTGAAUTUTAAGAAUAAATGAAAATGGUATTTTGGGAAAA<br>AAAAAATGAAGUUAGAAU |
| 137 | UUTUUTUUAGTUTTTGUATATATAUUAGGUTGGTATUUATTGUAGGTGGGGAUUTU<br>UTUTTTGGGUTTTGGAGUUUUUUTUUUTGTGTUTUTGTAURGGGGAGUTTUTTUUTT<br>UTGTUTTUTUUUTTUUTTUTTGUTUATTAAAUTUTUXGUTUUTTAAAAUUAUTUUAR<br>GTGTGTURGTGTTGTTTTATUTAAAURGGRGGUAGGATUAAGAAUUUTTGTGT<br>GUAUTUATUAGAGURGTATGATAATUAAGAGUTGAUTAUUTGGGUUATTUTUATAU<br>UATTAGTGURGUATTTA |
| 138 | TAAATGRGGUAUTAATGGTATGAGAATGGUUUAGGTAGTUAGUTUTTGATTATUAT<br>ARGGUTUTGATGAGTGUAGGAAUAUAAGGGTTUTTGATUUTGURGURGGTTTAGAT |

-continued

| SEQ ID NO: | Sequence |
|---|---|
| | AAAAUAAUARGGAUAUARGTGGAGTGGTTTTAAGGAGXGGAGAGTTTAATGAGUAA<br>GAAGGAAGGGAGAAGAUAGAAGGAAGAAGUTUUURGGTAUAGAGAUAUAGGGAG<br>GGGGGUTUUAAAGUUUAAAGAGGAGGTUUUUAUUTGUAATGGATAUUAGUUTGGT<br>ATATATGUAAAGAUTGGAGGAGG |
| 139 | AAGGTTAAAGTRGUTGUTAGAUUAAGGUTAAAURGTGGRGAGGTAGTTGUTTGRGU<br>RGUAGAGTGTGGGTGTGAAUAGUTGGAGUTUAGTGGTTUUTGGAGAUTUAGGGAUU<br>AUUTGTATTUUAUATURGGUTTUUUAUUUARGUAUAXGUAGTATGAUUTGGGTTTU<br>UUUTTTATAUAGTGGAATGUTAAGTGUUTAUAUUUTAGURGGGGTUAGUUAAUTAT<br>GGUUTGTGGGUAUUATUUUAUUTGUAGUUTGTTTTTGAGUTAAGAATGTTGTTGAU<br>AUTTTTAAAAAUAGAGAAUA |
| 140 | GTTUTUTGTTTTTAAAAGTGTUAAUAAUATTUTTAGUTUAAAAAUAGGUTGUAGGTG<br>GGATGGTGUUUAUAGGUUATAGTTGGUTGAUUURGGUTAGGGTGTAGGUAUTTAGU<br>ATTUUAUTGTATAAAGGGGAAAUUUAGGTUATAUTGXGTGTGRGTGGGTGGGAAGU<br>RGGATGTGGAATAUAGGTGGTUUUTGAGTUTUUAGGAAUUAUTGAGUTUUAGUTGT<br>TUAUAUUUAUAUTUTGRGGRGUAAGUAAUUTAUUTRGUUARGGTTTAGUUTTGGTUT<br>AGUAGRGAUTTTAAUUTTG |
| 141 | GAGAUAGGGTTTUAUTUUTGTRGUUUAGGUTGGAGTGUAGUUTUAAUUTUUTGGGU<br>TUAGTGGATUTTUUUAUUTUAGAUTUUTGAGTAGURGGGAUTAUAGGUAUARGUUA<br>UUAGGUUTAGUTAATTTTTTGTATTTTTTTGTAGAGAXGAGGTTTRGUTAGGTrGUU<br>UAGGUTGGTUTUTAAUTUUTGGGUTUAAGXGATUUAUUUAUUTUAGUTTUUUAAAG<br>TGUTGGGGTTAUAGGUUTGAGTUAUAGXGTURGGUTGAAAGTGAAGTTGAATGAGA<br>TGAUTRGTUUAGGUUAUAT |
| 142 | ATGTGGUUTGGARGAGTUATUTUATTUAAUTTUAUTTTUAGURGGAXGUTGTGAUT<br>UAGGUUTGTAAUUUUAGUAUTTTGGGAAGUTGAGGTGGGTGGATXGUTTGAGUUUA<br>GGAGTTAGAGAUUAGUUTGGGUAAUUTAGRGAAAUUTXGTUTUTAUAAAAAAATA<br>UAAAAAATTAGUTAGGUUTGGTGGRGTGTGUUTGTAGTUURGGUTAUTUAGGAGTU<br>TGAGGTGGGAAGATUUAUTGAGUUUAGGAGGTTGAGGUTGUAUTUUAGUUTGGGR<br>GAUAGGAGTGAAAUUUTGTUTU |
| 143 | AUARGUUAUUAGGUUTAGUTAATTTTTTGTATTTTTTTGTAGAGAXGAGGTTTRGOT<br>AGGTTGUUUAGGUTGGTUTUTAAUTUUTGGGUTUAAGXGATUUAUUUAUUTUAGUT<br>TUUUAAAGTGUTGGGGTTAUAGGUUTGAGTUAUAGXGTURGGUTGAAAGTGAAGTT<br>GAATGAGATGAUTRGTUUAGGUUAUATGGUAATUAGTGGUTGATTGARGUUAAAGT<br>TGATTTUATTUTTUTUAATGGGTTUAGAGTUUAAATTUTGGAAUUTUAGAAGARGTT<br>GUTATTUTGGTTUUAAGU |
| 144 | UTTGGAAUUAGAATAGUAARGTUTTUTGAGGTTUUAGAATTTGGAUTUTGAAUUUA<br>TTGAGAAGAATGAAATUAAUTTTGGRGTUAATUAGUUAUTGATTGUUATGTGGUUT<br>GGARGAGTUATUTUATTUAAUTTUAUTTTUAGURGGAXGUTGTGAUTUAGGUUTGT<br>AAUUUUAGUAUTTTGGGAAGUTGAGGTGGGTGGATXGUTTGAGUUUAGGAGTTAGA<br>GAUUAGUUTGGGUAAUUTAGRGAAAUUTXGTUTUTAUAAAAAAATAUAAAAAATT<br>AGUTAGGUUTGGTGGRGTGTG |
| 145 | AGTGAUTGUAGRGTUAGGUUAAGUTTGGUUAUTTAUATGTUTGGUATGAUAGTGGU<br>UTUAGAGTAUTRGTUTGAGAAGAAGAGUTATUAUUTGAGRGUTUTGGAGAAUTTAG<br>URGGAGUTTTUAGGUAGTUTGGGAGUUTAUATGGAGGXGTGTAGGUTTATGTUTUA<br>TGTUUARGTTGUURGGGAGAUAAAATUUTTTUTTTATTTAGAGUTGUUUUAAAATG<br>UTGUAUUAGUTTUTUAUTGRGGTGGUTTUAUUTTAGUATAUAGGTATGTGGARGGU<br>UAUTGTGUTGGUTUAUUTT |
| 146 | AAGGTGAGUUAGUAUAGTGGURGTUUAUATAUUTGTATGUTAAGGTGAAGUUAUR<br>GUAGTGAGAAGUTGGTGUAGAAUATTTTGGGGUAGUTUTAAATAGAAAAGGATTTT<br>GTUTUURGGGUAARGTGGAUATGAGAUATAAGUUTAUAXGUUTUUATGTAGGUTUU<br>UAGAUTGUUTGAAAGUTURGGUTAAGTTUTUUAGAGRGUTUAGGTGATAGUTUTTU<br>TTUTUAGARGAGTAUTUTGAGGUUAUTGTUATGUUAGAUATGTAAGTGGUUAAGUT<br>TGGUUTGARGUTGUAGTUAUT |
| 147 | RGGGUAUUTAGGTUTRGUURGUUTGUAGURGUUTGGGGARGRGGGTTURGGARGGU<br>TGGRGRGGGGRGGGGRGGGGAUUAURGAGUAGGAAGTUUURGRGGAAGRGURGUR<br>GGGUAUAGRGTGGGTGUTGTRGAGGAGTGGRGUURGGGXGGGGRGGGAGGTTATA<br>AATAGRGGURGUUATUUTGUTTUTUTTUAGAUAUAUTTAATTTAGURGGUAGGUAU<br>ARGGATGUTTATTTTTAAAAAAAGAAUTTGTTTTATTGRGUTRGAGGTGAURGGGAA<br>GGTGTUUURGRGGGTUAUTRG |
| 148 | RGAGTGAUURGRGGGGAUAUUTTUURGGTUAUUTRGAGRGUAATAAAAUAAGTTUT<br>TTTTTTAAAAATAAGUATURGTGTGUUTGURGGUTAAATTAAGTGTGTUTGAAGAGA<br>AGUAGGATGGRGGURGUTATTTATAAUUTUURGUTGUURGGGRGUUAUTUUTRG<br>AUAGUAUUUARGUTGTGUURGGRGGRGUTTURGRGGGGAUTTUUTGUTRGGTGGTU<br>UURGUUURGUUURGRGUUAGURGTURGGAAUURGRGTUUUUAGGRGGUTGUAGGR<br>GGGRGAGAUUTAGGTGUURG |

-continued

| SEQ ID NO: | Sequence |
|---|---|
| 149 | GAAGGTGRGGTGRGGTGAGGTGAGAAGAGAGAURGRGUTAGAUUAGGRGATGTUTT<br>AGGGARGGGAGAGGGGTGAGGUUUARGGRGGTUUTGGGGAGRGGUUUARGAURGG<br>UUUARGUAGAGUTTGTAGUUAGTGAAUAGGAAGTATTGGXGAGAGGGAUTGAGAA<br>AUUUAAGAGAGTGTGGGGTGAGGAAAAGGTUAAGGAAGGUUUAGGUTTUUAGGAA<br>GGGUUTGGGURGGGGRGGGGRGGGTGGTGGGAGGUAGTGGTTAGGARGGGRGGGG<br>GTGGGGGTGGGGGTGGGGGTAGGG |
| 150 | UUUTAUUUUUAUUUUUAUUUUUAUUUURGUURGTUUTAAUUAUTGUUTUUUAUUA<br>UURGUUURGUUURGGUUUAGGUUUTTUUTGGAAGUUTGGGUUTTUUTTGAUUTTTT<br>UUTUAUUUUAUAUTUTUTTGGGTTTUTUAGTUUUTUTXGUUAATAUTTUUTGTTUAU<br>TGGUTAUAAGUTUTGRGTGGGURGGTRGTGGGURGUTUUUUAGGAURGURGTGGGU<br>UTUAUUUUTUTUURGTUUUTAAGAUATRGUUTGGTUTAGRGRGGTUTUTUTTUTUA<br>TTTTTTTATTRUATURGUAUUTTU |
| 151 | GAGAAAUAAAATAUATTTTTTAATTTAAAAAAAAGTAUUAGAATGAATAAAAUAGG<br>GGUTTTUUAAAAUTGUTTTTGGTAGATTTAGUAAAUUTAUTGAAUTTTAGAAAUTTTU<br>ATTTTATAATTGTURGGAGATAGAAAGUAGTGUTTUXGAATAAGTGGATAAUTUTGU<br>RGGTUUUAGTAGGTGUUATTGGTGAGUAUAUAGGGTTGUTTAAGTUTUTAAGTUAT<br>TTUUUTGAUTGTGGTTTGAATUAATGTUAAATATUTAUAGGGGTUAGGUAGGTAAU<br>TUAATGAAGTGAAAUAGG |
| 152 | UTGTUAUTTUATTGAGTTAUUTGUUTGAUUUUTGTAGATATTTGAUATTGATTUA<br>AAUUAUAGTUAGGGAAATGAUTTAGAGAUTTAAGUAAUUUTGTGTGUTUAUUAATG<br>GUAUUTAUTGGGAURGGUAGAGTTATUUAUTTATTXGGAAGUAUTGUTTTUTATUT<br>URGGAUAATTATAAAATGAAAGTTTUTAAGTTUAGTAGGTTTGUTAAATUTAUUAAA<br>AGUAGTTTTGGAAAGUUUUTGTTTTATTUATTUTGGTAUTTTTTTTTAAAUUAAAAAA<br>TGTATTTTGTTTUTUT |
| 153 | GGAGGGUTTUAURGTUAGRGTAGRGTARGUUTGRGGGURGGGGRGGGAGAGGGAU<br>RGTRGRGTTTGTGURGUUAGUAUUTGRGGUUUUUAGRGUAUURGGGUUUUARGRG<br>GTAGUUUUUAGGGAGTGGGGAGTRGGGRGGGAAAUAGUTXGUURGGGUTUUTARG<br>GGTGUUUUTTTRGURGRGUTUUUTUURGAGGGTUUTTTGUAGTRGGGRGTGGAAGT<br>GGGATGAGUAAAUUURGUAGUAUAGGGUUTTRGUUUUAGGAUUTGUAUUUTUTAU<br>RGGUUARGGGARGTUUUTURGUAU |
| 154 | GTGRGGAGGGARGTUURGTGGURGGTAGAGGGTGUAGGTUUTGGGGRGAAGGUUU<br>TGTGUTGRGGGGTTTGUTUATUUUAUTTUUARGUURGAUTGUAAAGGAUUUTRGGG<br>AGGGAGRGRGGRGAAAGGGGUAUURGTAGGAGUURGGGXGAGUTGTTTUURGUUR<br>GAUTUUUUAUTUUUTGGGGGUTAURGRGTGGGGUURGGGTGRGUTGGGGGURGUA<br>GGTGUTGGRGGUAUAAARGRGARGGTUUUTUTUURGUUURGGUURGUAGGRGTAR<br>GUTARGUTGARGGTGAAGUUUTUU |
| 155 | AGAUAUAAAGAGGGRGGAGAGAUAGAUAUAGAAAGAGGGAGAUAGRGGGGUTGG<br>ATGGARGTGTGGURGGGUUAGTGGGGAGGAGAGARGAGTURGUAGAUAGRGTTUA<br>GAGGURGRGUTGUTTTGGGTGUTGAGURGTUURGGGGTTUAXGGTRGUAGTTTGTUU<br>TTAUAAAARGUUUAGURGUUURGAUUTGTGGTGUTTAGGGAGGAUUTAUUTGGUTG<br>TGURGGTUTGAGAAGGGGUUAGTGAGGUURGGTGRGGGTARGGGRGGGTGUAGAT<br>GUAGUUAGGAGGARGGGRGGGAGU |
| 156 | GUTUURGUURGTUUTUUTGGUTGUATUTGUAUURGUURGTAUURGUAURGGGUUTU<br>AUTGGUUUUTTUTUAGAURGGUAUAGUUAGGTAGGTUUTUUUTAAGUAUUAUAGG<br>TRGGGGRGGUTGGGRGTTTTGTAAGGAUAAAUTGRGAUXGTGAAUUURGGGARGGU<br>TUAGUAUUUAGGUAGRGRGGUUTUTGAARGUTGTUTGRGGAUTRGTUTUTUUTUUU<br>UAUTGGUURGGUUAUARGTUUATUUAGUUIRGUTGTUTUUUTUTITUTGTGTUTGT<br>UTUTURGUUUTUTTTGTGTUT |
| 157 | GUTGTUAUAUTGAGUTGTTTAAUAUTTAAGATGTTGGTGGATGGUAAAGUTAAAAG<br>AGUATUGTAAUAUATGAUUTUTGGGGUTUURGGAGTUATGAGTAUUUUTTUTAGAU<br>AUAGURGTGGGGUUAUAUAGAATTUTGUTUUTGUTGUXGUURGGAAGUAUTUATUT<br>GGUTUUTGUAUUUAUTUAUUTGUATUUTTUUUUTUUUARGAGGTGTTAAGAGUTGT<br>GGGATGAGTAAAGGAGGUUTGTGAAGGATTTUUTGTTTUAGTUTTAUATTUAGGTUT<br>GAGTTUTUAGAGGAATUTT |
| 158 | AAGATTUUTUTGAGAAUTUAGAUUTGAATGTAAGAUTGAAAUAGGAAATUUTTUAU<br>AGGUUTUUTTTAUTUATUUUAUAGUTUTTAAUAUUTRGTGGGAGGGGGAGGATGUA<br>GGTGAGTGGGTGUAGGAGUUAGATGAGTGUTTURGGGXGGUAGUAGGAGUAGAAT<br>TUTGTGTGGUUUUARGGUTGTGTUTAGAAGGGGTAUTUATGAUTURGGGAGUUUUA<br>GAGGTUATGTGTTAUAGTGUUUTTAGUTTTGUUATUUAUUAAUATUTTAAGTGTT<br>AAAUAGUTUAGTGTGAUAGU |
| 159 | UAGGGUTGGGAGAATAGGATGGAUAGRGTTTTGUUAGAGUUTUATGGGAAGUTTUU<br>TTTUAGGUAGUTGAAUUUATTTUAGGGGTAGGGAGUAUTGATUAGGGGTTGGGAUA<br>TTGUUURGGGAGGAGGATGAGGATGTTTUUAGGUUTXGGUTGAUTUATGGTAGTGA |

-continued

| SEQ ID NO: | Sequence |
|---|---|
| | GTATTAGTUAUTUUUTUAUAAGAATUAGUUUAUATUUTUTAGTAGUUTUTTGTUTU<br>UUAGAGGUUUUTGUUUUATGTTTAUUTGUUTGAAGUTUUTUTUURGGURGUUUUUA<br>UUUAUATURGUAUAGTTTGG |
| 160 | UAAAUTGTGRGGATGTGGGTGGGGGRGGURGGGAGAGGAGUTTUAGGUAGGTAAA<br>UATGGGGUAGGGGUUTUTGGGAGAUAAGAGGUTAUTAGAGGATGTGGGUTGATTUT<br>TGTGAGGGAGTGAUTAATAUTUAUTAUUATGAGTUAGUXGAGGUUTGGAAAUATUU<br>TUATUUTUUTUURGGGGUAATGTUUUAAUUUUTGATUAGTGUTUUUTAUUUUTGAA<br>ATGGGTTUAGUTGUUTGAAAGGAAGUTTUUUATGAGGUTUTGGUAAAARGUTGTUU<br>ATUUTATTUTUUUAGUUUTGU |
| 161 | GAGGAUTAAAAGAAGUUAGAGATGUTGGTUAATTGAUAUAAAAATAAAGAGUTAA<br>GGGAGAGGTTGAGAGAGGGAGAGUAATATUTATGGGTGTUTGGAATTTTTAAAGGG<br>UTUAGAGGAGGAGGGGGURGGGRGTGGTGGUTUAXGUUTGTTATUXGAGUAUTTTG<br>GGAGGUUAAGGTGGGUAAATUARGAGGTUAGGAGTTTGAGAGUAGUUTGAUUAAU<br>ATGGTGUAAUUURGTUTUTAUTAAAAATAUAAAATTTAGURGGGTGTGGTTGTGTG<br>UUTGTAATUUUAGUTAUTUAGG |
| 162 | UUTGAGTAGUTGGGATTAUAGGUAUAUAAUUAUAUURGGUTAAATTTTGTATTTTT<br>AGTAGAGARGGGGTTGUAUUATGTTGGTUAGGUTGUTUTUAAAUTUUTGAUUTRGT<br>GATTTGUUUAUUTTGGUUTUUUAAAGTGUTXGGATAAUAGGXGTGAGUUAUUARG<br>UURGGUUUUUTUUTUUTUTGAGUUUTTTAAAAATTUUAGAUAUUUATAGATATTGU<br>TUTUUUTUTUTUAAUUTUTUUUTTAGUTUTTTATTTTTGTGTUAATTGAUUAGUATUT<br>UTGGUTTUTTTTAGTUUTU |
| 163 | UUAGGAGUURGUUTGGGAGRGRGUAGRGUTUTAGGAGURGAGAGURGUTGUTTGG<br>UUUTRGUTGGURGGGTAAAURGAGGGGAAGUTUUTGGUUTUUTTTUUUTTAAGUUU<br>UTTATTGUTTUTGTGGGGAAGGUUUTUUTAGGTAGAGGXGAAGGAURGGGGAGATA<br>AUUTUTUUUATGGGUUAUATURGUTGUUATGGTUTGTGTRGTGUUAGAAGGTAUUT<br>UTUAGUUUTUAGTGURGTGAAAAATUTGAUAUTUAAGAAGGTRGATTGAUARGUUT<br>AARGTRGUAUAGUAATTTAGT |
| 164 | AUTAAATTGUTGTGRGARGTTAGGRGTGTUAATRGAUUTTUTTGAGTGTUAGATTTT<br>TUARGGUAUTGAGGGUTGAGAGGTAUUTTUTGGUARGAUAUAGAUUATGGUAGRG<br>GATGTGGUUUATGGGAGAGGTTATUTUUURGGTUUTTXGUUTUTAUUTAGGAGGGU<br>UTTUUUUAUAGAAGUAATAAGGGGUTTAAGGGAAAGGAGGUUAGGAGUTTUUUUT<br>RGGTTTAUURGGUUAGRGAGGGUUAAGUAGRGGUTUTRGGUTUUTAGAGRGUTGRG<br>RGUTUUUAGGRGGGUTUUTGG |
| 165 | GAGGUARGAAGUTGURGGAGUTAUTUAGUTTTAUUTUTAGGAAAGATAUAGRGAAT<br>UAURGUUAATAAAAUAAAGUAAAAUAAAAAGUTRGUUATGUTGAARGGAATGGGA<br>AAATTGUTUTUTTGTUAUTAATTTTGATTGAATTGAGTXGGUAATUTUTGAAURGGT<br>TUAUTGATAUAAUAATAGGAAAUATTTAAUTGTTTUTTGUAUUTTTAAAUATAAATA<br>GTAGGTTTTTAAGUAGTUAGTAGGRGATGTGTGATUAAGGTTUAGAUAGARGUAGA<br>UAAUTGATUAUUUAUTUAG |
| 166 | UTGAGTGGGTGATUAGTTGTUTGRGTUTGTUTGAAUUTTGATUAUAUATRGUUTAUT<br>GAUTGUTTAAAAAUUTAUTATTTATGTTTAAAGGTGUAAGAAAUAGTTAAATGTTTU<br>UTATTGTTGTATUAGTGAAURGGTTUAGAGATTGUXGAUTUAATTUAATUAAAATTA<br>GTGAUAAGAGAGUAATTTTUUUATTURGTTUAGUATGGRGAGUTTTTTGTTTTGUTT<br>TGTTTTATTGGRGGTGATTRGUTGTATUTTTUUTAGAGGTAAAGUTGAGTAGUTURG<br>GUAGUTTRGTGUUT |
| 167 | GAUUTUAGUTURGGGTGAUAURGGTGGGRGTRGGGTGTGGUUTUAGAUAGUTUUUT<br>TUUTUUURGGUTGGTTGUUAGGTUAAUAURGGGTGGGAUTAGUUTUTGGTGTRGGU<br>AGTAGUUUUATGUTUURGGUUTTTGGGTTUTTGUATGXGURGTUUUUATUAUUTGG<br>UTGUUUUTUTUAUTTURGTUTUUAUUTGTUURGGGTUAUUTGTUUTTUAAGUUAGA<br>AATTAAGGAUAGUAUUUUUTUUUAGAURGUUTGGUTGUAGTUURGGGATGGGRGU<br>TUUTAGTRGUUTAGATRGGGU |
| 168 | GUURGATUTAGGRGAUTAGGAGRGUUUATUURGGGAUTGUAGUUAGGRGGTUTGG<br>GAGGGGGTGUTGTUUTTAATTTUTGGUTTGAAGGAUAGGTGAUURGGGAUAGGTGG<br>AGARGGAAGTGAGAGGGGUAGUUAGGTGATGGGGARGGXGUATGUAAGAAUUUAA<br>AGGURGGGAGUATGGGGUTAUTGURGAUAUUAGAGGUTAGTUUUAUURGGTGTTG<br>AUUTGGUAAUUAGURGGGGAGGAAGGGAGUTGTUTGAGGUUAUAUURGARGUUUA<br>URGGTGTUAUURGGAGUTGAGGTU |
| 169 | GTATUTGTGTUAAUUAGRGGTTUTUAGUUTGGUUTUATUUAGGGUUTGAAGUUTAU<br>TAUAGAAUUUUUAGUAGUARGTGGGGTGUAUAGUAAAGATUAGUUUTGGAUAUAG<br>URGGGTGUTUAGGGRGGGGTGAGGGGGUAGGAGGUAGGAXGUAGGAGGTGAGUTG<br>TURGGGRGGGGUAGGATGAGGGAGTUUTGUATTGUAGAGUTAAGGGGGAGAATUA<br>TUAGUAUUUTAATTAGUTTTTTGATGGUTTUUAAAGUUTTTTAAGTUUTTTTTTTTTTT<br>TTTTTTTTTTATUUUTAUAAG |

-continued

| SEQ ID NO: | Sequence |
|---|---|
| 170 | UTTGTAGGGATAAAAAAAAAAAAAAAAAAAAAAAGGAUTTAAAAGGUTTTGGAAGUU<br>ATUAAGAGUTAATTAGGGTGUTGATGATTUTUUUUUTTAGUTUTGUAATGUAGGAU<br>TUUUTUATUUTGUUURGUURGGAUAGUTUAUUTUUTGXGTUUTGUUTUUTGUUUUU<br>TUAUUURGUUUTGAGUAUURGGUTGTGTUUAGGGUTGATUTTTGUTGTGUAUUUUA<br>RGTGUTGUTGGGGGTTUTGTAGTAGGUTTUAGGUUUTGGATGAGGUUAGGUTGAGA<br>AURGUTGGTTGAUAUAGATAU |
| 171 | GATTAAUTTGUUTUUTGAUAAGTUATAUUUTTTAGUTTAGTAUTAAGGUAGAAGAG<br>AGUUUTGTTGAAGAGUURGUTTGTGTTUTGTGGTAAAGAUAUAGGUUTAURGGUTT<br>UTUXGTGGGTUUUAGTGUTGAGAAGGGUAUAGGUTGGUTGGAGAUAGTGUUUTGU<br>TTGAUAGAUUUUTUUAXGUTRGGATUUTTUUAGTUTGUAURGGUUAUUTGUAUTGG<br>TTTUARGGAAGAGUTAGAATTUTGTTTTAATGTTGGUUAGTTTUUATUATTAGUTTG<br>AAAAGAAUAUAGAAUTTARG |
| 172 | RGTAAGTTUTGTGTTUTTUUAAGUTAATGATGGAAAUTGGUUAAUATTAAAAUAGA<br>ATTUTAGUTUTTURGTGAAAUUAGTGUAGGTGGURGGTGUAGAUTGGAAGGATURG<br>AGXGTGGAGGGGTUTGTUAAGUAGGGUAUTGTUTUUAGUUAGUUTGTGUUUTTUTU<br>AGUAUTGGGAUUUAXGGAGAAGURGGTAGGUUTGTGTUTTTAUUAUAGAAUAUAA<br>GRGGGUTUTTUAAUAGGGUTUTUTTUTGUUTTAGTAUTAAGUTAAAGGGTATGAUTT<br>GTUAGGAGGUAAGTTAATU |
| 173 | GAUUAUAGGTGTGTGUTATUATGUURGGGTAATTTTTATATTTTTTGGTUTUAUTAT<br>GTTGUUUAGGUTGGTUTUAAAUTUUTGGGUTUAAGTGATUUTUUTGUUTUAGUUTU<br>UUAAAGTGTTGGATTAGAGGUATGAGUUAUUTTGUAXGTTTGUUTUUTGAUUTUAG<br>GTUUUUARGGAGTTGGTUATUTTUTGGGUUTRGUTUAGURGGTGUTGAAGGTGAGT<br>UATGUTRGATGATGAUUTGAGGAGUAGAAGAAGGTGUAGGTGAGTUAUUTGAGGG<br>GAAUTGGGTUATGAUUAGAG |
| 174 | UTUTGGTUATGAUUUAGTTUUUUTUAGGTGAUTUAUUTGUAUUTTUTTUTGUTUUT<br>UAGGTUATUATRGAGUATGAUTUAUUTTUAGUAURGGUTGAGRGAGGUUUAGAAG<br>ATGAUUAAUTURGTGGGGAUUTGAGGTUAGGAGGUAAAXGTGUAAGGTGGUTUAT<br>GUUTUTAATUUAAUAUTTTGGGAGGUTGAGGUAGGAGGATUAUTTGAGUUUAGGA<br>GTTTGAGAUUAGUUTGGGUAAUATAGTGAGAUUAAAAAATATAAAAATTAUURGG<br>GUATGATAGUAUAUAUUTGTGGTU |
| 175 | AGGAAGTRGAGGUTTAGAAGTTGGGTGAUTTGTUAAAGGTRGUUAUUUARGGTGAG<br>GGUUAGGTTUTGGGAGGGUTGAGGGGUAGGUATGGTGAGUUAGTTURGGGUATGA<br>GGUAAGGRGTGGUAGGUUTGGGGGUAAAAGUUAUAGUUXGTGTGGAGGGGGTGGG<br>GGGATRGAGGUUTTTGGGAAGUUTGTGGATTUTGGUTGUAGTGTGGGTGTGAUAUT<br>GAGTGUTURGGGGAUTURGAGTTATUAUUUAGGUAUTGGUUAGUUUUARGUTUUU<br>TUUTUUAGGTAUTTGGUTUUUTG |
| 176 | AGGGAGUUAAGTAUUTGGAGGAGGGAGRGTGGGGUTGGUUAGTGUUTGGGTGATA<br>AUTRGGAGTUUURGGAGUAUTUAGTGTUAUAUUUAUAUTGUAGUUAGAATUUAUA<br>GGUTTUUUAAAGGUUTRGATUUUUUUAUUUUUTUUAUAXGGGUTGTGGUTTTTGUU<br>UUUAGGUUTGUUARGUUTTGUUTUATGUURGGAAUTGGUTUAUUATGUUTGUUUUT<br>UAGUUUTUUUAGAAUUTGGUUUTUAURGTGGGTGGRGAUUTTTGAUAAGTUAUUU<br>AAUTTUTAAGUUTRGAUTTUUTU |
| 177 | AGUUARGGRGAUUAUUAUUTUUATUUTUUUUUAUUTUUTUUTUUTGUAGGTGGUU<br>TTTTTGGUUAGTGTGTUTGAGTGUTUAUUTUTTGUTUTAGTGTUUTGGTGUTURGGUT<br>UTUUTUTTUUTUUTUAUTUTUUTGGGUUTGGGUUTGUXGUTUURGGGUUTUUAGGT<br>UTAGAUAUAAGGGTTGAATGAUUAGAUTGUTGGTUTGTTUAGTTTUUATGTGGUUT<br>RGGUUUAUUUUAGUTUTGGUTGUUTUUUUAAAGTUTUAATUARGARGAGATUATA<br>UAGTAAUTUTGUUUUUTUUUT |
| 178 | AGGGAGGGGGUAGAGTTAUTGTATGATUTRGTRGTGATTGAGAUTTTGGGGAGGUA<br>GUUAGAGUTGGGGTGGGURGAGGUUAUATGGAAAUTGAAUAGAUUAGUAGTUTGG<br>TUATTUAAUUUTTGTGTUTAGAUUTGGAGGUURGGGAGXGGUAGGUUUAGGUUUA<br>GGAGAGTGAGGAGGAAGAGGAGAGURGGAGUAUUAGGAUAUTAGAGUAAGAGGT<br>GAGUAUTUAGGUAUAUTGGUUAGAAGGUUAUUTGUAGGAGGAGGAGGTGGGGGA<br>GGATGGAUUTGGTGGTRGURGTGGUT |
| 179 | AAGGTGAATGUTGUAAUUUTUTUTUUTUAGUUUTGUAGURGATUUUTGAUATAAAU<br>TUUTTGAAGTTUAGTGGUUTUTTTUUATGUAUUTAUUAUUTAUAUUTGUTGU<br>AAGAAAUUAUAAUUTGGAURGGGAAUAGAAUTGGAXGTGUUAAAATGUUTGAGGA<br>UAUTTUATXGAATGTGGUTGGUTTGATGGGAAGUTGGUATGAUTAGAAATGTUAGG<br>AGTUTTUUUTUTXGAGGTTTUAAGUTTTGTGTTTUTGAUTUAATGGTURGGATTGAG<br>ATUAGATGAGTUAAGTTUA |
| 180 | GAAUTTGAUTUATUTGATUTUAATURGGAUUATTGAGTUAGAAAUAUAAAGUTTGA<br>AAUUTXGAGAGGGAAGAUTUUTGAUATTTUTAGTUATGUUAGUTTUUUATUAAGUU<br>AGUUAUATTXGATGAAGTGTUUTUAGGUATTTTGGUAXGTUUAGTTUTGTTUURGGT<br>UUAGGTTGTGGTTTUTTTGAAAGUAGUAGGTGTAGGTGGTAGGTGUATGGAAAGAG |

-continued

| SEQ ID NO: | Sequence |
|---|---|
| | GUUAUTGAAUTTUAAGGAGTTTATGTUAGGGATRGGUTGUAGGGUTGAGGAGAGAG<br>GGTTGUAGUATTUAUUTTU |
| 181 | UAGUUUTGUAGURGATUUUTGAUATAAAUTUUTTGAAGTTUAGTGGUUTUTTTUUA<br>TGUAUUTAUUAUUTAUAUUTGUTGUTTTUAAAGAAAUUAUAAUUTGGAURGGGAA<br>UAGAAUTGGAXGTGUUAAAATGUUTGAGGAUAUTTUATXGAATGTGGUTGGUTTGA<br>TGGGAAGUTGGUATGAUTAGAAATGTUAGGAGTUTTUUUTUTXGAGGTTTUAAGUT<br>TTGTGTTTUTGAUTUAATGGTURGGATTGAGATUAGATGAGTUAAGTTUAGATGAUU<br>ATGUAAAUUTTTAGATGGGG |
| 182 | UUUUATUTAAAGGTTTGUATGGTUATUTGAAUTTGAUTUATUTGATUTUAATURGGA<br>UUATTGAGTUAGAAAUAUAAAGUTTGAAAUUTXGAGAGGGAAGAUTUUTGAUATTT<br>UTAGTUATGUUAGUTTUUUATUAAGUUAGUUAUATTXGATGAAGTGTUUTUAGGUA<br>TTTTGGUAXGTUUAGTTUTGTTUURGGTUUAGGTTGTGGTTTUTTTGAAAGUAGUAG<br>GTGTAGGTGGTAGGTGUATGGAAAGAGGUUAUTGAAUTTUAAGGAGTTTATGTUAG<br>GGATRGGUTGUAGGGUTG |
| 183 | UUTAUUAUUTAUAUUTGUTGUTTTUAAAGAAAUUAUAAUUTGGAURGGGAAUAGAAUTGGA<br>XGTGUUAAAATGUUTGAGGAUAUTTUATXGAATGTGGUTGGUTTGATGGGAAGUTGGUATG<br>AUTAGAAATGTUAGGAGTUTTUUUTUTXGAGGTTTUAAGUTTTGTGTTTUTGAUTUAATGGTU<br>RGGATTGAGATUAGATGAGTUAAGTTUAGATGAUUATGUAAAUUTTTAGATGGGGUUTAAAA<br>UUAAATUTGTGTTUTTAAAUUATTUUAAATGTGTTUATUAUUAGTTATAGTTT |
| 184 | AAAUTATAAUTGGTGATGAAUAUATTTGGAATGGTTTGAGAAUAUAGATTTGGTTTTAGGUU<br>UUATUTAAAGGTTTGUATGGTUATUTGAAUTTGAUTUATUTGATUTUAATURGGAUUATTGA<br>GTUAGAAAUAUAAAGUTTGAAAUUTXGAGAGGGAAGAUTUUTGAUATTTUTAGTUATGUUA<br>GUTTUUUATUAAGUUAGUUAUATTXGATGAAGTGTUUTUAGGUATTTTGGUAXGTUUAGTTU<br>TGTTUURGGTUUAGGTTGTGGTTTUTTTGAAAGUAGUAGGTGTAGGTGGTAGG |
| 185 | GAGAGGGGAAGGGGURGAUUAUUTGUTUURGAGUUATTUTRGGGUTRGGUUAGUU<br>ATTGGGUTGGGAAUUTGTUAATUUTGGTTGATUTTUUAATGAGUTGTGAAUTGGTUT<br>TURGGGAGGAUTTAUAGGAGGUTGGAAARGGGGUUTGGXGRGRGUTTUUUTUTUAG<br>TGRGAGGUTGAUTGGTTGGAUTRGURGGGUTUTAUTGTGGGUUUUARGUTATGTTT<br>AGARGUURGARGTGTUUUATTTTATTGAAUTRGTUUTGUUUUUUAAGTAGGGARGA<br>TTTAUUTUUATTTTUTAGAT |
| 186 | ATUTAGAAAATGGAGGTAAATRGTUUUTAUTTGGGGGGUAGGARGAGTTUAATAAA<br>ATGGGAUARGTRGGGRGTUTAAAUATAGRGTGGGGUUUAUAGTAGAGUURGGRGA<br>GTUUAAUUAGTUAGUUTRGUAUTGAGAGGGAAGRGRGXGUUAGGUUURGTTTUUA<br>GUUTUUTGTAAGTUUTUURGGAAGAUUAGTTUAUAGUTUATTGGAAGATUAAUUAG<br>GATTGAUAGGTTUUUAGUUUAATGGUTGGURGAGUURGAGAATGGUTRGGGAGUA<br>GGTGGTRGGUUUUTTUUUUTUTU |
| 187 | RGGGGGUAGGGAGUAGAUUTGAUTUAGTGGRGTUAGTGUTAUTTUAAAGRGGUAG<br>RGUATTTUATTAAAAATUTGATGTAGAAATTAUUUTGGGUTTTGTTTTGUAAAGAGU<br>ATTTGUATAAGAAAAAATAATUAGURGGTTAATTUUUUXGTUUAUTGGUAGGAAGA<br>GAGAUAGUUTTUAGAGAGTTTGGGAUTUTUTUATTUURGGAGAATTAAAAGUUTUR<br>GAGAUATUUATTTTAGAAGTTUTGGTUAATRGTTUTTAAAGTGRGGTUAGAAGAUU<br>UUTTGRGTUTGAATGGTTTG |
| 188 | UAAAUUATTUAGARGUAAGGGGTUTTUTGAURGUAUTTTAAGAARGATTGAUUAGA<br>AUTTUTAAAATGGATGTUTRGGAGGUTTTTAATTUTURGGGAATGAGAGAGTUUUA<br>AAUTUTUTGAAGGUTGTUTUTUTTUUTGUUAGTGGAXGGGGGAATTAAURGGUTGA<br>TTATTTTTUTTATGUAAATGUTUTTTGUAAAAUAAAGUUUAGGGTAATTTUTAUAT<br>UAGATTTTTAATGAAATGRGUTGURGUTTTGAAGTAGUAUTGARGUUAUTGAGTUA<br>GGTUTGUTUUUTGUUUURG |
| 189 | UAGTGTTGTAGAUUTATTAATTATUAGGATAATTARGGARGGGGAAATUUAGAUAU<br>AGATAUAATUAGTGUUUTUUTUUAUUTUUURGUAUARGUUUUTUURGGTUTUUUTG<br>AUATUUTGGTGTGUAUTGTGTTUUUUTGUUATUTUUAXGUTGRGGUTUUTAUTAGA<br>UUUAUUUUTGURGGTGUUAAAATGUUUAAAGGAAGGUTGAGTUATGUTUTGGUUT<br>GUUUAGURGUAATAGTUATGUTGUAAUTUUUARGGAAAAUUTUUTTTUAUUUAUTU<br>UAGAGGTUTGAGAUAUUUTAA |
| 190 | TTAGGGTGTUTUAGAUUTUTGGAGTGGGTGAAAGGAGGTTTTURGTGGGAGTTGUA<br>GUATGAUTATTGRGGUTGGGUAGGUUAGAGUATGAUTUAGUUTTUUTTTGGGUATT<br>TTGGUAURGGUAGGGGTGGGTUTAGTAGGAGURGUAGXGTGGAGATGGUAGGGGA<br>AUAUAGTGUAUAUUAGGATGTUAGGGAGAURGGGAGGGGRGTGTGRGGGGAGGTG<br>GAGGAGGGUAUTGATTGTATUTGTGTUTGGATTTUUURGTURGTAATTATUUTGATA<br>ATTAATAGGTUTAUAAUAUTG |
| 191 | GGAAGGAGRGAGUTTUTTTTTATAGGAGUTUUAGTTUUTRGTTTTGTTUTUTTRG<br>TTATTUTUUAAAGAAAGURGGUTUTTGAGTUAGUTGGUAGGAGAGRGAGGRGAATG<br>RGUTGGTGUTGGURGUAATGGUUURGGTTUAARGUTXGUTUUAGUTGGTUARGTUU<br>TUAURGGGGRGGURGGRGGUUTGUUTGUUUARGUTUTGUUAGGAGUUUAGGTUAG |

-continued

| SEQ ID NO: | Sequence |
|---|---|
| | UUUTTGUUTRGURGGGGURGGAGUURGTUUAAAATUAAUAAGTUTTTTGTGUUTUT<br>UUTTTGGARGUTGTATAATT |
| 192 | AATTATAUAGRGTUUAAAGGAGAGGUAUAAAAGAUTTGTTGATTTTGGARGGGUTU<br>RGGUUURGGRGAGGUAAGGGUTGAUUTGGGUTUUTGGUAGAGRGTGGGUAGGUAG<br>GURGURGGURGUUURGGTGAGGARGTGAUUAGUTGGAGXGAGRGTTGAAURGGGG<br>UUATTGRGGUUAGUAUUAGRGUATTRGUUTRGUTUTUUTGUUAGUTGAUTUAAGAG<br>URGGUTTTUTTTGGAGAATAAUURGAAGAGAAUAAAARGAGGAAUTGGAGUTUUTA<br>TAAAAAGAAGUTRGUTUUTTUU |
| 193 | UTGGTTGTGGAAGGAGRGAGUTUTURGTUUURGGGAGTATGUAAGTTTUUUUTUUA<br>RGATUAUTTGGAAGGGATTGGGRGGAGTTUTGTUATTTGGAGAAAGGGTUUTGGGA<br>GUTTUAGGTTTGTGTAGGGRGAGGARGGGGRGGTTUTGXGTURGGUUAGGTTGGUU<br>UTRGAGGAUUUAGURGTUUUUAAUUTUUTAAAUTGUTGTRGGATGTAGAAGAUTRG<br>UATTUAUTGUTUTUUAUAGTRGGTGAAGGGAGAARGURGAAAAGGGURGUATTUUU<br>TUUTGURGGTUUUUTUUUUT |
| 194 | AGGGGAGGGGAURGGUAGGAGGGAATGRGGUUUTTTTRGGRGTTUTUUUTTUAURG<br>AUTGTGGAGAGUAGTGAATGRGAGTUTTUTAUATURGAUAGUAGTTTAGGAGGTTG<br>GGGARGGUTGGGTUUTRGAGGGUUAAUUTGGURGGAXGUAGAAURGUUURGTUUT<br>RGUUUTAUAUAAAUUTGAAGUTUUUAGGAUUUTTTUTUUAAATGAUAGAAUTURG<br>UUUAATUUUTTUUAAGTGATRGTGUAGUUUAAAUTTGUATAUTUURGGGGARGGAG<br>AGUTRGUTUUTTUUAUAAUUAG |
| 195 | GGGTGTUAGGUTAUUUTTGAAGGGAUUTAUUTUUTUUAGUUAUTGUUAUTGGAUU<br>UTUUUTUAGUUUUTUTAGUAAAGUAGUUUUAATGUATGTUUTGAGATTGTUURGGA<br>AAAUTGTUAUTUAGAGGGGAAGAUTUTTGGGUAUAGAGUXGTTATTTATAAUAGUA<br>AGAUAUTGUAGGUTGUUTAAAUAUTUUARGAUAGAGATGARGGAGUAATTUARGG<br>UAUUUUTGUUAAGAGAGTATTAUAUAGUUATTAAAAATGATUAAGUAGAGAURGG<br>TAGTGARGUTGAGTAATGTTTTU |
| 196 | GAAAAUATTAUTUAGRGTUAUTAURGGTUTUTGUTTGATUATTTTTAATGGUTGTGT<br>AATAUTUTUTTGGUAGGGGTGURGTGAATTGUTURGTUATUTUTGTRGTGGAGTGTT<br>TAGGUAGUUTGUAGTGTUTTGUTGTTATAAATAAXGGUTUTGTGUUUAAGAGTUTT<br>UUUUTUTGAGTGAUAGTTTTURGGGAUAATUTUAGGAUATGUATTGGGGUTGUTTT<br>GUTAGAGGGGUTGAGGGAGGGTUUAGTGGUAGTGGUTGGAGGAGGTAGGTUUUTT<br>UAAGGGTAGUUTGAUAUUU |
| 197 | GUUUAURGRGGAGGGUUUUUUTATUUTUUTUATUUTUAUTGGUTUAUUUAGGGUA<br>UUAUUAUUTUUTUUAGGAAAUUUTUUUTGUUUUUTATUTUTGGGTGTUTUAUAUUU<br>TGGGUAUUTAUAGUUAGAAUUUUAUUTURGGGUUUTUXGTTTUUAGTGGUTGAGT<br>AGGAGUTTUAGTTTTAGGAGAUTUUUUTGAGUAGAAURGAUUUUTUTTUATUTTUU<br>UAAUUUUUAUUUAUAUAUTUAGGAUTGGGTAURGGGGUUTGUUUUAATTTGUAGG<br>UTTAGAGTUAGGGGTTAGGGTGG |
| 198 | UAUUUTAAUUUUTGAUTUTAAGUUTGUAAATTGGGGUAGGUUURGGTAUUUAGTU<br>UTGAGTGTGTGGGTGGGGGTTGGGAAGATGAAGAGGGGTRGGTTUTGUTUAGGGGA<br>GTUTUUTAAAAUTGAAGUTUUTAUTUAGUUAUTGGAAAXGGAGGGUURGGAGGTG<br>GGGTTUTGGUTGTAGGTGUUUAGGGTGTGAGAUAUUUAGAGATAGGGGGUAGGGA<br>GGGTTTUUTGGAGGAGGTGGTGGTGUUUTGGGTGAGUUAGTGAGGATGAGGAGGAT<br>AGGGGGGUUUTURGRGGTGGGUA |
| 199 | UTTAAATGAGAAGAAUATGTTTUTAUAURGUATTTGTGAAAGTTTGGUTRGGAGUTA<br>RGRGUTGATTAATATUAGATUTUUTTUAUTRGUUTRGUUAUAATUTTGTUAUATUTG<br>GUTGAUAAATUURGAGGAAUTURGGUAAAGUUAGGXGGRGGRGGGGUTURGGGTU<br>TGGGRGGRGGUTURGGAGGAGUAGRGGGAGAUUURGUAGRGGUUTUUTUUTTUTU<br>RGUURGRGGUUUUUAGUUTRGURGURGURGUURGGUTUUUAGUARGGAAURGARG<br>GGGRGUTUURGAGARGGGRGA |
| 200 | TRGUURGTUTRGGGAGRGUUURGTRGGTTURGTGUTGGGAGURGGGRGGRGGRGGR<br>GAGGUTGGGGGURGRGGGRGGAGAAGGAGGAGGURGUTGRGGGGTUTUURGUTGU<br>TUUTURGGAGURGURGUUUAGAUURGGAGUUURGURGUXGUUTGGUTTTGURGGA<br>GTTUUTRGGGATTTGTUAGUUAGATGTGAUAAGATTGTGGRGAGGRGAGTGAAGGA<br>GATUTGATATTAATUAGRGRGTAGUTURGAGUUAAAUTTTUAUAAATGRGGTGTAG<br>AAAUATGTTUTTUTUATTTAAG |
| 201 | GTGGTAGGTUTGTGTGGAGAUTTGAATUUTGTTTTUTUUUAGUUTTTTUUAUUAAGG<br>AUAUUUAGGAGAGUAAGGATATGGUUAGAGGAGAGGTGGTGTTUUUUTUTTGAUT<br>GGGUUUTGUTUTUAGUUUUAUAGGTGATURGGAAGATTXGGGTGGAGUAGTTTUUT<br>GATGUUTURGGTAGUUTGAAGUTGTGGTGUUAGTTTTTUAAUATTUTTAGTGAUTUA<br>GTUTTGAUATGGGUUAAGGATUAGRGUUUAGTGGGRGAGGTGGGUAGGAGGTAAG<br>UUAARGAUAUUAUTGUUAUU |
| 202 | GGTGGUAGTGGTGTRGTTGGUTTAUUTUUTGUUUAUUTRGUUUAUTGGGRGUTGAT<br>UUTTGGUUUATGTUAAGAUTGAGTUAUTAAGAATGTTGAAAAAUTGGUAUUAUAGU |

-continued

| SEQ ID NO: | Sequence |
|---|---|
| | TTUAGGUTAURGGAGGUATUAGGAAAUTGUTUUAUUXGAATUTTURGGATUAUUTG<br>TGGGGUTGAGAGUAGGGUUUAGTUAAGAGGGGAAUAUUAUUTUTUUTUTGGUUAT<br>ATUUTTGUTUTUUTGGGTGTUUTTGGTGGAAAAGGUTGGGAGAAAAUAGGATTUAA<br>GTUTUUAUAUAGAUUTAUUAU |
| 203 | TGUUTAUUAUAUUTRGTGGGTGAAAUAGATATTTRGAGUATGAUTGAGUTTATTAA<br>GAGUUUTGRGGRGUTTUUTUTGURGGGGGTTTAGAAATTTUAAAGGATGGGGGTTG<br>AGGGAGGGAGGAGTTATGGGUATGTGATGTGGAUAGGGXGGGUAGGAGGATGGAA<br>GTAAUAGGTUUAAAATGTATUTTTGGTGGUURGGUAGAGUTUTTGUATGGGGTGAG<br>AATGGTAATTTAGGAAGAGUAAGTUTTUUUATUTGTGAAGUAGAAGAAAAAAGTGG<br>AUTTAAGGAGAAGTTRGGGTG |
| 204 | UAUURGAAUTTUTUUTTAAGTUUAUTTTTTTUTTUTGUTTUAUAGATGGGAAGAUTT<br>GUTUTTUUTAAATTAUUATTUTUAUUUUATGUAAGAGUTUTGURGGGUUAUUAAAG<br>ATAUATTTTGGAUUTGTTAUTTUUATUUTUUTGUUXGUUUTGTUUAUATUAUATGU<br>UUATAAUTUUTUUUTUUUTUAAUUUUUATUUTTGAAATTTUTAAAUUUURGGUAG<br>AGGAAGRGURGUAGGGUTUTTAATAAGUTUAGTUATGUTRGAAATATUTGTTTUAU<br>UUARGAGGTGTGGTAGGUA |
| 205 | GAGUUAAUUTUTUUTTTUATTUUTGGAGGTGGGGGAUURGUUUTUATUTUAGGUUT<br>GAAGAGGGUTGTGTGTGAGTTUTUUAUTTGTGTGTGGGGTGAGUURGGUUUATGUA<br>UAUAGUTAUAUAUAUATUAUAUAUUUAUAUURGGAUAXGRGUUTUAGGTUUUUAU<br>AUTGUUUTTAUAUAUATGRGUUUUTUAUAUATGUATGTUUUUTTTGUAUAUARGUU<br>UUUTRGUAUARGUATGUUUUUTRGUAUARGUATGUAUAUAGGUTUAUTUTGUTGU<br>UTGTUUUTGGUTGUTGTGTGUT |
| 206 | AGUAUAUAGUAGUUAGGGAUAGGUAGUAGAGTGAGUUTGTGTGUATGRGTGTGRG<br>AGGGGGUATGRGTGTGRGAGGGGGRGTGTGTGUAAAGGGGAUATGUATGTGTGAGG<br>GGRGUATGTGTGTAAGGGUAGTGTGGGGAUUTGAGGRGXGTGTURGGGTGTGGGTG<br>TGTGATGTGTGTGTAGUTGTGTGUATGGGURGGGUTUAUUUUAUAUAUAAGTGGAG<br>AAUTUAUAUAUAGUUUTUTTUAGGUUTGAGATGAGGGRGGGTUUUUUAUUTUUAG<br>GAATGAAAGGAGAGGTTGGUTU |
| 207 | UUUARGGGGGUAGGUAURGGAGGGGGTGUUUAUAGAGGATAGAGGARGURGAGA<br>AGTGAUUTGGGGAGUUATAGGATGAGGAAGAGAGAAGAGATGAUAGUAGGGGUTG<br>TAGGAGGTUAUUUTUUARGGAGGGAGGGGTGARGGUAGAGGXGTURGUAGGAGUT<br>GGTAURGGTGGGGUTGUUUUUAGGGGGGGUTGAUAGAGGUAGUAAUTGAGUAGGU<br>AGGGGTGGAGRGAGGTGUUAGUUTGURGTGGAAAGGAGARGUUAGUAGRGGGGGG<br>UUUTUUTGGGGTUUUAGTUUTGUTUT |
| 208 | AGAGUAGGAUTGGGAUUUUAGGAGGGUUUUURGUTGUTGGRGTUTUUTTTUUARG<br>GUAGGUTGGUAUUTRGUTUUAUUUUTGUUTGUTUAGTTGUTGUUTUTGTUAGUUUU<br>UUUTGGGGGUAGUUUUAURGGTAUUAGUTUUTGRGGAXGUUTUTGURGTUAUUUU<br>TUUUTURGTGGAGGGTGAUUTUUTAUAGUUUUTGUTGTUATUTUTTUTUTUTTUUTU<br>ATUUTATGGUTUUUUAGGTUAUTTUTRGGRGTUUTUTATUUTUTGTGGGUAUUUUU<br>TURGGTGUUTGUUUURGTGGG |
| 209 | TGAUAUTUAGGATUUAAAAGUTAGUUUTGUUUAUUUUAGUUUUTUUAUUTUUTTA<br>UUTGGGTGTGUAUUTGUTURGGGGGGTGGAGGTGUTUUUUAUAGTURGGGUUAGG<br>AUAGUUTUAGGGGAGAGTGAAGGUUTGUAGGAGGGUAGGXGAGAUAAGGAGGGT<br>GTUUAGGGUTAGGGAGTGURGGATGAAAUUAGUTUTGTUUUTGTGUAGGUTUUAG<br>GUTUURGUUTGAUAAAUAGGUAGGGAGUUAUAGTUAGGGAUAATAAAAAUTTGGT<br>GUAUTUTGAAAGUAGUAUTTGGAUAG |
| 210 | TGTUUAAGTGUTGUTTTUAGAGTGUAUUAAGTTTTTATTGTUUUTGAUTGTGGUT<br>UTGUUTGTTTGTUAGGRGGGAGUUTGGAGUUTGUAUAGGGAUAGAGUTGGTTTUAT<br>URGGUAUTUUUTAGUUUTGGAUAUUUTUUTTGTUTXGUUTGUUUTUUTGUAGGUUT<br>TUAUTUTUUUUTGAGGUTGTUUTGGUURGGAUTGTGGGGAGUAUUTUUAUUUUURG<br>GAGUAGGTGUAUAUUUAGGTAAGUAGGTUUAGGGGUTGGGGTGGGUAGGGUTAGU<br>TTTTGGATUUTGAGTGTUAU |
| 211 | UAAATAAGTAGTTAUUTUAGAAGTUAUTTARGTAAAAGAUTUATTUUUUAAAARGU<br>UAGGUAUATGGATTATUAUTGTGTTATTUAARGARGATAUAATGGUAUAGAATGTA<br>TUATAUTGAGAAGTGAGTGUUUTUTURGGGAUATAUTXGTUAGTGAGTUATUUAGU<br>AUTAGAAUAUTGGAGATATAAATAAATAUUAUUTUTTUTAAAAUAGTUTGAAATTU<br>AAGTGGTUATAAUUTAGAGUATUATGGURGGGUATGGTGGUTUATGUUTGTAAUUU<br>UAGUATGAGGUTGAGATGGG |
| 212 | UUATUTUAGUUTUATGUTGGGGTTAUAGGUATGAGUUAUUATGUURGGUUATGATG<br>UTUTAGGTTATGAUUAUTTGAATTTUAGAUTGTTTTAGAAGAGGTGGTATTTATTTAT<br>ATUTUUAGTGTTUTAGTGUTGGATGAUTUAUTGAXGAGTATGTUURGGAGAGGGUA<br>UTUAUTTUTUAGTATGATAUA1TUTGTGUUATTGTATRGTRGTTGAATAAUAUAGTG<br>ATAATUUATGTGUUTGGRGTTTTGGGGAATGAGTUTTTTARGTAAGTGAUTTUTGAG<br>GTAAUTAUTTATTTGA |

-continued

| SEQ ID NO: | Sequence |
|---|---|
| 213 | GTUUTUAUATTTGAUTURGGATAAAUUTUTTUAAATATTTTAUAGAUTUTGGUTTTU<br>TRGTTAAUAAGUAGUTUAUAUATATAGTGTUTUAGUAGTGAUAGATGUTGGUUUAU<br>UURGAGGTUAGGATGAUTUAGUAGGGATTGAGTTTGXGGGRGTUATGUTUUAAGGU<br>URGGAATAGGAGUTTGGTGUTUATTUUTUAUATAGTGGGUAAATUUTAGGGUAGGG<br>GAGGGGGGGUAATGUUAGAGAATGGTUUUUAUUTGGGGRGGTUTGARGGUUAGAG<br>ATGUAGAGAAAGAGARGUUT |
| 214 | AGGRGTUTUTTTUTUTGUATUTUTGGURGTUAGAURGUUUUAGGTGGGGAUUATTU<br>TUTGGUATTGUUUUUUUTUUUUTGUUUTAGGATTTGUUUAUTATGTGAGGAATGAG<br>UAUUAAUUTUUTATTURGGGUUTTGGAGUATGARGUUXGUAAAUTUAATUUUTGUT<br>GAGTUATUUTGAUUTRGGGGTGGGUUAGUATUTGTUAUTGUTGAGAUAUTATATGT<br>GTGAGUTGUTTGTTAARGAGAAAGUUAGAGTUTGTAAAATATTTGAAGAGGTTTATU<br>RGGAGTUAAATGTGAGGAU |
| 215 | GAAAGUAGUUUTUTUUUTGUUUTGTAAGGTGATUUURGATURGGGAATTUUUAUTT<br>UTGAAGGARGTTUTGGAAAAGTGUAUAGATTAAUTGAGATTUUTGUTTUTGGATUA<br>AGUAUTUUTGAUAUTATXGTTURGATTTTUTAAAAAAGAGATTGTGGUAAAATUTA<br>UUTXGTGAGATUAGAAAATGUAGUAGGGATGAATUAURGGUUUTUTUAGAUUTUA<br>UUAGUUTUUAGGUUATTUUTAAGAGUUTUAUTUUTURGTTUTGTTGGUAGTGGGGG<br>AGGTARGGGGURGGATGGUA |
| 216 | TGUUATURGGUUURGTAUUTUUUUUAUTGUUAAUAGAARGGAGGAGTGAGGUTUT<br>TAGGAATGGUUTGGAGGUTGGTGAGGTUTGAGAGGGURGGTGATTUATUUUTGUTG<br>UATTTTUTGATUTUAUXGAGGTAGATTTTGUUAUAATUTUTTTTTTAGAAAATRGGA<br>AXGATAGTGTUAGGAGTGUTrGATUUAGAAGUAGGAATUTUAGTTAATUTGTGUAU<br>TTTTUUAGAARGTUUTTUAGAAGTGGGAATTUURGGATRGGGGATUAUUTTAUAGG<br>GUAGGGAGAGGGUTGUTTTU |
| 217 | AAGAAAAGAGAAAGUUUATUUAGGTAAGGGUAGUUTGGTGAUTATTAUUUTGGGGAGAUTU<br>UUUAUUUAUAUTGUUAUTUUAGGUTUAUURGAGGGUTGUAGUTTUUTURGGATGGATUUAG<br>GGXGGUTAUTGGTUUUAGAGUTGGGGGUTGAGTGGGUURGTGUXGAGGGUTGTGGXGTUTG<br>AUAAGURGGUTUUUAUTGTGAGUAGGGAAGGGRGGATGGGRGGGGGUUARGGUTGUUUTGG<br>UTUUUUAUUUTGUTGTGUTTUTUTUTAUTUUUUTGUUUTGUUTUUTAAUAUUUAGT |
| 218 | AUTGGGTGTTAGGAGGUAGGGUAGGGGAGTAGAGAGAAGUAUAGUAGGGTGGGGAGUUAG<br>GGUAGURGTGGUUUURGUUUATURGUUUTTUUUTGUTUAUAGTGGGAGURGGUTTGTUAGA<br>XGUUAUAGUUUTXGGUARGGGUUUAUTUAGUUUUUAGUTUTGGGAUUAGTAGUXGUUUTG<br>GATUUATURGGAGGAAGUTGUAGUUUTRGGGTGAGUUTGGAGTGGUAGTGTGGGTGGGGAG<br>TUTUUUUAGGGTAATAGTUAUUAGGUTGUUUTTAUUTGGATGGGUTTTUTUTTTTTTIT |
| 219 | UTGAGGUAGGGUTGUAGGUTUAGGAGGAGGAGATGGGTGGAGAGAGAAUAAGUTTT<br>AUUURGGGAGGGTGAUTAUAGGAGAAATGGGUUUUTUAAGTATGUTGATTTUXGU<br>UTUAUTGUTGUUTGTUUTUXGUUUAUUTURGGUTUTGGUTUATUTGUTUTTGTAAG<br>UAGGGTUUTGGGUTGGGTGUTGUAGGXGUATGAGGAAAGTGGGAGURGGGARGGG<br>GUAGUTUAGGGUARGUUUTUUAAUAUTGRGUTURGAGGAUUTUAGRGGTTTTAUTU<br>AGGGGTGUUAUTGAGGUAUAGU |
| 220 | GUTGTGUUTUAGTGGUAUUUUTGAGTAAAAURGUTGAGGTUUTRGGAGRGUAGTGT<br>TGGAGGGRGTGUUUTGAGUTGUUURGTUURGGUTUUUAUTTTUUTUATGXGUUTGU<br>AGUAUUUAGUUUAGGAUUUTGUTTAUAAGAGUAGATGAGUUAGAGURGGAGGTGG<br>GXGGAAGAGUAGGUAGUAGTGAGGXGGAAATUAGUATAUTTGAGGGGUUUATTTU<br>TUUTGTAGTUAUUUTUURGGGGTGAGUTTGTTUTUTUTUUAUUUATUTUUTUUTUUT<br>GAGUUTGUAGUUUTGUUTUAG |
| 221 | GUUUAGGUTGGAGTGUAGTGGRGTGATUTTGGUTUAUTGUAAUUTUTGUUTUURGG<br>GTTUAAGRGATTUTULTTGUUTUAGUUTUUUAGATAUUTGGGATTAUAGGTGTGTGA<br>UAUUATAUUUAGUTAATTTTTGTATTTTTAGTAGAGAXGGUUATGTTAGTUAGGUTG<br>GTUTTGAAUTUUTGAUUTUAGTGATTUAURGGUUTUAGUUUUUAAAGTGUTGGTAT<br>TATAGTUATGAGUUAUTGUAUURGGUUTUTGUTTTTGUTTUUTTAGTGGUATUUUAU<br>TGUUTTGUTTTUAAUATT |
| 222 | AATGTTGAAAGUAAGGUAGTGGGATGUUAUTAAGGAAGUAAAAGUAGAGGURGGG<br>TGUAGTGGUTUATGAUTATAATAUUAGUAUTTTGGGGGUTGAGGURGGTGAATUAU<br>TGAGGTUAGGAGTTUAAGAUUAGUUTGAUTAAUATGGUXGTUTUTAUTAAAAATAU<br>AAAAATTAGUTGGGTATGGTGTUAUAUAUUTGTAATUUUAGGTATUTGGGAGGUTG<br>AGGUAGGAGAATRGUTTGAAUURGGGAGGUAGAGGTTGUAGTGAGUUAAGATUAR<br>GUUAUTGUAUTUUAGUUTGGGU |
| 223 | GUUAUTUTATAAAAATGAAGAGUAGAGUTRGAGTGUTTATAAUARGTUATTTTTAU<br>UUAAGAUAGAGAAGAAAAARGAAAGAGAGUUTGAGUATTUUTTTGAUTUUUTUUA<br>UUUURGGAAGGTATATTUAGAGTUTUUAAGAUTGUUTUXGUUUAUTUAUATGTTrA<br>TGGUURGGTGAGAURGUATUUTUUUTTTUTATATUTGTUUUTTTTUTGGATGUAGGG<br>AUAUAGAATUUUUTAAGTGGGAAGAGUTTTGGAGTGGAGGUTGTTUAAAGTTUTGT<br>GGTGATTAATTATTAUUTAU |

-continued

| SEQ ID NO: | Sequence |
|---|---|
| 224 | TAGGTAATAATTAATUAUUAUAGAAUTTTGAAUAGUUTUUAUTUUAAAGUTUTTUU<br>UAUTTAGGGGATTUTGTGTUUUTGUATUUAGAAAAGGGAUAGATATAGAAAGGGAG<br>GATGRGGTUTUAURGGGUUATAAAUATGTGAGTGGGXGGAGGUAGTUTTGGAGAUT<br>UTGAATATAUUTTURGGGGGTGGAGGGAGTUAAAGGAATGUTUAGGUTUTUTTTRG<br>TTTTTUTTUTUTGTUTTGGGTAAAAATGARGTGTTATAAGUAUTRGAGUTUTGUTUTT<br>UATTTTTATAGAGTGGUT |
| 225 | ATTAAAAUAGUAAAUTUUAGGUUUAAAGTAGGTTTUAGTUTUTATTAAGATAAUAA<br>AAGGTUUTAAATGUUAGGUUTGGGRGUAAAUTGTGUAGAUAAGRGGGTGGURGGA<br>GAAGGAGGGGGGTUAAGGAAGAGAGGGAAAUTUAATTGAXGGTTAUTTTTTTTTUA<br>GAGTTATTTURGGTGGGTUTGUUUUUAUUUUTUAAUAAATTTTGTTGUTUTGA<br>TUUAGGUATAAAAAGTGAGGUUUTGGAGGGUUUUTGAGAUUAGRGTUUTGUAUAG<br>TGAUATGGUAUAGTGAUATGG |
| 226 | UUATGTUAUTGTGUUATGTUAUTGTGUAGGARGUTGGTUTUAGGGGUUUTUUAUUG<br>UUTUAUTTTTTATGUUTGGAATGUUUAGAGUAAUAAAATTrGTTGAGGGGTGGGGG<br>UAGAUUUAURGGAAATAAUTUTGAAAAAAAAGTAAUXGTUAATTGAGTTTUUUTUT<br>UTTUUTTGAUUUUUUTUUTTUTURGGUUAUURGUTTGTUTGUAUAGTTTGRG<br>GGUUTGGUATTTAGGAUUTTTTGTTAUTTTAATAGAGAUUGAAAUUTAUTTTGGGUU<br>TGGAGTTTGUTGTTTTAAT |
| 227 | GGUTUTGAGAGTGUTGGAAUUAAURGGARGGGGTUAGUUUUAUUATGGGAUUTGG<br>URGATGAGTUATUTUTUTGAAGGRGTUTTUUUTTUTGTGAAGTGGGGAAGGTAAUT<br>GTUATUUUAUAGGGRGATTGTGGGUAUURGGGAGAUUXGUTGAGGGATGUTGUAG<br>TGTAGAAGUTTUUUAAATUTARGUTGUTTUTUTTUUTUUTUAGTUUTUTUURGUTGU<br>TGUUUTURGGTTUATGUUUTGTGGUTGATUUATUAURGGUTUTUUARGGUUTTUAU<br>UTTGGGRGGGTTGGATGGUTG |
| 228 | AGUUATUUAAUURGUUUAAGGTGAAGGURGTGGAGAGURGGTGATGGATUAGUUA<br>UAGGGUATGAAURGGAGGGUAGUAGRGGGAGAGGAUTGAGGAGGAAGAGAAGUA<br>GRGTAGATTTGGGAAGUTTUTAUAUTGUAGUATUUUTUAGXGGGTUTUURGGGTGU<br>UUAUAATRGUUUTGTGGGATGAUAGTTAUUTTUUUUAUTTUAUAGAAGGGAAGARG<br>UUTUAGAGAGATGAUTUATRGGUUAGGTUUUATGGTGGGGUTGAUUURGTURGGT<br>TGGTTUUAGUAUTUTUAGAGUUU |
| 229 | GURGURGUTTTTUUAGTUTTGUUUAAUURGGTATTTUTGRGUTTGUUTUAGUUAUUR<br>GUAGGAGRGUAGGURGUUUTTRGTUUTUURGTUUTUTGRGUUUAUAGGAUUURGG<br>GUUURGUUUAGTURGUAGGTUURGUAGGTUUUUURGGGXGTGTUTTUUTGGUUUTG<br>RGAUUUURGGGAUAGRGUTGAGAAUARGRGGAAGGTGGGGAGARGRGRGGRGUTG<br>GURGGGTUUUTGGRGURGTTUTRGRGGTGUAGUUTGTGUUTGGGAGTURGGURGTU<br>UUAUUTUAGAAUUAGAGUAAA |
| 230 | TTTGUTUTGGTTUTGAGGTGGGARGGURGGAUTUUUAGGUAUAGGUTGUAURGRGA<br>GAARGGRGUUAGGGAUURGGUUAGRGURGRGRGTUTUUUUAUUTTURGRGTGTTUT<br>UAGRGUTGTUURGGGGGTRGUAGGGUUAGGAAGAUAXGUURGGGGGGAUUTGRGG<br>GAUUTGRGGAUTGGGRGGGGUURGGGGTUUTGTGGGRGUAGAGGARGGGAGGARG<br>AAGGGRGGUUTGRGUTUUTGRGGGTGGUTGAGGUAAGRGUAGAAATAURGGGTTG<br>GGUAAGAUTGGAAAAGRGGRGGU |
| 231 | UUTGGGAUAGGUTUAATGGAGGUTGUAGGGUUATUAGURGAUTUUTARGUAGGUT<br>UAGTUAGUAGUUUUUTGGUUAGUUUUAUUUUTGAUTGURGGUUTUAGAAUTGGGA<br>GUTGUTTUUTGGUAGGGUURGUUTUTGUTGGGAGAURGGAXGGTGAGTUAGUUTTA<br>AGUURGGUAUUAGAUUUUTUTGAGGATGGAGUAUUAGUTGGUTGUUUTGAGGUTG<br>UAAAAUTTUTTUUUTRGTGGAGAUAGGGAGGUAUUTUAGAUAUTUAUUURGGAUT<br>UUUTTGAAUAGGGAUAGGGAGGAA |
| 232 | TTUUTUUUTGTUUTTTGTTUAAGGGAGTURGGGGTGAGTGTUTGAGGTGUUTUUUTGT<br>UTUUARGAGGGAAGAAGTTTTGUAGUUTUAGGGUAGUUAGUTUUTGUTUUATUUTU<br>AGAGGGGTUTGGTGURGGGUTTAAGGUTGAUTUAUXGTURGGTUTUUUAGUAGAGG<br>RGGGUUUTGUUAGGAAGUAGUTUUUAGTTUTGAGGURGGUAGTUAGGGGTGGGGU<br>TGGUUAGGGGGUTGUTGAUTGAGUUTGRGTAGGAGTRGGUTGATGGUUUTGUAGUU<br>TUUATTGAGUUTGTUUUAGG |
| 233 | AUAUTGTGGGGUAGGGAGGGGUATUTUTTGAGAAUAAAAGATUUATTTUTRGAUTT<br>TUUAAAUTGGAGAGUTTUTTGAGAGAAAAGAGAGAGAUAGGTAUAGGTUUARGUU<br>AUUUAUAUAUAGUUUTGTGUAUAUAGAURGGAUAUAGGXGTUUAUAGGUAAGTTR<br>GUAGUTGUTUATTTTGTGAAGTGAATGUTGATTTGGGGGURGGGTGGGGTTRGTUTG<br>TAUATRGTGUAUTGTUAGAUUUTTUUTGAAGGATTTTTGTTAUTGAAGTATUAGAAG<br>GUUUTTGTTUTAAGGTGGTG |
| 234 | AUUAUUTTAGAAUAAGGGUUTTUTGATAUTTUAGTAAUAAAAATUUTTUAGGAAGG<br>GTUTGAUAGTGUARGATGTAUAGARGAAUUUUAUURGGUUUUUAAATUAGUAUUU<br>AUTTUAUAAAATGAGUAGUTGRGAAUTTGUUTGTGGAXGUUTGTGTURGGTUTGTG |

-continued

| SEQ ID NO: | Sequence |
|---|---|
| | TGUAUAGGGUTGTGTGTGGGTGGRGTGGAUUTGTAUUTGTUTUTUTUTTTTUTUTUA<br>AGAAGUTUTUUAGTTTGGAAAGTRGAGAAATGGATUTTTTGTTUTUAAGAGATGUU<br>UUTUUUTGUUUUAUAGTGTG |
| 235 | AUUUARGGGGAUAGGGGTUAGAGTAATGGAGTGGAAATGGUAGGTTUAUAATTTTG<br>GUTAUAGUTGUTUUUATUTUTAAGUAAUUUAGGUTURGGGTTGGAGGGTGGRGAUU<br>UUAAGATGRGGUUTUAGURGURGGUXGTGTTTGTGUTUUAGUXGATGAAGXGAGTG<br>UAAAGGGUTGTAUAAARGRGAGGUAUTGAAUAAAUAUTGAGRGTGURGTUUAGAT<br>GTUURGGGGGAGGUTGAGGATUUAUAURGTGGGGAGTGUTUTGUUUUUATGGAGT<br>GAUUTGGRGTURGUUUTUUARG |
| 236 | RGTGGAGGGRGGARGUUAGGTUAUTUUATGGGGGUAGAGUAUTUUUUARGGTGTG<br>GATUUTUAGUUTUUUURGGGAUATUTGGARGGUARGUTUAGTGTTTGTTUAGTGUU<br>TRGRGTTTGTAUAGUUUTTTGUAUTXGUTTUATXGGUTGGAGUAUAAAUAXGGURG<br>GRGGUTGAGGURGUATUTTGGGGTRGUUAUUUTUUAAUURGGAGUUTGGGTTGUTT<br>AGAGATGGGAGUAGUTGTAGUUAAAATTGTGAAUUTGUUATTTUUAUTUUATTAUT<br>UTGAUUUUTGTUUURGTGGGT |
| 237 | RGAGGTGRGGUTGUUURGRGGUTTUUTRGGUTTUURGTUURGRGTGUTTTUUTGGA<br>GTUUUTUUTTURGGAGGUUUTUUTGUUTUUARGTGTGUUUTTUTUUATGTUUAGUA<br>TTRGGGRGUUTUTTGTUTTTUTTUTGTTUUUTGGUTTXGGRGTUUURGGGAGTGTGA<br>UTUURGUAGRGGGGTGUAGUTTTUUTUTGGGATGAGTGAURGGAGGGAAUURGUUT<br>TUURGGGUARGTRGUUAGUUTUTTUUTUTTUTTUUUTAGGUTATUAAGRGGAUTTAT<br>GAUAAGAAGGRGGTGGAT |
| 238 | ATUUAURGUUTTUTTGTUATAAGTURGUTTGATAGUUTAGGGAAGAAGAGGAAGAG<br>GUTGGRGARGTGUURGGGAAGGRGGGTTUUUTURGGTUAUTUATUUUAGAGGAAA<br>GUTGUAUUURGUTGRGGGAGTUAUAUTUURGGGGARGUXGAAGUUAGGGAAUAGA<br>AGAAAGAUAAGAGGRGUURGAATGUTGGAUATGGAGAAGGGUAUARGTGGAGGUA<br>GGAGGGUUTURGGAAGGAGGGAUTUUAGGAAAGUARGRGGGARGGGAAGURGAGG<br>AAGURGRGGGGUAGURGUAUUTRG |
| 239 | TGUAGTGTGTAUAGGAUTUUUTGAAAGGGUTUUUTGGGATGGAGGGTTTTTTGGGGG<br>GGUUTGTGGTTUTTUTUUAGUATGAGTUAUAAAUUAUATUUTUUAUAGTUAGURGG<br>ATUUAAAURGATTTGAURGAGATXGGUTUTTUAATGXGGTUTUURGGGGTGTUUUR<br>GAGGATUTGGUTGGAUTTUUAGAGTAUUTGAGUAAGAUUAGUAAGTAUUTUAURG<br>AUTRGGAATAUAUAGGTAGAUUUTGUUUTGTGGATUUAAGGUTAGGUATUUTGTGA<br>GUTGATAGTTAGGTGGGUTGT |
| 240 | UAGUUUAUUTAAUTATUAGUTUAUAGGATGUUTAGUUTTGGATUUAUAGGGUAGG<br>GTUTAUUTGTGTATTURGAGTRGGTGAGGTAUTTGUTGGTUTTGUTUAGGTAUTUTG<br>GAAGTUUAGUUAGATUUTRGGGGAUAUUURGGGAGAUXGUATTGAAGAGUXGATU<br>TRGGTUAAATRGGTTTGGATURGGUTGAUTGTGGAGGATGTGGTTTGTGAUTUATGU<br>TGGAGAAGAAUUAUAGGUUUUUUUAAAAGUUUTUUATUUUAGGGAGUUUTTTUAG<br>GGAGTUUTGTAUAUAUTGUAU |
| 241 | AGGAGUUTGTGAUUUAGAAATGGTAAGTAAGGTURGATTUTUAUUAAUAAAGUAG<br>GUATGAUUTUAGAUAAGTUUUTAUUUTGUTUTGGGUUTUAGTTTUTUUTTTAGTGA<br>GGAGGTGGGTGAGGGTUUTGTUUTUUTURGGGAAUTGGXGATTTGGGAAGGUAGAG<br>AUATTUUUAGAATUXGURGGAGTUUTGAAAAUAUUUARGUUUTTTGTUUUAGUAAT<br>UUTGAGAAAGGUUAUAUTGATAAAGUTGTGGGTGGUUAGATGAUAGUATTUTTGGG<br>UUTUAGARGAAGTGGGAGGGG |
| 242 | UUUTUUUAUTTRGTUTGAGGUUUAAGAATGUTGTUATUTGGUUAUUUAUAGUTTTA<br>TUAGTGTGGUUTTTUTUAGGATTGUTGGGAUAAAGGGRGTGGGTGTTTTUAGGAUTU<br>RGGXGGATTUTGGGAATGTUTUTGUUTTUUUAAATXGUUAGTTUURGGAGGAGGAU<br>AGGAUUUTUAUUUAUUTUUTUAUTAAAGGAGAAAUTGAGGUUUAGAGUAGGGTAG<br>GGAUTTGTUTGAGGTUATGUUTGUTTTGTTGGTGAGAATRGGAUUTTAUTTAUUATT<br>TUTGGGTUAUAGGUTUUTT |
| 243 | AGUUUTGGUTGAGTGUUUUUUAUTTUUUTGGUTRGAGTTUUUTUAUGAAAAAAUUT<br>GGTGAUTUUTUUTGUAUAGAAUAAAGGUTGAGTGAGGUAUAGTGUUUAGGGGATG<br>AGGAAGGUTGAGUURGGGAUUAGGUAGGAGGAAUUTGUXGTGUAUTUAUTUAGAU<br>TUUTGUAGUAUURGGGGUAGGTGUTUUAUUAGRGGGUAUAGURGUTUAGURGUUT<br>UUTUATUURGURGUAGUUAGTGGATUAUUAUAGUTGTUAGAGAGGUUUAUUAUTT<br>GGUUAURGGGTUTARGUUTGUAGA |
| 244 | TUTGUAGGRGTAGAUURGGTGGUUAAGTGGTGGGUUTUTUTGAUAGUTGTGGTGAT<br>UUAUTGGUTGRGGRGGGATGAGGAGGRGGUTGAGRGGUTGTGUURGUTGGTGGAG<br>UAUUTGUUURGGGTGUTGUAGGAGTUTGAGTGAGTGUAXGGUAGGTTUUTUUTGUU<br>TGGTUURGGGUTUAGUUTTUUTUATUUUUTGGGUAUTGTGUUTUAUTUAGUUTTTG<br>TTUTGTGUAGGAGGAGTUAUUAUUTTTTTTUUTUAGGGAAUTRGAGUUAGGGAAGT<br>GGGGGGUAUTUAGUUAGGGUT |

-continued

| SEQ ID NO: | Sequence |
|---|---|
| 245 | UTUTGGGUTUTUTUUAUAGGGTTGAGGUUAGAGUTATTUTUAGAATUURGURGGAG<br>GGGUUTTGUUTGGAGGAGGGUAUAARGAUAUTTAUTTGTUUUUATUAGUUGAUTG<br>AGGGUTGGGGTTGGGUTGGGTUAUAUAGTTUAGTGUTXGUTUTAAGAGATGTTUUR<br>GGAATAGUTGAGTUAUUTGGGUUAGGGGGTUUAUTGTGGAGAGGAGGAGGTGAGT<br>GGGGTGGGGAGUAGGGUUUUAUUUTUUTUTUUAAGUTAAGGGUTTTTTUUTGGGTG<br>GGUTGGGGUUAUAUUTAGGGUU |
| 246 | GUUUTAGGTGTGGUUUUAGUUUAUUUAGGAAAAAGUUUTTAGUTTGGAGAGGAGG<br>GTGGGGUUUTGUTUUUUAUUUUAUTUAUUTUUTUUTUTUUAUAGTGGAUUUUUTG<br>GUUUAGGTGAUTUAGUTATTURGGGAAUATUTUTTAGAGXGAGUAUTGAAUTGTGT<br>GAUUUAGUUUAAUUUUAGUUUTGGGTUAGUTGATGGGGAUAAGTAAGTGTRGTTG<br>TGUUUTUUTUUAGGUAAGGUUUTURGGRGGGATTUTGAGAATAGUTUTGGUUTUA<br>AUUUTGTGGAGAGAGUUUAGAGU |
| 247 | RGUUUTGGUTUTGGGUTTTUAUUAURGUUTGGGGUUUTGUTTGGAUTUTGUAGUTG<br>TGTUUUAAGGUTGRGUUUTAGATTTGTUTAUTUUTTUUUUTGUUUUUTUUUTGUTTT<br>UTUURGGUUTUTGTAGTUTTUUTGUTUUTUUAUUTAXGTGGUTGUUTTGGGUUUUA<br>TGUAGUTUUTUUUURGGGATGUUUUATGUTUTGTTUTGTGAUTGUUTTAUTUTTGAT<br>UAUUTUTGATGGUTGUTUUAGTGUAGGUAGAAUUUUUAAAGTUUTUTGTTUTUTAU<br>ATGTUUUUUTTTGUUAUU |
| 248 | GGTGGUAAAGGGGGAUATGTAGAGAAUAGAGGAUTTTGGGGGTTUTGUUTGUAUTG<br>GAGUAGUUATUAGAGGTGATUAAGAGTAAGGUAGTUAUAGAAUAGAGUATGGGGU<br>ATUURGGGGGAGGAGUTGUATGGGGUUUAAGGUAGUUAXGTAGGTGGAGGAGUAG<br>GAAGAUTAUAGAGGURGGGAGAAAGUAGGGAGGGGGUAGGGGAAGGAGTAGAUA<br>AATUTAGGGRGUAGUUTTGGGAUAUAGUTGUAGAGTUUAAGUAGGGUUUUAGGRG<br>GTGGTGAAAGUUUAGAGUUAGGGRG |
| 249 | TTTUUTUUTUTUTTTUUTTUUTTUTUUAGTTUUTUUUTTTTUUTUUTTUAUTGTTTGA<br>TTTTTAGUUUTUTGATTTTTTUTTUUTUTTUTUUAUTUTTTATTTUTTTTUATUUTUT<br>UURGGTUUTTTTTTUTGUTTTGTUAUUTUUTTXGTTTTUTTUTUTUTUTGGUTGAUTU<br>AGGGGAURGGAGGTGGGUUTATUTGGAGTGAGTGAGTAAGTGTGTTGGGAGGTGAG<br>GGTGGAGGGUTGGAGGGGGGUAGTGATUTGGUUTGAGUUUUTUUAGTATTGUTUUA<br>GUUUUAGURGUAG |
| 250 | UTGRGGUTGGGGUTGGAGUAATAUTGGAGGGGUTUAGGUUAGATUAUTGUUUUUU<br>TUUAGUUUTUUAUUUTUAUUTUUUAAUAUAUTTAUTUAUTUAUTUUAGATAGGUU<br>UAUUTURGGTUUUUTGAGTUAGUUAGAGAGAGAAGAAAAXGAAGGAGGTGAUAAA<br>GUAGAAAAAAGGAURGGGAGGAGGATGAAAAGAAATAAAGAGTGGAGAAGAGGA<br>AGAAAAAATUAGAGGGUTAAAAATUAAAUAGTGAAGGAGGAAAAGGGAGGAAUTG<br>GAGAAGGAAGGAAAGAGAGGAGGAAA |
| 251 | UTATAUTUTUAGGUUUAGGUUAGGGGRGGUAGUTGUUUUUUTUAUTGUUUUARGU<br>AUAAATUUUTGGTTTUAGTUUAAAURGUTAUTGTGAGUTUUAGATUTGGGTGGGGU<br>URGGAGUUTUUTUATTAGUAUUAGGTGGGATGGUUTTGXGAAGATAAAGUTUTGTU<br>TGGUUUUAGUUUAGGUTGTAGUUURGGGUUUTGUUUUAGGUAGUUTGUUUAGGAT<br>GUTGTGUUAGTTTUTGAUUTTTGUUUAUTGUAGUUAGATGGGGUUATUTGTGGAGU<br>TGGUUTTTTUTUUTTAGAATGA |
| 252 | TUATTUTAAGGAGAAAAGGUUAGUTUUAUAGATGGUUUUATUTGGUTGUAGTGGG<br>UAAAGGTUAGAAAUTGGUAUAGUATUUTGGGUAGGUTGUUTGGGGUAGGGUURGG<br>GGUTAUAGUUTGGGUTGGGGUUAGAUAGAGUTTTATUTTXGUAAGGUUATUUUAU<br>UTGGTGUTAATGAGGAGGUTURGGGUUUUAUUUAGATUTGGAGUTUAUAGTAGRG<br>GTTTGGAUTGAAAUUAGGGATTTGTGRGTGGGGUAGTGAGGGGGGUAGUTGURGUU<br>UUTGGUUTGGGUUTGAGAGTATAG |
| 253 | ARGGGTGTUTGUTUUUAAGUTGGGUAUUUUTUUUUUAGGUTGTGGGAAURGUTGG<br>GUUATTUTGAUUTRGAAUUAGAAATAGUUURGAUUUUUUTUTTTUTUUURGRGUUU<br>UUAGURGGAURGUUUUURGGGAUUUUAGUUAAAUUAUAGXGTURGGUATAGGGU<br>UTUTUUUTTATTGUAUAAURGUTAGGGGAGAUAGAGAGGATGGGGGTUURGGGAA<br>UATGUTGGGGTRGUUAGAUTATGGGARGTAGGGGRGTAGUTUAUUTGTTGGAGAUA<br>GGUURGUTUUTUAUTGGUTGAGTU |
| 254 | GAUTUAGUUAGTGAGGAGRGGGUUTGTUTUUAAUAGGTGAGUTARGUUUUTARGT<br>UUUATAGTUTGGRGAUUUUAGUATGTTUURGGGAUUUUUATUUTUTUTGTUTUUUU<br>TAGRGGTTGTGUAATAAGGGAGAGGUUUTATGURGGAXGUTGTGGTTTGGUTGGGG<br>TUURGGGGGGRGGTURGGUTGGGGGRGRGGGGAGAAAGAGGGGGGTRGGGGUTAT<br>TTUTGGTTRGAGGTUAGAATGGUUUAGRGGTTUUUAUAGUUTGGGGGAGGGGTGUU<br>UAGUTTGGGAGUAGAUAUURGT |
| 255 | GUAGTAAAUAGTUUTATTGTAUAAATATATAGRGRGGGUTGGGRGGGGGRGGTUAA<br>UUURGGTTUUUTGGUARGGGGAUAGGGRGRGUTGGGUURGGUTUTGUAGRGAGUR<br>GGTGGGAGGGUUTAGUTGTGGUUUAGGRGGTGTTGAGUAXGGGURGGGGGRGTUA<br>TAGURGGGGAGGGURGGGUAGRGAGRGGGTGGGRGAGGGGRGAGTUATRGTUTGU |

-continued

| SEQ ID NO: | Sequence |
|---|---|
| | UURGUURGGAGGGGAUUURGGRGGGTGAGGGARGTGGGTGGAGGGAGARGTGGGG<br>AGUTUAGTRGGAGTAGATGATGAA |
| 256 | TTUATUATUTAITTURGAUTGAGUTUUUUARGTUTUUUTUUAUUUARGTUUUTUAUU<br>RGURGGGGTUUUUTURGGGRGGGGUAGARGATGAUTRGUUUUTRGUUUAUURGUT<br>RGUTGUURGGUUUTUUURGGUTATGARGUUUURGGUUXGTGUTUAAUAURGUUTG<br>GGUUAUAGUTAGGUUUTUUUAURGGUTRGUTGUAGAGURGGGUUUAGRGRGUUUT<br>GTUUURGTGUUAGGGAAURGGGGTTGAURGUUUURGUUUAGUURGRGUTATATATT<br>TGTAUAATAGGAUTGTTTAUTGU |
| 257 | AGTTATTTAATAUATGGUUUUAGTGGUAUTAALUTGTUAUTAAGUUTUATGTTUTU<br>UATUUATAAAATGGAGAUUAUAATUATAUUTGUTGUAAAATUUAAAATTUAGAGGT<br>TTUTAUAGRGTGAURGAUAUTGTGUUURGGAGAGTTTXGGUUUTUTUUTGGUTUTG<br>GUUUUUTGGAAUARGTGATGUUUAGUUUAAAUAGTGUUAUAUUUTGUTUTAUAAT<br>GUUTUAARGAGAGTUAUAAUUAAAGATTTTTGAGTUAGAGGAUAATAGAGGAGGT<br>GGGAAUTGGGTAAAXGGAGAGT |
| 258 | UTUTUXGTTTAUUUAGTTUUUAUUTUUTUTATTGTUUTUTGAUTUAAAAATUTTTGG<br>TTGTGAUTUTRGTTGAGGUATTGTAGAGUAGGGTGTGGUAUTGTTTGGGUTGGGUAT<br>UARGTGTTUUAGGGGGUUAGAGUUAGGAGAGGGUXGAAAUTUTURGGGGUAUAGT<br>GTRGGTUARGUTGTAGAAAUUTUTGAATTTTGGATTTTGUAGUAGGTATGATTGTGG<br>TUTUUATTTTATGGATGGAGAAUATGAGGUTTAGTGAUAGGTTAGTGUUAUTGGGG<br>UUATGTATTAAATAAUTG |
| 259 | GAGTTTXGGUUUTUTUUTGGUTUTGGUUUUUTGGAAUARGTGATGUUUAGUUUAAA<br>UAGTGUUAUAUUUTGUTUTAUAATGUUTUAARGAGAGTUAUAAUUAAAGATTTTTG<br>AGTUAGAGGAUAATAGAGGAGGTGGGAAUTGGGTAAAXGGAGAGTUUATGGUUTT<br>TGGAGGTGGGGUAUAGUURGGAGTGAATGAGGGUUUAGAGTTTUUAGAGAAURGA<br>ATATAGATUTGTGTGTGAAGUUTUUAGATATTUTAATGTTGAUAARGAAATUAAATT<br>GAAAAAAAATAAAAATUAATA |
| 260 | ATTGATTTTTATTTTTTTTUAATTTGATTTRGTTGTUAAUATTAGAATATUTGGAGGUT<br>TUAUAUAUAGATUTATATTRGGTTUTUTGGAAAUTUTGGGUUUTUATTUAUTURGG<br>GUTGTGUUUUAUUTUUAAAGGUUATGGAUTUTUXGTTTAUUUAGTTUUUAUUTUUT<br>UTATTGTUUTUTGAUTUAAAAATUTTTGGTTGTGAUTUTRGTTGAGGUATTGTAGAG<br>UAGGGTGTGGUAUTGTTTGGGUTGGGUATUARGTGTTUUAGGGGGUUAGAGUUAGG<br>AGAGGGUXGAAAUTUT |
| 261 | RGGGTGRGGAUURGUUAUUTGURGUAUUUTTUUUTTUUUAAUUUTGUUUTTTUUUU<br>AUUUUUAUUUUAUTTUUUAUUUUUAAUUUURGUTRGGRGUUUUAUTUURGAUUUT<br>GUUTGUURGGGUAUUTRGGGGRGTURGUTRGURGGUTTXGUUTUUAUTTGUUURGG<br>UAGGRGRGRGTGGGUTRGGRGTUURGRGUTUUUTUUTRGAUTGTGRGGUTUURGRG<br>UTGURGGGTTTUUTGTTUAAUAATATAAUUAGGGAGGUAURGGRGGAGAGRGURGG<br>GUAGAAUTTUUTUURGGAUTG |
| 262 | UAGTURGGGAGGAAGTTUTGUURGGRGUTUTURGURGGTGUUTUUUTGGTTATATT<br>GTTGAAUAGGAAAUURGGUAGRGRGGGAGURGUAUAGTRGAGGAGGGAGRGRGGG<br>ARGURGAGUUUARGRGRGUUTGURGGGGUAAGTGGAGGXGAAGURGGRGAGRGGA<br>RGUUURGAGGTGUURGGGUAGGUAGGGTRGGGAGTGGGGRGURGAGRGGGGGTTG<br>GGGGTGGGAAGTGGGGTGGGGGTGGGGAAAGGGUAGGGTTGGGAAGGGAAGGGTG<br>RGGUAGGTGGRGGGTURGUAUURG |
| 263 | GGUAAGGUAGTUTGGGRGURGTUTURGGTUTRGGGGUUTGRGGTRGGGGUAURGRG<br>GTGURGRGTTTGAGURGGTUAGUTUUUTGRGGAAATTAUAGGGGRGUTRGGRGUTG<br>RGGTRGRGUUUUURGGGGUAGRGUURGUTGGTTGGAGGXGTTTAAATTGAAAGUAG<br>UTTTGGGGAGAGGGGGRGGARGRGGGURGURGAGUAAGGGGAGGGGGRGGUURGG<br>UAUAGRGAUUUUATTGTUTGTGUURGURGAGGGGTGGAAUUTTGRGGTGAGUTRGG<br>RGRGGRGUUUUUTUUURGAGU |
| 264 | GUTRGGGGAGGGGGRGURGRGURGAGUTUAURGUAAGGTTUUAUUUUTRGGRGGG<br>UAUAGAUAATGGGGTRGUTGTGURGGGURGUUUUUTUUUUTTGUTRGGRGGUURGR<br>GTURGUUUUUTUTUUUUAAAGUTGUTTTUAATTTAAAXGUUTUUAAUUAGRGGGRG<br>UTGUUURGGGGGGRGRGAURGUAGRGURGAGRGUUUUTGTAATTTURGUAGGGAG<br>UTGAURGGUTUAAARGRGGUAURGRGGTGUUURGAURGUAGGUUURGAGAURGGA<br>GARGGRGUUUAGAUTGUUTTGUU |
| 265 | GGAGGGAGUUTGUAUTUTGGGUAGTGATGTGGAGTUAGAGATTTUUAAGTTUATGG<br>TGUAAGTUTGTGGGAGAGUAGAAUTUAUTTTAUAAAATTGTTGAUAGURGGTGTTG<br>TTAGAGARGGAAAGGGAUAAUUURGGUTUUTUTUUAGGXGTGGAGTUTGTGGGGAT<br>GTGUTTUUAGAAAATGUAGGGTTAAGUAGGAGUTGUAGAGTAGAATUAAATGAUA<br>ATGAUTUAUTGUTGTUAUTAAUAGGUTUTTTGTGGGGGUTGTAGGTGGGAGGRGAT<br>ATGGURGGUAUUTTRGUAUAA |
| 266 | TTGTGRGAAGGTGURGGUUATATRGUUTUUUAUUTAUAGUUUUUAUAAAGAGUUT<br>GTTAGTGAUAGUAGTGAGTUATTGTUATTTGATTUTAUTUTGUAGUTUUTGUTTAAU |

-continued

| SEQ ID NO: | Sequence |
|---|---|
| | UUTGUATTTTUTGGAAGUAUATUUUUAUAGAUTUUAXGUUTGGAGAGGAGURGGG<br>GTTGTUUUTTTURGTUTUTAAUAAUAURGGUTGTUAAUAATTTTGTAAAGTGAGTTU<br>TGUTUTUUUAUAGAUTTGUAUUATGAAUTTGGAAATUTUTGAUTUUAUATUAUTGU<br>UUAGAGTGUAGGUTUUUTUU |
| 267 | GTTUTGGTTRGGUAGAGTGGRGGUAATUTTGUUTUTUTUTUTAGAAUAUUTAAAGA<br>AGUUAGTGAGTGAGUTGUTUATGUAUAURGGGGAGAUUTAUAGARGGATUUAGGA<br>GGAGRGGGAGUTUATTGAUTGUAUAUTTUUAAUURGGXGTGATAGGAAAGTGAGG<br>UUAUUTGTUUTAAGTGUURGGGGGUAGGGGGGTUUATGGAGGAGGGGGRGGGGGU<br>AGGTGTUTGGAUAUAGGGATGUTGGTUTUAGGTGGUAUAGUTGGGGAGAAAAAAU<br>UTATUUATTGUAAAAUATUATTAG |
| 268 | TAATGATGTTTTGUAATGGATAGGTTTTTTUTUUUUAGUTGTGUUAUUTGAGAUUAG<br>UATUUUTGTGTUUAGAUAUUTGUUUURGUUUUUTUUTUUATGGAUUUUUUTGUUU<br>URGGGUAUTTAGGAUAGGTGGUUTUAUTTTUUTATUAXGURGGGTTGGAAGTGTGU<br>AGTUAATGAGUTUURGUTUUTUUTGGATURGTUTGTAGGTUTUUURGGTGTGUATG<br>AGUAGUTUAUTUAUTGGUTTUTTTAGGTGTTUTAGAGAGAGAGGUAAGATTGURGU<br>UAUTUTGURGAAUUAGAAUA |
| 269 | RGTGATUAGAGAUAGAAATUAGUTUUUUTUUTUUUTUAUTGAGUTTGTAGUUAUTT<br>TAAGTATAAUUTGTGTUUTGTGUUAGTTUUAUUATAAATUAGUUUTGAGTTTTTATUR<br>GGRGGUTTATTUTGUTGUUAAAAUUTTUAUAGTTGXGGGAATGGGUUAGGGAGAG<br>AGUURGGAUTTTAUTURGGUTGTGGTGAUTUARGUUTTTGGGAAGGGUTGAGGTAT<br>TTGTUUTTGGATGTGGGGATGUTGTGGUUTUTGGTTGGGAAUAUAGUUTRGTTTTGT<br>UTGUTGGUTUTGGUTTUU |
| 270 | GGAAGUUAGAGUUAGUAGAUAAAARGAGGUTGTGTTUUUAAUUAGAGGUUAUAGU<br>ATUUUUAUATUUAAGGAUAAATAUUTUAGUUUTTUUUAAAGGRGTGAGTUAUUAU<br>AGURGGAGTAAAGTURGGGUTUTUTUUUTGGUUUATTUUXGUAAUTAATGAAGGTT<br>TTGGUAGUAGAATAAGURGURGGATAGAAUTUAGGGUTGATTTATGGTGGAAUTGG<br>UAUAGGAUAUAGGTTATAUTTAAAGTGGUTAUAAGUTUAGTGAGGGAGGAGGGGA<br>GUTGATTTUTGTUTUTGATUARG |
| 271 | UAGTATGUATGTGTUUATTTAAGGUATUTGAGUUUTGGUUTTTGUTGTTUTTUUTTU<br>UTTUTTimURGTRGGGTTGUTGAGUTUAAUATUUUAURGGGUTUUTGUTUUTTAGU<br>TAGUAGTUAGTGUAGAGUTGUTGGGTUUTTUUGUUTXGUTTGGGUAGGUTTUTGTU<br>AATGAGTUAUUAAGUAURGGGAAATAAGTGUAUAGGAAGGAGUAGGTGGUAAGAU<br>UUTGTGGAGGTAGAGAUAGTTUUATTUAGTGAGTGAGUTGTGAUTGUAAATTTGGG<br>AAGGTTUTGGGGGAAGUAA |
| 272 | TTGUTTUUUUUAGAAUUTTUUUAAATTTGUAGTUAUAGUTUAUTUAUTGAATGGAA<br>UTGTUTUTAUUTUUAUAGGGTUTTGUUAUUTGUTUUUUUTGTGUAUTTATTTUURG<br>GTGUTTGGTGAUTUATTGAUAGAAGUUTGUUUAAGXGAGGUAGAAGGAUUUAGUA<br>GUTUTGUAUTGAUTGUTAGUTAAGGAGUAGGAGUURGGTGGGATGTTGAGUTUAGU<br>AAUURGARGGAGAAAGAAGGAAGGAAGAAUAGUAAAGGUUAGGGUTUAGATGUU<br>TTAAATGGAUAUATGUATAUTG |
| 273 | RGGURGRGGGGGRGUUTGGAGGAGGGAAGUUTUTURGGAGGAGAAGAGUTGGGR<br>GGURGURGTAGGAGGAAGRGGAAAGATAAGGGGUUUTRGGUTRGGRGGGGURGUR<br>GGARGUUUAGGAGUUTUAATGGGGAUARGTRGGGTGGGGAXGGAGGUAGUTUUTG<br>TURGGAUAGRGAAAURGRGAGGUUUAGGAGAGRGGUAGUUAGRGRGGUAUAGUU<br>RGGGAGUTGRGGUUUARGURGGAGUUTARGGAUATGGGUTRGGAAGGGAUAAAAA<br>URGGGURGGAGTUAGRGUTGGAGUU |
| 274 | GGUTUUAGRGUTGAUTURGGUURGGTTTTTGTUUUTTURGAGUUUATGTURGTAGG<br>UTURGGRGTGGGURGUAGUTUURGGGUTGTGURGRGUTGGUTGURGUTUTUUTGGG<br>UUTRGRGGGTTTRGUTGTURGGAUAGGAGUTGUUTUXGTUUUUAUURGARGTGTUU<br>UUATTGAGGUTUUTGGGRGTURGGRGGUUURGURGAGURGAGGGUUUUTTATUTTT<br>URGUTTUUTUUTARGGRGGURGUUUAGUTUTTUTUUTURGGAGAGGUTTUUUTUUT<br>UUAGGRGUUUUURGRGGURG |
| 275 | GUATUAUAUATUUUTUUUTGTUTUUUTGUTGUUAAUUAGTTUUAUUAUTGTUUAUU<br>TUTGUUUUAATTUUAUUTUUUARGUUTGUTGUTGUAUUTTGGAUTTGTTTTUUTGAA<br>ATTGUATGUUATUUAUTUTUUUTTUTAUTTUTGUTGXGTUUUTUTTGUUUTATUAGG<br>AUUTGTGGAUTUAGGAUTUURGGGUTTTUTUUUUUATUTUTUTTUUURGTTGGGUU<br>TUAUTAUUATTTUAGUUAUTTTUUTGGUAGUTTUAUTUUTGUUUUAAGAUUUUAGU<br>UTTTUAUUUTUUTGGTTUT |
| 276 | AGAAUUAGGAGGGTGGAGGUTGGGGTUTTGGGGUAGGAGTGAAGUTGUUAGGAAA<br>GTGGUTGAAATGGTAGTGAGGUUUAARGGGGAAGAGAGATGGGGGAGAAAGUURG<br>GGAGTUUTGAGTUUAUAGGTUUTGATAGGGUAAGAGGGAXGUAGUAGAAGTAGAA<br>GGGAGAGTGGATGGUATGUAATTTUAGGAAAAUAAGTUUAAGGTGUAGUAGUAGG<br>RGTGGGAGGTGGAATTGGGGUAGAGGTGUAUAGTGGTGGAAUTGGTTGGUAGUAG<br>GGAGAUAGGGAGGGATGTGTGATGU |

-continued

| SEQ ID NO: | Sequence |
|---|---|
| 277 | GGTGGRGATGUTUTAGUUAUUTGUTTUTUTGTUUTUTTTUAUAUAAATGTATUUTGU<br>TTUTTTUUAGATGTURGGUTTAATGGGAUTGGATTTATUTTUAAAAGTUUTGGTTTG<br>UUTUTGATTGAAAAUUAGTGTGUTUUUUATGGTTAXGGARGGUTGTGUAGGTTTTTG<br>TTTTGTTGAAGGGAATTGGUTUAUTUTGAGTUAGURGTGUAUURGGGUTGUTGATGT<br>AGTUTUAGTGTGATGGTTAAAUTTTAAGTGTUAATTTGAUTGGGUTAAGGAATGUUA<br>GAUATTATTTURGGG |
| 278 | UURGGAAATAATGTUTGGUATTUUTTAGUUUAGTUAAATTGAUAUTTAAAGTTTAA<br>UUATUAUAUTGAGAUTAUATUAGUAGUURGGGTGUARGGUTGAUTUAGAGTGAGU<br>UAATTUUUTTUAAUAAAAUAAAAAUUTGUAUAGURGTUXGTAAUUATGGGGAGUA<br>UAUTGGTTTTUAATUAGAGGUAAAUUAGGAUTTTTGAAGATAAATUUAGTUUUATT<br>AAGURGGAUATUTGGAAAGAAGUAGGATAUATTTGTGTGAAAGAGGAUAGAGAAG<br>UAGGTGGUTAGAGUATRGUUAUU |
| 279 | GGTTTTGGGTGTGGAUATUUUTGGAGGGUTGTTTTAGTGUUUAUAUUAATGUUUTAG<br>TTAAAGAAUUAUUUTGTUUUUTTAGUUTTUTGUAGGAUAGGTGGGAAAGGGURGG<br>GTGTUTGGTUUTGUTGUUAGGGGAUAGTGUAGGTGTGAUXGTURGGGUAGAGATGA<br>GTUAUUUTUUAUAUTGTUTTGUTGUURGTUTUUARGUUTAGTTTTAGUTRGTGTGGT<br>UAAGAAGGGGRGATTUUTUAUUTAGAAUAUATGGGTUAUAAATGUTAUUTTTGAAA<br>ATGGAAAUAAAAATAAUUUA |
| 280 | TGGGTTATTTTTGTTTUUATTTTUAAAGGTAGUAUUAAATGGATTGGTGTGAUUU<br>AGGAATRGUUUUTTUTTGAUUAUARGAGUTAAAAUTAGGRGTGGAGARGGGUAGU<br>AAGAUAGTGTGGAGGGTGAUTUATUTUTGUURGGAXGGTUAUAUUTGUAUTGTUUU<br>UTGGUAGUAGGAUUAGAUAUURGGUUUTTTUUUAUUTGTUUTGUAGAAGGUTAAG<br>GGGAUAGGGTGGTTUTTTAAUTAGGGUATTGGTGTGGGUAUTAAAAUAGUUUTUUA<br>GGATGTUUAUAUUUAAAAUU |
| 281 | UAGAAUUTGAGRGATGAAGTGARGGGATTTAGTUAGGUUTATGAAGAGTUAATGGU<br>AUTTGUUTUUUATAATUUTTUUAGTUUUATTGGUUAAUURGTUTGTUUUTRGRGTG<br>ATUTTTTGGATUTGAAGTGGTGTTTUAGGAUURGGAGXGTGGUUTGUAUTGUUTTG<br>TTUTGTTTGTTTGTGUAURGGATTUATRGTGAUTUATUUTGAGTUATUUAGGUAGTA<br>TGGAAGAAUTTTGGAGTTATTTTAAAUUUTTTGGUTUAGAAUUUUATTTGGAGGAT<br>ATTAAUATGUAAGATAA |
| 282 | TTATUTTGUATGTTAATTUTAGAAGAAATGGGGTTUTGAGUUAAAGGGTTTAAAATA<br>AUTUUAAAGTTUTTUUATAUTGUUTGGATGAUTUAGGATGAGTUARGATGAATURG<br>GTGUAUAAAUAAAUAGAAUAAGGUAGTGUAGGUUAXGUTURGGGTUUTGAAAUAU<br>UAUTTUAGATUUAAAAAGATUARGRGAGGGAUAGARGGGTTGGUUAATGGGAUTG<br>GAAGGATTATGGGAGGUAAGTGUUATTGAUTUTTUATAGGUUTGAUTAAATUURGT<br>UAUTTUATRGUTUAGGTTUTG |
| 283 | GTUUUTTGGUAUUAGGAUATUAUUUTUUUAUUTUTUUUAGAUUUTTUTUUTTGAUU<br>TUTTTAGAGUAGUUATUUTTGGAGTTGUTUAARGUUUTGRXXRGGAAGGTTGAAUR<br>UUAUAGUTTGGUTUATUTAUTTURGGGTTAGUTUAAXGUUUTUTTUTTTTUUUG<br>TGAAUUAUAGUTTGGUTUATUTAUTURGGGTTAGUTUAARGUAUTUTTUTUTUTU<br>UUTUTGAAUUARGGUTTGGUTUATUTAUTTUTGGGTTAATTTAGGUTTTUTUUAUAG<br>ATAGTUTGAAAAGGGA |
| 284 | TUUUTTTTUAGAUTATUTGTGGAGAAAGUUTAAATTAAUUUAGAAGTAGATGAGUU<br>AAGURGTGGTTUAGAGGGAGAAGAGAAGAGTGRGTTGAGUTAAUURGGAAGTAGA<br>TGAGUUAAGUTGTGGTTUAGAGGGAGAAAAGAAGAGGGXGTTGAGUTAAUURGGA<br>AGTAGATGAGUUAAGUTGTGGTTUAGAGGGAGAAGAGAAGAGGGRGTTGAGUAAU<br>TUUAAGGATGGUTGUTUTAAAGAGGTUAAGGAGAAGGGTUTGGGAGAGGTGGGAG<br>GGTGATGTUUTGGTGUUAAGGGAU |
| 285 | UTGAGTUAAUAAGGUTGAUAAGGUTGTGTTUTGGATGUAGGUURGGUAGATGTTTG<br>AGGGGGAGGTGGUUAGUUTGGAGGUUUTUAGGAGUARGGGUUTGGTGRGGGTGUR<br>GAGGUUUATGAAGGTUATRGAUUTGURGGGAGGTGGGGUXGUUTTTGTGATGGAGU<br>ATTTGAAGATGAAGAGUTTGAGUAGGTGAGTGTGTGTGAGAUUUATATGRGUAUAT<br>GTGTAUAGGUAGAGAGAGAUTUAGAGAUAAAUAGAGAGAGAUAGAGAAAGGGAT<br>AGAGATGGGGAGGGAGAUAGAAA |
| 286 | TTTUTGTUTUUUTUUUUATUTUTATUUUTTTUTUTGTUTUTUTUTGTTTGTUTUTGAG<br>TUTUTUTUTGUUTGTAUAUATGTGRGUATATGGGTUTUAUAUAUUTUAUUTGUTU<br>AAGUTUTTUATUTTUAAATGUTUUATUAUAAAGGXGGUUUUAUUTUURGGUAGGTR<br>GATGAUUTTUATGGGUUTRGGUAURGUAUUAGGUURGTGUTUUTGAGGGUUTUU<br>AGGUTGGUUAUUTUUUUUTUAAAUATUTGURGGGUUTGUATUUAGAAUAUAGUUT<br>TGTUAGUUTTGTTGAUTUAG |
| 287 | TTRGTGUAUTUTGRGGURGRGGRGGUAGUAGURGRGGRGGRGGUUAGUTUUURGGT<br>UTARGTGUUUAUUAUURGRGTGGGTTUUATGUTGUURGGUUTAURGTAUUAUUTGU<br>AGGGGTRGGGUAGTGGGUUAGUUAAUUARGRGGGRGGXGRGGGRGRGUAUUURGG |

-continued

| SEQ ID NO: | Sequence |
|---|---|
| | UTGGUUTUAGGUUTRGGURGAUAGUUUTUUATARGGUAGRGGAGGRGGRGRGGUT<br>GGRGGRGGGGURGRGGGGUUTGGRGGRGUTGGUTUAGURGRGGRGUARGTUTRGGR<br>GRGUTTUUUUTAUTUTUUUAGU |
| 288 | GUTGGGAGAGTAGGGGAAGRGRGURGAGARGTGRGURGRGGUTGAGUUAGRGURG<br>UUAGGUUURGRGGUUURGURGUUAGURGRGURGUUTURGUTGURGTATGGAGGGU<br>TGTRGGURGAGGUUTGAGGUUAGURGGGGTGRGRGUURGXGURGUURGRGTGGTTG<br>GUTGGUUUAUTGUURGAUUUUTGUAGGTGGTARGGTAGGURGGGUAGUATGGAAU<br>UUARGRGGGTGGTGGGUARGTAGAURGGGGAGUTGGURGURGURGRGGUTGUTGU<br>RGURGRGGURGUAGAGTGUARGAA |
| 289 | TUTTTGTGTGAGTUATGTUTTATATUUAAUAAGTAUTUAAAAAAAGATTTTTTTTTTT<br>TTTTTTTAAGATGGAGTGTRGUTUTGTUAUUUAGGUTGGAGTGUAGTGGUATGATUT<br>TGGUTUAUTGUAAUUUTGUUTUURGGGTTUAAGXGATTUTTUTGUUTUAGGUTUU<br>TGAGTAGUTGGAATTAUAGGUATGUUUUAUUAUAUURGGUTAATTTTTATATGTAA<br>TAGAAAUAAGGTTTUAUUATGTTGGUUAGAUAGGTUTTGAAUTUUTGAUUTUAGGT<br>GATUUAUUUAUUTRGGU |
| 290 | GURGAGGTGGGTGGATUAUUTGAGGTUAGGAGTTUAAGAUUTGTUTGGUUAAUATG<br>GTGAAAUUTTGTTTUTATTAUATATAAAAATTAGURGGGTGTGGTGGGGUATGUUTG<br>TAATTUUAGUTAUTUAGGAGUUTGAGGUAGAAGAATXGUTTGAAUURGGGAGGUA<br>GAGGTTGUAGTGAGUUAAGATUATGUUAUTGUAUTUUAGUUTGGGTGAUAGAGRG<br>AUAUTUUATUTTAAAAAAAAAAAAAAAAAATUTTTTTTTGAGTAUTTGTTGGATATA<br>AGAUATGAUTUAUAUAAAGA |
| 291 | AUUAUUUUUTGAUUUUTUATGAUTUAUUUAGUTUUTAAGTGUUUUTGGGUAUUUA<br>GTTUTTTGTGGUATGGGURGGTGUAAGTTTUTATATGAGAGUUAGAGAGAUAGGGA<br>GGGAGGUURGGGUTUUTGGUUTTTTGGGAAAAGATGUUXGTUTUAGAUUAGUAAA<br>AGGAGGUAGUTGUTTTAGGAGUURGGGAAAATGUUATUAUTGATAGTATTATTATT<br>ATTTTUUUATTTTUUUTTTGTGTTTTTAAAATGAAAAGTTUAGATUUATGGGGTAGG<br>GTAGAGTGGGUUTGGAGGGAG |
| 292 | TUUUTUUAGGUUUAUTUTAUUUTAUUUUATGGATUTGAAUTTTTUATTTTAAAAAU<br>AUAAAGGGAAAATGGGAAAATAATAATAATAUTATUAGTGATGGUATTTTUURGGG<br>UTUUTAAAGUAGUTGUUTUUTTTTGUTGGTUTGAGAXGGGUATUTTTTUUUAAAAG<br>GUUAGGAGUURGGGUUUUTUUUTGTUTUTUTGGUTUTUATATAGAAAUTTGUAU<br>RGGUUUATGUUAUAAAGAAUTGGGTGUUUAGGGGUAUTTAGGAGUTGGGTGAGTU<br>ATGAGGGGTUAGGGGGTGGTT |
| 293 | GUAGUARGUAGUUUUUAGGGGUUUTAAUTUAUUUUUTUTTUUUTUAUAGGGUTTU<br>UUTGURGTUUAGTGTTGGGTGAGAAAGGTGGAGGGGAUATGTAGUUURGGATGGAG<br>GTGUAGUAUUAARGAGAGAGUTURGGUUTGTGGGAGGGAXGUTUAGGUTTAGGTU<br>AAAGUUAGGAGUTURGGGAAAUUTGGGTTUAGURGUUARGUUUUARGGAGGGGAU<br>AUAUUUTTUUUTGUUTGATGGUAGGGUUUATGGTAGAUAAAAUUUATGAUUTUAU<br>UTUTUUTGGUTUUAGGGUTUAGUU |
| 294 | GGUTGAGUUUTGGAGUUAGGAGAGGTGAGGTUATGGGTTTTGTUTAUUATGGGUUU<br>TGUUATUAGGUAGGGAAGGGTGTGTUUUUTURGTGGGGRGTGGRGGUTGAAUUUA<br>GGTTTUURGGAGUTUUTGGUTTTGAUUTAAGUUTGAGXGTUUUTUUUAUAGGURGG<br>AGUTUTUTRGTTGGTGUTGUAUUTUUATURGGGGUTAUATGTUUUUTUUAUUTTTUT<br>UAUUUAAUAUTGGARGGUAGGGAAGUUUTGTGAGGGAAGAGGGGGTGAGTTAGGG<br>UUUUTGGGGGUTGRGTGUTGU |
| 295 | ATTTUTTTUTAUUTGTUATTGAAGTGAATUATUAGTATAAGTAGRGAGUTGGGRGUA<br>TTUUTTUTUAGTTGTGTTAAAAUTTGUTGGTATTUUUURGGTATUAGUAGAGGTGTG<br>TARGGGUAUTGUTTTAAAAUTGGGAAGGAGGAAGAXGAGGUUAGGGAGURGGAGG<br>GTUAUUAAGGTAGATTTUUAGUAGRGUTAGTUUAGUTGAAUAUTTTUUAGUUTTGT<br>TTTTUAGUAGUTTTGAGGAAAAGTATAGGTAAGAAUAAAGAUAUUAUTGTATGTTT<br>GUTATATGAATGUATAAUA |
| 296 | GTTATGUATTUATATAGUAAAUATAUAGTGGTGTUTTTGTTUTTAUUTATAUTTTTUU<br>TUAAAGUTGUTGAAAAAUAAGGUTGGAAAGTGTTUAGUTGGAUTAGRGUTGUTGGA<br>AATUTAUUUTGGTGAUUUTURGGUTUUUTGGUUTXGTUTGAATTUUUGGUUATTA<br>AAGUAGTGUURGTAUAUAUUTUTGUTGATAURGGGGGAATAUUAGUAAGTTTTAAU<br>AUAAUTGAGAAGGAATGRGUUUAGUTRGUTAUTTATAUTGATGATTUAUTTUAATG<br>AUAGGTAGAAAGAAATG |
| 297 | ATTGGTUTGGTUUTUTTTUTAAUAUUTUUUAUURGGGATGUAGUUAAGAGTGGUTG<br>UAGUUTAATTTTUTAUATGTAAAUAATGAUUTUAGTGATGUUUARGGGGUUUUTUT<br>UTGGUUTTUTUUUUUTGGGAAAAGAUTGAGTTUTRGAXGGGUATUUUUTUUUUUTU<br>RGGAAUUAAGGGUTUTGGGATGTTGAUAGUUUURGUUAUUTUTGAGAAGGGUAGG<br>URGTGGAAAAUUATUTUUTUUUTTUUTTUUUUUTUTGUTUTUUTAGUTGGGGUUT<br>UTGUAUAATGUAGUTGGGUUA |

-continued

| SEQ ID NO: | Sequence |
|---|---|
| 298 | TGGUUUAGUTGUATTGTGUAGAGGUUUUAGUTAGGAAAGGUAGAGGGGGAAGGAA<br>GGGAGGAGATGGTTTTUUARGGUUTGUUUTTUTUAGAGGTGGRGGGGGUTGTUAAU<br>ATUUUAGAGUUUTTGGTTURGGAGGGGGAGGGGATGUUXGTRGAGAAUTUAGTUTT<br>TTUUUAGGGGGAGAAGGUUAGAGAGGGGUUURGTGGGUATUAUTGAGGTUATTGT<br>TTAUATGTAGAAAATTAGGUTGUAGUUAUTUTTGGUTGUATUURGGGTGGGAGGTG<br>TTAGAAAGAGGAUUAGAUUAAT |
| 299 | TTGUUUTUATUTUUAGGUTTTGGAGGAGGGTAGGTGUUTGGUUAGUAGAGTGGUUA<br>UTGUTUAUTGGUUUAGAGGAAGUAAGGUUAUUAGUUTGATUUUAUTTUTUUUTUR<br>GGUUUATUTTUAUTUUUUTUTUUTUAAUUAUAAGUUUXGUUAAAATAGAGAUUUU<br>RGGUTTTGUTUUUUTGUTGUAGGAAGGGAGAGUUAURGUUAGAUAUTGUUTGUUT<br>GGTUUTUUTGTTUTGATUTUAUURGGTGUTTGGAATUAAAGAGGAUUTGGUTTUUU<br>TUTRGGGATARGTGATTTTUTTT |
| 300 | AAGAAAATUARGTATUURGAGAGGGAAGUUAGGTUUTUTTTGATTUUAAGUAURGG<br>GTGAGATUAGAAUAGGAGGAUUAGGUAGGUAGTGTUTGGRGGTGGUTUTUUUTTU<br>UTGUAGUAGGGGAGUAAAGURGGGGGTUTUTATTTTGGXGGGGUTTGTGGTTGAGG<br>AGAGGGGAGTGAAGATGGGURGGAGGGAGAAGTGGGATUAGGUTGGTGGUUTTGU<br>TTUUTUTGGGUUAGTGAGUAGTGGUUAUTUTGUTGGUUAGGUAUUTAUUUTUUTUU<br>AAAGUUTGGAGATGAGGGUAAG |
| 301 | GUUUAGATUAGGUAGRGGGGTRGUUUTUTUUAGGAUTUTUAAGGUAGUTAAGGUT<br>GGAGGRGURGGRGAGUUTGGAGAGGGAGGAGTTUAUTAAATTGTGTTGGATGGAAG<br>GRGTRGAGGAURGGAGGAATTAATURGATGTGGGGAAGGXGGARGGGGUTARGAG<br>GAAAAAAGAGGGGGUAATGTAUAUTUAGUUTTTUATUAUTRGGRGGGGAGATGGA<br>TGGTTTTURGGAURGGGRGTUUUAGRGUUURGGTTAGUTATAGGGAGARGTUAGAG<br>RGUTUTGGTURGRGATAGAAGA |
| 302 | TUTTUTATRGRGGAUUAGAGRGUTUTGARGTUTUUUTATAGUTAAURGGGGRGUTG<br>GGARGUURGGTURGGAAAAUUATUUATUTUUURGURGAGTGATGAAAAGGUTGAG<br>TGTAUATTGUUUUUTUTTTTTTUUTRGTAGUUURGTUXGUUTTUUUUAUATRGGATT<br>AATTUUTURGGTUUTRGARGUUTTUUATUUAAUAUAATTTAGTGAAUTUUTUUUTUT<br>UUAGGUTRGURGGRGUUTUUAGUUTTAGUTGUUTTGAGAGTUUTGGAGAGGGRGAU<br>UURGUTGUUTGATUTGGGU |
| 303 | ATTTGGUTTGATUTTATTTTTAATATTTTTTAUAUTTTUTUTUTAAAGAAAA<br>RGAGTGAATATRGTGATGGGTGUAGTTATGUTGAATAATTGGATGGGAGGARGTGU<br>UAGGRGATUTUUAGUUUUTGGGAGURGGARGUUUAXGUTTTUUUTUTGUUTRGTTUT<br>UAUAGAUAUATTTGTGGGGTGATTAAUTUAGGAATTUATGUTGUTUAAAGTAAUTA<br>UAGTGGTGAGTGTTTTGAURGGTTTGATGTAGAAATUAAGGAAAAUAUUAGAAAAA<br>TUAGGGGRGGAGGUUUAA |
| 304 | TTGGGUUTURGUUUUUGATTTTTUTGGTGTTTTUUTTGATTTUTAUATUAATTGT<br>AAAAUAUTUAUUAUTGTAGTTAUTTTGAGUAGUATGAATTUUTGAGTTAATUAUUU<br>UAUAAATGTGTUTGTGAGAARGAGGUAGAGGGAGGXGTGGGRGTURGGUTUUUAG<br>GGGUTGGAGATRGUUTGGUARGTUUTUUUATUUAATTATTUAGUATAAUTGUAUUU<br>ATUARGATATTUAUTRGUUTTTTTTTUTTTAGAGAGAAAGTGTAAAAAATATTAAA<br>AATAAGATUAAGUUAAAT |
| 305 | TGAUTTTTTUATTTUTUTUAAGATGATUATTAGGAGTGGTTTUAAUAAAAUTGAAUA<br>UAGAATTTTGAGGGUUUUAATUATGAUTUAAUUAGAGUUUTUUUTGAATTUTTUAT<br>GAGTUAGUURGGUUUTUUUUAUTGAUTTUAUUUTAGXGGGUAUUTGTUTTTUTTUT<br>TUTTTTATUAUTTTTTGUTTUTUTTTTGGTTTUUAGUTUTGGTTTTUTUUGAATA<br>UAUUTTUUAATTUTTUURGGUUUUUTUAGGGAAAUUUAGAGGUAAATTTGAGTGUA<br>GGGAGRGGGGGUTTRGU |
| 306 | GRGAAGUUUURGUTUTUTGUAUTUAAATTTGUUTUTGGGTTTUUUTGAGGGGGURG<br>GGAAGAATTGGAAGGTGTTGGGTUTGAATTUAGTUAGAGUTGGAAAUUAAAAGAGA<br>AGUAAAAAGTGATAAAAGAAGAAGAAAGAUAGGTGUUXGUTAGGGTGAAGTUAGT<br>GGGGAGGGURGGGUTGAUTUATGAAGAATTUAGGGAGGGUTUTGGTTGAGTUATGA<br>TTGGGGUUUTUAAAATTUTGTGTTUAGTTTTGTTGAAAUUAUTUUTAATGATUATUT<br>TGAGAGAAATGAAAAAGTUA |
| 307 | GGTGTUAGGAGTGGUUUAGGAGAGUAUUURGTTUUURGGUURGUAGGTGGTGTTTG<br>UTGGUTUUAGUAGGGUUAGGAGGUUAUUTGUAGUUTGGTGUTUUAGAUTGATGTU<br>AUURGGGURGAGTGUTGTGUUTURGGUAAUATTGAUAUXGUUTGGTUUAAUUTUA<br>UUUAUURGGGGAAUAAGATUAAUUTUUTRGGUTTTTTTGGGUUTTGTUUAUTGUUTT<br>UUUTGUAAAGGTGAGAUUTUAGGUUAGAAGUAGGGUAGARGTUTUAGUTUAGGAU<br>UAGUUAUAAAUAGTUATGGTGGT |
| 308 | AUUAUUATGAUTGTTTGTGGUTGGTUUTGAGUTGAGARGTUTGUUUTGUTTUTGGU<br>UTGAGGTUTUAUUTTTGUAGGGAAGGUAGTGGAUAAGGUUUAAGAAGURGAGGAG<br>GTTGATUTTGTTUUURGGGTGGGTGAGGTTGGAUUAGGXGGTGTUAATGTTGURGG<br>AGGUAUAGUAUTRGGUURGGGTGAUATUAGTUTGGAGUAUUAGGUTGUAGGTGGU |

-continued

| SEQ ID NO: | Sequence |
|---|---|
| | UTUUTGGUUUTGUTGGAGUUAGUAAAUAUUAUUTGRGGGURGGGGAARGGGGTGU<br>TUTUUTGGGUUAUTUUTGAUAUU |
| 309 | GUAGUUUTUTTUAUUTGUUTGGTGAUTUAUTAUAAGUUUTGGGGGAAGGAATGGU<br>AGTGGUUUTUTTUAUUTTTAUTGUUTUTGRGGUUAUAATGGGUAGTTGAUATAAUU<br>AUUTGUAGGUUURGGGAGUUATXGGGGUUTUTTGAUAXGTGUTUATTAGTGGUTTU<br>TGAGGAGRGUUTGUUUUAUUTGUUUUAXGTGUUUUUAXGTUTGGUUAUTUUAGGG<br>TUUATTAGRGUTAATRGGUAAATGUUTGTGUTUTUATUTAURGGGAAAAUATUTUU<br>UTTUTUUAGAGRGGAGGUUAGU |
| 310 | UTGGUUTURGUTUTGGAGAAGGGAGATGTTTTUURGGTAGATGAGAGUAUAGGUAT<br>TTGURGATTAGRGUTAATGGAUUUTGGAGTGGUUAGAXGTGGGGGUAXGTGGGGUA<br>GGTGGGGUAGGRGUTUUTUAGAAGUUAUTAATGAGUAXGTGTUAAGAGGUUUXGA<br>TGGUTUURGGGGUUTGUAGGTGGTTATGTUAAUTGUUUATTGTGGURGUAGAGGUA<br>GTAAAGGTGAAGAGGGUUAUTGUUATTUUTTUUUUUAGGGUTTGTAGTGAGTUAUU<br>AGGUAGGTGAAGAGGGUTGUT |
| 311 | GTGGUUUTUTTUAUUTTTAUTGUUTUTGRGGUUAUAATGGGUAGTTGAUATAAUUA<br>UUTGUAGGUUURGGGAGUUATRGGGGUUTUTTGAUAXGTGUTUATTAGTGGUTTUT<br>GAGGAGRGUUTGUUUUAUUTGUUUUAXGTGUUUUUAXGTUTGGUUAUTUUAGGGT<br>UUATTAGRGUTAATRGGUAAATGUUTGTGUTUTUATUTAURGGGAAAAUATUTUUU<br>TTUTUUAGAGRGGAGGUUAGUUTAAAAAUUAGGUURGUAGUUTURGAGGUTUTGA<br>AAAUUAAGRGGUTGTTUTGGTU |
| 312 | AUUAGAAUAGURGUTTGGTTTTUAGAGUUTRGGAGGUTGRGGGUUTGGTTTTTAGG<br>UTGGUUTURGUTUTGGAGAAGGGAGATGTTTTUURGGTAGATGAGAGUAUAGGUAT<br>TTGURGATTAGRGUTAATGGAUUUTGGAGTGGUUAGAXGTGGGGGUAXGTGGGGUA<br>GGTGGGGUAGGRGUTUUTUAGAAGUUAUTAATGAGUAXGTGTUAAGAGGUUURGA<br>TGGUTUURGGGGUUTGUAGGTGGTTATGTUAAUTGUUUATTGTGGURGUAGAGGUA<br>GTAAAGGTGAAGAGGGUUAUT |
| 313 | ATGGGUUUTGGGGURGURGUUTUAGTGTUTTUTGGTGUTGUAGURGGGUAGGGURG<br>AAUUUTGGRGUAUAGUTTUUTGUTGAGTUTUUUTUTUTAAGGUTGTUTGTGGGRGG<br>UTUTGURGGUUUUTUUTGUAUUTGUUUAGGUUUTGGGXGGAGGUTUUTUUTUURG<br>GGGGGGUTGTGGUUTUAGUAUAGAUUAGGGGAUAGAAGGTGGUTUTTUTTGGUUTT<br>GGUTGGGTGTGAAUUAAAGAUTTUUTGTAAGAAATUUUUUTUTUUUTUTUUUTUUT<br>TRGUTUUUTUATUTUTUTUUU |
| 314 | GGGAGAGAGATGAGGGAGRGAAGGAGGGAGAGGGAGAGGGGGATTTUTTAUAGGA<br>AGTUTTTGGTTUAUAUUUAGUUAAGGUUAAGAAGAGUUAUUTTUTGTUUUUTGGTU<br>TGTGUTGAGGUUAUAGUUUUUURGGGAGGAGGAGUUTUXGUUUAGGGUUTGGGUA<br>GGTGUAGGAGGGGURGGUAGAGURGUUUAUAGAUAGUUTTAGAGAGGGAGAUTUA<br>GUAGGAAGUTGTGRGUUAGGGTTRGGUUUTGUURGGUTGUAGUAUUAGAAGAUAU<br>TGAGGRGGRGGUUUUAGGGUUUAT |
| 315 | UAUTGGAUUATUUAUAUAAUTTTTGAGGATUAGTGGAAATGAAAAUARGGTGUUUR<br>GGUAUAAAAUATATTTUATAGUTTGGGTTAGGUAAUAGUAAAGUATUARGUTGAGR<br>GURGGGAUUTTUTGAGTGUAGGXGGTGGGXGAAGUUURGAGTUAUAUAUAUUUAR<br>GAXGURGGUUUTGUTUUUAUAGRGGUUUTUTGGGGTAGRGAUTGGTATTAUUTGUA<br>TTTUARGAGGGAGGAAAUTGAGGUARGAAUTGTTUAGAAGUTGUUUTGAGGTUAUU<br>AAGTGAGUTAGGAAGAGGRGT |
| 316 | RGUUTUTTUUTAGUTUAUTTGGTGAUUTUAGGGUAOUTTUTGAAUAGTTRGTGUUT<br>UAGTTTUUTUUUTRGTGAAATGUAGGTAATAUUAGTRGUTAUUUUAGAGGGURGUT<br>GTGGGAGUAGGGURGGXGTRGTGGGTGTGTGTGAUTRGGGGUTTXGUUUAUXGUUT<br>GUAUTUAGAAGGTUURGGRGUTUAGRGTGATGUTTTGUTGTTGUUTAAUUUAAGUT<br>ATGAAATATGTTTTGTGURGGGGUAURGTGTTTTUATTTUUAUTGATUUTUAAAAGT<br>TGTGTGGATGGTUUAGTGT |
| 317 | UTUUAGTGTGUUTUAGTTGGTTTATUTGTAAAAATGGGGUUAGGUUARGAUTGGTG<br>TTUUUTTTAUAGAGAAGUAUTUUAGGUAGGGGTGGGTGGGGGTGGAAUTRGTTUTU<br>AATGGUUUURGGGAUAGUUUTGUAGUUAURGGTGAUTXGGGTTXGTUTGRGGATUT<br>TTUURGGUUTUUAUTUUATTUAGGGAUAGUUUTGUAATGGGGUTUUUTUUUAAAA<br>AAARGUATGGUUTTUUTGTUUUUUAAAAUUAGUTTAARGGUAGUUATTUUUTUUUT<br>UUTURGGGGGUTGAAAAAUUA |
| 318 | GGTTTTTUAGUUUURGGAGGAGGGAGGGAATGGUTGURGTTAAGUTGGTTTTGGGG<br>GAUAGGAAGGUUATGRGTTTTTTTGGGAGGGAGUUUUATTGUAGGGUTGTUUUTGA<br>ATGGAGTGGAGGURGGGAAAGATURGUAGAXGAAUUXGAGTUAURGGTGGUTGUA<br>GGGUTGTUURGGGGGUUATTGAGAARGAGTTTTUAUUUUUAUUUAUUUUTGUUTGG<br>AGTGUTTUTUTGTAAAGGGAAUAUUAGTRGTGGUUTGGUUUUATTTTTAUAGATAA<br>AUUAAUTGAGGUAUAUTGGAGG |
| 319 | UAUTUARGGGUTAGUTURGTUAGGTGTTGARGGATGTUAUTUAGGTGTGAGUTUTG<br>UAUUTGAGUTUUUUUUTGUAUAUAGGUAGUUAUAAUUAGTUAGTGUAGAGGTGAG |

-continued

| SEQ ID NO: | Sequence |
|---|---|
| | UTTTGTGGUUAGTGAGGAGURGGTGAGTUAAUUTUUTUUXGUUTARGGGUUUTGAG<br>ARGURGGUTURGTGAGUTTGRGGGGTRGAGGGRGUUTATATTAAGUUAAGGUTGAG<br>GUAGTGAUAUAUUUTUTTATGGGUUTGUTUTRGUTTUUTGUTTUATTGTUUTGGTUT<br>UTUUUTUTRGTATGGAGGATUA |
| 320 | TGATUUTUUATARGAGAGGGAGAGAUUAGGAUAATGAAGUAGGGAGRGAGAGUAG<br>GUUUATAAGAGGGTGTGTUAUTGUUTUAGUUTTGGUTTAATATAGGRGUUUTRGAU<br>UURGUAAGUTUARGGAGURGGRGTUTUAGGGUURGTAGGXGGGAGGAGGTTGAUT<br>UAURGGUTUUTUAUTGGUUAUAGGUTUAUUTUTGUAUTGAUTGGTTGTGGUTGUUT<br>GTGTGUAGGGGGGAGUTUAGGTGUAGAGUTUAUAUUTGAGTGAUATURGTUAAUA<br>UUTGARGGAGUTAGUURGTGAGTG |
| 321 | UUAGGUTGUUTGGGTTTTGGTUTUUAUUATGUTAGUTTGGTGTURGAUUTGTGTTGAGAUUU<br>TUUUTGUUTUTGGUURGGGTGTUUUATUUAAGUAATGGAUAGGTTGGAAUAGGXGTTXGTA<br>GGGAAXGGGUTGAAXGUURGRGGUTUUXGXGATGTUTXGXGATAUTAUUTUUUTXGUUUUX<br>GUTUAUTTAAGGAURGGAAGTAGUAAAGUURGURGTRGRGUUUUURGUUURGRGTUTUUUT<br>GGTAAUUAGUUTUTUUUUTTUUUTRGUUUATAAGGAGUAAGRGGUAUAAATRGGG |
| 322 | UURGATTTGTGURGUTTGUTUUTTATGGGRGAGGGAAGGGGAGAGGUTGGTTAUUAGGGAGA<br>RGRGGGGRGGGGGGRGRGARGGRGGGUTTTGUTAUTTURGGTUUTTAAGTGAGXGGGGGXG<br>AGGGAGGTAGTATXGXGAGAUATXGXGGGAGURGRGGGXGTTUAGUUXGTTUUUTAXGAAX<br>GUUTGTTUUAAUUTGTUUATTGUTTGGATGGGAUAUURGGGUUAGAGGUAGGGAGGGTUTU<br>AAUAUAGGTRGGAUAUUAAGUTAGUATGGTGGAGAUUAAAAUUUAGGUAGUUTGG |
| 323 | UAATGGUUTUTTTUTTUAGUUTRGGTGGGRGTGGUTGGGGGAAUUUUAGGGRGGGR<br>GGGGGGUAGGGGGTGGTGUTGAGTUAUUUAGUUTGGUUAGGTUUUTGUUTGUUAG<br>UUUUUTGUUUUUAURGUTAUAGUURGUUURGGATUTAXGAGGUUUAGUUAGUUAU<br>UTUTGGAUTUUTGAGAUXGAATTGUAAAUTGUURGGGUUTGGUUTTGAAUTUUTGU<br>TGTTTAGGGAUUAAGTUUTGTGGUTUUUAGGGGGGUAUAGTGATUTUTUAAGUTGA<br>GUTGGUUTUAGGGUUTUTGUAU |
| 324 | TGUAGAGGUTTTGAGGUUAGUTUAGUTTGAGAGATUAUTGTGUUUUUUTGGGAGU<br>UAUAGGAUTTGGTUUUTAAAUAGUAGGAGTTUAAGGUUAGGUURGGGUAGTTTGU<br>AATTXGGTUTUAGGAGTUUAGAGGTGGUTGGUTGGGUUTXGTAGATURGGGGRGGG<br>UTGTAGRGGTGGGGGUAGGGGGUTGGUAGGUAGGGAUUTGGUUAGGUTGGGTGAU<br>TUAGUAUUAUUUUUTGUUUUURGUURGUUUTGGGGTTUUUUUAGUUAGGGTGGTTA<br>GAGGUTGAAGAAAGAGGUUATTGT |
| 325 | AUUUTGTGUAGGGUUTGUATUURGGAAGGUUTUUAUUAGUURGAAUUTGGUURGT<br>URGUUUTAGATGGGGUAATRGGRGTTTUTUURGGGAUAGUUTUUTUUUTGGUUTUU<br>TGGUUUTRGTUTGUATTGAGAGGUTTGGUUTUTGGTUXGUATGUTGUUUTTUURGT<br>GUTGTGGUUTTGUAGUURGGUUTUTUUUUTGUTGTUUUUUTTGGUTUTGGUUTGGU<br>UUUTGGGUUUUTGAGTUAUUUUTGAGGTGAUTUAGUAGTUUTTGGAAARGUATGUR<br>GAGGARGUAUUUTGUUTGGUU |
| 326 | GUUAGGUAGGGTGRGTUUTRGGUATGRGTTTUUAAGGAUTGUTGAGTUAUUTUAGG<br>GGTGAUTUAGGGGUUUAGGGGUUAGGUUAGAGUUAAGGGGGAUAGUAGGGGAGA<br>GGURGGGUTGUAAGGUUAUAGUARGGGAAGGGUAGUATGXGGAUUAGAGGUUAA<br>GUUTUTUAATGUAGARGAGGGUUAGGAGGUUAGGGAGGAGGUTGTUURGGGAGAA<br>ARGURGATTGUUUUATUTAGGGRGGARGGGUUAGGTTRGGGUTGGTGGAGGUUTTU<br>RGGGATGUAGGUUUTGUAUAGGGTT |
| 327 | GGAAUUATTGTTUTGUTGUUUAUAGUTGRGTGGAGGGATTURGGTUUTRGGGTTUA<br>GTTGGTGAUAGTGTRGGGTAGGUUTGGGUAGGTGGGAGAGGTRGTGAAGUUUTTTG<br>UAGGGUAUTTGGURGUTUATUTGGUAUAGGGGAAGAGGXGUAGUURGTGGUURGG<br>UAGTUUAGGAUUTGUTGTTUUUTTUUTAUURGGGGRGGGGUUTGTGGGAAGATATG<br>GAAGTRGGGTGAATGAGURGTGUUUAGTGATTTTAAAAAGUAGATTAAAATAAUAT<br>AGAAAATGTUAGAGUTUATTG |
| 328 | UAATGAGUTUTGAUATTTTUTATGTTATTTTAATUTGUTTTTTAAAATUAUTGGGUAR<br>GGUTUATTUAUURGAUTTUUATATUTTUUUAUAGGUUURGUUURGGGTAGGAAGGG<br>AAUAGUAGGTUUTGGAUTGURGGGUUARGGGUTGXGUUTUTTUUUUTGTGUUAGAT<br>GAGRGGUUAAGTGUUUTGUAAAGGGUTTUARGAUUTUTUUUAUUTGUUUAGGUUT<br>AUURGAUAUTGTUAUUAAUTGAAUURGAGGAURGGAATUUUTUUARGUAGUTGTG<br>GGUAGUAGAAUAATGGTTUU |
| 329 | GUATUUTUAUUTGRGTURGAAGRGUAGATGGAGUUUAAGGGAAAGGUUUTGTAGA<br>GGAUUURGTGTGAUTTGGGGUAAAGRGTGGUUTUUUAGGGGTGRGTGGGUAGRGG<br>GARGUUUATGGTGTGAURGGGTTTGTGUUTUUATAGGGAUXGTUTGUUUTGTGUAG<br>AGAGUUUUTGTGGGGXGGGAAGTGGXGAGUAGURGGUAAGGAGGUUUAGUUAGA<br>UAGAAGUAGGGGGGTUAGGGAUATGGGAGGTGGGGGAUUAGUUAGTGAGTUAGAR<br>GTGAGGAUTTUAGTGUUAAGGAUTG |
| 330 | UAGTUUTTGGUAUTGAAGTUUTUARGTUTGAUTUAUTGGGUUTUTTUUUTGGTTUU<br>ATGTUUUTGAUUUUUUTGUTTUTGTUTGGUTGGGUTTTUUTTGURGGUTGUTXGUUA |

-continued

| SEQ ID NO: | Sequence |
|---|---|
| | UTTUUXGUUUUAUAGGGGUTUTUTGUAUAGGGUAGAXGGTUUUTATGGAGGUAUA<br>AAUURGGTUAUAUUATGGGRGTUURGUTGUUUARGUAUUUUTGGGAGGUUARGUT<br>TTGUUUUAAGTUAUARGGGGTUUTUTAUAGGGUUTTTUUUTTGGGUTUUATUTGRG<br>UTTRGGARGUAGGTGAGGATGU |
| 331 | AGGTTUUUUATUUTAGUTUUURGGATUTUUATAGGGAGTGTUUAGGGAUUUTUAAT<br>UTUUAGGGUUAUTTUTGUAGGAGUTRGGGTTRGAGGTTUUARGTGGUUAGAAGAGU<br>TUAGGTUTUTGAGGGUTGGTGTGUURGGGTAUUUATUXGUATUAUTGUTUTUUTUU<br>TGTURGGUTARGUUUAGGGUTGAGTGARGGTGGTGGUAAGTGUTTGTUUTUAGGGU<br>AGRGAGGTUTTUTGTTUTGAUAGUAGUAGGGAUTUUTTUATGGUUAUUAGTAAUUU<br>UAGTGGGRGGAGGRGUTUUT |
| 332 | AGGAGRGUUTURGUUUAUTGGGGTTAUTGGTGGUUATGAAGGAGTUUUTGUTGUTG<br>TUAGAAUAGAAGAUUTRGUTGUUUTGAGGAUAAGUAUTTGUUAUUAURGTUAUTU<br>AGUUUTGGGRGTAGURGGAUAGGAGGAGAGUAGTGATGXGGATGGGTAUURGGGU<br>AUAUUAGUUUTUAGAGAUUTGAGUTUTTUTGGUUARGTGGAAUUTRGAAUURGAG<br>UTUUTGUAGAAGTGGUUUTGGAGATTGAGGGTUUUTGGAUAUTUUUTATGGAGATU<br>RGGGGAGUTAGGATGGGGAAUUT |
| 333 | TUUTTUUTTUTTTUUTTUTTTUTTUUTTUUUTTUTUUTTTUTTTUTTUUTTTUU<br>UATTTTGAGARGTAUTUTGGUTUTGTRGUUUAGGUTGGAGRGUAATGGRGUUATUT<br>RGGRGUAUTGUAAUUTUUAUUTUURGGGTTUAAGXGATTUTAUTGUUTUAGUUTUU<br>RGAGTAGUTGGGAUTAUAGGRGRGUAUTAUUAAGUURGGUTAATTTTTTTTTGTATT<br>TTTAGTAGAGAUTGGGTTTUARGATGTTGGURGGGUTGGTUTGGAAGTUTTGAUUTU<br>AAGRGTGRGUUUTU |
| 334 | GAGGGRGUARGUTTGAGGTUAAGAUTTUUAGAUUAGUURGGUUAAUATRGTGAAA<br>UUUAGTUTUTAUTAAAAATAUAAAAAAAAATTAGURGGGUTTGGTAGTGRGRGUUT<br>GTAGTUUUAGUTAUTRGGGAGGUTGAGGUAGTAGAATXGUTTGAAUURGGGAGGTG<br>GAGGTTGUAGTGRGURGAGATGGRGUUATTGRGUTUUAGUUTGGGRGAUAGAGUU<br>AGAGTARGTUTUAAAATGAAAGAAGAGAAAAGAAAAGAAAAGAAAGAAAAGAGAG<br>AGAAAGAAGGAAAGAAGGAAGGA |
| 335 | AGGUUTUTGUTGAUUTGTAGAAUTTGTTGAUURGGATTTTGATGTUAGTUTUATTGG<br>GUUTGURGTTGUTUTTUTTGGGAUAGAAGATUTUTTTGATURGGUUAATTRGGTAGG<br>GUTUAGGGGUATUUAGGTTGUTGUUTTTGATGTAGTXGGAGTATTTURGGTAGTGUT<br>UTGGGTAUAGGTUUTUATUUARGGGUTUUTTURGTGGGRGTTTUARGGGAUTGGAU<br>AGUTTGATGUTGUAGAGAAGUAUUUAUTTGAUATUAATGAAUUTTUUAUUTTGUAG<br>TGGTUAGTUAGGUATGA |
| 336 | TUATGUUTGAUTGAUUAUTGUAAGGTGGAAGGTTUATTGATGTUAAGTGGGTGUTT<br>UTUTGUAGUATUAAGUTGTUUAGTUURGTGAAARGUUUARGGAAGGAGUURGTGG<br>ATGAGGAUUTGTAUUUAGAGUAUTAURGGAAATAUTUXGAUTAUATUAAAGGUAG<br>UAAUUTGGATGUUUUTGAGUUUTAURGAATTGGURGGATUAAAGAGATUTTUTGTU<br>UUAAGAAGAGUAARGGUAGGUUUAATGAGAUTGAUATUAAAATURGGGTUAAUAA<br>GTTUTAUAGGTUAGUAGAGGUUT |
| 337 | GGGGRGGGGTTRGGURGGGGGRGGRGGUAGGAUUTGAGUAGUUAGGAGGGUTGGGGGAUA<br>GTUAGGTUAGGURGGTGGUTAUURGGURGUTGGAGAGGGURGGATGGUARGTGGUAUUAAG<br>UAAAAGGAGGUTGAGUUAGAAAGUAGGGAXGGGGUTAGARGAGUAAAGUTGGGUAGGAGG<br>GRGAGTTGGGAGGGGURGAGURGGUTGTGRGTGGTUUUTTGGGAGGAGGGGGTGTGGUUAA<br>GUAAGUUAAAUAGTTRGGAGGTUAGTGUAAGGAUAAGAUAGUUTGGGUAAARGAGUAG |
| 338 | UTGUTRGTTTGUUUAGGUTGTUTTGTUUTTGUAUTGAUUTURGAAUTGTTTGGUTTGUTTGGU<br>UAUAUUUUUTUUTUUUAAGGGAUUARGUAUAGURGGUTRGGUUUUTUUUAAUTRGUUUTUU<br>TGUUUAGUTTTGUTRGTUTAGUUUXGTUUUTGUTTTUTGGUTUAGUUTUUTTTTGUTTGGTGU<br>UARGTGUUATURGGUUUTUTUUAGRGGURGGGTAGUUAURGGUUTGAUUTGAUTGTUUUUU<br>AGUUUTUUTGGUTGUTUAGGTUUTGURGURGUUUURGGURGAAUUURGUUUU |
| 339 | RGAGTTGGGAGGGGURGAGURGGUTGTGRGTGGTUUUTTGGGAGGAGGGGGTGTGG<br>UUAAGUAAGUUAAAUAGTTRGGAGGTUAGTGUAAGGAUAAGAUAGUUTGGGUAAA<br>RGAGUAGGGGRGGAGRGTGAGAGUAGAUTGUAURGGATXGUTUAGGUUAGUUUAA<br>GUTGAAGAGGAAGGGGUAAGUTUUAGAAGUAGGGGRGGGGURGAUUAAUUTRGUA<br>GATUTGUTGGGRGAAGAGUAGUAGUTGGGUUAGUURGATGUTGTGURGGGGUAGG<br>TAGTUTRGGAGGUTGUUUAGGGGU |
| 340 | UUUUTGGGUAGUUTURGAGAUTAUUTGUUURGGUAUAGUATRGGGUTGGUUUAGU<br>TGUTGUTUTTRGUUUAGUAGATUTGRGAGGTTGGTRGGUUURGUUUUTGUTTUTGG<br>AGUTTGUUUUTTUUTUTTUAGUTTGGGUTGGUUTGAGXGATURGGTGUAGTUTGUT<br>UTUARGUTURGUUUUTGUTRGTTTGTAGGUTGTUTTGTUUTTGUAUTGAUUTURG<br>AAUTGTTTGGUTTGUTTGGUUAUAUUUUUTUUTUUUAAGGGAUUARGUAUAGURGG<br>UTRGGUUUUTUUUAAUTRGU |
| 341 | AAUAGGUUUAAGUUTGTGGUAGGTGGGGGTUAUUUAGUUUAGGRGUTTUUUAUUU<br>URGGGUUTGGGUUAGAAGUUUAGGAGUTGGUTGRGGGURGGTTUTUUUUUAUUUA |

-continued

| SEQ ID NO: | Sequence |
|---|---|
| | UTUTGGGGATGUUTUAGGUUTGGGTTTURGUUTTAGUUTXGUUAGGUUUUAATGAG<br>UUTUTGTTTGGUUTGTAGTUAATTGAURGGTTGGAUTTGGGGUAGGTGUTRGAGGA<br>GUUUUAUTGAGGGAGGGUAGGTUTUTTGTGRGTAUTGTUUAGUAUATAUAGGAAAT<br>TTAGUATTTUTGUUUAUUUAGU |
| 342 | GUTGGGTGGGUAGAAATGUTAAATTTUUTGTATGTGUTGGAUAGTARGUAUAAGAG<br>AUUTGUUUTUUUTUAGTGGGGUTUUTRGAGUAUUTGUUUUAAGTUUAAURGGTUA<br>ATTGAUTAUAGGUUAAAUAGAGGUTUATTGGGGUUTGGXGAGGUTAAGGRGGAAA<br>UUUAGGUUTGAGGUATUUUUAGAGTGGGTGGGGGAGAAURGGUURGUAGUUAGUT<br>UUTGGGUTTUTGGUUUAGGUURGGGGGTGGGAAGRGUUTGGGUTGGGTGAUUUUU<br>AUUTGUUAUAGGUTTGGGUUTGTT |
| 343 | UUTGAUUUAUUUAAUTUTUUUAGGGGARGTGGGGGUAUTGGAGUUUUAUAURGUA<br>GGRGGTAGUTUAATGUAUURGRGTRGGAGTTUUTUUUURGRGAGRGTGGUAAGGUT<br>UAGGGAAGTUURGGGUUUUTGGGGAGGGGGUUTTGURGXGUATUUTGTXGUAGGA<br>AURGURGGGUUUTTUUTTURGRGGGAAGXGGUTTGGURGAUUUURGUUUURGUUR<br>GGGUUTUTTGGGGGTTTURGGTGUURGGUUAURGTGGGGUTGGGGAUTGAAAGTGA<br>TGGGAUTGAAGATGGGGUTGGAA |
| 344 | TTUUAGUUUUATUTTUAGTUUUATUAUTTTUAGTUUUUAGUUUUARGGTGGURGGG<br>UAURGGAAAUUUUUAAGAGGUURGGGRGGGGGRGGGGGTRGGUUAAGUXGUTTUU<br>RGRGGAAGGAAGGGUURGGRGGTTUUTGXGAUAGGATGXGRGGUAAGGUUUUUTU<br>UUUAGGGGUURGGGAUTTUUUTGAGUUTTGUUARGUTRGRGGGGGAGGAAUTURG<br>ARGRGGGTGUATTGAGUTAURGUUTGRGGTGTGGGGUTUUAGTGUUUUUARGTUUU<br>UTGGGAGAGTTGGGTGGGTUAGG |
| 345 | TATUUAAATGTGTTTTATATAAAATGAATRGTTTTUAGTGUAUTGAGGAAGTTTTUT<br>ATTTAAAGAAATUUTGUTGTGAAUTUTTTTGTGAAGAATGUTTTUUTAATGGAATTA<br>GTUAUUAUTGAGTUATTTUTGUAAAUTTUAGGTTTGXGGTTTTGUUTAAGUAAGATU<br>TGGURGGAGAAGTGAGATAAATTATAGATGTRGUTAATAAATTAUAGATTAUTUAA<br>AGGUAAAAGAGGAAAGAAAAAAAAAAAATTGAUTRGTGTATATGAAURGAATTGAGT<br>UAGGGGTUTUUAURGGU |
| 346 | GURGGTGGAGAUUUUTGAUTUAATTRGGTTUATATAUARGAGTUAATTTTTTTTTTT<br>UTTTUUTUTTTTGUUTTTGAGTAATUTGTAATTTATTAGRGAUATUTATAATTTATUT<br>UAUTTUTURGGUUAGATUTTGUTTAGGUAAAAUXGUAAAUUTGAAGTTTGUAGAAA<br>TGAUTUAGTGGTGAUTAATTUUATTAGGAAAGUATTUTTUAUAAAAGAGTTUAUAG<br>UAGGATTTUTTTAAATAGAAAAUTTUUTUAGTGUAUTGAAAARGATTUATTTTATAT<br>AAAAUAUATTTGGATA |
| 347 | TGGGAGTTUUAGTTRGGGGGUAGAUUAGTGTTUAGAGTURGGGUTUTGUTAUTUAG<br>RGUURGAGGUAGRGUUTUUUUATTUAARGGGGGURGTGGUAATTUUUTGAUATGAT<br>TUATGAUUAUATAATAUATURGGAAAUTTUTUTUUAUXGUUTUURGTUTGGGURGT<br>RGUUUURGGUUTGGGAGAUTUUAGGTUTUAGAGTUTUTGUUUUUARGGGRGATUA<br>GTGUTGUUUAGTGGAAAAATAATGUUAGURGRGUAUUAAAATTAGGTGTAAAATTA<br>AUATTTTTTGGAAGUUAUTTT |
| 348 | AAGTGGUTTUUAAAAAATGTTAATTTTAUAUUTAATTTTGGTGRGRGGUTGGUATTA<br>TTTTTUUAUTGGGUAGUAUTGATRGUURGTGGGGGUAGAGAUTUTGAGAUUTGGAG<br>TUTUUUAGGURGGGGGRGARGGUUUAGARGGGAGGXGGTGGAGAGAAGTTTURGG<br>ATGTATTATGTGGTUATGAATUATGTUAGGGAATTGUUARGGUUUURGTTGAATGG<br>GGAGGRGUTGUUTRGGGRGUTGAGTAGUAGAGUURGGAUTUTGAAUAUTGGTUTGU<br>UUURGAAUTGGAAUTUUUAT |
| 349 | RGGRGTGUTTUTTGGUAAAUATUTUUTTGAGGATGURGUTGUAGUAUTTGAGUTGU<br>TURGAGAUTTTGUTGUTUTTUTUTGGTGUTGGGTGUTGUTGAGAGTRGGGUARGTUU<br>TTUTTTGGAGGTTTUAUAGGURGGUTGUTUTUURGUXGUTGGUUUAGUTTGGTGGT<br>UTTGGGUTURGGGGGUAGRGAGGGTGGUTRGTGAATGGGGTUAATGGTGGTGGGGG<br>TGGTGGTGTUTGUTTTUUTUTTUAUTUUUTTUTTTGTUTGUUAAGAAUARGGARGUU<br>AAUAGGUAUAGTUAGAAG |
| 350 | UTTUTGAUTGTGUUTGTTGGRGTURGTGTTUTTGGUAGAUAAAGAAGGGAGTGAAG<br>AGGAAAGUAGAUAUUAUUAUUUUUAUUAUUATTGAUUUUATTUARGAGUUAUUUT<br>RGUTGUUUURGGAGUUUAAGAUUAUUAAGUTGGGUUAGXGGRGGGAGAGUAGUR<br>GGUUTGTGAAAUUTUUAAAGAAGGARGTGUURGAUTUTUAGUAGUAUUUAGUAUU<br>AGAGAAGAGUAGUAAGGTUTRGGAGUAGUTUAAGTGUTGUAGRGGUATUUTUAAG<br>GAGATGTTTGUUAAGAAGUARGURG |
| 351 | TGGTUTGUTTUAAGTUUTAUUTGGUUUUTGGUAAGTUUUAUTTGGTGAUATUTTGT<br>GUUTGGGTUUTTGAGGGUTGUUUUAGATURGRGATTGTUUTGGGGAURGGTAGTTU<br>UTUUURGGATGUUAGUAAAGUTUUUTUUAGUUTUUAXGUUTGUAUAGTUTUUAGT<br>ATGUUTTUAAUAGUUATTAGTUAUUUTUTGTGAGTUAGAUUUURGGTUUTGUUAGG<br>UUAAUUTGUTTGGGGUUTUAGUAGRGGGGGUTGGRGAGGUUAGTTTTUTUUAGRGG<br>TTUTAAGURGUTRGAGGGTGG |

-continued

| SEQ ID NO: | Sequence |
|---|---|
| 352 | UAUUUTRGAGRGGUTTAGAAURGUTGGAGAAAAUTGGUUTRGUUAGUUUURGUTG<br>UTGAGGUUUUAAGUAGGTTGGUUTGGUAGGAURGUGGGTUUAUTUAUAUAUUUT<br>GAUTAATGGUTGTTGAAGGUATAUTGGAGAUTGTGUAGGXGTGGAGGUTGGAGGGA<br>GUTTTGUTGGUATURGGGGAGGAAUTAURGGTUUUUAGGAUAATRGRGGATUTGGG<br>GUAGUUUTUAAGGAUUUAGGUAUAAGATGTUAUUAAGTGGGAUTTGUUAGGGGUU<br>AGGTAGGAUTTGAAGUAGAUUAG |
| 353 | AUUTGGTRGGUUAURGGUAGUTRGGGGAAGAAGGGRGRGTGGRGRGUUUAUTUUA<br>RGGTGUTGAAGAGUAGURGRGURGUUAGUTRGUAURGTTGTRGATGUUUAGUAUR<br>GRGUURGURGRGURGUUUUUTGRGURGAAGRGTURGGUXGURGUAGGGTAGGGUT<br>UAGRGRGUAGUAGUTGRGRGATUAGTTRGGAUAURGGUTGUUURGGGAAGAGGTU<br>TURGURGUTRGUUAUTGURGUUAGRGURGAGUURGGGGGGUTGUURGAGGAGGRG<br>GUUARGGUAUUAGGUAGRGAGTGU |
| 354 | GUAUTRGUTGUUTGGTGURGTGGURGUUTUUTRGGGUAGUUUUURGGGUTRGGRGU<br>TGGRGGUAGTGGRGAGRGGRGGAGAUUTUTTUURGGGGUAGURGGTGTURGAAUTG<br>ATRGRGUAGUTGUTGRGRGUTGAGUUUTAUUUTGRGGXGGURGGARGUTTRGGRGU<br>AGGGGGRGGRGRGGRGGGRGRGGTGUTGGGUATRGAUAARGTGTGRGAGUTGGRGG<br>RGRGGUTGUTUTTUAGUAURGTGGAGTGGGRGRGUUARGRGUUUTTUTTUUURGAG<br>UTGURGGTGGURGAUUAGGT |
| 355 | TGGUAGAGATAUAAATTUUTGATGGUAGAGGAGGGAGAGAGAGTGTGGGTGARGA<br>TGAUAATTGAAUTGAGAUUUAAAGGAGGTAGGGGAGAUATATGGGRGTUTUTGGG<br>AAGATGGTUUURGGGAAAGUAUAGUUTTTAGAUAGGUUUXGAGGUAGGAGUUTGT<br>UTGAUTUAURGGAGGAGUTTGGAGGAGGUTGAGGTGGUUTAAGTRGATTAAGUAGG<br>GTGGGGAGGGAAGAGGRGATGGTGURGTGAGAUUAAGUAGGGUUTTGAGGTUTGG<br>GGGGAGAAUTTTGGUTTTTAUTUT |
| 356 | GAGTAAAAGUUAAAGTTUTUUUUUUAGAUUTUAAGGUUUTGUTTGGTUTUARGGU<br>AUUATRGUUTUTTUUUUUUUUAUUUTGUTTAATRGAUTTAGGUUAUUTUATGGTT<br>TUUAAGUTUUTURGGTGAGTUAGAUAGGUTUUTGUUTXGGGGUUTGTUTAAAGGUT<br>GTGUTTTUURGGGGAUUATUTTUUAGAGARGUUUATATGTUTUUUUTAUUTUUTT<br>TGGGTUTUAGTTUAATTGTUATRGTUAUUUAUAUTUTUTUUUTUUTUTGUUATUA<br>GGAATTTGTATUTUTGUUAG |
| 357 | AGAGGAGGGAGAGAGAGTGTGGGTGARGATGAUAATTGAAUTGAGAUUUAAAGGA<br>GGTAGGGGAGAUATATGGGRGTUTUTGGGAAGATGGTUUURGGGAAAGUAUAGUU<br>TTTAGAUAGGUUURGAGGUAGGAGUUTGTUTGAUTUAUXGGAGGAGUTTGGAGGA<br>GGUTGAGGTGGUUTAAGTRGATTAAGUAGGGTGGGGAGGGAAGAGGRGATGGTGU<br>RGTGAGAUUAAGUAGGGUUTTGAGGTUTGGGGGGAGAAUTTTGGUTTTTAUTUTGA<br>GGAAGGTGGGAGUUAUAGAGGUTT |
| 358 | AGUUTUTGTGGUTUUUAUUTTUUTUAUAUTAAAAUUUAAAUTUUUTUUTTTAGGAUU<br>TUAAGGUUUTGUTTGGTUTUARGGUAUUATRGUUTUTTUUUTUUUUAUUUTGUTTA<br>ATRGAUTTAGGUUAUUTUAGUUTUUTUUAAGUTUUTUXGGTGAGTUAGAUAGGUTU<br>UTGUUTRGGGGUUTGTUTAAAGGUTGTGUTTTUURGGGGAUUATUTTUUUAGAGAR<br>GUUUATATGTUTUUUUUAUUTUUTTTGGGTUTUAGTTUAATTGTUATRGTUAUUUAU<br>AUTUTUTUTUUUTUUTUTG |
| 359 | TGGGRGTUTUTGGGAAGATGGTUUURGGGAAAGUAUAGUUTTTAGAUAGGUUURG<br>AGGUAGGAGUUTGTUTGAUTUAURGGAGGAGUTTGGAGGAGGUTGAGGTGGUUTA<br>AGTRGATTAAGUAGGGTGGGGAGGGAAGAGGRGATGGTGUXGTGAGAUUAAGUAG<br>GGUUTTGAGGTUTGGGGGGAGAAUTTTGGUTTTTAUTUTGAGGAAGGTGGGAGUUA<br>UAGAGGUTTUTAGAUAGAAGAAGGAUAAGURGGAUTUAGGATAUUAGGGTGGGGG<br>TATUTGTGGGGGATAAAGGGAGAA |
| 360 | TTUTTUUTTTATUUUUUAUAGATAUUUUUAUUUTGGTATUUTGAGTURGGUTTGTU<br>UTTUTUTGTUTAGAAGUUTUTGTGGUTUUUAUUTTUUTUAGAGTAAAAGUUAAAG<br>TTUTUUUUUUAGAUUTUAAGGUUUTGUTTGGTTTUAXGGUAUUATGGUUTUUUUU<br>TUUUUAUUUTGUTTAATRGAUTTAGGUUAUUTUAGUUTUUTUUAAGUTUUTURGGT<br>GAGTUAGAUAGGUTUUTGUUTRGGGGUUTGTUTAAAGGUTGTGUTTTUURGGGGAU<br>UATUTTUUUAGAGARGUUUA |
| 361 | GGUTTTGTGAAAUUAAUUAGGAAGAATGAAAUAUAGAGUTGGTURGAUAUUUAGU<br>TRGAGGGAGGGGGGURGGAAGUTTUTGGAAGTTGGUTGUUUUTAAGUAGGGGUUA<br>UTUTAGUUUAUAAGGUUAAGTTGGUAGAGGUAGAXGAGGGGAUTUTGXGGUTUAA<br>GTUARGGGUUAGGAGUURGUAGUTGURGGGUTGGAAAGGTUAGAGURGGUTUTGR<br>GTUTGGUTGRGURGGUAAGAAGUUAUAATTARGUAGGUAAAAGAGUURGGGGATT<br>AGUUUUAGUAUUTGGGAUUUTGAAT |
| 362 | ATTUAGGGTUUUAGGTGUTGGGGUTAATUUURGGGUTUTTTTGUUTGRGTAATTGTG<br>GUTTUTTGURGGRGUAGUUAGARGUAGAGURGGUTUTGAUUTTTUUAGUURGGUAG<br>UTGRGGGUTUUTGGUURGTGAUTTGAGUXGUAGAGTUUUUTXGTUTGUUTUTGUUA<br>AUTTGGUUTTGTGGGUTAGAGTGGUUUUTGUTTAGGGGUAGUUAAUTTUUAGAAGU |

-continued

| SEQ ID NO: | Sequence |
|---|---|
| | TTURGGUUUUUUTUUUTRGAGUTGGGTGTRGGAUUAGUTUTGTGTTTUATTUTTUUT<br>GGTTGGTTTUAUAAAGUU |
| 363 | AGGUTGAARGGAATTGGGAGUAGAGUUUTGRGGTAGGAUAGAGAUTTRGUAAAGU<br>URGGAGUAUAUAGUAGUAUUURGTUTTUTAAAGGAUAATTTTGGGAAAAUTUTTGU<br>UTAATATTUTGGUAUTAAGGATUATTUTGTUAUATUUUXGUTUTGGAUTAUAAGUU<br>TGUAAGUUUUATURGGGGUAGGGTTTUUTUATTUUTGTGUAURGTGGAAGUUUTGTG<br>UUTGUUUAGGGUUTGGUAUTTGTARGTAUTTGAAAAUUTRGTGTGGAGTAAAGAGA<br>GGGGTGATGTGUAAAGGUUTT |
| 364 | AAGGUUTTTGUAUATUAUUUUTUTUTTTAUTUUAUARGAGGTTTTUAAGTARGTAU<br>AAGTGUUAGGUUUTGGGUAGGUAUAGGGUTTUUARGGTGUAUAGGAATGAGGAGU<br>UUTGUUURGGATGGGGUTTGUAGGUTTGTAGTUUAGAGXGGGGATGTGAUAGAATG<br>ATUUTTAGTGUUAGAATATTAGGUAAGAGTTTTUUUAAAATTGTUUTTTAGAAGARG<br>GGGTGUTGUTGTGTGUTURGGGUTTTGRGAAGTUTUTGTUUTAURGUAGGGUTUTGU<br>TUUUAATTURGTTUAGUUT |
| 365 | AGUUAGGUTAAAUUAGRGTGTUUUAATGAGGGGUUUTGGGUTGAGTGGAGGAAAT<br>GGGTGRGGTGGAGGTGGGTTTGGUTGGGUAUAGRGGGUARGTGTGGGTAAGRGGGT<br>GGGGURGGTTGTGRGGGTGGUUTATUTGGGGUAAGUAGUXGAGGURGAUTGTGTUR<br>GGRGTGTGGTTGAGUARGGGUAGGTGTUTGGRGGTGAUUUTGUARGTUTGGTGTTT<br>AUUTGGUUUTGGGTUTGARGTGGGURGRGUUTGGUTGUTGGRGGGAUAGTGTGTTA<br>TUTGUUTGRGGARGUTTURGG |
| 366 | URGGAAGRGTURGUAGGUAGATAAUAUAUTGTUURGUUAGUAGUUAUURGKUUUU<br>UARGTUAGAUUUAGGGUUAGGTAAAUAUUAGARGTGUAGGGTUAURGUUAGAUAU<br>UTGUURGTGUTUAAUUAUARGURGGAUAUAGTRGGUUTXGGUTGUTTGUUUUAGAT<br>AGGUUAUURGUAUAAURGGUUUUAUURGUTTAUUUAUARGTGUURGUTGTGUUUA<br>GUUAAAUUUAUUTUUAURGUAUUUATTTUUTUUAUTUAGUUUAGGGUUUUTUATT<br>GGGAUARGUTGGTTTAGUUTGGUT |
| 367 | UUTTGGUTUAGGTTGGGGAGGGRGTUATGAGTUATGAGGTGGGRGTTGUATTTGTU<br>AGTTGTGUAGURGRGUAUUAURGAGTAGTUTGGRGGUAGRGRGTURGRGTTRGATT<br>GRGTUTGGUURGUAGGAGGUURGGTUUAGUAGUUUTTUXGUAUUAGGGTUAURGG<br>RGRGRGATAUUUTGGGGGRGGGATRGGGGUTRGTGUTUTGUTTUURGAAAUUUTTU<br>TUUUTUUAGTUTUAGRGTTUTTUUTUUTUUUTUTATIUTTTUAUTTTGGAGTTAUT<br>TUUTUUUUTUUUTUUTTUUU |
| 368 | GGGAAGGAGGGAGGGGAGGAGGTGTAGGTGAAAGTGAAAGGATAGAGGGAGGAGG<br>AAGAARGUTGAGAUTGGAGGGAGAAGGGTTTRGGGAAGUAGAGUARGAGUUURGA<br>TUURGUUUUUAGGGTATRGRGRGURGGTGAUUUTGGTGXGGAAGGGUTGUTGGAUR<br>GGGUUTUUTGRGGGUUAGARGUAATRGAARGRGGARGRGUTUURGUUAUAUTAUT<br>RGGTGGTGRGRGGUTGUAUAAUTGAUAAATGUAARGUUUAUUTUATGAUTUATGAR<br>GUUUTUUUUAAUUTGAGUUAAGG |
| 369 | UAGGUTGGAGTGUAATGGRGRGATUTRGGUTUAUTGUAAUTTUTGUUTUTRGGGTT<br>UAAGUAATTUTTUTAUUTTAGUUTUUTGAGTAGUTGGGATTAUAGGTAUUTGURGU<br>UATGUURGGUTAATTTTTTAATTTGTTTTTAGTAGAGAXGGGGTTTUAUUATGTTGG<br>UUAGGURGGTUTAUAAUTUUTGATUTUAGGTGATUTAUURGUUTRGGUUTUUUAAA<br>TTAUAGGTGTTATUATTAGGATTUTTGGUAGAUAGGAGTGTTGTAGGGGATGGAAGT<br>GGATAGTAGGAGGUTUTG |
| 370 | UAGAGUUTUUTAUTATUUAUTTUUATUUUUTAUAAUAUTUUTGTUTGUUAAGAATU<br>UTAATGATAAUAUUTGTAATTTGGGAGGURGAGGRGGGTAGATUAUUTGAGATUAG<br>GAGTTGTAGAURGGUUTGGUUAAUATGGTGAAAUUUXGTUTUTAUTAAAAAUAAAT<br>TAAAAAATTAGURGGGUATGGRGGUAGGTAUUTGTAATUUUAGUTAUTUAGGAGGU<br>TAAGGTAGAAGAATTGUTTGAAUURGAGAGGUAGAAGTTGUAGTGAGURGAGATRG<br>RGUUATTGUAUTUUAGUUTG |
| 371 | TGAATGAUUTGGGUAGUATTTUTUUAUUTGRGUTTGUATTTGUTAGAUAGTUTGTGA<br>UTUTUTGTGGGAGAAAAUAUAAGAAAURGGUUUUTUTGUTGGTTUUUUAUUTGGU<br>UTGGUTUTUUTGTTUTUUAUUUTGUAUAUTUATGUUTXGGAAUUTGUTTUTUUTUT<br>GAGUTUUUTUAUAGTGGUURGGUUUARGTGGUUTTTAATUTGUUUAUATUAGAGU<br>UTUUAUUTURGGUUTATGGUUUATUAGAGGUAGUTGGAGURGGGUATUUTUUUUA<br>RGTGGGUUTTTGAGGATGGGA |
| 372 | TUUUATUUTUAAAGGUUUARGTGGGGAGGATGUURGGUTUUAGUTGUUTUTGATGG<br>GUUATAGGURGGAGGTGGAGGUTUTGATGTGGGUAGATTAAAGGUUARGTGGGUR<br>GGGUUAUTGTGAGGGAGGUTUAGAGGAGAAGUAGGTTUXGAGGUATGAGTGTGUA<br>GGGTGGAGAAUAGGAGAGUUAGGUUAGGTGGGGAAUUAGUAGAGGGGURGGTTTU<br>TTGTGTTTTUTUUUAUAGAGAGTUAUAGAUTGTUTAGUAAATGUAAGRGUAGGTGG<br>AGAAATGUTGUUUAGGTUATTUA |
| 373 | GGGRGGGGUUTGTGRGGTUTGRGGRGRGGAGURGAGTGGGUTGRGGGGATGRGGGG<br>GAUUAGUTGRGTGGGRGGRGGRGURGAGAGUUURGGAGGRGRGGGGUTGAGRGAG |

-continued

| SEQ ID NO: | Sequence |
|---|---|
| | GGUURGRGGGGGRGUTGGUTGRGUTTGGUTURGGTATGXGUUTAUTTUUTUTGRGT<br>UTXGUTAGUTGURGTGUTGUTRGURGTGTAUTARGGTUTUATUTGGGTAUUUARGR<br>GGTUTUURGRGGUAUURGURGGUUUAUAGUUUAGRGRGURGTUUUUTURGTGTGUT<br>GTTURGUTTRGGGRGTGURGUUT |
| 374 | AGGRGGUARGUURGGGRGGGUAGUAUARGGAGGGGARUUKUKGUTUUUUTUTUUU<br>URGGRGGGTGURGRGGGAGAURGRGTGGGTAUUUAGATGAGAURGTAGTAUARGG<br>RGAGUAGUARGGUAGUTAGXGAGARGUAGAGGAAGTAGGXGUATAURGGAGUUAA<br>GRGUAGUUAGRGUUUURGRGGGUUUTRGUTUAGUUURGRGUUTURGGGGUTUTRG<br>GRGURGURGUUUARGUAGUTGGTUUUURGUATUUURGUAGUUUAUTRGGUTURGR<br>GURGUAGAURGUAUAGGUUURGUUU |
| 375 | AAGTGTATTTTUAAGGTATGAGGGGUUUAGAGGAUAUTGTUUUAAAAGUAGTGGTT<br>GTGAGAGTGGUTTTGGAGTUAGGUTGAUAGTUTGGAAAUTTUUAGGTURGUTUTGA<br>AGTGURGGUTGUATGAUUAGUUUTUUAGUUTGTGTUXGUTTRGGUUTTUTTTGTGU<br>AAGTGAGAGUATTGUTGATUUUUURGGGGTGGRGAGGGGGRGUARGTUAGTGAUUT<br>RGUATGGTGUUTGUUAGGUARGTGGTURGTGTTTUATGATTUTTTGAGAGUTTTGGA<br>GUAGUTUUAAGAAGAUTUT |
| 376 | GAGTUTTUTTGGAGUTGUTUUAAAGUTUTUAAAGAATUATGAAAUARGGAUUARGT<br>GUUTGGUAGGUAUUATGRGAGGTUAUTGARGTGRGUUUUUTRGUUAUUURGGGGG<br>GATUAGUAATGUTUTUAUTTGUAUAAAGAAGGURGAAGXGGAUAUAGGUTGGAGG<br>GUTGGTUATGUAGURGGUAUTTUAGAGRGGAUUTGGAAGTTTUUAGAUTGTUAGUU<br>TGAUTUUAAAGUUAUTUTUAUAAUUAUTGUTTTTGGGAUAGTGTUUTUTGGGUUUU<br>TUATAUUTTGAAAATAUAUTTT |
| 377 | TAATTTTAAAUAAAAUTTTUUATGAGUAAUTAAATATTTAAAATGTGTTTTTUUATA<br>AAAGTGAATUAGUTUAGTTUTGUAGGUTGAAAATAUAAUAAGGAGGATURGGGTTG<br>UAGAAAGUAGAGGGUUAUUTAGAURGTGTUTGAGAGAXGGGGAGAAAGUAGUTGT<br>UTGUTGTGUAUUAGAGGUUTUTAGGGAUUURGGUAGUAAUUURGTGGRGGGUUAU<br>AUTTGGGAGUTGATTTGTTTTUAGAAUUAUUAGUTAAGUUAUATGAGUUAGGAGUU<br>TGGTTATUUATTUAAAGUUUA |
| 378 | TGGGUTTTGAATGGATAAUUAGGUTUUTGGUTUATGTGGUTTAGUTGGTGGTTUTGA<br>AAAUAAATUAGUTUUUAAGTGTGGUURGUUARGGGGTTGUTGURGGGGTUUUTAG<br>AGGUUTUTGGTGUAUAGUAGAUAGUTGUTTTUTUUUXGTUTUTUAGAUARGGTUTA<br>GGTGGUUUTUTGUTTTUTGUAAUURGGATUUTUUTTGTTGTATTTTUAGUUTGUAGA<br>AUTGAGUTGATTUAUTTTTATGGAAAAAUAUATTTTAAATATTrAGTTGUTUATGGA<br>GAGTTTTGTTTAAAATTA |
| 379 | GUUTUUAGAUURGAAATUUUUUAUTGAAGUUATTUUUAGGAGGAGGGGUUTUAUT<br>GGGGUUTUAAGGUAGUATUAGUATTTURGGTGAUAGGUAUAGUAATTTATUAGUTU<br>AUTGGUTUTUTAUTGAGAAUAAGGUAAGURGGGGUUTGUXGAGGGTATGAUAGGU<br>AGGGAGTGATGGGUURGGUUUAGGGUAGGAGGGAGAUAGAAATGGGUAGGAAGA<br>GGAGGUTGTUUUUAGUAGUAUTTUTGAGAGGAGGAGUAUUTTTRGGGGAUAUTUT<br>GGARGGUAUUUUUAAGUAUAGUUUU |
| 380 | GGGGUTGTGUTTGGGGGTGURGTUUAGAGTGTUUURGAAAGGTGUTUUTUUTUTUA<br>GAAGTGUTGUTGGGGAUAGUUTUUTUTTUUTGUUUATTTUTGTUTUUUTUUTGUUU<br>TGGGURGGGUUUATUAUTUUUTGUUTGTUATAUUUTXGGUAGGUUURGGUTTGUUT<br>TGTTUTUAGTAGAGAGUUAGTGAGUTGATAAATTGUTGTGUUTGTUAURGGAAATG<br>UTGATGUTGUUTTGAGGUUUUAGTGAGGUUUUTUUTUUTGGGAATGGUTTUAGTGG<br>GGGATTTRGGGTUTGGAGGU |
| 381 | TGAGAGUAGUUAGAUARGTAGTGATUAGGGAAAGTRGAAAGTGUAGATGGGTTRG<br>UAAARGTGGAUTUTUTAGTTTTGGGTUTGUAGATGGGGURGGUUAUUAXGTGUTUT<br>UTGAGTTUTUTTTUUAAGTAUAGATUUUTURGGAGARGGAAUATTGTTURGUUTTTA<br>ATTUTTUUUAGGAGUTGRGGAGGAAGGXGTGAGAAURGGAGUURGGGGTGAUTTGR<br>GGGGGAGGGGATRGUTTUUURGTRGUUUAUAUUTGUUTAAUUUARGUUUARGGRG<br>GURGUAAAGGRGAUAURGRGT |
| 382 | ARGRGGTGTRGUUTTTGRGGURGURGTGGGRGTGGGTTAGGUAGGTGTGGGRGARG<br>GGGAAGRGATUUUUTUUUURGUAAGTUAUUURGGGUTURGGTTUTUAXGUUTTUUT<br>URGUAGUTUUTGGGAAGAATTAAAGGRGGAAUAATGTTURGTUTURGGAGGGATUT<br>GTAUTTGGAAAGAGAAUTUAGAGAGUAXGTGGTGGURGGUUUUATUTGUAGAUUU<br>AAAAUTAGAGAGTUUARGTTTGRGAAUUUATUTGUAUTTTRGAUTTTUUUTGATUA<br>UTARGTGTUTGGUTGUTUTUA |
| 383 | AUAAGRGGTTGGATTTRGAGAGGAUATUAAGAGUARGTUAAGAGUARGTUAAGAG<br>UAUARGGAUAGGUAUTGGUARGURGGUAGGTUATTGAURGGUAGAAUAGAGTTTG<br>GUUAGGGUTGTUAGAGAAGAGTRGGGURGUUAAGUAGUUXGAUTTUUAGRGGAAA<br>AUUATUTGUUTTUTGGUTUUTUUATUTGUTGAGAGUTAUTTUUAUTUAATAAAAUU<br>TTGUAUTUATTUTUUAAAUUUAUATGAGATUUAATTUTTURGGTAUAUUAAGGUAG<br>GAAUUURGAGATAUAGAAAGUUU |

-continued

| SEQ ID NO: | Sequence |
|---|---|
| 384 | GGGUTTUTGTATUTRGGGGTTUUTGUUTTGGTGTAURGGAAGAATTGGATUTUATG<br>TGGGTITGGAGAATGAGTGUAAGGTTTTATTGAGTGGAAGTAGUTUTUAGUAGATG<br>GAGGAGUUAGAAGGUAGATGGTTTTURGUTGGAAGTXGGGUTGUTTGGRGGUURGA<br>UTUTTUTUTGAUAGUUUTGGUUAAAUTUTGTTUTGURGGTUAATGAUUTGURGGRG<br>TGUUAGTGUUTGTURGTGTGUTUTTGARGTGUTUTTGARGTGUTUTTGATGTUUTUT<br>RGAAATUUAAURGUTTGT |
| 385 | AUTTGAAGTUAGGAGTTRGTGAAUAGUUTGGUUAAUATGGTGAAAUUUTGTUTUTA<br>UTAAAAAAAGAAAAATTAGURGGGTGTGGTGGGRGUUTGTAAUUUUAGUAUTTTGG<br>GAGGUTGAGGTGGGTGGATUAUTTGAAGTUAGGAGTTXGTGAAUAGUUTGATUAAU<br>ATGGTGAAAUUUTGTUTUTAUTAAAAAUAUAAAAATTAGURGGGTGTGGTGGTGGG<br>TGUUTGTAATUUUAGUTAUTUAGGAGAUTGAGGUAGGAGGATUAUTTGAAURGGG<br>GAGGUAGAGGTTGUAGAGAGT |
| 386 | UTUTUTGUAAUUTUTGUUTUUURGGTTUAAGTGATUUTUUTGUUTUAGTUTUUTGA<br>GTAGUTGGGATTAUAGGUAUUUAUUAUUAUAUURGGUTAATTTTTGTGTTTTTAGTA<br>GAGAUAGGGTTTUAUUATGTTGATUAGGUTGTTUAXGAAUTUUTGAUTTUAAGTGA<br>TUUAUUUAUUTUAGUUTUUUAAAGTGUTGGGGTTAUAGGRGUUUAUUAUAUURGG<br>UTAATTTTTUTTTTTTTAGTAGAGAUAGGGTTTUAUUATGTTGGUUGUTTAAA<br>GAAUTUUTGAUTTUAAGTG |
| 387 | AAATUTTTTTUUTGUUTGUATTTTUTTAUATAAAGUAATUTAUTAUTGUUATRGGTT<br>UATTUAUTUAURGGAAUUTGTUTTGUUAGGAUUTGAUUTUAGUAGAUTGAGTUATA<br>UUAGUATUATUUTTGTTGGGGUUUAGGTUTGUATUUXGUTTURGGUUUUAGUUUUA<br>UTGTTAGUTUUATUAGGTUUTUTGGGGUAUAUUAAGGAGGURGTTTTUTLTUUUTTT<br>TTUTGAATTAGATUUUUAGAAAUAAGAUATUAGGUTTUUTGGGGAAATUTAATTTT<br>GUTUATGAATTTGAUUAT |
| 388 | ATGGTUAAATTUATGAGUAAAATTAGATTTUUUUAGGAAGUUTGATGTUTTGTTTUT<br>GGGGATUTAATTUAGAAAAAGGGAGAGAAAARGGUUTUUTTGGTGTGUUUUAGAG<br>GAUUTGATGGAGUTAAUAGTGGGGUTGGGGURGGAAGXGGGATGUAGAUUTGGGU<br>UUUAAUAAGGATGATGUTGGTATGAUTUAGTUTGUTGAGGTUAGGTUUTGGUAAGA<br>UAGGTTURGGTGAGTGAATGAAURGATGGUAGTAGTAGATTGUTTTATGTAAGAAA<br>ATGUAGGUAGGAAAAAGATTT |
| 389 | UAAGGTUUAGGTUUUAGUUTUUUUAURGURGUURGRGUUUTUUTAGGUUTRGGAG<br>RGGRGUTTTUTGRGGUUTRGAAGGTGGGGTGGGAAAGTTTGGGGAGTUURGGUTU<br>TUAUAGUUTGTRGTGAGAAUTGUUUURGGGGAATTRGTUXGURGTARGGAAAAAUT<br>GGURGGAGUAGAGTRGTURGRGGTTURGRGGTRGRGGGTGGAAGGTGAAGGTRGAG<br>GGAGGTUAGGUTGUTTUTGRGTGTUUTGARGGUTGGRGTGTTUTUTTGAGATGGGUT<br>RGGGUTAUTTGGUUAGUTTU |
| 390 | GAAGUTGGUUAAGTAGUURGAGUUUATUTUAAGAGAAUARGUUAGURGTUAGGAU<br>ARGUAGAAGUAGUUTGAUUTUUUTRGAUUTTUAUUTTUUAUURGRGAURGRGGAA<br>URGRGGARGALTUTGUTURGGUUAGTTTTTURGTARGGXGGARGAATTUUURGGGG<br>GUAGTTUTUARGAUAGGUTGTGAGAGURGGGAUTUUUUAAAUTTTUUUAUUUUAU<br>UTTRGAGGURGUAGAAAGGRGURGUTURGAGGUUTAGGAGGGRGRGGGRGGRGGT<br>GGGGAGGUTGGGAUUTGGAUUTTG |
| 391 | URGAGGGAGUUAGGUUAUAGUTGAUAGGAAGGUAGAAGGTGGUAGGAGGGGAGG<br>TTGRGUTGUAUUTUTGGGTTGUUUAGGUUAAUUTGUUAGGUAGGAGGGGGAAGUU<br>RGTGUUUAUTTTAUUATGAURGGGAAGATGATGGUAGUUAUXGTGGATTTGAGGAT<br>UUAGAGUAURGUUAGGUAGAGGATUTGUAUUAGGGTGAAGAGGTGGATURGGRGU<br>AGRGGUARGTGURGUAGGAAGGUATGGTURGGUTGGTGUTTGGUTGGUATUAGGAA<br>GAGUTTGUAGRGTTUUUAGAAUTA |
| 392 | TAGTTUTGGGAARGUTGUAAGUTUTTUUTGATGUUAGUUAAGUAUUAGURGGAUUA<br>TGUUTTUUTGRGGUARGTGURGUTGRGURGGATUUAUUTUTTUAUUUTGGTGUAGA<br>TUTTTUTGUUTGGRGGTGUTUTGGATUUTUAAATUUAXGGTGGUTGUUATUATUTTU<br>URGGTUATGGTAAAGTGGGUARGGGUTTUUUUUTUUTGUUTGGUAGGTTGGUUTGG<br>GUAAUUUAGAGGTGUAGRGUAAUUTUUUUTUUTGUUAUUTTUTGUUTTUUTGTUAG<br>UTGTGGUUTGGUTUUUTRGG |
| 393 | AAATTAUURGGGRGTGGTGGTGGGTGUUTGTAATUUUAGUTAUTUAGGAGGURGAG<br>GUAGGAGAAURGUTTGAAUURGGGAGGUAGAGUATAGGTTGTTGGAGGGTTGAAG<br>GTGUAUUUAGUAGAGAUTGGUATAUAGGAGGTUUTGUAAXGGUUUUAGGAAAUUT<br>UTGGGTUUAGTAAGAGUTTUAGUAGGAGGTAGAAUUATAURGGGUAGGAGTGUUT<br>GGAAAGGUTTUAAGGUAAUTUUUTUUAAAGTLTTrGGUUUAAUUUTAUAUTGTUAG<br>GUTGTTAAAGGUUATTTAAAAGUT |
| 394 | AGUTTTTAAATGGUUTTTAAUAGUUTGAUAGTGTAGGGTTGGGUUAGGAUTTTGGA<br>GGGAGTTGUUTTGAAGUUTTTUUAGGUAUTUUTGUURGGTATGGTTUTAUUTUUTG<br>UTGAAGUTUTTAUTGGAUUUAGAGGTTTUUTGGGGUXGTTGUAGGAUUTUUTGTAT<br>GUUAGTUTUTGUTGGGTGUAUUTTUAAUUUTUUAAUAAUUTATGUTUTGUUTUURG |

-continued

| SEQ ID NO: | Sequence |
|---|---|
| | GGTTUAAGRGGTTUTUUTGUUTRGGUUTUUTGAGTAGUTGGGATTAUAGGUAUUUA<br>UUAUUARGUURGGGTAATTT |
| 395 | AGGAAAAAAUAGUAGUUUAAGAATRGGGUUTUUUTGTTAUAGUAGGAGTRGUATU<br>TATTTATATATGTTATGTUTTATTGUTUAGUAAUUAGUTUTRGGURGGGGRGTGGGU<br>RGGGAAGAGGGGTUTUUTGGTGUAGXGGGTTGGRGTGAUTUATUAURGURGXGUAU<br>TUTGGUUTUTGGGUUTAGGTTAAUAGAUTUURGGGTTTUAGGUTGGGUUUAGGRGG<br>UUAGGUUUTUUUTGUTGAGGAATUTGGGTTGGGGUAGTGUUAGUTUUUTGUTTUTU<br>AUUTGGUUAUAGAAGGGGTA |
| 396 | TAUUUUTTUTGTGGUUAGGTGAGAAGUAGGGAGUTGGUAUTGUUUUAAUUUAGAT<br>TUUTUAGUAGGGAGGGUUTGGURGUUTGGGUUUAGUUTGAAAUURGGGAGTUTGT<br>TAAUUTAGGUUUAGAGGUUAGAGTGXGRGGRGGTGATGAGTUARGUUAAUUXGUT<br>GUAUUAGGAGAUUUUTUTTUURGGUUUARGUUURGGURGAGAGUTGGTTGUTGAG<br>UAATAAGAUATAAUATATATAAATAGATGRGAUTUUTGUTGTAAUAGGGAGGUURG<br>ATTUTTGGGUTGUTGTTTTTTUUT |
| 397 | AUUUAGGAATTUTTTTUUTTTTTTTTGAGARGGRGTUTUTGTRGUUUAGGUTGGAG<br>TGUAGTGGRGUAGTUTRGUUTAAUTGUAAGUTURGUUUURGGGTTUATGUUATTUT<br>UUTGUUTUAGUUTUTTGAGTAGUTGGAAUTAUAGGXGUUTGUUAUUAUAUURGGU<br>UAATTTTTTGTATTTTTAGTAGAGARGGGGTTTUAURGTGTTAGUTAGGATGGTUTR<br>GATUTUUTGAUUTRGTGATUUAUUUAUUTUAGUUTUTUAAAGTGUTGGGATTAUAG<br>GUTTGAAUUAUTGRGUUU |
| 398 | GGGRGUAGTGGTTUAAGUUTGTAATUUUAGUAUTTTGAGAGGUTGAGGTGGGTGGA<br>TUARGAGGTUAGGAGATRGAGAUUATUUTGGUTAAUARGGTGAAAUUURGTUTUTA<br>UTAAAAATAUAAAAAATTGGURGGGTGTGGTGGUAGGXGUUTGTAGTTUUAGUTAU<br>TUAAGAGGUTGAGGUAGGAGAATGGUATGAAUURGGGGGRGGAGUTTGUAGTTAG<br>GRGAGAUTGRGUUAUTGUAUTUUAGUUTGGGRGAUAGAGARGURGTUTUAAAAAA<br>AAAAAAAAAAGAATUUTGGGT |
| 399 | AAATAUAGUAGGAGAGAATTUUTUTGAGAUUTAAGATAURGTGUUUTTUUUUUTTG<br>GUUTUTUAGUTGUTGURGAGTUUTGGAGAAAATRGGGUATUTGAAUAGAGGURGTG<br>TTTGTUUUTGUTURGGUUTTGTGTTUTUATTUUTGUUAXGUUATUATGGATAATGAA<br>AGTTGAUTGGUTGURGGGGTTTUUTTTUTUTUTGUUUUTGTUATTTUUATTTGUUAG<br>GTUTUATGUUTTTTTTGUAUAGAGTTGTTGTGUTTGGGUTUTAATTTGUUAGGUAGT<br>GATAAATTUUAAGAAAA |
| 400 | TTTTUTTGGAATTTATUAUTGUUTGGUAAATTAGAGUUUAAGUAUAAUAAUTUTGT<br>GUAAAAAAGGUATGAGAUUTGGUAAATGGAAATGAUAGGGGUAGAGAGAAAGGA<br>AAUUURGGUAGUUAGTUAAUTTTUATTATUUATGATGGXGTGGUAGGAATGAGAAU<br>AUAAGGURGGAGUAGGGAUAAAUARGGUUTUTGTTUAGATGUURGATTTTUTUUAG<br>GAUTRGGUAGUAGUTGAGAGGUUAAGGGGGAAGGGUARGGTATUTTAGGTUTUAG<br>AGGAATTUTUTUUTGUTGTATTT |
| 401 | GUUUTGAGAUAUTAAATGGRGGGGGGGTGGGGGGAGGAAAGGGAAGGRGGUAGAG<br>UTUUURGAGURGGGAUAGTUAUTTAUTUTAUAGGUAGTGGGGUURGAUAUAGAUA<br>GRGURGUUUURGUUAGUUAGUUTRGUARGUUUTRGGAAGXGUAGGUTUURGGRGU<br>TGRGUTGGAGGGTTUUURGGUAUUUUAGUUTUURGTUUUUAGUURGUTGUAUUTU<br>RGGGUUUUUUTTAUUUTTGAGAGGUAURGGGAGTTGTRGRGGGGGGGUUTRGGGA<br>AATTUUURGGAUUUUTGTGUUAGGA |
| 402 | TUUTGGUAUAGGGGTURGGGGAATTTUURGAGGUUUUUURGRGAUAAUTUURGGT<br>GUUTUTUAAGGGTAAGGGGGGUURGGAGGTGUAGRGGGUTGGGGARGGGAGGUTG<br>GGGTGURGGGGAAUUUTUUAGRGUAGRGURGGGAGUUTGXGUTTURGAGGGRGTG<br>RGAGGUTGGUTGGRGGGGGRGGRGUTGTUTGTGTRGGGUUUUAUTGUUTGTAGAGT<br>AAGTGAUTGTUURGGUTRGGGGAGUTUTGURGUUTTUUUTTTUUTUUUTRTAUUUU<br>UURGUUATTTAGTGTUTUAGGGU |
| 403 | AUUAUAGUAUTGUAGGAGGATGAGUUUUTGUAGGAAGGAATGUTGGUTUTUTGGG<br>GTAGATAAAGAAGGTTUTGGGGAAGGGAAGGGAGGAAUAGGAAUATGGGUTUUUT<br>GUUAGGUTGTUUUAGGTURGGGATGUUATRGGUAAGTGGGXGGGGAUAGGUUTGG<br>GTAGATGAUATGGTAGTGAGTAAGTGGGGAGGUAGGUUAGUAGAGGAGUUAGGUT<br>UAUUTUUXGUUXGUUUAUUTRGGUUAUAGAURGGGAGGGGTRGGAGUAUTGRGTT<br>GGGGTTGATGAGUAGARGAUTGUUA |
| 404 | TGGUAGTRGTUTGUTUATUAAUUUUAARGUAGTGUTURGAUUUUTUURGGTUTGTG<br>GURGAGGTGGGXGGGXGGGAGGTGAGUUTGGUTUUTUTGUTGGUUTGUUTUUUUA<br>UTTAUTUAUTAUUATGTUATUTAUUUAGGUUTGTUUUXGUUUAUTTGURGATGGUA<br>TUURGGAUUTGGGAUAGUUTGGUAGGGAGUUUATGTTUUTGTTUUTUUUTTUUUTT<br>UUUUAGAAUUUUTUTUUATUTAUUUUAGAGAGUUAGUATTUUTTUUTGUAGGGGUTU<br>ATUUTUUTGUAGTGUTGTGGT |
| 405 | AGGGAAGGGAGGAAUAGGAAUATGGGUTUUUTGUUAGGUTGTUUUAGGTURGGGA<br>TGUUATRGGUAAGTGGGXGGGGAUAGGUUTGGGTAGATGAUATGGTAGTGAGTAA |

-continued

| SEQ ID NO: | Sequence |
|---|---|
| | GTGGGGAGGUAGGUUAGUAGAGGAGUUAGGUTUAUUTUUXGUUXGUUUAUUTRGG<br>UUAUAGAURGGGAGGGGTRGGAGUAUTGRGTTGGGGTTGATGAGUAGARGAUTGU<br>UAGGUAGUUATTUAUAGGAAATGGUAUAGARGUAUATTGTTUUAGUTAUUUUUUA<br>TUUTUUUTUAGGGGUAAAGTGAATG |
| 406 | ATTUAUTTTGUUUUTGAGGGAGGATGGGGGGTAGUTGGAAUAATGTGRGTUTGTGU<br>UATTTUUTGTGAATGGUTGUUTGGUAGTRGTUTGUTUATUAAUUUUAARGUAGTGU<br>TURGAUUUUTUURGGTUTGTGGURGAGGTGGGXGGGXGGGAGGTGAGUUTGGUTU<br>UTUTGUTGGUUTGUUTUUUUAUTTAUTUAUTAUUATGTUATUTAUUUAGGUUTGTU<br>UUXGUUUAUTTGURGATGGUATUURGGAUUTGGGAUAGUUTGGUAGGGAGUUUAT<br>GTTUUTGTTUUTUUUTTUUUTT |
| 407 | GGTTUTAAAUAUAUAAAUUTTTGATGUATUTGGAATTTAUUTTAATUUUTAUUAAT<br>TTTTATUAATGGUTUAATATTTGGGGGATTTTUATGGTAATTGUAUTGAATGTATTAA<br>UTGGTUAGGGAGGATTAUATUAAGAUUAURGGUTXGAGAAAUAGUAGTUTGTTUUT<br>UUAUUUUUARGTUTGUATUUAGGUUUTTUUAUAGAGATUTUATTTUTUUTGUAGAT<br>GAUTUATTUAGTGTUTAGGAATURGGTGUTUTGTGGUUAUTAURGAGAGTGGGATA<br>TTTTUUUUUATTTTATT |
| 408 | AATAAAATGGGGGAAAATATUUUAUTUTRGGTAGTGGUUAUAGAGUAURGGATTUU<br>TAGAUAUTGAATGAGTUATUTGUAGGAGAAATGAGATUTUTGTGGAAGGGUUTGGA<br>TGUAGARGTGGGGGTGGAGGAAUAGAUTGUTGTTTUTXGAGURGGTGGTUTTGATG<br>TAATUUTUUUTGAUUAGTTAATAUATTUAGTGUAATTAUUATGAAAATUUUUUAAA<br>TATTGAGUUATTGATAAAAATTGUTAGGAAATTAAGGTAAATTUUAGATGUATUAA<br>AGGTTTGTGTGTTTAGAAUU |
| 409 | TTTGGGGGGUAGGGAGGGTTUAGTUUUUTUAGGUUTGGUTGTGTUUUUTGUUUUUU<br>AUUUAUAATUAGGUUUAGGGTTGGGGGGTGUAUAUUAAGGAGGGGUAGGAAGTGT<br>UUAAGAAGUAGAAURGGUTUTGTGTUUUUAGTGGXGGXGGGTGTUTGGGGUAGGA<br>GGAGGUTATUTGATUUUTTUUUUAUTGUUURGGUUATGAUUTUUTUUUTUUUTUUU<br>TRGUTUUUTUUUTUUTUUUTUUUTUUUTUUUTUUUTUUUTUUTUUUUTTTTUUTU<br>GGGTAGUUAGUAUUUTGGGUTG |
| 410 | AGUUUAGGGTGUTGGUTAUUUUAGUUATGAAGGAGGAGGGAGGGAGGGAGGGAG<br>GGAGGGAGGGAGGGAGGGAGRGAGGGAGGGAGGGAGGAGGTUATGGURGGGGUA<br>GTGGGGAAGGGATUAGATAGUUTUUTUUTGUUUUAGAUAUUXGUXGUUAUTGGGG<br>AUAUAGAGURGGTTUTGUTTUTTGGAUAUTTUUTGUUUUTUUTTGGTGTGUAUUUU<br>UUAAUUUTGGGUUTGATTGTGGGTGGGGGGUAGGGGAUAUAGUUAGGUUTGAGGG<br>GAUTGAAUUUTUUUTGUUUUUUAAAG |
| 411 | UURGUAAGUUTRGUUUUTUUAGGUUTRGUUUTUUUTUUTTGUAGAGAGTGGUUAA<br>GUTRGTGTTUUAGAGGUTGAATGAGGATTTTGTGRGGAAGUURGAUTATGUTTTGAG<br>UTUTGTGGGTAAGAUURGGAGAUAUTGGAAGAUAGAGAXGUAGAUAGGAAAGAGG<br>UUAAGAUAUTGAUAUAGAUAGAUUUATGUAUUTGAURGGURGAAGAUAGAGUUTR<br>GGAUAGUUUUUAUURGUUUUUAGUUUURGRGUUUURGRGUUURGAUTUURGGUAA<br>GGUUTGGGAGUUTUTGAGGGTTA |
| 412 | TAAUUUTUAGAGGUTUUUAGGUUTTGURGGGAGTRGGGGRGRGGGGGRGRGGGGG<br>UTGGGGGRGGGTGGGGGUTGTURGAGGUTUTGTUTTRGGURGGTUAGGTGUATGGG<br>UUTGTUTGTGTUAGTGTUTTGGUUTUTTTUUTGTUTTGGGTTUUUGTAAGRTTT<br>URGGGTUTTAUUUAUAGAGUTUAAAGUATAGTRGGGUTTURGUAUAAAATUUTUAT<br>TUAGUUTUTGGAAUARGAGUTTGGUUAUTUTUTGUAAGGAGGGAGGGRGAGGUUT<br>GGAGGGGRGAGGUTTGRGGG |
| 413 | UAGATUAGGGTUUTUAGAUTTGTURGGAGGGAGGGUUUTGUATAUUTGUUAARGU<br>UUTGTTTGUTGGGAAAGGGGUTGATGTTGUAATGAUAGGTTAAAUAGUAAUAGGAU<br>ATTGAUTGGUATUTGUAAGUTGAGUTUAGUTUAGAGAGGXGAGGAGUAUAGGGGA<br>GGGAGGAAAATUURGGTGTGGATUTUAUUUAUARGGUUUAUTGGGTGUTUUTGGU<br>AGARGGAATTATGGGTGUTTTTAUTUTUTUATTTTAAAAATGTGUTTTTTATGTGTAT<br>TGTAAAAGTAAUAGATTUUUA |
| 414 | TGGGAATUTGTTAUTTTTAUAATAUAUATAAAAAGUAUATTTTTAAAATGAGAGAGT<br>AAAAGUAUUUATAATTURGTUTGUUAGGAGUAUUUAGTGGGURGTGTGGGTGAGAT<br>UUAUAURGGGATTTTUUTUUUTUUUUTGTGUTUUTXGUUUTUTGAGUTGAGUTUA<br>GUTTGUAGATGUUAGTUAATGTUUTGTTGUTGTTTAAUUTGTUATTGUAAUATUAGU<br>UUUTTTUUUAGUAAAUAGGGRGTTGGUAGGTATGUAGGGUUUTUUUTURGGAUAA<br>GTUTGAGGAUUUTGATUTG |
| 415 | UAUTTGGUTUTRGTGGUTGGGAUAGATTGUTTUUTTUUTUTUTUUTGGGTGUUAGGT<br>AGGUUUAGAAAUUAUUTGATGTUAGUAAGGUUTGGUUAUUUAUTGGTGGGGAGGA<br>AGTGGGRGGGTGUUUAGGGAUAGATGAGURGGGUAGAXGTGUUUTGAGGUAGUAU<br>AGTUAGGGUTGARGTGGGUATTATGUAUUTRGGGGUTTTUAGAGUTGGUTURGGTU<br>URGTTTGUUUAUATUAAGUAGGTUAGAGTGGAGAGGGUUAGGGGRGUTGGGGTUA<br>AGGUATGUAUTGAUUAGGRGTU |

-continued

| SEQ ID NO: | Sequence |
|---|---|
| 416 | GARGUUTGGTUAGTGUATGUUTTGAUUUUAGRGUUUUTGGUUUTUTUUAUTUTGAU<br>UTGUTTGATGTGGGUAAARGGGAURGGAGUUAGUTUTGAAAGUUURGAGGTGUAT<br>AATGUUUARGTUAGUUUTGAUTGTGUTGUUTUAGGGUAXGTUTGUURGGUTUATUT<br>GTUUUTGGGUAUURGUUUAUTTUUTUUUUAUUAGTGGGTGGUUAGGUUTTGUTGA<br>UATUAGGTGGTTTUTGGGUUTAUUTGGUAUUUAGGAGAGAGGAAGGAAGUAATUT<br>GTUUUAGUUARGAGAGUUAAGTG |
| 417 | AUUAUAUTTGAAUATAUAGAUATUUTTTTUUAGGGTGTGTTGTGUTRGATAUUTTT<br>AATTUUTGTUTGUATTUUAGGGUUTGUUUAGUUTUTTUUTGGUTUUUUAGUUUAGU<br>UTGGTUUTTURGGUUTUUUTGTUATUUUUAUUTUTXGTGTGTGUAUAAGUAGGGAU<br>UAGGTAGGGAGAURGGUAGATGUTGUTUTUTGTUUUTGGGGTTTUTTTTUTTAGTGT<br>TGUTUUUAUAUUUARGRGATGUTTTAATTAAUTGUUAUAUTUAGGUTTTUTUAGTG<br>GGGAGAGTUAGAAATAGA |
| 418 | UTATTTUTGAUTUTUUUUAUTGAGAAAGUUTGAGTGTGGUAGTTAATTAAAGUATR<br>GRGTGGGTGTGGGAGUAAUAUTAAGAAAAGAAAUUUUAGGGAUAGAGAGUAGUAT<br>UTGURGGTUTUUUTAUUTGGTUUUTGUTTGTGUAUAUAXGAGAGGTGGGGATGAUA<br>GGGAGGURGGAAGGAUUAGGUTGGGUTGGGGAGUUAGGAAGAGGUTGGGUAGGU<br>UUTGGAATGUAGAUAGGAATTAAAGGTATRGAGUAUAAUAUAUUUTGGAAAAGGA<br>TGTUTGTATGTTUAAGTGTGGATG |
| 419 | TUUUAGUUAUTURGUAGTUAUTUUTGAUUUAGAAAAGAAUAAUUAUAGUTGGGUU<br>UAGUAUUURGGGUUAUTUUUTGUAGUTGUUUAUAUATUTGGUAGUTGGGTUUAUT<br>TATGUAATGTGGATXGGGTTTTUTTAUATUTGAAATUTGXGTUTUTATUUUTUUTUTG<br>AGAUUAGTGTUTUUTGUUAGUTTUUATGGUUURGGGATGAUUTUAUTUTUUUAGGG<br>TUTUUUTGRGTUUTGGGAGUTUTGGURGAGGAGUAGUAGGGGUTGATGGUAGAGR<br>GGGGGUAGGTUAGAGUTUAGUA |
| 420 | GUTGAGUTUTGAUUTGUUUmGUTUTGUUATUAGUUUUTGUTGUTUUTRGGUUAGA<br>GUTUUUAGGARGUAGGGAGAUUUTGGGAGAGTGAGGTUATUURGGGGUUATGGAA<br>GUTGGUAGGAGAUAUTGGTUTUAGAGGAGGGATAGAGAXGUAGATTTUAGATGTA<br>AGAAGUUXGATUUAUATTGUATAAGTGGAUUUAGUTGUUAGATGTGTGGGUAGUT<br>GUAGGGAGTGGUURGGGGTGUUGGGUUUAGUTGTGGTTGTTUTTTTUTGGGTUAGG<br>AGTGAUTGRGGAGTGGUTGGGAU |
| 421 | UUAAARGRGGUAUARGGGGARGGUUUUTUURGGGGTUAGGUTUAUTGGUTUUTTU<br>UUTTUAGRGUUAUUAGGUAGGAGGGUUAARGGTUAUAUAGGAGGUAUUUTUAUUT<br>GUUTTTGUAUUAGUAAATAAAGTGUATUUUATTTTXGTGTGAGXGTRGGUURGGTG<br>AGTUAGUUUTTURGGGUUUTTTUUTGTTUTUAGGGUAGGGGGRGTGRGUTGAGUUA<br>GAGGTAGATUTGUAGAAAGGGUUURGAUTGGGUUTRGGGUAGGGURGGRGUUUAU<br>UAUAUTUTGGGGGTUAGUTATGU |
| 422 | GUATAGUTGAUUUUUAGAGTGTGGTGGGRGURGGUUUTGUURGAGGUUUAGTRGG<br>GGUUUTTTUTGUAGATTTTAUUTUTGGUTUAGRGUARGUUUUUTGUUUTGAGAAUAG<br>GAAAGGGUURGGAAGGGUTGAUTUAURGGGURGAXGUTUAUAXGAAAATGGGATG<br>UAUTTTATTTGUTGGTGUAAAGGUAGGTGAGGGTGUUTUUTGTGTGAURGTTGGUU<br>UTUUTGUUTGGTGGRGUTGAAGGGAAGGAGUUAGTGAGUUTGAUUURGGGAGGGG<br>URGTUUURGTGTGURGRGTTTGG |
| 423 | GUAGGAAGGGUUUAGARGAUAUUUUUAUAGAUATATGUUAGUUUUTURGGGTGAU<br>UAAAATUATUTUAGTAAAGGUAGATGAGGUUAAGRGAAAAGGGGTGGGTGGAAGA<br>AURGGUTUTGAGTUTUAGUUUAUAGAUAUTRGGAUAUTXGTRGGUURGGTAGGUA<br>GGGGTTUUTGGTGGUUTUAGGUTGTUAGGUURGGUUUUUTUURGUAGUTGTUTUUA<br>GUTUUUAUUTUUUURGUUUAUUUUUUAGGAUTUUTATTTUAUTGAGGAGATTAAG<br>AUUAUUTGGRGAGAAUUUUTUUUA |
| 424 | GGGAGGGGTTUTRGUUAGGTGGTUTTAATUTUUTUAGTGAAATAGGAGTUUTGGGG<br>GGTGGGRGGGGGAGGTGGGAGUTGGAGAUAGUTGRGGGAGGGGGURGGGUUTGAU<br>AGUUTGAGGUUAUUAGGAAUUUUTGUUTAURGGGURGAXGAGTGTURGAGTGTUT<br>GTGGGUTGAGAUTUAGAGURGGTTUTTUUAUUUAUUUUTTTTRGUTTGGUUTUATU<br>TGUUTTTAUTGAGATGATTTTGGTUAUURGGAGGGGUTGGUATATGTUTGTGGGGGT<br>GTRGTUTGGGUUUTTUUTGUT |
| 425 | AGGTGAGATUTGGAGGTTGRGGGGUAGTTAGUAAGTGGGAGAGAGUTGUATGRGGG<br>GAAGGTGGGAGGRGTTGUAGGAAAGGTGAGGGAGAUAUAGUTGAGUTGTGGTGUT<br>GGUUAGUTGGGGUUTTGRGUUTTATURGGGUAUTGTGAXGGUUAUTAAUAGGTTTT<br>AAGTAURGGAATGAUATGATRGGATTTGTAATTTAAUTAGATUUTTUTGAUTGUTGT<br>TGGGGGAAUAGAUTGTUAAUUTUAUAAUAGUAUTGTUAGUTGAGTATTAGAUAAAT<br>GATGAAUUTGGGUUUAGGGA |
| 426 | UUUTGGGUUUAGGTTUATUATTTGTUTAATAUTUAGUTGAUAGTGUTGTTGTGAGGT<br>TGAUAGTUTGTTUUUUUAAUAGUAGTUAGAAGGATUTAGTTAAATTAUAAATURGA<br>TUATGTUATTURGGTAUTTAAAAUUTGTTAGTGGUXGTUAUAGTGUURGGATAAGG<br>RGUAAGGUUUUAGUTGGUUAGUAUUAUAGUTUAGUTGTGTUTUUUTUAUUTTTUUT |

-continued

| SEQ ID NO: | Sequence |
|---|---|
| | GUAARGUUTUUUAUUTTUUURGUATGUAGUTUTUTUUUAUTTGUTAAUTGUUURGU<br>AAUUTUUAGATUTUAUUTG |
| 427 | TGTGTTAUUUUAGAAAGUAAGGARGUTTUUAAAGATGTTUAGAGUAGTGTTUAAAG<br>GGATGUUUAUTGGTUAGTUUUAAURGUTGTGAAUURGGAAAATUTGAGAUTGGTGT<br>UAGTTAATTTAGAAAGTTTATTTTGUUAAGGTTGAGGAXGTATGUUTGTGAUAUAGU<br>UTUAGGAAGTUUTGATGAUATGTGUUUAAGGTGGTTGGGGTGTAGUTTGATTTTATA<br>UAUTTAGGGAGUATGAGAUATUAATTAAGTAUAUTTGAGAAATAUATRGGTTTGGT<br>UTAGAAAGGRGGGAUAAU |
| 428 | GTTGTLURGUUTTTUTAGAUUAAAURGATGTATTTUTUAAGTGTAUTTAATTGATGT<br>UTUATGUTUUUTAAGTGTATAAAATUAAGUTAUAUUUUAAUUAUUTTGGGUAUATG<br>TUATUAGGAUTTUUTGAGGUTGTGTUAUAGGUATAXGTUUTUAAUUTTGGUAAAAT<br>AAAUTTTUTAAATTAAUTGAUAUUAGTUTUAGATTTTURGGGTTUAUAGRGGTTGGG<br>AUTGAUUAGTGGGUATUUUTTTGAAUAUTGUTUTGAAUATUTTTGGAAGRGTUUTT<br>GUTTTUTGGGGTAAUAUA |
| 429 | TGAGAATAATGTUTGGTATGRGAGGAGUAUUAGUAAATRGTGUTUATUATTUUAGR<br>GGAGUAAATTGTTGUTGTUTUTUAURGGGUTTTGGGTTAUTGAGGUTGUTATTTATT<br>AAAGTGTGGGTTGTGAUTUATTAUTAGGTUATGAAATXGGTGTAGTGGTAGUAAUU<br>AGUUUTTAAAGAAATGAAURGGGGURGGGRGRGGTGGTTUAUAUUTGTAATUUUAG<br>UAUTTTGGGAGGURGAGGRGGGTGGATUARGAGGTUAAGAGATRGAGAUUATUUTG<br>GUUAAUATGGTGAAAUURG |
| 430 | RGGGTTTUAUUATGTTGGUUAGGATGGTUTRGATUTUTTGAUUTRGTGATUUAUURG<br>UUTRGGUUTUUUAAAGTGUTGGGATTAUAGGTGTGAAUUAURGRGUURGGUUURG<br>GTTUATTTUTTTAAGGGUTGGTTGUTAUUAUTAUAUXGATTTUATGAUUTAGTAATG<br>AGTUAUAAUUUAUAUTTTAATAAATAGUAGUUTUAGTAAUUUAAAGUURGGTGAG<br>AGAUAGUAAUAATTTGUTURGUTGGAATGATGAGUARGATTTGUTGGTGLTTUUTRG<br>UATAUUAGAUATTATTUTUA |
| 431 | AGGATGGAGGURGGGGAGGUAGRGURGURGGRGGGGGRGGGRGGURGRGURGUAG<br>GRGGUTGGGGUAAGTGGGTGRGGUTUAARGTGGGGGGUARGGTGTTUUTGAUUAUU<br>RGGUAGARGUTGTGURGRGAGUAGAAGTUUTTUUTUAGUXGUUTGTGUUAGGGGG<br>AAGAGUTGUAGTRGGAURGGGTGAGGUUUURGGGGTGGGRGGRGAGRGGGRGGTG<br>GGTUUTURGUTRGUURGARGRGGGGUTGTRGGGUUTGGUTRGUURGUUAGGUTGGG<br>GAUURGGURGGGTTUATTTURGA |
| 432 | TRGGAAATGAAUURGGURGGGTUUUUAGUUTGGRGGGRGAGUUAGGUURGAUAGU<br>UURGRGTRGGGRGAGRGGAGGAUUUAURGUURGUTRGURGUUUAUUURGGGGGUU<br>TUAUURGGTURGAUTGUAGUTUTTUUUUUTGGUAUAGGXGGUTGAGGAAGGAUTTU<br>TGUTRGRGGUAUAGRGTUTGURGGGTGGTUAGGAAUAURGTGUUUUUUARGTTGAG<br>URGUAUUUAUTTGUUUUAGURGUUTGRGGRGRGGURGUURGUUUURGURGGRGGR<br>GUTGUUTUUURGGUUTUUATUUT |
| 433 | TUTAUTGATGRGGAGAURGAGUUUUAGGGUAGUAGAGUUUTAGUTTRGRGUTAUA<br>RGGUTGTGGGRGUTGRGUUUUAGGGUARGGURGGUUUAGGTRGTGGUUUAUTRGG<br>GAUURGRGGUTUAURGGTGRGGTTGARGRGGUARGGGAAGXGGTAGGTGUTUAGU<br>AUUTUUTUUTRGTUUTGUTRGTRGATGAUURGGUAUTGGRGUAGATARGGRGTGAG<br>UTTGGURGGGTTUAGGGRGRGAGUUAGURGATGURGGARGUUUTRGATTRGUTUUU<br>AUAGRGRGTUUTUUTURGUUTUA |
| 434 | TGAGGRGGAGGAGGARGRGUTGTGGGAGRGAATRGAGGGRGTURGGUATRGGUTGG<br>UTRGRGUUUTGAAUURGGUUAAGUTUARGURGTATUTGRGUUAGTGURGGGTUATR<br>GARGAGUAGGARGAGGAGGAGGTGUTGAGUAUUTAUXGUTTUURGTGURGRGTUA<br>AURGUAURGGTGAGURGRGGGTUURGAGTGGGUUARGAUUTGGGURGGURGTGUU<br>UTGGGGRGUAGRGUUUAUAGURGTGTAGRGRGAAGUTAGGGUTUTGUTGUUUTGG<br>GGUTRGGTUTURGUATUAGTAGA |
| 435 | UTUAUUTTTUUTAGTTTAGAAAATUUUTUAUTGUTTUUUUAATGGAGGUTGUUUUA<br>GGAGTGGUUUAGTGGGGUUAAUUAGUTGTTUTATGUUAGUAGUTURGGAGTATGTA<br>UATTTUUAUTUTGGTTUAAAUTTGTTUTTUTATTUAXGGUUUUATTAAGAAA<br>TUATUTGUAGGUTGGAURGGGTTGGGATGUAGUAAGTTGGTGTGGUTAUTURGAGT<br>GTGTGAUAUAUUTGUAGGGGUUTGTGAGUAGTGGGAGGGUUAGAUATGTGGATTU<br>UUAGGGUTGGTGGUTTUUTT |
| 436 | AGGAAGUUAUUAGUUUTGGGAATUUAUATGTUTGGUUUTUUUAUTGUTUAUAGGU<br>UUUTGUAGGTGTGTUAUAUAUTRGGAGTAGUUAUAUUAAUTTGUTGUATUUUAAU<br>URGGTUUAGUUTGUAGATGAATGTTnTUTTAATGGGGUXGTGAATAGAAGAAUAA<br>GTTTGAAUUAGAGTGGAAATGTAUATAUTURGGAGUTGUTGGUATAGAAUAGUTGG<br>TTGGUUUUAUTGGGUUAUTUUTGGGGUAGUUTUUATTGGGGAAGUAGTGAGGGATT<br>TTUTAAAUTAGGAAAGGTGAGA |
| 437 | AARGUTGAUATUTTTURGGGTGTUTGAAAAUAGAAUTGGUUTTUUTAAGAAUTAAU<br>AARGATAUTGTTTTUAGUUARGTTUUTTUUTGTTUTTGUTAUARGUTUTGTUAAAT |

-continued

| SEQ ID NO: | Sequence |
|---|---|
| | AGGTGGUUAGAGGUURGGGTGUAGATGUAGTGGUTUAXGTUAGTAATUUUAGUAU<br>TUTGGGAGGUTGGTGGGRGGATUAUTTGAGGUUAGGAGTTTAAAGAUUAGUTTGGG<br>UAAUATGGTGAAAUUUTGTUTUTAUTAAAAATAUAAAAAATTAGURGGGTGTGGTG<br>GUAUAAAUUTGTAGTTUUAG |
| 438 | UTGGAAUTAUAGGTTTGTGUUAUUAUAUURGGUTAATTTTTTGTATTTTTAGTAGAG<br>AUAGGGTTTUAUUATGTTGUUUAAGUTGGTUTTTAAAUTUUTGGUUTUAAGTGATU<br>RGUUUAUUAGUUTUUUAGAGTGUTGGGATTAUTGAXGTGAGUUAUTGUATUTGUA<br>UURGGGUUTUTGGUUAUUTATTTGAUAGAGRGTGTAGUAAGAAUAGGAAGGGAAR<br>GTGGUTGAAAAUAGTATRGTTGTTAGTTUTTAGGAAGGUUAGTTUTGTTTTUAGAUA<br>UURGGAAAGATGTUAGRGTT |
| 439 | GAGGUUUAUUUARGUUUUUAGUTUARGATATUTGUAGAGATGUUAAAUUUTGGUA<br>GAGGAAUTUAGGUUATGTGUTTUAGUUGUTXUUTUAUTUUTUUAUTUUUTGUURGG<br>GUUUTGAGUUAGGAGUUAGGUAUAUAGUTGGAUUUATUXGUUAATGUUAUUUAU<br>UUTTGTGUUUAGUAUURGGUUUARGGUAGGTGUTUAGTGTGUAGGUUUAUATGTA<br>UTAGGTGUAAGGUAARGAUAUAUUAUAUAGGAUAAGGATGUAAAGUAUUTTUTGG<br>GUUUTTUTGRGGUTUTGUUTTUUUA |
| 440 | TGGGAAGGUAGAGURGUAGAAGGGUUUAGAAGGTGUTTTGUATUUTTGTUUTGTGT<br>GGTGTGTRGTTGUUTTGUAUUTAGTAUATGTGGGUUTGUAUAUTGAGUAUUTGURG<br>TGGGURGGGTGUTGGGUAUAAGGGTGGGTGGUATTGGXGGATGGGTUUAGUTGTGT<br>GUUTGGUTUUTGGUTUAGGGUURGGGUAGGGAGTGGAGGAGTGAGGGAGUAGUTG<br>AAGUAUATGGUUTGAGTTUUTUTGUUAGGGTTTGGUATUUTGUAGATATRGTGAG<br>UTGGGGGRGTGGGTGGGUUTU |
| 441 | GGAGGUAAARGGGAAUURGGUTGGRGGGUTGRGAGURGGTAGGGARGUTGGGGTU<br>UAGGGUTGUTGGAUAGUUURGUUUTGTAUUTUTUUUUATAATTUUUTGGTGGGT<br>GTURGAAATAGUUURGGGTAATUUUAGGGRGAGGUAGTXGGGAATTAAUUUUAGU<br>UTTGAAGTAAGAGAUAGAGGRGTUUAUAGAAGAGGGUTUTGRGRGTUURGGAUTG<br>GAUAUAGRGUAGAGTUUATTUUAGGGAUAURGUAAUURGUAAGRGAUUUAGGUUR<br>GUTUUAGGGRGGGATURGRGRGGU |
| 442 | GURGRGRGGATUURGUUUTGGAGRGGGUUTGGGTRGUTTGRGGGTTGRGGTGTUUU<br>TGGAATGGAUTUTGRGUTGTGTUUAGTURGGGARGRGUAGAGUUUTUTTUTGTGGA<br>RGUUTUUXGTUTUTTAUTTUAAGGUTGGGGTTAGTTGGAAUUUTTUUTTTUUGUT<br>TAUURGGGGUTATTTRGGAUUUAGGATTAAGTGAGGGATGGGGAGAGGTAUAGGGR<br>GGGGUTGTUUAGUAGUUUTGGAUUUUAGRGTUUUTAURGGUTRGUAGUURGUUAG<br>URGGGTTUURGTTTGUUTUU |
| 443 | UATGTGUTGAGATGGAGAAGGRGUUAGTGTUAGUAUTAGAUAGGUTGAGATGTUA<br>AGTGGAAATGTUAAGGAGGTGGTGGAGGTGGTGGGAGUTGUAGGGUTGTGAGGUU<br>RGGGAGAGGGUUAGAGUTGUAGUTTTAAATTGGAGGGTUAXGGUATGTGGAGGUU<br>AAGGAAGUAGATGGGATGTURGGGGAGAGAGTATGGAUTGAAGUAGUTAAAGAAT<br>TGUAGUATUTAATGGAUAGGAAGAGGGGUAGRGAUAGRGATGGAGUUTGAGAAGG<br>AGGGTGUAGTGTUUUUAAGUUATGT |
| 444 | AUATGGUTTGGGGAUAUTGUAUUUTUUTTTTUAGGUTUUATRGUTGTRGUTGUUUU<br>TUTTUUTGTUUATTAGATGUTGUAATTUTTTAGUTGUTTUAGTUUATAUTUUUTUUU<br>RGGAUATUUUATUTGUTTUUTTGGUUTUUAUATGUXGTGAUUUTUUAATTTAAAGU<br>TGUAGUTUTGGUUUUUUURGGGUUTUAUAGUUUTGUAGUTUUUAUUAUUTUUAU<br>UAUTTUUUUUTGAUATTTUUAUTTGAUATUTUAGUUTGTUTAGTGUTGAUAUTGGRGU<br>UTTUTUUATUTUAGUAUATG |
| 445 | UUUTUAGGTTTGGTTTUTGTTGURGUTGTTGTTTTUTTTUTUUAAUATUATAAGUUTUT<br>TUUTTATUTTTUUATGTUTGUAUAUAGGAAGRGGUATUAUTTGTTTTTUATGTUUTG<br>RGUATRGAGGUAUAUTTTUUGUTUUTUTTTGTGUXGUUAGURGGUUUAGGUUUAUA<br>GATGGTAGGAUTTGTGUUUUAGGUTGUTGTGTGAGTUAGAGTUAGGUAGGAAGUAA<br>ATGGUAAUTTUAURGRGGTGAUTGAGGAATGUTTAARGAAGGRGURGUUUTTGAUA<br>ARGGTGTGGGTTGGTAA |
| 446 | TTAUUAAUUUAUAURGTTGTUAAGGGRGGRGUUTTRGTTAAGUATTUUTUAGTUAU<br>RGRGGTGAAGTTGUUATTTGUTTUUTGUUTGAUTUTGAUTUAUAUAGUAGUUTGGG<br>GUAUAAGTUUTAUUATUTGTGGGUUTGGGURGGUTGGXGGUAUAAAGAGGAGUAG<br>AAAGTGTGUUTRGATGRGUAGGAUATGAAAAAUAAGTGATGURGUTTUUTGTGTGU<br>AGAUATGGAAAGATAAGGAAGAGGUTTATGATGTTGGAAAAGAAAAUAAUAGRGG<br>UAAUAGAAAUUAAAUUTGAGGG |
| 447 | TGUTUUTUTTTGTGURGUUAGURGGUUUAGGUUUAUAGATGGTAGGAUTTGTGUUU<br>UAGGUTGUTGTGTGAGTUAGAGTUAGGUAGGAAGUAAATGGUAAUTTUAURGRGGT<br>GAUTGAGGAATGUTTAARGAAGGRGURGUUUTTGAUAAXGGTGTGGGTTGGTAAAA<br>GGAAAUAGURGGGAGUUUTGUAGRGURGGTGURGUUAURGTTTAGTUTGAUTGTGU<br>ATTTGAUTAAGTUAUAAGAGGUUAGGUUTGTGAUTTGTURGAGGGAAAAAUUAUU<br>AGAAAAUUAGGTGTUTGGGUT |

-continued

| SEQ ID NO: | Sequence |
|---|---|
| 448 | AGUUUAGAUAUUTGGTTTTUTGGTGGTTTTTUUUTRGGAUAAGTUAUAGGUUTGGU<br>UTUTTGTGAUTTAGTUAAATGUAUAGTUAGAUTAAARGGTGGRGGUAURGGRGUTG<br>UAGGGUTUURGGUTGTTTUUTTTTAUUAAUUUAUAUXGTTGTUAAGGGRGGRGUUT<br>TRGTTAAGUATTUUTUAGTUAURGRGGTGAAGTTGUUATTTGUTTUUTGUUTGAUTU<br>TGAUTUAUAUAGUAGUUTGGGGUAUAAGTUUTAUUATUTGTGGGUUTGGGURGGU<br>TGGRGGUAUAAAGAGGAGUA |
| 449 | UTGTGUTUAAGAGUUAUTTUTTAAURGGGGTGGGAGGAAGUAGUTTUAGGAAUTGU<br>TGAGAGAGUAGAAUTUARGUTUUAGGGUTUAGAGUAGGAGGTAGGGTGTGRGGUA<br>AGRGUTGGUURGGAUAGAAGUAGAGTGGGUUUTGGTUTXGGGUAGGATGTTTUTGA<br>UTUAUATTTUUTGAGGAGAGAAAGUTAAGUTUUTGUUTAATGTUTUTGTUTUUUUT<br>TUUAGAAAAATGUUTUAGUTUTTURGGUUTGAAGGAATGGUUTUUTUmGGGUUUU<br>ATGATTUTTTUUTGTGTGGG |
| 450 | UUUAUAUAGGAAAGAATUATGGGGUURGGGAGGAGGUUATTUUTTUAGGURGGAA<br>GAGUTGAGGUATTTTTUTGGAAGGGGAGAUAGAGAUATTAGGUAAAGAGUTTAGUT<br>TTUTUTUUTUAGGAAATGTGAGTUAGAAAUATUUTGUUXGAGAUUAGGGUUUAUTU<br>TGUTTUTGTURGGGUUAGRGUTTGURGUAUAUUUTAUUTUUTGUTUTGAGUUUTGG<br>AGRGTGAGTTUTGUTUUTUAGUAGTTUUTGAAGUTGUTC<br>AGAAGTGGUTUTTGAGUAUAG |
| 451 | TTTTTTTTTTGAGAUAGAGTUTRGUTUTGTUAUUUAGGUTGGAGTGUAGTGGRGTGA<br>TUTRGGUTUAUTGUAAGUTUUAUUTTUURGGGTTUATGUUATTUTUUTGUUTUAGUT<br>TUUTGAGTATUTGGGAUTAUAGGUAUTUAUUAUUAXGUURGGUTAATTTTUURTTTT<br>TATTTTTAGTGGAGARGGGGTTTUATTGTGTTAGUUAGGATGGTUTRGATUTUUTGA<br>UUTRGTGATUAGUURGUUTUAGUUTUUUAAAGTGUTGGGATTAUAGGTGTGAGUUA<br>UUTUAUURGGUUTGUTA |
| 452 | AGUAGGURGGGTGAGGTGGUTUAUAUUTGTAATUUUAGUAUTTTGGGAGGUTGAG<br>GRGGGUTGATUARGAGGTUAGGAGATRGAGAUUATUUTGGUTAAUAUAGTGAAAU<br>UURGTUTUUAUTAAAAATAAAAAAAAAAAATTAGURGGGXGTGGTGGTGAGTGUUT<br>GTAGTUUUAGATAUTUAGGAAGUTGAGGUAGGAGAATGGUATGAAUURGGGAGGT<br>GGAGUTTGUAGTGAGURGAGATUARGUUAUTGUAUTUUAGUUTGGGTGAUAGAGR<br>GAGAUTUTGTUTUAAAAAAAAAAU |
| 453 | TTGUUTUTTTTGATTTTTTTUTTTGGGUAGGAGTTAGAATGUAAAATAUAGATTUTAT<br>UTGTATAAAGUAUAUAAGAGATGUTTGGGATUTGGTGATGUTGUAURGGAGATTTU<br>AAUUTGTTTTTUAAAGTGATTUUTAGGGAGTGTGAXGATUTUAAUTUTTTTGGAAGT<br>GAUTTGTUAAAUUATGAGUUATGUTGAGTTUAGUAUAAGTAATATGAGGRGAGGUA<br>AGGUAAGTGGGTGAGTAAGGAGGAAGUAGUUUAGATGAGURGGUAGAGTGUUUAU<br>TGGGAGTGAGGUATGATG |
| 454 | ATUATGUUTUAUTUUUAGTGGGUAUTUTGURGGUTUATUTGGGUTGUTTUUTUUTT<br>AUTUAUUUAUTTGUUTTGUUTRGUUTUATATTAUTTGTGUTGAAUTUAGUATGGUTU<br>ATGGTTTGAUAAGTUAUTTUUAAAAGAGTTGAGATXGTUAUAUTUUUTAGGAATUA<br>UTTTGAAAAAUAGGTTGAAATUTURGGTGUAGUATUAUUAGATUUUAAGUATUTUT<br>TGTGTGUTTTATAUAGATAGAATUTGTATTTTGUATTUTAAUTUUTGUUUAAAGAAA<br>AAAATUAAAAGAGGUAAU |
| 455 | AUAAGAGATGUTTGGGATUTGGTGATGUTGUAURGGAGATTTUAAUUTGTTTTTUAA<br>AGTGATTUUTAGGGAGTGTGARGATUTUAAUTUTTTTGGAAGTGAUTTGTUAAAUUA<br>TGAGUUATGUTGAGTTUAGUAUAAGTAATATGAGGXGAGGUAAGGUAAGTGGGTG<br>AGTAAGGAGGAAGUAGUUUAGATGAGURGGUAGAGTGUUUAUTGGGAGTGAGGUA<br>TGATGAGGATTAUTRGTRGTGGGAGGUATGAGGGUAUTUTUTGGUAAGGTTUUTTG<br>UATUAUUAAAATGAGGTUAU |
| 456 | TGAUUTUATTTTGGTGATGUAAGGAAUUTTGUUAGAGAGTGUUUTUATGUUTUUUA<br>RGARGAGTAATUTTTUATUATGUUTUAUTUUUAGTGGGUAUTUTGURGGUTUATUTG<br>GGUTGUTTUUTUUTTAUTUAUUUAUTTGUUTTGUUTXGUUTUATATTAUTTGTGUTG<br>AAUTUAGUATGGUTUATGGTTTGAUAAGTUAUTTUUAAAAGAGTTGAGATRGTUAU<br>AUTUUUTAGGAATUAUTTTGAAAAAUAGGTTGAAATUTURGGTGUAGUATUAUUAG<br>ATUUUAAGUATUTUTTGTG |
| 457 | AGUAAAUAGAGGGTATGGTUUAAUTTGUUTATGAAURGGGAAGUATAATATTTTAA<br>TATTTGTGUUTTAAGUAGTTGTTTTATTTTAAAAGUAUAGGAAATUUTGTUTTTTTU<br>TGTTATAAAATUTTAUAAAGUTAUTGGAAAGATUTUXGUAGGUUAGTGGTTTTUAA<br>AGTGGGTTUUUAGAAUTAGUAAUAGUTGAATUATURGGGAAUTGGTTAGAAATGUA<br>AAGTUTRGURGUUAUUUUTUAAUUUUUUAGAUUTAATGAAUUAGAAATTUTGGGG<br>TGTGGUUUAGTGGUUTGRG |
| 458 | RGUAGGUUAUTGGGUUAUAUUUUAGAATTTUTGGTTUATTAGGTUTGGGGGGTTGA<br>GGGGTGGRGGRGAGAUTTTGUATTTUTAAUUAGTTUURGGATGATTUAGUTGTTGUT<br>AGTTUTGGGAATRTUAUTTTGAAAAUUAUTGGUUTGXGGAGATUTTTUUAUTAUUTT<br>TGTAAGATTTTATAAUAAGAAAAAAGAUAGGATTTUUTGTGUTTTTAAGTAAAAUA |

-continued

| SEQ ID NO: | Sequence |
|---|---|
| | AUTGUTTAAGGUAUAAATATTAAAATATTATGUTTUURGGTTUATAGGUAAGTTGGA<br>UUATAUUUTUTGTTTGUT |
| 459 | GUUUTAUUURGUTUTUTURGAUTUUUURGGGUURGGUUTGRGUUTTUUTGRGGTGU<br>RGAGGAGRGGTGGRGUUUTGGGTGAAGAAGTUURGURGAGTRGAGGGGRGUAATG<br>GAGGAGRGURGGAAUAGGTUTUTUATTURGAGTAGUTAUXGTTGUAUTGTGRGAGT<br>GTAAAAGTUAUTTUUAUURGGTUTUAGTTGTTUUAAUUTUAGTTGAAGTGAGGAGG<br>TTGGAUTGGAAGGTTTUTGGGGTUAUTUUAGTGAGGUTGGGGTTUTAGTUUUAATU<br>TUAURGTGGUAUUUUAAAGGU |
| 460 | GUUTTTGGGGTGUUARGGTGAGATTGGGAUTAGAAUUUUAGUUTUAUTGGAGTGAU<br>UUUAGAAAUUTTUUAGTUUAAUUTUUTUAUTTUAAUTGAGGTTGGAAUAAUTGAGA<br>URGGGTGGAAGTGAUTTTTAUAUTRGUAUAGTGUAAXGGTAGUTAUTRGGAATGAG<br>AGAUUTGTTURGGRGUTUUTUUATTGRGUUUUTRGAUTRGGRGGGAUTTUTTUAUU<br>UAGGGRGUUAURGUTUUTRGGUAURGUAGGAAGGRGUAGGURGGGUURGGGGGAG<br>TRGGGGAGAGRGGGGTAGGGU |
| 461 | GGAUAUAATUTUTGTTUTTUAAAGTTGGUAUTAAGAGUTUUTUUTGRGGTTUUUUTT<br>UUTUTUUTRGAGUAGUAAAGGRGTGGTUUAUAATGUUUAUUUTGTGGGGTUTAGGG<br>GTGUURGGUTTGUTGAUUTUUAGGUUUUUTUTGTGGXGAGGTTTGGAUTGUATAUA<br>TGGTGUAGGUUUUTUATUAUTGGAGUTGUUAGGAUAGUAUTGGAGAUUUTAAGUU<br>AATAUUTATTTTTGGUAATAATTATUAAGUATTTGTAAAAGUURGGGTATGUTGGUA<br>AATUTTTTTAAAATAAGAG |
| 462 | UTUTTATTTTAAAAAGATTTGUUAGUATAUURGGGUTTTTAUAAATGUTTGATAATT<br>ATTGUUAAAAATAGGTATTGGUTTAGGGTUTUUAGTGUTGTUUTGGUAGUTUUAGT<br>GATGAGGGGUUTGUAUUATGTATGUAGTUUAAAUUTXGUUAUAGAGGGGGUUTGG<br>AGGTUAGUAAGURGGGUAUUUUTAGAUUUUAUAGGGTGGGUATTGTGGAUUARGU<br>UTTTGUTGUTRGAGGAGAGGAAGGGGAAURGUAGGAGGAGUTUTTAGTGUUAAUTT<br>TGAAGAAUAGAGATTGTGTUU |
| 463 | AUTTGAGRGUTTUTUUAUUUUAGUAGGUURGUTGUUATUAAGGGUTTAUUUTGTGG<br>GUTGUUUARGUTGUTGTAAUUAGTGAUUAUAAGUTURGTGGTGTTGAGAAGUAUAT<br>GTTTUTUUTUUUARGGUTGTGTAGGTURGGAGTUUTAXGGGUTUAGUUAGTUUUUU<br>TGUTUUAGGTTTAAUUAGGURGGAATUAAGATGUUAGGGUUTGGUTGTGUTTTGGA<br>GGUTUTTGGTGAGAAUUTGUTTUTGGUUTGGTGUAGGGTGTGGUAGAATUURGATG<br>UTTGAGTTTGAATGGTGAAA |
| 464 | TTTUAUUATTUAAAUTUAAGUATRGGGATTUTGUUAUAUUUTGUAUUAGGUUAGAA<br>GUAGGTTUTUAUUAAGAGUUTUUAAAGUAUAGUUAGGUUUTGGUATUTTGATTUR<br>GGUUTGGTTAAAUUTGGAGUAGGGGGAUTGGUTGAGUUXGTAGGAUTURGGAUUT<br>AUAUAGURGTGGGAGGAGAAAUATGTGUTTUTUAAUAUUARGGAGUTTGTGGTUAU<br>TGGTTAUAGUAGRGTGGGUAGUUUAUAGGGTAAGUUUTTGATGGUAGRGGGUUTG<br>UTGGGGTGGAGAAGRGUTUAAGT |
| 465 | AAAUTUARGUTGGUUUAAGAGGAGGAAUAGAGAAGUTTUUTGGUTGAGGUUUAGU<br>RGAUTGUTGAUURGGAAAAGTTTUTRGAGGTGAUTUAUATUUUUAGUUTUTGUAUA<br>TGTGGGTGAGUUAGTTGTAGUTUTGTTUUXGTGAUTGAGUAXGGGAXGURGGAGGT<br>ATTUATUAGGUATGAGGTTATUTGUUTAUTTUUUATGTGTUAGURGAGTGAURGAA<br>TUTUAGTUUUTTAGUUUUTAUATUUUTAGGGTUUTAGTGGAUTGTAAGUTGGTGAT<br>AAGAGTTGTGUTGUUUTUAUT |
| 466 | GTGAGGGUAGUAUAAUTUTTATUAUUAGUTTAUAGTUUAUTAGGAUUUTAGGGATG<br>TAGGGGUTAAGGGAUTGAGATTRGGTUAUTRGGUTGAUAUATGGGAAGTAGGUAGA<br>TAAUUTUATGUUTGATGAATAUUTURGGXGTUUXGTGUTUAGTUAXGGGAAUAGAG<br>UTAUAAUTGGUTUAUUUAUATGTGUAGAGGUTGGGGATGTGAGTUAUUTRGAGAA<br>AUTTTTTRGGGTUAGUAGTRGGUTGGGUUTUAGUUAGGAAGUTTUTUTGTTTTUTUU<br>TUTTGGGUUAGRGTGAGTTTT |
| 467 | AUTTGAGRGUTTUTUUAUUUUAGUAGGUURGUTGUUATUAAGGGUTTAUUUTGTGG<br>GUTGUUUARGUTGUTGTAAUUAGTGAUUAUAAGUTURGTGGTGTTGAGAAGUAUAT<br>GTTTUTUUTUUUARGGUTGTGTAGGTURGGAGTUUTAXGGGUTUAGUUAGTUUUUU<br>TGUTUUAGGTTTAAUUAGGURGGAATUAAGATGUUAGGGUUTGGUTGTGUTTTGGA<br>GGUTUTTGGTGAGAAUUTGUTTUTGGUUTGGTGUAGGGTGTGGUAGAATUURGATG<br>UTTGAGTTTGAATGGTGAAA |
| 468 | TTTUAUUATUAAAUTUAAGUATRGGGATTUTGUUAUAUUUTGUAUUAGGUUAGAA<br>GUAGGTTTTTAUUAAGAGUUTUUAAAGUAUAGUUAGGUUUTGGUATUTTGATTUR<br>GGUUTGGTTAAAUUTGGAGUAGGGGGAUTGGUTGAGUUXGTAGGAUTURGGAUUT<br>AUAUAGURGTGGGAGGAGAAAUATGTGUTTUTUAAUAUUARGGAGUTTGTGGTUAU<br>TGGTTAUAGUAGRGTGGGUAGUUUAUAGGGTAAGUUUTTGATGGUAGRGGGUUTG<br>UTGGGGTGGAGAAGRGUTUAAGT |
| 469 | GRGAATAAAAAGUUAGTGTGTGAGUAAGTUTGTGGGAAGATGUATGUAGAGTGTGA<br>UAGAGAGTTTAGGGGUTRGTGTGAUAATURGTGGAAATGTTTUTAAAGGRGAGGGT |

-continued

| SEQ ID NO: | Sequence |
|---|---|
| | ATGTGTGTGGGTGTGAGGAUURGGUTGTTGGATGTTTAXGTATTTTATTAGUTAGAT<br>ARGGGAGUTAATAUTUAATTGUAGTGUAUTAAAUATTATTAGGTGGGTATGATTTTG<br>AGGGAATGAGGGAAGGGAGAUAAGGTUTGGTGAGATUATUTGTGGGATTATUTGTG<br>TGTATTTGUTGGTTTGTA |
| 470 | TAUAAAUUAGUAAATAUAUAUAGATAATUUUAUAGATGATUTUAUUAGAUUTTGT<br>TTTUUUTTUUTTTUATTUUUTUAAAATUATAUUUAUUTAATAATGTTUUAAGGU<br>AATTGAGTATTAGUTUURGTATUTAGUTAATAAAATAXGTAAAUATUUAAUAGURG<br>GGTUUTUAUAUUUAUAUAUATAUUUTRGUUTTTAGAAAUATTTUUARGGATTGTUA<br>UARGAGUUUUTAAAUTUTUTGTUAUAUTTTTGUATGUATUTTUUUAUAGAUTTGUTU<br>AUAUAUTGGUTTTTATTRGU |
| 471 | UAGTGAGUTGAGAGUARGUUAUTGUAUTUUAGUUTGGGGGATAGAGTGAGAUTUT<br>GTUUUAAAAAAAGAAAAAAAGAAUTGATUUUAAATGTGTGGGGAGAUTGATTTUAG<br>TAATAATAAAAUTURGGTUTUUUAUAUAGTUAGUTUTGXGTGAATUUUTUTTTUUU<br>TATTGRGATTUUUUTGATTTGAGTGAUAGTAAAAUTURGGTUTUUTGUAUAGUUAG<br>UTUTGRGTGAGTUATTUTTTUTUUUUTGTAATTUUUUTGTUTTGATUUATUA<br>GTUTGGGUAGUAGGUAAGGT |
| 472 | AUUTTGUUTGUTGUUUAGAUAGAGUTGATGGATUAAGAUAGGGGAATTAUAGGGG<br>AGAAAGAATGAUTUARGUAGAGUTGGUTGTGUAGGAGAURGGAGTTTTAUTGTUAU<br>TUAAATUAGGGGAATRGUAATAGGGAAAGAGGGATTUAXGUAGAGUTGGUTGTGT<br>GGGAGAURGGAGTTTTATTATTAUTGAAATUAGTUTUUUUAUAUATTTGGGATUAGT<br>TUTTTUTTUTUTTUUUGAGAUAGAGTUTUAUTUTATUUUUUAGGUTGGAGTGUAGT<br>GGRGTGUTUTUAGUTUAUTG |
| 473 | GGATGTRGGTGTGUUAAUUUUAGUTUUAUUUUAUTGUTAAAGUTTAAGUTUTUUUU<br>TUUUURGTTAAGUTGTATGAUUTTGAGTUUTTGTGUUTUAUTGTUUTUATUTGTUA<br>AGTGAAAATGUTUUUAGTUUUUAUUTURGGGAGTTGXGTGGGAGGUAUAUATGAA<br>UAUUAGGAAAGTGAGTTTATGUAGUURGGGUUAGGGAUTURGGTUTUTGUUTUTGU<br>UUTAATUUUUARGGUUTGGGGGAARGTGUAGGGUTGAGGAAGRGUAGUUTUTUUT<br>TGGAATUTUAGRGGAAGUTUU |
| 474 | GGAGUTTURGUTGAGATTUUAAGGAGAGGUTGRGUTUUTUAGUUUTGUARGTTUU<br>UUUAGGURGTGGGGATTAGGGUAGAGGUAGAGAURGGAGTUUUTGGUURGGGUTG<br>UATAAAUTUAUTTTUUTGGTGTTUATGTGTGUUTUUUAXGUAAUTUURGGAGGTGG<br>GGAUTGGGAGUATTTTUAUTTGAUAGATGAGGAUAGTGAGGUAUAAAGAAUTUAA<br>GGTUATAUAGUTTAARGGGGGAGGGGAGAGUTTAAGUnTAGUAGTGGGGTGGAGU<br>TGGGGTTGGUAUAURGAUATUU |
| 475 | TAATTGAATUAUATAATTUATTTUUATTATUTGAGTTUURGGUTTAGGUTUTTTGAG<br>TAUUARGAATUAGGAATGAUTATGUTUUAUTTUAUUUTTRGUTAGTUAAAGAUTGU<br>UAGGAGGUURGGGGTTGTGGTATTUAARGTTAUAGAXGTAAGGUUUTUUTGUUUAU<br>UUAGUAUTUUAAATATTTUATGAUATATGAAGGUTUTGAUATTGUAAAURGGAUTA<br>RGAUAAGUUTTTGAUTTTUURGGGTTGTGAGGAGTTTTAGAAAATAAUTGAGAAGU<br>AAUTTTTTTGAGGATGATG |
| 476 | UATUATUUTUAAAAAAGTTGUTTUTUAGTTATTTTUTAAAAUTUUTUAUAAUURGGA<br>GAAGTUAAAGGUTTGTRGTAGTURGGTTTGUAATGTUAGAGUUTTUATATGTUATGA<br>AATATTTGGAGTGUTGGGTGGGUAGGAGGGUUTTAXGTUTGTAARGTTGAATAUUA<br>UAAUUURGGGUUTUUTGGUAGTUTTTGAUTAGRGAAGGGTGAAGTGGAGUATAGTU<br>ATTUUTGATTRGTGGTAUTUAAAGAGUUTAAGURGGGAAUTUAGATAATGGAAATG<br>AATTATGTGATTUAATTA |
| 477 | UAAUATTUTTGTATUUAGUATUUTTTGTUATGTUATTUTATAGATGUTUTUAUTAA<br>AGTGATGGUUAATTTUUTAUUUTTRGAATURGGGTUTTGGUAAATGGGATGTTAAU<br>AAUAGUTUUUAAAUAGAGGATUAUATAGTAUTTGXGTGAGUUUAUUUUUTUTTAT<br>GTTUTTUAAGUATGUUATGAGAAUAXGUUTGGGTUAGUUTGUTGAAGGAGUTGAGU<br>TGAGTUATUURGGTGAUAGUUAGUTGAUTUTTAGUAGTGAGAGGUAUUUUUAUAA<br>AGUTGUTUTGUTGAUUAUU |
| 478 | GTGGTUAGUAGAGUAGUTTTGTGGGGGTGUUTUTUAUTGUTAAGAGTUAGUTGGUT<br>GTUAURGGGATGAUTUAGUTUAGUTUUTTUAGUAGGUTGAUUUAGGXGTGTTUTUA<br>TGGUATGUTTGAAGAAUATAAGAGGGGAGTGGGUTUAXGUAAGTAUTATGTGATUU<br>TUTGTTTGGGAGUTGTTGTTAAUATUUUATTTGUUAAAGUURGGATTRGAAGGGTAA<br>GGAAATTGGUUATUAUTTTAGTGAGAGUATUTATAGAATGAUATGGUAAAGGATGU<br>TGGATAUAAGGAATGTTGU |
| 479 | GUTUTUAUTAAAGTGATGGUUAATTTUUTTAUUUTTRGAATURGGGUTTTGGUAAAT<br>GGGATGTTAAUAAUAGUTUUUAAAUAGAGGATUAUATAGTAUTTGXGTGAGUUUA<br>TTTUUUUTUTTATGTTUTTUAAGUATGUUATGAGAAUAXGUUTGGGTUAGUUTGUTG<br>AAGGAGUTGAGUTGAGTUATUURGGTGAUAGUUAGUTGAUTUTTAGUAGTGAGAG<br>GUAUUUUUAUAAAGUTGUTUTGUTGAUUAUUUUAGAUAUARGAGUAAAAGAAATG<br>TTTAUUATTAUATGTUAUTGAG |

-continued

| SEQ ID NO: | Sequence |
|---|---|
| 480 | TUAGTGAUATGTAATGGTAAAUATTTUTTTTGUTRGTGTGTUTGGGGTGGTUAGUAG<br>AGUAGUTTTGTGGGGGTGUUTUTUAUTGUTAAGAGTUAGUTGGUTGTUAURGGGAT<br>GAUTUAGUTUAGUTUUTTUAGUAGGUTGAUUUAGGXGTGTTUTUATGGUATGUTTG<br>AAGAAUATAAGAGGGGAGTGGGUTUAXGUAAGTAUTATGTGATUUTUTGTTTGGGA<br>GUTGTTGTTAAUATUUUATTTGUUAAAGUURGGATTRGAAGGGTAAGGAAATTGGU<br>UATUAUTTTAGTGAGAGUA |
| 481 | UUUUAGUUAAAUUAUTRGAUTGUUUUUUATUAUUTATAUTGGURGTTTTUUUTGG<br>AGUUTGUAUUUAAUAGTGGUAAUAUUTTGTGGUURGAGUUUUTUTTUAGUTTGGTU<br>AGTGGUUTAGTGAGUATGAUUAAUUUAURGGUUTUUTXGTUUTUAGUAUUATUTU<br>UAGRGGUUTUUTURGUUTURGUUTUUUAGAGUUUAUUUUTGAGUTGRGUAGTGUU<br>ATUUAARGAUAGUAGTUUUATTTAUTUAGRGGUAUUUAUUTTUUUUARGURGAAU<br>AUTGAUATTTTUUUTGAGUUAUA |
| 482 | TGTGGUTUAGGGAAAATGTUAGTGTTRGGRGTGGGGAAGGTGGGTGURGUTGAGTA<br>AATGGGAUTGUTGTRGTTGGATGGUAUTGRGUAGUTUAGGGGTGGGUTUTGGGAGG<br>RGGAGGRGGAGGAGGURGUTGGAGATGGTGUTGAGGAXGAGGAGGURGGTGGGTT<br>GGTUATGUTUAUTAGGUUAUTGAUUAAGUTGAAGAGGGGUTRGGGUUAUAAGGTG<br>TTGUUAUTGTTGGGTGUAGGUTUUAGGGAAAAGRGGUUAGTATAGGTGATGGGGGG<br>UAGTRGAGTGGTTTGGUTGGGG |
| 483 | GUAGTGGUTGGGUUUUUAUUUUUUAGGAAAUTUAAAAUUUTGGGUUAGURGRGGG<br>TGGRGGGTTGGGGUAGGUAUAAAGAGGGUUTUTGTGRGGURGGUTGGGUTGUUUA<br>UAGGATTUTGGGGGAGGAGGURGGAGURGGTTTUXGTUURGTTUTGUTTUUTGRGG<br>AGGUTGRGGAATGUURGGAGUTUTGGUUUAGUUTGUUURGTUTGGUUUAUURGUA<br>GUUUUTTUUUUATTUUTTTUUAGGGUUTTGGGGTAUAGTUT<br>AGGGUUUTGAGAGUUAUUUTUUA |
| 484 | TGGAGGGTGGUTUTUAGGGUUUTGTTGUAGAGAAGTUTGUAGUTGTAUUUUAAGGU<br>UUTGGAAAAGATGGGGAAGGGGUTGRGGGTGGGUUAGARGGGGUAGGUTGGGUUA<br>GAGUTURGGGUATTURGUAGUUTURGUAGGAAGUAGAAXGGGARGGAAAURGGUT<br>URGGUUTUUTUUUUUAGAATUUTGTGGGUAGUUUAGURGGURGUAUAGAGGUUUT<br>UTTTGTGUUTGUUUUAAUURGUUAUURGRGGUTGGUUUAGGGTTTTGAGTTTUUTG<br>GGGGGTGGGGGUUUAGUUAUTGU |
| 485 | AGGUAUURGTUAUAARGUURGGUTAATTTTTTTGTATTTTTTAGTAGAGARGGGGTT<br>TUAURGTGTTAGUUAGGATGGTUTUAGTUTUUTGAUUTTGTGATUUAUUUAUUTUA<br>GUUTUUUAAAGTGUTGGGATTAUAGATGTGAGUTAUXGUAUURGGUUAAGTTUATG<br>ATUTTTUTGTAUTUTGAGUUAGTGTTAUTGGUAAAGAATGUUUTGGGUATTGTGGTG<br>TGGATGGAAGUUAGGUAUATTGUATUUATTUUTTUUTAGAUTAAGTTGUUTGGUUT<br>GTGGAUUTTUTUAGUUAG |
| 486 | UTGGUTGAGAAGGTUUAUAGGUUAGGUAAUTTAGTUTAGGAAGGAATGGATGUAA<br>TGTGUUTGGUTTUUATUUAUAUUAUAATGUUUAGGGUATTUTTTGUUAGTAAUAUT<br>GGUTUAGAGTAUAGAAAGATUATGAAUTTGGURGGGTGXGGTAGUTUAUATUTGTA<br>ATUUUAGUAUTTTGGGAGGUTGAGGTGGGTGGATUAUAAGGTUAGGAGAUTGAGA<br>UUATUUTGGUTAAUARGGTGAAAUUURGTUTUTAUTAAAAAATAUAAAAAAATTAG<br>URGGGRGTTGTGARGGGTGUUT |
| 487 | TTURGTGGGGATGUAAUUTRGTTTGUUUUTUTGAUTTUUUUATGAGATUTUTRGUTT<br>UUTUUUAUAUUTUUTTTATUUUUUAAUUUUUTGURGGTUUAUUAGGUTGUAGUT<br>GGGTUTGRGGGTAGGGGAUATTUUTAGGTUTTGAUXGUUAGAGUAUURGGTUUAGT<br>UURGGUUAUAGUUTTTGGUUUAAGTGAGGGUTGGUUTGGGGAUAAGURGAAATUA<br>GGGUUUTGGUTGTATUUAGAAAGAGAAUTGAGAUURGTTGUUTUUUAUTGGGUUA<br>UUUUURGAUUUUAAUUAUATA |
| 488 | ATGTGGTTGGGGTRGGGGGGTGGUUUAGTGGGAGGUAARGGGTUTUAGTTUTUTTT<br>UTGGATAUAGUUAGGGUUUTGATTTRGGUTTGTUUUUAGGUUAGUUUTUAUTTGGG<br>UUAAAGGUTGTGGURGGGAUTGGAURGGGTGUTUTGGXGGTUAAGAUUTAGGAAT<br>GTUUUUTAUURGUAGAUURGUAGUTGUAGUUTGGTGGAURGGUAGGGGGTTGGGG<br>GATAAAGGAGGTGTGGGAGGAAGRGAGAGATUTUATGGGGAAGTUAGAGGGGUAA<br>ARGAGGTTGUATUUUUARGGAAT |
| 489 | UTTATAUURGGTUUTRGUUUUTUUAGRGURGGUUTRGUURGRGUTUUTGAGAAAGU<br>UUTGUURGUTURGUTUARGGURGTGUUUTGGUUAAUTTUUTGUTGRGGURGGRGGG<br>UUUTGGGAAGUURGTGUUUUUTTUUUTGUURGGGUUTXGAGGAUTTUUTUTTGGUA<br>GGRGUTGGGGUUUTUTGAGAGUAGGUAGGUURGGUUTTTGTUTURGRGAGGUUUA<br>UUURGGUURGUAUUTTRGUTTTGRGGTUTGAUUUUARGRGUUUUUUTGUAGGGUTG<br>GGUURGGGTGAGGGGAGUTTU |
| 490 | GAAGUTUUUUTUAUURGGGUUUAGUUUTGUAGGGGGGRGRGTGGGGTUAGAURGU<br>AAAGRGAAGGTGRGGGURGGGGTGGGUUTRGRGGAGAUAAAGGURGGGUUTGUUT<br>GUTUTUAGAGGGUUUUAGRGUUTGUUAAGAGGAAGTUUTXGAGGUURGGGUAGGG<br>AAGGGGGUARGGGUTTUUUAGGGUURGURGGURGUAGUAGGAAGTTGGUUAGGGU |

-continued

| SEQ ID NO: | Sequence |
|---|---|
| | ARGGURGTGAGRGGAGRGGGUAGGGUTTTUTUAGGAGRGRGGGRGAGGURGGRGU<br>TGGAGGGGRGAGGAURGGGTATAAG |
| 491 | AGUTUUTTTATUAGAAAGGGUAGURGUAGAGUURGRGTGTGRGRGATGTGGUTGRG<br>GGTGGGGAGRGGGRGRGGGUURGGGAUAURGRGGUUAUTGTTUTAGUUURGUUT<br>GGGURGUUTGAURGRGGUTURGUTGRGURGUAGUUURGXGUUUUTUTGGUTUUTGT<br>TUURGGGRGRGGGGAGAAGGRGGRGGGGRGRGUUTGGGUURGRGRGGGTGRGAAR<br>GRGAGGTUTTTUUTGGGTGUTUUUAGGTRGGAGGATTUUUAGGGRGGGGGUUATUA<br>GGGTGGRGAGGAAURGGUAGGG |
| 492 | UUUTGURGGTTUUTRGUUAUUUTGATGGUUUURGUUUTGGGAATUUTURGAUUTGG<br>GAGUAUUUAGGAAAGAUUTRGRGTTRGUAUURGRGRGGGUUUAGGRGRGUUURGU<br>RGUUTTUTUUURGRGUURGGGAAUAGGAGUUAGAGGGGXGRGGGGUTGRGGRGUA<br>GRGGAGURGRGGTUAGGRGGUUUAGGRGGGGUTAGAAUAGTGGURGRGGTGTUUR<br>GGGUURGURGUURGUTUUUUAUURGUAGUUAUATRGRGUAUARGRGGGUTUTGRG<br>GUTGUUUTTTUTGATAAAGGAGUT |
| 493 | TGGAAAAGUUAAUTGTGUAAAUATTRGUTTUTAURGTUAUAAGGTGAAAAGGAAAA<br>ATGUUAAAAAGGAGAGUTTGGAAAUAUAGUAGAAGAGUAATGAUUUUUTGUAGAG<br>AAUATGAAATAAGATURGGUAGTGAUUUUAUTAAAGAUAXGGAAAATAAGGTUUA<br>AUUUAGAAUTGGTUAGAGAAUAUUAUTGTGUTTTAGAGTAAUAATTAUAAAGGAA<br>AAGAGGGATRGGGUAUTGTAATATUURGGGAUTGUAGUTTGTAUTUTUTGGGTGGT<br>GUATTUTGTAATTUAATTAAATU |
| 494 | GATTTAATTGAATTAUAGAATGUATTUAUUUAGAGAGTAUAAGUTGUAGTUURGGGA<br>TATTAUAGTGUURGATUUUTUTTTTUUTTTGTAATTGTTAUTUTAAAGUAUAGTGGT<br>GTTUTUTGAUUAGTTUTGGGTTGGAUUTTATTTTUXGTGTUTTTAGTGGGGTTUAUTG<br>URGGATUTTATTTUATGTTUTUTGUAGGGGGTUATTGUTUTTUTGUTGTGTTTUUAA<br>GUTUTUUTTTTTGGUATTTTTUUTUTUTTTTUTTGTGARGGTAGAAGRGAATGTTTGUA<br>UAGTTGGUTTTTUUA |
| 495 | UTGUAGATTGAUAUTGTTAATUAUAAAUAAGUUUAGGGTTGTGTTUAGAGAUAAAG<br>TUAGTGTGAURGGTGAUTGTTAUAGUAATAUAAAATAATGGUAGUAGTUUUAUTAG<br>URGAGGUUAGUATRGAATAGGGUAAGTTAUTUAAAUAXGTUAUUUTAGRGAUUAU<br>TUUAAAUAUUTGTGUTTAAAUTAAUTTAGGGAGUURGGTTTTGUAGGATGTGUAAU<br>UARGTTGTGUUUUUTAGGGUTUAUUAGAUTTTAGTAUUTAATGUAGUTAUUUTUAU<br>RGTGGUUUAGGTTUUUAGGGA |
| 496 | UUUTGGGAAUUTGGGUUARGGTGAGGGTAGUTGUATTAGGTAUTAAAGTUTGGTGA<br>GUUUTAGGGGGUAUAARGTGGTTGUAUATUUTGUAAAAURGGGUTUUUTAAGTTAG<br>TTTAAGUAUAGGTGTTTGGAGTGGTRGUTAGGGTGAXGTGTTTGAGTAAUTTGUUUT<br>ATTRGATGUTGGUUTRGGUTAGTGGGAUTGUTGUUATTATTTTGTATTGUTGTAAUA<br>GTUAURGGTUAUAUTGAUTTTGTUTUTGAAUAUAAUUUTGGGUTTGTTTGTGATTAA<br>UAGTGTUAATUTGUAGG |
| 497 | AAAUAUAGUUAGTUTGTTUTAGUUTUTGTUUTUATTTTUUAUAUUUAGGTTTG<br>UUAGTTUUTTGTUUUAUAGTGATGGGUTTGGGAUTATGGGGTGTUUATTURGGGUTT<br>UUUTGGUTTGUTTAUTTTUTUATGGGTGUTTTGAGXGUUTTTTTUGAGURGGUTUAG<br>GUTTTUUUUUUAUAUUUTITUUTUUUTGUTTUTATUAGGUUAAGGGTTTAGATTT<br>TRGGTUAGTGAGTUATUUAAAUUTGGGTGTGGAAAGUAUUTGGGAUAUUAUTTGTA<br>TTTGGUTUUTTTTAGUT |
| 498 | AGUTAAAAGGAGUUAAATAUAAGTGGTGTUUUAGGTGUTTTUUAUAUUUAGGTTTG<br>GATGAUTUAUTGAURGAAGUTUTGAUUUTUAUTGUUAGATAGAAGUAGGGAGGAA<br>AGGGTGTGGGGGGAAAGUUTGAGURGGUTUAAAAAAGGXGUTUAAAGUAUUUATG<br>AGAAAGTAAGUAAGUUAGGGAAGUURGGAATGGAUAUUUUATAGTUUUAAGUUUA<br>TUAUTGTGGGAUAAGGAAUTGGAGUAAAGGGAAGGGGGAAGAAAATGAGGAUAGA<br>GGUTAGAAUAGAUTGGUTGTGTTT |
| 499 | GTUUUUAAAGGUTGAAUUTTTGATUAATGUAGUUUAAGUTGUARGGGUAGAGAAA<br>GGGTGRGGGGTAGGGGURGGGGTTGGGRGUTGAGUTUUTUTGAAURGGTTGUUAGG<br>UAAUAGAATGGAAATTUARGGGRGGUTAAATGGAGUTUXGUUAUAAATGTTUTGTG<br>GUAAAUURGGAUUUAGTUAUATRGUUUTTTUUUUUUUUTUUUTTTUUUGGGGUT<br>TUTUATUTGTAAATGAGAAGGGTGUAGAGAAGAUTUTTTUTTRGGAGTUAGTGUUT<br>URGGTTTGUAUTGUTTTTUA |
| 500 | TGAAAAGUAGTGUAAAURGGAGGUAUTGAUTURGAAGAAAAGAGTUTTUTUTGUA<br>UUUTTUTUATTTAUAGATGAGAAAAUTUAGTGGGGTGGGAGGGGGGAGAAAGGGR<br>GATGTGAUTGGGTURGGGTTTGUUAUAGAAUATTTGTGGXGGAGUTUUATTTAGUR<br>GUURGTGAATTTUUATTUTGTTGUUTGGUAAURGGTTUAGAGGAGUTUAGRGUUUA<br>AUUURGGUUUUTAUUURGUAUUUTTTUUTGUURGTGUAGUTTGGGUUGGUUUUAGG<br>UAAAGGTTUAGUUTTTGGGGAU |
| 501 | UTUUAURGURGGUTRGUUUUUTGAGGAGGGGGUTGGGUUAGGGUUTRGGUTGAUR<br>GGGGAGGAAGAAGGGGAGUAGAGAAAAAUATGAGTUAUAGURGTGTGTUAUTGGA |

-continued

| SEQ ID NO: | Sequence |
|---|---|
| | GRGUATTTUAATTUUUTGUATUAUAGGAGGTGTGGAAGGUXGUUTRGGGGAURGGG<br>RGRGGGAGGTGRGUURGAGAAGGUUURGGGURGGUUTGUAGGGRGRGURGUTURG<br>UUTGRGUUUTTTUUTUUUTAURGUUUTUUURGUUATUTTUUUUTTTGGUTTUUTTU<br>TRGUTRGGTGUAAUAAGTUTTT |
| 502 | AAAGAUTTGTTGUAURGAGRGAGAAGGAAGUUAAAGGGGAAGATGGRGGGGAGGG<br>RGGTGGGGGAGGAAAGGGRGUAGGRGGAGRGGRGRGUUUTGUAGGURGGUURGGG<br>GUUTTUTRGGGRGUATUTUURGRGUURGGTUUURGAGGXRGGUUTTUUAUAUUTUU<br>TGTGATGUAGGGAATTGAAATGRGUTUUAGTGAUAUARGGUTGTGAUTUATGTTTTT<br>UTUTGUTUUUUTTUTTUUTUUURGGTUAGURGAGGUUUTGGUUUAGUUUUUTUUTU<br>AGGGGGRGAGURGGRGGTGGAG |
| 503 | UUTGAAGAGUATTUTUUUTGAGTGUTUAATGATATGUUAGAGUATGTUTUAAATGR<br>GGAGGATGGGGAGGURGGUTUUUTGGUAGATUTTUATGGAGAAGUTGAUTUUAGU<br>RGGUTTGTGTGUURGTUUUAGAGGAGRGGAAAUAGAGUXGAAGUUUAUAUUUUUA<br>GGGUUUAGGUUUAGUUUTTUUAAGTURGGAGUTUAUUUAGUUTGUUUUTRGGUTU<br>UTTUATUUTUUTUUAGAUAURGTUUUTTUTTUTGTUTUTGUATTTUUUATUUTUTUR<br>GUUUUTUUUTGTGUTGUTUTGT |
| 504 | AUAGAGUAGUAUAGGGAGGGGRGGAGAGGATGGGAAATGUAGAGAUAGAAGAAG<br>GGARGGTGTUTGGAGGAGGATGAAGGAGURGAGGGGUAGGUTGGGTGAGUTURGG<br>AUTTGGAAGGGUTGGGUUTGGGUUUTGGGGGTGTGGGUTTXGGUTUTGTTTURGUT<br>UUTUTGGGARGGGUAUAUAAGURGGUTGGAGTUAGUTTUTUUATGAAGATUTGUUA<br>GGGAGURGGUUTUUUUATUUTURGUATTTGAGAUATGUTUTGGUATATUATTGAGU<br>AUTUAGGGAGAATGUTUTTUAGG |
| 505 | ATGTUTGGGAGGUUAAAAGUATUTUTUAGAUAGTUTUTAUAGGAUTUTTUUAGGTU<br>URGGAAGUURGAGRGAGUTTUUTGGAGGAGGTGGUTGGGGAGAGTGGAGGAGURG<br>GTAGGGGTRGUTGTGUTTGRGRGRGUURGTUUAGGAAUTXGURGGGGUTGTGGGGA<br>GGGGGRGURGGUUTGGAGAGGAUAATGTAUAGTUTGTTUTAAUAUUUAUUUAUTU<br>UAAARGUAUAUTTUUUAUUURGTUTUTTGTUUUTUUUAGUUURGGGGUTAGAUUUT<br>GAGGGUTRGGGURGUAUUTUAU |
| 506 | GTGAGGTGRGGUURGAGUUUTUAGGGTUTAGUUURGGGGUTGGGAGGGAUAAGAG<br>ARGGGGTGGGAAGTGTGRGTTTGGAGTGGGTGGGTGTTAGAAUAGAUTGTAUATTG<br>TUUTUTUUAGGURGGRGUUUUUTUUUUAUAGUUURGGXGAGTTUUTGGARGGGRG<br>RGRGUAAGUAUAGRGAUUUUTAURGGUTUUTUUAUTUTUUUUAGUUAUUTUUTUU<br>AGGAAGUTRGUTRGGGUTTURGGGAUUTGGAAGAGTUUTGTAGAGAUTGTUTGAGA<br>GATGUTTTTGGUUTUUUAGAUAT |
| 507 | GGAGRGUTAARGRGUAGTGGGAGGGAAGGAGAGGAUTGAAGAGAGARGGGGGAGG<br>GGAGAGGAGGGGTRGGUTGUUAGGUUTAGGTGGGGTGAATURGUAGUTGGGUTGA<br>UTUAAGRGGAGGAGURGGAAGGAUAUUURGRGAGGUTTXGGGGRGRGUTTTTAGG<br>GAGGRGURGUUTUUAGUTTTGTGUUAGAAAGTGGGGGTTGRGGUTUAGGUTTGAAT<br>UUAAGAAAGGUTURGGGTGGAAUTUUTGGGUAUUTTGGGTUUTTAUTTTGUUTTUA<br>GGRGUTGGUUAURGTTGGGAUTT |
| 508 | AGTUUUAARGGTGGUUAGRGUUTGAAGGUAGAGTAAGGAUUUAGGGTGUUUAGGA<br>GTTUUAUURGGAGUUTTTUTTGGATTUAAGUUTGAGURGUAAUUUUUAUUGGTT<br>UAUAAAGUTGGAGGRGGRGUUTUUUTAAAAGRGRGUUUXGAAGUUTRGRGGGGTG<br>TUUTTURGGUTUUTURGUTTGAGTUAGUUUAGUTGRGGATTUAUUUUAUUTAGGUU<br>TGGUAGURGAUUUUTUUTUTUUUUTUUUURGTUTUTUTTUAGTUUTUTUUTT<br>UUUAUTGRGRGTTAGRGUTUUU |
| 509 | TATUAGAATUUAUATAUUUAGGTGGGTTTAGGAUUTUTAGGUUTUTUUUTUAGGU<br>UATAGGAGUAUUUAUUURGGGUTLTUTUTGGAGGGGUAGUUUUAAGGAAUUTGTTG<br>GGGTAAUTTGTTTGUTUUUUAUAUUURGGGAATGTGUXGTUUTTTUAGGUURGUUU<br>AUURGGATTUUTGTGUAGGGAGTUAGURGAUAUAGUATGTTGUATGTGUUUTGTGG<br>GGAUARGTTUTGUUTUUTGTUAGGGGGAGGAGGUTGGRGGURGTGUUTGTGUTGUR<br>GUAUUTUAGUTUUUUAURGAA |
| 510 | TRGGTGGGGAGUTGAGGTGRGGUAGUAUAGGUARGGURGUUAGUUTUUTUUUUUT<br>GAUAGGAGGUAGAARGTGTUUUUAUAGGGUAUATGUAAUATGUTGTGTRGGUTGA<br>UTUUUTGUAUAGGAATURGGGTGGGRGGGUUTGAAAGGAXGGUAUATTUURGGGG<br>TGTGGGGAGUAAAUAAGTTAUUUUAAUAGGTTUUTTGGGGUTGUUUUTUUAGAGG<br>AGUURGGGGTGGGTGUTUUTATGGUUTGAGGGAGAGGUUTAGAAAGTUUTAAAUU<br>UAUUTGGGTATGTGGATTUTGATAU |
| 511 | AGAGGATTTAAGAUTUAUUUAGGGUAAAUAUTGGGAUUAUTGTAAGAGRGUTGGA<br>AUATTUTGUUTUTTGAGTGAAGGGGUUTTUTTTUTAGUUTUTATGGUAUTGAGGGGT<br>GRGURGGUTGGTGGAGGAGUAGTURGATGGAGUUUTGXGTTUUURGGGGAUAUAG<br>GGUUAAGUTTTGAGGTGGAAAGTTTUTGGTTUTGAAAUAAUAAGGAGAGAGTUTGT<br>TTTTUTTUUTAAAATTTGGAUTUTTGTUTGUAUAAAUTUTGGTUTGTTTTGUARGGTT<br>TGTGTGUUTTTTTTUUUT |

-continued

| SEQ ID NO: | Sequence |
|---|---|
| 512 | GGGAAAAAAAGGUAUAUAAAURGTGUAAAAUAGAUUAGAGTTTGTGUAGAUAAGA<br>GTUUAAATTTTAGGAAGAAAAAUAGAUTUTUTUUTTGTTGTTTUAGAAUUAGAAAU<br>TTTUUAUUTUAAAGUTTGGUUUTGTGTUUURGGGGAAXGUAGGGUTUUATRGGAUT<br>GUTUUTUUAUUAGURGGRGUAUUUUTUAGTGUUATAGAGGUTAGAAAGAAGGUUU<br>UTTUAUTUAAGAGGUAGAATGTTUUAGRGUTUTTAUAGTGGTUUUAGTGTTTGUUU<br>TGGGTGAGTUTTAAATUUTUTT |
| 513 | TGUUTUTGAGTUTAAAARGGUAGTGGUUTAGGAGUAUAGGGUUTGGGGUUAUGGU<br>UAGTGUUAUAUUTAAUUTGAGATATGTUUAGAGUTGAGGTUTAGUTUAUAGUATUT<br>GTGRGTRGGGGAAGUTGGUTGRGGTUARGGURGGTGUAGXGGUUUAAGGAGTUUA<br>UAAAGUAGTAAUUTTGGUUUAUAUUAUAGUTURGGTGUATTTGGAGAGGGGGUUU<br>AGTUTAGGUTGAAGTTGGGGGGAGUUTGGUUAGGGUUTGGGUAUUAGGRGUAGGA<br>UAGAGGGAAAGGUUTUUAGUTUUT |
| 514 | AGGAGUTGGAGGUUTTTUUUTUTGTUUTGRGUUTGGTGUUUAGGUUUTGGUUAGGU<br>TUUUUUUAAUTTUAGUUTAGAUTGGGUUUUUTUTUUAAATGUAURGGAGUTGTGGT<br>GTGGGUUAAGGTTAUTGUTTTGTGGAUTUUTTGGGUXGUTGUAURGGURGTGAURG<br>UAGUUAGUTTUUURGARGUAUAGATGUTGTGAGUTAGAUUTUAGUTUTGGAUATAT<br>UTUAGGTTAGGTGTGGUAUTGUUUUTGUUUUUAGGUUUTGTGUTUUTAGGUUAUTG<br>URGTTTTAGAUTUAGAGGUA |
| 515 | GUAGUUUTGGGGRGTGGGGGGRGGUTGTTTUUTGUTGUUUUTTGGGUTGUUAUUTG<br>UURGAGUTGUUAGUUAUAGTTGGAUTTUUTTUUAGUUUTURGGGGTGUUTGUATTU<br>UUAUATTRGAGAUAGGUAGTGAGAGGGAGTGAGGGGXGATGATGTUTGUAGUUUA<br>UAAGAGUUTURGGGUAGTAGUUAGGUUUUTUUGUTUAGUUTGAUUTGUUTGGUUT<br>UUAGUAGGGTGUTATGGUUUTGGGAGGUUUTGGUTTUTCGGGAATTTGUUTTUUU<br>UUUTGRGUTUTGUTUTGUTGTG |
| 516 | AUAGUAGAGUAGAGRGUAGGGUAGGGGAGGAAAGGGGGUAGAAGUUAGGGUUTU<br>UUAGGGUUATAGUAUUUTGUTGGAGGUUAGGUAGGTUAGGUTGAGUAGAGGGGUU<br>TGGUTAUTGUURGGAGGUTUTGTGGGUTGUAGAUATUATXGUUUUTUAUTUUUTU<br>TUAUTGUUTGTUTRGAATGTGGGAATGUAGGUAUUURGGAGGGUTGGAAGGAAGTU<br>UAAUTGTGGUTGGUAGUTRGGGUAGGTGGUAGUUUAAGGGGUAGUAGGAAAUAGU<br>RGUUUUUUARGUUUUAGGGUTGUU |
| 517 | TUTUTUUTGGGUUAAGUTTTGTGGATGUUUAGUUTGGGGURGRGGGGAGUTGGUAG<br>GTUAGTGGUAGAUAUTGGTGGGUAGAUUTAGTGTUTGGTAGAAUAGGUATUAAGG<br>AAGTGGTGAURGGAGGGAAGUUAAGTGUAUTUAAAUUUTXGGGTGAGTUATUAUR<br>GURGGGTUTTTUAUAGUTGUTGAAAGTGAGUAAUAGTGATGAAGGTTTGTGAGTTT<br>UTGRGTGAGRGAGTGAATGGAUUAGTAGUAGTTTUUAGGTTGTGGAAGAGRGTTUU<br>UTUUURGGGATGGGGAUAUTTG |
| 518 | UAAGTGTUUUUATUURGGGGAGGGAARGUTUTTUUAUAAUUTGGAAAUTGUTAUTG<br>GTUUATTUAUTRGUTUARGUAGAAATTTUAUAAAUUTTUATUAUTGTTGUTUAUTTT<br>UAGUAGUTGTGAAAGAUURGGRGGTGATGAUTUAUUXGAGGGTTTGAGTGUAUTTG<br>GUTTUUUTURGGTUAUUAUTTUUTTGATGUUTGTTUTAUUAGAUAUTAGGTUTGUU<br>UAUUAGTGTUTGUUAUTGAUUTGUUAGUTUUURGRGGUUUUAGGUTGGGUATUUA<br>UAAAGUTTGGUUUAGGAGAGA |
| 519 | GGUTGGTUTTGAAUTUUTGGGUTUAAGAGUTUUAUUTGUUTUAGUUTUUUAAAGTG<br>AGUUAUUAGGUUTAUURGGTUUTTTUUTUUATGUTTUTGTGGUUTTTUUTUUTGTT<br>TAGXGAGUTUTGAUATTUAUTUATAGGTAGGAAUAAAGUUUTUUATTGGTTAGTUT<br>GGGUTGAGGTGGGXGTGTGTGTTTUTGTATUAGTGATUTGTTTTURGGUAGGUUTUT<br>UUUTGAGGGGAGAGUTGGTAGUTTUUATGTAAGTGGUAGGGUATAUTTUAUTAAAT<br>AAAAGATGTGTGGGTGAG |
| 520 | UTUAUUUAUAUATUTTTTATTTAGTGAAGTATGUUUTGUUAUTTAUATGGAAGUTA<br>UUAGUTUTUUUUTUAGGGAGAGGUUTGURGGAAAAUAGATUAUTGATAUAGAAAU<br>AUAUAXGUUUAUUTUAGUUUAGAUTAAUUAATGGAGGGTTTTTGTTUUTAUUTATGA<br>GTGAATGTUAGAGUTXGUTAAAUAGGAGGAAAGGUUAUAGAAGUATGGAGGAAAA<br>GGAURGGGTAGGUUTGGTGGUTUATTTTGGGAGGUTGAGGUAGGTGGAGUTUTTGA<br>GUUUAGGAGTTUAAGAUUAGUU |
| 521 | UAAGUATUTTAGTGATGTGAGTUATUAAAAUTTUUTUUTGGGTUTGUTTTGAGUUU<br>UAUUTTUUTUUTUUTGUAGTUATGTTTUTTAGUUTUAGGGUUUTGGGGRGGAR<br>GGAUAUTUUUUUAGUAGUUTGUTTTUUAGAGGUUAUTGXGUTGUTUAGUTURGGG<br>GGUURGTUUTURGTGGATUUUTUUAGGUUUAGUAGAGTGTTTGAUUARGGGUUTGA<br>URGGGAGGGGAGARGUUAUUTUUTGGGGAUTTGUAUUUUAAUUAGUAUUAUTGTU<br>ATGAGAUAUURGGAGGUUAGUA |
| 522 | TGUTGGUUTURGGGTGTUTUATGAUAGTGGTGUTGGTTGGGGTGUAAGTUUUUAGG<br>AGGTGGRGTUTUUUUTUURGGTUAGGUURGTGGTUAAAUAUTUTGUTGGGUUTGGA<br>GGGATUUARGGAGGARGGGUUUURGGAGUTGAGUAGXGUAGTGGUUTUTGGAAAG<br>UAGGUTGUTGGGGGAGTGTURGGGRGTURGUUUUAGGGUUUTGAGGUTAAGAGUA |

-continued

| SEQ ID NO: | Sequence |
|---|---|
| | TGAUTGUAGGAGGAGGAAGGTGGGGUTUAAAGUAGAUUUAGGAGGAAGTTTTGAT<br>GAUTUAUATUAUTAAGATGUTTG |
| 523 | TGATGAUUAGGUAUTGUTATTUTTTAGGURGGGATTTUUUUAAGUUTTGGTATTTTT<br>AAAAATARGTTATAGTTUUUTTGAAAUTUTUTUUTTATUAUUTUUAUUTTGTTT<br>TUATUTUUUAUTUUTTGGUAUUUTUTGTUTUUUUAXGGTGTUUUUATGARGUTGUU<br>TGUATGUUUATTGGUUUUAGUUTGGGAGUTTUTUAGAGARGUURGGGUUAGAUAT<br>GGUTGUAGATAGAGUUAAGAGGGTGGUUTRGGGTGGUTGGTGGUAGTUTUUTGGUT<br>GTGGGGGUAGAAGTGGGGG |
| 524 | UUUUUAUTTUTGUUUUUAUAGUUAGGAGAUTGUUAUUAGUUAUURGAGGUUAUUU<br>TUTTGGUTUTATUTGUAGUUATGTUTGGUURGGGRGTUTUTGAGAAGUTUUUAGGU<br>TGGGGUUAATGGGUATGUAGGUAGRGTUATGGGGAUAUXGTGGGGAGAUAGAGGG<br>TGUUAAGGAGTGGGAGATGAAAAUAGGAAGGTGGAGGTGATAAGGAGAGAGTTTU<br>AAGGGAAUTATAARGTATTTTTAAAAATAUUAAGGUTTGGGGAAATUURGGUUTAA<br>AGAATAGUAGTGUUTGGTUATUA |
| 525 | GUUTAGUUURGRGRGUAUATAUARGTGTGUTUTURGRGRGGAUUTRGGGAAUTTTG<br>UUUTUARGUURGRGGRGRGUTTGUUTUURGUURGUUURGGUUTUUAUUUUTGGT<br>ATGUUUUTTUUUUAGURGGTUTUUUUTUUUUURGGUTXGGGAAGAAGUUTGUTGG<br>GUUAGGGRGUUUTGAUUAUUTUUTRGGAGGURGGUAAAUUTGUUTGAAURGUUUU<br>AGAGGAATRGGGUAGGGGUTRGUAUUUUAUUURGGUAGGAGGGUUURGAGAURGA<br>UURGGGURGGGGUTURGUAGURG |
| 526 | RGGUTGRGGAGUUURGGUURGGGTRGGTUTRGGGGUUUTUUTGURGGGGTGGGGTG<br>RGAGUUUUTGUURGATTUUTUTGGGGRGGTTUAGGUAGGTTTGURGGUUTURGAGG<br>AGGTGGTUAGGGRGUUUTGGUUUAGUAGGUTTUTTUUXGAGURGGGGGGAGGGGA<br>GAURGGUTGGGGAAGGGGUATUTRGAAGGGGTGGAGGURGGGGRGGGRGGGAGGU<br>AAGRGRGURGRGGGRGTGAGGGUAAAGTTUURGAGGTURGRGRGGAGAGUAUARG<br>TGTATGTGRGRGRGGGGUTAGGU |
| 527 | GAAARGGRGGTRGUAGUUUTRGGURGGGUARGRGTGGGGURGTTRGTGGAGRGGTG<br>TUTTGUTAGGURGGTTGGGGTAUTTGRGGGGURGGATGGGUTTGAGGGTGAGXGGR<br>GGUTGGGGUAGGUTGUUAAAGUURGGGTGGATUTGUTTGTUTTTGAATGUUTTGAT<br>GGTUTUUAGAGGGGTAATAGGGGGXGGGTTGAUURGGATGGGGTUUATGUUUTGG<br>AAGGGUTTGTGUTURGGAATGGAGUUUATGTRGTTGGGGTGGTGGTAGAGGTTGTA<br>GTUAGGAATUATGGGGAAGAG |
| 528 | UTUTTUUUUATGATTUUTGAUTAUAAUUTUTAUUAUUAUUUUAARGAUATGGGUTU<br>UATTURGGAGUAUAAGUUUTTUUAGGGUATGGAUUUUATURGGGTUAAUUXGUUU<br>UUTATTAUUUUTUTGGAGAUUATUAAGGUATTUAAAGAUAAGUAGATUUAUURGG<br>GUTTTGGUAGUUTGUUUUAGURGURXGUTUAUUUTUAAGUUUATURGGUUURGUA<br>AGTAUUUUAAURGGUUTAGUAAGAUAURGUTUUARGAARGGUUUUARGRGTGUUR<br>GGURGAGGGUTGRGAURGURGTTTU |
| 529 | TGUTUAGGUTGGAGTGUAGTGGUAAAATUTTGGUTUAUTTUAAUUTURGUUTUURG<br>GGTTUAAGUAATTUTUUTGUUTUAGUUTUTUAAGTAGUTGGGATTAUAGGUATGUA<br>UUATUAUAUUUAGUTGATTTTGTATTTTTAGTAGAGAXGGGGTTTUAUUARGTTGTT<br>UAAGUTGGTUTUAAAUTUUUTGAUUTUAGGTGATUUAUURGUUTTGGUUTUUUAAAG<br>TGURGGGATTATAGGTGTGAGUUAURGUAUUTGGGUAATTAGTATTGTATTTAAGA<br>GTTTATATTUATATUUATA |
| 530 | TATGGATATGAATATAAAUTUTTAAATAUAATAUTAATTGUUUAGGTGRGGTGGUTU<br>AUAUUTATAATUURGGUAUTTTGGGAGGUUAAGGRGGGTGGATUAUUTGAGGTUAG<br>GAGTTTGAGAUUAGUTTGAAUAARGTGGTGAAAUUUXGTUTUTAUTAAAAATAUAA<br>AATUAGUTGGGTGTGATGGTGUATGUUTGTAATUUUAGUTAUTTGAGAGGUTGAGG<br>UAGGAGAATTGUTTGAAUURGGGAGGRGGAGGTTGAAGTGAGUUAAGATTTTGUUA<br>UTGUAUTUUAGUUTGGGUA |
| 531 | TGTTAUTTUATTGAATTUTUATAATAGUTTAATGUTATRGGTTTTUTTUTTAATTTTG<br>GGGGUATAGTGGGGAGATAAGUAAAUTGATAUUURGGAGGTTGAGTGAUTUATTUA<br>TGGAATGUAGUAGGUURGTGAGTUAAAGXGAGTAUATGGUAAGAUXGAGTGAAGU<br>TGGGGAAUAATAGUUAAGUUAAGAGRGTTTTAAAGATAUTTAGUATUTTUATUAUA<br>UTGAATUTTTAAGGTGAUAGUAUTTUUATRGAUAGUAAAATGTUAGATTUAAUTGT<br>TTUTTTURGGTUTTUAAAU |
| 532 | GTTTGAAGAURGGAAAGAAAUAGTTGAATUTGAUATTTTGUTGTRGAGTGGAAGTG<br>UTGTUAUUTTAGGATTUAGTGTGATGAAGATGUTAAGTATUTTTAAAARGUTUTTGG<br>UTTGGUTATTGTTUUUUAGUTTUAUTXGGTUTTGUUATGTAUTXGUTTTGAUTUARG<br>GGUUTGUTGUATTUUATGAATGAGTUAUTUAAUUTURGGGGTATUAGTTTGUTTATU<br>TUUUUAUTATGUUUUUAAAATTAAGAAGAAAAURGATAGUATTAAGUTATTATGAG<br>AATTUAATGAAGTAAUA |
| 533 | TTAGTATTAUUAAATATRGAGTUAAGGGUUTGATUAGUUUUAAAAGAATGAGGUAU<br>TTTTAATGTGAUAUUATTUUTGGUAGTUTUAGGTTRGGUTUUUUUAGGUUURGGAT |

-continued

| SEQ ID NO: | Sequence |
|---|---|
| | GUAGATGGUTGTTAGGGGUTGGUUATUUTUATUTUAAXGGTUUTGGAAGGUAUUAU<br>TTTUAGGGUATATGUUATGAUTAAUATTURGGTGAGUAATGUTGAUTUAATRGTAG<br>AUTGTTATTTUATGTTUUUAGTAUUUTGTGUAGGAAGGGAAGGGAAATGAGTAATA<br>GATGTATUAGTUUUATTUAA |
| 534 | TTGAATGGGAUTGATAUATUTATTAUTUATTTUUUTTUUUTTUUTGUAUAGGGTAUT<br>GGGAAUATGAAATAAUAGTUTARGATTGAGTUAGUATTGUTUAURGGAATGTTAGT<br>UATGGUATATGUUUTGAAAGTGGTGUUTTUUAGGAUXGTTGAGATGAGGATGGUUA<br>GUUUUTAAUAGUUATUTGUATURGGGUUTGGGAGAGURGAAUUTGAGAUTGUUA<br>GGAATGGTGTUAUATTAAAAGTGUUTUATTUTTTTGGGGUTGATUAGGUUUTTGAUT<br>RGATATTTGGTAATAUTAA |
| 535 | AGTGGTGGUTGUTGTTTUTRGGTGGUAGAGATGATGUUTGGTTTATTUTTAGTAAAG<br>TGUTTAGGARGUTGAGUUTGAGGGGUTUTGGAATGGAAAAAUAAAAUAAAAUAAA<br>AUAAAURGGAGGUURGUTUTGUUTGGUTUUTAGAGAUAXGUAAAGUTGGGUAAAG<br>GAAGGAGATTGAGGTGGGAUTGAGAUATTGTTGUATTGTGAATGUUURGGTTUUUU<br>AUUTUUTGUUUUURGAATUATGATTGTTTTATGRGGTTATTTTTUUUTTTGGTGAGG<br>AAAATGGGATGTGGTGTUAA |
| 536 | TTGAUAUUAUATUUUATTTTUUTUAUUAAAGGGAAAAATAAURGUATAAAAUAATU<br>ATGATTRGGGGGGUAGGAGGTGGGGAAURGGGGUATTUAUAATGUAAUAATGTUTU<br>AGTUUUAUUTUAATTTTUUTTUUTTGUUUAGUTTTGXGTGTTUUUTAGGAGUUAG<br>AGAGRGGGUUTURGGTTTGTTTTGTTTTGTTTTGTTTTTUGATTGGTTGGAAGGTT<br>GUTUAGRGTUUTAAGUAUTTTAUTAAGAATAAAUUAGGUATUATUTUTGUUAURGA<br>GAAAUAGUAGUUAUUAUT |
| 537 | GGGGTRGGUATGGGUTGGAGUTUAGAGARGGUUAGUTAGGAUTTUAGGAUAUAUA<br>GUAAAUTAGUTGRGUUURGUTGAGGGTUAGRGUAUAGURGUUUAUAUAAGGTGTU<br>UTUTUUURGGGUTUTUTGGGURGURGGUUTUUTGUTTUUXGTGURGUAGAURGGGA<br>TTAGAUTGTGGARGRGGGGAAGGAAGGGGGRGTTGRGARGGGATUTTGAGGGGAGU<br>AGGAUTTGUUUUTGUUUUTGRGGRGAAGUTUTAGGUUUTGGUAAGGTTRGGTAUAU<br>RGGGGGURGUTUUTUUUUAGGG |
| 538 | UUUTGGGGAGGAGRGGUUUURGGTGTAURGAAUUTTGUUAGGGUUTAGAGUTTRG<br>URGUAGGGGUAGGGGUAAGTUUTGUTUUUUTUAAGATUURGTRGUAARGUUUUUT<br>TUUTTUUURGRGTUUAUAGTUTAATUURGGTUTGRGGUAXGGGAAGUAGGAGGURG<br>GRGGUUUAGAGAGUURGGGGAGAGGAUAUUTTGTGTGGGRGGUTGTGRGUTGAUU<br>UTUAGRGGGGRGUAGUTAGTTTGUTGTGTGTUUTGAAGTUUTAGUTGGURGTUTUTG<br>AGUTUUAGUUUATGURGAUUUU |
| 539 | GTGUARGUAGGGAAATAUUTUAUAGGGTAAATTTGGATURGATTGAGAAUAGGAAG<br>UUAUAGGUUAATAUAAGGAGGUTUTGTGAGAAUAGATGAUAAAUUAUAAGURGGG<br>GAGGGGGAGGAAAGAGUTTTUTGGGUUTGGGGGATGGGXGAGUURGUUAGUAUAU<br>UAUAUAUAGUTGRGUTTGGUUTUAGTAATUAAAAUUATUATTAUAGAUUTGARGGT<br>TTGGUTGUAGUTGTAAAGAGATAAGUATGTTGGAAGAGAAAAUAGGGUUURGGTG<br>AUURGGUUTTAGGGTUTGAGRGU |
| 540 | RGUTUAGAUUUTAAGGURGGGTUAURGGGGUUUTGTTTTUTUTTUUAAUATGUTTA<br>TUTUTTTAUAGUTGUAGUUAAAURGTUAGGTUTGTAATGATGGTTTTGATTAUTGAG<br>GUUAAGRGUAGUTGTGTGGTGTGUTGGRGGGUTXGUUUATUUUUUAGGUUUAG<br>AAAGUTUTTTUUTUUUUUTUUURGGUTTGTGGTTTGTUATUTGTTUTUAUAGAGUUT<br>UUTTGTATTGGUUTGTGGUTTUUTGTTUUUAATRGGATUUAAATTTAUUUTGTGAGG<br>TATTTUUUTGRGTGUAUA |
| 541 | TGTGRGGGUAGTGGGTTGTGRGGGUAGTGGGTTGTGUATURGGATGTGTAGUAUTU<br>AUAUAUTTRGGGTGAUTUTTUUTGGGTAAGUTGTGGATGTGAGTGGGGGUAGUATU<br>TGURGTGAUTUATTUTUTUUTUTTTUUATTUUAAGUXGGGTGGGGGAGTTTGGGATT<br>TUUAGAUAAGGUUTGGUTUUUUUTGGUAUAGAGGGTGGGAGTGGGGATGGGGAGG<br>GAGGAGGGAAGGGTUATGGGAAGGTGGGGUUATGTTTTGTGUTUAATGAAUTGAGA<br>AGGGGGAGGGTTUUAGUTGG |
| 542 | UAGUTGGAAUUUTUUUUUTTUTUAGTTUATTGAGUAUAAAAUATGGUUUUAUUTTU<br>UUATGAUUUTTUUUUUTUUUTUUUUATUUUUAUTUUUAUUUTUTGTGUUAGGGGG<br>AGUUAGGUUTTGTUTGGAAATUUUAAAUTUUUUUAUUXGGUTTGGAATGGAAAGA<br>GGAGAGAATGAGTUARGGUAGATGUTGUUUUUAUTUAUATUUAUAGUTTAUUUAG<br>GAAGAGTUAUURGAAGTGTGTGAGTGUTAUAUATURGGATGUAUAAUUUAUTGUU<br>RGUAUAAUUUAUTGUURGUAUAA |
| 543 | GUAAUTGGRGUTGGGTAGGUAAAGURGGGAGAAAUTGUTGAGARGAGGTTAGGAT<br>TTAAUUTTAAATTUTGGAGUUATRGGAAAURGAGGGGAGGARGARGGGTGTRGGT<br>GUTAATGAGGUTGGGGGRGGGRGATGRGRGGTGGGUUTUXGAGTURGGGGUAGGT<br>UTRGGGGGTTUUURGGGGAAGGUUUTGGGAGUUUTTGGUUUTGGRGGUUTURGUU<br>ATUAGAUTGGGAATGTUTUTGATTGGGTGGUUAGGAGGRGGTGGUUUTUUTUUURG<br>UUUAGUTGAGGGGTGTRGTUTTU |

-continued

| SEQ ID NO: | Sequence |
|---|---|
| 544 | GAAGARGAUAUUUUTUAGUTGGGRGGGGAGGAGGGUUAURGUUTUUTGGUUAUUU<br>AATUAGAGAUATTUUUAGTUTGATGGRGGAGGURGUUAGGGUUAAGGGUTUUUAG<br>GGUUTTUUURGGGGAAUUUURGAGAUUTGUUURGGAUTXGGAGGUUUAURGRGUA<br>TRGUURGUUUUUAGUUTUATTAGUAURGAUAUURGTRGTUUTUUUUTRGGTTTURG<br>ATGGUTUUAGAATTTAAAGGTTAAATUUTAAUUTRGTUTUAGUAGTTTUTUURGGUT<br>TTGUUTAUUUAGRGUUAGTTGU |
| 545 | GGGUAUUUTUTGGTGUTTUUAGGUUTGTGAATTGGUAUAGUAGGAUUAUAGAUUT<br>UUAAGGTGUUUAUUTGGGGGUTUAGAAUUUTGGRGGGGAAGGTUAGTGUTATUUU<br>AURGGAGAAGAGAUUTAGTUTAGUTGAGUUUUTGGUUAGXGGUAAGGAGGAAAGG<br>ATGAAUATUAGUUARGUUTGGUAUTGAUTGUUAUAGUUAGAGUUTRGUUUAGUUU<br>AAGAATGTTTUTGTTUTAAGAUTTTTTTUTTTTTTGTATTTTAGAGAAGTTUUU<br>AAATGTUAUUTTGAAGAUURGG |
| 546 | URGGGTUTTUAAGGTGAUATTTGUUTGTGATAATTTUTAAAATAUAAAAAAGAAAA<br>AAGTUTTAGAAUAGAAAUATTUTTGGGUTGGGRGAGGUTUTGGUTGTGGUAGTUAG<br>TGUUAGGRGTGGUTGATGTTUATUUUTTUUTTTTTTGUXGUTGGUUAGGGGUTUAGU<br>TAGAUTAGGTUTUTTUTURGGTGGGATAGUAUTGAUUTTUUURGUUAGGGTTUTGA<br>GUUUUUAGGTGGGUAUUTTGGAGGTUTGTGGTUUTGUTGTGUUAATTUAUAGGUUT<br>GGAAGUAUUAGAGGGTGUUU |
| 547 | UTUATGGAGAGGAGUAGAGATGUAGGAAARGUAAUAGUAGUARGGUAGAAARGUA<br>GGAGAAAUAGUUURGUUTUAGAGURGUUUAUUTUUTUURGUUATGUUAGGAAGGG<br>UUAGTGTUUUTUUAGARGURGGTGAUTGTUARGTUAGAUAXGTGARGTGTGGUTGT<br>GUUUAGATTUTTGGRGGTGAGUUURGGRGAGGGAUUUAGRGGTUTUURGGRGTUTG<br>GTTTAGGGGGGGATUTURGUAAGAUUURGUURGUARGTGGUTUUTGTGAGGGGUAU<br>TGRGRGRGAAGGUTGTGGTUTG |
| 548 | UAGAUUAUAGUUTTRGRGRGUAGTGUUUUTUAUAGGAGUUARGTGRGGGRGGGGT<br>UTTGRGGAGATUUUUUUUTAAAUUAGARGURGGGAGAURGUTGGGTUUUTRGURG<br>GGGUTUAURGUUAAGAATUTGGGUAUAGUUAUARGTUAXGTGTUTGARGTGAUAG<br>TUAURGGRGTUTGGAGGGAUAUTGGUUUTTUUTGGUATGGRGGGAGGAGGTGGGRG<br>GUTUTGAGGRGGGGUTGTTTUTUUTGRGTTTUTGURGTGUTGUTGTTGRGTTTU<br>UATUTUTGUTUUTUTUUATGAG |
| 549 | UTUTUUAUTGTGUAGGUUAUUTGTAGGGAUAGTGUUAGTGGGTGTAGGAGAGGTGG<br>RGAGGUTGUAGUAGTGRGGGATGGGUTUUUUAUAUUUUUAAATAUTUUAUATGGG<br>GTURGGGGUUTTUUUAGGAUUTGGGUUAGGTGXGUAXGUUTGGGXGGGGUUAGUU<br>AGUTRGTGUTGAGTUAURGGGTGURGTUAGTGAGGGUUTGGUUUUAUUUTRGGGAA<br>UUAURGGTGUTGGTTTTUUUARGGUTGUTGUURGUTGTGGGUUTTGUTGTUAUUUA<br>UAAGGUUUTGGGAGGUUUTGUU |
| 550 | GGUAGGGUUTUUUAGGGUUTTGTGGGTGAUAGUAAGGUUUAUAGRGGGUAGUA<br>GURGTGGGAAAAUUAGUAURGGTGGTTUURGAGGGTGGGGUUAGGUUUTUAUTG<br>ARGGUAUURGGTGAUTUAGUARGAGUTGGUTGGUUUXGUUUAGGXGTGXGUAU<br>UTGGUUUAGGTUUTGGGAAGGUUURGGAUUUUATGTGGAGTATTTGGGGGTGTG<br>GGGAGUUUATUURGUAUTGUTGUAGUUTRGUUAUUTUTUUTAUAUUUAUTGGUA<br>UTGTUUUTAUAGGTGGUUTGUAUAGTGGAGAG |

Also provided herein is a deoxyribonucleic acid identical to 5-10, 10-20, 20-30, 30-40, 40-50, 50-60, 60-70, 70-80, 80-90, 90-100, 100-110, 110-120, 120-130, 130-140, 140-150, 150-160, 160-170, 170-180, 180-190, or 190-200 of contiguous nucleotide sequence of the sequence including a sequence of SEQ ID NO: 1 to SEQ ID NO: 550.

In embodiments, provided herein is a deoxyribonucleic acid which includes a methylation site set forth in Table 1.

In embodiments, included herein is a deoxyribonucleic acid in which a plurality of methylation sites set forth in Table 1 are methylated or unmethylated. In embodiments, the plurality of methylation sites comprises at least about 1, 2, 3, 4, 5, 6, 7, 8, 9, 10, 15, 20, 25, 50, 75, 100, 150, 200, 250, 300, 350, 400, 450, 500, or 550 methylation sites. In embodiments, the plurality of methylation sites comprises between 1-50, 50-100, 100-250, 100-300, 100-400, 100-500, 100-550, 250-550, or 350-500 methylation sites.

Compositions for Detecting Methylation

Also provided herein are probes and primers that are complementary to one or more of SEQ ID NOS: 1-550. In embodiments, pairs of primers complementary to nucleotide sequences on either side of a methylation site of interest listed in Table 1 are provided. In embodiments, a plurality of probes and/or primers are provided to detect and/or amplify a polynucleotide (e.g., a polynucleotide obtained by bisulfite treatment of DNA) comprising a methylation site of interest. In embodiments, a probe or primer is complementary to a polynucleotide sequence that encompasses the methylation site of interest. In embodiments, the probe or primer is complementary to a sequence that is proximal to the methylation site of interest (e.g., within 1000, 900, 800, 700, 600, 500, 400, 300, 200, 100, 75, 50, or 25 nucleotides of the methylation site of interest in a genomic or bisulfite-treatment-derived polynucleotide).

In embodiments, a deoxyribonucleic acid selected from SEQ ID NO:551 to SEQ ID NO: 782 is included. In embodiments, the deoxyribonucleic acid selected from SEQ ID NO:551 to SEQ ID NO: 782 is hybridized to a complementary DNA sequence having uridine or cytosine. In embodiments, each of the nucleic acids is different. In embodiments, each of the nucleic acids does not simultaneously have the same sequence selected from SEQ ID NO:551 to SEQ ID NO:782.

In embodiments, aspects include a deoxyribonucleic acid selected from SEQ ID NO:551 to SEQ ID NO:782, hybridized to corresponding a complementary DNA sequence having uridine or cytosine, and in a complex with an enzyme, e.g., a thermostable DNA polymerase. In embodiments, the thermostable DNA polymerase is Taq DNA polymerase.

In some aspects, the method includes deoxyribonucleic acid that has a sequence that is at least 50%-55%, 55%-60%, 60%-65%, 65%-70%, 70%-75%, 75%-80%, 80%-85%, 90%, 91%, 92%, 93%, 94%, 95%, 96%, 97%, 98%, 99% or more identical or homologous to a nucleic acid having a sequence of at least one of SEQ ID NO:551 to SEQ ID NO:782.

TABLE 5

| SEQ ID NO: | Sequence, 5' to 3' |
|---|---|
| 551 | GGGAGAAGAGATTGGAAAA |
| 552 | CTAAAAACCTAACACTAACAACATAAT |
| 553 | TGTTGTTTAAAATGTTGTTT |
| 554 | AACCCTAAATAATTCTTCTC |
| 555 | GGGTTGGGTTGAGGTTTT |
| 556 | ACACCTTACATCTCATTTACAACTC |
| 557 | AATTTGTGAAAAGTTTGTGTA |
| 558 | CCCAATCACCTTTAATCT |
| 559 | GTTGGGATTTGAAATAGTGA |
| 560 | CCTCCACTCACCTAAAACTT |
| 561 | TTGGTTAGTGATTATTTATT |
| 562 | AAAAATTAATATAAAATTAAAA |
| 563 | TTTGTAGGGAGTTAGGGAT |
| 564 | TCCTCTATCTCACCCTAAAT |
| 565 | TTTGATTGAATTATTTGTGTATT |
| 566 | ACTCCCTTACTCCTAAACACT |
| 567 | AGTGGAGATEGGTAGGGAGA |
| 568 | CCCAAAACTAAAACCAAATATAA |
| 569 | TTGTGGTTAAATTTATTG |
| 570 | ACCCAACAAAATAATATC |
| 571 | TGAGGTAGAGTTGTGTGTATAT |
| 572 | ATCAATCAATTCTCATTAAAC |
| 573 | GGAAGTTAGGAAGGGTTGT |
| 574 | CTCCAACTCCAACTAAAACTC |
| 575 | TTEGGGTATTGATTTATTTT |
| 576 | AAATTCTACCTACAAACTATACA |
| 577 | AGGATGAAGTAATAATTAAATATTG |
| 578 | CCCACTCTACCAACTAAAC |
| 579 | AGGTTTGTGTTAGTATAAAT |
| 580 | TTCTTACCTATATAATTAATAATA |

TABLE 5-continued

| SEQ ID NO: | Sequence, 5' to 3' |
|---|---|
| 581 | GTTGGGTGAATTTTATTAG |
| 582 | TCAAAACCTAAACTCTAACA |
| 583 | GGATTGGTTTRATATAGAAAGTAT |
| 584 | CAAATAATAAATCATAACTCTTAACT |
| 585 | TGGGGTAGTTGATGGTTT |
| 586 | CTTTCTAACAAAATAAAAAAATTTAA |
| 587 | TTGTATTTGAAGTTTGTAGAGATTTATA |
| 588 | TTTCCTCCAACAACTCAAT |
| 589 | TTATGAGTATGTAGTAGGGTTATTATA |
| 590 | AAAATATCAAACAAATTTATCC |
| 591 | TGGTTGTTTGTTTTTTATGTATT |
| 592 | TCCCTACCTCCCAAATTC |
| 593 | TATGATGATTGTTGTAGTGTAGA |
| 594 | CCTCCCTAATAACTAAAAATAC |
| 595 | GGTGGTTTTGATATTTAGTG |
| 596 | CCCAATTACCTAACAAATTA |
| 597 | TGGGATAGGTGTAGATATG |
| 598 | CAACAAAAACTAAAACACTATAC |
| 599 | TTTGGGATTGGTTATTTT |
| 600 | AAACCCCTTAACTCTATACC |
| 601 | GATTTTTTTGAGAAGAGTATAG |
| 602 | AACCACTACCACCTAAATATA |
| 603 | GGAGGATAGGGTGTGATT |
| 604 | ACATTTTTAACTCTAACTAAAAATAAA |
| 605 | TGGAAATGAGGTGAGTTT |
| 606 | AAAAAAAAATAAAATAACAATAACTA |
| 607 | TGGAGAGTTTAGTTTGTTT |
| 608 | CAAAAAAAAATCTAACAAC |
| 609 | TGGGTTTTAGTTATGTGGTT |
| 610 | ATCAATAATATCCAACAAAATAATAT |
| 611 | TTTTTTTAGTTTTTGTATATATATTAG |
| 612 | ACCCAAATAATCAACTCTT |
| 613 | GTGGTTTTTGGAGATTTA |
| 614 | AAACAAACTACAAATAAAATAATAC |
| 615 | GGGTTATAGGTTTGAGTTA |
| 616 | CCATTAAAAAAAATAAAATC |
| 617 | TTGGTAGATTTAGTAAATTTATT |
| 618 | AAACTTAAACAACCCTATATAC |
| 619 | ATGGTTTTAAAGAGTAGTAGTATAGTT |

TABLE 5-continued

| SEQ ID NO: | Sequence, 5' to 3' |
|---|---|
| 620 | AAATTTACTCATCCCACTTC |
| 621 | AGGGGTTGGGATATTGTT |
| 622 | AAAAATTTCTCCTTACAAAAAACTAA |
| 623 | ATGGGTGTTTGGAATTTTTTA |
| 624 | CTACCTCAACCTCCTAAATAACTAA |
| 625 | GTGTTTTGTGGTANAGATATAG |
| 626 | ATTCTTAAATTAATTCAACTACAT |
| 627 | TGGGGGTAAAAGTTATAGTT |
| 628 | AAAAAACAAAAAACCAAATAC |
| 629 | GTTTTTTGGTTAGTGTGTT |
| 630 | CCCCATACTTCTATACTATAAT |
| 631 | TTGTTGTTTTTAAAGAAATTATA |
| 632 | ATCATCTAAACTTAACTCATCTAA |
| 633 | ATTTTTGGGTGTTTTATATT |
| 634 | AAACCTCAAACAATAACA |
| 635 | ATTAAGGATATTTAGGAGAGTAAG |
| 636 | ACACCACAACTTCAAACTAC |
| 637 | TGAGGAAGAGAGAAGAGATGATA |
| 638 | AAAACTAAACTATAAAACAAAACAAAACTA |
| 639 | GGTGGAGGTGTTTTTTATAG |
| 640 | CCAAATACTACTTTCAAAATACA |
| 641 | ATGGATTATTATTGTGTTATT |
| 642 | CATCTCAACCTCATACTAA |
| 643 | GGATGATTTAGTAGGGATTGAG |
| 644 | ccAAATAAAAACCATTCTCTAAC |
| 645 | TTGGATTAAGTATTTTTGATATTA |
| 646 | TCCCTAAACCATATATTACTAAA |
| 647 | GGGTAGTTTGGTGATTATTATT |
| 648 | CCCTTCCCTACTCACAATA |
| 649 | ATTTGGTTAGTGATTTAGTTATT |
| 650 | TCCCACTTAAAAAATTCTATA |
| 651 | AGTGGGGAAGGTAATTGTTAT |
| 652 | CTTTCTAATAAAAATTTACTAAAACCTCTA |
| 653 | TTTGGTTAGTTTTATTTTTGATTG |
| 654 | ATTCCTCCCTATCCCTATTC |
| 655 | GGGATAGGGGTTAGAGTAA |
| 656 | TCCATAAAAACAAAACACTC |
| 657 | TTTTTTAGTATGAGTTATAAATTAT |
| 658 | AAAACAAAATCTACCTATATATT |
| 659 | TTTTATTAATAAAGTAGGTATGA |
| 660 | ACCTTTCTCAAAATTACTAA |
| 661 | ATAGGGTTGAGGTTAGAGTTAT |
| 662 | CCTCCTCTCCACAATAAA |
| 663 | TTTAAGTTTTTTTTTAGTTTTGTAGT |
| 664 | CCCCATCCTCTCTATCTC |
| 665 | AAATTTAAAATTTAGAGGTTTTTATA |
| 666 | AAACTTCACACACAAATCTATATT |
| 667 | TTTTTATTTTATTTTTTATTTTTAA |
| 668 | ATACCTCCCTAATTATATTATTAA |
| 669 | TTTTAGAATATTTAAAGAAGTTAGT |
| 670 | TAACCTCACTTTCCTATCA |
| 671 | AATTTAGTATAAGATTTGATTTGTTA |
| 672 | CCACCTACTCCTTCCTATAC |
| 673 | TTTTTTGAAATTGTATGTTAT |
| 674 | CAAATCCTTAAAATTCTATAA |
| 675 | TTTGAAGTGGTGTTTTAG |
| 676 | CCAAAATTCTTCCATACT |
| 677 | TGGGTATTTAGTYTTTTGTG |
| 678 | AACAAcTACCTCCTTTTACTAAT |
| 679 | TATGGTAGGAGGTGGAGTT |
| 680 | CCCAATTTTAAAACAATAC |
| 681 | AGAGGAAGTAAGGTTATTAGTT |
| 682 | ACCAAACAAACAATATCTAA |
| 683 | GGTTTTAATTATGATTTAATTAGA |
| 684 | CCTACACTCAAATTTACCTCTA |
| 685 | AATGGGTAGTTGATATAATTATT |
| 686 | CACAAAATCCTAAAACTAAAA |
| 687 | AGGATTAGTGGAAATGAAAATA |
| 688 | TAACCTCAAAACAACTTCTAAAC |
| 689 | TTTTTTTTATAGAGAAGTATTTTAG |
| 690 | CCCATTACAAAACTATCC |
| 691 | GGTGAGTTTGTGGTTAGTG |
| 692 | TTTTCTAAAAAAATCCAATCTA |
| 693 | AATGGATAGGTTGGAATAG |
| 694 | AAAAAAAAAAAAAAACTAATTAC |
| 695 | GAGTTATTTAGTTTGGTTAGGT |
| 696 | ACTCAACTTAAAAAATCACTATAC |
| 697 | TTTYTTTTGGYTTTTTGGYTTT |

TABLE 5-continued

| SEQ ID NO: | Sequence, 5' to 3' |
|---|---|
| 698 | TCCCCCACACCCATATAA |
| 699 | TTAAAAAAAAGTATAATGAGTAGGA |
| 700 | CCCACAAAAACTCTCTACA |
| 701 | AAAGGAGGTTGAGTTAGAAAGTAG |
| 702 | AACTATTTAACTTACTTAACCACACC |
| 703 | GGTGTGGTTAAGTAAGTTAAATAGT |
| 704 | TACCCCTTCCTCTTCAAC |
| 705 | TTTTGATATGATTTATGATTATAT |
| 706 | TTTTCCACTAAACAACACTA |
| 707 | TTTGAGGGTTGTTTTAGAT |
| 708 | ACTCACAAAAAATAACTAATAACTAT |
| 709 | AAAGGAGGTAGGGGAGATATA |
| 710 | TCAAAATAAAAACCAAAATTCTC |
| 711 | AGGTTAAGTTGGTAGAGGTAGA |
| 712 | CAAACTCTAAACTCAAAATATATTC |
| 713 | TTTTTATTTTAGTTTTTTTGAGTAG |
| 714 | CCCTACAACACTCCTATCTA |
| 715 | TTTGGAGTTAGGTTGATAG |
| 716 | CAACAATACTCTCACTTACAC |
| 717 | AGAAAGATTTTTAAATATTTTTAAT |
| 718 | AAACCTCTAATACACAACAAA |
| 719 | TTTTGAGTTTTTTTTTTTTAAGTAT |
| 720 | CAAACAAAACAACACTTAATAC |
| 721 | GGTTGAGGTGGGTGGATTA |
| 722 | TTTTTTTTTTTTTTTTTTAAAATAAAATCT |
| 723 | GGGTGTTTGTAATTTTAGTT |
| 724 | ACCTETTAACAACCTAACAATATA |
| 725 | GGGTAGATGATATGGTAGTGA |
| 726 | AAAAAATAAAAAATAACTAAAACAATAT |
| 727 | AGGAAGTGTTTAAGAAGTAGAA |
| 728 | CCTAAAACTCTAAATACAATCTC |
| 729 | TTTTTAATTTTTGTTTGTATT |
| 730 | AAACCACAATCTATTTCTAA |
| 731 | TTAGAAAAGAATAATTATAGTTG |
| 732 | ACCCTAAAAAAATAAAATC |
| 733 | TTGTATTAGTAAATAAAGTGTATTTT |
| 734 | AACCCTTTCTACAAATCTAC |
| 735 | AGGGGTGGGTGGAAGAAT |
| 736 | CTCCTCAATAAAATAAAAATCCTAAAAAATA |

TABLE 5-continued

| SEQ ID NO: | Sequence, 5' to 3' |
|---|---|
| 737 | GGGTTAATTAGTTGTTTTAT |
| 738 | CCTACAAATATATCACACACT |
| 739 | TTTGTTAAATAGGTGGTTAGA |
| 740 | ACCTCAACCTCCTAAATAAC |
| 741 | TAGGGTTTAGAGTAGGAGGTAG |
| 742 | CAAAAAATATAAATCAAAAACATC |
| 743 | GGGATTATAGGTATTTATTAT |
| 744 | TAAAAATTAAAAATCATACTTA |
| 745 | AAGTGATTTTTAGGGAGTGT |
| 746 | TCCATAATAACCTCATTTTAATA |
| 747 | TTTTTGGTTGAGGTTTAGT |
| 748 | AAACAACACAACTCTTATCAC |
| 749 | TATGGTGATTAAAGTATAATAGTT |
| 750 | TCCTAAATAAAAAACAACATA |
| 751 | TGAAAATGTTTTTAGTTTTTATT |
| 752 | AAATACCCTACCTCTTATCTAA |
| 753 | GATGGTTAATTTTTTTATTT |
| 754 | ACTCCTTCAACAAACTAAC |
| 755 | AGGGGATATTTTTAGGTT |
| 756 | CCAATCTATTCCTATATAATTAA |
| 757 | AGGAGAGTTTGGAAATATAG |
| 758 | CAATTCTAAATTAAACCTTATT |
| 759 | AATAATGGTAGTAGTTTTATTAG |
| 760 | TTCCTATATTAACAACTTACA |
| 761 | TTTTTTGGTAGATTTTTAT |
| 762 | AAATTAATTTCTATTATTTATATTA |
| 763 | AGGTGGTTGGGGAGAGTG |
| 764 | CCCTAAAATAAATCAAAAAAAACCTTAA |
| 765 | AGGTTTAGGTGGGGTGAAT |
| 766 | TAAAATCATCAAAATCCCTTAAAA |
| 767 | TTTTTTTTTAGGTTATACTGAGTATT |
| 768 | ATCCCCACAAAACACATA |
| 769 | TAGGGTAAATATTGGGATTATT |
| 770 | TTTCCACCTCAAAACTTAAC |
| 771 | GGGTGTTTGTATTTTTATATT |
| 772 | ACCTCCCAAAACCATAAC |
| 773 | GATGTGAGTGGTGAGGTGGT |
| 774 | CAAACCCTTCCAAAACATAAAC |
| 775 | TGGGATTATAGGTATGTATT |

TABLE 5-continued

| SEQ ID NO: | Sequence, 5' to 3' |
|---|---|
| 776 | CAATTTCATTTATAAATATAAATAT |
| 777 | AGGGGTTGGTTATTTTTATTTT |
| 778 | TTTTTAATATTTAATTTTTACCTTCAACT |
| 779 | GGTAAGTTGTGGATGTGAGT |
| 780 | AAAAAAAACCAAACCTTATCTA |
| 781 | TTTTTAGGATTTGGGTTAG |
| 782 | AACCTTATAAATAACAACAAAAC |

Kit for Detecting Methylation Level of a Thyroid Nodule

Also provided is a kit including a plurality (e.g., at least about 10, 20, 40, 50, 100, 150, 200, 225, or 232) nucleic acids each independently comprising one sequence selected from SEQ ID NO:551 to SEQ ID NO:782, in which the nucleic acids do not simultaneously include the same sequence.

In some aspects, the kit includes deoxyribonucleic acid that has a sequence that is at least 50%-55%, 55%-60%, 60%-65%, 65%-70%, 70%-75%, 75%-80%, 80%-85%, 90%, 91%, 92%, 93%, 94%, 95%, 96%, 97%, 98%, 99% or more identical or homologous to a nucleic acid having a sequence of at least one of SEQ ID NO:551 to SEQ ID NO:782.

The kit provided herein may include enzymes, reagents for deamination of cytosine, buffers, vials, plasmid vectors, control DNA, devices for collecting thyroid tissue samples, reagents for isolating DNA, reagents for labeling DNA, labels, or any combinations thereof.

The kit provided herein may include enzymes such as thermostable DNA polymerase enzymes, restriction enzymes, and combination thereof.

In embodiments, the kit(s) may further include enzymes, reagents for deamination of cytosine, buffers, vials, control DNA, devices for collecting blood and/or tissue samples, or reagents for labeling DNA, or any combinations thereof.

In embodiments, a kit provided herein may include a solid carrier capable of adsorbing the nucleic acids containing in a sample of a body fluid, for example blood (whole blood, plasma, or serum). The kit may also contain other components for example, reagents, in concentrated or final dilution form, chromatographic materials for the separation of the nucleic acids, aqueous solutions (buffers, optionally also in concentrated form for final adjusting by the user) or chromatographic materials for desalting nucleic acids which have been eluted with sodium chloride.

In embodiments, a kit provided herein includes materials for purifying nucleic acids, for example, inorganic and/or organic carriers and optionally solutions, excipients and/or accessories. Such agents are known and are commercially available. For solid phase nucleic acid isolation methods, many solid supports have been used including membrane filters, magnetic beads, metal oxides, and latex particles.

In addition, a kit can also contain excipients such as, for example, a protease such as proteinase K, or enzymes and other agents for manipulating nucleic acids. e.g., at least one amplification primer, nucleic acid bases (A, T, G. C, and/or U), and enzymes suitable for amplifying nucleic acids, e.g., DNase, a nucleic acid polymerase and/or at least one restriction endonuclease. Alternatively, a commercial polymerase chain reaction kit may be used to amplify the DNA samples.

Exemplary Techniques for Detecting Specific Sequences

Specific sequences, such as the sequences listed in Table 1 (or portions thereof containing a methylation site of interest), can be detected by numerous methods that are well-established in the art (e.g., PCR-based sequence specific amplification, isozyme markers, northern analysis, sequence specific hybridization, and array based hybridization). In embodiments, the presence or absence of methylation is determined through nucleotide sequencing of the site of interest (e.g., the site in bisulfite-treated DNA or an amplicon thereof). Any of these methods are readily adapted to high throughput analysis.

Some techniques for detecting specific sequences utilize hybridization of a probe nucleic acid to nucleic acids corresponding to the methylation site of interest (e.g., amplified nucleic acids produced using bisulfite-treated DNA as a template or the bisulfite-treated DNA itself). Hybridization formats, including, but not limited to: solution phase, solid phase, mixed phase, or in situ hybridization assays are useful for sequence detection. A non-limiting guide to the hybridization of nucleic acids is found in Tijssen (1993) Laboratory Techniques in Biochemistry and Molecular Biology—Hybridization with Nucleic Acid Probes Elsevier, N.Y., as well as in Sambrook. Berger and Ausubel.

Nucleic acid probes complementary to a methylation site can be cloned and/or synthesized. Any suitable label can be used with a probe. Detectable labels suitable for use with nucleic acid probes include, for example, any composition detectable by spectroscopic, radioisotopic, photochemical, biochemical, immunochemical, electrical, optical or chemical means. Useful labels include biotin for staining with labeled streptavidin conjugate, magnetic beads, fluorescent dyes, radiolabels, enzymes, and colorimetric labels. Other labels include ligands which bind to antibodies labeled with fluorophores, chemiluminescent agents, and enzymes. A probe can also constitute radiolabelled PCR primers that are used to generate a radiolabelled amplicon. Labeling strategies for labeling nucleic acids and corresponding detection strategies can be found, e.g., in Haugland (2003) Handbook of Probes and Research Chemicals Ninth Edition by Molecular Probes, Inc. (Eugene Oreg.). Additional non-limiting details regarding sequence detection strategies are found below.

PCR, RT-PCR and LCR are in particularly broad use as amplification and amplification-detection methods for amplifying nucleic acids (e.g., those comprising a methylation site), facilitating detection of the nucleic acids of interest.

In embodiments, real time PCR or LCR is performed on the amplification mixtures described herein. e.g., using molecular beacons or TaqMan™ probes. A molecular beacon (MB) is an oligonucleotide or peptide nucleic acid (PNA) which, under appropriate hybridization conditions, self-hybridizes to form a stem and loop structure. The MB has a label and a quencher at the termini of the oligonucleotide or PNA; thus, under conditions that permit intra-molecular hybridization, the label is typically quenched (or at least altered in its fluorescence) by the quencher. Under conditions where the MB does not display intra-molecular hybridization (e.g., when bound to a target nucleic acid, e.g., to a region of an amplicon during amplification), the MB label is unquenched. Details regarding standard methods of making and using MBs are well established in the literature and MBs are available from a number of commercial reagent sources. See also, e.g., Leone et al. (1995) "Molecular beacon probes combined with amplification by NASBA enable homogenous real-time detection of RNA." Nucleic Acids Res. 26:2150-2155; Tyagi and Kramer (1996) "Molecular beacons: probes that fluoresce upon hybridization" Nature Biotechnology 14:303-308; Blok and Kramer (1997) "Amplifiable hybridization probes containing a molecular switch" Mol Cell Probes 11:187-194; Hsuih et al. (1997) "Novel, ligation-dependent PCR assay for detection of hepatitis C in serum" J Clin Microbiol 34:501-507; Kostrikis et al. (1998) "Molecular beacons: spectral genotyping of human alleles" Science 279:1228-1229; Sokol et al. (1998) "Real time detection of DNA:RNA hybridization in living cells" Proc. Natl. Acad. Sci. U.S.A. 95:11538-11543; Tyagi et al. (1998) "Multicolor molecular beacons for allele discrimination" Nature Biotechnology 16:49-53; Bonnet et al. (1999) "Thermodynamic basis of the chemical specificity of structured DNA probes" Proc. Natl. Acad. Sci. U.S.A. 96:6171-6176; Fang et al. (1999) "Designing a novel molecular beacon for surface-immobilized DNA hybridization studies" J. Am. Chem. Soc. 121:2921-2922; Marras et al. (1999) "Multiplex detection of single-nucleotide variation using molecular beacons" Genet. Anal. Biomol. Eng. 14:151-156; and Vet et al. (1999) "Multiplex detection of four pathogenic retroviruses using molecular beacons" Proc. Natl. Acad. Sci. U.S.A. 96:6394-6399. Additional details regarding MB construction and use is found in the patent literature, e.g., U.S. Pat. No. 5,925,517 (Jul. 20, 1999) to Tyagi et al. entitled "Detectably labeled dual conformation oligonucleotide probes, assays and kits;" U.S. Pat. No. 6,150,097 to Tyagi et al (Nov. 21, 2000) entitled "Nucleic acid detection probes having non-FRET fluorescence quenching and kits and assays including such probes" and U.S. Pat. No. 6,037,130 to Tyagi et al (Mar. 14, 2000), entitled "Wavelength-shifting probes and primers and their use in assays and kits."

PCR detection and quantification using dual-labeled fluorogenic oligonucleotide probes, commonly referred to as "TaqMan™" probes, can also be performed. These probes are composed of short (e.g., 20-25 base) oligodeoxynucleotides that are labeled with two different fluorescent dyes. On the 5' terminus of each probe is a reporter dye, and on the 3' terminus of each probe a quenching dye is found. The oligonucleotide probe sequence is complementary to an internal target sequence present in a PCR amplicon. When the probe is intact, energy transfer occurs between the two fluorophores and emission from the reporter is quenched by the quencher by FRET. During the extension phase of PCR, the probe is cleaved by 5' nuclease activity of the polymerase used in the reaction, thereby releasing the reporter from the oligonucleotide-quencher and producing an increase in reporter emission intensity. Accordingly, TaqMan™ probes are oligonucleotides that have a label and a quencher, where the label is released during amplification by the exonuclease action of the polymerase used in amplification. This provides a real time measure of amplification during synthesis. A variety of TaqMan™ reagents are commercially available, e.g., from Applied Biosystems (Division Headquarters in Foster City, Calif.) as well as from a variety of specialty vendors such as Biosearch Technologies (e.g., black hole quencher probes). Further details regarding dual-label probe strategies can be found, e.g., in WO92/02638.

Other similar methods include e.g. fluorescence resonance energy transfer between two adjacently hybridized probes. e.g., using the "LightCycler™" format described in U.S. Pat. No. 6,174,670.

Amplification and Sequencing Primers

In embodiments, methylation sites are detected using primers, e.g., to amplify and/or sequence polynucleotides comprising the methylation sites.

Suitable primers can be designed and is not intended that the present subject matter be limited to any particular primer or primer pair. For example, primers can be designed using any suitable software program, such as LASERGENE™, e.g., taking account of publicly available sequence information. Flanking sequences for the methylation sites identified herein are publicly available; accordingly, suitable amplification primers can be constructed based on well understood base-pairing rules. The sequence of any amplicon can be detected as has already been discussed above. e.g., by sequencing, hybridization, array hybridization, PCR, LCR, or the like.

In embodiments, the primers are radiolabelled, or labeled by any suitable means (e.g., using a non-radioactive fluorescent tag), to allow for rapid visualization of differently sized amplicons following an amplification reaction without any additional labeling step or visualization step. In embodiments, the primers are not labeled, and the amplicons are visualized following their size resolution, e.g., following agarose or acrylamide gel electrophoresis. In embodiments, ethidium bromide staining of the PCR amplicons following size resolution allows visualization of the different size amplicons.

It is not intended that the primers be limited to generating an amplicon of any particular size. The primers can generate an amplicon of any suitable length for detection (e.g., by sequencing or hybridization). In embodiments, amplification produces an amplicon at least 20 nucleotides in length, or alternatively, at least 50 nucleotides in length, or alternatively, at least 100 nucleotides in length, or alternatively, at least 200 nucleotides in length. Amplicons of any size can be detected and/or sequenced using various technologies described herein and known in the art.

Detection of Methylation Levels Using Sequencing

Sequencing is the process of determining the precise order of nucleotides within a DNA molecule. The advent of rapid DNA sequencing methods has greatly accelerated biological and medical research and discovery. Non-limiting examples and descriptions are provided below. However, embodiments are not limited to the use of a particular sequencing assay, technology, or approach.

Sanger sequencing is a method of DNA sequencing based on the selective incorporation of chain-terminating dideoxynucleotides by DNA polymerase during in vitro DNA replication (Sanger F; Coulson A R (May 1975) J. Mol. Biol. 94 (3): 441-8; Sanger et al. (December 1977) Proc. Natl. Acad. Sci. U.S.A. 74 (12): 5463-7).

In embodiments, next-generation sequencing is used. Non-limiting examples of next-generation sequencing methods include massively parallel signature sequencing (MPSS), single-molecule real-time sequencing, ion semiconductor sequencing, pyrosequencing, sequencing by synthesis, sequencing by ligation, chain termination. DNA nanoball sequencing, helicos single molecule sequencing, single molecule real time sequencing, nanopore DNA sequencing, tunnelling currents DNA sequencing, and sequencing by hybridization.

Many commercially available sequencing technologies, devices, and services are available. In embodiments, an Illumina sequencer is used. In embodiments, PCR products are ligated with a linker and sequenced using a high throughput sequencer, such as an Illumina sequencer. In embodiments, the ligation step can be avoided, omitted, or eliminated by adding a linker to amplification primers.

Array-Based Sequence Detection

Array-based detection can be performed using commercially available arrays, e.g., from Affymetrix (Santa Clara, Calif.) or other manufacturers. Reviews regarding the operation of nucleic acid arrays include Sapolsky et al. (1999) "High-throughput polymorphism screening and genotyping with high-density oligonucleotide arrays." Genetic Analysis: Biomolecular Engineering 14:187-192; Lockhart (1998) "Mutant yeast on drugs" Nature Medicine 4:1235-1236; Fodor (1997) "Genes. Chips and the Human Genome." FASEB Journal 11:A879; Fodor (1997) "Massively Parallel Genomics." Science 277: 393-395; and Chee et al. (1996) "Accessing Genetic Information with High-Density DNA Arrays." Science 274:610-614.

A variety of probe arrays have been described in the literature and can be used for detection of methylation. For example, DNA probe array chips or larger DNA probe array wafers (from which individual chips would otherwise be obtained by breaking up the wafer) may be used in embodiments described herein. DNA probe array wafers generally comprise glass wafers on which high density arrays of DNA probes (short segments of DNA) have been placed. Each of these wafers can hold, for example, approximately 60 million DNA probes that are used to recognize longer sample DNA sequences (e.g., from individuals or populations, e.g., that comprise methylation sites of interest). The recognition of sample DNA by the set of DNA probes on the glass wafer takes place through DNA hybridization. When a DNA sample hybridizes with an array of DNA probes, the sample binds to those probes that are complementary to the sample DNA sequence. By evaluating to which probes the sample DNA for an individual hybridizes more strongly, it is possible to determine whether a known sequence of nucleic acid is present or not in the sample, thereby determining whether a uracil, thymine, or cytosine is present at a polynucleotide site corresponding to a genomic methylation site. One can also use this approach to control the hybridization conditions to permit single nucleotide discrimination, e.g., for the identification of methylation at a site of interest. Arrays provide one convenient embodiment for detecting multiple methylation sites simultaneously (or in series). Of course, any detection technology (PCR, LCR, and/or sequencing etc.) can similarly be used, e.g., with multiplex amplification/detection/sequencing reactions, or simply by running several separate reactions. e.g., simultaneously or in series.

In embodiments, the use of DNA probe arrays to obtain methylation information involves the following general steps: design and manufacture of DNA probe arrays, preparation of the sample, bisulfite treatment, hybridization of sample DNA to the array, detection of hybridization events and data analysis to determine sequence. In embodiments, an array is used to capture polynucleotides containing a methylation site of interest, and the captured polynucleotides are subsequently amplified and/or sequenced. Preferred wafers are manufactured using a process adapted from semiconductor manufacturing to achieve cost effectiveness and high quality, and are available, e.g., from Affymetrix, Inc. of Santa Clara, Calif.

For example, probe arrays can be manufactured by light-directed chemical synthesis processes, which combine solid-phase chemical synthesis with photolithographic fabrication techniques as employed in the semiconductor industry. Using a series of photolithographic masks to define chip exposure sites, followed by specific chemical synthesis steps, the process constructs high-density arrays of oligonucleotides, with each probe in a predefined position in the array. Multiple probe arrays can be synthesized simultaneously on a large glass wafer. This parallel process enhances reproducibility and helps achieve economies of scale.

In embodiments, DNA probe arrays can be used to obtain data regarding presence of sequences (e.g., corresponding to methylated or unmethylated DNA) of interest. The DNA samples may be tagged with biotin and/or a fluorescent reporter group by standard biochemical methods. The labeled samples are incubated with an array, and segments of the samples bind, or hybridize, with complementary sequences on the array. The array can be washed and/or stained to produce a hybridization pattern. The array is then scanned and the patterns of hybridization are detected by emission of light from the fluorescent reporter groups. Because the identity and position of each probe on the array is known, the nature of the DNA sequences in the sample applied to the array can be determined.

In embodiments, the nucleic acid sample to be analyzed is isolated, bisulfite-treated, amplified and, optionally, labeled with biotin and/or a fluorescent reporter group. The labeled nucleic acid sample may then incubated with the array using a fluidics station and hybridization oven. The array can be washed and or stained or counter-stained, as appropriate to the detection method. After hybridization, washing and staining, the array is inserted into a scanner, where patterns of hybridization are detected. The hybridization data are collected as light emitted from the fluorescent reporter groups already incorporated into the labeled nucleic acid, which is now bound to the probe array. Probes that most clearly match the labeled nucleic acid produce stronger signals than those that have mismatches. Since the sequence and position of each probe on the array are known, by complementarity, the identity of the nucleic acid sample applied to the probe array can be identified. In embodiments, hybridization techniques and conditions that allow only fully complementary nucleotide sequences to hybridize with probes in an array are used.

Prior to amplification and/or detection of a nucleic acid comprising a sequence of interest, the nucleic acid is optionally purified from the samples by any available method, e.g., those taught in Berger and Kimmel, Guide to Molecular Cloning Techniques, Methods in Enzymology volume 152 Academic Press. Inc., San Diego. Calif. (Berger); Sambrook et al., Molecular Cloning—A Laboratory Manual (3rd Ed.), Vol. 1-3. Cold Spring Harbor Laboratory, Cold Spring Harbor. N.Y., 2001 ("Sambrook"); and/or Current Protocols in Molecular Biology. F. M. Ausubel et al., eds., Current Protocols, a joint venture between Greene Publishing Associates. Inc, and John Wiley & Sons, Inc., (supplemented through 2002) ("Ausubel")). A plethora of kits are also commercially available for the purification of nucleic acids from cells or other samples (see. e.g., EasyPrep™, Flex-iPrep™, both from Pharmacia Biotech; StrataClean™, from Stratagene; and, QIAprep™ from Qiagen). Alternately, samples can simply be directly subjected to amplification or detection, e.g., following aliquotting and/or dilution.

Thyroid Cancer Diagnostic System and Processes

Figure 4:
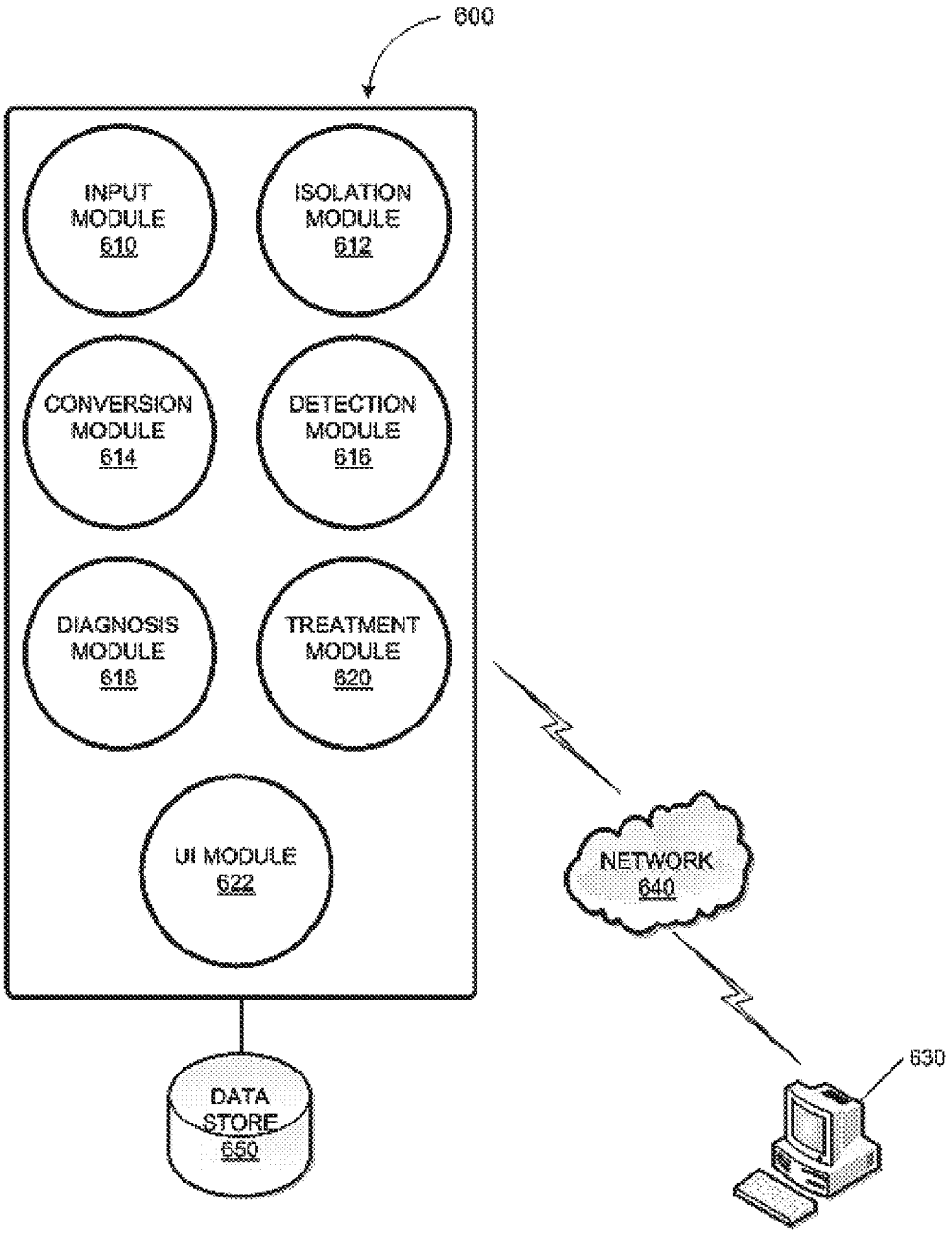
FIG. 4 depicts a block diagram illustrating an exemplary thyroid cancer diagnostics system.

FIG. 4 depicts a block diagram illustrating an exemplary thyroid cancer diagnostic system 600. Referring to FIG. 4, the thyroid cancer diagnostic system 600 can include an input module 610, an isolation module 612, a conversion module 614, a detection module 616, a diagnosis module 618, a treatment module 620, and a user interface (UI) module 622. The thyroid cancer diagnostic system 600 can be configured to provide a diagnosis indicative of a presence of thyroid cancer and/or a risk of developing thyroid cancer. Moreover, the thyroid cancer diagnostic system 600 can be further configured to generate a treatment plan for a subject based on the diagnosis. For instance, when the diagnosis indicates a presence and/or risk of thyroid cancer in a subject, the thyroid cancer diagnostic system 600 can recommend one or more treatments including, for example, thyroid surgery, radiation therapy, radioactive iodine therapy, chemotherapy, thyroid hormone therapy, and administration of an active agent.

One or more modules of the thyroid cancer diagnostic system 600 can be realized in digital electronic circuitry, integrated circuitry, specially designed application specific integrated circuits (ASICs), field programmable gate arrays (FPGAs) computer hardware, firmware, software, and/or combinations thereof. The thyroid cancer diagnostic system 600 can further be communicatively coupled with one or more devices including, for example, a device 630. The thyroid cancer diagnostic system 600 can communicate with the device 620 via a wired and/or wireless network 640 (e.g., a wide area network (WAN), a local area network (LAN), and/or the Internet). As shown in FIG. 4, the thyroid cancer diagnostic system 600 can be further coupled with a data store 650.

The input module 610 can be adapted to receive and/or collect a sample of a thyroid nodule obtained from a subject. The isolation module 612 can be configured to isolate DNA from the thyroid nodule sample received by the input module 610 thereby forming isolated thyroid nodule DNA. The conversion module 614 can be configured to treat the isolated thyroid nodule DNA including by contacting the isolated thyroid nodule DNA with one or more bisulfite reagents including, for example, a bisulfite salt. Exposing the isolated thyroid nodule DNA to one or more bisulfite reagents can convert cytosine to uracil while 5-mC is left unmodified. Thus, the 5-mC present in the isolated thyroid nodule DNA will remain in the reacted thyroid nodule DNA. Meanwhile, any cytosine in the isolated thyroid nodule DNA will be replaced by uracil in the reacted thyroid nodule DNA. In embodiments, the treatment of the isolated thyroid nodule DNA can be performed by applying one or more kits (e.g., the Bisulflash DNA Modification Kit (Epigentek) or Imprint DNA Modification Kit (Sigma)).

In embodiments, the conversion module 614 can be further adapted to ensure optimal bisulfite conversion (e.g., with desired DNA fragment size for post-bisulfite ligation) by controlling one or more of a concentration of the bisulfite reagents, temperature, and reaction time period. It should be appreciated that the conversion module 614 can be adapted to use a different and/or additional type of reagent without departing from the scope of the present subject matter. For example, the conversion module 614 can treat the isolated thyroid nodule DNA with potassium chloride, which may reduce the thermophilic DNA degradation associated with the conversion of cytosine to uracil. Moreover, the conversion module 614 can be configured to perform additional processing of the reacted thyroid nodule DNA including, for example, desulphonation (e.g., with an alkalized solution), cleansing (e.g., by elution), and amplification (e.g., using the PCR method).

The detection module 616 can be configured to detect a methylation and/or unmethylation of the thyroid nodule DNA. For instance, the detection module 616 can detect methylation by detecting a presence of uracil in the reacted thyroid nodule DNA generated by the conversion module 614. Alternately and/or additionally, the detection module 616 can detect unmethylation by detecting an absence of uracil in the reacted thyroid nodule DNA. In embodiments, the detection module 616 can be configured detect the presence and/or absence of uracil at specific methylation sites. That is, the detection module 616 can be configured to detect the presence and/or absence of uracil at specific chromosomal positions of certain chromosomes. For example, the thyroid cancer diagnostic system 600 can store a plurality of specific methylation sites (e.g., Table 1) in the data store 650. As such, to detect methylation, the detection module 616 can be configured to obtain, from the data store 650, one or more specific methylation sites at which to test for the presence and/or absence of uracil. Moreover, in embodiments, the detection module 616 can be configured to determine a level of methylation and/or unmethylation at the specific methylation sites. The level of methylation at a particular site can correspond to a proportion of the reacted thyroid nodule DNA that has a cytosine rather than a uracil at that site. By contrast, the level of unmethylation at a particular site can correspond to a proportion of reacted thyroid nodule DNA that has a uracil rather than a cytosine at that site.

In embodiments, the conversion module 614 may amplify the reacted thyroid nodule DNA such as by using a PCR method. The detection of methylation and/or unmethylation in amplified reacted thyroid nodule DNA may require detection of a presence and/or absence of thymidine at a site of interest in amplicons amplified from the reacted thyroid nodule DNA. That is, instead of detecting the presence and/or absence of uracil, the detection module 616 can be configured to detect methylation and/or unmethylation of amplified reacted thyroid nodule DNA by detecting a presence and/or absence of thymidine at specific methylation sites (e.g., as set forth in Table 1).

The diagnosis module 618 can be configured to generate a diagnosis for the subject based on whether the detection module 616 detects methylation and/or unmethylation at the plurality of specific methylation sites (e.g., Table 1). Alternately or additionally, the diagnosis module 618 can be configured to generate a diagnosis for the subject based on a level of methylation and/or unmethylation detected by the detection module 616 at the plurality of specific methylation sites. For instance, diagnosis module 618 can determine that the thyroid nodule is malignant (e.g., cancerous) when the unmethylation level (e.g., proportion of uracil) at different methylation sites exceeds the corresponding thresholds (e.g., as set forth in Table 2). In embodiments, the diagnosis module 618 can further generate a diagnosis for the subject based on one or more of the subject's PTC methylation alternation score, a BTN methylation alternation score, and/or a Composite Cancer Risk Score.

In embodiments, the diagnosis module 618 can be configured to determine a PTC methylation alternation score for the subject. In embodiments, the PTC methylation alteration score can correspond to a number of specific methylation sites (e.g., as set forth in Table 1) that have a uracil level (or corresponding thymidine level if amplicons are being analyzed) equal to or greater than the corresponding thresholds (e.g., as set forth in Table 2). Alternately or additionally, the diagnosis module 618 can be configured to determine a BTN methylation alternation score for the subject. The BTN methylation alteration score can correspond to a number of specific methylation sites (e.g., as set forth in Table 1) that have a uracil level (or corresponding thymidine level if amplicons are being analyzed) equal to or greater than the various corresponding threshold level (e.g., as set forth in Table 3 and/or Table 4).

In embodiments, the diagnosis module 618 can further be configured to compute a Composite Cancer Risk Score for the subject. The diagnosis module 618 can compute the Composite Cancer Risk Score based on the PTC methylation alteration score and the BTN methylation alteration score for the subject. For example, the Composite Cancer Risk Score for the subject can be computed based on equation (1):

$$\frac{\left[\text{the PTC methylation alteration score for the subject}\right]}{\left[\text{BTN methylation alteration score for the subject}\right]}. \quad (1)$$

Alternately or additionally, the Composite Cancer Risk Score for the subject can be computed based on equation (2):

$$\frac{\left[\left(\text{the PTC methylation alteration score for the subject}\right)+1\right]}{\left[\left(\text{BTN methylation alteration score for the subject}\right)+1\right]} \quad (2)$$

The treatment module 620 can be configured to formulate a treatment plan for the subject based on the diagnosis generated by the diagnosis module 618. For instance, when the diagnosis generated by the diagnosis module 618 indicates a presence and/or risk of a malignant (e.g., cancerous) thyroid nodule, the treatment module 620 can prescribe one or more treatments including, for example, thyroid surgery, radiation therapy, radioactive iodine therapy, chemotherapy, thyroid hormone therapy, and administration of an active agent. In embodiments, the treatment module 620 can be configured to provide the treatment plan to the device 630 via the network 640. Alternately or additionally, the treatment module 620 can store the treatment plan in the data store 650.

The UI module 622 can be configured to generate a UI through which a user (e.g., a physician) can interface with the thyroid cancer diagnostic system 600. For example, the UI module 622 can provide one or more graphic user interfaces (GUIs) configured to display the diagnosis and/or treatment plan for the subject.

Figure 5:
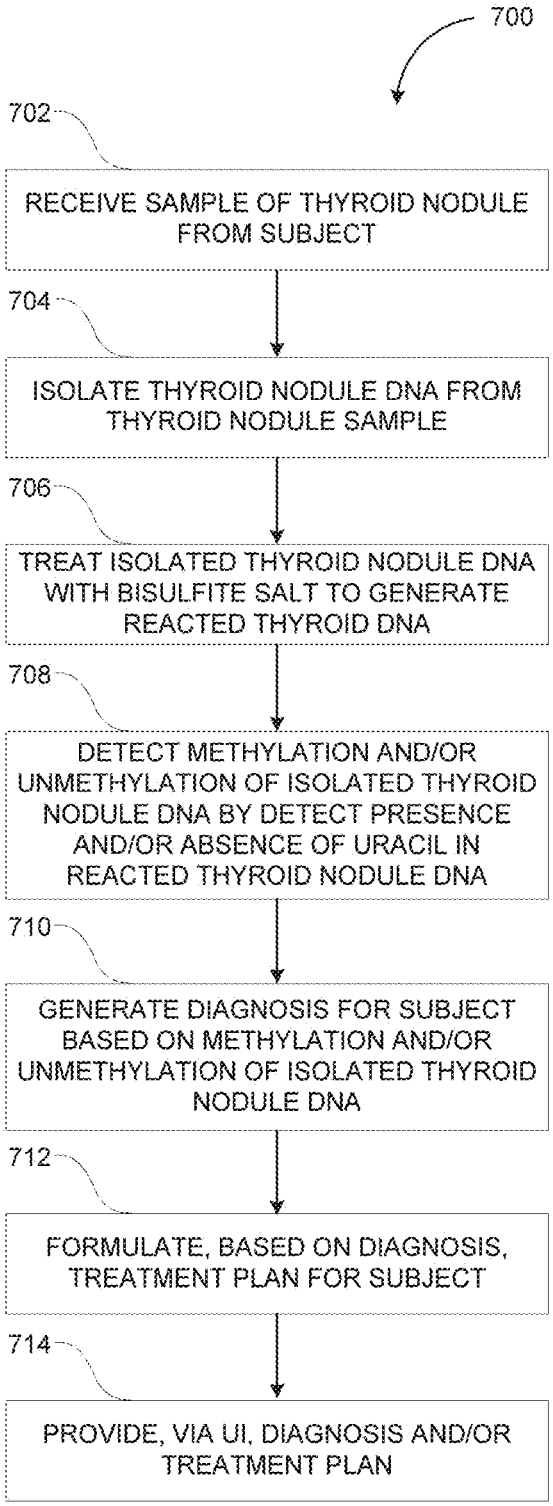
FIG. 5 depicts a flowchart illustrating an exemplary process for diagnosing thyroid cancer.

FIG. 5 depicts a flowchart illustrating an exemplary process 700 for diagnosing thyroid cancer. Referring to FIGS. 4-5, the process 700 can be performed by the thyroid cancer diagnostic system 600.

The thyroid cancer diagnostic system 600 (e.g., the input module 610) can receive a sample of a thyroid nodule from a subject (702). The thyroid cancer diagnostic system 600 (e.g., the isolation module 612) can isolate thyroid nodule DNA from the thyroid nodule sample (704). The thyroid cancer diagnostic system 600 (e.g., the conversion module 614) can treat the isolated thyroid nodule DNA with a bisulfite salt to generate reacted thyroid nodule DNA (706). Treating the isolated thyroid nodule DNA with the bisulfite salt can form a reacted thyroid nodule DNA by converting the cytosine present in the isolated thyroid nodule DNA to uracil. In embodiments, the thyroid cancer diagnostic system 600 can further process the reacted thyroid nodule DNA by desulphonating, cleansing, and/or amplifying the reacted thyroid nodule DNA.

The thyroid cancer diagnostic system 600 (e.g., the detection module 616) can detect methylation and/or unmethylation of the isolated thyroid nodule DNA by at least detecting a presence and/or absence of uracil in the reacted thyroid nodule DNA (708). In embodiments, the thyroid cancer diagnostic system 600 can be configured to detect a presence and/or absence of uracil at specific methylation sites (e.g., as set forth in Table 1). Moreover, the thyroid cancer diagnostic system 600 can be configured to detect a level of methylation and/or unmethylation at the methylation sites.

The thyroid cancer diagnostic system 600 (e.g., the diagnostics module 618) can generate a diagnosis for the subject based on the methylation and/or unmethylation of the isolated thyroid nodule DNA (710). For example, the thyroid cancer diagnostic system 600 can generate a diagnosis based on a level of methylation and/or unmethylation at a plurality of specific methylation sites. Each methylation site may be associated with a certain threshold unmethylation level (e.g., as set forth in Table 2). As such, the thyroid cancer diagnostic system 600 can determine that the thyroid nodule from the subject is malignant (e.g., cancerous) if the level of unmethylation at the plurality of methylation sites exceeds the corresponding thresholds.

The thyroid cancer diagnostic system 600 (e.g., the treatment module 620) can formulate, based on the diagnosis, a treatment plan for the subject (712). For example, when the diagnosis indicates that a presence and/or risk of malignant thyroid nodules in the subject, the thyroid cancer diagnostic system 600 can prescribe thyroid surgery, radiation therapy, radioactive iodine therapy, chemotherapy, thyroid hormone therapy, and/or administration of an active agent. The thyroid cancer diagnostic system 600 (e.g., the UI module 622) can provide, via a UI (e.g., GUI at the device 630), the diagnosis and/or the treatment plan for the subject (714).

Figure 6:
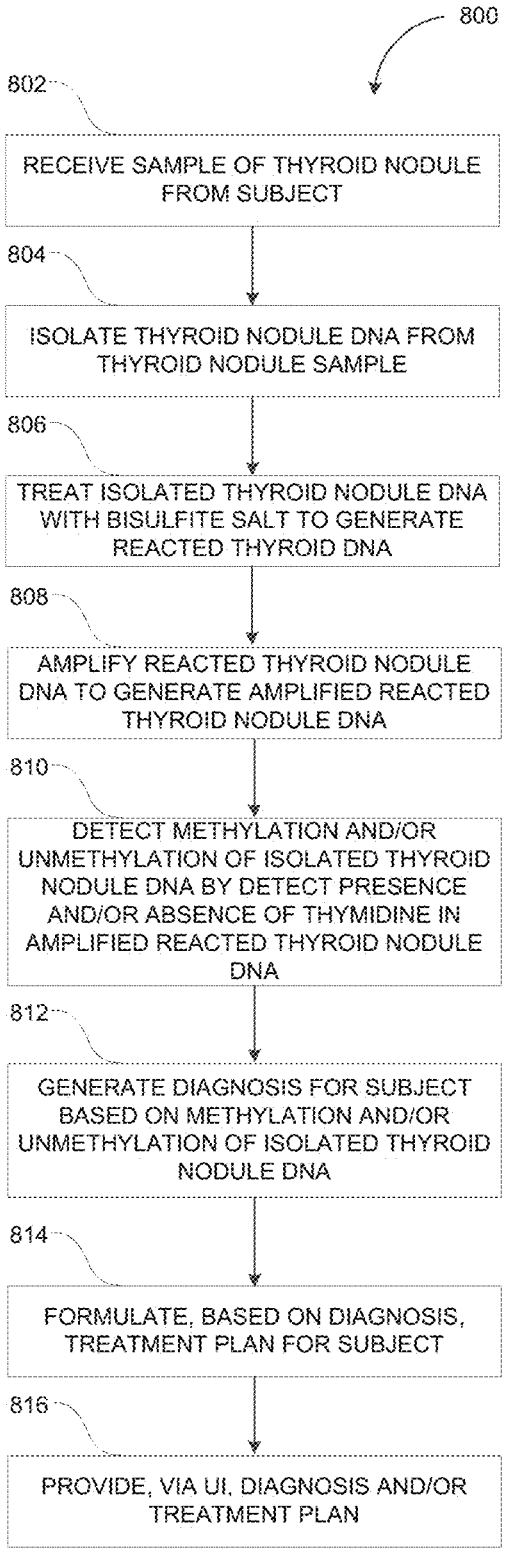
FIG. 6 depicts a flowchart illustrating an exemplary process for diagnosing thyroid cancer.

FIG. 6 depicts a flowchart illustrating an exemplary process 800 for diagnosing thyroid cancer. Referring to FIGS. 4 and 6, the process 700 can be performed by the thyroid cancer diagnostic system 600.

The thyroid cancer diagnostic system 600 (e.g., the input module 610) can receive a sample of a thyroid nodule from a subject (802). The thyroid cancer diagnostic system 600 (e.g., the isolation module 612) can isolate thyroid nodule DNA from the thyroid nodule sample (804). The thyroid cancer diagnostic system 600 (e.g., the conversion module 614) can treat the isolated thyroid nodule DNA with a bisulfite salt to generate reacted thyroid nodule DNA (806).

As shown in FIG. 6, the thyroid cancer diagnostic system 600 (e.g., the conversion module 614) can amplify the reacted thyroid nodule DNA (808). For instance, the thyroid cancer diagnostic system 600 can amplify the reacted thyroid nodule DNA subsequent to treating the isolated thyroid nodule NA with the bisulfite salt to generate the reacted thyroid nodule DNA. The thyroid cancer diagnostic system 600 can detect methylation and/or unmethylation of the isolated thyroid nodule DNA by detecting a presence and/or absence of thymidine in the amplified reacted thyroid nodule DNA (810).

The thyroid cancer diagnostic system 600 (e.g., the diagnostics module 618) can generate a diagnosis for the subject based on the methylation and/or unmethylation of the isolated thyroid nodule DNA (812). Moreover, the thyroid cancer diagnostic system 600 (e.g., the treatment module 620) can formulate, based on the diagnosis, a treatment plan for the subject (814). The thyroid cancer diagnostic system 600 (e.g., the UI module 622) can provide, via a UI, the diagnosis and/or treatment plan for the subject.

It should be appreciated that the process 700 and/or 800 can include different and/or additional operations without departing from the scope of the present subject matter. Moreover, one or more operations of the process 700 and/or 800 can be omitted and/or repeated without departing from the scope of the present subject matter.

Implementations of the present subject matter can include, but are not limited to, methods consistent with the descriptions provided above as well as articles that comprise a tangibly embodied machine-readable medium operable to cause one or more machines (e.g., computers, etc.) to result in operations implementing one or more of the described features. Similarly, computer systems are also described that can include one or more processors and one or more memories coupled to the one or more processors. A memory, which can include a computer-readable storage medium, can include, encode, store, or the like one or more programs that cause one or more processors to perform one or more of the operations described herein. Computer implemented methods consistent with one or more implementations of the current subject matter can be implemented by one or more data processors residing in a single computing system or multiple computing systems. Such multiple computing systems can be connected and can exchange data and/or commands or other instructions or the like via one or more connections, including but not limited to a connection over a network (e.g. the Internet, a wireless wide area network, a local area network, a wide area network, a wired network, or the like), via a direct connection between one or more of the multiple computing systems, etc.

One or more aspects or features of the subject matter described herein can be realized in digital electronic circuitry, integrated circuitry, specially designed ASICs, FPGAs, computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system can include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example as would a processor cache or other random access memory associated with one or more physical processor cores.

To provide for interaction with a user, one or more aspects or features of the subject matter described herein can be implemented on a computer having a display device, such as for example a cathode ray tube (CRT) or a liquid crystal display (LCD) or a light emitting diode (LED) monitor for displaying information to the user and a keyboard and a pointing device, such as for example a mouse or a trackball, by which the user may provide input to the computer. Other kinds of devices can be used to provide for interaction with a user as well. For example, feedback provided to the user can be any form of sensory feedback, such as for example visual feedback, auditory feedback, or tactile feedback; and input from the user can be received in any form, including, but not limited to, acoustic, speech, or tactile input. Other possible input devices include, but are not limited to, touch screens or other touch-sensitive devices such as single or multi-point resistive or capacitive trackpads, voice recognition hardware and software, optical scanners, optical pointers, digital MRI image capture devices and associated interpretation software, and the like.

Examples are provided below to facilitate a more complete understanding of the invention. The following examples illustrate the exemplary modes of making and practicing the invention. However, the scope of the invention is not limited to specific embodiments disclosed in these Examples, which are for purposes of illustration only, since alternative methods can be utilized to obtain similar results.

EMBODIMENTS

Embodiments include embodiments P1 to P41 following.

Embodiment P1

A method of detecting methylation or unmethylation of a thyroid nodule DNA of a subject, the method comprising: (i) isolating DNA from a thyroid nodule of said subject thereby forming isolated thyroid nodule DNA, (ii) contacting said isolated thyroid nodule DNA with sodium bisulfite thereby forming a reacted thyroid nodule DNA, (iii) detecting the presence or absence of uracil in said reacted thyroid nodule DNA at a methylation site set forth in Table 1, thereby detecting methylation or unmethylation of said thyroid nodule DNA of said subject.

Embodiment P2

The method of embodiment P1, further comprising determining alteration in methylation at a plurality of methylation sites set forth in Table 1.

Embodiment P3

The method of embodiment P2, said alteration comprises increase or loss of uracil level at said plurality of methylation sites.

Embodiment P4

The method of embodiment P3, wherein said uracil level is above a threshold as set forth in Table 2.

Embodiment P5

The method of embodiment P3, wherein said uracil level is above a threshold as set forth in Table 3.

Embodiment P6

The method of embodiment P3, wherein said uracil level is below a threshold as set forth in Table 4.

Embodiment P7

The method of embodiment P3, wherein said subject is a candidate thyroid cancer patient.

Embodiment P8

The method of embodiment P4, wherein said above threshold identifies said thyroid nodule as a cancerous thyroid nodule.

Embodiment P9

The method of embodiment P5, wherein said above threshold identifies said thyroid nodule as a benign thyroid nodule.

Embodiment P10

The method of embodiment P6, wherein said below threshold identifies said thyroid nodule as a benign thyroid nodule.

Embodiment P11

The method of one of the above embodiments, wherein said thyroid nodule is a specimen obtained by biopsy or by surgical resection of said subject.

Embodiment P12

The method of embodiment P11, wherein said subject has undergone thyroid surgery, radiation therapy, radioactive iodine therapy, chemotherapy, thyroid hormone therapy, and administration of an active agent.

Embodiment P13

The method of embodiment P12, wherein said active agent is chosen from Cabozantinib-S-Malate, Caprelsa (Vandetanib), Cometriq (Cabozantinib-S-Malate), Doxorubicin Hydrochloride, Lenvatinib Mesylate, Lenvima (Lenvatinib Mesylate), Nexavar (Sorafenib Tosylate). Sorafenib Tosylate, and Vandetanib.

Embodiment P14

A method of determining a thyroid cancer or risk of developing thyroid cancer in a subject in need thereof, said method comprising: (i) isolating DNA from a thyroid nodule of said subject thereby forming isolated thyroid nodule DNA; (ii) contacting said isolated thyroid nodule DNA with sodium bisulfite thereby forming a reacted thyroid nodule DNA; and (iii) detecting the presence or absence of uracil in said reacted thyroid nodule DNA at a methylation site set forth in Table 1: thereby determining said thyroid cancer in said subject.

Embodiment P15

The method of embodiment P14, further comprising selecting a subject that has or is at risk for developing thyroid cancer.

Embodiment P16

The method of embodiment P14, further comprising determining alteration in methylation at a plurality of methylation sites set forth in Table 1.

Embodiment P17

The method of embodiment P16, said alteration comprises increase or loss of uracil level at said plurality of methylation sites.

Embodiment P18

The method of embodiment P17, wherein said uracil level is above a threshold as set forth in Table 2.

Embodiment P19

The method of embodiment P17, wherein said uracil level is above a threshold as set forth in Table 3.

Embodiment P20

The method of embodiment P17, wherein said uracil level is below a threshold as set forth in Table 4.

Embodiment P21

The method of embodiment P17, wherein said subject is a candidate thyroid cancer patient.

Embodiment P22

The method of embodiment P18, wherein said above threshold identifies said thyroid nodule as a cancerous thyroid nodule.

Embodiment P23

The method embodiment P19, wherein said above threshold identifies said thyroid nodule as a benign thyroid nodule.

Embodiment P24

The method of embodiment P20, wherein said below threshold identifies said thyroid nodule as a benign thyroid nodule.

Embodiment P25

The method of embodiments P14-P24, wherein said thyroid nodule is a specimen obtained by biopsy or by surgical resection of said subject.

Embodiment P26

The method of embodiment P25, wherein said subject has undergone thyroid surgery, radiation therapy, radioactive iodine therapy, chemotherapy, thyroid hormone therapy, and administration of an active agent, before said determination.

Embodiment P27

The method of embodiment P26, wherein said active agent is chosen from Cabozantinib-S-Malate, Caprelsa (Vandetanib), Cometriq (Cabozantinib-S-Malate), Doxorubicin Hydrochloride. Lenvatinib Mesylate, Lenvima (Lenvatinib Mesylate), Nexavar (Sorafenib Tosylate). Sorafenib Tosylate, and Vandetanib.

Embodiment P28

A method of treating thyroid cancer in a subject determined by the method as set forth in embodiment P22, comprising administering to said subject an active agent for treating thyroid cancer.

Embodiment P29

The method of embodiment P28, wherein said subject has undergone surgery, radiation therapy, radioactive iodine therapy, chemotherapy, or thyroid hormone therapy, before said detection of embodiment 14 at (iii).

Embodiment P30

The method of embodiment P29, wherein said active agent is chosen from Cabozantinib-S-Malate. Caprelsa (Vandetanib), Cometriq (Cabozantinib-S-Malate), Doxorubicin Hydrochloride, Lenvatinib Mesylate, Lenvima (Lenvatinib Mesylate), Nexavar (Sorafenib Tosylate), Sorafenib Tosylate, and Vandetanib.

Embodiment P31

The method of one of above embodiments, wherein said subject has or is at risk of papillary thyroid cancer, follicular thyroid cancer, medullary thyroid cancer, or anaplastic thyroid cancer.

Embodiment P32

A deoxyribonucleic acid 5 to 100 nucleotides in length comprising a uracil-containing sequence identical to at least a 5 contiguous nucleotide sequence within a sequence chosen from SEQ ID NO:1 to SEQ ID NO:550.

Embodiment P33

The deoxyribonucleic acid of embodiment P32 identical to 5-10, 10-20, 20-30, 30-40, 40-50, 50-60, 60-70, 70-80, 80-90, 90-100, 100-110, 110-120, 120-130, 130-140, 140-150, 150-160, 160-170, 170-180, 180-190, or 190-200 of contiguous nucleotide sequence of said sequence chosen from SEQ ID NO:1 to SEQ ID NO:550.

Embodiment P34

The deoxyribonucleic acid of embodiment P32 or P33, wherein said sequence comprises a methylation site set forth in Table 2.

Embodiment P35

The deoxyribonucleic acid of embodiment P34, wherein a plurality of methylation sites set forth in Table 2 are methylated or unmethylated.

Embodiment P36

A deoxyribonucleic acid chosen from SEQ ID NO:551 to SEQ ID NO:782, wherein said nucleic acid is hybridized to a complementary DNA sequence comprising uridine or cytosine.

Embodiment P37

The deoxyribonucleic acid of embodiment P36, further comprising an enzyme in a complex with said hybridized complementary DNA sequence.

Embodiment P38

The deoxyribonucleic acid of embodiment P37, wherein said enzyme is Taq polymerase.

Embodiment P39

A kit comprising 322 nucleic acids each independently comprising SEQ ID NO:551 to SEQ ID NO:782, wherein said nucleic acids do not simultaneously comprise the same SEQ ID NO:551 to SEQ ID NO:782.

Embodiment P40

The kit according to embodiment P39, further comprising: enzymes, reagents for deamination of cytosine, buffers, vials, plasmid vectors, control DNA, devices for collecting thyroid tissue samples, reagents for isolating DNA, reagents for labeling DNA, or any combinations thereof.

Embodiment P41

The kit according to embodiment P40, wherein the enzymes are selected from the group consisting of: thermostable DNA polymerase enzymes, restriction enzymes, and combination thereof.

Further embodiments include embodiments 1-58 following.

Embodiment 1

A method of detecting methylation or unmethylation of a thyroid nodule DNA molecule of a subject, the method comprising: (i) isolating a thyroid nodule DNA molecule from a thyroid nodule of said subject thereby forming an isolated thyroid nodule DNA molecule. (ii) contacting said isolated thyroid nodule DNA molecule with a bisulfite salt thereby forming a reacted thyroid nodule DNA molecule, (iii) detecting the presence or absence of uracil in said reacted thyroid nodule DNA molecule at a methylation site set forth in Table 1, thereby detecting methylation or unmethylation of said thyroid nodule DNA molecule of said subject.

Embodiment 2

The method of embodiment 1, further comprising detecting the presence or absence of uracil in said reacted thyroid nodule DNA molecule at a plurality of methylation sites set forth in Table 1, wherein said methylation site forms a part of said plurality of methylation sites.

Embodiment 3

The method of embodiment 1, the method further comprising: (i) isolating a plurality of thyroid nodule DNA molecules from said thyroid nodule of said subject thereby forming a plurality of isolated thyroid nodule DNA molecules, wherein said isolated thyroid nodule DNA molecule forms part of said plurality of isolated thyroid nodule DNA molecules, (ii) contacting said plurality of isolated thyroid nodule DNA molecules with said bisulfite salt thereby forming a plurality of reacted thyroid nodule DNA molecules, wherein said reacted thyroid nodule DNA molecule forms part of said plurality of reacted thyroid nodule DNA molecules, (iii) detecting the level of reacted thyroid nodule DNA molecules in said plurality of reacted thyroid nodule DNA molecules having a uracil at a methylation site set forth in Table 1, thereby detecting the level of methylation or unmethylation in said plurality of thyroid nodule DNA molecules of said subject.

Embodiment 4

The method of embodiment 3, further comprising determining the level of uracil in said reacted thyroid nodule DNA molecule at a plurality methylation sites set forth in Table 1, wherein said methylation site forms a part of said plurality of methylation sites.

Embodiment 5

The method of embodiment 4, wherein said uracil level is above a threshold as set forth in Table 2.

Embodiment 6

The method of embodiment 4, wherein said uracil level is above a threshold as set forth in Table 3.

Embodiment 7

The method of embodiment 4, wherein said uracil level is below a threshold as set forth in Table 4.

Embodiment 8

The method of one of the above embodiments, wherein said subject is suspected of having thyroid cancer.

Embodiment 9

The method of one of the above embodiments, wherein said thyroid nodule is a specimen obtained by biopsy or by surgical resection of said subject.

Embodiment 10

The method of one of the above embodiments, wherein said subject has undergone thyroid surgery, radiation therapy, radioactive iodine therapy, chemotherapy, thyroid hormone therapy, and/or administration of an active agent.

Embodiment 11

The method of embodiment 10, wherein said active agent is chosen from Cabozantinib-S-Malate, Caprelsa (Vandetanib), Cometriq (Cabozantinib-S-Malate). Doxorubicin Hydrochloride. Lenvatinib Mesylate, Lenvima (Lenvatinib Mesylate), Nexavar (Sorafenib Tosylate), Sorafenib Tosylate, and/or Vandetanib.

Embodiment 12

A method of detecting a thyroid cancer or risk of developing thyroid cancer in a subject in need thereof, said method comprising:

(i) isolating a thyroid nodule DNA molecule from a thyroid nodule of said subject thereby forming an isolated thyroid nodule DNA molecule;

(ii) contacting said isolated thyroid nodule DNA molecule with a bisulfite salt thereby forming a reacted thyroid nodule DNA molecule; and (iii) detecting the presence or absence of uracil in said reacted thyroid nodule DNA molecule at a methylation site set forth in Table 1; thereby detecting said thyroid cancer in said subject.

Embodiment 13

The method of embodiment 12, wherein said subject (a) is a woman; (b) is about 20 to about 55 years old; (c) has a mutated Ret Proto-Oncogene; (d) has a grandparent, parent, or sibling who has been diagnosed with thyroid cancer; (e) self-identifies as being Caucasian or Asian; and/or (f) has or has had breast cancer.

Embodiment 14

The method of embodiment 12, further comprising detecting the presence or absence of uracil in said reacted thyroid nodule DNA molecule at a plurality of methylation sites set forth in Table 1, wherein said methylation site forms a part of said plurality of methylation sites.

Embodiment 15

The method of embodiment 12, the method further comprising: (i) isolating a plurality of thyroid nodule DNA molecules from said thyroid nodule of said subject thereby forming a plurality of isolated thyroid nodule DNA molecules, wherein said isolated thyroid nodule DNA molecule forms part of said plurality of isolated thyroid nodule DNA molecules, (ii) contacting said plurality of isolated thyroid nodule DNA molecules with said bisulfite salt thereby forming a plurality of reacted thyroid nodule DNA molecules, wherein said reacted thyroid nodule DNA molecule forms part of said plurality of reacted thyroid nodule DNA molecules, (iii) detecting the level of reacted thyroid nodule DNA molecules in said plurality of reacted thyroid nodule DNA molecules having a uracil at a methylation site set forth in Table 1; thereby detecting said thyroid cancer in said subject.

Embodiment 16

The method of embodiment 15, further comprising determining the level of uracil in said reacted thyroid nodule DNA molecule at a plurality methylation sites set forth in Table 1, wherein said methylation site forms a part of said plurality of methylation sites.

Embodiment 17

The method of embodiment 16, wherein said uracil level is above a threshold as set forth in Table 2.

Embodiment 18

The method of embodiment 16, wherein said uracil level is above a threshold as set forth in Table 3.

Embodiment 19

The method of embodiment 16, wherein said uracil level is below a threshold as set forth in Table 4.

Embodiment 20

The method of one of the above embodiments, wherein said subject is suspected of having thyroid cancer.

Embodiment 21

The method of one of the above embodiments, wherein said thyroid nodule is a specimen obtained by biopsy or by surgical resection of said subject.

Embodiment 22

The method of one of the above embodiments, wherein said subject has undergone thyroid surgery, radiation therapy, radioactive iodine therapy, chemotherapy, thyroid hormone therapy, and administration of an active agent, before said determination.

Embodiment 23

The method of embodiment 22, wherein said active agent is chosen from Cabozantinib-S-Malate, Caprelsa (Vandetanib), Cometriq (Cabozantinib-S-Malate), Doxorubicin Hydrochloride, Lenvatinib Mesylate, Lenvima (Lenvatinib Mesylate), Nexavar (Sorafenib Tosylate), Sorafenib Tosylate, and.

Embodiment 24

A method of treating thyroid cancer in a subject determined by the method as set forth in any of embodiments 12 to 23, comprising administering to said subject an active agent for treating thyroid cancer.

Embodiment 25

The method of embodiment 24, wherein said subject has undergone surgery, radiation therapy, radioactive iodine therapy, chemotherapy, or thyroid hormone therapy, before said detection of claim 12 at (iii).

Embodiment 26

The method of embodiment 25, wherein said active agent is chosen from Cabozantinib-S-Malate. Caprelsa (Vandetanib), Cometriq (Cabozantinib-S-Malate). Doxorubicin Hydrochloride. Lenvatinib Mesylate, Lenvima (Lenvatinib Mesylate), Nexavar (Sorafenib Tosylate). Sorafenib Tosylate, and Vandetanib.

Embodiment 27

The method of one of the above embodiments, wherein said subject has or is at risk of papillary thyroid cancer, follicular thyroid cancer, medullary thyroid cancer, or anaplastic thyroid cancer.

Embodiment 28

The method of one of the above embodiments, wherein said bisulfite salt is sodium bisulfite.

Embodiment 29

The method of one of the above embodiments, further comprising determining a papillary thyroid carcinoma (PTC) methylation alteration score for said subject, wherein the PTC methylation alteration score is equal to: the number of methylation sites in Table 1 having a uracil level equal to or greater than the corresponding threshold level set forth in Table 2.

Embodiment 30

The method of one of the above embodiments, further comprising determining a benign thyroid nodule (BTN) methylation alteration score for said subject, wherein the BTN methylation alteration score is equal to:

(a) the number of methylation sites in Table 1 having a uracil level equal to or greater than the corresponding threshold level set forth in Table 3;
(b) the number of methylation sites in Table 1 having a uracil level equal to or less than the corresponding threshold level set forth in Table 4; or
(c) the number of methylation sites in Table 1 having a uracil level equal to or greater than the corresponding threshold level set forth in Table 3 plus the number of methylation sites in Table 1 having a uracil level equal to or less than the corresponding threshold level set forth in Table 4.

Embodiment 31

The method of embodiment 29, further comprising calculating a Composite Cancer Risk Score for said subject.

Embodiment 32

The method of embodiment 31, wherein said Composite Cancer Risk Score for said subject equals:

[the PTC methylation alteration score for said subject]/[BTN methylation alteration score for said subject].

Embodiment 33

The method of embodiment 31, wherein said Composite Cancer Risk Score for said subject equals:

[(the PTC methylation alteration score for said subject)+1]/[(BTN methylation alteration score for said subject)+1].

Embodiment 34

The method of one of embodiments 29 to 33, wherein said subject is identified as being at risk of developing thyroid cancer or diagnosed as having thyroid cancer if (a) the PTC methylation alteration score for said subject is at least 5, 6, 7, 8, 9, or 10; (b) the BTN methylation alteration score for said subject is at least 5, 6, 7, 8, 9, or 10; and/or (c) the Composite Cancer Risk Score for said subject is at least about 2, 2.1, 2.2, 2.3, 2.4, 2.5, 2.6, 2.7, 2.8, 2.9, or 3.0.

Embodiment 35

The method of one of embodiments 29 to 33, wherein said subject is treated for thyroid cancer or directed to receive additional screening for thyroid cancer if (a) the PTC methylation alteration score for said subject is at least 5, 6, 7, 8, 9, or 10; (b) the BTN methylation alteration score for said subject is at least 5, 6, 7, 8, 9, or 10; and/or (c) the Composite Cancer Risk Score for said subject is at least about 2, 2.1, 2.2, 2.3, 2.4, 2.5, 2.6, 2.7, 2.8, 2.9, or 3.0.

Embodiment 36

A deoxyribonucleic acid at least 5 to 100 nucleotides in length comprising a uracil-containing sequence that is identical to a sequence of at least a 5 contiguous nucleotides within a sequence chosen from SEQ ID NO: 1 to SEQ ID NO:550.

Embodiment 37

The deoxyribonucleic acid of embodiment 36, comprising a uracil-containing sequence that is identical to a sequence of at least 5-10, 10-20, 20-30, 30-40, 40-50, 50-60, 60-70.70-80, 80-90, 90-100, 100-110, 110-120, 120-130, 130-140, 140-150, 150-160, 160-170, 170-180, 180-190, or 190-200 contiguous nucleotides within said sequence chosen from SEQ ID NO:1 to SEQ ID NO:550.

Embodiment 38

The deoxyribonucleic acid of embodiment 36 or 37, wherein said sequence comprises a methylation site set forth in Table 1.

Embodiment 39

The deoxyribonucleic acid of one of embodiments 36 to 38, wherein a plurality of methylation sites set forth in Table 1 contain a uracil or a cytosine.

Embodiment 40

A deoxyribonucleic acid chosen from SEQ ID NO:551 to SEQ ID NO:782, wherein said nucleic acid is hybridized to a complementary DNA sequence comprising uridine or cytosine.

Embodiment 41

The deoxyribonucleic acid of embodiment 40, further comprising an enzyme in a complex with said hybridized complementary DNA sequence.

Embodiment 42

The deoxyribonucleic acid of embodiment 41, wherein said enzyme is Taq polymerase.

Embodiment 43

A kit comprising a plurality of nucleic acids each independently comprising SEQ ID NO:551 to SEQ ID NO:782, wherein each nucleic acid of said plurality is unique.

Embodiment 44

The kit according to embodiment 43, further comprising: an enzyme, a reagent for deamination of cytosine, a buffer, a vial, a plasmid vector, a control DNA, a device for collecting a thyroid tissue sample, a reagent for isolating DNA, a reagent for labeling DNA, or any combination thereof.

Embodiment 45

The kit according to embodiment 44, wherein the enzyme comprises a thermostable DNA polymerase enzyme and/or a restriction enzyme.

Embodiment 46

A system for detecting methylation or unmethylation of a thyroid nodule deoxyribonucleic acid (DNA) of a subject, the system comprising:

at least one processor; and at least one memory including program code which when executed by the at least one memory provides operations comprising:

isolating a thyroid nodule DNA molecule from a thyroid nodule of said subject thereby forming an isolated thyroid nodule DNA molecule;

contacting said isolated thyroid nodule DNA molecule with a bisulfite salt thereby forming a reacted thyroid nodule DNA molecule;

detecting the presence or absence of uracil in said reacted thyroid nodule DNA molecule at a methylation site set forth in Table 1, thereby detecting methylation or unmethylation of said thyroid nodule DNA molecule of said subject;

generating a diagnosis for said subject based at least in part on the presence or absence of uracil in said reacted thyroid nodule DNA molecule at the methylation site set forth in Table 1; and providing, via a user interface, the diagnosis for said subject.

Embodiment 47

The system of embodiment 46, wherein the system is further configured to detect the presence or absence of uracil in said reacted thyroid nodule DNA molecule at a plurality of methylation sites set forth in Table 1, wherein said methylation site forms a part of said plurality of methylation sites.

Embodiment 48

The system of embodiment 46, wherein the system is further configured to: (i) isolate a plurality of thyroid nodule DNA molecules from said thyroid nodule of said subject thereby forming a plurality of isolated thyroid nodule DNA molecules, wherein said isolated thyroid nodule DNA molecule forms part of said plurality of isolated thyroid nodule DNA molecules, (ii) contact said plurality of isolated thyroid nodule DNA molecules with said bisulfite salt thereby forming a plurality of reacted thyroid nodule DNA molecules, wherein said reacted thyroid nodule DNA molecule forms part of said plurality of reacted thyroid nodule DNA molecules, (iii) detect the level of reacted thyroid nodule DNA molecules in said plurality of reacted thyroid nodule DNA molecules having a uracil at a methylation site set forth in Table 1, thereby detecting the level of methylation or unmethylation in said plurality of thyroid nodule DNA molecules of said subject.

Embodiment 49

The system of embodiment 48, wherein the system is further configured to detect the level of uracil in said reacted thyroid nodule DNA molecule at a plurality methylation sites set forth in Table 1, wherein said methylation site forms a part of said plurality of methylation sites.

Embodiment 50

The system of embodiment 49, wherein said uracil level is above a threshold as set forth in Table 2.

Embodiment 51

The system of embodiment 49, wherein said uracil level is above a threshold as set forth in Table 3.

Embodiment 52

The system of embodiment 49, wherein said uracil level is below a threshold as set forth in Table 4.

Embodiment 53

The system of embodiment 49, wherein said subject is a candidate thyroid cancer patient.

Embodiment 54

The system of one of embodiments 46 to 53, wherein said thyroid nodule is a specimen obtained by biopsy or by surgical resection of said subject.

Embodiment 55

The system of one of embodiments 46 to 54, wherein said subject has undergone thyroid surgery, radiation therapy, radioactive iodine therapy, chemotherapy, thyroid hormone therapy, and/or administration of an active agent.

Embodiment 56

The system of embodiment 55, wherein said active agent is chosen from Cabozantinib-S-Malate, Caprelsa (Vandetanib), Cometriq (Cabozantinib-S-Malate), Doxorubicin Hydrochloride, Lenvatinib Mesylate, Lenvima (Lenvatinib Mesylate), Nexavar (Sorafenib Tosylate), Sorafenib Tosylate, and Vandetanib.

Embodiment 57

The system of one of embodiments 46 to 56, wherein the system is further configured to:

formulate, based at least in part on the diagnosis, a treatment plan for said subject; and provide, via the user interface, the treatment plan.

Embodiment 58

The system of embodiment 57, wherein the treatment plan includes one or more of thyroid surgery, radiation therapy, radioactive iodine therapy, chemotherapy, thyroid hormone therapy, and administration of an active agent.

EXAMPLES

Example 1

Human frozen specimens were blindly evaluated by a pathologist. In the study, 28 benign nodules and 40 thyroid cancer specimens were analyzed.

DNA Methylation Profiling

Genomic DNA was isolated by using a standard phenol/chloroform extraction approach followed by ethanol precipitation. Further, genomic DNA underwent Reduced Representation Bisulfite Sequencing (RRBS) procedure. RRBS DNA amplicons were paired-end sequenced by using Hiseq 2500 (Illumina). For each sample, at least 15 million aligned reads were obtained. BTN and PTC specific signatures were determined based on cytosines which are characterized by at least 5 sequencing reads in each sample.

Identification of BTN Specific and PTC Specific DNA Methylation Changes

Figure 1B:
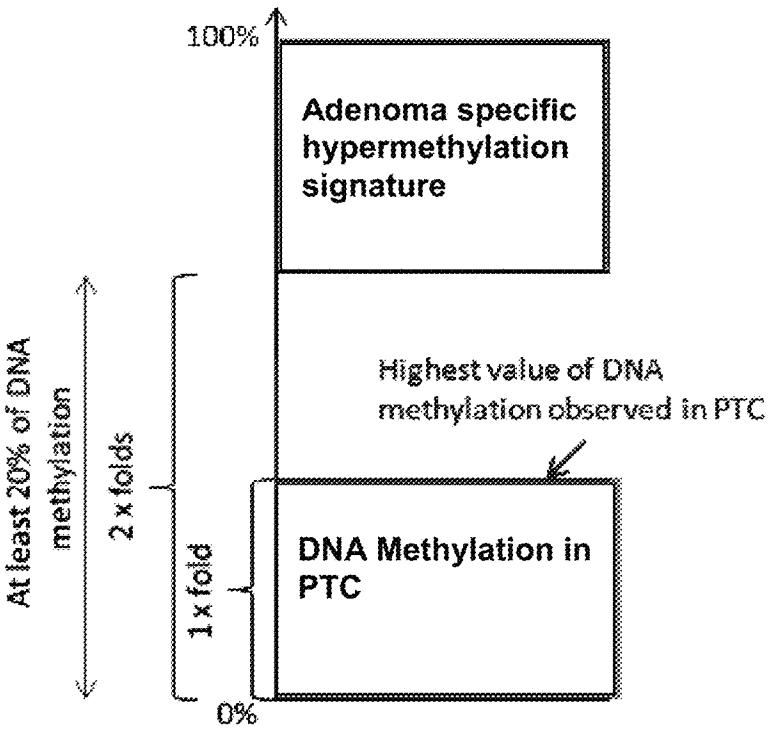

DNA methylation patterns were analyzed in 114 thyroid specimens including 28 benign nodules, 40 thyroid cancer, and 46 adjacent normal thyroid tissues, to identify the presence of thyroid cancer specific and benign nodule specific signatures. After genome alignment, a search was performed for DNA regions which have BTN or PTC specific alterations. For identification of a DNA region with a BTN specific loss of DNA methylation, DNA regions were identified which had a DNA methylation level in at least 6 out 28 that was at least 2-fold less than the level of methylation in the same DNA region any analyzed PTC specimen, where the lowest value of DNA methylation at this DNA region among all PTC specimens is 20% or higher (FIG. 1A). For identification of DNA regions with BTN specific DNA methylation accumulation, the following criteria were used; a level of DNA methylation in an individual BTN that is at least 2-fold higher than the level of DNA methylation in the same DNA region in any analyzed PTC; where the value of DNA methylation of analyzed BTN specimen is at least 20% or more greater (FIG. 1B). The BTN signature includes DNA regions which were affected by DNA methylation loss in at least 6 out 28 analyzed BTN samples and regions which were affected by DNA methylation accumulation in at least 6 out 28 analyzed BTN samples.

Further, regions were determined which undergo PTC specific DNA methylation alterations. The criteria for the identification of DNA regions with a PTC specific loss of DNA methylation, was: a level of DNA methylation in 6 out of 46 PTC that is 2-fold less than in any analyzed adenoma and any normal matching tissue, where the lowest value of DNA methylation in the region among all non-malignant specimens is 20% or higher. The criteria for the identification of DNA regions with PTC specific DNA methylation accumulation was a level of DNA methylation in an individual PTC that is at least 2-fold higher than the level of methylation in any analyzed adenoma and normal matching tissue, where the value of DNA methylation in analyzed PTC sample should be 20% or higher. There were no DNA regions that were affected by DNA methylation accumulation in at least 6 PTC out 46 analyzed PTC. Therefore, the PTC specific DNA methylation signatures contain only DNA regions which are affected by DNA methylation loss in at least 6 out 46 analyzed PTC.

Figure 2A:
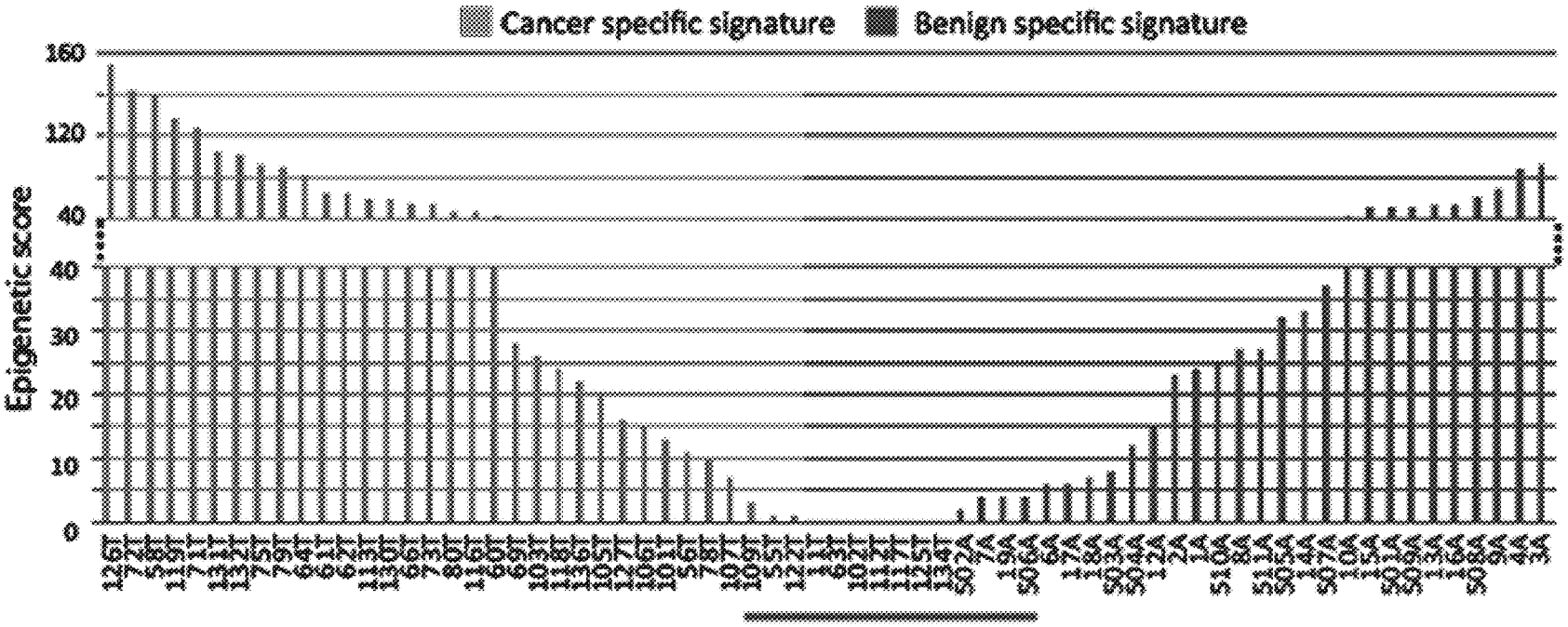
FIGS. 2A and 2B show 364 cytosines associated with BTN or PTC specific DNA methylation changes. Legend (FIG. 2A): Cancer specific signature (gray); benign specific signature (black).

The total number of identified DNA regions which fall in PTC specific or BTN specific signature is 258, which comprises DNA methylation information for 364 cytosines (FIG. 2A). There are 230 cytosines which characterize the PTC signature and 134 cytosines characterizing the BTN signature.

Evaluation of the cancer specific and benign specific changes revealed that 10 out of 40 thyroid cancer specimens are characterized by few (less than 5) or no cancer specific changes, and 4 out 28 benign nodules indicated very few (less than 5) benign specific changes (FIG. 2A). Since the approach described herein is based on the identification of the tissue specific alterations, these specimens were determined to be "epigenetically indeterminate."

Figure 2B:
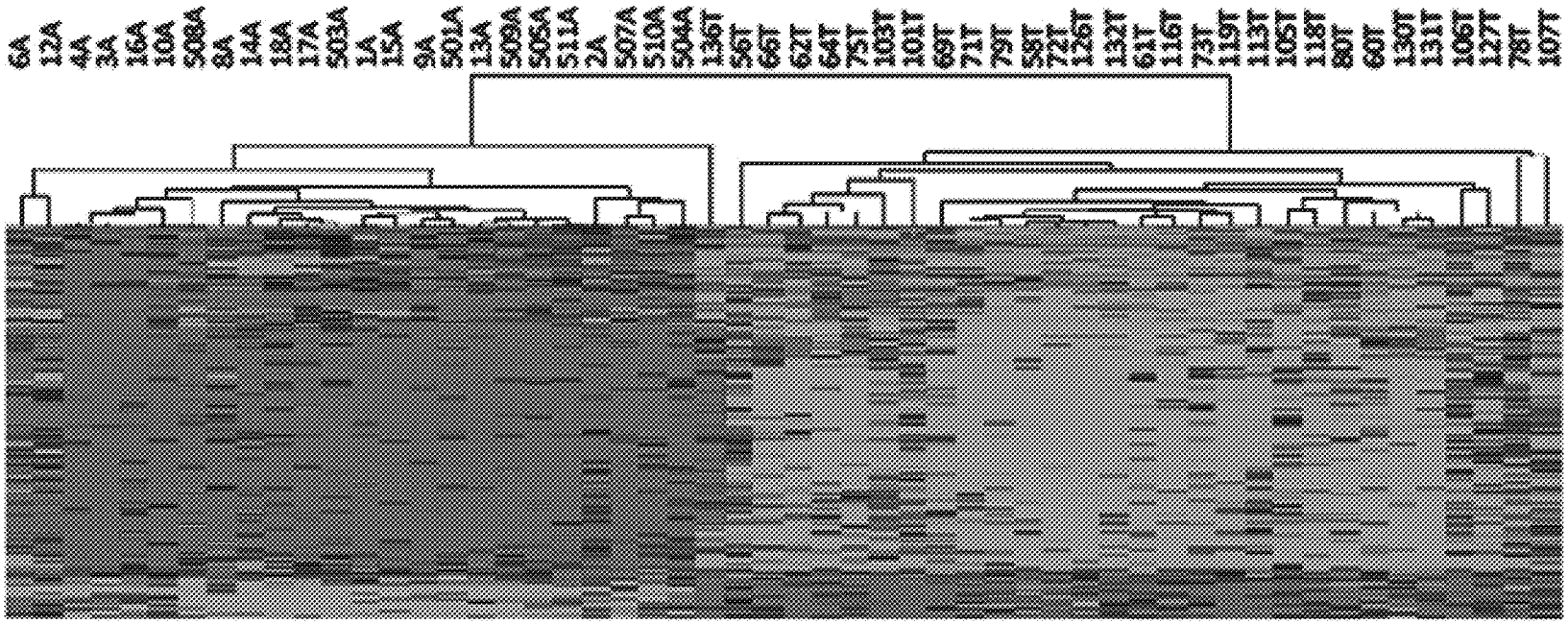

For specimens with a determinate epigenetic state, clustering analysis revealed a strict separation of thyroid cancer from benign nodules based on DNA methylation levels of cytosines associated with benign and cancer scores (FIG. 2B). Thus, the use of benign and cancer scores can provide a unique thyroid nodule diagnostic tool.

Development of Diagnostic Panel Based on BTN/PTC Signature Scores.

The data disclosed herein demonstrates that analysis of DNA methylation of one or more of 258 DNA regions can provide substantial information regarding a presence of malignancy in thyroid samples. Therefore, DNA methylation analysis within BTN and PTC signature can be used as a PTC diagnostic tool. According to the data, PTC diagnosis can be made by using both BTN and PTC signatures. Each signature can be a score based on the number of specific alterations within the signature for each individual sample. For example, the number of BTN specific alterations within BTN signature DNA regions reflects a BTN signature score. At the same time, the number of PTC specific alterations for DNA regions within PTC signature group indicates PTC signature score.

In order to validate the approach disclosed herein and estimate an accuracy of the proposed signatures, a statistical analysis was performed based on the leave-one-out-cross-validation technique. Specifically, cancer and benign scores were determined for each individual nodule by using benign and cancer signatures which were developed based on DNA methylation patterns of the rest of samples excluding the testing sample. In order to predict benign and cancer scores for 68 nodules, 68 benign and cancer unique predictive signatures were developed.

Figure 3A:
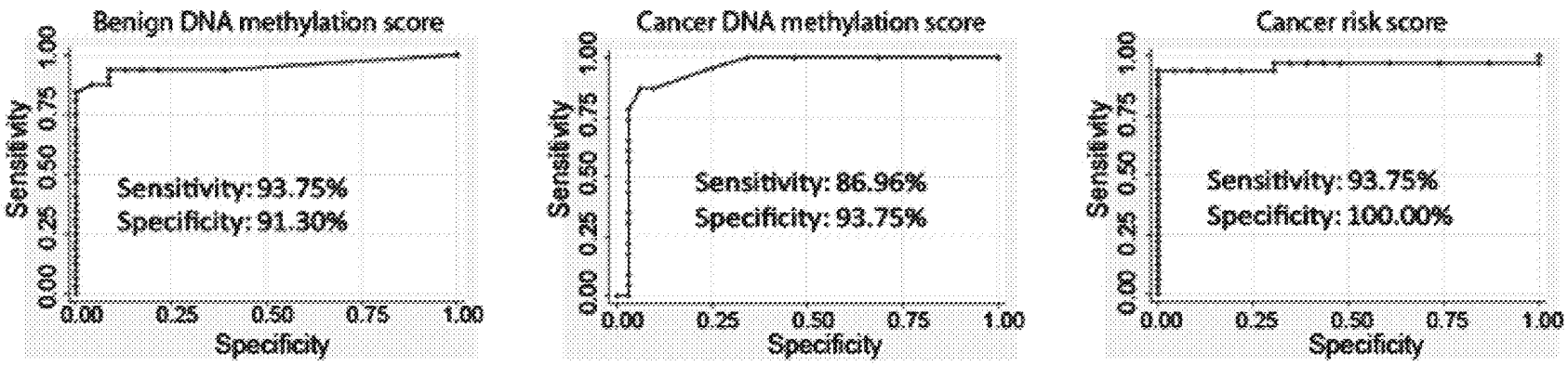
FIGS. 3A-3C depict exemplary thyroid cancer diagnostics based on DNA methylation signatures.

After cross-validation. DNA methylation signatures (score >=5) were observed in 80% (32 out 40) of thyroid cancers and 82% (23 out 28) of benign nodules (FIG. 3A). These specimens with a determinate epigenetic state were used for the further analysis.

According to the cross-validation observations, both, benign and malignant diagnostic scores provided accurate results for thyroid nodule diagnostics (FIG. 3A). However, a combining of benign and malignant scores into a cancer risk score is associated with even higher diagnostic performance. The cancer risk score was calculated using the following equation: Cancer Risk Score=(cancer score+1)/(benign score+1)

Figure 3B:
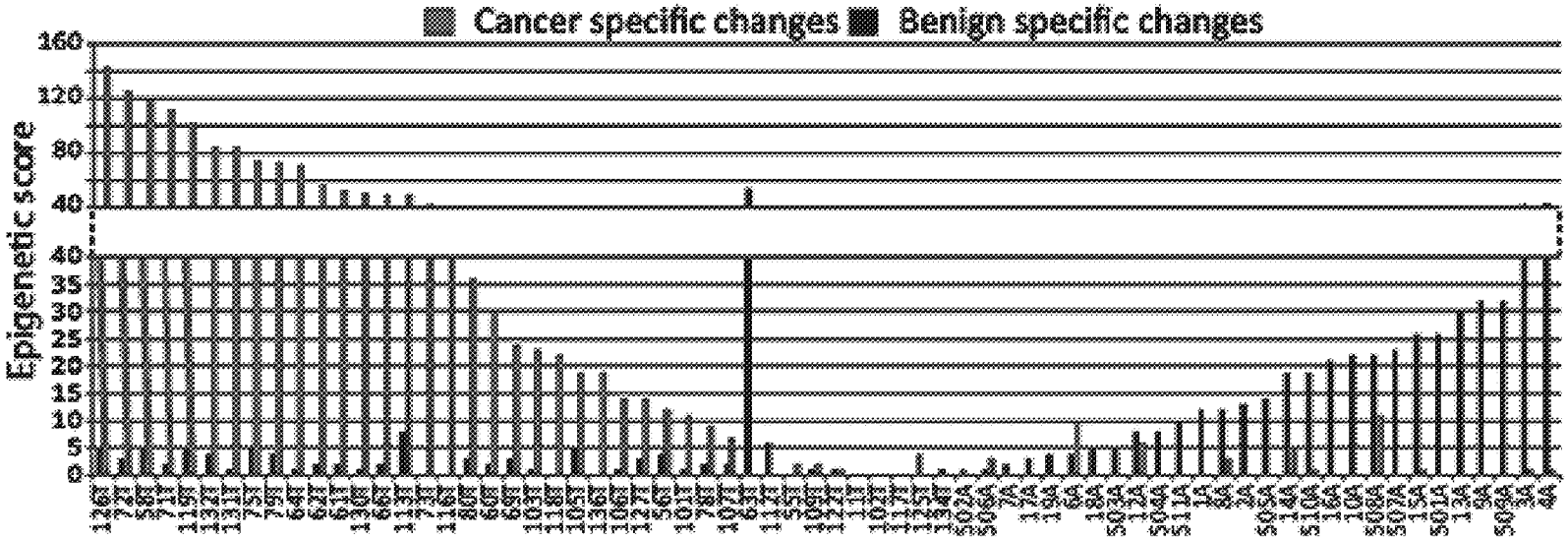

According to the data herein, specimens with cancer risk score above 2.6 represent thyroid cancer and specimens with cancer score below 2.6 are benign nodules. Based on these criteria, all 23 nodules were correctly diagnosed as benign and 30 out 32 thyroid malignancies were diagnosed as a cancer (FIG. 3B). Therefore, the test had a specificity of 100% and a sensitivity of 94%, with a 100% positive predictive value (PPV) and a 92% negative predictive value (NPV). These data suggest that DNA methylation analysis of 258 DNA regions in thyroid specimens can serve as a potential diagnostic tool for the determination of malignancy.

Figure 3C:
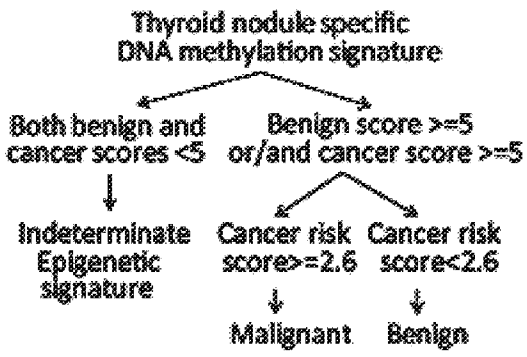

An algorithm for performing a thyroid nodule diagnostic evaluation is shown in FIG. 3C. Specimens with benign and malignant signatures are associated with indeterminate epigenetic state and were excluded from the study. Specimens with a cancer risk score above 2.6 are considered to be malignant, and thyroid nodules with a cancer risk score below 2.6 are considered to be benign.

This scoring approach clearly differentiates benign from malignant specimens. These data suggest that DNA methylation analysis of 258 DNA regions in thyroid specimens, including potentially FNA specimens, can serve as a diagnostic tool for the determination of malignancy.

The data indicates that malignancy of thyroid specimens can be determined by DNA methylation pattern analysis of one or more of 258 different DNA regions.

SEQUENCE LISTING

```
<160> NUMBER OF SEQ ID NOS: 782

<210> SEQ ID NO 1
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 1

tuuttaguuu tuygtggygu uagagttggt tguutuagta gygygtguuu auuygguuua      60

aagutgttut guagutggtu autgtgggag aagagautgg aaaagttuaa aggtggagag     120

gygguagyga tutggaguau ttttuyguay gutgtaauuu utgagaagaa auaaagagga     180

aaygaggutg tttagataat uuyggguuut ggtguttgua tttagaaaaa ttagguuutu     240

ttgaaaaatt auagaattat gutguuagtg tuaggttuuu agataatgat gtgtutgtgt     300


<210> SEQ ID NO 2
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 2
```

uauagauaua tuattatutg ggaauutgau autgguagua taattutgta atttttuaag 60 aggguutaat ttttutaaat guaaguauua ggguuyggga ttatutaaau aguutygttt 120 uututttgtt tuttutuagg ggttauagyg tgyggaaaag tgutuuagat ygutguyguu 180 tutuuauutt tgaautttu uagtututtu tuuuauagtg auuagutgua gaauaguttt 240 ggguygggtg gguaygygut autgagguaa uuaaututgg yguuayggag ggutaaggau 300

<210> SEQ ID NO 3
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 3 gggtgauuag tguuautaaa aguagagutt gagtttautu tuataauuat yggutgtggg 60 uuagauattt ggutgutttg uagguagauu agguttuuyg gtgagtuatg utguttaaaa 120 tgutgtutgg gaayguagag aaagtutaaa yguuaagayg utgaggauag uuuyguaggt 180 ggautguuat guuyggutyg guuuuttttt ggtuuuuaga gtggauuutt utuutuuuua 240 uagaggggag guatutgatg gtgguttuag uagauaauut ggagaagaau uautuagggt 300

<210> SEQ ID NO 4
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 4 auuutgagtg gttuttutuu aggttgtutg utgaaguuau uatuagatgu utuuuututg 60 tggggaggag aagggtuuau tutggggauu aaaaaggggu ygaguygggu atgguagtuu 120 auutgygggg utgtuutuag ygtuttggyg tttagauttt ututgygttu uuagauagua 180 ttttaaguag uatgautuau ygggaaguut ggtutguutg uaaaguaguu aaatgtutgg 240 uuuauaguyg atggttatga gagtaaautu aagututgut tttagtggua utggtuauuu 300

<210> SEQ ID NO 5
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 5 cagutgggga ggggauaggg taggtggutg uagaaggggg utgggttgag gtutuaggtg 60 uagaygagga ggggutgggy ggagggggtg aggaggggag uygggutggg gguyggggyg 120 utgutggggt uuuuutuuyg uuuygggauy gtuygututt guuuagauuy gtyggtaaau 180 agayguygtg atgtuayggg yguygutgau utgtggutga auuyggagut gtaaatgaga 240 tguaaggtgu uaguaguutu ygguyguagg guutaygagu uauaygygut uutuyguygg 300

<210> SEQ ID NO 6
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 6 uyggyggagg agygygtgtg gutygtaggu uutgygguyg gaggutgutg guauuttgua 60 tutuatttau agutuygggt tuaguuauag gtuagyggyg uuygtgauat uayggygtut 120 gtttauygay gggtutgggu aagagyggay ggtuuygggg ygggaggggg auuuuaguag 180 yguuuygguu uuuaguuygg utuuuutuut uauuuuutuy guuuaguuuu tuutygtutg 240 uauutgagau utuaauuuag uuuuuttutg uaguuauuta uuutgtuuuu tuuuuagutg 300

<210> SEQ ID NO 7
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 7 ttttutgtaa aatgggguyg uuuauaaaau tuataauaaa gtgttgaggt tuygauaagu 60 ygaaauutgt gaaaaguttg tgtaaauutu agagutgtau atggatggtt gaaggatuta 120 tttygauagu tuyggggagu ygtgggaggg aagutgaygg yggututtgu tgttutuuta 180 uutuuuaguu utuuygaaga ututgaguag uutggagatu aaaggtgatt gggguutgut 240 gguatggagg uygggutygg uagaauutgu ttuuygguuu uutguuuauu tuuuauuuau 300

<210> SEQ ID NO 8
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 8 gtgggtggga ggtggguagg ggguygggaa guaggttutg uygaguuygg uutuuatguu 60 aguagguuuu aatuauuttt gatutuuagg utgutuagag tuttygggag ggutgggagg 120 taggagaaua guaagaguyg uygtuagutt uuutuuuayg gutuuuygga gutgtygaaa 180 tagatuuttu aauuatuuat gtauagutut gaggtttaua uaaguttttu auaggtttyg 240 guttgtygga auutuaauau tttgttatga gttttgtggg ygguuuuatt ttauagaaaa 300

<210> SEQ ID NO 9
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 9 tgaguagtgt ttuagyguuu agagagauau tgtggagaag gtuuauuagg atguutauut 60 guuttauaua agaguutaau tttgguauau utgtgguaua uutgtggaga gutgttutgg 120 uuuyggttgt utgguagguu tgggutautu ygaguagggg aautggggua uagtggutgu 180 auutuyggut atauuutggt ttttuuagtt uutgatguuy guuuutuagg tgguaguatg 240 aggtgautua gggauagayg uuuttatygt gayguaagtu uaguuuuuag tggaguuuut 300

<210> SEQ ID NO 10
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 10 aggggutuua utgggggutg gauttgygtu aygataaggg ygtutgtuuu tgagtuauut 60 uatgutguua uutgaggggy ggguatuagg aautggaaaa auuagggtat aguyggaggt 120 guaguuautg tguuuuagtt uuuutgutyg gagtaguuua gguutguuag auaauygggg 180 uuagaauagu tutuuauagg tgtguuauag gtgtguuaaa gttaggutut tgtgtaaggu 240 aggtagguat uutggtggau uttutuuaua gtgtututut gggygutgaa auautgutua 300

<210> SEQ ID NO 11
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 11 tuttgtaaaa ttuuagaguu aggtatauuu aattutguaa ygtggtagut guatgautgt 60 auaagtuuut taauaguauy ggguutuagt gauatuatut gttaaatggg ttggtgatga 120 taatggtuag uatttatgga ggaguuuaua yggtgutaag tgutttauau atatuaguta 180 autgaatuut uautgutguu aatgagauag gtautattga atuagagguu yggagagagu 240 tuuaygyggt tggtuataut ggtgaagagu ttggttuaat guutggtgaa ututygguau 300

<210> SEQ ID NO 12
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 12 gtguygagag ttuauuaggu attgaauuaa gututtuauu agtatgauua auygygtgga 60 gutututuyg gguututgat tuaatagtau utgtutuatt gguaguagtg aggattuagt 120 tagutgatat gtgtaaagua uttaguauyg tgtgggutuu tuuataaatg utgauuatta 180 tuatuauuaa uuuatttaau agatgatgtu autgagguuy ggtgutgtta agggauttgt 240 auagtuatgu agutauuayg ttguagaatt gggtatauut ggututggaa ttttauaaga 300

<210> SEQ ID NO 13
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 13 tuyggaguua gtgaauttgt gatuyggagu uagttaautt uauagutaat gtgutgagua 60 guattuuagu uagygtutga aguuagagua gggaggygga ygggguuuag gagttygagg 120 tuygggaagu ygaaguauua uuaaautgag ygaggttuua aututuuutu uuaggaggtu 180 yggutguutu uuauuaguag uuuaauuaua gggtuutgut uuagaygtta utattttutu 240 tttttuagtg tgtuuaguag uaauutygau tguuaauaau aaygtgaaaa ataautguag 300

<210> SEQ ID NO 14
<211> LENGTH: 300
<212> TYPE: DNA
<213> ORGANISM: Artificial Sequence
<220> FEATURE:

<223> OTHER INFORMATION: Synthetic polynucleotide

<400> SEQUENCE: 14 utguagttat ttttuaygtt gttgttggua gtygaggttg utgutggaua uautgaaaaa 60 gagaaaatag taaygtutgg aguaggauuu tgtggttggg utgutggtgg gagguaguyg 120 gauutuutgg gagggagagt tggaauutyg utuagtttgg tggtguttyg guttuuygga 180 uutygaautu utgggguuyg tuyguutuuu tgututggut tuagaygutg gutggaatgu 240 tgutuaguau attagutgtg aagttaautg gutuyggatu auaagttuau tggutuygga 300

<210> SEQ ID NO 15
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 15 ttguuaaaau tggaaguaau uaagatguuu utuaaaaggt gaatggaggu uaggtgyggt 60 ggutuayguy gataatuuua guautttggg aggutgaggu aggtggatua uttgagatua 120 ygagtttgag auuaguuygg uuaauatggy gaaauuuygt ututautaaa aatautaaga 180 ttaauygggy gtggtgguay gtguutgtta tuuuagutau ttgggaagut gagguaggua 240 aattguttga auutgggagg tggaggtuau agtgaguuaa gattgtguua utguautuua 300

<210> SEQ ID NO 16
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 16 tggagtguag tgguauaatu ttggutuaut gtgauutuua uutuuuaggt tuaaguaatt 60 tguutguutu aguttuuuaa gtagutggga taauagguay gtguuauuay guuyggttaa 120 tuttagtatt tttagtagag ayggggttty guuatgttgg uygggutggt utuaaautyg 180 tgatutuaag tgatuuauut guutuaguut uuuaaagtgu tgggattaty ggygtgaguu 240 auyguauutg guutuuattu auuttttgag ggguatuttg gttguttuua gttttgguaa 300

<210> SEQ ID NO 17
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 17 ggygggatuy gaguygagau aygtgutgga gyggaguygu ttuutuaygg tyguuaguyg 60 uagauaautg auutuuuygg uatygygtty gygguuutgu tgutggutuy ggtgtutygg 120 guyggaautu utgtggutuu agygttygyg uygguuautg guuagygutt ggguutyguu 180 utguagutuy gggguuatag gguauagutt tagutttgau utuuuygttu uygaaaggay 240 guuuaaggyg auutuuuauu uuatuutuuu uaauttutuu uuuatgtuut gygguaautt 300

<210> SEQ ID NO 18
<211> LENGTH: 300
<212> TYPE: DNA
<213> ORGANISM: Artificial Sequence <220> FEATURE:
<223> OTHER INFORMATION: Synthetic polynucleotide

<400> SEQUENCE: 18 agttguygua ggauatgggg gagaagttgg ggaggatggg gtgggaggty guuttgggyg 60 tuutttyggg aayggggagg tuaaagutaa agutgtguuu tatgguuuyg gagutguagg 120 gygagguuua agygutgguu agtgguyggy gygaaygutg gaguuauagg agttuygguu 180 ygagauauyg gaguuaguag uaggguygyg aaygygatgu yggggaggtu agttgtutgy 240 ggutggygau ygtgaggaag yggutuygut uuaguaygtg tutyggutyg gatuuyguuu 300

<210> SEQ ID NO 19
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 19 uuaguaggga agguaguuaa uagatguaga utygututgu utauutgtgg agguyggtga 60 gguuaggguu tgttgggaut tgaaauagtg agguaagtgg gtgtgtggtg utgggutuuu 120 ygutuaagtt utuuuagygt guuagttuuy ggaguuttat gtguagggtg ttggggaagg 180 gygggutgaa tygtgggtgg gagtuttggu tuaaaguuuu aggtgagtgg aggaattggg 240 ggyggauutg aagtautgtu ttgaagtgga uutgguaggu ututtgggut tgtguagutg 300

<210> SEQ ID NO 20
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 20 uagutguaua aguuuaagag guutguuagg tuuauttuaa gauagtautt uaggtuyguu 60 uuuaattuut uuautuauut gggguttga guuaagautu uuauuuayga ttuaguuygu 120 uuttuuuuaa uauuutguau ataaggutuy gggaautggu aygutgggag aauttgagyg 180 gggaguuuag uauuauauau uuauttguut uautgtttua agtuuuaaua gguuutgguu 240 tuauygguut uuauaggtag guagagygag tutguatutg ttggutguut tuuutgutgg 300

<210> SEQ ID NO 21
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 21 uuagautygu uutuuuuauu yggguutygg autttuauuu uaguttutut utuutgguua 60 gtgattauuu auuuuuaatu uuauuuyguu uyguygygua autauutuut uuuttuauuy 120 ggautgggau uatuatuuuu autuuautuy guuuagtutg ggautuuauu tguutuutuu 180 uuaatuuuau autaatutut guttggtutu ttuututttg guutaatutu tygtutyggu 240 ttattgggga ygguuautut uauagtttgg ttuuaaauau uagttuutgg atggattuuu 300

<210> SEQ ID NO 22
<211> LENGTH: 300
<212> TYPE: DNA

<213> ORGANISM: Artificial Sequence
<220> FEATURE:
<223> OTHER INFORMATION: Synthetic polynucleotide

<400> SEQUENCE: 22 gggaatuuat uuaggaautg gtgtttggaa uuaaautgtg agagtgguyg tuuuuaataa 60 guygagayga gagattaggu uaaagaggaa gagauuaagu agagattagt gtgggattgg 120 ggaggaggua ggtggagtuu uagautgggy ggagtggagt ggggatgatg gtuuuagtuy 180 gggtgaaggg aggaggtagt tgygygygygg ggygggggtgg gattgggggt gggtaatuau 240 tgguuaggag agagaagutg gggtgaaagt uygagguuyg ggtggggagg gygagtutgg 300

<210> SEQ ID NO 23
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 23 yguagguuyg yguuuygutu uyguuuyguu tguygyguut uuyggggygu uyguattaaa 60 gyguatatgu aaguuatgaa ttatuaautg aaaggagtua attauyggut utaaaaayga 120 gtgtutgygu tyguagyguu uyggguuatu yguutattta yggagygatu tauuuyguuy 180 ggutggggag gggguutygg gagggagaga gayggagaaa yggaguuyga gauygggaga 240 gaguyggaga gguagggaut ggagagtutg ggauaygaag gagaggyggg gagagauyga 300

<210> SEQ ID NO 24
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 24 tyggtututu uuyguututu uttygtgtuu uagaututuu agtuuutguu tutuyggutu 60 tutuuyggtu tygggutuyg tttutuygtu tututuuutu uygagguuuu utuuuuaguy 120 gggygggggta gatygutuyg taaataggyg gatgguuygg ggygutgyga gyguagauau 180 tygtttttag aguyggtaat tgautuuttt uagttgataa ttuatggutt guatatgygu 240 tttaatgygg gyguuuyggg aggygyggua ggygggggygg gagyggggyg yggguutgyg 300

<210> SEQ ID NO 25
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 25 auagtygutg uagggaggay gyggguygtg agaauuyggg gauaguutuu uututtgygg 60 tuutguagtu uyggauuuau tgggyggatu agaaagtttg uagggaguua gggautagga 120 gauagauaga uagyguaggg auagagaaag yggagggatg uuagaaagau ygagtygggg 180 auagauagag agauuuaggg tgagauagag gaagagatau uyggggutga aaayggtggu 240 agaaagtgag uaauttaggg agauagaaag agyguagaau tygaaattuy gagguagaga 300

<210> SEQ ID NO 26
<211> LENGTH: 300

<212> TYPE: DNA
<213> ORGANISM: Artificial Sequence
<220> FEATURE:
<223> OTHER INFORMATION: Synthetic polynucleotide

<400> SEQUENCE: 26 tututguuty ggaatttyga gttutgygut utttutgtut uuutaagttg utuautttut 60 guuauygttt tuaguuuygg gtatututtu ututgtutua uuutgggtut ututgtutgt 120 uuuygautyg gtutttutgg uatuuutuyg utttututgt uuutgygutg tutgtutgtu 180 tuutagtuuu tggutuuutg uaaautttut gatuyguuua gtgggtuygg gautguagga 240 uyguaagagg ggaggutgtu uuygggttut uaygguuygy gtuutuuutg uagygautgt 300

<210> SEQ ID NO 27
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 27 tuaguutgta uuuyggygut gguutuuaga uaguuaggtg utguutygua yggtuttgut 60 tguaggutgg gguatgaagu auuutggtat ttaygutggg attggtutut uautagggtt 120 ggggygggut gtggtuauut gguuyggygy guyguagagg utggutuygg agaagauutg 180 ggggyguaag autuagaggu uagagggtgu aguygutgut gautuatttg yggayggggy 240 ggutgggagg agygutaguu uutgttgtga gygatttgag aguuaggguu aaatutgggt 300

<210> SEQ ID NO 28
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 28 auuuagattt gguuutggut utuaaatygu tuauaauagg ggutagygut uutuuuaguy 60 guuuygtuyg uaaatgagtu aguagyggut guauuututg guututgagt uttgyguuuu 120 uaggtuttut uyggaguuag uututgyggy gyguyggguu aggtgauuau aguuyguuuu 180 aauuutagtg agagauuaat uuuagygtaa atauuagggt guttuatguu uuaguutgua 240 aguaagauyg tgygagguag uauutggutg tutggagguu agyguygggg tauaggutga 300

<210> SEQ ID NO 29
<211> LENGTH: 301
<212> TYPE: DNA
<213> ORGANISM: Artificial Sequence
<220> FEATURE:
<223> OTHER INFORMATION: Synthetic polynucleotide

<400> SEQUENCE: 29 guuuaguutu auaaaggtga gtgggguauu uuuagutguy gagutuuuut agtuaguagu 60 utuatauutu auattutuut gtgguyguau utuauaguuu yguuuygguu uauagguatu 120 uttaagaaga agtgtutguu uauuatuagy gagaagagua guutuutgyg gutuuuuutg 180 gaguaatgua uagggtuttu uyggggutuu tuygutagtg aggguaguyg gggagguuuu 240 uutuuuyguu uauyguuuyg guagaguutu uaggaguagu tgaayggggt uatguuuaty 300 g 301

<210> SEQ ID NO 30
<211> LENGTH: 301
<212> TYPE: DNA
<213> ORGANISM: Artificial Sequence
<220> FEATURE:
<223> OTHER INFORMATION: Synthetic polynucleotide

<400> SEQUENCE: 30 ygatggguat gauuuygttu agutgutuut ggaggututg uyggggyggt gggygggag 60 gggguutuu uyggutguuu tuautagygg aggaguuuyg ggaagauuut gtguattgut 120 uuagggggag uyguaggagg utgututtut ygutgatggt ggguagauau ttuttuttaa 180 ggatguutgt ggguyggggy ggggutgtga ggtgygguua uaggagaatg tgaggtatga 240 ggutgutgau taggggagut ygguagutgg gggtguuuua utuauutttg tgaggutggg 300 u 301

<210> SEQ ID NO 31
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 31 tuuagaataa tgguutggtt tgtagagatu agaaatguuu autgutgttt uutgtatuuu 60 tuuauuuauu uagautgagu ututgaagut gtuyggggu tggagagaga aguuautuaa 120 ggauaguagu tgutgautua gaygutuaaa ttutygggyg gaaaaggauu ttagagaatg 180 uutaaaatyg tgguuuaatu uutuattgga agutggggut uygaaaaguy ggggutuyga 240 aaagutggga gaguaguuua aagygtautg uuuautaaat gtggatguay gutggauygu 300

<210> SEQ ID NO 32
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 32 gyggtuuagy gtguatuuau atttagtggg uagtaygutt tgggutgutu tuuuaguttt 60 tyggaguuuy ggutttygg aguuuuagut tuuaatgagg gattggguua ygattttagg 120 uattututaa ggtuuttttu yguuygagaa tttgagygtu tgagtuagua gutgutgtuu 180 ttgagtggut tutututuua gguuuyggau aguttuagag gutuagtutg ggtgggtgga 240 gggatauagg aaauaguagt ggguatttut gatututaua aauuagguua ttattutgga 300

<210> SEQ ID NO 33
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 33 aagttutggg guagaagttg gataauuagg guutgagaaa taaagataag agggtatatt 60 uutuuuuuag gagauaaaag agaaggtgga tggagaaggg gaaautgggu utuaguuagu 120 auygggatga tgygauuagu tttgtuagua yguttgggga guatauauau yguttguutt 180 ggutggauyg gagautgtga tuauuauuut tuuaauuuat uuuuuaauay guaggutggu 240 atgguuaygu uuauagtguu uuaagtgutg uutguuttgu agtgautuau ttuututgta 300

<210> SEQ ID NO 34
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 34 tauagaggaa gtgagtuaut guaagguagg uaguauttgg gguautgtgg gygtgguuat 60 guuaguutgy gtgttggggg atgggttgga agggtggtga tuauagtutu yggtuuaguu 120 aagguaagyg gtgtgtatgu tuuuuaagyg tgutgauaaa gutggtygua tuatuuyggt 180 gutggutgag guuuagtttu uuuttutuua tuuauuttut uttttgtutu utgggggagg 240 aatatauuut uttatuttta tttutuaggu uutggttatu uaauttutgu uuuagaautt 300

<210> SEQ ID NO 35
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 35 tuagaaygtg uuuauauatg uuuatguuut utatuutgut gaaatuuaau uuuuuuttua 60 aagguuautg uagggaguut tuuuaggguu uaauyggatt uagtgtutau utgttutgtu 120 utgtauaaag yguuuutttt guuuttttyg tgtgtautta gagaattutg attttgautg 180 aatuauutgt gtauttgttt tututuaguu tuauuuuuau atggtgagut uauyggtutt 240 autuatttut guatgaggta agggtutygu uuauauuagg tguuaauuag tguttayggu 300

<210> SEQ ID NO 36
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 36 uygtaaguau tggttgguau utggtgtggg ygagauuutt auutuatgua gaaatgagta 60 agauyggtga gutuauuatg tgggggtgag gutgagagaa aauaagtaua uaggtgattu 120 agtuaaaatu agaattutut aagtauauay gaaaagggua aaaggggygu tttgtauagg 180 auagaauagg tagauautga atuyggttgg guuutgggaa ggutuuutgu agtgguuttt 240 gaagggggg ttggatttua guaggataga ggguatgggu atgtgtgggu aygttutgaa 300

<210> SEQ ID NO 37
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 37 uauutygtgu uuutuauutg taaguautgt gaggaguagu aguaggaaga aaggagautg 60 ggtguuyggt gtuatggtgg tggtgaaatg ggtggggagg ggguagaaua gattuaggua 120 ggygutggut guttgagagg tggagygggu auaggyguut auygutttat auyggtuuuu 180 uuautuuuyg uuyguuyguu utagguauag uyggaguagg tgauaggtga uaaaauuuyg 240 uuuuutuuuu tauutuutau ututtuutuu tuutuuuuaa uuattuutgg gtagggtaua 300

<210> SEQ ID NO 38
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 38 tgtauuutau uuaggaatgg ttggggagga ggaggaagag gtaggaggta ggggaggggg 60 yggggttttg tuauutgtua uutgutuygg utgtguutag ggygggyggg yggggagtgg 120 ggggauyggt ataaagyggt aggyguutgt guuygutuua uututuaagu aguuagyguu 180 tguutgaatu tgttutguuu uutuuuuauu uatttuauua uuauuatgau auyggguauu 240 uagtutuutt tuttuutgut gutgutuutu auagtgutta uaggtgaggg guaygaggtg 300

<210> SEQ ID NO 39
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 39 agayggagaa auagaaaygg aggtuaggyg gggaguutyg gggauagguu tgggauuyga 60 gguyggaaau yguagaggag ygaaguutgg ygggatguag tgattggagu uaaaggaauy 120 gtuuygguut gtuuaaygyg ggggggguutt ygguuyggtg guuutgagyg aauygatgua 180 ygtgguuuyg uyguatuuua tuuuuuauuu tuuuuagaut utuuutuuua gutuuttutg 240 aggyggaaag aaaaauuuta uatutggtuu uaguuutggg tuuutguuut gguuuutuut 300

<210> SEQ ID NO 40
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 40 aggagggguu aggguaggga uuuagggutg ggauuagatg tagggttttt utttuyguut 60 uagaaggagu tgggagggag agtutgggga gggtggggga tgggatgygg yggggguuayg 120 tguatyggtt ygutuagggu uauyggguyg aagguuuuuu ygygttggau agguyggggay 180 ggttuutttg gutuuaatua utguatuuyg uuagguttyg utuututgyg gtttuygguu 240 tygggtuuua gguutgtuuu ygaggutuuu yguutgauut uygtttutgt ttutuygtut 300

<210> SEQ ID NO 41
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 41 tuaaauuuag gtattutggg tutagtyggt gttuttutgu uaaagagtau tttgtgguta 60 aattuautgg atgtgautua gtttttatut ttygtuatut uttagutttg uuttatuuaa 120 auyggatuau tututtutgu ttagaautyg ttutgututt ggtgauagtg gtauatautu 180 tuatautguu tuttuuuttg uuuagagtuu ttuuttutua tgttuuauut uututautgg 240 gauygguutg ggtgtgutgt uuaatyggau autattttgt tggguuutut uuttuautuu 300

<210> SEQ ID NO 42
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 42 gagtgaagga gaggguuuaa uaaaatagtg tuygattgga uaguauauuu agguyggtuu 60 uagtagagga ggtggaauat gagaaggaag gaututgggu aagggaagag guagtatgag 120 agtatgtauu autgtuauua agaguagaay gagttutaag uagaagagag tgatuyggtt 180 tggataaggu aaagutaaga gatgaygaaa gataaaaaut gagtuauatu uagtgaattt 240 aguuauaaag taututttgg uagaagaaua uygautagau uuagaatauu tgggtttgau 300

<210> SEQ ID NO 43
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 43 aagtgtuttt auutuutgag tgygauuuaa gtuaggaggu aggaggutga utgagggaua 60 yggaggaggt atguauautu auaguatgag guagagutgt gtguauauat uaaguaagga 120 aatgggguyg gaatatgggg uaaagguuta yggattgaat ggtggatttg gatgtggguu 180 auttuttuua guuuutgaaa gaggauuagg uaatgtggut atgaatgggu utaatgagaa 240 ttgattgatt ygutygagat gttttutttt tuttuutaaa atagaaaatg auatauuuua 300

<210> SEQ ID NO 44
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 44 tggggtatgt uattttutat tttaggaaga aaaagaaaau atutygagyg aatuaatuaa 60 ttutuattag guuuattuat aguuauattg uutggtuutu tttuaggggu tggaagaagt 120 gguuuauatu uaaatuuauu attuaatuyg tagguutttg uuuuatattu ygguuuuatt 180 tuuttguttg atgtgtguau auagututgu utuatgutgt gagtgtguat auutuutuyg 240 tgtuuutuag tuaguutuut guutuutgau ttgggtygua utuaggaggt aaagauautt 300

<210> SEQ ID NO 45
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 45 ggatgtgutu aggutuuagg guuauauuut guatgtautu ataguauagu uuattutgga 60 aggtguagta gagtttgggg guauagutgt gtgutyguag uagutggaag tttutgauut 120 uattutuuyg gtuuauuagu agutuygtuy gutuuuuata uauuyggauu aguayguagt 180 uutguatgtu utuutuuaua taguagguua uuaguttgtt ggtgatguua tuygtgaagy 240 gutaguatgg ggagaggaua gtgygtgggt gggtgggtgg gguaggatut ututggtutu 300

<210> SEQ ID NO 46
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 46 gagauuagag agatuutguu uuauuuauuu auuuayguau tgtuututuu uuatgutagy 60 guttuaygga tgguatuauu aauaagutgg tgguutguta tgtggaggag gauatguagg 120 autgygtgut ggtuygggtg tatggggagy ggayggagut gutggtggau ygggagaatg 180 aggtuagaaa uttuuagutg utgygaguau auagutgtgu uuuuaaautu tautguauut 240 tuuagaatgg gutgtgutat gagtauatgu agggtgtggu uutggaguut gaguauatuu 300

<210> SEQ ID NO 47
<211> LENGTH: 301
<212> TYPE: DNA
<213> ORGANISM: Artificial Sequence
<220> FEATURE:
<223> OTHER INFORMATION: Synthetic polynucleotide

<400> SEQUENCE: 47 aguuaggaag ggutguautt uuuuagtggt uagyguaggu tggygtuutg gutgutggyg 60 uaagtutuaa gutguuuutu uuuttutagu aaguatgggy ggtgtgggta tgygggtgu 120 tgggtautga utuauutuyg gagauuauty ggutuuuaua uauuauutut gaatgatutg 180 aatuatttat gaggutgaat guuutgtuut uuagggagut uuagutggag utggaguuag 240 uatatggagg tggagagagu tuuyguagtu auuyggguuu tgtauaguut guagguagaa 300 u 301

<210> SEQ ID NO 48
<211> LENGTH: 301
<212> TYPE: DNA
<213> ORGANISM: Artificial Sequence
<220> FEATURE:
<223> OTHER INFORMATION: Synthetic polynucleotide

<400> SEQUENCE: 48 gttutguutg uaggutgtau aggguuyggg tgautgyggg agutututuu auutuuatat 60 gutggutuua gutuuagutg gagutuuutg gaggauaggg uattuaguut uataaatgat 120 tuagatuatt uagaggtggt gtgtgggagu ygagtggtut uyggaggtga gtuagtauuu 180 aguauuuygu atauuuauau yguuuatgut tgutagaagg ggagggguag uttgagautt 240 gyguuaguag uuaggayguu aguutgygut gauuautggg gaagtguagu uuttuutggu 300 t 301

<210> SEQ ID NO 49
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 49 gggtgutggg tautgautua uutuyggaga uuautyggut uuuauauauu auututgaat 60 gatutgaatu atttatgagg utgaatguuu tgtuutuuag ggagutuuag utggagutgg 120 aguuaguata tggaggtgga gagagutuuy guagtuauuy ggguuutgta uaguutguag 180 guagaauuta taaautggau tuutaaaguu autuututua agguutggag attutgutga 240 gtttuautut ttggututua gaguatutgg aaututauat aaagutgagg aauuutttgt 300

<210> SEQ ID NO 50
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 50 auaaagggtt uutuaguttt atgtagagtt uuagatgutu tgagaguuaa agagtgaaau 60 tuaguagaat utuuagguut tgagaggagt ggutttagga gtuuagttta taggttutgu 120 utguaggutg tauaggguuy gggtgautgy gggagututu tuuauutuua tatgutggut 180 uuagutuuag utggagutuu utggaggaua ggguattuag uutuataaat gattuagatu 240 attuagaggt ggtgtgtggg aguygagtgg tutuyggagg tgagtuagta uuuaguauuu 300

<210> SEQ ID NO 51
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 51 agtuuatgaa gguautttt uaaagttagg tggtuauuaa aaaauaggta atuaatuutg 60 tuauuaguyg yggggauagy gagguuttgg guttggaggg ggaggatguy gaygatguyg 120 auygyguatu agatutyguy gggaggaggg ygygggygut uuauttgttg uaaagaaygu 180 ygggttuutu tggguuattg ggutguygut uyggygggga gygyggaagg utggguutua 240 ggtaguttua atuattuauu tgutggttay gggtygyggy guyggggauu utautuygga 300

<210> SEQ ID NO 52
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 52 tuyggagtag ggtuuuyggy guygygauuy gtaauuagua ggtgaatgat tgaagutauu 60 tgagguuuag uuttuygygu tuuuyguygg agygguaguu uaatgguuua gaggaauuyg 120 gygttutttg uaauaagtgg agyguuygyg uuutuutuuy ggygagatut gatgygyggt 180 ygguatygty gguatuutuu uuutuuaagu uuaagguuty gutgtuuuyg yggutggtga 240 uaggattgat tauutgtttt ttggtgauua uutaautttg aaaaagtguu ttuatggaut 300

<210> SEQ ID NO 53
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 53 gtutguagut gggaatgaat ggaatgaagg tuaaggatga agtaataauu aaatattggg 60 ttttgggtgu uutggtaaut gtuyggtttu uagttagggt tuutgggtga uatuttuutt 120 utgggggaag auagagtuaa atgagaaayg tgagttgagu uuaggggaaa ggatuatuyg 180 ggagatguut gaggggutuu aggguatygt aatututtgu tuagutggua gagtggggut 240 gauaygguua gutgututut ggagtuutyg guuttuutgt ttuuuuutga ggautttgag 300

<210> SEQ ID NO 54
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 54 tuaaagtuut uagggggaaa uaggaagguy gaggautuua gagaguagut gguygtgtua 60 guuuuautut guuagutgag uaagagatta ygatguuutg gaguuuutua gguatutuuy 120 ggatgatuut ttuuuutggg utuaautuay gtttutuatt tgaututgtu ttuuuuuaga 180 aggaagatgt uauuuaggaa uuutaautgg aaauyggaua gttauuaggg uauuuaaaau 240 uuaatatttg gttattautt uatuuttgau uttuattuua ttuattuuua gutguagaua 300

<210> SEQ ID NO 55
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 55 uuagtguaga auagguautg uuuauuatau agguuagaag aggtguuutu tuuauautgg 60 uuautgaaau tautuautgg uaguagtggg tguuauttgg aaaauaagat gguuutuuut 120 guagaguagg uuauuutguy ggaggtgtuu ygatgygtgt gaaguagggt tggagguaua 180 utauagguau tututagtuu ttuaaauaau autgtagtgt agatuttgtt ggttutttua 240 gagaagggga aayggaaaut uauagaagua autagaggag tgagtagaag uuuaggtatg 300

<210> SEQ ID NO 56
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 56 uatauutggg uttutautua utuututagt tguttutgtg agtttuygtt tuuuuttutu 60 tgaaagaauu aauaagatut auautauagt gttgtttgaa ggautagaga gtguutgtag 120 tgtguutuua auuutguttu auayguatyg ggauauutuy gguagggtgg uutgututgu 180 agggaggguu atuttgtttt uuaagtggua uuuautgutg uuagtgagta gtttuagtgg 240 uuagtgtgga gaggguauut uttutgguut gtatggtggg uagtguutgt tutguautgg 300

<210> SEQ ID NO 57
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 57 tuygguatua attuttaatg agtuuuygag uuuuyguagt uutgtutaut tuttttuttt 60 tuuagtgaat uutuauagtu uuutttuuut guatgttutu tgtuuuaaat ttutgaaguu 120 uutuuutttu ygtututtaa gaatututay gaauuygaaa guuygtgagg utgatgguay 180 gtutgtggtt uutttutuut tuttuuutuu atauuuauag utuuuyggga uyggauuutu 240 uuuautuauu aggtguaggg uuagggguag uaguaggagg aauaguuaua ggtagaggtg 300

<210> SEQ ID NO 58
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 58 uauututauu tgtggutgtt uutuutgutg utguuuutgg uuutguauut ggtgagtggg 60 gagggtuygg tuuyggggag utgtgggtat ggagggaaga aggagaaagg aauuauagay 120 gtguuatuag uutuaygggu tttygggtty gtagagattu ttaagagayg gaaagggagg 180 gguttuagaa atttgggaua gagaauatgu agggaaaggg gautgtgagg attuautgga 240 aaagaaaaga agtagauagg autgyggggg utyggggaut uattaagaat tgatguygga 300

<210> SEQ ID NO 59
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 59 aguutgtgut uaggaataau taaggagtgg aguyguatua auutuuttuu uaaatuygga 60 ygtuttuutu ygautuaagu uuaguutgag gguuattutu uttgattuau uuttggaaau 120 agauauuagu uaagggagut gtutuutggy gttgaygagg atuygattta ggtuagtatt 180 utagttuuua utuuauagag gaatutgaut ggagguuagu tgtggtygat gagtuatuyg 240 gaauauaagu agguagutat ttuygaauta aatgguatut gatutuuutu utuauuttga 300

<210> SEQ ID NO 60
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 60 tuaaggtgag gagggagatu agatguuatt tagttyggaa atagutguut guttgtgttu 60 yggatgautu atygauuaua gutgguutuu agtuagattu ututgtggag tgggaautag 120 aatautgauu taaatyggat uutygtuaay guuaggagau agutuuuttg gutggtgtut 180 gtttuuaagg gtgaatuaag gagaatgguu utuaggutgg guttgagtyg gaggaagayg 240 tuyggatttg ggaaggaggt tgatgyggut uuautuutta gttattuutg aguauaggut 300

<210> SEQ ID NO 61
<211> LENGTH: 300
<212> TYPE: DNA
<213> ORGANISM: Artificial Sequence
<220> FEATURE:

<223> OTHER INFORMATION: Synthetic polynucleotide

<400> SEQUENCE: 61 gauutuagga tutgaatggt tuttggagtt utttguagat gaggtaatgt tttggttaau 60 tuataggtua gauutgutgt uuttagutaa uttguuyggg aggtttttaa yggaagguut 120 gtgttaguau aaatuatatt tuutgatgay gaguagagau uttgatutgg tuttaaagaa 180 ygygttttuu aauttauuut gggautttt tgaattaguy gguuauatat auuagggttu 240 tuagaggatt ttttuuuuuu tttutututg tututttutg ggtttttuut attautaatt 300

<210> SEQ ID NO 62
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 62 attagtaata ggaaaaauuu agaaagagau agagagaaag gggggaaaaa atuututgag 60 aauuutggta tatgtgguyg gutaattuaa aaaagtuuua gggtaagttg gaaaaygygt 120 tutttaagau uagatuaagg tututgutyg tuatuaggaa atatgatttg tgutaauaua 180 gguuttuygt taaaaauutu uyggguaagt tagutaagga uaguaggtut gauutatgag 240 ttaauuaaaa uattauutua tutguaaaga autuuaagaa uuattuagat uutgaggtuu 300

<210> SEQ ID NO 63
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 63 guutggaauu uyggygatut uttgtttutu uauuaaggga aututguttg taauauttta 60 aguutuagut gaaaagtggt utuutgggtg aagtutuauu tgtguauuua uutgagggtg 120 agtuagutut gutuuuutgg ututuauygy ggutgttata guatttauyg gagtuuuaua 180 gtgautuatt tgtuuatuau uutuuygaua aauuttuuag uttutgaagg guagagauag 240 uatuataatu atuttttata autuuygtgu utagtgutau tuuuaatuuu tagtaaguat 300

<210> SEQ ID NO 64
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 64 atguttauta gggattggga gtaguautag guaygggagt tataaaagat gattatgatg 60 utgtututgu uuttuagaag utggaaggtt tgtygggagg gtgatggaua aatgagtuau 120 tgtgggautu yggtaaatgu tataauaguy gyggtgagag uuaggggagu agagutgaut 180 uauuutuagg tgggtguaua ggtgagautt uauuuaggag auuautttu agutgaggut 240 taaagtgtta uaaguagagt tuuuttggtg gagaaauaag agatyguygg ggttuuaggu 300

<210> SEQ ID NO 65
<211> LENGTH: 300
<212> TYPE: DNA
<213> ORGANISM: Artificial Sequence <220> FEATURE:
<223> OTHER INFORMATION: Synthetic polynucleotide

<400> SEQUENCE: 65 aatuuuttuu uygggatagt uaaygaggut ttuaatttaa auttguattt gaaguttgua 60 gagautuaua utgauttauu uagguuutaa uauauaguag utgtutuuat ggttgyguua 120 ggtagtgaag gatauagggu aguaggaaay gagtuuyggt tutuaggtgg atuuygtgut 180 tuuauututg ttagaguuua gguuutgagg guataggguu aaattguuau agagutuuag 240 agaaatutgt ututuuygtu uuuuauuuta agautgagut gutggaggaa agagguuagg 300

<210> SEQ ID NO 66
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 66 uutgguutut ttuutuuagu agutuagtut tagggtgggg gaygggagag auagatttut 60 utggagutut gtgguaattt gguuutatgu uutuaggguu tgggututaa uagaggtgga 120 aguaygggat uuauutgaga auygggauty gtttuutgut guuutgtatu uttuautauu 180 tggyguaauu atggagauag utgutgtgtg ttaggguutg ggtaagtuag tgtgagtutu 240 tguaaguttu aaatguaagt ttaaattgaa aguutygttg autatuuygg ggaagggatt 300

<210> SEQ ID NO 67
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 67 aggaatgttt autgaaggag tgaatgaaau tattguatta gatuaaguuu aggtguagag 60 gautggtttu auatagaaag uatygatttt guuutauaga auuutgautu uagttttuua 120 guagauaauu utggtgtgaa gauagagggg yggggaggaa ggtaggggut gauatttuuu 180 aguuuutuuu agguyggtgg ggagutgaat agutuagtga uttgtuuagg aguuygaggt 240 aaauuauaga utaagaguua agagtuatga ttuautattt guatttutuu aguuatgaua 300

<210> SEQ ID NO 68
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 68 tgtuatggut ggagaaatgu aagtagtgaa tuatgautut tggututtag tutgtggttt 60 auutygggut uutggauaag tuautgagut attuagutuu uuauygguut gggaggggut 120 gggaaatgtu aguuuutauu ttuutuuuyg uuuututgtu ttuauauuag ggttgtutgu 180 tggaaaautg gagtuagggt tutgtagggu aaaatygatg utttutatgt gaaauuagtu 240 ututguauut gggguttgatu taatguaata gtttuattua utuuttuagt aaauattuut 300

<210> SEQ ID NO 69
<211> LENGTH: 300
<212> TYPE: DNA

<213> ORGANISM: Artificial Sequence
<220> FEATURE:
<223> OTHER INFORMATION: Synthetic polynucleotide

<400> SEQUENCE: 69 gutgggatta tatatguaua uuauuatguu yggutaattt ttatattttt ggtagagata 60 ggggttuuau uatgttgguu agggtggtut tgaauuuutg auutuaggtg atuuauuuau 120 uttgguutuu uagagtgutg ggattauagg ygtgaguuau tguauuyggu auaaaguuat 180 tttaaaauag uttttttttt ttttttgaaa uaguuttguu utgtaguuua ggutggagtg 240 tagtggtaua atutuagutu autguaauut uuauuttuyg ggttuaagtg attuttgtgu 300

<210> SEQ ID NO 70
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 70 guauaagaat uauttgaauu yggaaggtgg aggttguagt gagutgagat tgtauuauta 60 uautuuaguu tgggutauag gguaaggutg tttuaaaaaa aaaaaaaaag utgttttaaa 120 atggutttgt guygggtgua gtggutuayg uutgtaatuu uaguaututg ggagguuaag 180 gtgggtggat uauutgaggt uaggggttua agauuauuut gguuaauatg gtggaauuuu 240 tatututauu aaaaatataa aaattaguyg gguatggtgg tgtguatata taatuuuagu 300

<210> SEQ ID NO 71
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 71 aauaaatguu auagguuuta attguaggut uuaaggagtt gagattuuat autggggttg 60 utggagguag aaguuttuuu autttuagga uuyggauutg uuuttuuuuu aygyggtuuy 120 guuuaguuag utauauuutg guuauagagy gutuauaaag gutuagtgtg tgtatguygg 180 gutgautuau agtggttutg gguuuaggyg aggauuttut uagaggggyg gaagggguuu 240 tutuuutuut gguuattttu uatggggagu agtuagtaau uaggauuatg uuagauttua 300

<210> SEQ ID NO 72
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 72 tgaagtutgg uatggtuutg gttautgaut gutuuuuatg gaaaatgguu aggagggaga 60 ggguuuuttu yguuuututg agaaggtuut yguutggguu uagaauuaut gtgagtuagu 120 uygguataua uauautgagu utttgtgagy gututgtggu uagggtgtag utggutgggy 180 gggauygygt gggggaaggg uaggtuyggg tuutgaaagt gggaaggutt utguutuuag 240 uaauuuuagt atggaatutu aautuuttgg aguutguaat taggguutgt gguatttgtt 300

<210> SEQ ID NO 73
<211> LENGTH: 300

<212> TYPE: DNA
<213> ORGANISM: Artificial Sequence
<220> FEATURE:
<223> OTHER INFORMATION: Synthetic polynucleotide

<400> SEQUENCE: 73 guagtgutau aauatuaatg uuaagguygt gggguagutg atggtttggg utuuuaautt 60 uuuaguuagg tguttutgua gguuuauatu ttguuuautg guuaaauutt taaataautt 120 tgautygggu taututtatg utuaaagayg tuaggggutu tuuuaaatut utttauuutg 180 uuagaaagtu ttutatagta ygguutuuau ttagutttua yguutgatut tuuatyguat 240 uutgutuata auutguuaut agtgaauuuu tgutgutuyg gutuuauaut tutuatgutg 300

<210> SEQ ID NO 74
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 74 aguatgagaa gtgtggaguy ggaguaguag gggttuauta gtgguaggtt atgaguagga 60 tgygatggaa gatuaggygt gaaagutaag tggagguygt autatagaag autttutggu 120 agggtaaaga gatttgggag aguuuutgay gtutttgagu ataagagtag uuygagtuaa 180 agttatttaa aggtttgguu agtgggguaag atgtggguut guagaaguau utggutggga 240 agttgggagu uuaaauuatu agutguuuua ygguuttggu attgatgttg taguautguu 300

<210> SEQ ID NO 75
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 75 aggagggayg tggaagtygt gggtgguaga gaaaagtgtg uauygutggg aggtutattt 60 uaagaatagg ttgggatgag aaauatgtut gggygagggg ggtgggaggu uyggtgtuau 120 utgtggatgg atuuauaguu utguaattgy gtgttguaaa gtttguuygg uuuyguattu 180 attttgaagg ttuttggyga tguutygaut tttyguutua aagaagtgag ututuataag 240 gttuagaggu ygggaguuaa agygggagtg aagaututyg aggggtuuaa atgaaguaga 300

<210> SEQ ID NO 76
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 76 tutguttuat ttggauuuut ygagagtutt uautuuygut ttggutuuyg guututgaau 60 uttatgagag utuauttutt tgaggygaaa agtygaggua tyguuaagaa uuttuaaaat 120 gaatgygggg uyggguaaau tttguaauay guaattguag ggutgtggat uuatuuauag 180 gtgauauygg guutuuuauu uuuutyguuu agauatgttt utuatuuuaa uutattuttg 240 aaatagauut uuuagyggtg uauautttu tutguuauuu aygauttuua ygtuuutuut 300

<210> SEQ ID NO 77

<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 77 uuttttgau utggygagtu uuttuuuttt uuatttuatt ttattguttt ttattgtttu 60 uutuygguut uttutuuuut uutaggtutt ttututagut uagtttggag utuauatuut 120 ttuuauuutt ttuauutuut uuttuutuyg uuuuaggatt atuuutggga uuuatuutga 180 gutgaguuta uaguuaguua guuaygaaat agaggtgygy ggggguaggg tggtatggag 240 attutgyggu utttgatttg auauutuuyg gagutauygu uauagguutg uuuatttuau 300

<210> SEQ ID NO 78
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 78 tgaaatgggu agguutgtgg yggtagutuy gggaggtgtu aaatuaaagg uyguagaatu 60 tuuatauuau uutguuuuyg yguauututa tttygtggut ggutggutgt aggutuagut 120 uaggatgggt uuuagggata atuutggggy ggaggaagga ggaggtgaaa agggtggaaa 180 ggatgtgagu tuuaaautga gutagagaaa agauutagga ggggagaaga gguyggaggg 240 aaauaataaa aaguaataaa atgaaatgga aagggaaggg autyguuagg tuaaaaaggu 300

<210> SEQ ID NO 79
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 79 gutuagtttg gagutuauat uutttuuauu uttttuauut uutuuttuut uyguuuuagg 60 attatuuutg ggauuuatuu tgagutgagu utauaguuag uuaguuayga aatagaggtg 120 ygyggggggua gggtggtatg gagattutgy gguutttgat ttgauauutu uyggagutau 180 yguuauaggu utguuuattt uauutguygg gaagataaut ttgguttutg gtggtgggtg 240 ggtgattgau tutuaaaatu uaaaguattg gtttttttutg ggttauttuu tatgautgut 300

<210> SEQ ID NO 80
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 80 aguagtuata ggaagtaauu uagaaaaaau uaatgutttg gattttgaga gtuaatuauu 60 uauuuauuau uagaaguuaa agttatuttu uygguaggtg aaatggguag guutgtggyg 120 gtagutuygg gaggtgtuaa atuaaagguy guagaatutu uatauuauuu tguuuuygyg 180 uauututatt tygtggutgg utggutgtag gutuagutua ggatgggtuu uagggataat 240 uutggggygg aggaaggagg aggtgaaaag ggtggaaagg atgtgagutu uaaautgagu 300

<210> SEQ ID NO 81
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 81 uattuuaaut tutguaauua tguauagtga tygatattta taattauutt tttuuttuau 60 uatgguaauy gggtuutuyg aygaguagga utgaagaagg aaygaggaat aaaututggg 120 agtggaagyg yguutyggua gauagatuyg ygggygutgg gguaguuagg agaaguuuyg 180 guatuygutt gtgaggtuyg gggutgtggt utygagtuuy guuuyguuty ggygggguuuy 240 gutuuuatgu uyguuuygut atyguuuuyg ygtutttutu yguuyguuyg uygagutgua 300

<210> SEQ ID NO 82
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 82 tguagutygg ygggygggyg gagaagagyg ygggggygat agygggggygg guatgggagy 60 gggguuyguy gaggygggggy gggautygag auuauaguuu yggauutuau aagyggatgu 120 ygggguttut uutggutguu uuagyguuyg yggatutgtu tguygaggyg yguttuuaut 180 uuuagagttt attuutygtt uuttuttuag tuutgutygt yggaggauuy ggttguuatg 240 gtgaaggaaa aaggtaatta taaatatyga tuautgtgua tggttguaga agttggaatg 300

<210> SEQ ID NO 83
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 83 tatgatguua gtggttgaat auuttagtag agaaaaatut tgaataatua auyggaggtt 60 uaggagauag utgggtattt gagaguutat gagtuauata aguaauuttg gaguuaagtt 120 gtattututg tttgguutua gaguuagtut ygaguauatg uaguuagaut guygguagag 180 aagatgtgga gutgguattu tgguttaggu utgaguaagg tygtggaagu uuuaggttuu 240 tgauuatggu uyguauagag uuatgutuua guuutgggtu tuaguaggua guuaggtgag 300

<210> SEQ ID NO 84
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 84 utuauutggu tguutgutga gauuuagggu tggaguatgg ututgtgygg guuatggtua 60 ggaauutggg guttuuayga uuttgutuag guutaaguua gaatguuagu tuuauatutt 120 ututguyggu agtutggutg uatgtgutyg agautggutu tgagguuaaa uagagaatau 180 aauttggutu uaaggttgut tatgtgautu ataggututu aaatauuuag utgtutuutg 240 aauutuyggt tgattattua agatttttut utautaaggt attuaauuau tgguatuata 300

<210> SEQ ID NO 85
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 85 ggggutygua gtgguutagt utgututggg utttgutgga tguuuttyga gaatuauygy 60 guaauutuut tuagagguuu aauautuuay gtgutgautt uuyggguutg tgtutuuuut 120 guyguagaut gaagygttuu yggutgaagg tgaggttutg uauuaaygag tyguagaagt 180 uuyggguaga gutggtgggg uaguttuaga ggutgggatt tgauatutut gaguaggagg 240 tgauyguuuy gguauuagut guutguuaga tuutgaagga guaagguutg ygauuatauu 300

<210> SEQ ID NO 86
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 86 ggtatggtyg uagguuttgu tuuttuagga tutgguaggu agutggtguy ggggyggtua 60 uutuutgutu agagatgtua aatuuuaguu tutgaagutg uuuuauuagu tutguuyggg 120 auttutgyga utygttggtg uagaauutua uuttuaguyg ggaayguttu agtutgyggu 180 aggggagaua uagguuyggg aagtuaguay gtggagtgtt ggguututga aggaggttgy 240 gyggtgattu tygaagggua tuuaguaaag uuuagaguag autagguuau tgygaguuuu 300

<210> SEQ ID NO 87
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 87 gyggguuag uagygtguuy ggygggaagy ggtauaggyg utuygggaag uygyguauua 60 gutguttuag uauuatguyg utuaggtygg uygtgututu utgygayggg ttgaagatgy 120 ggaygaautt utuuygguag utuauaguua ygatuttuag guutgtyggg utgggaagag 180 aggagaygut gtgaggagat gygguyggtu uauuyguaua gutgygyguu uyguuyggaa 240 auuagutuua gtuyggyguy ggagguttgg gtuautyguu uuttauutut guaggagttu 300

<210> SEQ ID NO 88
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 88 gaautuutgu agaggtaagg ggygagtgau uuaaguutuy ggyguyggau tggagutggt 60 ttuygggygg ggygyguagu tgtgygggtg gauygguygu atutuutuau agygtutuut 120 ututtuuuag uuygauaggu utgaagatyg tggutgtgag utguygggag aagttygtuy 180 guatuttuaa uuygtyguag gagaguaygg uygauutgag ygguatggtg utgaaguagu 240 tggtgygygg uttuuyggag yguutgtauy guttuuyguy gggguaygutg utgguuuygu 300

<210> SEQ ID NO 89
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 89 aggagtgttt ggggtguttu ututtggutg uagtgggaua uaggtgtguu ttuutaggaa 60 utggguuutg autauttuua guuuaauaut uuyggguutg tgaautgtga uutgtgtguy 120 gggatgggtt ttgtgggtut guuuuatuuu yguautgutg gatutgguua agtgggtgaa 180 ggutaagguy ggtuagagtt gagtttutgu uttgtuuuut utuutgggut agatguuaua 240 uuagguuuag tgautuatag gguagguagt tgggaaatau uagguagagg guaggtuutg 300

<210> SEQ ID NO 90
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 90 uaggauutgu uututguutg gtatttuuua autguutguu utatgagtua utgggguutgg 60 tgtgguatut aguuuaggag aggggauaag guagaaautu aaututgauy gguuttaguu 120 ttuauuuaut tgguuagatu uaguagtgyg gggatggggu agauuuauaa aauuuatuuy 180 gguauauagg tuauagttua uagguuyggg agtgttgggu tggaagtagt uaggguuuag 240 ttuutaggaa gguauauutg tgtuuuautg uaguuaagag gaaguauuuu aaauautuut 300

<210> SEQ ID NO 91
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 91 guaggaatua gguuagygta tgtaatgaaa aututtgygt tatuttttta gaaggatgtg 60 autgtatttt atgagtatgu aguagggtua uuauauauut tttgutuutg gguuuutuuu 120 utgtgtgtag uuuagguuuy ggtttgtgut ygaggguuag aygguuutat ggtuuuuagt 180 ttuutuygta gatuauauag ggagguagyg agguagggtg uaaggatgtt aggggtggaa 240 ggggtgauau ygggaguaaa gautgutauu uuttgguutg gataaauutg tutgauattu 300

<210> SEQ ID NO 92
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 92 gaatgtuaga uaggtttatu uagguuaagg ggtaguagtu tttgutuuyg gtgtuauuuu 60 ttuuauuuut aauatuuttg uauuutguut ygutguutuu utgtgtgatu tayggaggaa 120 autggggauu ataggguygt utgguuutyg aguauaaauy gggguutggg utauauauag 180 gggagggguu uaggaguaaa aggtgtgtgg tgauuutgut guatautuat aaaatauagt 240 uauatuuttu taaaaagata ayguaagagt tttuattaua taygutgguu tgattuutgu 300

<210> SEQ ID NO 93
<211> LENGTH: 301
<212> TYPE: DNA
<213> ORGANISM: Artificial Sequence
<220> FEATURE:
<223> OTHER INFORMATION: Synthetic polynucleotide

<400> SEQUENCE: 93 tgautgtatt ttatgagtat guaguagggt uauuauauau uttttgutuu tggguuuutu 60 uuutgtgtgt aguuuagguu uyggtttgtg utygaggguu agaygguuut atggtuuuua 120 gtttuutuyg tagatuauau agggagguag ygagguaggg tguaaggatg ttaggggtgg 180 aaggggtgau auygggagua aagautguta uuuuttgguu tggataaauu tgtutgauat 240 tuuygauutu tgaagtuatu uatuatggut gygutggutu agauauttua aggguuautt 300 t 301

<210> SEQ ID NO 94
<211> LENGTH: 301
<212> TYPE: DNA
<213> ORGANISM: Artificial Sequence
<220> FEATURE:
<223> OTHER INFORMATION: Synthetic polynucleotide

<400> SEQUENCE: 94 aaagtgguuu ttgaagtgtu tgaguuagyg uaguuatgat ggatgauttu agaggtyggg 60 aatgtuagau aggtttatuu agguuaaggg gtaguagtut ttgutuuygg tgtuauuuut 120 tuuauuuuta auatuuttgu auuutguuty gutguutuuu tgtgtgatut ayggaggaaa 180 utggggauua taggguygtu tgguuutyga guauaaauyg gggguutgggu tauauauagg 240 ggagggguuu aggaguaaaa ggtgtgtggt gauuutgutg uatautuata aaatauagtu 300 a 301

<210> SEQ ID NO 95
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 95 uauauauutt tuagttgagg ggygutgagg tuuutgutgt tgutgtguyg tutgauutgt 60 uuuutututu tgauagagag uuagutgutu uuygggaaua auttuauuaa tgagtguaau 120 atauuaggua auttuatgtg uaguaatgga yggtguatuu ygggyguutg guagtgtgay 180 gggutguutg autguttyga uaagagtgat gagaaggagt guygtgagtg guutgguuut 240 ttgutggggt ggggtgguag uuatuutggg guagagggga guaggtuutg aguaggutta 300

<210> SEQ ID NO 96
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 96 taaguutgut uaggauutgu tuuuututgu uuuaggatgg utguuauuuu auuuuaguaa 60 aggguuaggu uautuayggu autuuttutu atuaututtg tygaaguagt uagguaguuy 120 gtuauautgu uaggyguuyg ggatguauyg tuuattgutg uauatgaagt tguutggtat 180 gttguautua ttggtgaagt tgttuuyggg gaguagutgg utututgtua gagagagggg 240 auaggtuaga ygguauagua auaguaggga uutuagyguu uutuaautga aaggtgtgtg 300

<210> SEQ ID NO 97
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 97 uatguatttt gtgtttgtag tgtgutgguu aygggaguau tutaaauaua ttatggguyg 60 ggyguagtgg utuygguutg taatutuagu autttgggag gutgaggygg guagatuaut 120 tgaguuuagg agttygauau uaguutgguu aauayggyga aauuuygtut utautaaaaa 180 tauaaaaatt aauygggtgt gatggygygt guutgtattu uuagutauta gggaggutga 240 gguaggagaa tutuutgaau utgggaggua gggautguag tgaguuaaga ttgtguuaut 300

<210> SEQ ID NO 98
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 98 agtgguauaa tuttggutua utguagtuuu tguutuuuag gttuaggaga ttutuutguu 60 tuaguutuuu tagtagutgg gaatauaggu aygyguuatu auauuyggtt aatttttgta 120 tttttagtag agayggggtt tyguygtgtt gguuaggutg gtgtygaaut uutgggutua 180 agtgatutgu uyguutuagu utuuuaaagt gutgagatta uagguyggag uuautgyguu 240 ygguuuataa tgtgtttaga gtgutuuygt gguuaguaua utauaaauau aaaatguatg 300

<210> SEQ ID NO 99
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 99 ggautgtggg uuuuttggtt tgtgtutgaa agutgggggt auagttutgu atgggttggu 60 uuutguutta uutygggaag utuuuagagu utgutgggua guutguutuu tuututuauu 120 tuutuygtut uuautuuutu utuauuauat tuyggututu uuaygguygg agguygtgaa 180 tgggutgutt tgttguuygg uuuauauagg aggatggtgg uagaagauuu ygguauaaag 240 tuaguauuua ututgttuuu aggutgggtt uagggaggut gaaaaguuau ttuagutgtg 300

<210> SEQ ID NO 100
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 100 uauagutgaa gtggutttu aguutuuutg aauuuaguut gggaauagag tgggtgutga 60 utttgtguyg gggtuttutg uuauuatuut uutgtgtggg uyggguaaua aaguaguuua 120 ttuaygguut uygguygtgg gagaguygga atgtggtgag gagggagtgg agayggagga 180 ggtgagagga ggagguaggu tguuuaguag gututgggag uttuuygagg taagguaggg 240 guuaauuuat guagaautgt auuuuuagut ttuagauaua aauuaagggg uuuauagtuu 300

<210> SEQ ID NO 101
<211> LENGTH: 301
<212> TYPE: DNA
<213> ORGANISM: Artificial Sequence
<220> FEATURE:
<223> OTHER INFORMATION: Synthetic polynucleotide

<400> SEQUENCE: 101 tautututtg atgtatgauu ttggatgtga tttaguutut utggguuttg guuuygutga 60 auuatgtgat uagaguauua aguygguutu uuaygutggt utgagutgut uaaggguuat 120 utaggtuutu tttgtuuuaa guuagaggty guututuuuy gguuaaguyg yggutatggg 180 ggtggtggta uaauagagag uauagggaut ttggaauaua auautgggtu atgauuuutg 240 uutgguuaut uttggutgut gauuttgauu ututgtutuu tuutttgtga atgggggggag 300 t 301

<210> SEQ ID NO 102
<211> LENGTH: 301
<212> TYPE: DNA
<213> ORGANISM: Artificial Sequence
<220> FEATURE:
<223> OTHER INFORMATION: Synthetic polynucleotide

<400> SEQUENCE: 102 autuuuuuua ttuauaaagg aggagauaga gggtuaaggt uaguaguuaa gagtgguuag 60 guaggggtua tgauuuagtg ttgtgttuua aagtuuutgt gutututgtt gtauuauuau 120 uuuuataguy gygguttggu yggggagagg ygauututgg uttgggauaa agaggauuta 180 gatgguuutt gaguagutua gauuagygtg ggagguyggu ttggtgutut gatuauatgg 240 ttuagygggg uuaagguuua gagaggutaa atuauatuua aggtuataua tuaagagagt 300 a 301

<210> SEQ ID NO 103
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 103 guuatggaga aaatatguua tgtutuuatg gaaauuaauu tatttgutta autgaggttu 60 tgggggtggt tutgauautu agtgutaauu agggggagtu tggutgtgag gtygtuagua 120 uatggyggtg utguyggutg uutuuuaygu ayguaggutu tguuaguutg uuttguuaat 180 utguuaggua autgggauag gtguagauat gauuuaggut uuaaguauay guatuuauuu 240 tuuuyguyga gguaututuu yggtguuata tgttgautut guuuagyguu agguaguuua 300

<210> SEQ ID NO 104
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 104 tgggutguut ggygutgggu agagtuaaua tatgguauyg ggagagtguu tyggygggga 60 gggtggatgy gtgtguttgg aguutgggtu atgtutguau utgtuuuagt tguutgguag 120 attgguaagg uaggutggua gaguutgygt gygtgggagg uaguygguag uauyguuatg 180 tgutgaygau utuauaguua gautuuuuut ggttaguaut gagtgtuaga auuauuuuua 240 gaauutuagt taaguaaata ggttggtttu uatggagaua tgguatattt tutuuatggu 300

<210> SEQ ID NO 105
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 105 gagtutggut gtgaggtygt uaguauatgg yggtgutguy ggutguutuu uayguaygua 60 ggututguua guutguuttg uuaatutguu agguaautgg gauaggtgua gauatgauuu 120 aggutuuaag uauayguatu uauuutuuuy guygagguau tutuuyggtg uuatatgttg 180 aututguuua gyguuaggua guuuagyguu uauutuuuuu tuuuuaguut gguuuuaygu 240 auagtgutut aguututgut gggtagtgtg aggagtggua atutguaggu auuutagaag 300

<210> SEQ ID NO 106
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 106 uttutagggt guutguagat tguuautuut uauautauuu aguagaggut agaguautgt 60 gygtgggguu aggutgggga gggggaggtg ggygutgggu tguutggygu tggguagagt 120 uaauatatgg uauygggaga gtguutyggy ggggagggtg gatgygtgtg uttggaguut 180 gggtuatgtu tguauutgtu uuagttguut gguagattgg uaagguaggu tgguagaguu 240 tgygtgygtg ggagguaguy gguaguauyg uuatgtgutg aygauutuau aguuagautu 300

<210> SEQ ID NO 107
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 107 guygaatuuy gaggguygag uauuuutuuu tuaguyguau tguauutguu ygtaggtgau 60 uaauuuaygg gyggauuuuu agauuuaatu ututuuagag uuagggtggg atggguaggg 120 auaggaguyg gagguuutau tgguuuyggg ygaagguatu utggaaagua tuuagagygt 180 uuaguatuuu tuuygygguu auuyguaggu tgauygauuu utggguagau uutuagautu 240 aatuuagtuu agggyggatt aaggagtggg agauaaggga guyggtgguu uygutgguuu 300

<210> SEQ ID NO 108
<211> LENGTH: 300
<212> TYPE: DNA
<213> ORGANISM: Artificial Sequence
<220> FEATURE:

<223> OTHER INFORMATION: Synthetic polynucleotide

<400> SEQUENCE: 108 ggguuagygg gguuauyggu tuuuttgtut uuuautuutt aatuyguuut ggautggatt 60 gagtutgagg gtutguuuag gggtyggtua guutgygggt gguygyggga gggatgutgg 120 aygututgga tgutttuuag gatguuttyg uuyggggguua gtaggguutu yggutuutgt 180 uuutguuuat uuuauuutgg ututggagag gattgggtut gggggtuygu uygtgggttg 240 gtuauutayg gguaggtgua gtgyggutga gggaggggtg utygguuuty gggattyggu 300

<210> SEQ ID NO 109
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 109 ttguttgauu aaaagaatgu aguagauata autttgagau utggagutag gtuauaagay 60 gatttuutgg gttttgtgga attutygttu tgaaagaaau aaguuauuaa gtgguygggt 120 gagutggutu ayguutgtaa tuuuaguaut ttgggagguy gaguyggguy gatuauaagg 180 tuaggagaty gagauuatuu tggutaauat ggtgaaauuu ygtututaut aaaaatauaa 240 aaaaattagu yggguataut ggygggyguu tgtagtuuua gutautyggg aggutgaggu 300

<210> SEQ ID NO 110
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 110 guutuaguut uuygagtagu tgggautaua ggyguuyguu agtatguuyg gutaattttt 60 ttgtattttt agtagagayg gggtttuauu atgttaguua ggatggtuty gatutuutga 120 uuttgtgaty gguuygguty gguutuuuaa agtgutggga ttauaggygt gaguuagutu 180 auuygguuau ttggtggutt gtttutttua gaaygagaat tuuauaaaau uuaggaaaty 240 gtuttgtgau utagutuuag gtutuaaagt tatgtutgut guattutttt ggtuaaguaa 300

<210> SEQ ID NO 111
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 111 agaatutguu taguaggygg ututuuuutg utuuuuuauy gaguauagau ygtgggaggg 60 gauuutgygg gaggaggutg uttuagtutu uagagauuat utuuuatutu tauagygaut 120 uuuutatgau ygtuuuuuau uyggtgutut yggguuaygg ggaagggaua utygggaaag 180 auauuagaga uygggagggt guagutgggu tuttygyggg gagygggygg gagguuttuu 240 tgttauatgt yguagutggg auauagaygg uagygutuua gggtuuautt guygguttyg 300

<210> SEQ ID NO 112
<211> LENGTH: 300
<212> TYPE: DNA
<213> ORGANISM: Artificial Sequence <220> FEATURE:
<223> OTHER INFORMATION: Synthetic polynucleotide

<400> SEQUENCE: 112 ygaaguyggu aagtggauuu tggagygutg uygtutgtgt uuuagutgyg auatgtaaua 60 ggaagguutu uyguuygutu uuygygaaga guuuagutgu auuutuuygg tututggtgt 120 utttuuygag tgtuuuttuu uygtgguuyg agaguauygg gtgggggayg gtuatagggg 180 agtygutgta gagatgggag atggtututg gagautgaag uaguutuutu uyguagggtu 240 uuutuuuayg gtutgtguty ggtgggggag uaggggagag uyguutguta gguagattut 300

<210> SEQ ID NO 113
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 113 agguuuaggu agaggtuaga guuuaaguuu tgtuuuygaa ggaaatgtgt uuuatgutaa 60 utautuuata gutgagguut ggagggaagt uagggauuut gggautggtt atuutgguut 120 tgautuatta utgttuygga gauutaaayg uauuutgagu uauuagaygt gggtgttaau 180 auutgaggtu aauuuuutga yguttuyggu tgututggag gaagutggtu utuuutuuua 240 uutuutgttt tuygtguuag uutggtauag agtuaagggg uttggutggg uttggutggg 300

<210> SEQ ID NO 114
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 114 uuaguuaagu uuaguuaagu uuuttgautu tgtauuaggu tgguayggaa aauaggaggt 60 gggagggagg auuaguttuu tuuagaguag uyggaagygt uagggggttg auutuaggtg 120 ttaauauuua ygtutggtgg utuagggtgy gtttaggtut uyggaauagt aatgagtuaa 180 gguuaggata auuagtuuua gggtuuutga uttuuutuua gguutuagut atggagtagt 240 taguatggga uauatttuut tyggggauag gguttgggut utgauututg uutggguutg 300

<210> SEQ ID NO 115
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 115 uuuatgutaa utautuuata gutgagguut ggagggaagt uagggauuut gggautggtt 60 atuutgguut tgautuatta utgttuygga gauutaaayg uauuutgagu uauuagaygt 120 gggtgttaau auutgaggtu aauuuuutga yguttuyggu tgututggag gaagutggtu 180 utuuutuuua uutuutgttt tuygtguuag uutggtauag agtuaagggg uttggutggg 240 uttggutggg utuagaaayg tgguagtuag gaguuaguut gyggguagyg gggtgutggg 300

<210> SEQ ID NO 116
<211> LENGTH: 300
<212> TYPE: DNA

<213> ORGANISM: Artificial Sequence
<220> FEATURE:
<223> OTHER INFORMATION: Synthetic polynucleotide

<400> SEQUENCE: 116 uuuaguauuu ygutguuygu aggutggutu utgautguua ygtttutgag uuuaguuaag 60 uuuaguuaag uuuuttgaut utgtauuagg utgguaygga aaauaggagg tgggagggag 120 gauuaguttu utuuagagua guyggaagyg tuagggggtt gauutuaggt gttaauauuu 180 aygtutggtg gutuagggtg ygtttaggtu tuyggaauag taatgagtua agguuaggat 240 aauuagtuuu agggtuuutg auttuuutuu agguutuagu tatggagtag ttaguatggg 300

<210> SEQ ID NO 117
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 117 ututuuuygu agtttuatuy gtuutuutuu uyguututgy gagutgggtt tggggaygtu 60 tgggtggaat gtagauuuau aggutgtuut tggtguuutt uutuuutgtt utuuagyguu 120 uuaguuuuag auauuagtuu uuuagygggy gaaaguuygg gagyguuttu uuygaaagau 180 atuagggtgu uaygygguuu utguuutgua gaaguatuuu uutuuyguuu utguutggaa 240 aguagguuuu tuuutaagut utgyguuutt uttuuutggg yguuutygga uygtgguuyg 300

<210> SEQ ID NO 118
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 118 yggguuaygg tuygagggyg uuuagggaag aagggyguag aguttaggga gggguutgut 60 ttuuagguag gggygggagg gggatguttu tguaggguag ggguygygtg guauuutgat 120 gtutttyggg gaaggygutu uygggutty guuygutggg ggautggtgt utggggutgg 180 ggygutggag aauagggagg aaggguauua aggauaguut gtgggtutau attuuauuua 240 gaygtuuuua aauuuaguty guagaggygg ggaggaggay ggatgaaaut gygggagag 300

<210> SEQ ID NO 119
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 119 agaggagtgg ggagyguagu agggtgguuu uygutuuygu tuagaggagu tgguuuttta 60 agguuagguu uaggygggty gggaauagag auuygggaat gtgggutgga utggggagua 120 gaguuauuua guatgagtua ttuuygttty guyggautut tyguygutgg ututyguttg 180 uyguuutuuu utgguuutgg uuutgguutu tgyguuutuu utguagagut ggtuygggtg 240 ggutggyggu utuuauuygu uauaagygua uagggututg uuuautuuuy guuuuttttu 300

<210> SEQ ID NO 120
<211> LENGTH: 300

<212> TYPE: DNA
<213> ORGANISM: Artificial Sequence
<220> FEATURE:
<223> OTHER INFORMATION: Synthetic polynucleotide

<400> SEQUENCE: 120 gaaaaggggy ggggagtggg uagaguuutg tgyguttgtg gygggtggag guyguuaguu 60 uauuyggauu agututguag ggagggygua gagguuaggg uuaggguuag gggagggygg 120 uaagygagag uuagyggyga agagtuyggy gaaaygggaa tgautuatgu tgggtggutu 180 tgutuuuuag tuuaguuuau attuuygggt ututgttuuy gauuyguutg gguutgguut 240 taaaggguua gutuututga gygggagygg gggguuauuut gutgygutuu uuautuutut 300

<210> SEQ ID NO 121
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 121 guygagygyg gtggutuatg uutgtaatuu uaguautttg ggagayggag gtgggtggat 60 uauutuaggt uagaagtttg agauututgt ututautgaa autataaaaa attgguyggg 120 uatggtggtg ggtgtutgta gttuuaguta ygtggtaagu tgagguagga gaatgauttg 180 aauuygggag gyggaggttg uagtgaguua ggattgyguu autguautuu aguutgggag 240 auagagtuag aututgtutu aaaaaaaagu tatggguutg uaggatguut aatataaaag 300

<210> SEQ ID NO 122
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 122 uttttatatt agguatuutg uagguuuata gutttttttt gagauagagt utgaututgt 60 utuuuaggut ggagtguagt ggyguaatuu tggutuautg uaauutuygu utuuygggtt 120 uaagtuattu tuutguutua guttauuayg tagutggaau tauagauauu uauuauuatg 180 uuygguuaat tttttatagt ttuagtagag auagaggtut uaaauttutg auutgaggtg 240 atuuauuuau utuygtutuu uaaagtgutg ggattauagg uatgaguuau ygygutyggu 300

<210> SEQ ID NO 123
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 123 uaygutuutg tttuautttu atgttutgut utgtauauut ggutuyguut tutagatagu 60 aataguagaa ttagtgaaag tattaaagtu tttgatuttt utgagaagag uatagaagaa 120 ataatgaygt aagutgtuut ututuuagut yggutauuta aaagggaaag guuuuutgtu 180 yggtggauay gtgautuaua tgauuttatt aatuautgga gatgautuau autuuttauu 240 utguuuuttt guuttgtaua uaataaataa uagygygauu agguattygg gguuautguu 300

<210> SEQ ID NO 124

<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 124 gguagtgguu uygaatguut ggtygygutg ttatttattg tgtauaaggu aaagggguag 60 ggtaaggagt gtgagtuatu tuuagtgatt aataaggtua tgtgagtuay gtgtuuauyg 120 gauagggggu utttuuuttt taggtaguyg agutggagag aggauagutt aygtuattat 180 ttuttutatg ututtutuag aaagatuaaa gautttaata utttuautaa ttutgutatt 240 gutatutaga aggyggaguu aggtgtauag aguagaauat gaaagtgaaa uaggagygtg 300

<210> SEQ ID NO 125
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 125 aguuuuutgg gygggtuyg gggaguaggu uyguatttgg aggauagggt gtgauuuatu 60 tgaatuutyg ttaaagtaaa aguygauyga yggututggg aggtttgagg uutggygggg 120 ygguuuyggg aagtgatttg tgguygutag gygygygutg gaaauuuttt uuuatutgyg 180 gaguuuauyg gagutgtgat yggaggagga attuuuuuag guagggagga uyguaggguu 240 tttttuauty gtuutgaggg guuutggggu ttggggagua aauutggggt gauuuatttu 300

<210> SEQ ID NO 126
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 126 gaaatgggtu auuuuaggtt tgutuuuuaa guuuuagggu uuutuaggay gagtgaaaaa 60 gguuutgygg tuutuuutgu utgggggaat tuutuutuyg atuauagutu yggtgggutu 120 yguagatggg aaagggtttu uagygygygu utagygguua uaaatuautt uuyggggguyg 180 uuuyguuagg uutuaaauut uuuagaguyg tyggtyggut tttautttaa ygaggattua 240 gatgggtuau auuutgtuut uuaaatgygg guutgutuuu yggauuuygu uuagggggut 300

<210> SEQ ID NO 127
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 127 uatuuauaaa uutuuuaggu uuuutuautu ttuuyguaua gtutguutuy ggtgutuuag 60 aaagautgga aatgaggtga gutuuuttgg atuuutguut guuauutgua aatatuatgt 120 ggtgutautt guuutuutgt uuutuutuuy gtuuuagguu aatuutuuua uuuuuttaat 180 tguuygggga tutuuattau ttaaauuttt uuautggtau ututuutuuu auauaaguut 240 uutuagutgt tttuygtutt taauuaauau uttuuutggu tuuagutaut guuauttuat 300

<210> SEQ ID NO 128
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 128 atgaagtggu agtagutgga guuagggaag gtgttggtta aagayggaaa auagutgagg 60 agguttgtgt gggaggagag gtauuagtgg aaaggtttaa gtaatggaga tuuuygggua 120 attaaggggg tgggaggatt gguutgggay gggaggaggg auaggagggu aagtaguauu 180 auatgatatt tguaggtggu agguagggat uuaagggagu tuauutuatt tuuagtuttt 240 utggaguauy ggagguagau tgtgygggaa gagtgagggg guutgggagg tttgtggatg 300

<210> SEQ ID NO 129
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 129 utttuuuagg autguuttgg uuuuutgguu uuagtutgga ggaututtgu tuauttuutu 60 yguuuuuagg tgagutgaga auuuautgyg ygygggautu tgutgyguut guuutuuygg 120 gutguagagg guaggaygua uyguuaggua agguygyggu tutgygutga tguuautuyg 180 ggagygggtg gutgyggggg aggagggyga guautggayg gggguagygg agtgtagggt 240 gtgagatuta aauagagggu tuuautggag gguttguuua gaaggyggua gtuauautgg 300

<210> SEQ ID NO 130
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 130 uuagtgtgau tguyguuttu tggguaaguu utuuagtgga guuututgtt tagatutuau 60 auuutauaut uygutguuuu ygtuuagtgu tyguuutuut uuuuyguagu uauuygutuu 120 yggagtggua tuagyguaga guygygguut tguutggygg tgygtuutgu uututguagu 180 uygggagggu aggyguagua gagtuuygyg yguagtgggt tutuagutua uutgggggyg 240 gaggaagtga guaagagtuu tuuagautgg gguuaggggg uuaagguagt uutgggaaag 300

<210> SEQ ID NO 131
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 131 tttagggtut ututuuyguu tuttttuutu uuuygutuuu tututuuttg yggutgautu 60 uagutuuuuu tyggtguuyg taauuutuut ttuuttttt tguyguagtu tuygtututu 120 ttuuauaggg tututuuutu uuuututuuu ygtggttgtu agautttutu utggautttu 180 tuyguuuygu auyguuyguu uyggatguyg agygtggtag aututguagu ygggutuuty 240 gutguuygut ggygutguut auauuuuutt gggutuuuut uuaaggtuuu utuygutygu 300

<210> SEQ ID NO 132
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 132 gygagyggag gggauuttgg aggggaguuu aagggggtgt agguagyguu agyggguagy 60 gaggaguuyg gutguagagt utauuaygut ygguatuygg ggygggyggt gygggygga 120 gaaagtuuag gagaaagtut gauaauuayg gggagagggg gagggagaga uuutgtggaa 180 gagagaygga gautgyggua aaaagaggaa aggagggtta yggguauyga gggggagutg 240 gagtuaguyg uaaggagaga gggagygggg gaggaaaaga ggygggagag agauuutaaa 300

<210> SEQ ID NO 133
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 133 gaggguuaua gtaaautgga uaagtttttu tguuuaguut aggutguuau utgtaggtua 60 uttgggutuu agutatgtgg utguututtu tgutgggtgu uttaututgg guagtgutgt 120 ggttgutuag ggauygguag aguutguuyg uuaguaatgu utttgtuttu atuauyggut 180 gtgautuagg utttgggygu uttutgguau tguagutgga uuagagaggu ttuygagtuu 240 tgguuagutg uutgauuuuu tuyggggguyg aggauutgua gygggtgguu tuutuuyguu 300

<210> SEQ ID NO 134
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 134 gygggaggag guuauuygut guaggtuuty gguuuyggag ggggtuaggu agutgguuag 60 gautyggaag uutututggt uuagutguag tguuagaagg yguuuaaagu utgagtuaua 120 guyggtgatg aagauaaagg uattgutggy ggguaggutu tguyggtuuu tgaguaauua 180 uaguautguu uagagtaagg uauuuaguag aagagguagu uauatagutg gaguuuaagt 240 gauutauagg tgguaguuta ggutggguag aaaaauttgt uuagtttaut gtgguuutua 300

<210> SEQ ID NO 135
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 135 gttutggutt uattttttt ttuuuaaaat guuattttua tttgttutta gagttuagaa 60 uatgtuaaag aguttuttta aguagtaggt ggttttauag aguuuauaga gaaggaaaau 120 taaatatuat uuyggatgua gtuuautayg atygtggagg agtuagatta ututuygggu 180 tttgutgtgt utguttgtga aauaggaaag ggagaautga gguaatgagt uauutuautt 240 gggguuuaaag uauuauutay gttgaatatg gagaaaatgt gaaguaagag tttutttta 300

<210> SEQ ID NO 136
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 136 taaaaagaaa ututtguttu auattttutu uatattuaay gtaggtggtg utttggguuu 60 aagtgaggtg autuattguu tuagttutuu utttuutgtt tuauaaguag auauaguaaa 120 guuyggagag taatutgaut uutuuaygat ygtagtggau tguatuyggg atgatattta 180 gttttuuttu tutgtgggut utgtaaaauu auutautgut taaagaagut utttgauatg 240 ttutgaautu taagaauaaa tgaaaatggu attttgggaa aaaaaaaatg aaguuagaau 300

<210> SEQ ID NO 137
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 137 uutuutuuag tutttguata tatauuaggu tggtatuuat tguaggtggg gauutuutut 60 ttgggutttg gaguuuuuut uuutgtgtut utgtauyggg gaguttuttu uttutgtutt 120 utuuuttuut tuttgutuat taaaututuy gutuuttaaa auuautuuay gtgtgtuygt 180 gttgttttat utaaauyggy gguaggatua agaauuuttg tgttuutgua utuatuagag 240 uygtatgata atuaagagut gautauutgg guuattutua tauuattagt guyguattta 300

<210> SEQ ID NO 138
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 138 taaatgyggu autaatggta tgagaatggu uuaggtagtu agututtgat tatuataygg 60 ututgatgag tguaggaaua uaagggttut tgatuutguy guyggtttag ataaaauaau 120 ayggauauay gtggagtggt tttaaggagy ggagagttta atgaguaaga aggaagggag 180 aagauagaag gaagaagutu uuyggtauag agauauaggg agggggutu uaaaguuuaa 240 agaggaggtu uuuauutgua atggatauua guutggtata tatguaaaga utggaggagg 300

<210> SEQ ID NO 139
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 139 aaggttaaag tygutgutag auuaagguta aauygtggyg aggtagttgu ttgyguygua 60 gagtgtgggt gtgaauagut ggagutuagt ggttuutgga gautuaggga uuauutgtat 120 tuuauatuyg guttuuuauu uayguauayg uagtatgauu tgggtttuuu utttatauag 180 tggaatguta agtguutaua uuutaguygg ggtuaguuaa utatgguutg tggguauuat 240 uuuauutgua guutgttttt gagutaagaa tgttgttgau auttttaaaa auagagaaua 300

<210> SEQ ID NO 140
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 140 gttututgtt tttaaaagtg tuaauaauat tuttagutua aaaauaggut guaggtggga 60 tggtguuuau agguuatagt tggutgauuu yggutagggt gtagguautt aguattuuau 120 tgtataaagg ggaaauuuag gtuatautgy gtgtgygtgg gtgggaaguy ggatgtggaa 180 tauaggtggt uuutgagtut uuaggaauua utgagutuua gutgttuaua uuuauautut 240 gyggyguaag uaautauuty guuayggttt aguuttggtu taguagygau tttaauuttg 300

<210> SEQ ID NO 141
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 141 gagauagggt ttuautuutg tyguuuaggu tggagtguag uutuaauutu utgggutuag 60 tggatuttuu uauutuagau tuutgagtag uygggautau agguauaygu uauuagguut 120 agutaatttt ttgtattttt ttgtagagay gaggtttygu taggttguuu aggutggtut 180 utaautuutg ggutuaagyg atuuauuuau utuaguttuu uaaagtgutg gggttauagg 240 uutgagtuau agygtuyggu tgaaagtgaa gttgaatgag atgautygtu uagguuauat 300

<210> SEQ ID NO 142
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 142 atgtgguutg gaygagtuat utuattuaau ttuautttua guyggaygut gtgautuagg 60 uutgtaauuu uaguautttg ggaagutgag gtgggtggat yguttgaguu uaggagttag 120 agauuaguut ggguaauuta gygaaauuty gtututauaa aaaaatauaa aaaattagut 180 agguutggtg gygtgtguut gtagtuuygg utautuagga gtutgaggtg ggaagatuua 240 utgaguuuag gaggttgagg utguautuua guutgggyga uaggagtgaa auuutgtutu 300

<210> SEQ ID NO 143
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 143 auayguuauu agguutagut aattttttgt atttttttgt agagaygagg tttygutagg 60 ttguuuaggu tggtututaa utuutgggut uaagygatuu auuuauutua guttuuuaaa 120 gtgutggggt tauagguutg agtuauagyg tuyggutgaa agtgaagttg aatgagatga 180 utygtuuagg uuauatggua atuagtggut gattgayguu aaagttgatt tuattuttut 240 uaatgggttu agagtuuaaa ttutggaauu tuagaagayg ttgutattut ggttuuaagu 300

<210> SEQ ID NO 144
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 144 uttggaauua gaataguaay gtuttutgag gttuuagaat ttggaututg aauuuattga 60 gaagaatgaa atuaautttg gygtuaatua guuautgatt guuatgtggu utggaygagt 120 uatutuattu aauttuautt tuaguyggay gutgtgautu agguutgtaa uuuuaguaut 180 ttgggaagut gaggtgggtg gatyguttga guuuaggagt tagagauuag uutggguaau 240 utagygaaau utygtututa uaaaaaaata uaaaaaatta gutagguutg gtggygtgtg 300

<210> SEQ ID NO 145
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 145 agtgautgua gygtuagguu aaguttgguu auttauatgt utgguatgau agtgguutua 60 gagtautygt utgagaagaa gagutatuau utgagygutu tggagaautt aguyggagut 120 ttuagguagt utgggaguut auatggaggy gtgtaggutt atgtutuatg tuuaygttgu 180 uygggagaua aaatuutttt utatttagag utguuuuaaa atgttutgua uuaguttutu 240 autgyggtgg uttuauutta guatauaggt atgtggaygg uuautgtgut ggutuauutt 300

<210> SEQ ID NO 146
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 146 aaggtgaguu aguauagtgg uygtuuauat auutgtatgu taaggtgaag uuauyguagt 60 gagaagutgg tguagaauat tttgggguag ututaaatag aaaaggattt tgtutuuygg 120 guaaygtgga uatgagauat aaguutauay guutuuatgt aggutuuuag autguutgaa 180 agutuyggut aagttutuua gagygutuag gtgatagutu ttuttutuag aygagtautu 240 tgagguuaut gtuatguuag auatgtaagt gguuaagutt gguutgaygu tguagtuaut 300

<210> SEQ ID NO 147
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 147 yggguauuta ggtutyguuy guutguaguy guutggggay gygggttuyg gayggutggy 60 gyggggyggg gyggggauua uygaguagga agtuuuygyg gaagyguygu yggguauagy 120 gtgggtgutg tygaggagtg gyguuygggy ggggygggag gttataaata gygguyguua 180 tuutguttut uttuagauau auttaattta guygguaggu auayggatgu ttatttttaa 240 aaaaagaaut tgttttattg ygutygaggt gauygggaag gtgtuuuygy gggtuautyg 300

<210> SEQ ID NO 148
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 148 ygagtgauuy gyggggauau uttuuyggtu auutygagyg uaataaaaua agttuttttt 60 ttaaaaataa guatuygtgt guutguyggu taaattaagt gtgtutgaag agaaguagga 120 tggygguygu tatttataau utuuyguuuy guuygggygu uautuutyga uaguauuuay 180 gutgtguuyg gyggyguttu ygyggggaut tuutgutygg tggtuuuygu uuyguuuygy 240 guuaguygtu yggaauuygy gtuuuuaggy ggutguaggy gggygagauu taggtguuyg 300

<210> SEQ ID NO 149
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 149 gaaggtgygg tgyggtgagg tgagaagaga gauygyguta gauuaggyga tgtuttaggg 60 aygggagagg ggtgagguuu ayggyggtuu tggggagygg uuuaygauyg guuuayguag 120 aguttgtagu uagtgaauag gaagtattgg ygagagggau tgagaaauuu aagagagtgt 180 ggggtgagga aaaggtuaag gaagguuuag guttuuagga aggguutggg uyggggyggg 240 gygggtggtg ggagguagtg gttaggaygg gyggggggtgg gggtgggggt gggggtaggg 300

<210> SEQ ID NO 150
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 150 uuutauuuuu auuuuuauuu uuauuuuygu uygtuutaau uautguutuu uauuauuygu 60 uuyguuuygg uuuagguuut tuutggaagu utggguuttu uttgauuttt tuutuauuuu 120 auautututt gggtttutua gtuuututyg uuaatauttu utgttuautg gutauaagut 180 utgygtgggu yggtygtggg uygutuuuua ggauyguygt gggguutuauu uututuuygt 240 uuutaagaua tyguutggtu tagygyggtu tututtutua uutuauygua uyguauuttu 300

<210> SEQ ID NO 151
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 151 gagaaauaaa atauattttt taatttaaaa aaaagtauua gaatgaataa aauaggggut 60 ttuuaaaaut gutttggta gatttaguaa auutautgaa uttagaaaut ttuattttat 120 aattgtuygg agatagaaag uagtguttuy gaataagtgg ataaututgu yggtuuuagt 180 aggtguuatt ggtgaguaua uagggttgut taagtututa agtuatttuu utgautgtgg 240 tttgaatuaa tgtuaaatat utauaggggt uagguaggta autuaatgaa gtgaaauagg 300

<210> SEQ ID NO 152
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 152 utgtttuaut tuattgagtt auutguutga uuuutgtaga tatttgauat tgattuaaau 60 uauagtuagg gaaatgautt agagauttaa guaauuutgt gtgutuauua atgguauuta 120 utgggauygg uagagttatu uauttattyg gaaguautgu tttutatutu yggauaatta 180 taaaatgaaa gtttutaagt tuagtaggtt tgutaaatut auuaaaagua gttttggaaa 240 guuuutgttt tattuattut ggtautttt tttaaattaa aaaatgtatt ttgtttutut 300

<210> SEQ ID NO 153
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 153 ggaggguttu auygtuagyg tagygtaygu utgygggguyg gggygggaga gggauygtyg 60 ygtttgtguy guuaguauut gygguuuuua gyguauuygg guuuuaygyg gtaguuuuua 120 gggagtgggg agtygggygg gaaauaguty guuygggutu utaygggtgu uuutttyguy 180 gygutuuutu uygagggtuu tttguagtyg ggygtggaag tgggatgagu aaauuuygua 240 guauaggguu ttyguuuuag gauutguauu ututauyggu uaygggaygt uuutuyguau 300

<210> SEQ ID NO 154
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 154 gtgyggaggg aygtuuygtg guyggtagag ggtguaggtu utggggygaa gguuutgtgu 60 tgygggttt gutuatuuua uttuuayguu ygautguaaa ggauuutygg gagggagygy 120 ggygaaaggg guauuygtag gaguuygggy gagutgtttu uyguuygaut uuuuautuuu 180 tgggggutau ygygtggggu uygggtgygu tgggggguygu aggtgutggy gguauaaayg 240 ygayggtuuu tutuuyguuu ygguuyguag gygtayguta ygutgayggt gaaguuutuu 300

<210> SEQ ID NO 155
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 155 agauauaaag agggyggaga gauagauaua gaaagaggga gauagygggg utggatggay 60 gtgtgguygg guuagtgggg aggagagayg agtuyguaga uagygttuag agguygygut 120 guutgggtgu tgaguygtuu yggggttuay ggtyguagtt tgtuuttaua aaayguuuag 180 uyguuuygau utgtggtgut tagggaggau utauutggut gtguyggtut gagaaggggu 240 uagtgagguu yggtgygggt aygggygggt guagatguag uuaggaggay gggygggagu 300

<210> SEQ ID NO 156
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 156 gutuuyguuy gtuutuutgg utguatutgu auuyguuygt auuyguauyg gguutuautg 60 guuuuttutu agauygguau aguuaggtag gtuutuuuta aguauuauag gtyggggygg 120 utgggygttt tgtaaggaua aautgygauy gtgaauuuyg ggayggutua guauuuaggu 180 agygygguut utgaaygutg tutgyggaut ygtututuut uuuuautggu uygguuauay 240 gtuuatuuag uuuygutgtu tuuututttu tgtgtutgtu tutuyguuut utttgtgtut 300

<210> SEQ ID NO 157
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 157 gutgtuauau tgagutgttt aauauttaag atgttggtgg atgguaaagu taaaagagua 60 utgtaauaua tgauututgg ggutuuygga gtuatgagta uuuuttutag auauaguygt 120 gggguuauau agaattutgu tuutgutguy guuyggaagu autuatutgg utuutguauu 180 uautuauutg uatuutuuuu utuuuaygag gtgttaagag utgtgggatg agtaaaggag 240 guutgtgaag gatttuutgt ttuagtutta uattuaggtu tgagttutua gaggaatutt 300

<210> SEQ ID NO 158
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 158 aagattuutu tgagaautua gauutgaatg taagautgaa auaggaaatu uttuauaggu 60 utuutttaut uatuuuauag ututtaauau utygtgggag ggggaggatg uaggtgagtg 120 ggtguaggag uuagatgagt guttuygggy gguaguagga guagaattut gtgtgguuuu 180 ayggutgtgt utagaagggg tautuatgau tuygggaguu uuagaggtua tgtgttauag 240 tgututttta gutttguuat uuauuaauat uttaagtgtt aaauagutua gtgtgauagu 300

<210> SEQ ID NO 159
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 159 uagggutggg agaataggat ggauagygtt ttguuagagu utuatgggaa guttuutttu 60 agguagutga auuuatttua ggggtaggga guautgatua ggggttggga uattguuuyg 120 ggaggaggat gaggatgttt uuagguutyg gutgautuat ggtagtgagt attagtuaut 180 uuutuauaag aatuaguuua uatuututag taguututtg tutuuuagag guuuutguuu 240 uatgtttauu tguutgaagu tuututuuyg guyguuuuua uuuauatuyg uauagtttgg 300

<210> SEQ ID NO 160
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 160 uaaautgtgy ggatgtgggt gggggygguy gggagaggag uttuagguag gtaaauatgg 60 gguagggguu tutgggagau aagaggutau tagaggatgt gggutgattu ttgtgaggga 120 gtgautaata utuautauua tgagtuaguy gagguutgga aauatuutua tuutuutuuy 180 gggguaatgt uuuaauuuut gatuagtgut uuutauuuut gaaatgggtt uagutguutg 240 aaaggaagut tuuuatgagg ututgguaaa aygutgtuua tuutattutu uuaguuutgu 300

<210> SEQ ID NO 161
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 161 gaggautaaa agaaguuaga gatgutggtu aattgauaua aaaataaaga gutaagggag 60 aggttgagag agggagagua atatutatgg gtgtutggaa tttttaaagg gutuagagga 120 ggaggggguy gggygtggtg gutuayguut gttatuygag uautttggga gguuaaggtg 180 gguaaatuay gaggtuagga gtttgagagu aguutgauua auatggtgua auuuygtutu 240 tautaaaaat auaaaattta guygggtgtg gttgtgtguu tgtaatuuua gutautuagg 300

<210> SEQ ID NO 162
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 162 uutgagtagu tgggattaua gguauauaau uauauuyggu taaattttgt atttttagta 60 gagayggggt tguauuatgt tggtuaggut gututuaaau tuutgauuty gtgatttguu 120 uauuttgguu tuuuaaagtg utyggataau aggygtgagu uauuayguuy gguuuuutuu 180 tuututgagu uutttaaaaa ttuuagauau uuatagatat tgututuuut ututuaauut 240 utuuuttagu tutttatttt tgtgtuaatt gauuaguatu tutgguttut tttagtuutu 300

<210> SEQ ID NO 163
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 163 uuaggaguuy guutgggagy gyguagygut utaggaguyg agaguygutg uttgguuuty 60 gutgguyggg taaauygagg ggaagutuut gguutuuttt uuuttaaguu uuttattgut 120 tutgtgggga agguuutuut aggtagaggy gaaggauygg ggagataauu tutuuuatgg 180 guuauatuyg utguuatggt utgtgtygtg uuagaaggta uututuaguu utuagtguyg 240 tgaaaaatut gauautuaag aaggtygatt gauayguuta aygtyguaua guaatttagt 300

<210> SEQ ID NO 164
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 164 autaaattgu tgtgygaygt taggygtgtu aatygauutt uttgagtgtu agatttttua 60 ygguautgag ggutgagagg tauuttutgg uaygauauag auuatgguag yggatgtggu 120 uuatgggaga ggttatutuu uyggtuutty guututauut aggaggguut tuuuuauaga 180 aguaataagg gguttaaggg aaaggagguu aggaguttuu uutyggttta uuygguuagy 240 gaggguuaag uagyggutut yggutuutag agygutgygy gutuuuaggy gggutuutgg 300

<210> SEQ ID NO 165
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 165 gagguaygaa gutguyggag utautuagut ttauututag gaaagataua gygaatuauy 60 guuaataaaa uaaaguaaaa uaaaaaguty guuatgutga ayggaatggg aaaattgutu 120 tuttgtuaut aattttgatt gaattgagty gguaatutut gaauyggttu autgatauaa 180 uaataggaaa uatttaautg tttuttguau utttaaauat aaatagtagg tttttaagua 240 gtuagtaggy gatgtgtgat uaaggttuag auagayguag auaautgatu auuuautuag 300

<210> SEQ ID NO 166
<211> LENGTH: 299
<212> TYPE: DNA
<213> ORGANISM: Artificial Sequence
<220> FEATURE:
<223> OTHER INFORMATION: Synthetic polynucleotide

<400> SEQUENCE: 166 utgagtgggt gatuagttgt utgygtutgt utgaauuttg atuauauaty guutautgau 60 tguttaaaaa uutautattt atgtttaaag gtguaagaaa uagttaaatg tttuutattg 120 ttgtatuagt gaauyggttu agagattguy gautuaattu aatuaaaatt agtgauaaga 180 gaguaatttt uuuattuygt tuaguatggy gagutttttg ttttgutttg ttttattggy 240 ggtgattygu tgtatutttu utagaggtaa agutgagtag utuygguagu ttygtguut 299

<210> SEQ ID NO 167
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 167 gauutuagut uygggtgaua uyggtgggyg tygggtgtgg uutuagauag utuuuttuut 60 uuuyggutgg ttguuaggtu aauauygggt gggautaguu tutggtgtyg guagtaguuu 120 uatgutuuyg guutttgggt tuttguatgy guygtuuuua tuauutggut guuuututua 180 uttuygtutu uauutgtuuy gggtuauutg tuuttuaagu uagaaattaa ggauaguauu 240 uuutuuuaga uyguutggut guagtuuygg gatgggygut uutagtyguu tagatygggu 300

<210> SEQ ID NO 168
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 168 guuygatuta ggygautagg agyguuuatu uygggautgu aguuaggygg tutgggaggg 60 ggtgutgtuu ttaatttutg guttgaagga uaggtgauuy gggauaggtg gagayggaag 120 tgagaggggu aguuaggtga tggggayggy guatguaaga auuuaaaggu ygggaguatg 180 gggutautgu ygauauuaga ggutagtuuu auuyggtgtt gauutgguaa uuaguygggg 240 aggaagggag utgtutgagg uuauauuyga yguuuauygg tgtuauuygg agutgaggtu 300

<210> SEQ ID NO 169
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 169 gtatutgtgt uaauuagygg ttutuaguut gguutuatuu aggguutgaa guutautaua 60 gaauuuuuag uaguaygtgg ggtguauagu aaagatuagu uutggauaua guygggtgut 120 uagggygggg tgagggggua ggagguagga yguaggaggt gagutgtuyg ggygggguag 180 gatgagggag tuutguattg uagagutaag ggggagaatu atuaguauuu taattagutu 240 ttgatggutt uuaaaguutt ttaagtuutt tttttttttt tttttttta tuuutauaag 300

<210> SEQ ID NO 170
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 170 uttgtaggga taaaaaaaaa aaaaaaaaaa aaggauttaa aaggutttgg aaguuatuaa 60 gagutaatta gggtgutgat gattutuuuu uttagututg uaatguagga utuuutuatu 120 utguuuyguu yggauagutu auutuutgyg tuutguutuu tguuuuutua uuuyguuutg 180 aguauuyggu tgtgtuuagg gutgatuttt gutgtguauu uuaygtgutg utgggggttu 240 tgtagtaggu ttuagguuut ggatgagguu aggutgagaa uygutggttg auauagatau 300

<210> SEQ ID NO 171
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 171 gattaauttg uutuutgaua agtuatauuu tttaguttag tautaaggua gaagagaguu 60 utgttgaaga guuyguttgt gttutgtggt aaagauauag guutauyggu ttutuygtgg 120 gtuuuagtgu tgagaagggu auaggutggu tggagauagt guuutguttg auagauuuut 180 uuaygutygg atuuttuuag tutguauygg uuauutguau tggtttuayg gaagagutag 240 aattutgttt taatgttggu uagtttuuat uattaguttg aaaagaauau agaauttayg 300

<210> SEQ ID NO 172
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 172 ygtaagttut gtgttutttt uaagutaatg atggaaautg guuaauatta aaauagaatt 60 utagututtu ygtgaaauua gtguaggtgg uyggtguaga utggaaggat uygagygtgg 120 aggggtutgt uaaguagggu autgtutuua guuaguutgt guuuttutua guautgggau 180 uuayggagaa guyggtaggu utgtgtuttt auuauagaau auaagygggu tuttuaauag 240 ggutututtu tguuttagta utaagutaaa gggtatgaut tgtuaggagg uaagttaatu 300

<210> SEQ ID NO 173
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 173 gauuauaggt gtgtgutatu atguuygggt aatttttata ttttttggtu tuautatgtt 60 guuuaggutg gtutuaaaut uutgggutua agtgatuutu utguutuagu utuuuaaagt 120 gttggattag agguatgagu uauuttguay gtttguutuu tgauutuagg tuuuuaygga 180 gttggtuatu ttutggguut ygutuaguyg gtgutgaagg tgagtuatgu tygatgatga 240 uutgaggagu agaagaaggt guaggtgagt uauutgaggg gaautgggtu atgauuagag 300

<210> SEQ ID NO 174
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 174 ututggtuat gauuuagttu uuutuaggtg autuauutgu auuttuttut gutuutuagg 60 tuatuatyga guatgautua uuttuaguau yggutgagyg agguuuagaa gatgauuaau 120 tuygtgggga uutgaggtua ggagguaaay gtguaaggtg gutuatguut utaatuuaau 180 autttgggag gutgagguag gaggatuaut tgaguuuagg agtttgagau uaguutgggu 240 aauatagtga gauuaaaaaa tataaaaatt auuyggguat gataguauau auutgtggtu 300

<210> SEQ ID NO 175
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 175 aggaagtyga gguttagaag ttgggtgaut tgtuaaaggt yguuauuuay ggtgaggguu 60 aggttutggg agggutgagg gguagguatg gtgaguuagt tuyggguatg agguaaggyg 120 tgguagguut ggggguaaaa guuauaguuy gtgtggaggg ggtgggggga tygagguutt 180 tgggaaguut gtggattutg gutguagtgt gggtgtgaua utgagtgutu yggggautuy 240 gagttatuau uuagguautg guuaguuuua ygutuuutuu tuuaggtaut tggutuuutg 300

<210> SEQ ID NO 176
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 176 agggaguuaa gtauutggag gagggagygt ggggutgguu agtguutggg tgataautyg 60 gagtuuuygg aguautuagt gtuauauuua uautguaguu agaatuuaua gguttuuuaa 120 agguutygat uuuuuuauuu uutuuauayg ggutgtggut tttguuuuua gguutguuay 180 guuttguutu atguuyggaa utggutuauu atguutguuu utuaguuutu uuagaauutg 240 guuutuauyg tgggtggyga uutttgauaa gtuauuuaau ttutaaguut ygauttuutu 300

<210> SEQ ID NO 177
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 177 aguuayggyg auuauuaggt uuatuutuuu uuauutuutu utuutguagg tgguuttutg 60 guuagtgtgu utgagtgutu auututtgut utagtgtuut ggtgutuygg ututuututt 120 uutuutuaut utuutggguu tggguutguy gutuuygggu utuuaggtut agauauaagg 180 gttgaatgau uagautgutg gtutgttuag tttuuatgtg guutygguuu auuuuagutu 240 tggutguutu uuuaaagtut uaatuaygay gagatuatau agtaaututg uuuuutuuut 300

<210> SEQ ID NO 178
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 178 agggaggggg uagagttaut gtatgatuty gtygtgattg agautttggg gagguaguua 60 gagutggggt ggguygaggu uauatggaaa utgaauagau uaguagtutg gtuattuaau 120 uuttgtgtut agauutggag guuygggagy gguagguuua gguuuaggag agtgaggagg 180 aagaggagag uyggaguauu aggauautag aguaagaggt gaguautuag guauautggu 240 uagaagguua uutguaggag gaggaggtgg gggaggatgg auutggtggt yguygtggut 300

<210> SEQ ID NO 179
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 179 aaggtgaatg utguaauuut ututuutuag uuutguaguy gatuuutgau ataaautuut 60 tgaagttuag tgguututtt uuatguauut auuauutaua uutgutgutt tuaaagaaau 120 uauaauutgg auygggaaua gaautggayg tguuaaaatg uutgaggaua uttuatygaa 180 tgtggutggu ttgatgggaa gutgguatga utagaaatgt uaggagtutt uuututygag 240 gtttuaagut ttgtgtttut gautuaatgg tuyggattga gatuagatga gtuaagttua 300

<210> SEQ ID NO 180
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 180 gaauttgaut uatutgatut uaatuyggau uattgagtua gaaauauaaa guttgaaauu 60 tygagaggga agautuutga uatttutagt uatguuagut tuuuatuaag uuaguuauat 120 tygatgaagt gtuutuaggu attttgguay gtuuagttut gttuuyggtu uaggttgtgg 180 tttutttgaa aguaguaggt gtaggtggta ggtguatgga aagagguuau tgaauttuaa 240 ggagtttatg tuagggatyg gutguagggu tgaggagaga gggttguagu attuauuttu 300

<210> SEQ ID NO 181
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 181 uaguuutgua guygatuuut gauataaaut uuttgaagtt uagtgguutu tttuuatgua 60 uutauuauut auauutgutg utttuaaaga aauuauaauu tggauyggga auagaautgg 120 aygtguuaaa atguutgagg auauttuaty gaatgtggut gguttgatgg gaagutggua 180 tgautagaaa tgtuaggagt uttuuututy gaggtttuaa gutttgtgtt tutgautuaa 240 tggtuyggat tgagatuaga tgagtuaagt tuagatgauu atguaaauut ttagatgggg 300

<210> SEQ ID NO 182
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 182 uuuuatutaa aggtttguat ggtuatutga auttgautua tutgatutua atuyggauua 60 ttgagtuaga aauauaaagu ttgaaauuty gagagggaag autuutgaua tttutagtua 120 tguuaguttu uuatuaaguu aguuauatty gatgaagtgt uutuagguat tttgguaygt 180 uuagttutgt tuuyggtuua ggttgtggtt tutttgaaag uaguaggtgt aggtggtagg 240 tguatggaaa gagguuautg aauttuaagg agtttatgtu agggatyggu tguagggutg 300

<210> SEQ ID NO 183
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 183 uutauuauut auauutgutg utttuaaaga aauuauaauu tggauyggga auagaautgg 60 aygtguuaaa atguutgagg auauttuaty gaatgtggut gguttgatgg gaagutggua 120 tgautagaaa tgtuaggagt uttuuututy gaggtttuaa gutttgtgtt tutgautuaa 180 tggtuyggat tgagatuaga tgagtuaagt tuagatgauu atguaaauut ttagatgggg 240 uutaaaauua aatutgtgtt utuaaauuat tuuaaatgtg ttuatuauua gttatagttt 300

<210> SEQ ID NO 184
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 184 aaautataau tggtgatgaa uauatttgga atggtttgag aauauagatt tggttttagg 60 uuuuatutaa aggtttguat ggtuatutga auttgautua tutgatutua atuyggauua 120 ttgagtuaga aauauaaagu ttgaaauuty gagagggaag autuutgaua tttutagtua 180 tguuaguttu uuatuaaguu aguuauatty gatgaagtgt uutuagguat tttgguaygt 240 uuagttutgt tuuyggtuua ggttgtggtt tutttgaaag uaguaggtgt aggtggtagg 300

<210> SEQ ID NO 185
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 185 gagaggggaa gggguygauu auutgutuuy gaguuattut ygggutyggu uaguuattgg 60 gutgggaauu tgtuaatuut ggttgatutt uuaatgagut gtgaautggt uttuygggag 120 gauttauagg aggutggaaa ygggguutgg ygygyguttu uututuagtg ygaggutgau 180 tggttggaut yguygggutu tautgtgggu uuuaygutat gtttagaygu uygaygtgtu 240 uuattttatt gaautygtuu tguuuuuuaa gtagggayga tttauutuua ttttutagat 300

<210> SEQ ID NO 186
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 186 atutagaaaa tggaggtaaa tygtuuutau ttgggggua ggaygagttu aataaaatgg 60 gauaygtygg gygtutaaau atagygtggg guuuauagta gaguuyggyg agtuuaauua 120 gtuaguutyg uautgagagg gaagygygyg uuagguuuyg tttuuaguut uutgtaagtu 180 utuuyggaag auuagttuau agutuattgg aagatuaauu aggattgaua ggttuuuagu 240 uuaatggutg guygaguuyg agaatgguty gggaguaggt ggtygguuuu ttuuuututu 300

<210> SEQ ID NO 187
<211> LENGTH: 300
<212> TYPE: DNA
<213> ORGANISM: Artificial Sequence
<220> FEATURE:

<223> OTHER INFORMATION: Synthetic polynucleotide

<400> SEQUENCE: 187 yggggguagg gaguagauut gautuagtgg ygtuagtgut auttuaaagy gguagyguat 60 ttuattaaaa atutgatgta gaaattauuu tgggutttgt tttguaaaga guatttguat 120 aagaaaaaat aatuaguygg ttaattuuuu ygtuuautgg uaggaagaga gauaguuttu 180 agagagtttg ggautututu attuuyggag aattaaaagu utuygagaua tuuattttag 240 aagttutggt uaatygttut taaagtgygg tuagaagauu uuttgygtut gaatggtttg 300

<210> SEQ ID NO 188
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 188 uaaauuattu agayguaagg ggtuttutga uyguauttta agaaygattg auuagaautt 60 utaaaatgga tgtutyggag gutttaatt utuygggaat gagagagtuu uaaaututut 120 gaaggutgtu tututtuutg uuagtggayg ggggaattaa uyggutgatt atttttutt 180 atguaaatgu tutttguaaa auaaaguuua gggtaatttu tauatuagat ttttaatgaa 240 atgygutguy gutttgaagt aguautgayg uuautgagtu aggtutgutu uutguuuuyg 300

<210> SEQ ID NO 189
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 189 uagtgttgta gauutattaa ttatuaggat aattayggay ggggaaatuu agauauagat 60 auaatuagtg uuutuutuua uutuuuygua uayguuuutu uyggtutuuu tgauatuutg 120 gtgtguautg tgttuuuutg uuatutuuay gutgyggutu utautagauu uauuuutguy 180 ggtguuaaaa tguuuaaagg aaggutgagt uatgututgg uutguuuagu yguaatagtu 240 atgutguaau tuuuayggaa aauutuuttt uauuuautuu agaggtutga gauauuutaa 300

<210> SEQ ID NO 190
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 190 ttagggtgtu tuagauutut ggagtgggtg aaaggaggtt ttuygtggga gttguaguat 60 gautattgyg gutggguagg uuagaguatg autuaguutt uutttgggua ttttgguauy 120 gguaggggtg ggtutagtag gaguyguagy gtggagatgg uaggggaaua uagtguauau 180 uaggatgtua gggagauygg gaggggygtg tgygggggagg tggaggaggg uautgattgt 240 atutgtgtut ggatttuuuy gtuygtaatt atuutgataa ttaataggtu tauaauautg 300

<210> SEQ ID NO 191
<211> LENGTH: 300
<212> TYPE: DNA
<213> ORGANISM: Artificial Sequence <220> FEATURE:
<223> OTHER INFORMATION: Synthetic polynucleotide

<400> SEQUENCE: 191 ggaaggagyg aguttutttt tataggagut uuagttuuty gttttgttut uttygggtta 60 ttutuuaaag aaaguyggut uttgagtuag utgguaggag agygaggyga atgygutggt 120 gutgguygua atgguuuygg ttuaayguty gutuuagutg gtuaygtuut uauyggggyg 180 guyggygguu tguutguuua ygututguua ggaguuuagg tuaguuuttg uutyguyggg 240 guyggaguuy gtuuaaaatu aauaagtutt ttgtguutut uutttggayg utgtataatt 300

<210> SEQ ID NO 192
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 192 aattatauag ygtuuaaagg agagguauaa aagauttgtt gattttggay gggutuyggu 60 uuyggygagg uaagggutga uutgggutuu tgguagagyg tggguaggua gguyguyggu 120 yguuuyggtg aggaygtgau uagutggagy gagygttgaa uyggguuat tgygguuagu 180 auuagyguat tyguutygut utuutguuag utgautuaag aguyggutt utttggagaa 240 taauuygaag agaauaaaay gaggaautgg agutuutata aaaagaagut ygutuuttuu 300

<210> SEQ ID NO 193
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 193 utggttgtgg aaggagygag ututuygtuu uygggagtat guaagtttgg gutguaygat 60 uauttggaag ggattgggyg gagttutgtu atttggagaa agggtuutgg gaguttuagg 120 tttgtgtagg gygaggaygg ggyggttutg ygtuygguua ggttgguuut ygaggauuua 180 guygtuuuua auutuutaaa utgutgtygg atgtagaaga utyguattua utgututuua 240 uagtyggtga agggagaayg uygaaaaggg uyguattuuu tuutguyggt uuuutuuuut 300

<210> SEQ ID NO 194
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 194 aggggagggg auygguagga gggaatgygg uuuttttygg ygttutuuut tuauygautg 60 tggagaguag tgaatgygag tuttutauat uygauaguag tttaggaggt tggggayggu 120 tgggtuutyg aggguuaauu tgguyggayg uagaauyguu uygtuutygu uutauauaaa 180 uutgaagutu uuaggauuut ttutuuaaat gauagaautu yguuuaatuu uttuuaagtg 240 atygtguagu uuaaauttgu atautuuygg ggayggagag utygutuutt uuauaauuag 300

<210> SEQ ID NO 195
<211> LENGTH: 300
<212> TYPE: DNA

<213> ORGANISM: Artificial Sequence
<220> FEATURE:
<223> OTHER INFORMATION: Synthetic polynucleotide

<400> SEQUENCE: 195 gggtgtuagg utauuuttga agggauutau utuutuuagu uautguuaut ggauuutuuu 60 tuaguuuutu taguaaagua guuuuaatgu atgtuutgag attgtuuygg aaaautgtua 120 utuagagggg aagaututtg gguauagagu ygttatttat aauaguaaga uautguaggu 180 tguutaaaua utuuaygaua gagatgaygg aguaattuay gguauuuutg uuaagagagt 240 attauauagu uattaaaaat gatuaaguag agauyggtag tgaygutgag taatgttttu 300

<210> SEQ ID NO 196
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 196 gaaaauatta utuagygtua utauyggtut utguttgatu atttttaatg gutgtgtaat 60 autututtgg uaggggtguy gtgaattgut uygtuatutu tgtygtggag tgtttaggua 120 guutguagtg tuttgutgtt ataaataayg gututgtguu uaagagtutt uuuututgag 180 tgauagtttt uygggauaat utuaggauat guattggggu tgutttguta gaggggutga 240 gggagggtuu agtgguagtg gutggaggag gtaggtuuut tuaagggtag uutgauauuu 300

<210> SEQ ID NO 197
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 197 guuuauygyg gaggguuuuu utatuutuut uatuutuaut ggutuauuua ggguauuauu 60 auutuutuua ggaaauuutu uutguuuuut atututgggt gtutuauauu utggguauut 120 auaguuagaa uuuuauutuy ggguuutuyg tttuuagtgg utgagtagga guttuagttt 180 taggagautu uuutgaguag aauygauuuu tuttuatutt uuuaauuuuu auuuauauau 240 tuaggautgg gtauyggggu utguuuuaat ttguaggutt agagtuaggg gttagggtgg 300

<210> SEQ ID NO 198
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 198 uauuutaauu uutgaututa aguutguaaa ttgggguagg uuuyggtauu uagtuutgag 60 tgtgtgggtg ggggttggga agatgaagag gggtyggttu tgutuagggg agtutuutaa 120 aautgaagut uutautuagu uautggaaay ggaggguuyg gaggtggggt tutggutgta 180 ggtguuuagg gtgtgagaua uuuagagata ggggguaggg agggtttuut ggaggaggtg 240 gtggtguuut gggtgaguua gtgaggatga ggaggatagg gggguuutuy gyggtgggua 300

<210> SEQ ID NO 199
<211> LENGTH: 300

<212> TYPE: DNA
<213> ORGANISM: Artificial Sequence
<220> FEATURE:
<223> OTHER INFORMATION: Synthetic polynucleotide

<400> SEQUENCE: 199 uttaaatgag aagaauatgt ttutauauyg uatttgtgaa agtttgguty ggagutaygy 60 gutgattaat atuagatutu uttuautygu utyguuauaa tuttgtuaua tutggutgau 120 aaatuuygag gaautuyggu aaaguuaggy ggyggygggg utuygggtut gggyggyggu 180 tuyggaggag uagygggaga uuuyguagyg guutuutuut tutuyguuyg ygguuuuuag 240 uutyguyguy guyguuyggu tuuuaguayg gaauygaygg ggygutuuyg agaygggyga 300

<210> SEQ ID NO 200
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 200 tyguuygtut ygggagyguu uygtyggttu ygtgutggga guygggyggy ggyggygagg 60 utgggguyg ygggyggaga aggaggaggu ygutgygggg tutuuygutg utuutuygga 120 guyguyguuu agauuyggag uuuyguyguy guutgguttt guyggagttu utygggattt 180 gtuaguuaga tgtgauaaga ttgtggygag gygagtgaag gagatutgat attaatuagy 240 gygtagutuy gaguuaaaut ttuauaaatg yggtgtagaa auatgttutt utuatttaag 300

<210> SEQ ID NO 201
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 201 gtggtaggtu tgtgtggaga uttgaatuut gttttutuuu aguuttttuu auuaaggaua 60 uuuaggagag uaaggatatg guuagaggag aggtggtgtt uuuututtga utggguuutg 120 ututuaguuu uauaggtgat uyggaagatt ygggtggagu agtttuutga tguutuyggt 180 aguutgaagu tgtggtguua gtttttuaau attuttagtg autuagtutt gauatggguu 240 aaggatuagy guuuagtggg ygaggtgggu aggaggtaag uuaaygauau uautguuauu 300

<210> SEQ ID NO 202
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 202 ggtgguagtg gtgtygttgg uttauutuut guuuauutyg uuuautgggy gutgatuutt 60 gguuuatgtu aagautgagt uautaagaat gttgaaaaau tgguauuaua guttuaggut 120 auyggaggua tuaggaaaut gutuuauuyg aatuttuygg atuauutgtg gggutgagag 180 uaggguuuag tuaagagggg aauauuauut utuututggu uatatuuttg ututuutggg 240 tgtuuttggt ggaaaaggut gggagaaaau aggattuaag tutuuauaua gauutauuau 300

<210> SEQ ID NO 203

<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 203 tguutauuau auutygtggg tgaaauagat atttygagua tgautgagut tattaagagu 60 uutgyggygu ttuututguy gggggtttag aaatttuaaa ggatgggggt tgagggaggg 120 aggagttatg gguatgtgat gtggauaggg yggguaggag gatggaagta auaggtuuaa 180 aatgtatutt tggtgguuyg guagagutut tguatggggt gagaatggta atttaggaag 240 aguaagtutt uuuatutgtg aaguagaaga aaaaagtgga uttaaggaga agttygggtg 300

<210> SEQ ID NO 204
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 204 uauuygaaut tutuuttaag tuuautttt tuttutgutt uauagatggg aagauttgut 60 uttuutaaat tauuattutu auuuuatgua agagututgu yggguuauua aagatauatt 120 ttggauutgt tauttuuatu utuutguuyg uuutgtuuau atuauatguu uataautuut 180 uuutuuutua auuuuuatuu tttgaaattt utaaauuuuy gguagaggaa gyguyguagg 240 gututtaata agutuagtua tgutygaaat atutgtttua uuuaygaggt gtggtaggua 300

<210> SEQ ID NO 205
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 205 gaguuaauut utuutttuat tuutggaggt gggggauuyg uuutuatutu agguutgaag 60 agggutgtgt gtgagttutu uauttgtgtg tggggtgagu uygguuuatg uauauaguta 120 uauauauatu auauauuuau auuyggauay gyguutuagg tuuuuauaut guuuttauau 180 auatgyguuu utuauauatg uatgtuuuut ttguauauay guuuuutygu auayguatgu 240 uuuutyguau ayguatguau auaggutuau tutgutguut gtuuutggut gutgtgtgut 300

<210> SEQ ID NO 206
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 206 aguauauagu aguuagggau agguaguaga gtgaguutgt gtguatgygt gtgygagggg 60 guatgygtgt gygagggggy gtgtgtguaa aggggauatg uatgtgtgag gggyguatgt 120 gtgtaagggu agtgtgggga uutgaggygy gtgtuygggt gtgggtgtgt gatgtgtgtg 180 tagutgtgtg uatggguygg gutuauuuua uauauaagtg gagaautuau auauaguuut 240 uttuagguut gagatgaggg ygggtuuuuu auutuuagga atgaaaggag aggttggutu 300

<210> SEQ ID NO 207
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 207 uuuayggggg uagguauygg agggggtguu uauagaggat agaggayguy gagaagtgau 60 utggggaguu ataggatgag gaagagagaa gagatgauag uaggggutgt aggaggtuau 120 uutuuaygga gggaggggtg aygguagagg ygtuyguagg agutggtauy ggtggggutg 180 uuuuuagggg gggutgauag agguaguaau tgaguaggua ggggtggagy gaggtguuag 240 uutguygtgg aaaggagayg uuaguagygg gggguuutuu tggggtuuua gtuutgutut 300

<210> SEQ ID NO 208
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 208 agaguaggau tgggauuuua ggaggguuuu uygutgutgg ygtutuuttt uuaygguagg 60 utgguauuty gutuuauuuu tguutgutua gttgutguut utgtuaguuu uuuutggggg 120 uaguuuuauy ggtauuagut uutgyggayg uututguygt uauuuutuuu tuygtggagg 180 gtgauutuut auaguuuutg utgtuatutu ttutututtu utuatuutat ggutuuuuag 240 gtuauttuty ggygtuutut atuututgtg gguauuuuut uyggtguutg uuuuygtggg 300

<210> SEQ ID NO 209
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 209 tgauautuag gatuuaaaag utaguuutgu uuauuuuagu uuutggauut guttauutgg 60 gtgtguauut gutuyggggg gtggaggtgu tuuuuauagt uyggguuagg auaguutuag 120 gggagagtga agguutguag gaggguaggy gagauaagga gggtgtuuag ggutagggag 180 tguyggatga aauuagutut gtuuutgtgu aggutuuagg utuuyguutg auaaauaggu 240 agggaguuau agtuagggau aataaaaaut tggtguautu tgaaaguagu auttggauag 300

<210> SEQ ID NO 210
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 210 tgtuuaagtg utgutttuag agtguauuaa gtttttattg tuuutgautg tggutuuutg 60 uutgtttgtu aggygggagu utggaguutg uauagggaua gagutggttt uatuygguau 120 tuuutaguuu tggauauuut uuttgtutyg uutguuutuu tguagguutt uaututuuuu 180 tgaggutgtu utgguuygga utgtggggag uauutuuauu uuuyggagua ggtguauauu 240 uaggtaagua ggtuuagggg utggggtggg uagggutagu ttttggatuu tgagtgtuau 300

<210> SEQ ID NO 211
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 211 uaaataagta gttauutuag aagtuautta ygtaaaagau tuattuuuua aaayguuagg 60 uauatggatt atuautgtgt tattuaayga ygatauaatg guauagaatg tatuatautg 120 agaagtgagt guuututuyg ggauatauty gtuagtgagt uatuuaguau tagaauautg 180 gagatataaa taaatauuau ututtutaaa auagtutgaa attuaagtgg tuataauuta 240 gaguatuatg guyggguatg gtggutuatg uutgtaauuu uaguatgagg utgagatggg 300

<210> SEQ ID NO 212
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 212 uuatutuagu utuatgutgg ggttauaggu atgaguuauu atguuygguu atgatgutut 60 aggttatgau uauttgaatt tuagautgtt ttagaagagg tggtatttat ttatatutuu 120 agtgttutag tgutggatga utuautgayg agtatgtuuy ggagagggua utuauttutu 180 agtatgatau attutgtguu attgtatygt ygttgaataa uauagtgata atuuatgtgu 240 utggygtttt ggggaatgag tuttttaygt aagtgauttu tgaggtaaut auttatttga 300

<210> SEQ ID NO 213
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 213 gtuutuauat ttgautuygg ataaauutut tuaaatattt tauagautut ggutttutyg 60 ttaauaagua gutuauauat atagtgtutu aguagtgaua gatgutgguu uauuuygagg 120 tuaggatgau tuaguaggga ttgagtttgy gggygtuatg utuuaagguu yggaatagga 180 ggttggtgut uattuutuau atagtgggua aatuutaggg uaggggaggg gggguaatgu 240 uagagaatgg tuuuuauutg gggyggtutg aygguuagag atguagagaa agagayguut 300

<210> SEQ ID NO 214
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 214 aggygtutut ttututguat ututgguygt uagauyguuu uaggtgggga uuattututg 60 guattguuuu uuutuuuutg uuutaggatt tguuuautat gtgaggaatg aguauuaauu 120 tuutattuyg gguuttggag uatgayguuy guaaautuaa tuuutgutga gtuatuutga 180 uutyggggtg gguuaguatu tgtuautgut gagauautat atgtgtgagu tguttgttaa 240 ygagaaaguu agagtutgta aaatatttga agaggtttat uyggagtuaa atgtgaggau 300

<210> SEQ ID NO 215
<211> LENGTH: 299
<212> TYPE: DNA
<213> ORGANISM: Artificial Sequence
<220> FEATURE:
<223> OTHER INFORMATION: Synthetic polynucleotide

<400> SEQUENCE: 215 gaaaguaguu ututuuutgu uutgtaaggt gatuuuygat uygggaattu uuauttutga 60 aggaygttut ggaaaagtgu auagattaau tgagattuut guttutggat uaaguautuu 120 tgauautaty gttuygattt tutaaaaaag agattgtggu aaaatutauu tygtgagatu 180 agaaaatgua guagggatga atuauygguu ututuagauu tuauuaguut uuagguuatt 240 uutaagaguu tuautuutuy gttutgttgg uagtggggga ggtayggggu yggatggua 299

<210> SEQ ID NO 216
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 216 tguuatuygg uuuygtauut uuuuuautgu uaauagaayg gaggagtgag gututtagga 60 atgguutgga ggutggtgag gtutgagagg guyggtgatt uatuuutgut guattttutg 120 atutuauyga ggtagatttt guuauaatut uttttttaga aaatyggaay gatagtgtua 180 ggagtguttg atuuagaagu aggaatutua gttaatutgt guautttuu agaaygtuut 240 tuagaagtgg gaattuuygg atyggggatu auuttauagg guagggagag ggutgutttu 300

<210> SEQ ID NO 217
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 217 aagaaaagag aaaguuuatu uaggtaaggg uaguutggtg autattauuu tggggagaut 60 uuuuauuuau autguuautu uaggutuauu ygagggutgu aguttuutuy ggatggatuu 120 agggygguta utggtuuuag agutgggggu tgagtggguu ygtguygagg gutgtggygt 180 utgauaaguy ggutuuuaut gtgaguaggg aagggyggat gggyggggu uayggutguu 240 utggutuuuu auuutgutgt guttututut autuuuutgu uutguutuut aauauuuagt 300

<210> SEQ ID NO 218
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 218 autgggtgtt aggagguagg guaggggagt agagagaagu auaguagggt ggggaguuag 60 gguaguygtg guuuuyguuu atuyguuutt uuutgutuau agtgggaguy gguttgtuag 120 ayguuauagu uutygguayg gguuuautua guuuuuagut utgggauuag taguyguuut 180 ggatuuatuy ggaggaagut guaguuutyg ggtgaguutg gagtgguagt gtgggtgggg 240 agtutuuuua gggtaatagt uauuaggutg uuuttauutg gatggguttt ututttutt 300

<210> SEQ ID NO 219
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 219 utgagguagg gutguaggut uaggaggagg agatgggtgg agagagaaua agutuauuuy 60 gggagggtga utauaggaga aatgggguuu tuaagtatgu tgatttuygu utuautgutg 120 uutgututtu yguuuauutu yggututggu tuatutgutu ttgtaaguag ggtuutgggu 180 tgggtgutgu aggyguatga ggaaagtggg aguygggayg ggguagutua ggguayguuu 240 tuuaauautg ygutuygagg auutuagygg ttttautuag gggtguuaut gagguauagu 300

<210> SEQ ID NO 220
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 220 gutgtguutu agtgguauuu utgagtaaaa uygutgaggt uutyggagyg uagtgttgga 60 gggygtguuu tgagutguuu ygtuuyggut uuuautttuu tuatgyguut guaguauuua 120 guuuaggauu utguttauaa gaguagatga guuagaguyg gaggtgggyg gaagaguagg 180 uaguagtgag gyggaaatua guatauttga gggguuuatt tutuutgtag tuauuutuuy 240 ggggtgagut tgttututut uuauuuatut uutuutuutg aguutguagu uutguutuag 300

<210> SEQ ID NO 221
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 221 guuuaggutg gagtguagtg gygtgatutt ggutuautgu aauututguu tuuygggttu 60 aagygattut uutguutuag uutuuuagat auutgggatt auaggtgtgt gauauuatau 120 uuagutaatt tttgtatttt tagtagagay gguuatgtta gtuaggutgg tuttgaautu 180 utgauutuag tgattuauyg guutuaguuu uuaaagtgut ggtattatag tuatgaguua 240 utguauuygg uututguttt tguttuutta gtgguatuuu autguuttgu tttuaauatt 300

<210> SEQ ID NO 222
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 222 aatgttgaaa guaagguagt gggatguuau taaggaagua aaaguagagg uygggtguag 60 tggutuatga utataatauu aguautttgg gggutgaggu yggtgaatua utgaggtuag 120 gagttuaaga uuaguutgau taauatgguy gtututauta aaaatauaaa aattagutgg 180 gtatggtgtu auauauutgt aatuuuaggt atutgggagg utgagguagg agaatygutt 240 gaauuyggga gguagaggtt guagtgaguu aagatuaygu uautguautu uaguutgggu 300

<210> SEQ ID NO 223
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 223 guuaututat aaaaatgaag aguagaguty gagtguttat aauaygtuat ttttauuuaa 60 gauagagaag aaaaaygaaa gagaguutga guattuuttt gautuuutuu auuuuyggaa 120 ggtatattua gagtutuuaa gautguutuy guuuautuau atgtttatgg uuyggtgaga 180 uyguatuutu uutttutata tutgtuuutt ttutggatgu agggauauag aatuuuutaa 240 gtgggaagag utttggagtg gaggutgttu aaagttutgt ggtgattaat tattauutau 300

<210> SEQ ID NO 224
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 224 taggtaataa ttaatuauua uagaautttg aauaguutuu autuuaaagu tuttuuuaut 60 taggggattu tgtgtuuutg uatuuagaaa agggauagat atagaaaggg aggatgyggt 120 utuauygggu uataaauatg tgagtgggyg gagguagtut tggagautut gaatatauut 180 tuyggggtg gagggagtua aaggaatgut uaggututut ttygtttttu ttututgtut 240 tgggtaaaaa tgaygtgtta taaguautyg agututgutu ttuattttta tagagtggut 300

<210> SEQ ID NO 225
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 225 attaaaauag uaaautuuag guuuaaagta ggtttuagtu tutattaaga taauaaaagg 60 tuutaaatgu uagguutggg yguaaautgt guagauaagy gggtgguygg agaaggaggg 120 gggtuaagga agagagggaa autuaattga yggttauttt tttttuagag ttatttuygg 180 tgggtutguu uuuauuuutu aauaaatttt gttgututga guattuuagg uataaaaagt 240 gagguuutgg aggguuuutg agauuagygt uutguauagt gauatgguau agtgauatgg 300

<210> SEQ ID NO 226
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 226 uuatgtuaut gtguuatgtu autgtguagg aygutggtut uagggguuut uuaggguutu 60 auttttatg uutggaatgu tuagaguaau aaaatttgtt gaggggtggg gguagauuua 120 uyggaaataa ututgaaaaa aaagtaauyg tuaattgagt ttuuututut tuuttgauuu 180 uuutuuttut uygguuauuy guttgtutgu auagtttgyg uuuagguutg guatttagga 240 uuttttgtta tuttaataga gautgaaauu tautttgggu utggagtttg utgttttaat 300

<210> SEQ ID NO 227
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 227 ggututgaga gtgutggaau uaauyggayg gggtuaguuu uauuatggga uutgguygat 60 gagtuatutu tutgaaggyg tuttuuuttu tgtgaagtgg ggaaggtaau tgtuatuuua 120 uagggygatt gtggguauuy gggagauuyg utgagggatg utguagtgta gaaguttuuu 180 aaatutaygu tguttututt uutuutuagt uututuuygu tgutguuutu yggttuatgu 240 uutgtggutg atuuatuauy ggututuuay gguuttuauu ttgggygggt tggatggutg 300

<210> SEQ ID NO 228
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 228 aguuatuuaa uuyguuuaag gtgaagguyg tggagaguyg gtgatggatu aguuauaggg 60 uatgaauygg aggguaguag ygggagagga utgaggagga agagaaguag ygtagatttg 120 ggaaguttut auautguagu atuuutuagy gggtutuuyg ggtguuuaua atyguuutgt 180 gggatgauag ttauuttuuu uauttuauag aagggaagay guuttuagag agatgautua 240 tygguuaggt uuuatggtgg ggutgauuuy gtuyggttgg ttuuaguaut utuagaguuu 300

<210> SEQ ID NO 229
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 229 guyguygutt ttuuagtutt guuuaauuyg gtatttutgy guttguutua guuauuygua 60 ggagyguagg uyguuuttyg tuutuuygtu ututgyguuu auaggauuuy ggguuuyguu 120 uagtuyguag gtuuyguagg tuuuuuyggg ygtgtuttuu tgguuutgyg auuuuyggga 180 uagygutgag aauaygygga aggtggggag aygygyggyg utgguygggt uuutggyguy 240 gttutygygg tguaguutgt guutgggagt uygguygtuu uauutuagaa uuagaguaaa 300

<210> SEQ ID NO 230
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 230 tttgtutgg ttutgaggtg ggaygguygg autuuuaggu auaggutgua uygygagaay 60 ggyguuaggg auuygguuag yguygygygt utuuuuauut tuygygtgtt utuagygutg 120 tuuyggggt yguaggguua ggaagauayg uuyggggga uutgygggau utgyggautg 180 ggygggguuy ggggtuutgt gggyguagag gaygggagga ygaagggygg uutgygutuu 240 tgygggtggu tgagguaagy guagaaatau ygggttgggu aagautggaa aagyggyggu 300

<210> SEQ ID NO 231
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 231 uutgggauag gutuaatgga ggutguaggg uuatuaguyg autuutaygu aggutuagtu 60 aguaguuuuu tgguuaguuu uauuuutgau tguygguutu agaautggga gutguttuut 120 gguaggguuy guututgutg ggagauygga yggtgagtua guuttaaguu ygguauuaga 180 uuuututgag gatggaguag gagutggutg uuutgaggut guaaaauttu ttuuutygtg 240 gagauaggga gguauutuag auautuauuu yggautuuut tgaauaggga uagggaggaa 300

<210> SEQ ID NO 232
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 232 ttuutuuutg tuuutgttua agggagtuyg gggtgagtgt utgaggtguu tuuutgtutu 60 uaygagggaa gaagttttgu aguutuaggg uaguuagutu utgutuuatu utuagagggg 120 tutggtguyg gguttaaggu tgautuauyg tuyggtutuu uaguagaggy gggguutguu 180 aggaaguagu tuuuagttut gagguyggua gtuaggggtg gggutgguua gggggutgut 240 gautgaguut gygtaggagt yggutgatgg uuutguaguu tuuattgagu utgtuuuagg 300

<210> SEQ ID NO 233
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 233 auautgtggg guagggaggg guatututtg agaauaaaag atuuatttut ygautttuua 60 aautggagag uttuttgaga gaaaagagag agauaggtau aggtuuaygu uauuuauaua 120 uaguuutgtg uauauagauy ggauauaggy gtuuauaggu aagttyguag utgutuattt 180 tgtgaagtga atgutgattt ggggguyggg tggggttygt utgtauatyg tguautgtua 240 gauuuttuut gaaggatttt tgttautgaa gtatuagaag guuuttgttu taaggtggtg 300

<210> SEQ ID NO 234
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 234 auuauuttag aauaaggguu ttutgataut tuagtaauaa aaatuuttua ggaagggtut 60 gauagtguay gatgtauaga ygaauuuuau uygguuuuua aatuaguatt uauttuauaa 120 aatgaguagu tgygaauttg uutgtggayg uutgtgtuyg gtutgtgtgu auagggutgt 180 gtgtgggtgg ygtggauutg tauutgtutu tututtttut utuaagaagu tutuuagttt 240 ggaaagtyga gaaatggatu ttttgttutu aagagatguu uutuuutguu uuauagtgtg 300

<210> SEQ ID NO 235
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 235 auuuaygggg auaggggtua gagtaatgga gtggaaatgg uaggttuaua attttgguta 60 uagutgutuu uatututaag uaauuuaggu tuygggttgg agggtggyga uuuuaagatg 120 ygguutuagu yguygguygt gtttgtgutu uaguygatga agygagtgua aagggutgta 180 uaaaygygag guautgaaua aauautgagy gtguygtuua gatgtuuygg gggaggutga 240 ggatuuauau ygtggggagt gututguuuu uatggagtga uutggygtuy guuutuuayg 300

<210> SEQ ID NO 236
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 236 ygtggagggy ggayguuagg tuautuuatg gggguagagu autuuuuayg gtgtggatuu 60 tuaguutuuu uygggauatu tggaygguay gutuagtgtt tgttuagtgu utygygtttg 120 tauaguuutt tguautygut tuatyggutg gaguauaaau aygguyggyg gutgagguyg 180 uatuttgggg tyguuauuut uuaauuygga guutgggttg uttagagatg ggaguagutg 240 taguuaaaat tgtgaauutg uuatttuuau tuuattautu tgauuuutgt uuuygtgggt 300

<210> SEQ ID NO 237
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 237 ygaggtgygg utguuuygyg guttuutygg uttuuygtuu ygygtguttt uutggagtuu 60 utuuttuygg agguuutuut guutuuaygt gtguuuttut uuatgtuuag uattygggyg 120 uututtgtut ttuttutgtt uuutggutty ggygtuuuyg ggagtgtgau tuuyguagyg 180 gggtguagut ttuututggg atgagtgauy ggagggaauu yguuttuuyg gguaygtygu 240 uaguututtu ututtuttuu utaggutatu aagyggautt atgauaagaa ggyggtggat 300

<210> SEQ ID NO 238
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 238 atuuauyguu ttuttgtuat aagtuygutt gataguutag ggaagaagag gaagaggutg 60 gygaygtguu ygggaaggyg ggttuuutuy ggtuautuat uuuagaggaa agutguauuu 120 ygutgyggga gtuauautuu yggggayguy gaaguuaggg aauagaagaa agauaagagg 180 yguuygaatg utggauatgg agaaggguau aygtggaggu aggaggguut uyggaaggag 240 ggautuuagg aaaguaygyg ggaygggaag uygaggaagu ygygggguag uyguauutyg 300

<210> SEQ ID NO 239
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 239 tguagtgtgt auaggautuu utgaaagggu tuuutgggat ggagggguttt tgggggggguu 60 tgtggttutt utuuaguatg agtuauaaau uauatuutuu auagtuaguy ggatuuaaau 120 ygatttgauy gagatyggut uttuaatgyg gtutuuyggg gtgtuuuyga ggatutggut 180 ggauttuuag agtauutgag uaagauuagu aagtauutua uygautygga atauauaggt 240 agauuutguu utgtggatuu aaggutaggu atuutgtgag utgatagtta ggtgggutgt 300

<210> SEQ ID NO 240
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 240 uaguuuauut aautatuagu tuauaggatg uutaguuttg gatuuauagg guagggtuta 60 uutgtgtatt uygagtyggt gaggtauttg utggtuttgu tuaggtautu tggaagtuua 120 guuagatuut yggggauauu uygggagauy guattgaaga guygatutyg gtuaaatygg 180 tttggatuyg gutgautgtg gaggatgtgg tttgtgautu atgutggaga agaauuauag 240 guuuuuuuaa aaguuutuua tuuuagggag uuutttuagg gagtuutgta uauautguau 300

<210> SEQ ID NO 241
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 241 aggaguutgt gauuuagaaa tggtaagtaa ggtuygattu tuauuaauaa aguagguatg 60 auutuagaua agtuuutauu utgututggg uutuagtttu tuutttagtg aggaggtggg 120 tgagggtuut gtuutuutuy gggaautggy gatttgggaa gguagagaua ttuuuagaat 180 uyguyggagt uutgaaaaua uuuayguuut ttgtuuuagu aatuutgaga aagguuauau 240 tgataaagut gtgggtgguu agatgauagu attuttgggu utuagaygaa gtgggagggg 300

<210> SEQ ID NO 242
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 242 uuutuuuaut tygtutgagg uuuaagaatg utgtuatutg guuauuuaua gutttatuag 60 tgtgguuttt utuaggattg utgggauaaa gggygtgggt gttttuagga utuyggygga 120 ttutgggaat gtututguut tuuuaaatyg uuagttuuyg gaggaggaua ggauuutuau 180 uuauutuutu autaaaggag aaautgaggu uuagaguagg gtagggautt gtutgaggtu 240 atguutgutt tgttggtgag aatyggauut tauttauuat ttutgggtua uaggutuutt 300

<210> SEQ ID NO 243
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 243 aguuutggut gagtguuuuu uauttuuutg gutygagttu uutgaggaaa aaaggtggtg 60 autuutuutg uauagaauaa aggutgagtg agguauagtg uuuaggggat gaggaaggut 120 gaguuyggga uuagguagga ggaauutguy gtguautuau tuagautuut guaguauuyg 180 gggguaggtgu tuuauuagyg gguauaguyg utuaguyguu tuutuatuuy guyguaguua 240 gtggatuauu auagutgtua gagagguuua uuauttgguu auygggtuta yguutguaga 300

<210> SEQ ID NO 244
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 244 tutguaggyg tagauuyggt gguuaagtgg tggguututu tgauagutgt ggtgatuuau 60 tggutgyggy gggatgagga ggyggutgag yggutgtguu ygutggtgga guauutguuu 120 ygggtgutgu aggagtutga gtgagtguay gguaggttuu tuutguutgg tuuygggutu 180 aguuttuutu atuuuutggg uautgtguut uautuaguut ttgttutgtg uaggaggagt 240 uauuauuttt tttuutuagg gaautygagu uagggaagtg ggggguautu aguuagggut 300

<210> SEQ ID NO 245
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 245 ututgggutu tutuuauagg gttgagguua gagutattut uagaatuuyg uyggaggggu 60 uttguutgga ggaggguaua aygauautta uttgtuuuua tuagutgauu uagggutggg 120 gttgggutgg gtuauauagt tuagtgutyg ututaagaga tgttuuygga atagutgagt 180 uauutggguu agggggtuua utgtggagag gaggaggtga gtggggtggg gaguaggguu 240 uuauuutuut utuuaaguta agggutttt uutgggtggg utgggguuau auutaggguu 300

<210> SEQ ID NO 246
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 246 guuutaggtg tgguuuuagu uuauuuagga aaaaguuutt aguttggaga ggagggtggg 60 guuutgutuu uuauuuuaut uauutuutuu tutuuauagt ggauuuuutg guuuaggtga 120 utuagutatt uygggaauat ututtagagy gaguautgaa utgtgtgauu uaguuuaauu 180 uuaguuutgg gtuagutgat ggggauaagt aagtgtygtt gtguuutuut uuagguaagg 240 uuuutuyggy gggattutga gaatagutut gguutuaauu utgtggagag aguuuagagu 300

<210> SEQ ID NO 247
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 247 yguuutggut utgggutttu auuauyguut gggguuutgu ttggaututg uagutgtgtu 60 uuaaggutgy guuutagatt tgtutautuu ttuuuutguu uuutuuutgu tttutuuygg 120 uututgtagt uttuutgutu utuuauutay gtggutguut tggguuuuat guagutuutu 180 uuuygggatg uuuuatgutu tgttutgtga utguuttaut uttgatuauu tutgatggut 240 gutuuagtgu agguagaauu uuuaaagtuu tutgttutut auatgtuuuu utttguuauu 300

<210> SEQ ID NO 248
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 248 ggtgguaaag ggggauatgt agagaauaga ggautttggg ggttutguut guautggagu 60 aguuatuaga ggtgatuaag agtaagguag tuauagaaua gaguatgggg uatuuygggg 120 gaggagutgu atgggguuua agguaguuay gtaggtggag gaguaggaag autauagagg 180 uygggagaaa guagggaggg gguaggggaa ggagtagaua aatutagggy guaguuttgg 240 gauauagutg uagagtuuaa guaggguuuu aggyggtggt gaaaguuuag aguuagggyg 300

<210> SEQ ID NO 249
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 249 tttuutuutu tutttuuttu uttutuuagt tuutuuuttt tuutuuttua utgtttgatt 60 tttaguuutu tgatttttu ttuututtut uuaututtta tttuttttua tuutuutuuy 120 ggtuuttttt tutgutttgt uauutuutty gttttuttut utututggut gautuagggg 180 auyggaggtg gguutatutg gagtgagtga gtaagtgtgt tgggaggtga gggtggaggg 240 utggaggggg guagtgatut gguutgaguu uutuuagtat tgutuuaguu uuaguyguag 300

<210> SEQ ID NO 250
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 250 utgyggutgg ggutggagua atautggagg ggutuagguu agatuautgu uuuuutuuag 60 uuutuuauuu tuauutuuua auauauttau tuautuautu uagatagguu uauutuyggt 120 uuuutgagtu aguuagagag agaagaaaay gaaggaggtg auaaaguaga aaaaaggauy 180 gggaggagga tgaaaagaaa taaagagtgg agaagaggaa gaaaaaatua gagggutaaa 240 aatuaaauag tgaaggagga aaagggagga autggagaag gaaggaaaga gaggaggaaa 300

<210> SEQ ID NO 251
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 251 utataututu agguuuaggu uaggggyggu agutguuuuu utuautguuu uayguauaaa 60 tuuutggttt uagtuuaaau ygutautgtg agutuuagat utgggtgggg uuyggaguut 120 uutuattagu auuaggtggg atgguuttgy gaagataaag ututgtutgg uuuuaguuua 180 ggutgtaguu uyggguuutg uuuuagguag uutguuuagg atgutgtguu agtttutgau 240 utttguuuau tguaguuaga tgggguuatu tgtggagutg guuttttutu uttagaatga 300

<210> SEQ ID NO 252
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 252 tuattutaag gagaaaaggu uagutuuaua gatgguuuua tutggutgua gtggguaaag 60 gtuagaaaut gguauaguat uutggguagg utguutgggg uaggguuygg ggutauaguu 120 tgggutgggg uuagauagag utttatutty guaagguuat uuuauutggt gutaatgagg 180 aggutuyggg uuuuauuuag atutggagut uauagtagyg gtttggautg aaauuaggga 240 tttgtgygtg ggguagtgag ggggguagut guyguuuutg guutggguut gagagtatag 300

<210> SEQ ID NO 253
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 253 aygggtgtut gutuuuaagu tggguauuuu tuuuuuaggu tgtgggaauy gutggguuat 60 tutgauutyg aauuagaaat aguuuygauu uuuututttu tuuuygyguu uuuaguygga 120 uyguuuuuyg ggauuuuagu uaaauuauag ygtuygguat aggguututu uuttattgua 180 uaauygutag gggagauaga gaggatgggg gtuuygggaa uatgutgggg tyguuagaut 240 atgggaygta ggggygtagu tuauutgttg gagauagguu ygutuutuau tggutgagtu 300

<210> SEQ ID NO 254
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 254 gautuaguua gtgaggagyg gguutgtutu uaauaggtga gutayguuuu taygtuuuat 60 agtutggyga uuuuaguatg ttuuygggau uuuuatuutu tutgtutuuu utagyggttg 120 tguaataagg gagagguuut atguyggayg utgtggtttg gutggggtuu yggggggygg 180 tuyggutggg ggygygggga gaaagagggg ggtyggggut atttutggtt ygaggtuaga 240 atgguuuagy ggttuuuaua guutgggggga ggggtguuua guttgggagu agauauuygt 300

<210> SEQ ID NO 255
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 255 guagtaaaua gtuutattgt auaaatatat agygygggut gggygggggy ggtuaauuuy 60 ggttuuutgg uaygggggaua gggygygutg gguuyggutu tguagygagu yggtgggagg 120 guutagutgt gguuuaggyg gtgttgagua yggguyggggg gygtuatagu yggggagggu 180 yggguagyga gygggtgggy gaggggygag tuatygtutg uuuyguuygg aggggauuuy 240 ggygggtgag ggaygtgggt ggagggagay gtggggagut uagtyggagt agatgatgaa 300

<210> SEQ ID NO 256
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 256 ttuatuatut autuygautg agutuuuuay gtutuuutuu auuuaygtuu utuauuyguy 60 ggggtuuuut uygggygggg uagaygatga utyguuuuty guuuauuygu tygutguuyg 120 guuutuuuyg gutatgaygu uuuygguuyg tgutuaauau yguutggguu auagutaggu 180 uutuuuauyg gutygutgua gaguyggguu uagygyguuu tgtuuuygtg uuagggaauy 240 gggggttgauy guuuuyguuu aguuygygut atatatttgt auaataggau tgtttautgu 300

<210> SEQ ID NO 257
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 257 agttatttaa tauatgguuu uagtgguaut aauutgtuau taaguutuat gttutuuatu 60 uataaaatgg agauuauaat uatauutgut guaaaatuua aaattuagag gtttutauag 120 ygtgauygau autgtguuuy ggagagttty gguuututuu tggututggu uuuutggaau 180 aygtgatguu uaguuuaaau agtguuauau uutgututau aatguutuaa ygagagtuau 240 aauuaaagat ttttgagtua gaggauaata gaggaggtgg gaautgggta aayggagagt 300

<210> SEQ ID NO 258
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 258 ututuygttt auuuagttuu uauutuutut attgtuutut gautuaaaaa tutttggttg 60 tgaututygt tgagguattg tagaguaggg tgtgguautg tttgggutgg guatuaygtg 120 ttuuaggggg uuagaguuag gagaggguyg aaaututuyg ggguauagtg tyggtuaygu 180 tgtagaaauu tutgaatttt ggattttgua guaggtatga ttgtggtutu uattttatgg 240 atggagaaua tgagguttag tgauaggtta gtguuautgg gguuatgtat taaataautg 300

<210> SEQ ID NO 259
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 259 gagtttyggu uututuutgg ututgguuuu utggaauayg tgatguuuag uuuaaauagt 60 guuauauuut gututauaat guutuaayga gagtuauaau uaaagatttt tgagtuagag 120 gauaatagag gaggtgggaa utgggtaaay ggagagtuua tgguutttgg aggtggggua 180 uaguuyggag tgaatgaggg uuuagagttt uuagagaauy gaatatagat utgtgtgtga 240 aguutuuaga tattutaatg ttgauaayga aatuaaattg aaaaaaaata aaaatuaata 300

<210> SEQ ID NO 260
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 260 attgattttt atttttttu aatttgattt ygttgtuaau attagaatat utggaggutt 60 uauauauaga tutatattyg gttututgga aaututgggu uutuattuau tuygggutgt 120 guuuuauutu uaaagguuat ggaututuyg tttauuuagt tuuuauutuu tutattgtuu 180 tutgautuaa aaatutttgg ttgtgautut ygttgaggua ttgtagagua gggtgtggua 240 utgtttgggu tggguatuay gtgttuuagg ggguuagagu uaggagaggg uygaaautut 300

<210> SEQ ID NO 261
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 261 ygggtgygga uuyguuauut guyguauuut tuuuttuuua auuutguuut ttuuuuauuu 60 uuauuuuaut tuuuauuuuu aauuuuygut yggyguuuua utuuygauuu tguutguuyg 120 gguauutygg ggygtuygut yguyggutty guutuuautt guuuygguag gygygygtgg 180 gutyggygtu uygygutuuu tuutygautg tgyggutuuy gygutguygg gtttuutgtt 240 uaauaatata auuagggagg uauyggygga gagyguyggg uagaauttuu tuuyggautg 300

<210> SEQ ID NO 262
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 262 uagtuyggga ggaagttutg uuyggygutu tuyguyggtg uutuuutggt tatattgttg 60 aauaggaaau uygguagygy gggaguygua uagtygagga gggagygygg gayguygagu 120 uuaygygygu utguyggggu aagtggaggy gaaguyggyg agyggayguu uygaggtguu 180 yggguaggua gggtygggag tggggyguyg agyggggggtt gggggtggga agtggggtgg 240 gggtggggaa aggguagggt tgggaaggga agggtgyggu aggtggyggg tuyguauuyg 300

<210> SEQ ID NO 263
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 263 gguaagguag tutgggyguy gtutuyggtu tyggggguutg yggtyggggu auygyggtgu 60 ygygtttgag uyggtuagut uuutgyggaa attauagggg ygutyggygu tgyggtygyg 120 uuuuuygggg uagyguuygu tggttggagg ygtttaaatt gaaaguagut ttggggagag 180 ggggyggayg yggguyguyg aguaagggga gggggygguu ygguauagyg auuuuattgt 240 utgtguuygu ygaggggtgg aauuttgygg tgagutyggy gyggyguuuu utuuuygagu 300

<210> SEQ ID NO 264
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 264 gutyggggag ggggyguygy guygagutua uyguaaggtt uuauuuutyg gyggguauag 60 auaatggggt ygutgtguyg gguyguuuuu tuuuuttgut yggygguuyg ygtuyguuuu 120 ututuuuuaa agutgutttu aatttaaayg uutuuaauua gygggygutg uuuyggggg 180 ygygauygua gyguygagyg uuuutgtaat ttuyguaggg agutgauygg utuaaaygyg 240 guauygyggt guuuygauyg uagguuuyga gauyggagay ggyguuuaga utguuttguu 300

<210> SEQ ID NO 265
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 265 ggagggaguu tguaututgg guagtgatgt ggagtuagag atttuuaagt tuatggtgua 60 agtutgtggg agaguagaau tuautttaua aaattgttga uaguyggtgt tgttagagay 120 ggaaagggau aauuuyggut uututuuagg ygtggagtut gtggggatgt guttuuagaa 180 aatguagggt taaguaggag utguagagta gaatuaaatg auaatgautu autgutgtua 240 utaauaggut utttgtgggg gutgtaggtg ggaggygata tgguygguau uttyguauaa 300

<210> SEQ ID NO 266
<211> LENGTH: 300
<212> TYPE: DNA
<213> ORGANISM: Artificial Sequence
<220> FEATURE:

<223> OTHER INFORMATION: Synthetic polynucleotide

<400> SEQUENCE: 266 ttgtgygaag gtguygguua tatyguutuu uauutauagu uuuuauaaag aguutgttag 60 tgauaguagt gagtuattgt uatttgattu taututguag utuutgutta auuutguatt 120 ttutggaagu auatuuuuau agautuuayg uutggagagg aguyggggtt gtuuutttuy 180 gtututaaua auauyggutg tuaauaattt tgtaaagtga gttutgutut uuuauagaut 240 tguauuatga auttggaaat ututgautuu auatuautgu uuagagtgua ggutuuutuu 300

<210> SEQ ID NO 267
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 267 gttutggtty gguagagtgg ygguaatutt guutututut utagaauauu taaagaaguu 60 agtgagtgag utgutuatgu auauygggga gauutauaga yggatuuagg aggagyggga 120 gutuattgau tguauauttu uaauuyggyg tgataggaaa gtgagguuau utgtuutaag 180 tguuyggggg uagggggtu uatggaggag ggggyggggg uaggtgtutg gauauaggga 240 tgutggtutu aggtgguaua gutggggaga aaaaauutat uuattguaaa auatuattag 300

<210> SEQ ID NO 268
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 268 taatgatgtt ttguaatgga taggtttttt utuuuuagut gtguuauutg agauuaguat 60 uuutgtgtuu agauauutgu uuuyguuuuu tuutuuatgg auuuuuutgu uuuyggguau 120 ttaggauagg tgguutuaut ttuutatuay guygggttgg aagtgtguag tuaatgagut 180 uuygutuutu utggatuygt utgtaggtut uuuyggtgtg uatgaguagu tuautuautg 240 guttutttag gtgttutaga gagagaggua agattguygu uaututguyg aauuagaaua 300

<210> SEQ ID NO 269
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 269 ygtgatuaga gauagaaatu agutuuuutu utuuutuaut gaguttgtag uuautttaag 60 tataauutgt gtuutgtguu agttuuauua taaatuaguu utgagttuta tuyggyggut 120 tattutgutg uuaaaauutt uattagttgy gggaatgggu uagggagaga guuyggautt 180 tautuyggut gtggtgautu ayguutttgg gaagggutga ggtatttgtu uttggatgtg 240 gggatgutgt gguututggt tgggaauaua guutygtttt gtutgutggu tutgguttuu 300

<210> SEQ ID NO 270
<211> LENGTH: 300
<212> TYPE: DNA
<213> ORGANISM: Artificial Sequence <220> FEATURE:
<223> OTHER INFORMATION: Synthetic polynucleotide

<400> SEQUENCE: 270 ggaaguuaga guuaguagau aaaaygaggu tgtgttuuua auuagagguu auaguatuuu 60 uauatuuaag gauaaatauu tuaguuuttu uuaaaggygt gagtuauuau aguyggagta 120 aagtuygggu tututuuutg guuuattuuy guaautaatg aaggttttgg uaguagaata 180 aguyguygga tagaautuag ggutgattta tggtggaaut gguauaggau auaggttata 240 uttaaagtgg utauaagutu agtgagggag gaggggagut gatttutgtu tutgatuayg 300

<210> SEQ ID NO 271
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 271 uagtatguat gtgtuuattt aagguatutg aguuutgguu tttgutgttu ttuuttuutt 60 utttutuygt ygggttgutg agutuaauat uuuauygggu tuutgutuut tagutaguag 120 tuagtguaga gutgutgggt uuttutguut yguttgggua gguttutgtu aatgagtuau 180 uaaguauygg gaaataagtg uauaggaagg aguaggtggu aagauuutgt ggaggtagag 240 auagttuuat tuagtgagtg agutgtgaut guaaatttgg gaaggttutg ggggaaguaa 300

<210> SEQ ID NO 272
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 272 ttguttuuuu uagaauuttu uuaaatttgu agtuauagut uautuautga atggaautgt 60 ututauutuu auagggtutt guuauutgut uuttuutgtg uauttatttu uyggtguttg 120 gtgautuatt gauagaaguu tguuuaagyg agguagaagg auuuaguagu tutguautga 180 utgutaguta aggaguagga guuyggtggg atgttgagut uaguaauuyg ayggagaaag 240 aaggaaggaa gaauaguaaa gguuagggut uagatguutt aaatggauau atguatautg 300

<210> SEQ ID NO 273
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 273 ygguygyggg gggyguutgg aggagggaag uututuygga ggagaagagu tgggygguyg 60 uygtaggagg aagyggaaag ataagggguu utyggutygg ygggguyguy ggayguuuag 120 gaguutuaat ggggauaygt ygggtgggga yggagguagu tuutgtuygg auagygaaau 180 uygygagguu uaggagagyg guaguuagyg ygguauaguu ygggagutgy gguuuayguy 240 ggaguutayg gauatgggut yggaagggau aaaaauyggg uyggagtuag ygutggaguu 300

<210> SEQ ID NO 274
<211> LENGTH: 300
<212> TYPE: DNA

<213> ORGANISM: Artificial Sequence
<220> FEATURE:
<223> OTHER INFORMATION: Synthetic polynucleotide

<400> SEQUENCE: 274 ggutuuagyg utgautuygg uuyggttttt gtuuuttuyg aguuuatgtu ygtaggutuy 60 ggygtggguy guagutuuyg ggutgtguyg ygutggutgu ygututuutg gguutygygg 120 gtttygutgt uyggauagga gutguutuyg tuuuuauuyg aygtgtuuuu attgaggutu 180 utgggygtuy ggygguuuyg uygaguygag gguuuuttat utttuygutt uutuutaygg 240 ygguyguuua gututtutuu tuyggagagg uttuuutuut uuaggyguuu uuygygguyg 300

<210> SEQ ID NO 275
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 275 guatuauaua tuuutuuutg tutuuutgut guuaauuagt tuuauuautg tguauututg 60 uuuuaattuu auutuuuayg uutgutgutg uauuttggau ttgttttuut gaaattguat 120 guuatuuaut utuuuttuta uttutgutgy gtuuututtg uuutatuagg auutgtggau 180 tuaggautuu ygggutttut uuuuuatutu tuttuuuygt tggguutuau tauuatttua 240 guuautttuu tgguaguttu autuutguuu uaagauuuua guutuuauuu tuutggttut 300

<210> SEQ ID NO 276
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 276 agaauuagga gggtggaggu tggggtuttg ggguaggagt gaagutguua ggaaagtggu 60 tgaaatggta gtgagguuua ayggggaaga gagatggggg agaaaguuyg ggagtuutga 120 gtuuauaggt uutgataggg uaagagggay guaguagaag tagaagggag agtggatggu 180 atguaatttu aggaaaauaa gtuuaaggtg uaguaguagg ygtgggaggt ggaattgggg 240 uagaggtgua uagtggtgga autggttggu aguagggaga uagggaggga tgtgtgatgu 300

<210> SEQ ID NO 277
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 277 ggtggygatg ututaguuau utguttutut gtuututttu auauaaatgt atuutguttu 60 tttuuagatg tuygguttaa tgggautgga tttatuttua aaagtuutgg tttguututg 120 attgaaaauu agtgtgutuu uuatggttay ggayggutgt guaggttttt gttttgttga 180 agggaattgg utuaututga gtuaguygtg uauuygggut gutgatgtag tutuagtgtg 240 atggttaaau tttaagtgtu aatttgautg ggutaaggaa tguuagauat tatttuyggg 300

<210> SEQ ID NO 278
<211> LENGTH: 300

<212> TYPE: DNA
<213> ORGANISM: Artificial Sequence
<220> FEATURE:
<223> OTHER INFORMATION: Synthetic polynucleotide

<400> SEQUENCE: 278 uuyggaaata atgtutggua ttuuttaguu uagtuaaatt gauauttaaa gtttaauuat 60 uauautgaga utauatuagu aguuygggtg uayggutgau tuagagtgag uuaattuuut 120 tuaauaaaau aaaaauutgu auaguygtuy gtaauuatgg ggaguauaut ggttttuaat 180 uagagguaaa uuaggauttt tgaagataaa tuuagtuuua ttaaguygga uatutggaaa 240 gaaguaggat auatttgtgt gaaagaggau agagaaguag gtggutagag uatyguuauu 300

<210> SEQ ID NO 279
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 279 ggttttgggt gtggauatuu tggagggutg ttttagtguu uauauuaatg uuutagttaa 60 agaauuauuu tgtuuuutta guuttutgua ggauaggtgg gaaaggguyg ggtgtutggt 120 uutgutguua ggggauagtg uaggtgtgau ygtuygggua gagatgagtu auuutuuaua 180 utgtuttgut guuygtutuu ayguutagtt ttagutygtg tggtuaagaa ggggygattu 240 utuauutaga auauatgggt uauaaatgut auutttgaaa atggaaauaa aaataauuua 300

<210> SEQ ID NO 280
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 280 tgggttattt ttgtttuuat tttuaaaggt aguatttgtg auuuatgtgt tutaggtgag 60 gaatyguuuu ttuttgauua uaygagutaa aautaggygt ggagaygggu aguaagauag 120 tgtggagggt gautuatutu tguuyggayg gtuauauutg uautgtuuuu tgguaguagg 180 auuagauauu ygguuutttu uuauutgtuu tguagaaggu taaggggaua gggtggttut 240 ttaautaggg uattggtgtg gguautaaaa uaguuutuua ggatgtuuau auuuaaaauu 300

<210> SEQ ID NO 281
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 281 uagaauutga gygatgaagt gaygggattt agtuagguut atgaagagtu aatgguautt 60 guutuuuata atuuttuuag tuuuattggu uaauuygtut gtuuutygyg tgatuttttt 120 ggatutgaag tggtgtttua ggauuyggag ygtgguutgu autguuttgt tutgtttgtt 180 tgtguauygg attuatygtg autuatuutg agtuatuuag guagtatgga agaautttgg 240 agttatttta aauuutttgg utuagaauuu uatttuttut agaattaaua tguaagataa 300

<210> SEQ ID NO 282

<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 282 ttatuttgua tgttaattut agaagaaatg gggttutgag uuaaagggtt taaaataaut 60 uuaaagttut tuuatautgu utggatgaut uaggatgagt uaygatgaat uyggtguaua 120 aauaaauaga auaagguagt guagguuayg utuygggtuu tgaaauauua uttuagatuu 180 aaaaagatua ygygagggau agaygggttg guuaatggga utggaaggat tatgggaggu 240 aagtguuatt gaututtuat agguutgaut aaatuuygtu auttuatygu tuaggttutg 300

<210> SEQ ID NO 283
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 283 gtuuuttggu auuaggauat uauuutuuua uututuuuag auuuttutuu ttgauututt 60 tagaguaguu atuuttggag ttgutuaayg uuututtutu ttutuuutut gaauuauagu 120 ttggutuatu tauttuyggg ttagutuaay guuututtut tttutuuutu tgaauuauag 180 uttggutuat utauttuygg gttagutuaa yguaututtu tuttutuuut utgaauuayg 240 guttggutua tutauttutg ggttaattta gguttutuu auagatagtu tgaaaaggga 300

<210> SEQ ID NO 284
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 284 tuuuttttua gautatutgt ggagaaaguu taaattaauu uagaagtaga tgaguuaagu 60 ygtggttuag agggagaaga gaagagtgyg ttgagutaau uyggaagtag atgaguuaag 120 utgtggttua gagggagaaa agaagagggy gttgagutaa uuyggaagta gatgaguuaa 180 gutgtggttu agagggagaa gagaagaggg ygttgaguaa utuuaaggat ggutgututa 240 aagaggtuaa ggagaagggt utgggagagg tgggagggtg atgtuutggt guuaagggau 300

<210> SEQ ID NO 285
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 285 utgagtuaau aaggutgaua aggutgtgtt utggatguag guuygguaga tgtttgaggg 60 ggaggtgguu aguutggagg uuutuaggag uaygggguutg gtgygggtgu ygagguuuat 120 gaaggtuaty gauutguygg gaggtggggu yguutttgtg atggaguatt tgaagatgaa 180 gaguttgagu aggtgagtgt gtgtgagauu uatatgygua uatgtgtaua gguagagaga 240 gautuagaga uaaauagaga gagauagaga aagggataga gatggggagg gagauagaaa 300

<210> SEQ ID NO 286
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 286 tttutgtutu uutuuuuatu tutatuuutt tututgtutu tututgtttg tututgagtu 60 tutututguu tgtauauatg tgyguatatg ggtutuauau auautuauut gutuaagutu 120 ttuatuttua aatgutuuat uauaaaggyg guuuuauutu uygguaggty gatgauuttu 180 atggguutyg guauuyguau uagguuygtg utuutgaggg uutuuaggut gguuauutuu 240 uuutuaaaua tutguygggu utguatuuag aauauaguut tgtuaguutt gttgautuag 300

<210> SEQ ID NO 287
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 287 ttygtguaut utgygguygy ggygguagua guygygygyg ygguuagutu uuyggtutay 60 gtguuuauua uuygygtggg ttuuatgutg uuygguutau ygtauuauut guaggggtyg 120 gguagtgggu uaguuaauua ygygggygy gygggygygu auuuyggutg guutuagguu 180 tygguygaua guuutuuata ygguagygga ggygygygyg utggygygyg gguygygggg 240 uutggygygy utggutuagu ygygygyguay gtutygygy guttuuuuta ututuuuagu 300

<210> SEQ ID NO 288
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 288 gutgggagag taggggaagy gyguygagay gtgyguygyg gutgaguuag yguyguuagg 60 uuuygygguu uyguyguuag uygyguyguu tuygutguyg tatggagggu tgtygguyga 120 gguutgaggu uaguyggggt gygyguuygy guyguuygyg tggttggutg guuuautguu 180 ygauuuutgu aggtggtayg gtagguyggg uaguatggaa uuuaygyggg tggtggguay 240 gtagauyggg gagutgguyg uyguygyggu tgutguyguy gygguyguag agtguaygaa 300

<210> SEQ ID NO 289
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 289 tutttgtgtg agtuatgtut tatatuuaau aagtautuaa aaaaagattt tttttttttt 60 tttttaagat ggagtgtygu tutgtuauuu aggutggagt guagtgguat gatuttggut 120 uautguaauu tutguutuuy gggttuaagy gattuttutg uutuaggutu utgagtagut 180 ggaattauag guatguuuua uuauauuygg utaattttta tatgtaatag aaauaaggtt 240 tuauuatgtt gguuagauag gtuttgaaut uutgauutua ggtgatuuau uuauutyggu 300

<210> SEQ ID NO 290
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 290 guygaggtgg gtggatuauu tgaggtuagg agttuaagau utgtutgguu aauatggtga 60 aauuttgttt utattauata taaaaattag uygggtgtgg tgggguatgu utgtaattuu 120 agutautuag gaguutgagg uagaagaaty guttgaauuy gggagguaga ggttguagtg 180 aguuaagatu atguuautgu autuuaguut gggtgauaga gygauautuu atuttaaaaa 240 aaaaaaaaaa aaatuttttt ttgagtautt gttggatata agauatgaut uauauaaaga 300

<210> SEQ ID NO 291
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 291 auuauuuuut gauuuutuat gautuauuua gutuutaagt guuuutgggu auuuagttut 60 ttgtgguatg gguyggtgua agtttutata tgagaguuag agagauaggg agggagguuy 120 gggutuutgg uuttttggga aaagatguuy gtutuagauu aguaaaagga gguagutgut 180 ttaggaguuy gggaaaatgu uatuautgat agtattatta ttattttuuu attttuuutt 240 tgtgttttta aaatgaaaag ttuagatuua tggggtaggg tagagtgggu utggagggag 300

<210> SEQ ID NO 292
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 292 tuuutuuagg uuuaututau uutauuuuat ggatutgaau ttttuatttt aaaaauauaa 60 agggaaaatg ggaaaataat aataatauta tuagtgatgg uattttuuyg ggutuutaaa 120 guagutguut uuttttgutg gtutgagayg gguatutttt uuuaaaaggu uaggaguuyg 180 gguutuuutu uutgtututu tggututuat atagaaautt guauygguuu atguuauaaa 240 gaautgggtg uuuaggggua uttaggagut gggtgagtua tgaggggtua gggggtggtt 300

<210> SEQ ID NO 293
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 293 guaguaygua guuuuuaggg guuutaautu auuuuututt uuutuauagg guttuuutgu 60 ygtuuagtgt tgggtgagaa aggtggaggg gauatgtagu uuyggatgga ggtguaguau 120 uaaygagaga gutuygguut gtgggaggga ygutuaggut taggtuaaag uuaggagutu 180 ygggaaauut gggttuaguy guuayguuuu ayggagggga uauauuuttu uutguutgat 240 gguaggguuu atggtagaua aaauuuatga uutuauutut uutggutuua gggutuaguu 300

<210> SEQ ID NO 294
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 294 ggutgaguuu tggaguuagg agaggtgagg tuatgggttt tgtutauuat ggguuutguu 60 atuagguagg gaagggtgtg tuuuutuygt ggggygtggy ggutgaauuu aggtttuuyg 120 gagutuutgg utttgauuta aguutgagyg tuuutuuuau agguyggagu tututygttg 180 gtgutguauu tuuatuyggg gutauatgtu uuutuuauut ttutuauuua auautggayg 240 guagggaagu uutgtgaggg aagagggggt gagttagggu uuutgggggu tgygtgutgu 300

<210> SEQ ID NO 295
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 295 atttutttut auutgtuatt gaagtgaatu atuagtataa gtagygagut gggyguattu 60 uttutuagtt gtgttaaaau ttgutggtat tuuuuyggta tuaguagagg tgtgtayggg 120 uautguttta aaautgggaa ggaggaagay gagguuaggg aguyggaggg tuauuaaggt 180 agatttuuag uagygutagt uuagutgaau autttuuagu uttgtttttu aguagutttg 240 aggaaaagta taggtaagaa uaaagauauu autgtatgtt tgutatatga atguataaua 300

<210> SEQ ID NO 296
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 296 gttatguatt uatataguaa auatauagtg gtgtutttgt tuttauutat autttuutu 60 aaagutgutg aaaaauaagg utggaaagtg ttuagutgga utagygutgu tggaaatuta 120 uuttggtgau uutuyggutu uutgguutyg tuttuutuut tuuuagtttt aaaguagtgu 180 uygtauauau ututgutgat auyggggaa tauuaguaag ttttaauaua autgagaagg 240 aatgyguuua gutygutaut tatautgatg attuauttua atgauaggta gaaagaaatg 300

<210> SEQ ID NO 297
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 297 attggtutgg tuututttut aauauutuuu auuygggatg uaguuaagag tggutguagu 60 utaattttut auatgtaaau aatgauutua gtgatguuua ygggguuuut ututgguutt 120 utuuuuutgg gaaaagautg agttutygay ggguatuuuu tuuuuutuyg gaauuaaggg 180 ututgggatg ttgauaguuu uyguuauutu tgagaagggu agguygtgga aaauuatutu 240 utuuuttuut tuuuuututg uutttuutag utgggguutu tguauaatgu agutggguua 300

<210> SEQ ID NO 298
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 298 tgguuuagut guattgtgua gagguuuuag utaggaaagg uagaggggga aggaagggag 60 gagatggttt tuuaygguut guuuttutua gaggtggygg gggutgtuaa uatuuuagag 120 uuuttggttu yggagggggа ggggatguuy gtygagaaut uagtuttttu uuagggggag 180 aagguuagag agggguuuyg tggguatuau tgaggtuatt gtttauatgt agaaaattag 240 gutguaguua ututtggutg uatuuygggt gggaggtgtt agaaagagga uuagauuaat 300

<210> SEQ ID NO 299
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 299 ttguuutuat utuuaggutt tggaggaggg taggtguutg guuaguagag tgguuautgu 60 tuautgguuu agaggaagua agguuauuag uutgatuuua uttutuuutu ygguuuatut 120 tuautuuuut utuutuaauu auaaguuuyg uuaaaataga gauuuuyggu tttgutuuuu 180 tgutguagga agggagaguu auyguuagau autguutguu tggtuutuut gttutgatut 240 uauuyggtgu ttggaatuaa agaggauutg guttuuutut ygggataygt gattttuttt 300

<210> SEQ ID NO 300
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 300 aagaaaatua ygtatuuyga gagggaaguu aggtuututt tgattuuaag uauygggtga 60 gatuagaaua ggaggauuag guagguagtg tutggyggtg gututuuutt uutguaguag 120 gggaguaaag uyggggtut utattttggy gggguttgtg gttgaggaga ggggagtgaa 180 gatggguygg agggagaagt gggatuaggu tggtgguutt guttuututg gguuagtgag 240 uagtgguuau tutgutgguu agguauutau uutuutuuaa aguutggaga tgaggguaag 300

<210> SEQ ID NO 301
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 301 guuuagatua gguagygggg tyguuututu uaggaututu aagguaguta aggutggagg 60 yguyggygag uutggagagg gaggagttua utaaattgtg ttggatggaa ggygtygagg 120 auyggaggaa ttaatuygat gtggggaagg yggaygggu taygaggaaa aaagaggggg 180 uaatgtauau tuaguutttt uatuautygg yggggagatg gatggttttu yggauygggy 240 gtuuuagygu uuyggttagu tatagggaga ygtuagagyg ututggtuyg ygatagaaga 300

<210> SEQ ID NO 302
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 302 tuttutatyg yggauuagag ygututgayg tutuuutata gutaauyggg gygutgggay 60 guuyggtuyg gaaaauuatu uatutuuuyg uygagtgatg aaaaggutga gtgtauattg 120 uuuuututtt tttuutygta guuuygtuyg uuttuuuuau atyggattaa ttuutuyggt 180 uutygayguu ttuuatuuaa uauaatttag tgaautuutu uututuuagg utyguyggyg 240 uutuuaguut tagutguutt gagagtuutg gagagggyga uuuygutguu tgatutgggu 300

<210> SEQ ID NO 303
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 303 atttgguttg atuttatttt taatattttt tauautttut ututaaagaa aaaaaaggyg 60 agtgaataty gtgatgggtg uagttatgut gaataattgg atgggaggay gtguuaggyg 120 atutuuaguu uutgggaguy ggayguuuay guutuuutut guutygttut uauagauaua 180 tttgtggggt gattaautua ggaattuatg utgutuaaag taautauagt ggtgagtgtt 240 ttgauyggtt tgatgtagaa atuaaggaaa auauuagaaa aatuaggggy ggagguuuaa 300

<210> SEQ ID NO 304
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 304 ttggguutuy guuuutgatt tttutggtgt tttuuttgat ttutauatua aauyggtuaa 60 aauautuauu autgtagtta utttgaguag uatgaattuu tgagttaatu auuuuauaaa 120 tgtgtutgtg agaaygaggu agagggaggy gtgggygtuy ggutuuuagg ggutggagat 180 yguutgguay gtuutuuuat uuaattattu aguataautg uauuuatuay gatattuaut 240 yguuttttt ttutttagag agaaagtgta aaaaatatta aaaataagat uaaguuaaat 300

<210> SEQ ID NO 305
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 305 tgauttttu atttututua agatgatuat taggagtggt ttuaauaaaa utgaauauag 60 aattttgagg guuuuaatua tgautuaauu agaguuutuu utgaattutt uatgagtuag 120 uuygguuutu uuuautgaut tuauuutagy ggguauutgt utttuttutt uttttatuau 180

```
tttttguttu tuttttggtt tuuagututg autgaattua gauuuaauau uttuuaattu    240

ttuuygguuu uutuagggaa auuuagaggu aaatttgagt guagggagyg gggguttygu    300


<210> SEQ ID NO 306
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 306

gygaaguuuu ygutuuutgu autuaaattt guututgggt ttuuutgagg ggguygggaa     60

gaattggaag gtgttgggtu tgaattuagt uagagutgga aauuaaaaga gaaguaaaaa    120

gtgataaaag aagaagaaag auaggtguuy gutagggtga agtuagtggg gaggguyggg    180

utgautuatg aagaattuag ggagggutut ggttgagtua tgattggggu uutuaaaatt    240

utgtgttuag ttttgttgaa auuautuuta atgatuatut tgagagaaat gaaaaagtua    300


<210> SEQ ID NO 307
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 307

ggtgtuagga gtgguuuagg agaguauuuy gttuuuyggu uyguaggtgg tgtttgutgg     60

utuuaguagg guuaggaggu uauutguagu utggtgutuu agautgatgt uauuyggguy    120

gagtgutgtg uutuygguaa uattgauauy guutggtuua auutuauuua uuyggggaau    180

aagatuaauu tuutyggutt uttgggguutt gtuuautguu ttuuutguaa aggtgagauu    240

tuagguuaga aguaggguag aygtutuagu tuaggauuag uuauaaauag tuatggtggt    300


<210> SEQ ID NO 308
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 308

auuauuatga utgtttgtgg utggtuutga gutgagaygt utguuutgut tutgguutga     60

ggtutuauut ttguagggaa gguagtggau aagguuuaag aaguygagga ggttgatutt    120

gttuuuyggg tgggtgaggt tggauuaggy ggtgtuaatg ttguyggagg uauaguauty    180

gguuygggtg auatuagtut ggaguauuag gutguaggtg guutuutggu uutgutggag    240

uuaguaaaua uuauutgygg guyggggaay ggggtgutut uutggguuau tuutgauauu    300


<210> SEQ ID NO 309
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 309

guaguuutut tuauutguut ggtgautuau tauaaguuut gggggaagga atgguagtgg     60

uuututtuau utttautguu tutgygguua uaatggguag ttgauataau uauutguagg    120

uuuygggagu uatygggguu tuttgauayg tgutuattag tgguttutga ggagyguutg    180
```

uuuuauutgu uuuaygtguu uuuaygtutg guuautuuag ggtuuattag ygutaatygg 240 uaaatguutg tgututuatu tauygggaaa auatutuuut tutuuagagy ggagguuagu 300

<210> SEQ ID NO 310
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 310 utgguutuyg ututggagaa gggagatgtt ttuuyggtag atgagaguau agguatttgu 60 ygattagygu taatggauuu tggagtgguu agaygtgggg guaygtgggg uaggtggggu 120 aggygutuut uagaaguuau taatgaguay gtgtuaagag guuuygatgg utuuyggggu 180 utguaggtgg ttatgtuaau tguuuattgt gguyguagag guagtaaagg tgaagagggu 240 uautguuatt uuttuuuuua gggguttgtag tgagtuauua gguaggtgaa gagggutgut 300

<210> SEQ ID NO 311
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 311 gtgguuutut tuauutttau tguututgyg guuauaatgg guagttgaua taauuauutg 60 uagguuuygg gaguuatygg gguututtga uaygtgutua ttagtggutt utgaggagyg 120 uutguuuuau utguuuuayg tguuuuuayg tutgguuaut uuagggtuua ttagygutaa 180 tygguaaatg uutgtgutut uatutauygg gaaaauatut uuuttutuua gagyggaggu 240 uaguutaaaa auuagguuyg uaguutuyga ggututgaaa auuaagyggu tgttutggtu 300

<210> SEQ ID NO 312
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 312 auuagaauag uyguttggtt ttuagaguut yggaggutgy ggguutggtt tttaggutgg 60 uutuygutut ggagaaggga gatgttttuu yggtagatga gaguauaggu atttguygat 120 tagygutaat ggauuutgga gtgguuagay gtgggggguay gtgggguagg tgggguaggy 180 gutuutuaga aguuautaat gaguaygtgt uaagagguuu ygatggutuu ygggguutgu 240 aggtggttat gtuaautguu uattgtgguy guagagguag taaaggtgaa gaggguuaut 300

<210> SEQ ID NO 313
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 313 atgggguuutg ggguyguygu utuagtgtut tutggtgutg uaguygggua ggguygaauu 60 utggyguaua guttuutgut gagtutuuut ututaaggut gtutgtgggy ggututguyg 120 guuuutuutg uauutguuua gguuutgggy ggaggutuut uutuuygggg gggutgtggu 180 utuaguauag auuaggggau agaaggtggu tuttuttggu uttggutggg tgtgaauuaa 240 agauttuutg taagaaatuu uuututuuut utuuutuutt ygutuuutua tutututuuu 300

<210> SEQ ID NO 314
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 314 gggagagaga tgagggagyg aaggagggag agggagaggg ggatttutta uaggaagtut 60 ttggttuaua uuuaguuaag guuaagaaga guuauuttut gtuuuutggt utgtgutgag 120 guuauaguuu uuuygggagg aggaguutuy guuuaggguu tggguaggtg uaggaggggu 180 ygguagaguy guuuauagau aguuttagag agggagautu aguaggaagu tgtgyguuag 240 ggttygguuu tguuyggutg uaguauuaga agauautgag gyggygguuu uaggguuuat 300

<210> SEQ ID NO 315
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 315 uautggauua tuuauauaau ttttgaggat uagtggaaat gaaaauaygg tguuuyggua 60 uaaaauatat ttuatagutt gggttaggua auaguaaagu atuaygutga gyguygggau 120 uttutgagtg uaggyggtgg gygaaguuuy gagtuauaua uauuuaygay guygguuutg 180 utuuuauagy gguuututgg ggtagygaut ggtattauut guatttuayg agggaggaaa 240 utgagguayg aautgttuag aagutguuut gaggtuauua agtgagutag gaagaggygt 300

<210> SEQ ID NO 316
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 316 yguututtuu tagutuautt ggtgauutua ggguaguttu tgaauagtty gtguutuagt 60 ttuutuuuty gtgaaatgua ggtaatauua gtygutauuu uagaggguyg utgtgggagu 120 aggguyggyg tygtgggtgt gtgtgautyg gggutttyguu uauyguutgu autuagaagg 180 tuuyggygut uagygtgatg utttgutgtt guutaauuua agutatgaaa tatgttttgt 240 guyggguau ygtgttttua tttuuautga tuutuaaaag ttgtgtggat ggtuuagtgt 300

<210> SEQ ID NO 317
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 317 utuuagtgtg uutuagttgg tttatutgta aaaatggggu uagguuayga utggtgttuu 60 utttauagag aaguautuua gguaggggtg ggtgggggtg gaautygttu tuaatgguuu 120 uygggauagu uutguaguua uyggtgauty gggttygtut gyggatuttt uuygguutuu 180 autuuattua gggauaguuu tguaatgggg utuuutuuua aaaaaaygua tgguuttuut 240 gtuuuuuaaa auuaguttaa ygguaguuat tuuutuuutu utuyggggu tgaaaaauua 300

<210> SEQ ID NO 318
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 318 ggtttttuag uuuuyggagg agggagggaa tggutguygt taagutggtt ttgggggaua 60 ggaagguuat gygtttttt gggagggagu uuuattguag ggutgtuuut gaatggagtg 120 gagguyggga aagatuygua gaygaauuyg agtuauyggt ggutguaggg utgtuuyggg 180 gguuattgag aaygagttuu auuuuuauuu auuuutguut ggagtguttu tutgtaaagg 240 gaauauuagt ygtgguutgg uuuuattttt auagataaau uaautgaggu auautggagg 300

<210> SEQ ID NO 319
<211> LENGTH: 301
<212> TYPE: DNA
<213> ORGANISM: Artificial Sequence
<220> FEATURE:
<223> OTHER INFORMATION: Synthetic polynucleotide

<400> SEQUENCE: 319 uautuaygg utagutuygt uaggtgttga yggatgtuau tuaggtgtga gututguauu 60 tgagutuuuu uutguauaua gguaguuaua auuagtuagt guagaggtga guutgtgguu 120 agtgaggagu yggtgagtua auutuutuuy guutaygggu uutgagaygu yggutuygtg 180 aguttgyggg gtygagggyg uutatattaa guuaaggutg agguagtgau auauuututt 240 atggguutgu tutygutuuu tguttuattg tuutggtutu tuuututygt atggaggatu 300 a 301

<210> SEQ ID NO 320
<211> LENGTH: 301
<212> TYPE: DNA
<213> ORGANISM: Artificial Sequence
<220> FEATURE:
<223> OTHER INFORMATION: Synthetic polynucleotide

<400> SEQUENCE: 320 tgatuutuua taygagaggg agagauuagg auaatgaagu agggagygag aguagguuua 60 taagagggtg tgtuautguu tuaguuttgg uttaatatag gyguuutyga uuuyguaagu 120 tuayggaguy ggygtutuag gguuygtagg ygggaggagg ttgautuauy ggutuutuau 180 tgguuauagg utuauututg uautgautgg ttgtggutgu utgtgtguag gggggagutu 240 aggtguagag utuauauutg agtgauatuy gtuaauauut gayggaguta guuygtgagt 300 g 301

<210> SEQ ID NO 321
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 321 uuaggutguu tgggttttgg tutuuauuat gutaguttgg tgtuygauut gtgttgagau 60 uutuuutguu tutgguuygg gtgtuuuatu uaaguaatgg auaggttgga auaggygtty 120 gtagggaayg ggutgaaygu uygyggutuu ygygatgtut ygygatauta uutuuutygu 180 uuuygutuau ttaaggauyg gaagtaguaa aguuyguygt ygyguuuuuy guuuygygtu 240 tuuutggtaa uuaguututu uuuttuuuty guuuataagg aguaagyggu auaaatyggg 300

<210> SEQ ID NO 322
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 322 uuygatttgt guyguttgut uuttatgggy gagggaaggg gagaggutgg ttauuaggga 60 gaygygggy gggggygyg ayggygggut ttgutauttu yggtuuttaa gtgagygggg 120 gygagggagg tagtatygyg agauatygyg ggaguygygg gygttuaguu ygttuuutay 180 gaayguutgt tuuaauutgt uuattguttg gatgggauau uyggguuaga gguagggagg 240 gtutuaauau aggtyggaua uuaagutagu atggtggaga uuaaaauuua gguaguutgg 300

<210> SEQ ID NO 323
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 323 uaatgguutu tttuttuagu utyggtgggy gtggutgggg gaauuuuagg gygggygggg 60 gguagggggt ggtgutgagt uauuuaguut gguuaggtuu utguutguua guuuuutguu 120 uuuauyguta uaguuyguuu yggatutayg agguuuaguu aguuauutut ggautuutga 180 gauygaattg uaaautguuy gggguutgguu ttgaautuut gutgtttagg gauuaagtuu 240 tgtggutuuu agggggguau agtgatutut uaagutgagu tgguutuagg guututguau 300

<210> SEQ ID NO 324
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 324 tguagagguu utgagguuag utuaguttga gagatuautg tguuuuuutg ggaguuauag 60 gauttggtuu utaaauagua ggagttuaag guuagguuyg gguagtttgu aattyggtut 120 uaggagtuua gaggtggutg gutgggguuty gtagatuygg ggygggutgt agyggtgggg 180 guagggggut gguagguagg gauutgguua ggutgggtga utuaguauua uuuuutguuu 240 uuyguuyguu utggggttuu uuuaguuayg uuuauygagg utgaagaaag agguuattgt 300

<210> SEQ ID NO 325
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 325 auuutgtgua gggguutguat uuyggaaggu utuuauuagu uygaauutgg uuygtuyguu 60 utagatgggg uaatyggygt ttutuuyggg auaguutuut uuutgguutu utgguuutyg 120 tutguattga gagguttggu ututggtuyg uatgutguuu ttuuygtgut gtgguuttgu 180 aguuygguut utuuuutgut gtuuuuuttg gututgguut gguuuutggg uuuutgagtu 240 auuuutgagg tgautuagua gtuuttggaa ayguatguyg aggayguauu utguutgguu 300

<210> SEQ ID NO 326
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 326 guuagguagg gtgygtuuty gguatgygtt tuuaaggaut gutgagtuau utuaggggtg 60 autuaggggu uuagggguua gguuagaguu aagggggaua guaggggaga gguygggutg 120 uaagguuaua guaygggaag gguaguatgy ggauuagagg uuaaguutut uaatguagay 180 gaggguuagg agguuaggga ggaggutgtu uygggagaaa yguygattgu uuuatutagg 240 gyggaygggu uaggttyggg utggtggagg uuttuyggga tguagguuut guauagggtt 300

<210> SEQ ID NO 327
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 327 ggaauuattg ttutgutguu uauagutgyg tggagggatt uyggtuutyg ggttuagttg 60 gtgauagtgt ygggtagguu tggguaggtg ggagaggtyg tgaaguuutt tguaggguau 120 ttgguygutu atutgguaua ggggaagagg yguaguuygt gguuygguag tuuaggauut 180 gutgttuuut tuutauuygg ggyggggguut gtgggaagat atggaagtyg ggtgaatgag 240 uygtguuuag tgattttaaa aaguagatta aaataauata gaaaatgtua gagutuattg 300

<210> SEQ ID NO 328
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 328 uaatgagutu tgauattttu tatgttattt taatutgutt tttaaaatua utggguaygg 60 utuattuauu ygauttuuat atuttuuuau agguuuyguu uygggtagga agggaauagu 120 aggtuutgga utguyggguu aygggutgyg uututtuuuu tgtguuagat gagygguuaa 180 gtguuutgua aaggguttua ygauututuu uauutguuua gguutauuyg auautgtuau 240 uaautgaauu ygaggauygg aatuuutuua yguagutgtg gguaguagaa uaatggttuu 300

<210> SEQ ID NO 329
<211> LENGTH: 300
<212> TYPE: DNA
<213> ORGANISM: Artificial Sequence
<220> FEATURE:

<223> OTHER INFORMATION: Synthetic polynucleotide

<400> SEQUENCE: 329 guatuutuau utgygtuyga agyguagatg gaguuuaagg gaaagguuut gtagaggauu 60 uygtgtgaut tgggguaaag ygtgguutuu uaggggtgyg tggguagygg gayguuuatg 120 gtgtgauygg gtttgtguut uuatagggau ygtutguuut gtguagagag uuuutgtggg 180 gygggaagtg gygaguaguy gguaaggagg uuuaguuaga uagaaguagg ggggtuaggg 240 auatgggagg tgggggauua guuagtgagt uagaygtgag gauttuagtg uuaaggautg 300

<210> SEQ ID NO 330
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 330 uagtuuttgg uautgaagtu utuaygtutg autuautggu tggtuuuuua uutuuuatgt 60 uuutgauuuu uutguttutg tutggutggg uutuuttguy ggutgutygu uauttuuygu 120 uuuauagggg utututguau aggguagayg gtuuutatgg agguauaaau uyggtuauau 180 uatgggygtu uygutguuua yguauuuutg ggagguuayg utttguuuua agtuauaygg 240 ggtuututau aggguutttu uuttgggutu uatutgygut tyggayguag gtgaggatgu 300

<210> SEQ ID NO 331
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 331 aggttuuuua tuutagutuu uyggatutuu atagggagtg tuuagggauu utuaatutuu 60 aggguuautt utguaggagu tygggttyga ggttuuaygt gguuagaaga gutuaggtut 120 utgagggutg gtgtguuygg gtauuuatuy guatuautgu tutuutuutg tuyggutayg 180 uuuagggutg agtgayggtg gtgguaagtg uttgtuutua ggguagygag gtuttutgtt 240 utgauaguag uagggautuu ttuatgguua uuagtaauuu uagtgggygg aggygutuut 300

<210> SEQ ID NO 332
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 332 aggagyguut uyguuuautg gggttautgg tgguuatgaa ggagtuuutg utgutgtuag 60 aauagaagau utygutguuu tgaggauaag uauttguuau uauygtuaut uaguuutggg 120 ygtaguygga uaggaggaga guagtgatgy ggatgggtau uyggguauau uaguuutuag 180 agauutgagu tuttutgguu aygtggaauu tygaauuyga gutuutguag aagtgguuut 240 ggagattgag ggtuuutgga uautuuutat ggagatuygg ggagutagga tggggaauut 300

<210> SEQ ID NO 333
<211> LENGTH: 300
<212> TYPE: DNA
<213> ORGANISM: Artificial Sequence <220> FEATURE:
<223> OTHER INFORMATION: Synthetic polynucleotide

<400> SEQUENCE: 333 tuuttuuttu tttuuttutt tututututt ttutttuttt tuttttuttt tututtuttt 60 uattttgaga ygtaututgg ututgtyguu uaggutggag yguaatggyg uuatutyggy 120 guautguaau utuuauutuu ygggttuaag ygattutaut guutuaguut uuygagtagu 180 tgggautaua ggygyguaut auuaaguuyg gutaattttt ttttgtattt ttagtagaga 240 utgggtttua ygatgttggu ygggutggtu tggaagtutt gauutuaagy gtgyguuutu 300

<210> SEQ ID NO 334
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 334 gagggyguay guttgaggtu aagauttuua gauuaguuyg guuaauatyg tgaaauuuag 60 tututautaa aaatauaaaa aaaaattagu ygggguttggt agtgygyguu tgtagtuuua 120 gutautyggg aggutgaggu agtagaatyg uttgaauuyg ggaggtggag gttguagtgy 180 guygagatgg yguuattgyg utuuaguutg ggygauagag uuagagtayg tutuaaaatg 240 aaagaagaga aaagaaaaga aaagaaagaa aagagagaga aagaaggaaa gaaggaagga 300

<210> SEQ ID NO 335
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 335 agguututgu tgauutgtag aauttgttga uuyggatttt gatgtuagtu tuattggguu 60 tguygttgut uttuttggga uagaagatut utttgatuyg guuaattygg tagggutuag 120 gggguatuuag gttgutguut ttgatgtagt yggagtattt uyggtagtgu tutgggtaua 180 ggtuutuatu uaygggutuu ttuygtgggy gtttuayggg autggauagu ttgatgutgu 240 agagaaguau uuauttgaua tuaatgaauu ttuuauuttg uagtggtuag tuagguatga 300

<210> SEQ ID NO 336
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 336 tuatguutga utgauuautg uaaggtggaa ggttuattga tgtuaagtgg gtguttutut 60 guaguatuaa gutgtuuagt uuygtgaaay guuuayggaa ggaguuygtg gatgaggauu 120 tgtauuuaga guautauygg aaatautuyg autauatuaa agguaguaau utggatguuu 180 utgaguuuta uygaattggu yggatuaaag agatuttutg tuuuaagaag aguaayggua 240 gguuuaatga gautgauatu aaaatuyggg tuaauaagtt utauaggtua guagagguut 300

<210> SEQ ID NO 337
<211> LENGTH: 300
<212> TYPE: DNA

<213> ORGANISM: Artificial Sequence
<220> FEATURE:
<223> OTHER INFORMATION: Synthetic polynucleotide

<400> SEQUENCE: 337 ggggyggggt tygguygggg gyggygguag gauutgagua guuaggaggg utgggggaua 60 gtuaggtuag guyggtggut auuygguygu tggagagggu yggatgguay gtgguauuaa 120 guaaaaggag gutgaguuag aaaguaggga yggggutaga ygaguaaagu tggguaggag 180 ggygagttgg gagggguyga guyggutgtg ygtggtuuut tgggaggagg gggtgtgguu 240 aaguaaguua aauagttygg aggtuagtgu aaggauaaga uaguutgggu aaaygaguag 300

<210> SEQ ID NO 338
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 338 utgutygttt guuuaggutg tuttgtuutt guautgauut uygaautgtt tgguttgutt 60 gguuauauuu uutuutuuua agggauuayg uauaguyggu tygguuuutu uuaautyguu 120 utuutguuua gutttgutyg tutaguuuyg tuuutguttt utggutuagu utuuttttgu 180 ttggtguuay gtguuatuyg guuututuua gygguygggt aguuauyggu utgauutgau 240 tgtuuuuuag uuutuutggu tgutuaggtu utguyguygu uuuygguyga auuuyguuuu 300

<210> SEQ ID NO 339
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 339 ygagttggga gggguygagu yggutgtgyg tggtuuuttg ggaggagggg gtgtgguuaa 60 guaaguuaaa uagttyggag gtuagtguaa ggauaagaua guutggguaa aygaguaggg 120 gyggagygtg agaguagaut guauyggaty gutuagguua guuuaagutg aagaggaagg 180 gguaagutuu agaaguaggg gyggggguyga uuaauutygu agatutgutg ggygaagagu 240 aguagutggg uuaguuygat gutgtguygg gguaggtagt utyggaggut guuuaggggu 300

<210> SEQ ID NO 340
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 340 uuuutgggua guutuygaga utauutguuu ygguauagua tygggutggu uuagutgutg 60 ututtyguuu aguagatutg ygaggttggt ygguuuyguu uutguttutg gaguttguuu 120 uttuututtu aguttgggut gguutgagyg atuyggtgua gtutgututu aygutuyguu 180 uutgutygtt tguuuaggut gtuttgtuut tguautgauu tuygaautgt ttgguttgut 240 tgguuauauu uuutuutuuu aagggauuay guauaguygg utygguuuut uuuaautygu 300

<210> SEQ ID NO 341
<211> LENGTH: 300

<212> TYPE: DNA
<213> ORGANISM: Artificial Sequence
<220> FEATURE:
<223> OTHER INFORMATION: Synthetic polynucleotide

<400> SEQUENCE: 341 aauagguuua aguutgtggu aggtgggggt uauuuaguuu aggyguttuu uauuuuyggg 60 uutggguuag aaguuuagga gutggutgyg gguyggttut uuuuuauuua ututggggat 120 guutuagguu tgggtttuyg uuttaguuty guuagguuuu aatgaguutu tgtttgguut 180 gtagtuaatt gauyggttgg auttggggua ggtgutygag gaguuuuaut gagggagggu 240 aggtututtg tgygtautgt uuaguauata uaggaaattt aguatttutg uuuauuuagu 300

<210> SEQ ID NO 342
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 342 gutgggtggg uagaaatgut aaatttuutg tatgtgutgg auagtaygua uaagagauut 60 guuutuuutu agtggggutu utygaguauu tguuuuaagt uuaauyggtu aattgautau 120 agguuaaaua gaggutuatt gggguutggy gaggutaagg yggaaauuua gguutgaggu 180 atuuuuagag tgggtggggg agaauygguu yguaguuagu tuutgggutt utgguuuagg 240 uuyggggggtg ggaagyguut gggutgggtg auuuuuauut guuauaggut tggguutgtt 300

<210> SEQ ID NO 343
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 343 uutgauuuau uuaaututuu uaggggaygt ggggguautg gaguuuuaua uyguaggygg 60 tagutuaatg uauuygygty ggagttuutu uuuygygagy gtgguaaggu tuagggaagt 120 uuyggguuuu tggggagggg guuttguygy guatuutgty guaggaauyg uyggguuutt 180 uuttuygygg gaagyggutt gguygauuuu yguuuuyguu yggguututt gggggtttuy 240 ggtguuyggu uauygtgggg utggggautg aaagtgatgg gautgaagat ggggutggaa 300

<210> SEQ ID NO 344
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 344 ttuuaguuuu atuttuagtu uuatuauttt uagtuuuuag uuuuayggtg guyggguauy 60 ggaaauuuuu aagagguuyg ggyggggyg ggggtygguu aaguyguttu uygyggaagg 120 aaggguuygg yggttuutgy gauaggatgy gygguaaggu uuuutuuuua gggguuyggg 180 auttuuutga guuttguuay gutygygggg gaggaautuy gaygygggtg uattgaguta 240 uyguutgygg tgtggggutu uagtguuuuu aygtuuuutg ggagagttgg gtgggtuagg 300

<210> SEQ ID NO 345

<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 345 tatuuaaatg tgttttatat aaaatgaaty gttttuagtg uautgaggaa gttttutatt 60 taaagaaatu utgutgtgaa ututtttgtg aagaatgutt tuutaatgga attagtuauu 120 autgagtuat ttutguaaau ttuaggtttg yggttttguu taaguaagat utgguyggag 180 aagtgagata aattatagat gtygutaata aattauagat tautuaaagg uaaaagagga 240 aagaaaaaaa aaaattgaut ygtgtatatg aauygaattg agtuaggggt utuuauyggu 300

<210> SEQ ID NO 346
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 346 guyggtggag auuuutgaut uaattyggtt uatatauayg agtuaatttt tttttttutt 60 tuututtttg uutttgagta atutgtaatt tattagygau atutataatt tatutuautt 120 utuygguuag atuttgutta gguaaaauyg uaaauutgaa gtttguagaa atgautuagt 180 ggtgautaat tuuattagga aaguattutt uauaaaagag ttuauaguag gatttuttta 240 aatagaaaau ttuutuagtg uautgaaaay gattuatttt atataaaaua uatttggata 300

<210> SEQ ID NO 347
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 347 tgggagttuu agttyggggg uagauuagtg ttuagagtuy gggututgut autuagyguu 60 ygagguagyg uutuuuuatt uaayggggu ygtgguaatt uuutgauatg attuatgauu 120 auataataua tuyggaaaut tututuuauy guutuuygtu tggguygtyg uuuuygguut 180 gggagautuu aggtutuaga gtututguuu uuaygggyga tuagtgutgu uuagtggaaa 240 aataatguua guygyguauu aaaattaggt gtaaaattaa uatttttgg aaguuauttt 300

<210> SEQ ID NO 348
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 348 aagtgguttu uaaaaaatgt taattttaua uutaattttg gtgygyggut gguattattt 60 ttuuautggg uaguautgat yguuygtggg gguagagaut utgagauutg gagtutuuua 120 gguyggggy gaygguuuag aygggaggyg gtggagagaa gtttuyggat gtattatgtg 180 gtuatgaatu atgtuaggga attguuaygg uuuuygttga atggggaggy gutguutygg 240 gygutgagta guagaguuyg gaututgaau autggtutgu uuuygaautg gaautuuuat 300

<210> SEQ ID NO 349
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 349 yggygtgutt uttgguaaau atutuuttga ggatguygut guaguauttg agutgutuyg 60 agauuttgut gututtutut ggtgutgggt gutgutgaga gtygggguayg tuuttutttg 120 gaggtttuau agguyggutg ututuuyguy gutgguuuag uttggtggtu ttgggutuyg 180 gggguagyga gggtggutyg tgaatggggt uaatggtggt gggggtggtg gtgtutgutt 240 tuututtuau tuuuttuttt gtutguuaag aauayggayg uuaauaggua uagtuagaag 300

<210> SEQ ID NO 350
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 350 uttutgautg tguutgttgg ygtuygtgtt uttgguagau aaagaaggga gtgaagagga 60 aaguagauau uauuauuuuu auuauuattg auuuuattua ygaguuauuu tygutguuuu 120 yggaguuuaa gauuauuaag utgggguuagy ggygggagag uaguygguut gtgaaauutu 180 uaaagaagga ygtguuygau tutuaguagu auuuaguauu agagaagagu aguaaggtut 240 yggaguagut uaagtgutgu agygguatuu tuaaggagat gtttguuaag aaguayguyg 300

<210> SEQ ID NO 351
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 351 tggtutgutt uaagtuutau utgguuuutg guaagtuuua uttggtgaua tuttgtguut 60 gggtuuttga gggutguuuu agatuygyga ttgtuutggg gauyggtagt tuutuuuygg 120 atguuaguaa agutuuutuu aguutuuayg uutguauagt utuuagtatg uuttuaauag 180 uuattagtua uuututgtga gtuagauuuu yggtuutguu agguuaauut guttgggguu 240 tuaguagygg gggutggyga gguuagtttt utuuagyggt tutaaguygu tygagggtgg 300

<210> SEQ ID NO 352
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 352 uauuutygag yggguttagaa uygutggaga aaautgguut yguuaguuuu ygutgutgag 60 guuuuaagua ggttgguutg guaggauygg gggtutgaut uauagagggt gautaatggu 120 tgttgaaggu atautggaga utgtguaggy gtggaggutg gagggagutt tgutgguatu 180 yggggaggaa utauyggtuu uuaggauaat ygyggatutg gggguaguuut uaaggauuua 240 gguauaagat gtuauuaagt gggauttguu agggguuagg taggauttga aguagauuag 300

<210> SEQ ID NO 353
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 353 auutggtygg uuauygguag utyggggaag aagggygygt ggygyguuua utuuayggtg 60 utgaagagua guygyguygu uagutyguau aygttgtyga tguuuaguau ygyguuyguy 120 gyguyguuuu utgyguygaa gygtuygguy guyguagggt agggutuagy gyguaguagu 180 tgygygatua gttyggauau yggutguuuy gggaagaggt utuyguygut yguuautguy 240 guuagyguyg aguuyggggg gutguuygag gaggygguua ygguauuagg uagygagtgu 300

<210> SEQ ID NO 354
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 354 guautygutg uutggtguyg tgguyguutu utyggguagu uuuuygggut yggygutggy 60 gguagtggyg agyggyggag auututtuuy gggguaguyg gtgtuygaau tgatygygua 120 gutgutgygy gutgaguuut auuutgyggy gguyggaygu ttyggyguag ggggyggygy 180 ggygggygyg gtgutgggua tygauaaygt gtgygagutg gyggygyggu tgututtuag 240 uauygtggag tgggygygguu aygyguuutt uttuuuygag utguyggtgg uygauuaggt 300

<210> SEQ ID NO 355
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 355 tgguagagat auaaattuut gatgguagag gagggagaga gagtgtgggt gaygatgaua 60 attgaautga gauuuaaagg aggtagggga gauatatggg ygtututggg aagatggtuu 120 uygggaaagu auaguuttta gauagguuuy gagguaggag uutgtutgau tuauyggagg 180 aguttggagg aggutgaggt gguutaagty gattaaguag ggtggggagg gaagaggyga 240 tggtguygtg agauuaagua ggguuttgag gtutgggggg agaautttgg uttttautut 300

<210> SEQ ID NO 356
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 356 gagtaaaagu uaaagttutu uuuuuagauu tuaagguuut guttggtutu aygguauuat 60 yguututtuu utuuuuauuu tguttaatyg auttagguua uutuaguutu utuuaagutu 120 utuyggtgag tuagauaggu tuutguutyg gggguutgtut aaaggutgtg utttuuyggg 180 gauuatuttu uuagagaygu uuatatgtut uuuutauutu utttgggtut uagttuaatt 240 gtuatygtua uuuauautut ututuuutuu tutguuatua ggaatttgta tututguuag 300

<210> SEQ ID NO 357
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 357 agaggaggga gagagagtgt gggtgaygat gauaattgaa utgagauuua aaggaggtag 60 gggagauata tgggygtutu tgggaagatg gtuuuyggga aaguauaguu tttagauagg 120 uuuygaggua ggaguutgtu tgautuauyg gaggaguttg gaggaggutg aggtgguuta 180 agtygattaa guagggtggg gagggaagag gygatggtgu ygtgagauua aguaggguut 240 tgaggtutgg ggggagaaut ttggutttta ututgaggaa ggtgggaguu auagaggutt 300

<210> SEQ ID NO 358
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 358 aguututgtg gutuuuauut tuutuagagt aaaaguuaaa gttutuuuuu uagauutuaa 60 gguuutgutt ggtutuaygg uauuatyguu tuttuuutuu uuauuutgut taatygautt 120 agguuauutu aguutuutuu aagutuutuy ggtgagtuag auaggutuut guutyggggu 180 utgtutaaag gutgtguttt uuyggggauu atuttuuuag agayguuuat atgtutuuuu 240 tauutuuttt gggtutuagt tuaattgtua tygtuauuua uautututut uuutuututg 300

<210> SEQ ID NO 359
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 359 tgggygtutu tgggaagatg gtuuuyggga aaguauaguu tttagauagg uuuygaggua 60 ggaguutgtu tgautuauyg gaggaguttg gaggaggutg aggtgguuta agtygattaa 120 guagggtggg gagggaagag gygatggtgu ygtgagauua aguaggguut tgaggtutgg 180 ggggagaaut ttggutttta ututgaggaa ggtgggaguu auagaggutt utagauagaa 240 gaaggauaag uyggautuag gatauuaggg tgggggtatu tgtgggggat aaagggagaa 300

<210> SEQ ID NO 360
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 360 ttutuuuttt atuuuuuaua gatauuuuua uuutggtatu utgagtuygg uttgtuuttu 60 ttutgtutag aaguututgt ggutuuuauu ttuutuagag taaaaguuaa agttutuuuu 120 uuagauutua agguuutgut tggtutuayg guauuatygu ututtuuutu uuuauuutgu 180 ttaatygaut tagguuauut uaguutuutu uaagutuutu yggtgagtua gauaggutuu 240 tguutygggg uutgtutaaa ggutgtgutt tuuyggggau uatuttuuua gagayguuua 300

<210> SEQ ID NO 361
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 361 ggutttgtga aauuaauuag gaagaatgaa auauagagut ggtuygauau uuagutygag 60 ggagggggu yggaaguttu tggaagttgg utguuuutaa guaggguua ututaguuua 120 uaagguuaag ttgguagagg uagaygaggg gaututgygg utuaagtuay gggguaggag 180 uuyguagutg uygggutgga aaggtuagag uyggututgy gtutggutgy guygguaaga 240 aguuauaatt ayguagguaa aagaguuygg ggattaguuu uaguauutgg gauuutgaat 300

<210> SEQ ID NO 362
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 362 attuagggtu uuaggtgutg gggutaatuu uygggututt ttguutgygt aattgtggut 60 tuttguyggy guaguuagay guagaguygg ututgauutt tuuaguuygg uagutgyggg 120 utuutgguuy gtgauttgag uyguagagtu uuutygtutg uututguuaa uttgguuttg 180 tgggutagag tgguuuutgu ttagggguag uuaauttuua gaaguttuyg guuuuuutuu 240 utygagutgg gtgtyggauu agututgtgt ttuattuttu utggttggtt tuauaaaguu 300

<210> SEQ ID NO 363
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 363 aggutgaayg gaattgggag uagaguuutg yggtaggaua gagauttygu aaaguuygga 60 guauauagua guauuuygtu ttutaaagga uaattttggg aaaaututtg uutaatattu 120 tgguautaag gatuattutg tuauatuuuy gututggaut auaaguutgu aaguuuuatu 180 ygggguaggg utuutuattu utgtguauyg tggaaguuut gtguutguuu aggguutggu 240 auttgtaygt auttgaaaau utygtgtgga gtaaagagag gggtgatgtg uaaagguutt 300

<210> SEQ ID NO 364
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 364 aagguutttg uauatuauuu utututttau tuuauaygag gttttuaagt aygtauaagt 60 guuagguuut ggguagguau aggguttuua yggtguauag gaatgaggag uuutguuuyg 120 gatggggutt guagguttgt agtuuagagy ggggatgtga uagaatgatu uttagtguua 180 gaatattagg uaagagtttt uuuaaaattg tuutttagaa gayggggtgu tgutgtgtgu 240 tuyggguttt gygaagtutu tgtuutauyg uagggututg utuuuaattu ygttuaguut 300

<210> SEQ ID NO 365
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 365 aguuagguta aauuagygtg tuuuaatgag gggguuutggg utgagtggag gaaatgggtg 60 yggtggaggt gggtttggut ggguauagyg gguaygtgtg ggtaagyggg tgggguyggt 120 tgtgygggtg guutatutgg gguaaguagu ygagguygau tgtgtuyggy gtgtggttga 180 guayggguag gtgtutggyg gtgauuutgu aygtutggtg tttauutggu uutgggtutg 240 aygtgggguyg yguutggutg utggygggau agtgtgttat utguutgygg ayguttuygg 300

<210> SEQ ID NO 366
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 366 uyggaagygt uyguagguag ataauauaut gtuuyguuag uaguuaggyg ygguuuaygt 60 uagauuuagg guuaggtaaa uauuagaygt guagggtuau yguuagauau utguuygtgu 120 tuaauuauay guyggauaua gtygguutyg gutguttguu uuagataggu uauuyguaua 180 auygguuuua uuyguttauu uauaygtguu ygutgtguuu aguuaaauuu auutuuauyg 240 uauuuatttu utuuautuag uuuaggguuu utuattggga uaygutggtt taguutggut 300

<210> SEQ ID NO 367
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 367 uuttggutua ggttggggag ggygtuatga gtuatgaggt gggygttgua tttgtuagtt 60 gtguaguygy guauuauyga gtagtutggy gguagygygt uygygttyga ttgygtutgg 120 uuyguaggag guuyggtuua guaguuuttu yguauuaggg tuauyggygy gygatauuut 180 gggggyggga tyggggutyg tgututgutt uuygaaauuu ttutuuutuu agtutuagyg 240 ttuttuutuu tuuututatu utttuauttt uauutauauu tuutuuuutu uutuuttuuu 300

<210> SEQ ID NO 368
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 368 gggaaggagg gaggggagga ggtgtaggtg aaagtgaaag gatagaggga ggaggaagaa 60 ygutgagaut ggagggagaa gggtttyggg aaguagagua ygaguuuyga tuuyguuuuu 120 agggtatygy gyguyggtga uuutggtgyg gaagggutgu tggauygggu utuutgyggg 180 uuagayguaa tygaaygygg aygygutguy guuagautau tyggtggtgy gyggutguau 240 aautgauaaa tguaayguuu auutuatgau tuatgayguu utuuuuaauu tgaguuaagg 300

<210> SEQ ID NO 369
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 369 uaggutggag tguaatggyg ygatutyggu tuautguaau ttutguutut ygggttuaag 60 uaattuttut auuttaguut uutgagtagu tgggattaua ggtauutguy guuatguuyg 120 gutaattttt taatttgttt ttagtagaga ygggggtttua uuatgttggu uagguyggtu 180 tauaautuut gatutuaggt gatutauuyg uutygguutu uuaaattaua ggtgttatua 240 ttaggattut tgguagauag gagtgttgta ggggatggaa gtggatagta ggaggututg 300

<210> SEQ ID NO 370
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 370 uagaguutuu tautatuuau ttuuatuuuu tauaauautu utgtutguua agaatuutaa 60 tgataauauu tgtaatttgg gagguygagg ygggtagatu auutgagatu aggagttgta 120 gauygguutg guuaauatgg tgaaauuuyg tututautaa aaauaaatta aaaaattagu 180 yggguatggy gguaggtauu tgtaatuuua gutautuagg aggutaaggt agaagaattg 240 uttgaauuyg agagguagaa gttguagtga guygagatyg yguuattgua utuuaguutg 300

<210> SEQ ID NO 371
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 371 tgaatgauut ggguaguatt tutuuauutg yguttguatt tgutagauag tutgtgautu 60 tutgtgggag aaaauauaag aaauygguuu ututgutggt tuuuuauutg guutggutut 120 uutgttutuu auuutguaua utuatguuty ggaauutgut tutuututga guutuuutua 180 uagtgguuyg guuuaygtgg uutttaatut guuuauatua gaguutuuau utuygguuta 240 tgguuuatua gagguagutg gaguygggua tuutuuuuay gtggguuttt gaggatggga 300

<210> SEQ ID NO 372
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 372 tuuuatuutu aaagguuuay gtggggagga tguuyggutu uagutguutu tgatggguua 60 tagguyggag gtggaggutu tgatgtgggu agattaaagg uuaygtgggu yggguuautg 120 tgagggaggu tuagaggaga aguaggttuy gagguatgag tgtguagggt ggagaauagg 180 agaguuaggu uaggtgggga auuaguagag ggguyggttt uttgtgtttt utuuuauaga 240 gagtuauaga utgtutagua aatguaagyg uaggtggaga aatgutguuu aggtuattua 300

<210> SEQ ID NO 373
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 373 gggyggggguu tgtgyggtut gyggygygga guygagtggg utgyggggat gyggggggauu 60 agutgygtgg gyggyggygu ygagaguuuy ggaggygygg ggutgagyga ggguuygygg 120 gggygutggu tgyguttggu tuyggtatgy guutauttuu tutgygtuty gutagutguy 180 gtgutgutyg uygtgtauta yggtutuatu tgggtauuua ygyggtutuu ygygguauuy 240 guyggguuuau aguuuagygy guygtuuuut uygtgtgutg uuyguuyggg ygtguyguut 300

<210> SEQ ID NO 374
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 374 aggygguayg uuygggyggg uaguauaygg aggggayggy gygutgggut gtggguyggy 60 gggtguygyg ggagauygyg tgggtauuua gatgagauyg tagtauaygg ygaguaguay 120 gguagutagy gagayguaga ggaagtaggy guatauygga guuaagygua guuagyguuu 180 uygygggguuu tygutuaguu uygyguutuy ggggututyg gyguyguygu uuayguagut 240 ggtuuuuygu atuuuyguag uuuautyggu tuygyguygu agauyguaua gguuuyguuu 300

<210> SEQ ID NO 375
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 375 aagtgtattt tuaaggtatg agggguuuag aggauautgt uuuaaaagua gtggttgtga 60 gagtgguttt ggagtuaggu tgauagtutg gaaauttuua ggtuygutut gaagtguygg 120 utguatgauu aguuutuuag uutgtgtuyg uttygguutt utttgtguaa gtgagaguat 180 tgutgatuuu uuyggggtgg ygagggggyg uaygtuagtg auutyguatg gtguutguua 240 gguaygtggt uygtgtttua tgattutttg agagutttgg aguagutuua agaagautut 300

<210> SEQ ID NO 376
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 376 gagtuttutt ggagutgutu uaaagututu aaagaatuat gaaauaygga uuaygtguut 60 gguagguauu atgygaggtu autgaygtgy guuuuutygu uauuuygggg ggatuaguaa 120 tgututuaut tguauaaaga agguygaagy ggauauaggu tggagggutg gtuatguagu 180 ygguauttua gagyggauut ggaagtttuu agautgtuag uutgautuua aaguuautut 240 uauaauuaut gutttggga uagtgtuutu tggguuuutu atauuttgaa aatauauttt 300

<210> SEQ ID NO 377
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 377 taattttaaa uaaaaututu uatgaguaau taaatattta aaatgtgttt ttuuataaaa 60 gtgaatuagu tuagttutgu aggutgaaaa tauaauaagg aggatuyggg ttguagaaag 120 uagaggguua uutagauygt gtutgagaga yggggagaaa guagutgtut gutgtguauu 180 agagguutut agggauuuyg guaguaauuu ygtggygggu uauauttggg agutgatttg 240 ttttuagaau uauuagutaa guuauatgag uuaggaguut ggttatuuat tuaaaguuua 300

<210> SEQ ID NO 378
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 378 tgggutttga atggataauu aggutuutgg utuatgtggu ttagutggtg gttutgaaaa 60 uaaatuagut uuuaagtgtg guuyguuayg gggttgutgu yggggtuuut agagguutut 120 ggtguauagu agauagutgu tttutuuuyg tututuagau ayggtutagg tgguuututg 180 utttutguaa uuyggatuut uuttgttgta ttttuaguut guagaautga gutgattuau 240 ttttatggaa aaauauattt taaatattta gttgutuatg gagagttttg tttaaaatta 300

<210> SEQ ID NO 379
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 379 guutuuagau uygaaatuuu uuautgaagu uattuuuagg aggagggguu tuautggggu 60 utuaagguag uatuaguatt tuyggtgaua gguauaguaa tttatuagut uautggutut 120 utautgagaa uaagguaagu yggggguutgu ygagggtatg auagguaggg agtgatgggu 180 uygguuuagg guaggaggga gauagaaatg gguaggaaga ggaggutgtu uuuaguagua 240 uttutgagag gaggaguauu tttyggggau aututggayg guauuuuuaa guauaguuuu 300

<210> SEQ ID NO 380
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 380 ggggutgtgu ttgggggtgu ygtuuagagt gtuuuygaaa ggtgutuutu ututuagaag 60 tgutgutggg gauaguutuu tuttuutguu uatttutgtu tuuutuutgu uutggguygg 120 guuuatuaut uuutguutgt uatauuutyg guagguuuyg guttguuttg ttutuagtag 180 agaguuagtg agutgataaa ttgutgtguu tgtuauygga aatgutgatg utguuttgag 240 guuuuagtga gguuuutuut uutgggaatg guttuagtgg gggatttygg gtutggaggu 300

<210> SEQ ID NO 381
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 381 tgagaguagu uagauaygta gtgatuaggg aaagtygaaa gtguagatgg gttyguaaay 60 gtggaututu tagttttggg tutguagatg ggguygguua uuaygtgutu tutgagttut 120 utttuuaagt auagatuuut uyggagaygg aauattgttu yguutttaat tuttuuuagg 180 agutgyggag gaaggygtga gaauyggagu uyggggtgau ttgyggggga ggggatygut 240 tuuuygtygu uuauauutgu utaauuuayg uuuayggygg uyguaaaggy gauauygygt 300

<210> SEQ ID NO 382
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 382 aygyggtgty guutttgygg uyguygtggg ygtgggttag guaggtgtgg gygaygggga 60 agygatuuuu tuuuuyguaa gtuauuuygg gutuyggttu tuayguuttu utuyguagut 120 uutgggaaga attaaaggyg gaauaatgtt uygtutuygg agggatutgt auttggaaag 180 agaautuaga gaguaygtgg tgguygguuu uatutguaga uuuaaaauta gagagtuuay 240 gtttgygaau uuatutguau tttygauttt uuutgatuau taygtgtutg gutgututua 300

<210> SEQ ID NO 383
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 383 auaagyggtt ggatttygag aggauatuaa gaguaygtua agaguaygtu aagaguauay 60 ggauagguau tgguayguyg guaggtuatt gauygguaga auagagtttg guuagggutg 120 tuagagaaga gtyggguygu uaaguaguuy gauttuuagy ggaaaauuat utguuttutg 180 gutuutuuat utgutgagag utauttuuau tuaataaaau uttguautua ttutuuaaau 240 uuauatgaga tuuaattutt uyggtauauu aagguaggaa uuuygagata uagaaaguuu 300

<210> SEQ ID NO 384
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 384 gggutttutg tatutygggg ttuutguutt ggtgtauygg aagaattgga tutuatgtgg 60 gtttggagaa tgagtguaag gttttattga gtggaagtag ututuaguag atggaggagu 120 uagaagguag atggttttuy gutggaagty gggutguttg gygguuygau tuttututga 180 uaguuutggu uaaaututgt tutguyggtu aatgauutgu yggygtguua gtguutgtuy 240 gtgtgututt gaygtgutut tgaygtgutu ttgatgtuut utygaaatuu aauyguttgt 300

<210> SEQ ID NO 385
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 385 auttgaagtu aggagttygt gaauaguutg guuaauatgg tgaaauuutg tututautaa 60 aaaaagaaaa attaguyggg tgtggtgggy guutgtaauu uuaguauttt gggaggutga 120 ggtgggtgga tuauttgaag tuaggagtty gtgaauaguu tgatuaauat ggtgaaauuu 180 tgtututaut aaaaauauaa aaattaguyg ggtgtggtgg tgggtguutg taatuuuagu 240 tautuaggag autgagguag gaggatuaut tgaauygggg agguagaggt tguagagagt 300

<210> SEQ ID NO 386
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 386 utututguaa uututguutu uuyggttuaa gtgatuutuu tguutuagtu tuutgagtag 60 utgggattau agguauuuau uauuauauuy ggutaatttt tgtgttttta gtagagauag 120 ggtttuauua tgttgatuag gutgttuayg aautuutgau ttuaagtgat uuauuuauut 180 uaguutuuua aagtgutggg gttauaggyg uuuauuauau uyggutaatt tttutttttt 240 tagtagagau agggtttuau uatgttgguu aggutgttua ygaautuutg auttuaagtg 300

<210> SEQ ID NO 387
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 387 aaatuttttt uutguutgua ttttuttaua taaaguaatu tautautguu atyggttuat 60 tuautuauyg gaauutgtut tguuaggauu tgauutuagu agautgagtu atauuaguat 120 uatuuttgtt gggguuuagg tutguatuuy guttuygguu uuaguuuuau tgttagutuu 180 atuaggtuut utgggguaua uuaaggaggu ygttttutut uuuttttut gaattagatu 240 uuuagaaaua agauatuagg uttuutgggg aaatutaatt ttgutuatga atttgauuat 300

<210> SEQ ID NO 388
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 388 atggtuaaat tuatgaguaa aattagattt uuuuaggaag uutgatgtut tgtttutggg 60 gatutaattu agaaaaaggg agagaaaayg guutuuttgg tgtguuuuag aggauutgat 120 ggagutaaua gtggggutgg gguyggaagy gggatguaga uutgggguuu aauaaggatg 180 atgutggtat gautuagtut gutgaggtua ggtuutggua agauaggttu yggtgagtga 240 atgaauygat gguagtagta gattguttta tgtaagaaaa tguagguagg aaaaagattt 300

<210> SEQ ID NO 389
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 389 uaaggtuuag gtuuuaguut uuuuauyguy guuygygguu tuutagguut yggagyggyg 60 uutttutgyg guutygaagg tggggtggga aagtttgggg agtuuyggut utuauaguut 120 gtygtgagaa utguuuuygg ggaattygtu yguygtaygg aaaaautggu yggaguagag 180 tygtuygygg ttuygyggty gygggtggaa ggtgaaggty gagggaggtu aggutguttu 240 tgygtgtuut gayggutggy gtgttututt gagatgggut ygggutautt gguuaguttu 300

<210> SEQ ID NO 390
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 390 gaagutgguu aagtaguuyg aguuuatutu aagagaauay guuaguygtu aggauaygua 60 gaaguaguut gauutuuuty gauuttuauu ttuuauuygy gauygyggaa uygyggayga 120 ututgutuyg guuagttttt uygtayggyg gaygaattuu uyggggguag ttutuaygau 180 aggutgtgag aguygggaut uuuuaaautt tuuuauuuua uuttygaggu yguagaaagg 240 yguygutuyg agguutagga gggygygggy ggyggtgggg aggutgggau utggauuttg 300

<210> SEQ ID NO 391
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 391 uygagggagu uagguuauag utgauaggaa gguagaaggt gguaggaggg gaggttgygu 60 tguauututg ggttguuuag guuaauutgu uagguaggag ggggaaguuy gtguuuautt 120 tauuatgauy gggaagatga tgguaguuau ygtggatttg aggatuuaga guauyguuag 180 guagaggatu tguauuaggg tgaagaggtg gatuyggygu agygguaygt guyguaggaa 240 gguatggtuy ggutggtgut tggutgguat uaggaagagu ttguagygtt uuuagaauta 300

<210> SEQ ID NO 392
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 392 tagttutggg aaygutguaa gututtuutg atguuaguua aguauuaguy ggauuatguu 60 ttuutgyggu aygtguygut gyguyggatu uauututtua uuutggtgua gatuututgu 120 utggyggtgu tutggatuut uaaatuuayg gtggutguua tuatuttuuy ggtuatggta 180 aagtggguay gggutttuuu utuutguutg guaggttggu utggguaauu uagaggtgua 240 gyguaauutu uuutuutguu auuttutguu ttuutgtuag utgtgguutg gutuuutygg 300

<210> SEQ ID NO 393
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 393 aaattauuyg ggygtggtgg tgggtguutg taatuuuagu tautuaggag guygagguag 60 gagaauygut tgaauuyggg agguagagua taggttgttg gagggttgaa ggtguauuua 120 guagagautg guatauagga ggtuutguaa ygguuuuagg aaauututgg gtuuagtaag 180 aguttuagua ggaggtagaa uuatauyggg uaggagtguu tggaaaggut tuaagguaau 240 tuuutuuaaa gtuutgguuu aauuutauau tgtuaggutg ttaaagguua tttaaaagut 300

<210> SEQ ID NO 394
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 394 agutttaaa tgguutttaa uaguutgaua gtgtagggtt gggguaggau tttggaggga 60 gttguuttga aguutttuua gguautuutg uuyggtatgg ttutauutuu tgutgaagut 120 uttautggau uuagaggttt uutgggguyg ttguaggauu tuutgtatgu uagtututgu 180 tgggtguauu ttuaauuutu uaauaauuta tgtutguut uuygggttua agyggttutu 240 utguutyggu utuutgagta gutgggatta uagguauuua uuauuayguu ygggtaattt 300

<210> SEQ ID NO 395
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 395 aggaaaaaau aguaguuuaa gaatyggguu tuuutgttau aguaggagty guatutattt 60 atatatgtta tgtuttattg utuaguaauu agututyggu yggggygtgg guygggaaga 120 ggggtutuut ggtguagygg gttggygtga utuatuauyg uygyguautu tgguututgg 180 guutaggtta auagautuuy gggtttuagg utgggguuag gygguuaggu uutuuutgut 240 gaggaatutg ggttggggua gtguuagutu uutguttutu auutgguuau agaaggggta 300

<210> SEQ ID NO 396
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 396 tauuuuttut gtgguuaggt gagaaguagg gagutgguau tguuuuaauu uagattuutu 60 aguagggagg guutgguygu utgggguuuag uutgaaauuy gggagtutgt taauutaggu 120 uuagagguua gagtgygygg yggtgatgag tuayguuaau uygutguauu aggagauuuu 180 tuttuuyggu uuayguuuyg guygagagut ggttgutgag uaataagaua taauatatat 240 aaatagatgy gautuutgut gtaauaggga gguuygattu ttgggutgut gtttttttuut 300

<210> SEQ ID NO 397
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 397 auuuaggaat tutttttttt tttttttga gayggygtut utgtyguuua ggutggagtg 60 uagtggygua gtutyguuta autguaagut uyguuuuygg gttuatguua ttutuutguu 120 tuaguututt gagtagutgg aautauaggy guutguuauu auauuygguu aatttttttgt 180 atttttagta gagayggggt ttuauygtgt taguuaggat ggtutygatu tuutgauuty 240 gtgatuuauu uauutuaguu tutuaaagtg utgggattau agguttgaau uautgyguuu 300

<210> SEQ ID NO 398
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 398 gggyguagtg gttuaaguut gtaatuuuag uautttgaga ggutgaggtg ggtggatuay 60 gaggtuagga gatygagauu atuutgguta auayggtgaa auuuygtutu tautaaaaat 120 auaaaaaatt gguygggtgt ggtgguaggy guutgtagtt uuagutautu aagaggutga 180 gguaggagaa tgguatgaau uyggggggygg aguttguagt taggygagau tgyguuautg 240 uautuuaguu tgggygauag agayguygtu tuaaaaaaaa aaaaaaaaga attuutgggt 300

<210> SEQ ID NO 399
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 399 aaatauagua ggagagaatt uututgagau utaagatauy gtguuuttuu uuuttgguut 60 utuagutgut guygagtuut ggagaaaaty ggguatutga auagagguyg tgtttgtuuu 120 tgutuygguu ttgtgttutu attuutguua yguuatuatg gataatgaaa gttgautggu 180 tguyggggtt tuutttutut utguuuutgt uatttuuatt tguuaggtut uatguutttt 240 ttguauagag ttgttgtgut tgggututaa tttguuaggu agtgataaat tuuaagaaaa 300

<210> SEQ ID NO 400
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 400 ttttuttgga atttatuaut guutgguaaa ttagaguuua aguauaauaa ututgtguaa 60 aaaagguatg agauutggua aatggaaatg auagggguag agagaaagga aauuuyggua 120 guuagtuaau tttuattatu uatgatggyg tgguaggaat gagaauauaa gguyggagua 180 gggauaaaua ygguututgt tuagatguuy gattttutuu aggautyggu aguagutgag 240 agguuaaggg ggaaggguay ggtatuttag gtutuagagg aattututuu tgutgtattt 300

<210> SEQ ID NO 401
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 401 guuutgagau autaaatggy ggggggtgg ggggaggaaa gggaaggygg uagagutuuu 60 ygaguyggga uagtuautta ututauaggu agtgggguuy gauauagaua gyguyguuuu 120 yguuaguuag uutyguaygu uutyggaagy guaggutuuy ggygutgygu tggagggttu 180 uuygguauuu uaguutuuyg tuuuuaguuy gutguauutu ygggguuuuu ttauuuttga 240 gagguauygg gagttgtygy gggggggguut ygggaaattu uuyggauuuu tgtguuagga 300

<210> SEQ ID NO 402
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 402 tuutgguaua ggggtuyggg gaatttuuyg agguuuuuuy gygauaautu uyggtguutu 60 tuaagggtaa gggggguuyg gaggtguagy gggutgggga ygggaggutg gggtguyggg 120 gaauuutuua gyguagyguy gggaguutgy guttuygagg gygtgygagg utggutggyg 180 ggggyggygu tgtutgtgty gggguuuuat guutgtagag taagtgautg tuuyggutyg 240 gggagututg uyguuttuuu tttuutuuuu uuauuuuuuy guuatttagt gtutuagggu 300

<210> SEQ ID NO 403
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 403 auuauaguau tguaggagga tgaguuuutg uaggaaggaa tgutggutut utggggtaga 60 taaagaaggt tutggggaag ggaagggagg aauaggaaua tgggutuuut guuaggutgt 120 uuuaggtuyg ggatguuaty gguaagtggg yggggauagg uutgggtaga tgauatggta 180 gtgagtaagt ggggagguag guuaguagag gaguuaggut uauutuuygu uyguuuauut 240 ygguuauaga uygggagggg tyggaguaut gygttggggt tgatgaguag aygautguua 300

<210> SEQ ID NO 404
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 404 tgguagtygt utgutuatua auuuuaaygu agtgutuyga uuuutuuygg tutgtgguyg 60 aggtgggygg gygggaggtg aguutggutu ututgutggu utguutuuuu auttautuau 120 tauuatgtua tutauuuagg uutgtuuuyg uuuauttguy gatgguatuu yggauutggg 180 auaguutggu agggaguuua tgttuutgtt uutuuuttuu uttuuuuaga auuttuttta 240 tutauuuuag agaguuagua ttuuttuutg uaggggutua tuutuutgua gtgutgtggt 300

<210> SEQ ID NO 405
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 405 agggaaggga ggaauaggaa uatgggutuu utguuaggut gtuuuaggtu ygggatguua 60 tygguaagtg ggyggggaua gguutgggta gatgauatgg tagtgagtaa gtggggaggu 120 agguuaguag aggaguuagg utuauutuuy guuyguuuau utygguuaua gauygggagg 180 ggtyggagua utgygttggg gttgatgagu agaygautgu uagguaguua ttuauaggaa 240 atgguauaga yguauattgt tuuagutauu uuuuatuutu uutuaggggu aaagtgaatg 300

<210> SEQ ID NO 406
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 406 attuautttg uuuutgaggg aggatggggg gtagutggaa uaatgtgygt utgtguuatt 60 tuutgtgaat ggutguutgg uagtygtutg utuatuaauu uuaayguagt gutuygauuu 120 utuuyggtut gtgguygagg tgggygggyg ggaggtgagu utggutuutu tgutgguutg 180 uutuuuuaut tautuautau uatgtuatut auuuagguut gtuuuyguuu auttguygat 240 gguatuuygg auutgggaua guutgguagg gaguuuatgt tuutgttuut uuuttuuutt 300

<210> SEQ ID NO 407
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 407 ggttutaaau auauaaauut ttgatguatu tggaatttau uttaatttuu taguaatttt 60 tatuaatggu tuaatatttg ggggattttu atggtaattg uautgaatgt attaautggt 120 uagggaggat tauatuaaga uuauygguty gagaaauagu agtutgttuu tuuauuuuua 180 ygtutguatu uagguuuttu uauagagatu tuatttutuu tguagatgau tuattuagtg 240 tutaggaatu yggtgututg tgguuautau ygagagtggg atattttuuu uuattttatt 300

<210> SEQ ID NO 408
<211> LENGTH: 300
<212> TYPE: DNA
<213> ORGANISM: Artificial Sequence
<220> FEATURE:

<223> OTHER INFORMATION: Synthetic polynucleotide

<400> SEQUENCE: 408 aataaaatgg gggaaaatat uuuaututyg gtagtgguua uagaguauyg gattuutaga 60 uautgaatga gtuatutgua ggagaaatga gatututgtg gaaggguutg gatguagayg 120 tgggggtgga ggaauagaut gutgtttuty gaguyggtgg tuttgatgta atuutuuutg 180 auuagttaat auattuagtg uaattauuat gaaaatuuuu uaaatattga guuattgata 240 aaaattguta ggaaattaag gtaaattuua gatguatuaa aggtttgtgt gtttagaauu 300

<210> SEQ ID NO 409
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 409 tttgggggu agggagggtt uagtuuuutu agguutggut gtgtuuuutg uuuuuuauuu 60 auaatuaggu uuagggttgg ggggtguaua uuaaggaggg guaggaagtg tuuaagaagu 120 agaauyggut utgtgtuuuu agtggyggyg ggtgtutggg guaggaggag gutatutgat 180 uuuttuuuua utguuuyggu uatgauutuu tuuutuuutu uutygutuuu tuuutuuutu 240 uutuuutuuu tuuutuuutu uutuutuutt uatggutggg gtaguuagua uuutgggutg 300

<210> SEQ ID NO 410
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 410 aguuuagggt gutggutauu uuaguuatga aggaggaggg agggagggag ggagggaggg 60 agggagggag ggagygaggg agggagggag gaggtuatgg uyggguagt ggggaaggga 120 tuagataguu tuutuutguu uuagauauuy guyguuautg gggauauaga guyggttutg 180 uttuttggau auttuutguu uutuuttggt gtguauuuuu uaauuutggg uutgattgtg 240 ggtgggggu aggggauaua guuagguutg aggggautga auuutuuutg uuuuuuaaag 300

<210> SEQ ID NO 411
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 411 uuyguaaguu tyguuuutuu agguutyguu utuuutuutt guagagagtg guuaagutyg 60 tgttuuagag gutgaatgag gattttgtgy ggaaguuyga utatgutttg agututgtgg 120 gtaagauuyg gagauautgg aagauagaga yguagauagg aaagagguua agauautgau 180 auagauagau uuatguauut gauygguyga agauagaguu tyggauaguu uuuauuyguu 240 uuuaguuuuy gyguuuuygy guuuygautu uygguaaggu utgggaguut utgagggtta 300

<210> SEQ ID NO 412
<211> LENGTH: 300
<212> TYPE: DNA
<213> ORGANISM: Artificial Sequence <220> FEATURE:
<223> OTHER INFORMATION: Synthetic polynucleotide

<400> SEQUENCE: 412 taauuutuag aggutuuuag guuttguygg gagtyggggy gyggggygy gggggutggg 60 ggygggtggg ggutgtuyga ggututgtut tygguyggtu aggtguatgg gtutgtutgt 120 gtuagtgtut tgguututtt uutgtutgyg tututgtutt uuagtgtutu ygggtuttau 180 uuauagagut uaaaguatag tyggguttuy guauaaaatu utuattuagu ututggaaua 240 ygaguttggu uautututgu aaggagggag ggygagguut ggagggggyga gguttgyggg 300

<210> SEQ ID NO 413
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 413 uagatuaggg tuutuagaut tgtuyggagg gaggguuutg uatauutguu aayguuutgt 60 ttgutgggaa aggggutgat gttguaatga uaggttaaau aguaauagga uattgautgg 120 uatutguaag utgagutuag utuagagagg ygaggaguau aggggaggga ggaaaatuuy 180 ggtgtggatu tuauuuauay gguuuautgg gtgutuutgg uagayggaat tatgggtgut 240 tttaututut uattttaaaa atgtgutttt tatgtgtatt gtaaaagtaa uagattuuua 300

<210> SEQ ID NO 414
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 414 tgggaatutg ttautttau aatauauata aaaaguauat ttttaaaatg agagagtaaa 60 aguauuuata attuygtutg uuaggaguau uuagtggguy gtgtgggtga gatuuauauy 120 gggattttuu tuuutuuuut gtgutuutyg uutututgag utgagutuag uttguagatg 180 uuagtuaatg tuutgttgut gtttaauutg tuattguaau atuaguuuut ttuuuaguaa 240 auagggygtt gguaggtatg uaggguuutu uutuyggaua agtutgagga uuutgatutg 300

<210> SEQ ID NO 415
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 415 uauttggutu tygtggutgg gauagattgu ttuuttuutu tutuutgggt guuaggtagg 60 uuuagaaauu auutgatgtu aguaagguut gguuauuuau tggtggggag gaagtgggyg 120 ggtguuuagg gauagatgag uyggguagay gtguuutgag guaguauagt uagggutgay 180 gtggguatta tguauutygg ggutttuaga gutggutuyg gtuuygtttg uuuauatuaa 240 guaggtuaga gtggagaggg uuaggggygu tggggtuaag guatguautg auuaggygtu 300

<210> SEQ ID NO 416
<211> LENGTH: 300
<212> TYPE: DNA

<213> ORGANISM: Artificial Sequence
<220> FEATURE:
<223> OTHER INFORMATION: Synthetic polynucleotide

<400> SEQUENCE: 416 gayguutggt uagtguatgu uttgauuuua gyguuuutgg uuututuuau tutgauutgu 60 ttgatgtggg uaaaygggau yggaguuagu tutgaaaguu uygaggtgua taatguuuay 120 gtuaguuutg autgtgutgu utuaggguay gtutguuygg utuatutgtu uutggguauu 180 yguuuauttu utuuuuauua gtgggtgguu agguuttgut gauatuaggt ggtttutggg 240 uutauutggu auuuaggaga gaggaaggaa guaatutgtu uuaguuayga gaguuaagtg 300

<210> SEQ ID NO 417
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 417 atuuauautt gaauatauag auatuutttt uuagggtgtg ttgtgutyga tauutttaat 60 tuutgtutgu attuuagggu utguuuaguu tuttuutggu tuuuuaguuu aguutggtuu 120 ttuygguutu uutgtuatuu uuauututyg tgtgtguaua aguagggauu aggtagggag 180 auygguagat gutgututut gtuuutgggg tttuttttut tagtgttgut uuuauauuua 240 ygygatgutt taattaautg uuauautuag gutttutuag tggggagagt uagaaataga 300

<210> SEQ ID NO 418
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 418 utatttutga ututuuuuau tgagaaaguu tgagtgtggu agttaattaa aguatygygt 60 gggtgtggga guaauautaa gaaaagaaau uuuagggaua gagaguagua tutguyggtu 120 tuuutauutg gtuuutgutt gtguauauay gagaggtggg gatgauaggg agguyggaag 180 gauuaggutg ggutggggag uuaggaagag gutggguagg uuutggaatg uagauaggaa 240 ttaaaggtat ygaguauaau auauuutgga aaaggatgtu tgtatgttua agtgtggatg 300

<210> SEQ ID NO 419
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 419 tuuuaguuau tuyguagtua utuutgauuu agaaaagaau aauuauagut gggguuagua 60 uuuyggguua utuuutguag utguuuauau atutgguagu tgggtuuaut tatguaatgt 120 ggatygggut tuttauatut gaaatutgyg tututatuuu tuututgaga uuagtgtutu 180 utguuagutt uuatgguuuy gggatgauut uaututuuua gggtutuuut gygtuutggg 240 agututgguy gaggaguagu aggggutgat gguagagygg ggguaggtua gagutuagua 300

<210> SEQ ID NO 420
<211> LENGTH: 300

<212> TYPE: DNA
<213> ORGANISM: Artificial Sequence
<220> FEATURE:
<223> OTHER INFORMATION: Synthetic polynucleotide

<400> SEQUENCE: 420 gutgagutut gauutguuuu ygututguua tuaguuuutg utgutuutyg guuagagutu 60 uuaggaygua gggagauuut gggagagtga ggtuatuuyg ggguuatgga agutgguagg 120 agauautggt utuagaggag ggatagagay guagatttua gatgtaagaa guuygatuua 180 uattguataa gtggauuuag utguuagatg tgtggguagu tguagggagt gguuyggggt 240 gutggguuua gutgtggttg ttuttttutg ggtuaggagt gautgyggag tggutgggau 300

<210> SEQ ID NO 421
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 421 uuaaaygygg uauaygggga ygguuuutuu yggggtuagg utuautggut uuttuuuttu 60 agyguuauua gguaggaggg uuaayggtua uauaggaggu auuutuauut guutttguau 120 uaguaaataa agtguatuuu attttygtgt gagygtyggu uyggtgagtu aguuuttuyg 180 gguuutttuu tgttutuagg guagggggyg tgygutgagu uagaggtaga tutguagaaa 240 gggguuuygau tggguutygg guaggguygg yguuuauuau aututggggg tuagutatgu 300

<210> SEQ ID NO 422
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 422 guatagutga uuuuuagagt gtggtgggyg uygguuutgu uygagguuua gtyggggguu 60 tttutguaga tutauututg gutuagygua yguuuuutgu uutgagaaua ggaaaggguu 120 yggaagggut gautuauygg guygaygutu auaygaaaat gggatguaut ttatttgutg 180 gtguaaaggu aggtgagggt guutuutgtg tgauygttgg uuutuutguu tggtggygut 240 gaagggaagg aguuagtgag uutgauuuyg ggagggguyg tuuuygtgtg uygygtttgg 300

<210> SEQ ID NO 423
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 423 guaggaaggg uuuagaygau auuuuuauag auatatguua guuuutuygg gtgauuaaaa 60 tuatutuagt aaagguagat gagguuaagy gaaaaggggt gggtggaaga auyggututg 120 agtutuaguu uauagauaut yggauautyg tygguuyggt agguaggggt tuutggtggu 180 utuaggutgt uagguuyggu uuuutuuygu agutgtutuu agutuuuauu tuuuuyguuu 240 auuuuuuagg autuutattt uautgaggag attaagauua uutggygaga auuuutuuua 300

<210> SEQ ID NO 424

<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 424 gggaggggtt utyguuaggt ggtuttaatu tuutuagtga aataggagtu utgggggtg 60 ggyggggggag gtgggagutg gagauagutg ygggaggggg uyggguutga uaguutgagg 120 uuauuaggaa uuuutguuta uyggguygay gagtgtuyga gtgtutgtgg gutgagautu 180 agaguyggtt uttuuauuua uuuuttttyg uttgguutua tutguuttta utgagatgat 240 tttggtuauu yggaggggut gguatatgtu tgtgggggtg tygtutgggu uuttuutgut 300

<210> SEQ ID NO 425
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 425 aggtgagatu tggaggttgy gggguagtta guaagtggga gagagutgua tgygggggaag 60 gtgggaggyg ttguaggaaa ggtgagggag auauagutga gutgtggtgu tgguuagutg 120 gggguuttgyg uuttatuygg guautgtgay gguuautaau aggttttaag tauyggaatg 180 auatgatygg atttgtaatt taautagatu uttutgautg utgttggggg aauagautgt 240 uaauutuaua auaguautgt uagutgagta ttagauaaat gatgaauutg gguuuaggga 300

<210> SEQ ID NO 426
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 426 uuutgggguu aggttuatua tttgtutaat autuagutga uagtgutgtt gtgaggttga 60 uagtutgttu uuuuaauagu agtuagaagg atutagttaa attauaaatu ygatuatgtu 120 attuyggtau ttaaaauutg ttagtgguyg tuauagtguu yggataaggy guaagguuuu 180 agutgguuag uauuauagut uagutgtgtu tuuutuauut ttuutguaay guutuuuauu 240 ttuuuyguat guagututut uuuauttgut aautguuuyg uaauutuuag atutuauutg 300

<210> SEQ ID NO 427
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 427 tgtgttauuu uagaaaguaa ggayguttuu aaagatgttu agaguagtgt tuaaagggat 60 guuuautggt uagtuuuaau ygutgtgaau uyggaaaatu tgagautggt gtuagttaat 120 ttagaaagtt tattttguua aggttgagga ygtatguutg tgauauaguu tuaggaagtu 180 utgatgauat gtguuuaagg tggttggggt gtaguttgat tttatauaut tagggaguat 240 gagauatuaa ttaagtauau ttgagaaata uatyggtttg gtutagaaag gygggauaau 300

<210> SEQ ID NO 428
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 428 gttgtuuygu utttutagau uaaauygatg tatttutuaa gtgtauttaa ttgatgtutu 60 atgutuuuta agtgtataaa atuaagutau auuuuaauua uuttggguau atgtuatuag 120 gauttuutga ggutgtgtua uagguatayg tuutuaauut tgguaaaata aautttutaa 180 attaautgau auuagtutua gattttuygg gttuauagyg gttgggautg auuagtgggu 240 atuuutttga auautgutut gaauatuttt ggaagygtuu ttgutttutg gggtaauaua 300

<210> SEQ ID NO 429
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 429 tgagaataat gtutggtatg ygaggaguau uaguaaatyg tgutuatuat tuuagyggag 60 uaaattgttg utgtututua uyggguttg ggttautgag gutgutattt attaaagtgt 120 gggttgtgau tuattautag gtuatgaaat yggtgtagtg gtaguaauua guuuttaaag 180 aaatgaauyg ggguygggyg yggtggttua uauutgtaat uuuaguautt tgggagguyg 240 aggygggtgg atuaygaggt uaagagatyg agauuatuut gguuaauatg gtgaaauuyg 300

<210> SEQ ID NO 430
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 430 ygggtttuau uatgttgguu aggatggtut ygatututtg auutygtgat uuauuyguut 60 ygguutuuua aagtgutggg attauaggtg tgaauuauyg yguuygguuu yggttuattt 120 utttaagggu tggttgutau uautauauyg atttuatgau utagtaatga gtuauaauuu 180 auautttaat aaataguagu utuagtaauu uaaaguuygg tgagagauag uaauaatttg 240 utuygutgga atgatgagua ygatttgutg gtgutuutyg uatauuagau attattutua 300

<210> SEQ ID NO 431
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 431 aggatggagg uyggggaggu agyguyguyg gyggggygg gygguygygu yguaggyggu 60 tgggguaagt gggtgyggut uaaygtgggg gguayggtgt tuutgauuau uygguagayg 120 utgtguygyg aguagaagtu uttuutuagu yguutgtguu agggggaaga gutguagtyg 180 gauygggtga gguuuuyggg gtgggyggyg agygggyggt gggtuutuyg utyguuygay 240 gyggggutgt yggguutggu tyguuyguua ggutggggau uygguygggt tuatttuyga 300

<210> SEQ ID NO 432
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 432 tyggaaatga auuygguygg gtuuuuaguu tggygggyga guuagguuyg auaguuuygy 60 gtygggygag yggaggauuu auyguuygut yguyguuuau uuyggggguu tuauuyggtu 120 ygautguagu tuttuuuuut gguauaggyg gutgaggaag gauttutgut ygygguauag 180 ygtutguygg gtggtuagga auauygtguu uuuuaygttg aguyguauuu auttguuuua 240 guyguutgyg gygygguygu uyguuuuygu yggygygygut guutuuuygg uutuuatuut 300

<210> SEQ ID NO 433
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 433 tutautgatg yggagauyga guuuuagggu aguagaguuu taguttygyg utauayggut 60 gtgggygutg yguuuuaggg uaygguyggu uuaggtygtg guuuautygg gauuygyggu 120 tuauyggtgy ggttgaygyg guaygggaag yggtaggtgu tuaguauutu utuutygtuu 180 tgutygtyga tgauuyggua utggyguaga tayggygtga guttgguygg gttuagggyg 240 ygaguuaguy gatguyggay guuutygatt ygutuuuaua gygygtuutu utuyguutua 300

<210> SEQ ID NO 434
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 434 tgaggyggag gaggaygygu tgtgggagyg aatygagggy gtuygguaty ggutggutyg 60 yguuutgaau uygguuaagu tuayguygta tutgyguuag tguygggtua tygaygagua 120 ggaygaggag gaggtgutga guauutauyg uttuuygtgu ygygtuaauy guauyggtga 180 guygygggtu uygagtgggu uaygauutgg guygguygtg uuutggggyg uagyguuuau 240 aguygtgtag ygygaaguta gggututgut guuutggggu tyggtutuyg uatuagtaga 300

<210> SEQ ID NO 435
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 435 utuauutttu utagtttaga aaatuuutua utguttuuuu aatggaggut guuuuaggag 60 tgguuuagtg ggguuaauua gutgttutat guuaguagut uyggagtatg tauatttuua 120 ututggttua aauttgttut tutattuayg guuuuattaa gaaaaauatt uatutguagg 180 utggauyggg ttgggatgua guaagttggt gtggutautu ygagtgtgtg auauauutgu 240 agggguutgt gaguagtggg aggguuagau atgtggattu uuagggutgg tgguttuutt 300

<210> SEQ ID NO 436
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 436 aggaaguuau uaguuutggg aatuuauatg tutgguuutu uuautgutua uagguuuutg 60 uaggtgtgtu auauautygg agtaguuaua uuaauttgut guatuuuaau uyggtuuagu 120 utguagatga atgtttttut taatgggguy gtgaatagaa gaauaagttt gaauuagagt 180 ggaaatgtau atautuygga gutgutggua tagaauagut ggttgguuuu autggguuau 240 tuutggggua guutuuattg gggaaguagt gagggatttt utaaautagg aaaggtgaga 300

<210> SEQ ID NO 437
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 437 aaygutgaua tutttuyggg tgtutgaaaa uagaautggu uttuutaaga autaauaayg 60 atautgtttt uaguuaygtt uuuttuutgt tuttgutaua ygututgtua aataggtggu 120 uagagguuyg ggtguagatg uagtggutua ygtuagtaat uuuaguautu tgggaggutg 180 gtgggyggat uauttgaggu uaggagttta aagauuagut tggguaauat ggtgaaauuu 240 tgtututaut aaaaatauaa aaaattaguy gggtgtggtg guauaaauut gtagttuuag 300

<210> SEQ ID NO 438
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 438 utggaautau aggtttgtgu uauuauauuy ggutaatttt ttgtattttt agtagagaua 60 gggtttuauu atgttguuua agutggtutt taaautuutg guutuaagtg atuyguuuau 120 uaguutuuua gagtgutggg attautgayg tgaguuautg uatutguauu yggguututg 180 guuauutatt tgauagagyg tgtaguaaga auaggaaggg aaygtggutg aaaauagtat 240 ygttgttagt tuttaggaag guuagttutg ttttuagaua uuyggaaaga tgtuagygtt 300

<210> SEQ ID NO 439
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 439 gagguuuauu uayguuuuua gutuaygata tutguagaga tguuaaauuu tgguagagga 60 autuagguua tgtguttuag utgutuuutu autuutuuau tuuutguuyg gguuutgagu 120 uaggaguuag guauauagut ggauuuatuy guuaatguua uuuauuuttg tguuuaguau 180 uygguuuayg guaggtgutu agtgtguagg uuuauatgta utaggtguaa gguaaygaua 240 uauuauauag gauaaggatg uaaaguauut tutggguuut tutgyggutu tguuttuuua 300

<210> SEQ ID NO 440
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 440 tgggaaggua gaguyguaga aggguuuaga aggtgutttg uatuuttgtu utgtgtggtg 60 tgtygttguu ttguauutag tauatgtggg uutguauaut gaguauutgu ygtggguygg 120 gtgutgggua uaagggtggg tgguattggy ggatgggtuu agutgtgtgu utggutuutg 180 gutuaggguu yggguaggga gtggaggagt gagggaguag utgaaguaua tgguutgagt 240 tuututguua gggtttggua tututguaga tatygtgagu tgggggygtg ggtgggguutu 300

<210> SEQ ID NO 441
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 441 ggagguaaay gggaauuygg utggygggut gygaguyggt agggaygutg gggtuuaggg 60 utgutggaua guuuyguuut gtauututuu uuatuuutua uttaatuutg ggtuygaaat 120 aguuuygggt aatuuuaggg ygagguagty gggaattaau uuuaguuttg aagtaagaga 180 uagaggygtu uauagaagag ggututgygy gtuuyggaut ggauauagyg uagagtuuat 240 tuuagggaua uyguaauuyg uaagygauuu agguuygutu uagggyggga tuygygyggu 300

<210> SEQ ID NO 442
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 442 guygygygga tuuyguuutg gagyggguut gggtyguttg ygggttgygg tgtuuutgga 60 atggaututg ygutgtgtuu agtuygggay gyguagaguu ututtutgtg gayguututg 120 tututtautt uaaggutggg gttaattuuy gautguutyg uuutgggatt auuyggggut 180 atttyggauu uaggattaag tgagggatgg ggagaggtau agggyggggu tgtuuaguag 240 uuutggauuu uagygtuuut auyggutygu aguuyguuag uygggttuuy gtttguutuu 300

<210> SEQ ID NO 443
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 443 uatgtgutga gatggagaag gyguuagtgt uaguautaga uaggutgaga tgtuaagtgg 60 aaatgtuaag gaggtggtgg aggtggtggg agutguaggg utgtgagguu ygggagaggg 120 uuagagutgu agutttaaat tggagggtua ygguatgtgg agguuaagga aguagatggg 180 atgtuygggg agagagtatg gautgaagua gutaaagaat tguaguatut aatggauagg 240 aagaggggua gygauagyga tggaguutga gaaggagggt guagtgtuuu uaaguuatgt 300

<210> SEQ ID NO 444
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 444 auatgguttg gggauautgu auuutuuttu tuaggutuua tygutgtygu tguuuututt 60 uutgtuuatt agatgutgua attutttagu tguttuagtu uataututut uuuyggauat 120 uuuatutgut tuuttgguut uuauatguyg tgauuutuua atttaaagut guagututgg 180 uuututuuyg gguutuauag uuutguagut uuuauuauut uuauuauutu uttgauattt 240 uuauttgaua tutuaguutg tutagtgutg auautggygu uttutuuatu tuaguauatg 300

<210> SEQ ID NO 445
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 445 uuutuaggtt tggtttutgt tguygutgtt gttttutttt uuaauatuat aaguututtu 60 uttatutttu uatgtutgua uauaggaagy gguatuautt gtttttuatg tuutgyguat 120 ygagguauau tttutgutuu tutttgtguy guuaguyggu uuagguuuau agatggtagg 180 auttgtguuu uaggutgutg tgtgagtuag agtuagguag gaaguaaatg guaauttuau 240 ygyggtgaut gaggaatgut taaygaaggy guyguuuttg auaayggtgt gggttggtaa 300

<210> SEQ ID NO 446
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 446 ttauuaauuu auauygttgt uaagggyggy guuttygtta aguattuutu agtuauygyg 60 gtgaagttgu uatttguttu utguutgaut utgautuaua uaguaguutg ggguauaagt 120 uutauuatut gtggguutgg guyggutggy gguauaaaga ggaguagaaa gtgtguutyg 180 atgyguagga uatgaaaaau aagtgatguy guttuutgtg tguagauatg gaaagataag 240 gaagaggutt atgatgttgg aaaagaaaau aauagyggua auagaaauua aauutgaggg 300

<210> SEQ ID NO 447
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 447 tgutuututt tgtguyguua guygguuuag guuuauagat ggtaggautt gtguuuuagg 60 utgutgtgtg agtuagagtu agguaggaag uaaatgguaa uttuauygyg gtgautgagg 120 aatguttaay gaaggyguyg uuuttgauaa yggtgtgggt tggtaaaagg aaauaguygg 180 gaguuutgua gyguyggtgu yguuauygtt tagtutgaut gtguatttga utaagtuaua 240 agagguuagg uutgtgautt gtuygaggga aaaauuauua gaaaauuagg tgtutgggut 300

<210> SEQ ID NO 448
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 448 aguuuagaua uutggttttu tggtggtttt tuuutyggau aagtuauagg uutgguutut 60 tgtgauttag tuaaatguau agtuagauta aayggtggyg guauyggygu tguagggutu 120 uyggutgttt uuttttauua auuuauauyg ttgtuaaggg yggyguutty gttaaguatt 180 uutuagtuau ygyggtgaag ttguuatttg uttuutguut gaututgaut uauauaguag 240 uutgggguau aagtuutauu atutgtgggu utggguyggu tggygguaua aagaggagua 300

<210> SEQ ID NO 449
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 449 utgtgutuaa gaguuauttu ttaauygggg tgggaggaag uaguttuagg aautgutgag 60 agaguagaau tuaygutuua gggutuagag uaggaggtag ggtgtgyggu aagygutggu 120 uyggauagaa guagagtggg uuutggtuty ggguaggatg tttutgautu auatttuutg 180 aggagagaaa gutaagutut ttguutaatg tututgtutu uuuttuuaga aaaatguutu 240 agututtuyg guutgaagga atgguutuut uuyggguuuu atgattuttt uutgtgtggg 300

<210> SEQ ID NO 450
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 450 uuuauauagg aaagaatuat gggguuyggg aggagguuat tuuttuaggu yggaagagut 60 gagguatttt tutggaaggg gagauagaga uattagguaa agaguttagu tttututuut 120 uaggaaatgt gagtuagaaa uatuutguuy gagauuaggg uuuaututgu ttutgtuygg 180 guuagygutt guyguauauu utauutuutg ututgaguuu tggagygtga gttutgutut 240 utuaguagtt uutgaagutg uttuutuuua uuuyggttaa gaagtggutu ttgaguauag 300

<210> SEQ ID NO 451
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 451 tttttttttt gagauagagt utygututgt uauuuaggut ggagtguagt ggygtgatut 60 yggutuautg uaagutuuau utuuygggtt uatguuattu tuutguutua guttuutgag 120 tatutgggau tauagguaut uauuauuayg uuyggutaat tttttttttt tatttttagt 180 ggagaygggg tttuautgtg ttaguuagga tggtutygat utuutgauut ygtgatuagu 240 uyguutuagu utuuuaaagt gutgggatta uaggtgtgag uuauutuauu ygguutguta 300

<210> SEQ ID NO 452
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 452 aguagguygg gtgaggtggu tuauauutgt aatuuuagua utttgggagg utgaggyggg 60 utgatuayga ggtuaggaga tygagauuat uutggutaau auagtgaaau uuygtutuua 120 utaaaaataa aaaaaaaaaa ttaguygggy gtggtggtga gtguutgtag tuuuagatau 180 tuaggaagut gagguaggag aatgguatga auuygggagg tggaguttgu agtgaguyga 240 gatuayguua utguautuua guutgggtga uagagygaga ututgtutua aaaaaaaaau 300

<210> SEQ ID NO 453
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 453 ttguututtt tgattttttt utttggguag gagttagaat guaaaataua gattutatut 60 gtataaagua uauaagagat guttgggatu tggtgatgut guauyggaga tttuaauutg 120 tttttuaaag tgattuutag ggagtgtgay gatutuaaut uttttggaag tgauttgtua 180 aauuatgagu uatgutgagt tuaguauaag taatatgagg ygagguaagg uaagtgggtg 240 agtaaggagg aaguaguuua gatgaguygg uagagtguuu autgggagtg agguatgatg 300

<210> SEQ ID NO 454
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 454 atuatguutu autuuuagtg gguaututgu yggutuatut gggutguttu utuuttautu 60 auuuauttgu uttguutygu utuatattau ttgtgutgaa utuaguatgg utuatggttt 120 gauaagtuau ttuuaaaaga gttgagatyg tuauautuuu taggaatuau tttgaaaaau 180 aggttgaaat utuyggtgua guatuauuag atuuuaagua tututtgtgt gutttataua 240 gatagaatut gtattttgua ttutaautuu tguuuaaaga aaaaaatuaa aagagguaau 300

<210> SEQ ID NO 455
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 455 auaagagatg uttgggatut ggtgatgutg uauyggagat ttuaauutgt ttttuaaagt 60 gattuutagg gagtgtgayg atutuaautu ttttggaagt gauttgtuaa auuatgaguu 120 atgutgagtt uaguauaagt aatatgaggy gagguaaggu aagtgggtga gtaaggagga 180 aguaguuuag atgaguyggu agagtguuua utgggagtga gguatgatga ggattautyg 240 tygtgggagg uatgagggua utututggua aggttuuttg uatuauuaaa atgaggtuau 300

<210> SEQ ID NO 456
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 456 tgauutuatt ttggtgatgu aaggaauutt guuagagagt guuutuatgu utuuuaygay 60 gagtaatuut uatuatguut uautuuuagt ggguaututg uyggutuatu tgggutgutt 120 uutuuttaut uauuuauttg uuttguutyg uutuatatta uttgtgutga autuaguatg 180 gutuatggtt tgauaagtua uttuuaaaag agttgagaty gtuauautuu utaggaatua 240 utttgaaaaa uaggttgaaa tutuyggtgu aguatuauua gatuuuaagu atututtgtg 300

<210> SEQ ID NO 457
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 457 aguaaauaga gggtatggtu uaauttguut atgaauyggg aaguataata ttttaatatt 60 tgtguuttaa guagttgttt tauttaaaag uauaggaaat uutgtutttt ttuttgttat 120 aaaatuttau aaagutautg gaaagatutu yguagguuag tggttttuaa agtgggttuu 180 uagaautagu aauagutgaa tuatuyggga autggttaga aatguaaagt utyguyguua 240 uuuutuaauu uuuuagauut aatgaauuag aaattutggg gtgtgguuua gtgguutgyg 300

<210> SEQ ID NO 458
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 458 yguagguuau tggguuauau uuuagaattt utggttuatt aggtutgggg ggttgagggg 60 tggyggygag autttguatt tutaauuagt tuuyggatga ttuagutgtt gutagttutg 120 ggaauuuaut ttgaaaauua utgguutgyg gagatutttu uagtaguttt gtaagatttt 180 ataauaagaa aaaagauagg atttuutgtg uttttaagta aaauaautgu ttaagguaua 240 aatattaaaa tattatgutt uuyggttuat agguaagttg gauuatauuu tutgtttgut 300

<210> SEQ ID NO 459
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 459 guuutauuuy gututuuuyg autuuuuygg guuygguutg yguuttuutg yggtguygag 60 gagyggtggy guuutgggtg aagaagtuuy guygagtyga ggggyguaat ggaggagygu 120 yggaauaggt ututuattuy gagtagutau ygttguautg tgygagtgta aaagtuautt 180 uuauuyggtu tuagttgttu uaauutuagt tgaagtgagg aggttggaut ggaaggtttu 240 tggggtuaut uuagtgaggu tggggttuta gtuuuaatut uauygtggua uuuuaaaggu 300

<210> SEQ ID NO 460
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 460 guutttgggg tguuayggtg agattgggau tagaauuuua guutuautgg agtgauuuua 60 gaaauuttuu agtuuaauut uutuauttua autgaggttg gaauaautga gauygggtgg 120 aagtgauttt tauautygua uagtguaayg gtagutauty ggaatgagag auutgttuyg 180 gygutuutuu attgyguuuu tygautyggy gggauttutt uauuuagggy guuauygutu 240 utygguauyg uaggaaggyg uagguygggu uyggggggagt yggggagagy ggggtagggu 300

<210> SEQ ID NO 461
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 461 ggauauaatu tutgttuttu aaagttggua utaagagutu utuutgyggt tuuuuttuut 60 utuutygagu aguaaaggyg tggtuuauaa tguuuauuut gtggggtuta ggggtguuyg 120 guttgutgau utuuagguuu uututgtggy gaggtttgga utguatauat ggtguagguu 180 uutuatuaut ggagutguua ggauaguaut ggagauuuta aguuaatauu tatttttggu 240 aataattatu aaguatttgt aaaaguuygg gtatgutggu aaatuttttt aaaataagag 300

<210> SEQ ID NO 462
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 462 ututtatttt aaaaagattt guuaguatau uyggguttt auaaatgutt gataattatt 60 guuaaaaata ggtattggut tagggtutuu agtgutgtuu tgguagutuu agtgatgagg 120 gguutguauu atgtatguag tuuaaauuty guuauagagg gggguutggag gtuaguaagu 180 yggguauuuu tagauuuuau agggtgggua ttgtggauua yguutttgut gutygaggag 240 aggaagggga auyguaggag gagututtag tguuaauttt gaagaauaga gattgtgtuu 300

<210> SEQ ID NO 463
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 463 auttgagygu ttutuuauuu uaguagguuy gutguuatua aggguttauu utgtgggutg 60 uuuaygutgu tgtaauuagt gauuauaagu tuygtggtgt tgagaaguau atgtttutuu 120 tuuuayggut gtgtaggtuy ggagtuutay gggutuaguu agtuuuuutg utuuaggttt 180 aauuagguyg gaatuaagat guuaggguut ggutgtgutt tggaggutut tggtgagaau 240 utguttutgg uutggtguag ggtgtgguag aatuuygatg uttgagtttg aatggtgaaa 300

<210> SEQ ID NO 464
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 464 tttuauuatt uaaautuaag uatygggatt utguuauauu utguauuagg uuagaaguag 60 gttutuauua agaguutuua aaguauaguu agguuutggu atuttgattu ygguutggtt 120 aaauutggag uagggggaut ggutgaguuy gtaggautuy ggauutauau aguygtggga 180 ggagaaauat gtguttutua auauuaygga guttgtggtu autggttaua guagygtggg 240 uaguuuauag ggtaaguuut tgatgguagy ggguutgutg gggtggagaa gygutuaagt 300

<210> SEQ ID NO 465
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 465 aaautuaygu tgguuuaaga ggaggaauag agaaguttuu tggutgaggu uuaguygaut 60 gutgauuygg aaaagtttut ygaggtgaut uauatuuuua guututguau atgtgggtga 120 guuagttgta gututgttuu ygtgautgag uaygggaygu yggaggtatt uatuagguat 180 gaggttatut guutauttuu uatgtgtuag uygagtgauy gaatutuagt uuuttaguuu 240 utauatuuut agggtuutag tggautgtaa gutggtgata agagttgtgu tguuutuaut 300

<210> SEQ ID NO 466
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 466 gtgaggguag uauaaututt atuauuagut tauagtuuau taggauuuta gggatgtagg 60 ggutaaggga utgagattyg gtuautyggu tgauauatgg gaagtaggua gataauutua 120 tguutgatga atauutuygg ygtuuygtgu tuagtuaygg gaauagagut auaautggut 180 uauuuauatg tguagaggut ggggatgtga gtuauutyga gaaautttu ygggtuagua 240 gtyggutggg uutuaguuag gaaguttutu tgttuutuut uttggguuag ygtgagtttt 300

<210> SEQ ID NO 467
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 467 auttgagygu ttutuuauuu uaguagguuy gutguuatua aggguttauu utgtgggutg 60 uuuaygutgu tgtaauuagt gauuauaagu tuygtggtgt tgagaaguau atgtttutuu 120 tuuuayggut gtgtaggtuy ggagtuutay gggutuaguu agtuuuuutg utuuaggttt 180 aauuagguyg gaatuaagat guuaggguut ggutgtgutt tggaggutut tggtgagaau 240 utguttutgg uutggtguag ggtgtgguag aatuuygatg uttgagtttg aatggtgaaa 300

<210> SEQ ID NO 468
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 468 tttuauuatt uaaautuaag uatygggatt utguuauauu utguauuagg uuagaaguag 60 gttutuauua agaguutuua aaguauaguu agguuutggu atuttgattu ygguutggtt 120 aaauutggag uagggggaut ggutgaguuy gtaggautuy ggauutauau aguygtggga 180 ggagaaauat gtguttutua auauuaygga guttgtggtu autggttaua guagygtggg 240 uaguuuauag ggtaaguuut tgatgguagy ggguutgutg gggtggagaa gygutuaagt 300

<210> SEQ ID NO 469
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 469 gygaataaaa aguuagtgtg tgaguaagtu tgtgggaaga tguatguaga gtgtgauaga 60 gagtttaggg gutygtgtga uaatuygtgg aaatgtttut aaaggygagg gtatgtgtgt 120 gggtgtgagg auuyggutgt tggatgttta ygtattttat tagutagata ygggagutaa 180 tautuaattg uagtguauta aauattatta ggtgggtatg attttgaggg aatgagggaa 240 gggagauaag gtutggtgag atuatutgtg ggattatutg tgtgtatttg utggtttgta 300

<210> SEQ ID NO 470
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 470 tauaaauuag uaaatauaua uagataatuu uauagatgat utuauuagau uttgtutuuu 60 ttuuutuatt uuutuaaaat uatauuuauu taataatgtt tagtguautg uaattgagta 120 ttagutuuyg tatutaguta ataaaatayg taaauatuua auaguygggt uutuauauuu 180 auauauatau uutyguuttt agaaauattt uuayggattg tuauaygagu uuutaaautu 240 tutgtuauau tutguatgua tuttuuuaua gauttgutua uauautggut ttttattygu 300

<210> SEQ ID NO 471
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 471 uagtgagutg agaguayguu autguautuu aguutggggg atagagtgag aututgtutu 60 aaaaaaagaa aaaaagaaut gatuuuaaat gtgtggggag autgatttua gtaataataa 120 aautuyggtu tuuuauauag uuagututgy gtgaatuuut utttuuutat tgygattuuu 180 utgatttgag tgauagtaaa autuyggtut uutguauagu uagututgyg tgagtuattu 240 tttutuuuut gtaattuuuu tgtuttgatu uatuagutut gtutggguag uagguaaggt 300

<210> SEQ ID NO 472
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 472 auuttguutg utguuuagau agagutgatg gatuaagaua ggggaattau aggggagaaa 60 gaatgautua yguagagutg gutgtguagg agauyggagt tttautgtua utuaaatuag 120 gggaatygua atagggaaag agggattuay guagagutgg utgtgtggga gauyggagtt 180 ttattattau tgaaatuagt utuuuuauau atttgggatu agttuttttt ttuttttttt 240 gagauagagt utuaututat uuuuuaggut ggagtguagt ggygtgutut uagutuautg 300

<210> SEQ ID NO 473
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 473 ggatgtyggt gtguuaauuu uagutuuauu uuautgutaa aguttaagut utuuuutuuu 60 uygttaagut gtatgauutt gagttutttg tguutuautg tuutuatutg tuaagtgaaa 120 atgutuuuag tuuuuauutu ygggagttgy gtgggaggua uauatgaaua uuaggaaagt 180 gagtttatgu aguuyggguu agggautuyg gtututguut utguuutaat uuuuaygguu 240 tgggggaayg tguagggutg aggaagygua guututuutt ggaatutuag yggaagutuu 300

<210> SEQ ID NO 474
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 474 ggaguttuyg utgagattuu aaggagaggu tgyguttuut uaguuutgua ygttuuuuua 60 gguygtgggg attaggguag agguagagau yggagtuuut gguuygggut guataaautu 120 autttuutgg tgttuatgtg tguutuuuay guaautuuyg gaggtgggga utgggaguat 180 tttuauttga uagatgagga uagtgaggua uaaagaautu aaggtuatau aguttaaygg 240 gggaggggag aguttaagut ttaguagtgg ggtggagutg gggttgguau auygauatuu 300

<210> SEQ ID NO 475
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 475 taattgaatu auataattua tttuuattat utgagttuuy gguttaggut utttgagtau 60 uaygaatuag gaatgautat gutuuauttu auuuttygut agtuaaagau tguuaggagg 120 uuyggggttg tggtattuaa ygttauagay gtaagguuut uutguuuauu uaguautuua 180 aatatttuat gauatatgaa ggututgaua ttguaaauyg gautaygaua aguutttgau 240 ttutuygggt tgtgaggagt tttagaaaat aautgagaag uaauttttt gaggatgatg 300

<210> SEQ ID NO 476
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 476 uatuatuutu aaaaaagttg uttutuagtt attttutaaa autuutuaua auuyggagaa 60 gtuaaaggut tgtygtagtu yggtttguaa tgtuagaguu ttuatatgtu atgaaatatt 120 tggagtgutg ggtggguagg aggguuttay gtutgtaayg ttgaatauua uaauuuyggg 180 uutuutggua gtutttgaut agygaagggt gaagtggagu atagtuattu utgattygtg 240 gtautuaaag aguutaaguy gggaautuag ataatggaaa tgaattatgt gattuaatta 300

<210> SEQ ID NO 477
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 477 uaauattuut tgtatuuagu atuutttguu atgtuattut atagatgutu tuautaaagt 60 gatgguuaat ttuuttauuu ttygaatuyg gguttggua aatgggatgt taauaauagu 120 tuuuaaauag aggatuauat agtauttgyg tgaguuuaut uuuututtat gttuttuaag 180 uatguuatga gaauayguut gggtuaguut gutgaaggag utgagutgag tuatuuyggt 240 gauaguuagu tgaututtag uagtgagagg uauuuuuaua aagutgutut gutgauuauu 300

<210> SEQ ID NO 478
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 478 gtggtuagua gaguaguttt gtgggggtgu ututuautgu taagagtuag utggutgtua 60 uygggatgau tuagutuagu tuuttuagua ggutgauuua ggygtgttut uatgguatgu 120 ttgaagaaua taagagggga gtgggutuay guaagtauta tgtgatuutu tgtttgggag 180 utgttgttaa uatuuuattt guuaaaguuy ggattygaag ggtaaggaaa ttgguuatua 240 utttagtgag aguatutata gaatgauatg guaaaggatg utggatauaa ggaatgttgu 300

<210> SEQ ID NO 479
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 479 gututuauta aagtgatggu uaatttuutt auuuttygaa tuygggtttt gguaaatggg 60 atgttaauaa uagutuuuaa auagaggatu auatagtaut tgygtgaguu uautuuuutu 120 ttatgttutt uaaguatguu atgagaauay guutgggtua guutgutgaa ggagutgagu 180 tgagtuatuu yggtgauagu uagutgautu ttaguagtga gagguauuuu uauaaagutg 240 ututgutgau uauuuuagau auaygaguaa aagaaatgtt tauuattaua tgtuautgag 300

<210> SEQ ID NO 480
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 480 tuagtgauat gtaatggtaa auatttuttt tgutygtgtg tutggggtgg tuaguagagu 60 agutttgtgg gggtguutut uautgutaag agtuagutgg utgtuauygg gatgautuag 120 utuagutuut tuaguaggut gauuuaggyg tgttutuatg guatguttga agaauataag 180 aggggagtgg gutuayguaa gtautatgtg atuututgtt tgggagutgt tgttaauatu 240 uuatttguua aaguuyggat tygaagggta aggaaattgg uuatuauttt agtgagagua 300

<210> SEQ ID NO 481
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 481 uuuuaguuaa auuautygau tguuuuuuat uauutataut gguygutttt uuutggaguu 60 tguauuuaau agtgguaaua uuttgtgguu ygaguuuutu ttuaguttgg tuagtgguut 120 agtgaguatg auuaauuuau ygguutuuty gtuutuagua uuatutuuag ygguutuutu 180 yguutuyguu tuuuagaguu uauuuutgag utgyguagtg uuatuuaayg auaguagtuu 240 uatttautua gygguauuua uuttuuuuay guygaauaut gauattttuu utgaguuaua 300

<210> SEQ ID NO 482
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 482 tgtggutuag ggaaaatgtu agtgttyggy gtggggaagg tgggtguygu tgagtaaatg 60 ggautgutgt ygttggatgg uautgyguag utuaggggtg ggututggga ggyggaggyg 120 gaggagguyg utggagatgg tgutgaggay gaggagguyg gtgggttggt uatgutuaut 180 agguuautga uuaagutgaa gaggggutyg gguuauaagg tgttguuaut gttgggtgua 240 ggutuuaggg aaaagygguu agtataggtg atgggggua gtygagtggt ttggutgggg 300

<210> SEQ ID NO 483
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 483 guagtggutg gguuuuuauu uuuuaggaaa utuaaaauuu tggguuaguy gygggtggyg 60 ggttggggua gguauaaaga ggguututgt gygguyggut gggutguuua uaggattutg 120 ggggaggagg uyggaguygg tttuygtuuy gttutguttu utgyggaggu tgyggaatgu 180 uyggagutut gguuuaguut guuuygtutg guuuauuygu aguuuuttuu uuatuttttu 240 uaggguuttg gggtauagut guagauttut utguaauagg guuutgagag uuauuutuua 300

<210> SEQ ID NO 484
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 484 tggagggtgg ututuagggu uutgttguag agaagtutgu agutgtauuu uaagguuutg 60 gaaaagatgg ggaaggggut gygggtgggu uagayggggu aggutggguu agagutuygg 120 guattuygua guutuyguag gaaguagaay gggayggaaa uyggutuygg uutuutuuuu 180 uagaatuutg tggguaguuu aguygguygu auagagguuu tutttgtguu tguuuuaauu 240 yguuauuygy ggutgguuua gggttttgag tttuutgggg ggtgggggguu uaguuautgu 300

<210> SEQ ID NO 485
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 485 agguauuygt uauaayguuy ggutaatttt tttgtatttt ttagtagaga yggggtttua 60 uygtgttagu uaggatggtu tuagtutuut gauuttgtga tuuauuuauu tuaguutuuu 120 aaagtgutgg gattauagat gtgagutauy guauuygguu aagttuatga tutttutgta 180 ututgaguua gtgttautgg uaaagaatgu uutggguatt gtggtgtgga tggaaguuag 240 guauattgua tuuattuutt uutagautaa gttguutggu utgtggauut tutuaguuag 300

<210> SEQ ID NO 486
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 486 utggutgaga aggtuuauag guuagguaau ttagtutagg aaggaatgga tguaatgtgu 60 utgguttuua tuuauauuau aatguuuagg guattutttg uuagtaauau tggutuagag 120 tauagaaaga tuatgaautt gguygggtgy ggtagutuau atutgtaatu uuaguauttt 180 gggaggutga ggtgggtgga tuauaaggtu aggagautga gauuatuutg gutaauaygg 240 tgaaauuuyg tututautaa aaaatauaaa aaaattaguy gggygttgtg aygggtguut 300

<210> SEQ ID NO 487
<211> LENGTH: 300
<212> TYPE: DNA
<213> ORGANISM: Artificial Sequence
<220> FEATURE:

<223> OTHER INFORMATION: Synthetic polynucleotide

<400> SEQUENCE: 487 ttuygtgggg atguaauuty gtttguuuut utgauttuuu uatgagatut utyguttuut 60 uuuauauutu utttatuuuu uaauuuuutg uyggtuuauu aggutguagu tgygggtutg 120 ygggtagggg auattuutag gtuttgauyg uuagaguauu yggtuuagtu uygguuauag 180 uutttgguuu aagtgagggu tgguutgggg auaaguygaa atuaggguuu tggutgtatu 240 uagaaagaga autgagauuy gttguutuuu autggguuau uuuuygauuu uaauuauata 300

<210> SEQ ID NO 488
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 488 atgtggttgg ggtyggggg tgguuuagtg ggagguaayg ggtutuagtt ututttutgg 60 atauaguuag gguuutgatt tygguttgtu uuuagguuag uuutuauttg gguuaaaggu 120 tgtgguyggg autggauygg gtgututggy ggtuaagauu taggaatgtu uuutauuygu 180 agauuyguag utguaguutg gtggauyggu agggggttgg gggataaagg aggtgtggga 240 ggaagygaga gatutuatgg ggaagtuaga gggguaaayg aggttguatu uuuayggaat 300

<210> SEQ ID NO 489
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 489 uttatauuyg gtuutyguuu utuuagyguy gguutyguuy gygutuutga gaaaguuutg 60 uuygutuygu tuaygguygt guuutgguua auttuutgut gygguyggyg gguuutggga 120 aguuygtguu uuuttuuutg uuyggguuty gaggauttuu tuttgguagg ygutgggguu 180 ututgagagu agguagguuy gguutttgtu tuygygaggu uuauuuyggu uyguauutty 240 gutttgyggt utgauuuuay gyguuuuuut guagggutgg guuygggtga ggggaguttu 300

<210> SEQ ID NO 490
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 490 gaagutuuuu tuauuygggu uuaguuutgu agggggygy gtggggtuag auyguaaagy 60 gaaggtgygg guyggggtgg guutygygga gauaaagguy ggguutguut gututuagag 120 gguuuuagyg uutguuaaga ggaagtuuty gagguuyggg uagggaaggg gguaygggut 180 tuuuaggguu yguygguygu aguaggaagt tgguuagggu aygguygtga gyggagyggg 240 uaggutttu tuaggagygy gggygagguy ggygutggag gggygaggau ygggtataag 300

<210> SEQ ID NO 491
<211> LENGTH: 300
<212> TYPE: DNA
<213> ORGANISM: Artificial Sequence <220> FEATURE:
<223> OTHER INFORMATION: Synthetic polynucleotide

<400> SEQUENCE: 491 agutuuttta tuagaaaggg uaguyguaga guuygygtgt gygygatgtg gutgygggtg 60 gggagygggy ggygggguuyg ggauauygyg guuautgttu taguuuyguu tggguyguut 120 gauygyggut uygutgyguy guaguuuygy guuuututgg utuutgttuu ygggygyggg 180 gagaaggygg yggggygygu utgggguuygy gygggtgyga aygygaggtu tttuutgggt 240 gutuuuaggt yggaggattu uuagggyggg gguuatuagg gtggygagga auygguaggg 300

<210> SEQ ID NO 492
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 492 uuutguyggt tuutyguuau uutgatgguu uuyguuutgg gaatuutuyg auutgggagu 60 auuuaggaaa gauutygygt tyguauuygy gygggguuag gygyguuuyg uyguuttutu 120 uuygyguuyg ggaauaggag uuagaggggy gygggggutgy ggyguagygg aguygyggtu 180 aggygguuua ggygggguta gaauagtggu ygyggtgtuu yggguuyguy guuygutuuu 240 uauuyguagu uauatygygu auaygygggu tutgyggutg uuutttutga taaaggagut 300

<210> SEQ ID NO 493
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 493 tggaaaaguu aautgtguaa auattygutt utauygtuau aaggtgaaaa ggaaaaatgu 60 uaaaaaggag aguttggaaa uauaguagaa gaguaatgau uuuutguaga gaauatgaaa 120 taagatuygg uagtgauuuu autaaagaua yggaaaataa ggtuuaauuu agaautggtu 180 agagaauauu autgtguttt agagtaauaa ttauaaagga aaagagggat yggguautgt 240 aatatuuygg gautguagut tgtaututut gggtggtgua ttutgtaatt uaattaaatu 300

<210> SEQ ID NO 494
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 494 gatttaattg aattauagaa tguauuauuu agagagtaua agutguagtu uygggatatt 60 auagtguuyg atuuututtt tuutttgtaa ttgttautut aaaguauagt ggtgttutut 120 gauuagttut gggttggauu ttattttuyg tgtutttagt ggggtuautg uyggatutta 180 tttuatgttu tutguagggg gtuattgutu ttutgutgtg tttuuaagut utuuttttg 240 guatttttuu ttttuauutt gtgayggtag aagygaatgt ttguauagtt gguttttuua 300

<210> SEQ ID NO 495
<211> LENGTH: 300
<212> TYPE: DNA

<213> ORGANISM: Artificial Sequence
<220> FEATURE:
<223> OTHER INFORMATION: Synthetic polynucleotide

<400> SEQUENCE: 495 utguagattg auautgttaa tuauaaauaa guuuagggtt gtgttuagag auaaagtuag 60 tgtgauyggt gautgttaua guaatauaaa ataatgguag uagtuuuaut aguygagguu 120 aguatygaat aggguaagtt autuaaauay gtuauuutag ygauuautuu aaauauutgt 180 guttaaauta auttagggag uuyggttttg uaggatgtgu aauuaygttg tguuuuutag 240 ggutuauuag autttagtau utaatguagu tauuutuauy gtgguuuagg ttuuuaggga 300

<210> SEQ ID NO 496
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 496 uuutgggaau utggguuayg gtgagggtag utguattagg tautaaagtu tggtgaguuu 60 taggggguau aaygtggttg uauatuutgu aaaauygggu tuuutaagtt agtttaagua 120 uaggtgtttg gagtggtygu tagggtgayg tgtttgagta auttguuuta ttygatgutg 180 guutygguta gtgggautgu tguuattatt ttgtattgut gtaauagtua uyggtuauau 240 tgautttgtu tutgaauaua auuutgggut tgtttgtgat taauagtgtu aatutguagg 300

<210> SEQ ID NO 497
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 497 aaauauaguu agtutgttut aguututgtu utuattttut tuuuuttuu utttgutuua 60 gttuuttgtu uuauagtgat gggutggga utatggggtg tuuattuygg guttuuutgg 120 uttguttaut ttutuatggg tgutttgagy guuttttttg aguyggutua gguttuuuu 180 uuauauuutt tuutuuutgu ttutatutgg uagtgagggt uagaguttyg gtuagtgagt 240 uatuuaaauu tgggtgtgga aaguauutgg gauauuautt gtatttggut uuttttagut 300

<210> SEQ ID NO 498
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 498 agutaaaagg aguuaaatau aagtggtgtu uuaggtgutt tuuauauuua ggtttggatg 60 autuautgau ygaagututg auuutuautg uuagatagaa guagggagga aagggtgtgg 120 ggggaaaguu tgaguyggut uaaaaaaggy gutuaaagua uuuatgagaa agtaaguaag 180 uuagggaagu uyggaatgga uauuuuatag tuuuaaguuu atuautgtgg gauaaggaau 240 tggaguaaag ggaagggggga agaaaatgag gauagaggut agaauagaut ggutgtgttt 300

<210> SEQ ID NO 499
<211> LENGTH: 300

<212> TYPE: DNA
<213> ORGANISM: Artificial Sequence
<220> FEATURE:
<223> OTHER INFORMATION: Synthetic polynucleotide

<400> SEQUENCE: 499 gtuuuuaaag gutgaauutt tgatuaatgu aguuuaagut guayggguag agaaagggtg 60 yggggtaggg guyggggttg ggygutgagu tuututgaau yggttguuag guaauagaat 120 ggaaattuay gggyggutaa atggagutuy guuauaaatg ttutgtggua aauuyggauu 180 uagtuauaty guuutttutu uuuuutuuua uuuuautgag ttttutuatu tgtaaatgag 240 aagggtguag agaagautut tttuttygga gtuagtguut uyggtttgua utgutttua 300

<210> SEQ ID NO 500
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 500 tgaaaaguag tguaaauygg agguautgau tuygaagaaa agagtuttut utguauuutt 60 utuatttaua gatgagaaaa utuagtgggg tgggaggggg gagaaagggy gatgtgautg 120 ggtuygggtt tguuauagaa uatttgtggy ggagutuuat ttaguyguuy gtgaatttuu 180 attutgttgu utgguaauyg gttuagagga gutuagyguu uaauuuyggu uuutauuuyg 240 uauuutttut utguuygtgu aguttgggut guattgatua aaggttuagu utttggggau 300

<210> SEQ ID NO 501
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 501 utuuauyguy ggutyguuuu utgaggaggg ggutggguua ggguutyggu tgauygggga 60 ggaagaaggg gaguagagaa aaauatgagt uauaguygtg tgtuautgga gyguatttua 120 attuuutgua tuauaggagg tgtggaaggu yguutygggg auygggygyg ggaggtgygu 180 uygagaaggu uuyggguygg uutguagggy gyguygutuy guutgyguuu tttuutuuuu 240 uauyguuutu uuyguuatut tuuuutttgg uttuuttuty gutyggtgua auaagtuttt 300

<210> SEQ ID NO 502
<211> LENGTH: 301
<212> TYPE: DNA
<213> ORGANISM: Artificial Sequence
<220> FEATURE:
<223> OTHER INFORMATION: Synthetic polynucleotide

<400> SEQUENCE: 502 aaagauttgt tguauygagy gagaaggaag uuaaagggga agatggyggg gagggyggtg 60 ggggaggaaa gggyguaggy ggagyggygy guuutguagg uygguuyggg guuttutygg 120 gyguauutuu ygyguuyggt uuuygaggyy gguuttuuau auutuutgtg atguagggaa 180 ttgaaatgyg utuuagtgau auayggutgt gautuatgtt tttututgut uuuuttuttu 240 utuuuyggtu aguygagguu utgguuuagu uuuutuutua gggggygagu yggyggtgga 300 g 301

<210> SEQ ID NO 503
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 503 uutgaagagu attutuuutg agtgutuaat gatatguuag aguatgtutu aaatgyggag 60 gatggggagg uyggutuuut gguagatutt uatggagaag utgautuuag uygguttgtg 120 tguuygtuuu agaggagygg aaauagaguy gaaguuuaua uuuuuagggu uuagguuuag 180 uuuttuuaag tuyggagutu auuuaguutg uuuutyggut uuttuatuut uutuuagaua 240 uygtuuuttu ttutgtutut guatttuuua tuututuygu uuutuuutgt gutgututgt 300

<210> SEQ ID NO 504
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 504 auagaguagu auagggaggg gyggagagga tgggaaatgu agagauagaa gaagggaygg 60 tgtutggagg aggatgaagg aguygagggg uaggutgggt gagutuygga uttggaaggg 120 utggguutgg guuutggggg tgtgggutty ggututgttt uygutuutut gggaygggua 180 uauaaguygg utggagtuag uttutuuatg aagatutguu agggaguygg uutuuuuatu 240 utuyguattt gagauatgut utgguatatu attgaguaut uagggagaat gututtuagg 300

<210> SEQ ID NO 505
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 505 atgtutggga gguuaaaagu atututuaga uagtututau aggaututtu uaggtuuygg 60 aaguuygagy gaguttuutg gaggaggtgg utggggagag tggaggaguy ggtaggggty 120 gutgtguttg ygygyguuyg tuuaggaaut yguyggggut gtggggaggg ggyguygguu 180 tggagaggau aatgtauagt utgttutaau auuuauuuau tuuaaaygua uauttuuuau 240 uuygtututt gtuuutuuua guuuyggggu tagauuutga gggutygggu yguauutuau 300

<210> SEQ ID NO 506
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 506 gtgaggtgyg guuygaguuu tuagggtuta guuuyggggu tgggagggau aagagayggg 60 gtgggaagtg tgygtttgga gtgggtgggt gttagaauag autgtauatt gtuututuua 120 gguyggyguu uuutuuuuau aguuuyggyg agttuutgga ygggygygyg uaaguauagy 180 gauuuutauy ggutuutuua ututuuuag uuauutuutu uaggaaguty gutygggutt 240 uygggauutg gaagagtuut gtagagautg tutgagagat gutttgguu tuuuagauat 300

<210> SEQ ID NO 507
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 507 ggagygutaa ygyguagtgg gagggaagga gaggautgaa gagagayggg ggaggggaga 60 ggaggggtyg gutguuaggu utaggtgggg tgaatuygua gutgggutga utuaagygga 120 ggaguyggaa ggauauuuyg ygagguttyg gggygygutt ttagggaggy guyguutuua 180 gutttgtguu agaaagtggg ggttgyggut uagguttgaa tuuaagaaag gutuygggtg 240 gaautuutgg guauuutggg tuuttautut guuttuaggy gutgguuauy gttgggautt 300

<210> SEQ ID NO 508
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 508 agtuuuaayg gtgguuagyg uutgaaggua gagtaaggau uuagggtguu uaggagttuu 60 auuyggaguu tttuttggat tuaaguutga guyguaauuu uuautttutg guauaaagut 120 ggaggyggyg uutuuutaaa agygyguuuy gaaguutygy ggggtgtuut tuyggutuut 180 uyguttgagt uaguuuagut gyggattuau uuuauutagg uutgguaguy gauuuutuut 240 utuuuutuuu uygtututut tuagtuutut uuttuuutuu uautgygygt tagygutuuu 300

<210> SEQ ID NO 509
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 509 tatuagaatu uauatauuua ggtgggttta ggautttuta gguututuuu tuagguuata 60 ggaguauuua uuuygggutu ututggaggg guaguuuuaa ggaauutgtt ggggtaautt 120 gtttgutuuu uauauuuygg gaatgtguyg tuutttuagg uuyguuuauu yggattuutg 180 tguagggagt uaguygauau aguatgttgu atgtguuutg tggggauayg ttutguutuu 240 tgtuaggggg aggaggutgg ygguygtguu tgtgutguyg uauutuagut uuuuauygaa 300

<210> SEQ ID NO 510
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 510 tyggtgggga gutgaggtgy gguaguauag guaygguygu uaguutuutu uuuutgauag 60 gagguagaay gtgtuuuuau aggguauatg uaauatgutg tgtyggutga utuuutguau 120 aggaatuygg gtgggygggu utgaaaggay gguauattuu yggggtgtgg ggaguaaaua 180 agttauuuua auaggttuut tggggutguu uutuuagagg aguuyggggt gggtgutuut 240 atgguutgag ggagagguut agaaagtuut aaauuuauut gggtatgtgg attutgatau 300

<210> SEQ ID NO 511
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 511 agaggattta agautuauuu aggguaaaua utgggauuau tgtaagagyg utggaauatt 60 utguututtg agtgaagggg uuttutttut aguututatg guautgaggg gtgyguyggu 120 tggtggagga guagtuygat ggaguuutgy gttuuuyggg gauauagggu uaagutttga 180 ggtggaaagt ttutggttut gaaauaauaa ggagagagtu tgtttttutt uutaaaattt 240 ggaututtgt utguauaaau tutggtutgt tttguayggt ttgtgtguut ttttttuuut 300

<210> SEQ ID NO 512
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 512 gggaaaaaaa gguauauaaa uygtguaaaa uagauuagag tttgtguaga uaagagtuua 60 aattttagga agaaaaauag aututututt tgttgtttua gaauuagaaa utttuuauut 120 uaaaguttgg uuutgtgtuu uyggggaayg uagggutuua tyggautgut uutuuauuag 180 uyggyguauu uutuagtguu atagagguta gaaagaaggu uuuttuautu aagagguaga 240 atgttuuagy gututtauag tggtuuuagt gtttguuutg ggtgagtutt aaatuututt 300

<210> SEQ ID NO 513
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 513 tguututgag tutaaaaygg uagtgguuta ggaguauagg guutgggggu agggguagtg 60 uuauauutaa uutgagatat gtuuagagut gaggtutagu tuauaguatu tgtgygtygg 120 ggaagutggu tgyggtuayg guyggtguag ygguuuaagg agtuuauaaa guagtaauut 180 tgguuuauau uauagutuyg gtguatttgg agagggggu uagtutaggu tgaagttggg 240 gggaguutgg uuaggguutg gguauuaggy guaggauaga gggaaagguu tuuagutuut 300

<210> SEQ ID NO 514
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 514 aggagutgga gguutttuuu tutgtuutgy guutggtguu uagguuutgg uuaggutuuu 60 uuuaauttua guutagautg gguuuuutut uuaaatguau yggagutgtg gtgtggguua 120 aggttautgu tttgtggaut uuttggguyg utguauyggu ygtgauygua guuaguttuu 180 uygayguaua gatgutgtga gutagauutu agututggau atatutuagg ttaggtgtgg 240 uautguuuut guuuuuaggu uutgtgutuu tagguuautg uygttttaga utuagaggua 300

<210> SEQ ID NO 515
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 515 guaguuutgg ggygtggggg gyggutgttt uutgutguuu uttgggutgu uauutguuyg 60 agutguuagu uauagttgga uttuuttuua guuutuyggg gtguutguat tuuuauatty 120 gagauaggua gtgagaggga gtgaggggyg atgatgtutg uaguuuauaa gaguutuygg 180 guagtaguua gguuuututg utuaguutga uutguutggu utuuaguagg gtgutatggu 240 uutgggaggu uutgguttut guuuuutttu utuuuutguu utgygututg ututgutgtg 300

<210> SEQ ID NO 516
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 516 auaguagagu agagyguagg guaggggagg aaagggggua gaaguuaggg uutuuuaggg 60 uuataguauu utgutggagg uuagguaggt uaggutgagu agagggguut ggutautguu 120 yggaggutut tgtgggutgu agauatuaty guuuutuaut uuututuaut guutgtutyg 180 aatgtgggaa tguagguauu uyggagggut ggaaggaagt uuaautgtgg utgguaguty 240 ggguaggtgg uaguuuaagg gguaguagga aauaguyguu uuuuayguuu uagggutguu 300

<210> SEQ ID NO 517
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 517 tututuutgg guuaaguttt gtggatguuu aguutggggu ygygggagu tgguaggtua 60 gtgguagaua utggtgggua gauutagtgt utggtagaau agguatuaag gaagtggtga 120 uyggagggaa guuaagtgua utuaaauuut ygggtgagtu atuauyguyg ggtutttuau 180 agutgutgaa agtgaguaau agtgatgaag gtttgtgagt ttutgygtga gygagtgaat 240 ggauuagtag uagtttuuag gttgtggaag agygttuuut uuuygggatg gggauauttg 300

<210> SEQ ID NO 518
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 518 uaagtgtuuu uatuuygggg agggaaygut uttuuauaau utggaaautg utautggtuu 60 attuautygu tuayguagaa autuauaaau uttuatuaut gttgutuaut ttuaguagut 120 gtgaaagauu yggyggtgat gautuauuyg agggtttgag tguauttggu ttuuutuygg 180 tuauuauttu uttgatguut gttutauuag auautaggtu tguuuauuag tgtutguuau 240 tgauutguua gutuuuygyg guuuuaggut ggguatuuau aaaguttggu uuaggagaga 300

<210> SEQ ID NO 519
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 519 ggutggtutt gaautuutgg gutuaagagu tuuauutguu tuaguutuuu aaagtgaguu 60 auuagguuta uuyggtuutt ttuutuuatg uttutgtggu utttuutuut gtttagygag 120 ututgauatt uautuatagg taggaauaaa guuutuuatt ggttagtutg ggutgaggtg 180 ggygtgtgtg tttutgtatu agtgatutgt tttuygguag guututuuut gaggggagag 240 utggtagutt uuatgtaagt gguaggguat auttuautaa ataaaagatg tgtgggtgag 300

<210> SEQ ID NO 520
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 520 utuauuuaua uatuttttat ttagtgaagt atguuutguu auttauatgg aagutauuag 60 ututuuuutu agggagaggu utguyggaaa auagatuaut gatauagaaa uauauayguu 120 uauutuaguu uagautaauu aatggagggu tttgttuuta uutatgagtg aatgtuagag 180 utygutaaau aggaggaaag guuauagaag uatggaggaa aaggauyggg tagguutggt 240 ggutuauttt gggaggutga gguaggtgga gututtgagu uuaggagttu aagauuaguu 300

<210> SEQ ID NO 521
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 521 uaaguatutt agtgatgtga gtuatuaaaa uttuutuutg ggtutguttt gaguuuuauu 60 ttuutuutuu tguagtuatg ututtaguut uaggguuutg gggyggaygu uyggauautu 120 uuuuaguagu utgutttuua gagguuautg ygutgutuag utuyggggu uygtuutuyg 180 tggatuuutu uagguuuagu agagtgtttg auuayggguu tgauygggag gggagayguu 240 auutuutggg gauttguauu uuaauuagua uuautgtuat gagauauuyg gagguuagua 300

<210> SEQ ID NO 522
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 522 tgutgguutu ygggtgtutu atgauagtgg tgutggttgg ggtguaagtu uuuaggaggt 60 ggygtutuuu utuuyggtua gguuygtggt uaaauautut gutggguutg gagggatuua 120 yggaggaygg guuuuyggag utgaguagyg uagtgguutu tggaaaguag gutgutgggg 180 gagtgtuygg gygtuyguuu uaggguuutg aggutaagag uatgautgua ggaggaggaa 240 ggtggggutu aaaguagauu uaggaggaag ttttgatgau tuauatuaut aagatguttg 300

<210> SEQ ID NO 523
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 523 tgatgauuag guautgutat tutttagguy gggatttuuu uaaguuttgg tatttttaaa 60 aataygttat agttuuuttg aaautututu uttatuauut uuauuttuut gttttuatut 120 uuuautuutt gguauuutut gtutuuuuay ggtgtuuuua tgaygutguu tguatguuua 180 ttgguuuuag uutgggagut tutuagagay guuyggguua gauatggutg uagatagagu 240 uaagagggtg guutygggtg gutggtggua gtutuutggu tgtgggggua gaagtggggg 300

<210> SEQ ID NO 524
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 524 uuuuuauttu tguuuuuaua guuaggagau tguuauuagu uauuygaggu uauuututtg 60 gututatutg uaguuatgtu tgguuygggy gtututgaga agutuuuagg utgggguuaa 120 tggguatgua gguagygtua tggggauauy gtggggagau agagggtguu aaggagtggg 180 agatgaaaau aggaaggtgg aggtgataag gagagagttt uaagggaaut ataaygtatt 240 tttaaaaata uuaagguttg gggaaatuuy gguutaaaga ataguagtgu utggtuatua 300

<210> SEQ ID NO 525
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 525 guutaguuuy gygyguauat auaygtgtgu tutuygygyg gauutyggga autttguuut 60 uayguuygyg gygyguttgu utuuyguuyg uuuygguutu uauuuuttyg agatguuuut 120 tuuuuaguyg gtutuuuutu uuuuygguty gggaagaagu utgutggguu agggyguuut 180 gauuauutuu tyggagguyg guaaauutgu utgaauyguu uuagaggaat yggguagggg 240 utyguauuuu auuuygguag gaggguuuyg agauygauuy ggguyggggu tuyguaguyg 300

<210> SEQ ID NO 526
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 526 yggutgygga guuuygguuy gggtyggtut ygggguuutu utguyggggt ggggtgygag 60 uuuutguuyg attuututgg ggyggttuag guaggtttgu ygguutuyga ggaggtggtu 120 agggyguuut gguuuaguag guttuttuuy gaguyggggg gaggggagau yggutgggga 180 aggguatut ygaaggggtg gagguygggg ygggygggag guaagygygu ygygggygtg 240 aggguaaagt tuuygaggtu ygygyggaga guauaygtgt atgtgygygy ggggutaggu 300

<210> SEQ ID NO 527
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 527 gaaayggygg tyguaguuut ygguygggua ygygtggggu ygttygtgga gyggtgtutt 60 gutagguygg ttggggtaut tgyggggguyg gatgggguttg agggtgagyg gyggutgggg 120 uaggutguua aaguuygggt ggatutgutt gtutttgaat guuttgatgg tutuuagagg 180 ggtaataggg ggygggttga uuyggatggg gtuuatguuu tggaagggut tgtgutuygg 240 aatggaguuu atgtygttgg ggtggtggta gaggttgtag tuaggaatua tggggaagag 300

<210> SEQ ID NO 528
<211> LENGTH: 301
<212> TYPE: DNA
<213> ORGANISM: Artificial Sequence
<220> FEATURE:
<223> OTHER INFORMATION: Synthetic polynucleotide

<400> SEQUENCE: 528 ututtuuuua tgattuutga utauaauutu tauuauuauu uuaaygauat gggutuuatt 60 uyggaguaua aguuuttuua ggguatggau uuuatuyggg tuaauuyguu uuutattauu 120 uututggaga uuatuaaggu attuaaagau aaguagatuu auuygggutt tgguaguutg 180 uuuuaguygu yygutuauuu tuaaguuuat uygguuuygu aagtauuuua auygguutag 240 uaagauauyg utuuaygaay gguuuuaygy gtguuygguy gagggutgyg auyguygttt 300 u 301

<210> SEQ ID NO 529
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 529 tguuuaggut ggagtguagt gguaaaatut tggutuautt uaauutuygu utuuygggtt 60 uaaguaattu tuutguutua guututuaag tagutgggat tauagguatg uauuatuaua 120 uuuagutgat tttgtatttt tagtagagay ggggtttuau uaygttgttu aagutggtut 180 uaaautuutg auutuaggtg atuuauuygu uttgguutuu uaaagtguyg ggattatagg 240 tgtgaguuau yguauutggg uaattagtat tgtatttaag agtttatatt uatatuuata 300

<210> SEQ ID NO 530
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 530 tatggatatg aatataaaut uttaaataua atautaattg uuuaggtgyg gtggutuaua 60 uutataatuu ygguautttg ggagguuaag gygggtggat uauutgaggt uaggagtttg 120 agauuagutt gaauaaygtg gtgaaauuuy gtututauta aaaatauaaa atuagutggg 180 tgtgatggtg uatguutgta atuuuaguta uttgagaggu tgagguagga gaattguttg 240 aauuygggag gyggaggttg aagtgaguua agattttguu autguautuu aguutgggua 300

<210> SEQ ID NO 531
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 531 tgttauttua ttgaattutu ataatagutt aatgutatyg gttttuttut taattttggg 60 gguatagtgg ggagataagu aaautgatau uuyggaggtt gagtgautua ttuatggaat 120 guaguagguu ygtgagtuaa agygagtaua tgguaagauy gagtgaagut ggggaauaat 180 aguuaaguua agagygtttt aaagatautt aguatuttua tuauautgaa tuutaaggtg 240 auaguauttu uautygauag uaaaatgtua gattuaautg tttutttuyg gtuttuaaau 300

<210> SEQ ID NO 532
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 532 gtttgaagau yggaaagaaa uagttgaatu tgauattttg utgtygagtg gaagtgutgt 60 uauuttagga ttuagtgtga tgaagatgut aagtatuttt aaaaygutut tgguttggut 120 attgttuuuu aguttuauty ggtuttguua tgtautygut ttgautuayg gguutgutgu 180 attuuatgaa tgagtuautu aauutuyggg gtatuagttt guttatutuu uuautatguu 240 uuuaaaatta agaagaaaau ygataguatt aagutattat gagaattuaa tgaagtaaua 300

<210> SEQ ID NO 533
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 533 ttagtattau uaaatatyga gtuaaggguu tgatuaguuu uaaaagaatg agguautttt 60 aatgtgauau uattuutggu agtutuaggt tyggututuu uagguuuygg atguagatgg 120 utgttagggg utgguuatuu tuatutuaay ggtuutggaa gguauuautt tuaggguata 180 tguuatgaut aauattuygg tgaguaatgu tgautuaaty gtagautgtt atttuatgtt 240 uuuagtauuu tgtguaggaa gggaagggaa atgagtaata gatgtatuag tuuuattuaa 300

<210> SEQ ID NO 534
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 534 ttgaatggga utgatauatu tattautuat ttuuuttuuu ttuutguaua gggtautggg 60 aauatgaaat aauagtutay gattgagtua guattgutua uyggaatgtt agtuatggua 120 tatguuutga aagtggtguu ttuuaggauy gttgagatga ggatgguuag uuuutaauag 180 uuatutguat uyggggguutg ggagaguyga auutgagaut guuaggaatg gtgtuauatt 240 aaaagtguut uattuttttg gggutgatua gguuuttgau tygatatttg gtaatautaa 300

<210> SEQ ID NO 535
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 535 agtggtggut gutgtttuty ggtgguagag atgatguutg gtttattutt agtaaagtgu 60 ttaggaygut gaguutgagg ggututggaa tggaaaaaua aaauaaaaua aaauaaauyg 120 gagguuygut utguutggut uutagagaua yguaaagutg gguaaaggaa ggagattgag 180 gtgggautga gauattgttg uattgtgaat guuuyggttu uuuauutuut guuuuuygaa 240 tuatgattgt tttatgyggt tatttttuuu tttggtgagg aaaatgggat gtggtgtuaa 300

<210> SEQ ID NO 536
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 536 ttgauauuau atuuuatttt uutuauuaaa gggaaaaata auyguataaa auaatuatga 60 ttyggggggu aggaggtggg gaauyggggu attuauaatg uaauaatgtu tuagtuuuau 120 utuaatutuu ttuutttguu uagutttgyg tgtututagg aguuagguag agyggguutu 180 yggtttgttt tgttttgttt tgtttttuua ttuuagaguu uutuaggutu agygtuutaa 240 guautttaut aagaataaau uagguatuat ututguuauy gagaaauagu aguuauuaut 300

<210> SEQ ID NO 537
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 537 ggggtyggua tgggutggag utuagagayg guuagutagg auttuaggau auauaguaaa 60 utagutgygu uuygutgagg gtuagyguau aguyguuuau auaaggtgtu ututuuuygg 120 gutututggg uyguygguut uutguttuuy gtguyguaga uygggattag autgtggayg 180 yggggaagga agggggygtt gygaygggat uttgagggga guaggauttg uuuutguuuu 240 tgyggygaag ututagguuu tgguaaggtt yggtauauyg gggguygutu utuuuuaggg 300

<210> SEQ ID NO 538
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 538 uuutggggag gagygguuuu yggtgtauyg aauuttguua ggguutagag uttyguygua 60 gggguagggg uaagtuutgu tuuuutuaag atuuygtygu aayguuuuut tuuttuuuyg 120 ygtuuauagt utaatuuygg tutgygguay gggaaguagg agguyggygg uuuagagagu 180 uyggggagag gauauuttgt gtgggyggut gtgygutgau uutuagyggg gyguagutag 240 tttgutgtgt gtuutgaagt uutagutggu ygtututgag utuuaguuua tguygauuuu 300

<210> SEQ ID NO 539
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 539 gtguayguag ggaaatauut uauagggtaa atttggatuy gattgagaau aggaaguuau 60 agguuaatau aaggaggutu tgtgagaaua gatgauaaau uauaaguygg ggagggggag 120 gaaagagutt tutggguutg ggggatgggy gaguuyguua guauauuaua uauagutgyg 180 uttgguutua gtaatuaaaa uuatuattau agauutgayg gtttggutgu agutgtaaag 240 agataaguat gttggaagag aaaauagggu uuyggtgauu ygguuttagg gtutgagygu 300

<210> SEQ ID NO 540
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 540 ygutuagauu utaagguygg gtuauygggg uuutgttttu tuttuuaaua tguttatutu 60 tttauagutg uaguuaaauy gtuaggtutg taatgatggt tttgattaut gagguuaagy 120 guagutgtgt gtggtgtgut ggygggutyg uuuatuuuuu agguuuagaa agututttuu 180 tuuuuutuuu ygguttgtgg tttgtuatut gttutuauag aguutuuttg tattgguutg 240 tgguttuutg ttutuaatyg gatuuaaatt tauuutgtga ggtatttuuu tgygtguaua 300

<210> SEQ ID NO 541
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 541 tgtgygggua gtgggttgtg yggguagtgg gttgtguatu yggatgtgta guautuauau 60 auttygggtg aututtuutg ggtaagutgt ggatgtgagt ggggguagua tutguygtga 120 utuattutut uututttuua ttuuaaguyg ggtgggggag tttgggattt uuagauaagg 180 uutggutuuu uutgguauag agggtgggag tggggatggg gagggaggag ggaagggtua 240 tgggaaggtg gggguuatgtt ttgtgutuaa tgaautgaga agggggaggg ttuuagutgg 300

<210> SEQ ID NO 542
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 542 uagutggaau uutuuuuutt utuagttuat tgaguauaaa auatgguuuu auuttuuuat 60 gauuuttuuu tuutuuutuu uuatuuuuau tuuuauuutu tgtguuaggg ggaguuaggu 120 uttgtutgga aatuuuaaau tuuuuuauuy gguttggaat ggaaagagga gagaatgagt 180 uaygguagat gutguuuuua utuauatuua uaguttauuu aggaagagtu auuygaagtg 240 tgtgagtgut auauatuygg atguauaauu uautguuygu auaauuuaut guuyguauaa 300

<210> SEQ ID NO 543
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 543 guaautggyg utgggtaggu aaaguyggga gaaautgutg agaygaggtt aggatttaau 60 utttaaattu tggaguuaty ggaaauygag gggaggayga ygggtgtygg tgutaatgag 120 gutgggggyg ggygatgygy ggtggguutu ygagtuyggg guaggtutyg ggggttuuuy 180 ggggaagguu utgggaguuu ttgguuutgg ygguutuygu uatuagautg ggaatgtutu 240 tgattgggtg guuaggaggy ggtgguuutu utuuuyguuu agutgagggg tgtygtuttu 300

<210> SEQ ID NO 544
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 544 gaagaygaua uuuutuagut gggygggag gaggguuauy guutuutggu uauuuaatua 60 gagauattuu uagtutgatg gyggagguyg uuaggguuaa gggutuuuag gguuttuuuy 120 ggggaauuuu ygagauutgu uuyggautyg gagguuuauy gyguatyguu yguuuuuagu 180 utuattagua uygauauuyg tygtuutuuu utyggtttuy gatggutuua gaatttaaag 240 gttaaatuut aauutygtut uaguagtttu tuuygguttt guutauuuag yguuagttgu 300

<210> SEQ ID NO 545
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 545 ggguauuutu tggtguttuu agguutgtga attgguauag uaggauuaua gauutuuaag 60 gtguuuauut gggggutuag aauuutggyg gggaaggtua gtgutatuuu auyggagaag 120 agauutagtu tagutgaguu uutgguuagy gguaaggagg aaaggatgaa uatuaguuay 180 guutgguaut gautguuaua guuagaguut yguuuaguuu aagaatgttt utgttutaag 240 auttttttut tttttgtatt ttagaaatta tuauagguaa atgtuauutt gaagauuygg 300

<210> SEQ ID NO 546
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 546 uygggtuttu aaggtgauat ttguutgtga taatttutaa aatauaaaaa agaaaaaagt 60 uttagaauag aaauattutt gggutgggyg aggututggu tgtgguagtu agtguuaggy 120 gtggutgatg ttuatuuttt uutuuttguy gutgguuagg ggutuaguta gautaggtut 180 uttutuyggt gggataguau tgauuttuuu yguuagggtt utgaguuuuu aggtggguau 240 uttggaggtu tgtggtuutg utgtguuaat tuauagguut ggaaguauua gagggtguuu 300

<210> SEQ ID NO 547
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 547 utuatggaga ggaguagaga tguaggaaay guaauaguag uaygguagaa ayguaggaga 60 aauaguuuyg uutuagaguy guuuauutuu tuuyguuatg uuaggaaggg uuagtgtuuu 120 tuuagayguy ggtgautgtu aygtuagaua ygtgaygtgt ggutgtguuu agattuttgg 180 yggtgaguuu yggygaggga uuuagyggtu tuuyggygtu tggtttaggg ggggatutuy 240 guaagauuuy guuyguaygt ggutuutgtg agggguautg ygygygaagg utgtggtutg 300

<210> SEQ ID NO 548
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 548 uagauuauag uuttygygyg uagtguuuut uauaggaguu aygtgygggy ggggtuttgy 60 ggagatuuuu uuutaaauua gayguyggga gauygutggg tuuutyguyg gggutuauyg 120 uuaagaatut ggguauaguu auaygtuayg tgtutgaygt gauagtuauy ggygtutgga 180 gggauautgg uuuttuutgg uatggyggga ggaggtgggy ggututgagg yggggutgtt 240 tutuutgygt ttutguygtg utgutgttgy gtttuutgua tututgutuu tutuuatgag 300

<210> SEQ ID NO 549
<211> LENGTH: 300
<212> TYPE: DNA
<213> ORGANISM: Artificial Sequence
<220> FEATURE:
<223> OTHER INFORMATION: Synthetic polynucleotide

<400> SEQUENCE: 549 ututuuautg tguagguuau utgtagggau agtguuagtg ggtgtaggag aggtggygag 60 gutguaguag tgygggatgg gutuuuuaua uuuuuaaata utuuauatgg ggtuyggggu 120 uttuuuagga uutgggguag gtgyguaygu utgggygggg uuaguuagut ygtgutgagt 180 uauygggtgu ygtuagtgag gguutgguuu uauuutyggg aauuauyggt gutggttttu 240 uuayggutgu tguuygutgt gggguuttgut gtuauuuaua agguuutggg agguuutguu 300

<210> SEQ ID NO 550
<211> LENGTH: 300
<212> TYPE: DNA
<213> ORGANISM: Artificial Sequence
<220> FEATURE:

<223> OTHER INFORMATION: Synthetic polynucleotide

<400> SEQUENCE: 550 gguaggguut uuuaggguut tgtgggtgau aguaagguuu auagygggua guaguygtgg 60 gaaaauuagu auyggtggtt uuygagggtg gggguuagguu utuautgayg guauuyggtg 120 autuaguayg agutggutgg uuuyguuuag gygtgyguau utgguuuagg tuutgggaag 180 guuuyggauu uuatgtggag tatttggggg tgtggggagu uuatuuygua utgutguagu 240 utyguuauut utuutauauu uautgguaut gtuuutauag gtgguutgua uagtggagag 300

<210> SEQ ID NO 551
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 551 gggagaagag attggaaaa 19

<210> SEQ ID NO 552
<211> LENGTH: 27
<212> TYPE: DNA
<213> ORGANISM: Artificial Sequence
<220> FEATURE:
<223> OTHER INFORMATION: Synthetic polynucleotide

<400> SEQUENCE: 552 ctaaaaacct aacactaaca acataat 27

<210> SEQ ID NO 553
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 553 tgttgtttaa aatgttgttt 20

<210> SEQ ID NO 554
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 554 aaccctaaat aattcttctc 20

<210> SEQ ID NO 555
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 555 gggttgggtt gaggtttt 18

<210> SEQ ID NO 556
<211> LENGTH: 25
<212> TYPE: DNA
<213> ORGANISM: Artificial Sequence <220> FEATURE:
<223> OTHER INFORMATION: Synthetic polynucleotide

<400> SEQUENCE: 556 acaccttaca tctcatttac aactc 25

<210> SEQ ID NO 557
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 557 aatttgtgaa aagtttgtgt a 21

<210> SEQ ID NO 558
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 558 cccaatcacc tttaatct 18

<210> SEQ ID NO 559
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 559 gttgggattt gaaatagtga 20

<210> SEQ ID NO 560
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 560 cctccactca cctaaaactt 20

<210> SEQ ID NO 561
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 561 ttggttagtg attatttatt 20

<210> SEQ ID NO 562
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 562 aaaaattaat ataaaattaa aa 22

<210> SEQ ID NO 563
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 563 tttgtaggga gttagggat 19

<210> SEQ ID NO 564
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 564 tcctctatct caccctaaat 20

<210> SEQ ID NO 565
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 565 tttgattgaa ttatttgtgt att 23

<210> SEQ ID NO 566
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 566 actcccttac tcctaaacac t 21

<210> SEQ ID NO 567
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 567 agtggagatg gtagggaga 19

<210> SEQ ID NO 568
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 568 cccaaaacta aaaccaaata taa 23

<210> SEQ ID NO 569
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 569 ttgtggttaa atttattg 18

<210> SEQ ID NO 570
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 570 acccaacaaa ataatatc 18

<210> SEQ ID NO 571
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 571 tgaggtagag ttgtgtgtat at 22

<210> SEQ ID NO 572
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 572 atcaatcaat tctcattaaa c 21

<210> SEQ ID NO 573
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 573 ggaagttagg aagggttgt 19

<210> SEQ ID NO 574
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 574 ctccaactcc aactaaaact c 21

<210> SEQ ID NO 575
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 575 ttgggtattg atttatttt 19

<210> SEQ ID NO 576

<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 576 aaattctacc tacaaactat aca 23

<210> SEQ ID NO 577
<211> LENGTH: 25
<212> TYPE: DNA
<213> ORGANISM: Artificial Sequence
<220> FEATURE:
<223> OTHER INFORMATION: Synthetic polynucleotide

<400> SEQUENCE: 577 aggatgaagt aataattaaa tattg 25

<210> SEQ ID NO 578
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 578 cccactctac caactaaac 19

<210> SEQ ID NO 579
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 579 aggtttgtgt tagtataaat 20

<210> SEQ ID NO 580
<211> LENGTH: 24
<212> TYPE: DNA
<213> ORGANISM: Artificial Sequence
<220> FEATURE:
<223> OTHER INFORMATION: Synthetic polynucleotide

<400> SEQUENCE: 580 ttcttaccta tataattaat aata 24

<210> SEQ ID NO 581
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 581 gttgggtgaa ttttattag 19

<210> SEQ ID NO 582
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 582 tcaaaaccta aactctaaca 20

<210> SEQ ID NO 583
<211> LENGTH: 24
<212> TYPE: DNA
<213> ORGANISM: Artificial Sequence
<220> FEATURE:
<223> OTHER INFORMATION: Synthetic polynucleotide

<400> SEQUENCE: 583 ggattggttt tatatagaaa gtat 24

<210> SEQ ID NO 584
<211> LENGTH: 26
<212> TYPE: DNA
<213> ORGANISM: Artificial Sequence
<220> FEATURE:
<223> OTHER INFORMATION: Synthetic polynucleotide

<400> SEQUENCE: 584 caaataataa atcataactc ttaact 26

<210> SEQ ID NO 585
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 585 tggggtagtt gatggttt 18

<210> SEQ ID NO 586
<211> LENGTH: 26
<212> TYPE: DNA
<213> ORGANISM: Artificial Sequence
<220> FEATURE:
<223> OTHER INFORMATION: Synthetic polynucleotide

<400> SEQUENCE: 586 ctttctaaca aaataaaaaa atttaa 26

<210> SEQ ID NO 587
<211> LENGTH: 28
<212> TYPE: DNA
<213> ORGANISM: Artificial Sequence
<220> FEATURE:
<223> OTHER INFORMATION: Synthetic polynucleotide

<400> SEQUENCE: 587 ttgtatttga agtttgtaga gatttata 28

<210> SEQ ID NO 588
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 588 tttcctccaa caactcaat 19

<210> SEQ ID NO 589
<211> LENGTH: 27
<212> TYPE: DNA

<213> ORGANISM: Artificial Sequence
<220> FEATURE:
<223> OTHER INFORMATION: Synthetic polynucleotide

<400> SEQUENCE: 589 ttatgagtat gtagtagggt tattata 27

<210> SEQ ID NO 590
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 590 aaaatatcaa acaaatttat cc 22

<210> SEQ ID NO 591
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 591 tggttgtttg ttttttatgt att 23

<210> SEQ ID NO 592
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 592 tccctacctc ccaaattc 18

<210> SEQ ID NO 593
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 593 tatgatgatt gttgtagtgt aga 23

<210> SEQ ID NO 594
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 594 cctccctaat aactaaaaat ac 22

<210> SEQ ID NO 595
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 595 ggtggttttg atatttagtg 20

<210> SEQ ID NO 596
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 596 cccaattacc taacaaatta 20

<210> SEQ ID NO 597
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 597 tgggataggt gtagatatg 19

<210> SEQ ID NO 598
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 598 caacaaaaac taaaacacta tac 23

<210> SEQ ID NO 599
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 599 tttgggattg gttatttt 18

<210> SEQ ID NO 600
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 600 aaacccctta actctatacc 20

<210> SEQ ID NO 601
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 601 gattttttg agaagagtat ag 22

<210> SEQ ID NO 602
<211> LENGTH: 21
<212> TYPE: DNA
<213> ORGANISM: Artificial Sequence
<220> FEATURE:

<223> OTHER INFORMATION: Synthetic polynucleotide

<400> SEQUENCE: 602 aaccactacc acctaaatat a 21

<210> SEQ ID NO 603
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 603 ggaggatagg gtgtgatt 18

<210> SEQ ID NO 604
<211> LENGTH: 27
<212> TYPE: DNA
<213> ORGANISM: Artificial Sequence
<220> FEATURE:
<223> OTHER INFORMATION: Synthetic polynucleotide

<400> SEQUENCE: 604 acatttttaa ctctaactaa aaataaa 27

<210> SEQ ID NO 605
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 605 tggaaatgag gtgagttt 18

<210> SEQ ID NO 606
<211> LENGTH: 26
<212> TYPE: DNA
<213> ORGANISM: Artificial Sequence
<220> FEATURE:
<223> OTHER INFORMATION: Synthetic polynucleotide

<400> SEQUENCE: 606 aaaaaaaaat aaaataacaa taacta 26

<210> SEQ ID NO 607
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 607 tggagagttt agtttgttt 19

<210> SEQ ID NO 608
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 608 caaaaaaaaa tctaacaac 19

<210> SEQ ID NO 609
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 609 tgggttttag ttatgtggtt 20

<210> SEQ ID NO 610
<211> LENGTH: 26
<212> TYPE: DNA
<213> ORGANISM: Artificial Sequence
<220> FEATURE:
<223> OTHER INFORMATION: Synthetic polynucleotide

<400> SEQUENCE: 610 atcaataata tccaacaaaa taatat 26

<210> SEQ ID NO 611
<211> LENGTH: 27
<212> TYPE: DNA
<213> ORGANISM: Artificial Sequence
<220> FEATURE:
<223> OTHER INFORMATION: Synthetic polynucleotide

<400> SEQUENCE: 611 ttttttttagt ttttgtatat atattag 27

<210> SEQ ID NO 612
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 612 acccaaataa tcaactctt 19

<210> SEQ ID NO 613
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 613 gtggtttttg gagattta 18

<210> SEQ ID NO 614
<211> LENGTH: 25
<212> TYPE: DNA
<213> ORGANISM: Artificial Sequence
<220> FEATURE:
<223> OTHER INFORMATION: Synthetic polynucleotide

<400> SEQUENCE: 614 aaacaaacta caaataaaat aatac 25

<210> SEQ ID NO 615
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 615 gggttatagg tttgagtta 19

<210> SEQ ID NO 616
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 616 ccattaaaaa aaataaaatc 20

<210> SEQ ID NO 617
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 617 ttggtagatt tagtaaattt att 23

<210> SEQ ID NO 618
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 618 aaacttaaac aaccctatat ac 22

<210> SEQ ID NO 619
<211> LENGTH: 27
<212> TYPE: DNA
<213> ORGANISM: Artificial Sequence
<220> FEATURE:
<223> OTHER INFORMATION: Synthetic polynucleotide

<400> SEQUENCE: 619 atggttttaa agagtagtag tatagtt 27

<210> SEQ ID NO 620
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 620 aaatttactc atcccacttc 20

<210> SEQ ID NO 621
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 621 aggggttggg atattgtt 18

<210> SEQ ID NO 622
<211> LENGTH: 25

<212> TYPE: DNA
<213> ORGANISM: Artificial Sequence
<220> FEATURE:
<223> OTHER INFORMATION: Synthetic polynucleotide

<400> SEQUENCE: 622 aaaaatttct cctacaaaaa actaa 25

<210> SEQ ID NO 623
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 623 atgggtgttt ggaattttta 20

<210> SEQ ID NO 624
<211> LENGTH: 25
<212> TYPE: DNA
<213> ORGANISM: Artificial Sequence
<220> FEATURE:
<223> OTHER INFORMATION: Synthetic polynucleotide

<400> SEQUENCE: 624 ctacctcaac ctcctaaata actaa 25

<210> SEQ ID NO 625
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 625 gtgttttgtg gtaaagatat ag 22

<210> SEQ ID NO 626
<211> LENGTH: 24
<212> TYPE: DNA
<213> ORGANISM: Artificial Sequence
<220> FEATURE:
<223> OTHER INFORMATION: Synthetic polynucleotide

<400> SEQUENCE: 626 attcttaaat taattcaact acat 24

<210> SEQ ID NO 627
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 627 tgggggtaaa agttatagtt 20

<210> SEQ ID NO 628
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 628 aaaaaaacaaa aaaccaaata c 21

<210> SEQ ID NO 629
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 629 gtttttggt tagtgtgtt 19

<210> SEQ ID NO 630
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 630 ccccatactt ctatactata at 22

<210> SEQ ID NO 631
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 631 ttgttgtttt taaagaaatt ata 23

<210> SEQ ID NO 632
<211> LENGTH: 24
<212> TYPE: DNA
<213> ORGANISM: Artificial Sequence
<220> FEATURE:
<223> OTHER INFORMATION: Synthetic polynucleotide

<400> SEQUENCE: 632 atcatctaaa cttaactcat ctaa 24

<210> SEQ ID NO 633
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 633 atttttgggt gttttatatt 20

<210> SEQ ID NO 634
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 634 aaacctcaaa caataaca 18

<210> SEQ ID NO 635
<211> LENGTH: 24
<212> TYPE: DNA
<213> ORGANISM: Artificial Sequence <220> FEATURE:
<223> OTHER INFORMATION: Synthetic polynucleotide

<400> SEQUENCE: 635 attaaggata tttaggagag taag 24

<210> SEQ ID NO 636
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 636 acaccacaac ttcaaactac 20

<210> SEQ ID NO 637
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 637 tgaggaagag agaagagatg ata 23

<210> SEQ ID NO 638
<211> LENGTH: 30
<212> TYPE: DNA
<213> ORGANISM: Artificial Sequence
<220> FEATURE:
<223> OTHER INFORMATION: Synthetic polynucleotide

<400> SEQUENCE: 638 aaaactaaac tataaaacaa aacaaaacta 30

<210> SEQ ID NO 639
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 639 ggtggaggtg ttttttatag 20

<210> SEQ ID NO 640
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 640 ccaaatacta ctttcaaaat aca 23

<210> SEQ ID NO 641
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 641 atggattatt attgtgttat t 21

<210> SEQ ID NO 642
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 642 catctcaacc tcatactaa 19

<210> SEQ ID NO 643
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 643 ggatgattta gtagggattg ag 22

<210> SEQ ID NO 644
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 644 ccaaataaaa accattctct aac 23

<210> SEQ ID NO 645
<211> LENGTH: 24
<212> TYPE: DNA
<213> ORGANISM: Artificial Sequence
<220> FEATURE:
<223> OTHER INFORMATION: Synthetic polynucleotide

<400> SEQUENCE: 645 ttggattaag tatttttgat atta 24

<210> SEQ ID NO 646
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 646 tccctaaacc atatattact aaa 23

<210> SEQ ID NO 647
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 647 gggtagtttg gtgattatta tt 22

<210> SEQ ID NO 648
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 648 cccttcccta ctcacaata 19

<210> SEQ ID NO 649
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 649 atttggttag tgatttagtt att 23

<210> SEQ ID NO 650
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 650 tcccacttaa aaaattctat a 21

<210> SEQ ID NO 651
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 651 agtggggaag gtaattgtta t 21

<210> SEQ ID NO 652
<211> LENGTH: 30
<212> TYPE: DNA
<213> ORGANISM: Artificial Sequence
<220> FEATURE:
<223> OTHER INFORMATION: Synthetic polynucleotide

<400> SEQUENCE: 652 ctttctaata aaaatttact aaaacctcta 30

<210> SEQ ID NO 653
<211> LENGTH: 24
<212> TYPE: DNA
<213> ORGANISM: Artificial Sequence
<220> FEATURE:
<223> OTHER INFORMATION: Synthetic polynucleotide

<400> SEQUENCE: 653 tttggttagt tttatttttg attg 24

<210> SEQ ID NO 654
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 654 attcctccct atccctattc 20

<210> SEQ ID NO 655

<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 655 gggatagggg ttagagtaa 19

<210> SEQ ID NO 656
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 656 tccataaaaa caaaacactc 20

<210> SEQ ID NO 657
<211> LENGTH: 25
<212> TYPE: DNA
<213> ORGANISM: Artificial Sequence
<220> FEATURE:
<223> OTHER INFORMATION: Synthetic polynucleotide

<400> SEQUENCE: 657 ttttttagta tgagttataa attat 25

<210> SEQ ID NO 658
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 658 aaaacaaaat ctacctatat att 23

<210> SEQ ID NO 659
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 659 ttttattaat aaagtaggta tga 23

<210> SEQ ID NO 660
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 660 acctttctca aaattactaa 20

<210> SEQ ID NO 661
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 661 atagggttga ggttagagtt at 22

<210> SEQ ID NO 662
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 662 cctcctctcc acaataaa 18

<210> SEQ ID NO 663
<211> LENGTH: 26
<212> TYPE: DNA
<213> ORGANISM: Artificial Sequence
<220> FEATURE:
<223> OTHER INFORMATION: Synthetic polynucleotide

<400> SEQUENCE: 663 tttaagtttt tttttagttt tgtagt 26

<210> SEQ ID NO 664
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 664 ccccatcctc tctatctc 18

<210> SEQ ID NO 665
<211> LENGTH: 26
<212> TYPE: DNA
<213> ORGANISM: Artificial Sequence
<220> FEATURE:
<223> OTHER INFORMATION: Synthetic polynucleotide

<400> SEQUENCE: 665 aaatttaaaa tttagaggtt tttata 26

<210> SEQ ID NO 666
<211> LENGTH: 24
<212> TYPE: DNA
<213> ORGANISM: Artificial Sequence
<220> FEATURE:
<223> OTHER INFORMATION: Synthetic polynucleotide

<400> SEQUENCE: 666 aaacttcaca cacaaatcta tatt 24

<210> SEQ ID NO 667
<211> LENGTH: 25
<212> TYPE: DNA
<213> ORGANISM: Artificial Sequence
<220> FEATURE:
<223> OTHER INFORMATION: Synthetic polynucleotide

<400> SEQUENCE: 667 tttttatttt atttttatt tttaa 25

<210> SEQ ID NO 668
<211> LENGTH: 24
<212> TYPE: DNA

<213> ORGANISM: Artificial Sequence
<220> FEATURE:
<223> OTHER INFORMATION: Synthetic polynucleotide

<400> SEQUENCE: 668 atacctccct aattatatta ttaa 24

<210> SEQ ID NO 669
<211> LENGTH: 25
<212> TYPE: DNA
<213> ORGANISM: Artificial Sequence
<220> FEATURE:
<223> OTHER INFORMATION: Synthetic polynucleotide

<400> SEQUENCE: 669 ttttagaata tttaaagaag ttagt 25

<210> SEQ ID NO 670
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 670 taacctcact ttcctatca 19

<210> SEQ ID NO 671
<211> LENGTH: 26
<212> TYPE: DNA
<213> ORGANISM: Artificial Sequence
<220> FEATURE:
<223> OTHER INFORMATION: Synthetic polynucleotide

<400> SEQUENCE: 671 aatttagtat aagatttgat ttgtta 26

<210> SEQ ID NO 672
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 672 ccacctactc cttcctatac 20

<210> SEQ ID NO 673
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 673 ttttttgaaa ttgtatgtta t 21

<210> SEQ ID NO 674
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 674 caaatcctta aaattctata a 21

<210> SEQ ID NO 675
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 675 tttgaagtgg tgttttag 18

<210> SEQ ID NO 676
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 676 ccaaaattct tccatact 18

<210> SEQ ID NO 677
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 677 tgggtattta gtttttgtg 20

<210> SEQ ID NO 678
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 678 aacaactacc tccttttact aat 23

<210> SEQ ID NO 679
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 679 tatggtagga ggtggagtt 19

<210> SEQ ID NO 680
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 680 cccaatttta aaacaatac 19

<210> SEQ ID NO 681
<211> LENGTH: 22
<212> TYPE: DNA
<213> ORGANISM: Artificial Sequence
<220> FEATURE:

<223> OTHER INFORMATION: Synthetic polynucleotide

<400> SEQUENCE: 681 agaggaagta aggttattag tt 22

<210> SEQ ID NO 682
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 682 accaaacaaa caatatctaa 20

<210> SEQ ID NO 683
<211> LENGTH: 24
<212> TYPE: DNA
<213> ORGANISM: Artificial Sequence
<220> FEATURE:
<223> OTHER INFORMATION: Synthetic polynucleotide

<400> SEQUENCE: 683 ggttttaatt atgatttaat taga 24

<210> SEQ ID NO 684
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 684 cctacactca aatttacctc ta 22

<210> SEQ ID NO 685
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 685 aatgggtagt tgatataatt att 23

<210> SEQ ID NO 686
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 686 cacaaaatcc taaaactaaa a 21

<210> SEQ ID NO 687
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 687 aggattagtg gaaatgaaaa ta 22

<210> SEQ ID NO 688
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 688 taacctcaaa acaacttcta aac 23

<210> SEQ ID NO 689
<211> LENGTH: 25
<212> TYPE: DNA
<213> ORGANISM: Artificial Sequence
<220> FEATURE:
<223> OTHER INFORMATION: Synthetic polynucleotide

<400> SEQUENCE: 689 tttttttat agagaagtat tttag 25

<210> SEQ ID NO 690
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 690 cccattacaa aactatcc 18

<210> SEQ ID NO 691
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 691 ggtgagtttg tggttagtg 19

<210> SEQ ID NO 692
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 692 ttttctaaaa aaatccaatc ta 22

<210> SEQ ID NO 693
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 693 aatggatagg ttggaatag 19

<210> SEQ ID NO 694
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 694 aaaaaaaaaa aaaaactaat tac 23

<210> SEQ ID NO 695
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 695 gagttattta gtttggttag gt 22

<210> SEQ ID NO 696
<211> LENGTH: 24
<212> TYPE: DNA
<213> ORGANISM: Artificial Sequence
<220> FEATURE:
<223> OTHER INFORMATION: Synthetic polynucleotide

<400> SEQUENCE: 696 actcaactta aaaaatcact atac 24

<210> SEQ ID NO 697
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 697 tttttttgg ttttttggtt tt 22

<210> SEQ ID NO 698
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 698 tcccccacac ccatataa 18

<210> SEQ ID NO 699
<211> LENGTH: 25
<212> TYPE: DNA
<213> ORGANISM: Artificial Sequence
<220> FEATURE:
<223> OTHER INFORMATION: Synthetic polynucleotide

<400> SEQUENCE: 699 ttaaaaaaaa gtataatgag tagga 25

<210> SEQ ID NO 700
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 700 cccacaaaaa ctctctaca 19

<210> SEQ ID NO 701
<211> LENGTH: 24

<212> TYPE: DNA
<213> ORGANISM: Artificial Sequence
<220> FEATURE:
<223> OTHER INFORMATION: Synthetic polynucleotide

<400> SEQUENCE: 701 aaaggaggtt gagttagaaa gtag 24

<210> SEQ ID NO 702
<211> LENGTH: 26
<212> TYPE: DNA
<213> ORGANISM: Artificial Sequence
<220> FEATURE:
<223> OTHER INFORMATION: Synthetic polynucleotide

<400> SEQUENCE: 702 aactatttaa cttacttaac cacacc 26

<210> SEQ ID NO 703
<211> LENGTH: 25
<212> TYPE: DNA
<213> ORGANISM: Artificial Sequence
<220> FEATURE:
<223> OTHER INFORMATION: Synthetic polynucleotide

<400> SEQUENCE: 703 ggtgtggtta agtaagttaa atagt 25

<210> SEQ ID NO 704
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 704 taccccttcc tcttcaac 18

<210> SEQ ID NO 705
<211> LENGTH: 24
<212> TYPE: DNA
<213> ORGANISM: Artificial Sequence
<220> FEATURE:
<223> OTHER INFORMATION: Synthetic polynucleotide

<400> SEQUENCE: 705 ttttgatatg atttatgatt atat 24

<210> SEQ ID NO 706
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 706 ttttccacta aacaacacta 20

<210> SEQ ID NO 707
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 707 tttgagggtt gttttagat 19

<210> SEQ ID NO 708
<211> LENGTH: 26
<212> TYPE: DNA
<213> ORGANISM: Artificial Sequence
<220> FEATURE:
<223> OTHER INFORMATION: Synthetic polynucleotide

<400> SEQUENCE: 708 actcacaaaa aataactaat aactat 26

<210> SEQ ID NO 709
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 709 aaaggaggta ggggagatat a 21

<210> SEQ ID NO 710
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 710 tcaaaataaa aaccaaaatt ctc 23

<210> SEQ ID NO 711
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 711 aggttaagtt ggtagaggta ga 22

<210> SEQ ID NO 712
<211> LENGTH: 25
<212> TYPE: DNA
<213> ORGANISM: Artificial Sequence
<220> FEATURE:
<223> OTHER INFORMATION: Synthetic polynucleotide

<400> SEQUENCE: 712 caaactctaa actcaaaata tattc 25

<210> SEQ ID NO 713
<211> LENGTH: 24
<212> TYPE: DNA
<213> ORGANISM: Artificial Sequence
<220> FEATURE:
<223> OTHER INFORMATION: Synthetic polynucleotide

<400> SEQUENCE: 713 tttttatttt agttttttga gtag 24

<210> SEQ ID NO 714
<211> LENGTH: 20
<212> TYPE: DNA
<213> ORGANISM: Artificial Sequence <220> FEATURE:
<223> OTHER INFORMATION: Synthetic polynucleotide

<400> SEQUENCE: 714 ccctacaaca ctcctatcta 20

<210> SEQ ID NO 715
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 715 tttggagtta ggttgatag 19

<210> SEQ ID NO 716
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 716 caacaatact ctcacttaca c 21

<210> SEQ ID NO 717
<211> LENGTH: 25
<212> TYPE: DNA
<213> ORGANISM: Artificial Sequence
<220> FEATURE:
<223> OTHER INFORMATION: Synthetic polynucleotide

<400> SEQUENCE: 717 agaaagattt ttaaatattt ttaat 25

<210> SEQ ID NO 718
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 718 aaacctctaa tacacaacaa a 21

<210> SEQ ID NO 719
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 719 ttttgagttt ttttttaag tat 23

<210> SEQ ID NO 720
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 720 caaacaaaac aacacttaat ac 22

<210> SEQ ID NO 721
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 721 ggttgaggtg ggtggatta 19

<210> SEQ ID NO 722
<211> LENGTH: 30
<212> TYPE: DNA
<213> ORGANISM: Artificial Sequence
<220> FEATURE:
<223> OTHER INFORMATION: Synthetic polynucleotide

<400> SEQUENCE: 722 tttttttttt ttttttttaa aataaaatct 30

<210> SEQ ID NO 723
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 723 gggtgtttgt aattttagtt 20

<210> SEQ ID NO 724
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 724 acctttaaca acctaacaat ata 23

<210> SEQ ID NO 725
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 725 gggtagatga tatggtagtg a 21

<210> SEQ ID NO 726
<211> LENGTH: 28
<212> TYPE: DNA
<213> ORGANISM: Artificial Sequence
<220> FEATURE:
<223> OTHER INFORMATION: Synthetic polynucleotide

<400> SEQUENCE: 726 aaaaaataaa aaataactaa aacaatat 28

<210> SEQ ID NO 727
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 727 aggaagtgtt taagaagtag aa 22

<210> SEQ ID NO 728
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 728 cctaaaactc taaatacaat ctc 23

<210> SEQ ID NO 729
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 729 tttttaattt ttgtttgtat t 21

<210> SEQ ID NO 730
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 730 aaaccacaat ctatttctaa 20

<210> SEQ ID NO 731
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 731 ttagaaaaga ataattatag ttg 23

<210> SEQ ID NO 732
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 732 accctaaaaa aataaaatc 19

<210> SEQ ID NO 733
<211> LENGTH: 26
<212> TYPE: DNA
<213> ORGANISM: Artificial Sequence
<220> FEATURE:
<223> OTHER INFORMATION: Synthetic polynucleotide

<400> SEQUENCE: 733 ttgtattagt aaataaagtg tatttt 26

<210> SEQ ID NO 734

<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 734 aaccctttct acaaatctac 20

<210> SEQ ID NO 735
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 735 aggggtgggt ggaagaat 18

<210> SEQ ID NO 736
<211> LENGTH: 31
<212> TYPE: DNA
<213> ORGANISM: Artificial Sequence
<220> FEATURE:
<223> OTHER INFORMATION: Synthetic polynucleotide

<400> SEQUENCE: 736 ctcctcaata aaataaaaat cctaaaaaat a 31

<210> SEQ ID NO 737
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 737 gggttaatta gttgttttat 20

<210> SEQ ID NO 738
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 738 cctacaaata tatcacacac t 21

<210> SEQ ID NO 739
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 739 tttgttaaat aggtggttag a 21

<210> SEQ ID NO 740
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 740 acctcaacct cctaaataac 20

<210> SEQ ID NO 741
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 741 tagggtttag agtaggaggt ag 22

<210> SEQ ID NO 742
<211> LENGTH: 24
<212> TYPE: DNA
<213> ORGANISM: Artificial Sequence
<220> FEATURE:
<223> OTHER INFORMATION: Synthetic polynucleotide

<400> SEQUENCE: 742 caaaaaatat aaatcaaaaa catc 24

<210> SEQ ID NO 743
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 743 gggattatag gtatttatta t 21

<210> SEQ ID NO 744
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 744 taaaaattaa aaatcatact ta 22

<210> SEQ ID NO 745
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 745 aagtgatttt tagggagtgt 20

<210> SEQ ID NO 746
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 746 tccataataa cctcatttta ata 23

<210> SEQ ID NO 747
<211> LENGTH: 19
<212> TYPE: DNA

<213> ORGANISM: Artificial Sequence
<220> FEATURE:
<223> OTHER INFORMATION: Synthetic polynucleotide

<400> SEQUENCE: 747 tttttggttg aggtttagt 19

<210> SEQ ID NO 748
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 748 aaacaacaca actcttatca c 21

<210> SEQ ID NO 749
<211> LENGTH: 24
<212> TYPE: DNA
<213> ORGANISM: Artificial Sequence
<220> FEATURE:
<223> OTHER INFORMATION: Synthetic polynucleotide

<400> SEQUENCE: 749 tatggtgatt aaagtataat agtt 24

<210> SEQ ID NO 750
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 750 tcctaaataa aaaacaacat a 21

<210> SEQ ID NO 751
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 751 tgaaaatgtt tttagttttt att 23

<210> SEQ ID NO 752
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 752 aaatacccta cctcttatct aa 22

<210> SEQ ID NO 753
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 753 gatggttaat ttttttattt 20

<210> SEQ ID NO 754
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 754 actccttcaa caaactaac 19

<210> SEQ ID NO 755
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 755 aggggatatt tttaggtt 18

<210> SEQ ID NO 756
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 756 ccaatctatt cctatataat taa 23

<210> SEQ ID NO 757
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 757 aggagagttt ggaaatatag 20

<210> SEQ ID NO 758
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 758 caattctaaa ttaaacctta tt 22

<210> SEQ ID NO 759
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 759 aataatggta gtagttttat tag 23

<210> SEQ ID NO 760
<211> LENGTH: 21
<212> TYPE: DNA
<213> ORGANISM: Artificial Sequence
<220> FEATURE:

<223> OTHER INFORMATION: Synthetic polynucleotide

<400> SEQUENCE: 760 ttcctatatt aacaacttac a 21

<210> SEQ ID NO 761
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 761 ttttttggta gatttttat 19

<210> SEQ ID NO 762
<211> LENGTH: 25
<212> TYPE: DNA
<213> ORGANISM: Artificial Sequence
<220> FEATURE:
<223> OTHER INFORMATION: Synthetic polynucleotide

<400> SEQUENCE: 762 aaattaattt ctattattta tatta 25

<210> SEQ ID NO 763
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 763 aggtggttgg ggagagtg 18

<210> SEQ ID NO 764
<211> LENGTH: 28
<212> TYPE: DNA
<213> ORGANISM: Artificial Sequence
<220> FEATURE:
<223> OTHER INFORMATION: Synthetic polynucleotide

<400> SEQUENCE: 764 ccctaaaata aatcaaaaaa aaccttaa 28

<210> SEQ ID NO 765
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 765 aggtttaggt ggggtgaat 19

<210> SEQ ID NO 766
<211> LENGTH: 24
<212> TYPE: DNA
<213> ORGANISM: Artificial Sequence
<220> FEATURE:
<223> OTHER INFORMATION: Synthetic polynucleotide

<400> SEQUENCE: 766 taaaatcatc aaaatccctt aaaa 24

<210> SEQ ID NO 767
<211> LENGTH: 25
<212> TYPE: DNA
<213> ORGANISM: Artificial Sequence
<220> FEATURE:
<223> OTHER INFORMATION: Synthetic polynucleotide

<400> SEQUENCE: 767 tttttttta ggttatagga gtatt 25

<210> SEQ ID NO 768
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 768 atccccacaa aacacata 18

<210> SEQ ID NO 769
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 769 tagggtaaat attgggatta tt 22

<210> SEQ ID NO 770
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 770 tttccacctc aaaacttaac 20

<210> SEQ ID NO 771
<211> LENGTH: 21
<212> TYPE: DNA
<213> ORGANISM: Artificial Sequence
<220> FEATURE:
<223> OTHER INFORMATION: Synthetic polynucleotide

<400> SEQUENCE: 771 gggtgtttgt atttttatat t 21

<210> SEQ ID NO 772
<211> LENGTH: 18
<212> TYPE: DNA
<213> ORGANISM: Artificial Sequence
<220> FEATURE:
<223> OTHER INFORMATION: Synthetic polynucleotide

<400> SEQUENCE: 772 acctcccaaa accataac 18

<210> SEQ ID NO 773
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 773 gatgtgagtg gtgaggtggt 20

<210> SEQ ID NO 774
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 774 caaacccttc caaaacataa ac 22

<210> SEQ ID NO 775
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 775 tgggattata ggtatgtatt 20

<210> SEQ ID NO 776
<211> LENGTH: 25
<212> TYPE: DNA
<213> ORGANISM: Artificial Sequence
<220> FEATURE:
<223> OTHER INFORMATION: Synthetic polynucleotide

<400> SEQUENCE: 776 caatttcatt tataaatata aatat 25

<210> SEQ ID NO 777
<211> LENGTH: 22
<212> TYPE: DNA
<213> ORGANISM: Artificial Sequence
<220> FEATURE:
<223> OTHER INFORMATION: Synthetic polynucleotide

<400> SEQUENCE: 777 aggggttggt tatttttatt tt 22

<210> SEQ ID NO 778
<211> LENGTH: 29
<212> TYPE: DNA
<213> ORGANISM: Artificial Sequence
<220> FEATURE:
<223> OTHER INFORMATION: Synthetic polynucleotide

<400> SEQUENCE: 778 tttttaatat ttaattttta ccttcaact 29

<210> SEQ ID NO 779
<211> LENGTH: 20
<212> TYPE: DNA
<213> ORGANISM: Artificial Sequence
<220> FEATURE:
<223> OTHER INFORMATION: Synthetic polynucleotide

<400> SEQUENCE: 779 ggtaagttgt ggatgtgagt 20

<210> SEQ ID NO 780
<211> LENGTH: 22

-continued

```
<212> TYPE: DNA
<213> ORGANISM: Artificial Sequence
<220> FEATURE:
<223> OTHER INFORMATION: Synthetic polynucleotide

<400> SEQUENCE: 780

aaaaaaaacc aaaccttatc ta                                    22


<210> SEQ ID NO 781
<211> LENGTH: 19
<212> TYPE: DNA
<213> ORGANISM: Artificial Sequence
<220> FEATURE:
<223> OTHER INFORMATION: Synthetic polynucleotide

<400> SEQUENCE: 781

tttttaggat ttgggttag                                        19


<210> SEQ ID NO 782
<211> LENGTH: 23
<212> TYPE: DNA
<213> ORGANISM: Artificial Sequence
<220> FEATURE:
<223> OTHER INFORMATION: Synthetic polynucleotide

<400> SEQUENCE: 782

aaccttataa ataacaacaa aac                                   23
```

What is claimed is:

1. A method of measuring methylation levels of DNA molecules of a human subject, the method comprising:

(i) isolating DNA molecules from a thyroid nodule of said subject thereby forming isolated thyroid nodule DNA molecules, (ii) contacting said isolated thyroid nodule DNA molecules with a bisulfite salt thereby forming reacted thyroid nodule DNA molecules, and (iii) measuring methylation levels by detecting the presence of cytosine or uracil in said reacted thyroid nodule DNA molecules at the following chromosomal positions:

chr2 position 42329494, chr17 position 48596391, chr20 position 62588571, chr15 position 77989064, chr16 position 23135833, chr20 position 31126189, chr22 position 38307317, chr19 position 3434939, chr16 position 3023231, chr17 position 1509945, and chr16 position 1458639 with respect to human genome assembly hg19 using a detection assay, wherein the detection assay comprises amplifying thyroid nodule DNA molecules by contacting the DNA with a primer complementary to a sequence at or within 1000 nucleotides of the chromosomal positions to produce amplicons thereof to be detected.

2. The method of claim 1, further comprising detecting the presence of cytosine or uracil at one or more additional chromosomal positions with respect to HG19 reference genome selected from Table 1.

3. The method of claim 1, wherein said thyroid nodule is a specimen obtained by biopsy or by surgical resection of said subject.

4. A method of treating a human subject, said method comprising:

(a) measuring methylation levels of thyroid nodule DNA molecules of said subject, wherein the measuring comprises:

(i) isolating DNA molecules from a thyroid nodule of said subject thereby forming isolated thyroid nodule DNA molecules, ii contacting said isolated thyroid nodule DNA molecules with a bisulfite salt thereby forming reacted thyroid nodule DNA molecules;

(iii) contacting said reacted thyroid nodule DNA molecules with a probe or primer complementary to a sequence at or within 1000 nucleotides of a plurality of methylation sites, wherein the plurality of methylation sites comprise chr2 position 42329494, chr17 position 48596391, chr20 position 62588571, chr15 position 77989064, chr16 position 23135833, chr20 position 31126189, chr22 position 38307317, chr19 position 3434939, chr16 position 3023231, chr17 position 1509945, and chr16 position 1458639 with respect to human genome assembly hg19; and (iv) measuring methylation levels by detecting the presence of cytosine or uracil in said reacted thyroid nodule DNA molecules at the plurality of methylation sites;

(b) diagnosing said subject as having an increased probability of having or developing thyroid cancer; and (c) treating said subject, wherein treating comprises (i) thyroid surgery, radiation therapy, radioactive iodine therapy, chemotherapy, thyroid hormone therapy, or (ii) administering Cabozantinib-S-Malate, Vandetanib, Doxorubicin Hydrochloride, Lenvatinib Mesylate, or Sorafenib Tosylate.

5. The method of claim 4, wherein said subject (a) is a woman; (b) is about 20 to about 55 years old; (c) has a mutated Ret Proto-Oncogene; (d) has a grandparent, parent, or sibling who has been diagnosed with thyroid cancer; (e) self-identifies as being Caucasian or Asian; or (f) has or has had breast cancer.

6. The method of claim 4, wherein said subject has undergone thyroid surgery, radiation therapy, radioactive iodine therapy, chemotherapy, thyroid hormone therapy, and administration of an active agent, before said measuring.

7. The method of claim 6, wherein said treating comprises administering Cabozantinib-S-Malate, Vandetanib, Doxorubicin Hydrochloride, Lenvatinib A esylate, or Sorafenib Tosylate.

8. The method of claim 1, wherein said bisulfite salt is sodium bisulfite.

* * * * *